US007235142B2

(12) United States Patent
Sturgill et al.

(10) Patent No.: US 7,235,142 B2
(45) **Date of Patent: *Jun. 26, 2007**

(54) NON-TOXIC CORROSION-PROTECTION RINSES AND SEALS BASED ON COBALT

(75) Inventors: Jeffrey Allen Sturgill, Fairborn, OH (US); Andrew Wells Phelps, Kettering, OH (US); Joseph Thomas Swartzbaugh, Phillipsburg, OH (US)

(73) Assignee: University of Dayton, Dayton, OH (US)

( * ) Notice: Subject to any disclaimer, the term of this patent is extended or adjusted under 35 U.S.C. 154(b) by 452 days.

This patent is subject to a terminal disclaimer.

(21) Appl. No.: 10/038,150

(22) Filed: Jan. 4, 2002

(65) Prior Publication Data

US 2003/0230363 A1 Dec. 18, 2003

(51) Int. Cl.
*C23C 22/48* (2006.01)

(52) U.S. Cl. ..... 148/273; 148/253

(58) Field of Classification Search ..... 148/253, 148/241, 273; 252/387; 106/14.05
See application file for complete search history.

(56) References Cited

U.S. PATENT DOCUMENTS

| | | | | |
|---|---|---|---|---|
| 1,078,788 | A | 11/1913 | Kaplan | |
| 1,216,451 | A | 2/1917 | Holmes | |
| 3,055,833 | A | 9/1962 | Baltzer | |
| 3,615,810 | A | 10/1971 | Holznagel et al. | |
| 3,879,523 | A | 4/1975 | Miyata et al. | |
| 4,012,195 | A | 3/1977 | Noack | |
| 4,024,036 | A | 5/1977 | Nakamura et al. | |
| 4,096,090 | A | 6/1978 | Noack | |
| 4,109,176 | A | 8/1978 | Ernstausen et al. | |
| 4,145,234 | A | 3/1979 | Meissner | |
| 4,469,521 | A | 9/1984 | Salensky | |
| 4,479,917 | A | 10/1984 | Rothgery et al. | |
| 4,673,445 | A | 6/1987 | Tuttle, Jr. et al. | |
| 5,298,092 | A | 3/1994 | Schriever | |
| 5,322,560 | A | 6/1994 | DePue et al. | |
| 5,330,588 | A | 7/1994 | Gulley | |
| 5,378,293 | A | 1/1995 | Schriever | |
| 5,411,606 | A | 5/1995 | Schriever | |
| 5,415,687 | A | 5/1995 | Schriever | |
| 5,468,307 | A | 11/1995 | Schriever | |
| 5,472,524 | A | 12/1995 | Schriever | |
| 5,487,949 | A | 1/1996 | Schriever | |
| 5,505,792 | A * | 4/1996 | Ouyang et al. | 148/241 |
| 5,551,994 | A | 9/1996 | Schriever | |
| 5,587,059 | A | 12/1996 | Yamoto et al. | |
| 5,672,329 | A | 9/1997 | Okada et al. | |
| 5,756,218 | A | 5/1998 | Buchheit et al. | |
| 5,873,953 | A | 2/1999 | Schriever | |
| 6,068,709 | A * | 5/2000 | Schapira et al. | 148/253 |
| 6,074,464 | A | 6/2000 | Eddinger et al. | |
| 6,193,815 | B1 | 2/2001 | Wada et al. | |
| 6,200,672 | B1 | 3/2001 | Tadokoro et al. | |
| 6,291,018 | B1 | 9/2001 | Dattilo | |
| 6,432,225 | B1 | 8/2002 | Schriever | |
| 6,472,079 | B2 | 10/2002 | Hayashi et al. | |
| 6,500,276 | B1 | 12/2002 | Minevski et al. | |
| 2003/0221590 | A1 | 12/2003 | Sturgill et al. | |
| 2003/0234063 | A1 * | 12/2003 | Sturgill et al. | 148/273 |

FOREIGN PATENT DOCUMENTS

| | | | |
|---|---|---|---|
| DE | 33 09 194 | A1 | 10/1983 |
| EP | 0 368 470 | A1 | 5/1990 |
| EP | 0 458 020 | A1 | 11/1991 |
| EP | 0 486 778 | A1 | 5/1992 |
| EP | 0 488 430 | A2 | 6/1992 |
| EP | 0523288 | | 1/1993 |
| EP | 0 634 460 | A2 | 1/1995 |
| EP | 0 675 173 | A2 | 10/1995 |
| GB | 894261 | | 4/1962 |
| GB | 965837 | | 8/1964 |
| GB | 2 138 796 | A | 10/1984 |
| GB | 2 139 206 | A | 11/1984 |
| JP | 74 34929 | | 3/1974 |
| JP | 74 14621 | | 4/1974 |
| JP | 76 42057 | | 11/1976 |
| JP | 77 06258 | | 2/1977 |
| JP | 52034434 | | 3/1977 |
| WO | WO 92/18661 | | 10/1992 |
| WO | WO 93/05198 | | 3/1993 |
| WO | WO 94/00619 | | 1/1994 |
| WO | WO 95/31093 | | 11/1995 |
| WO | WO 96/05335 | | 2/1996 |
| WO | WO 96/21753 | | 7/1996 |
| WO | WO 96/29448 | | 9/1996 |
| WO | WO98/48075 | | 10/1998 |
| WO | WO 98/51841 | | 11/1998 |
| WO | WO 98/56963 | | 12/1998 |
| WO | WO 99/10567 | | 3/1999 |

* cited by examiner

*Primary Examiner*—Scott Kastler
(74) *Attorney, Agent, or Firm*—Dinsmore & Shohl LLP

(57) ABSTRACT

Rinsing or sealing solutions based on cobalt are described for barrier films such as anodic coatings, phosphate coatings, or "black oxide" coatings. The treated films contain a trivalent or tetravalent cobalt/valence stabilizer complex. The rinsing or sealing bath may also contain an optional preparative agent or an optional solubility control agent. The oxidized cobalt is present in the coating in a "sparingly soluble" form. The valence stabilizers can be either inorganic or organic in nature. Cobalt/valence stabilizer combinations are chosen based on the well-founded principles of cobalt coordination chemistry. A number of cobalt/valence stabilizer combinations that match the performance of conventional hexavalent chromium systems are presented.

56 Claims, No Drawings

NON-TOXIC CORROSION-PROTECTION RINSES AND SEALS BASED ON COBALT

CROSS-REFERENCE TO RELATED APPLICATIONS

This application is related to commonly assigned U.S. patent application Ser. No. 10/037,576, NON-TOXIC CORROSION-PROTECTION PIGMENTS BASED ON COBALT, filed Jan. 4, 2002, by Sturgill, et al. and Ser. No. 10/038,274, NON-TOXIC CORROSION-PROTECTION CONVERSION COATS BASED ON COBALT, filed Jan. 4, 2002, by Sturgill et al., the disclosures of which are incorporated herein by reference.

BACKGROUND OF THE INVENTION

This invention relates generally to compositions and methods for the formation of protective, corrosion-inhibiting rinses and seals for use to impart additional corrosion resistance to structural materials without the use of chromium in the hexavalent oxidation state. More particularly, this invention relates to non-toxic, corrosion-protective rinses and seals for metal phosphating, anodizing, and "black oxiding" processes based on trivalent (or tetravalent) cobalt and methods of making and using the same.

Metals like aluminum, zinc, titanium, iron, cadmium, tin, indium, manganese, beryllium, magnesium, niobium, tantalum, zirconium, lead, cobalt, copper, and silver, their alloys, or items plated with these metals, require protection from corrosion due to their low oxidation-reduction (redox) potentials or ease of oxide formation. These metal alloys have many uses that range from architectural adornments to protective coatings themselves to automotive, structural aerospace, and electronic components, to name a few. The unalloyed metals typically form an outer layer of natural oxide: a "passive film" that serves to protect them and reduce their overall rate of corrosion. However, the corrosion protection offered by the naturally formed oxide layer on certain alloys of these metals is not complete and corrosion will eventually occur unless some form of additional corrosion protection is used. Thus, for example, steels are typically "phosphated" to provide an impermeable coating that not only resists corrosive attack, but also provides a paint base. Additionally, architectural and structural aluminum are frequently "anodized" to form an impermeable oxide film for the same reasons.

Inhibiting the initiation, growth, and extent of corrosion is a significant part of component and systems design for the successful long-term use of metal objects. Uniform physical performance and safety margins of a part, a component, or an entire system can be compromised by corrosion.

One method to enhance the corrosion resistance of these alloys is through the use of a chemically- or electrolytically-generated coating such as an anodized coating (typically on aluminum), a phosphate coating (typically on electrogalvanized or bare steel), or a black oxide coating (for high strength bearing and tool steels). The metal is exposed to a compound that chemically alters the surface (in phosphating and black oxiding) or an electric current (in anodizing) and forms a coating that provides some corrosion resistance by forming a barrier film. The morphology and possibly the chemistry of the anodic coating or phosphate coating can allow for the formation of a strong bond with subsequently-applied paint systems. An anodic coating is usually applied via immersion in an electrolytic cell. A phosphating or black oxide solution may be applied by immersion, by spray, or by manual means.

These coatings frequently exhibit "flaws" such as pores, pinholes, or thin portions in the coating after formation and do not contain any inherent means to "repair" these coating breaches. The application of a second solution is necessary to fill the pores in the coating and deposit compounds that will act as long-term corrosion protective species. These "second solutions" are termed "rinses" or "seals" in the corrosion literature. The term "rinse" is typically used for the second solution applied to phosphating and black oxide coatings, whereas the term "seal" usually refers to the second solution applied to anodic coatings. These rinses and seals are typically applied via spray techniques, but immersion, fogging, and wiping are also accepted practices.

Hexavalent chromium has traditionally been the active corrosion-inhibiting agent used in rinses and seals for the formation of protective coatings for iron, electrogalvanized iron, aluminum, zinc, magnesium, titanium, cadmium, tin, indium, manganese, and their alloys. Niobium, tantalum, zirconium, beryllium, lead, cobalt, copper, and silver may also be treated with hexavalent chromium rinses and seals for special applications. The three main coating processes that use these rinses and seals are 1) the phosphating process for steel and galvanized steel products, 2) the anodization process for a host of structural metals, and 3) the black oxide process for high-strength steel and iron used for bearing materials. Table 1 illustrates the processes that typically utilize a final chrome "rinse" or "seal" to impart additional corrosion protection to a given substrate material.

TABLE 1

Current Rinse and Seal Processes Using Hexavalent Chromium

| Process | Comments/ Examples | Substrate Metals | Government/ ASTM/Mil Specs |
|---|---|---|---|
| Rinses for zinc phosphating on steel, steel products, and nonferrous alloys | Used as a paint base on all automotive bodies, also for some coil and sheet stock. Used as a lubricating layer on tooling dies. | Zinc-coated steel, zinc, or bare steel are usual substrates. Also for aluminum, magnesium, copper, titanium, cadmium, and silver in less common applications. | MIL-P-50002<br>DoD-P-16232<br>MIL-HDBK-205<br>SAE-AMS2481<br>QQ-P-416 |
| Seals for anodized aluminum including sulfuric, chromic, | Used extensively for architectural and decorative | Aluminum and aluminum alloys | MIL-A-8625<br>SAE-AMS2470<br>ASTM B580 |

TABLE 1-continued

Current Rinse and Seal Processes Using Hexavalent Chromium

| Process | Comments/ Examples | Substrate Metals | Government/ ASTM/Mil Specs |
|---|---|---|---|
| oxalic, boric, sulfonated organic acids, citric, and phosphoric acid anodizing | applications, adhesive bonding, siding, etc. Also used as a paint base. | | ASTM D1730 AA46-78 |
| Rinses for iron phosphating on bare steels | Used as a paint base on coil coatings for general appliance and siding applications. Different from Zn and Mn phosphating. | Steel and iron alloys | TT-C-490 MIL-HDBK-205 SAE-AMS2481 QQ-P-416 |
| Rinses for manganese phosphating on steel and steel alloys, also on nonferrous alloys | Used solely as a solid lubricant, not as a paint base. Used extensively on bearing materials. | Mostly bare steel. Can also be used on high-strength copper alloys. | MIL-P-50002 DoD-P-16232 MIL-HDBK-205 SAE-AMS2481 |
| Rinses for "black oxide" and other oxide lubricating layers | Used solely as a solid lubricant, not as a paint base. Used extensively on bearing materials. | Mostly bare steel. Can also be used on high-Strength copper alloys. | MIL-C-13924 MIL-C-46110 SAE-AMS2485 |
| Seals for anodized magnesium including sulfuric, chromic, oxalic, boric, sulfonated organic acids, citric, and phosphoric acid anodizing | Used as a paint and adhesive base. | Magnesium and magnesium alloys | MIL-M-45202 ASTM D1732 SAE-AMS2475 MIL-C-13335 |
| Seals for anodized titanium including sulfuric, chromic, oxalic, boric, citric, hydrofluoric, and phosphoric acid anodizing | Used as a paint and adhesive base. | Titanium and titanium alloys | SAE-AS4194 SAE AMS-2488 |
| Seals for anodized zinc including sulfuric, chromic, oxalic, boric, sulfonated organic acids, citric, and phosphoric acid anodizing | Used as a paint and adhesive base. | Zinc and zinc alloys | MIL-A-81801 |
| Seals for anodized steel including sulfuric, chromic, oxalic, boric, and phosphoric acid anodizing | Used as a paint and adhesive base. | Iron, steel, and steel alloys | QQ-P-35 |
| Seals for anodized copper, cadmium, silver, tantalum, lead, cobalt, niobium, zirconium, tin, indium, and manganese including sulfuric, chromic, oxalic, boric, sulfonated organic acids, citric, and phosphoric acid anodizing | Used for a number of applications, principally as a paint and adhesive base. For example, niobium and tantalum capacitors, cadmium plate, silver solder, and zirconium for nuclear applications. | Copper, cadmium, silver, tantalum, niobium, zirconium, tin, indium, manganese and their alloys | QQ-P-416 |

As shown in Table 1 above, there are three "generic" phosphating processes for steel and steel alloys—zinc, manganese, and iron phosphating. Differences in the coating solutions result in different chemistries and physical attributes in the formed coatings. For example, zinc phosphating is used primarily on galvanized steel sheet, and results in an ideal surface morphology for paint adhesion if the crystals are small in size, and as a solid lubricant for larger size crystals. Manganese phosphating, however, results in a hard, lubricious coating that has no use as a paint base, but exhibits excellent characteristics as a solid lubricant. Manganese phosphating coatings are rarely subjected to a post-chrome rinse, because the corrosion resistance of these coatings is of lesser concern. Iron phosphating is also used as a paint and adhesive base, and always receives post-treatments for corrosion protection.

Similar differences are also noted in anodizing processes. Anodizing processes involve the application of an electric potential under a variety of acidic conditions to the substrate to be coated. Sulfuric acid is the conventional anodizing acid used to form hard oxide films on aluminum, although other anodization solutions have specialized applications. For example, phosphoric acid may be used for adhesive bonding applications on aluminum. Oxalic acid anodization results in a harder, denser coating with higher corrosion resistance than sulfuric acid anodization and is used more often in Europe. Boric acid anodization is used frequently for electronic capacitors although citric and tartaric acid anodization can be used for the same application. Anodization with sulfonated organic acids (such as sulfosalicylic or sulfophthalic acids) is used to impart color during the anodization process. Chromic acid anodization is used on parts with complex shapes where final sealing or rinsing is not possible. Other acids, including hydrofluoric acid, have been used for special applications or in proprietary formulations. Those skilled in the anodization art know that there exist a wide variety of anodizing processes due to the multitude of substrate metals, anodizing acids, applied voltages, and final applications.

Finally, "black oxide" coatings are applied to high strength steels and copper-containing alloys to impart a lubricious coating. The difference between "black oxide" coatings and other lubricious coating processes (such as manganese phosphating) is that "black oxide" coatings are applied under caustic, elevated temperature conditions. For example, a concentrated sodium hydroxide solution is raised to its boiling point and the substrate metal is then immersed in this solution. This results in the formation of a lubricious coating of magnetite/ferrite on the surface of steel alloys.

Other coating processes that result in coatings with no inherent self-healing characteristics have also been enhanced through the use of hexavalent chromium rinses and seals. Carbonate coatings on metals such as zinc, iron, magnesium, and especially copper have been described in the early literature as providing some degree of corrosion protection. These coatings can be further enhanced through the use of hexavalent chromium rinses to deposit inhibiting compounds to self-heal coating breaches. Other oxide, phosphate, oxalate, silicate, aluminate, borate or polymeric coatings, or combinations thereof, can also be enhanced via hexavalent chromium rinses and seals.

For each of these three generic coating processes (phosphating, anodizing, and black oxiding), a second, subsequent chemical treatment is often applied. The nature of this second treatment is dependent upon the desired final characteristics of the metal piece. For phosphating and black oxiding processes, this second treatment is usually a rinse of hexavalent chromium, to impart additional corrosion protection to the coating. For anodizing processes, the second treatment can impart a number of useful attributes to the work piece. This second "sealing" process for anodized coatings can include: 1) pure boiling water (to plug the pores with a hydrated alumina composition); 2) silicates (to plug the pores with a silicate composition); 3) dyes or metal-dye complexes (to impart color to the anodic coating); 4) metal salts followed by cathodic reduction (to color the coating via the formation of metals or metal sulfides in the pores); 5) lubricating additives such as molybdenum disulfide or dispersions of polytetrafluoroethylene (to fill the pores with a lubricious additive); and 6) hexavalent chromium seals to fill the pores with chromate species. It is noteworthy that the only one of these six generic sealing processes that results in a coating with self-healing characteristics is the hexavalent chromium seals. The other sealing processes for anodic coatings may temporarily increase the corrosion resistance of the coating by plugging the pores in the oxide coating (e.g., with hydrated alumina or silicate), but the coating does not retain any corrosion-inhibitive species.

The various coating processes to which the art described in this invention is applicable are shown in Table 1 above. The frequent use of hexavalent chrome to "rinse" or "seal" the coating (phosphate, anodic, or black oxide) formed in the first unit operation of the process, to impart additional corrosion resistance, connects them. These solutions are usually simple formulations consisting of nothing more than dissolved chromium trioxide, chromate, or dichromate. These formulations are usually applied by spraying, although immersion, fogging, or even wiping may also be used.

Sometimes these hexavalent chromium rinse or sealing formulations will contain other constituents. Some formulations include minor concentrations of fluorides. These fluorides act to "etch back" the coating formed in the first unit operation (e.g., phosphate, anodic, or black oxide), thus further facilitating the deposition of corrosion-inhibiting species. Rinsing solutions for phosphate solutions are frequently observed to include phosphoric acid in addition to hexavalent chromium in order to reduce staining of the phosphate coating by the hexavalent chromium. These hexavalent chromium rinse or sealing solutions can also contain other constituents, such as ferricyanides or molybdates. The presence of these other constituents is significant in light of the chemistry developed and presented in this invention.

Significant efforts have been made to replace chromium with other metals for corrosion-inhibiting applications due to toxicity, environmental, and regulatory concerns. Cobalt is one non-toxic, non-regulated metal that has been considered as a chromium replacement. Cobalt (like chromium) exhibits more than one oxidation state ($Co^{+2}$ and $Co^{+3}$). In addition, the oxidation-reduction potential of the $Co^{+3}$-$Co^{+2}$ couple is comparable to the $Cr^{+6}$-$Cr^{+3}$ couple. For example, in acid solution:

$$Co^{+3}+e \Rightarrow Co^{+2}+1.92\ V$$

$$Cr^{+6}+3e \Rightarrow Cr^{+3}+1.36\ V$$

Accordingly, a number of processes have been reported in the literature, which make use of cobalt in rinsing or sealing bath solutions, generally to provide coloring of the coated alloys. However, the coatings formed by these processes provide only limited corrosion protection and do not approach the benefit derived from the use of hexavalent chromium. None of the prior art recognizes the importance of trivalent (or tetravalent) cobalt for corrosion protection, nor the need to "valence stabilize" trivalent cobalt to ensure its long-term stability. The use of cobalt in the prior art is primarily as a coloring agent for anodic coatings, although there is some reference to its use as a rinse for phosphate coatings. The use of cobalt in rinses for black oxide coatings has heretofore been unrecognized.

The use of film-forming substances, such as polymers, silicates, sol-gel, etc., which have no inherent oxidizing character in sealing or rinsing coating solutions, has been described in the literature. The film formers may enhance short-term corrosion resistance by functioning as a barrier layer. Barrier layers lacking an active corrosion inhibitor have been demonstrated to be capable of inhibiting corrosion as long as the barrier is not breached, as by a scratch or other flaw. Film formers can actually enhance corrosion on a surface after failure due to the well known effects of crevice corrosion.

1) Rinses for Phosphate Coatings

U.S. Pat. No. 4,673,445 to Tuttle, Jr., et al. describes the use of a 175° F. post-treatment for phosphate coatings that contains cobalt, a tin (II) compound [stannous], and tartaric acid. Given the proper pH conditions, it may be possible to form a stannate-stabilized cobalt complex from this solution. However, no conditions are described that would result in oxidation of the cobalt to the trivalent or tetravalent oxidation state. Stannous compounds are mild reducing agents so it is extremely unlikely that $Co^{+3}$ or $Co^{+4}$ could be formed from these solutions in the absence of any oxidizing species.

European Patent No. EP 0 486 778 B1 to McMillen, et al. describes the use of rinsing solutions that contain an amino compound (amino acid or amino alcohol) and a transition metal compound. However, the preferred group IIIB and IVB transition metal and rare earth metal compounds described are zirconium, titanium, hafnium, cerium, and mixtures thereof.

2) Seals for Anodic Coatings

Cobalt has primarily been described as a coloring agent for anodized coatings, under a variety of different processing conditions. These include:

a) Electrolysis in the absence of valence stabilizer compounds once an anodic coating is formed. Coloring is frequently accomplished by immersing the work piece into a separate, cobalt-containing solution and then electrolyzing. However, these solutions typically do not contain materials that can function as valence stabilizers, nor are subsequent treatments with compounds that can function as valence stabilizers described. Additionally, electrolysis is performed under conditions that reduce the cobalt-to-cobalt metal, cobalt-containing alloys, or reduced cobalt compounds such as sulfides. This process involves connecting the anodized work piece to the electrolytic cell so that it functions as a cathode to reduce the cobalt. An example of this is described in European Patent No. EP 0 368 470 B1 to Fern, et al. A "pore-filling" metal (cobalt is a described example) is deposited into the pores using an a.c. or modified a.c. deposition. Long-term corrosion resistance will be decreased due to the formation of galvanic couples between the anodized substrate metal and the pore-filling metal, while a temporary increase in corrosion resistance may be expected due to the filling of the pores. The use of trivalent or tetravalent cobalt to provide long-term corrosion protection is not described in these patents.

b) Use of cobalt-dye complexes to color anodic coatings has been used since the 1950s with metal complexes of azo dyes, sulfonic acids, amino acids, aromatic carboxylic acids, and other organic compounds. Many of these compounds can be used as "valence stabilizers" for trivalent cobalt. The oxidation state of the cobalt in the described coloring materials is always divalent. Divalent cobalt provides no redox-based corrosion-inhibiting protection. The use of cobalt in corrosion-inhibiting seals for anodic coatings has been described less often than for coloring. None of these compositions describe the use of trivalent (or tetravalent) cobalt as the inhibitor species, nor the use of "valence stabilizers" to provide long-term corrosion-resistance.

Accordingly, the need remains for improved rinses and seals which have an effectiveness, ease of application, and performance comparable to coatings formed with hexavalent chromium and which do so without the use of toxic or currently regulated materials.

SUMMARY OF THE INVENTION

That need is met by the present invention which represents a significant improvement in the formulation of non-toxic rinses and seals through the use of trivalent cobalt. The rinses and seals of the present invention inhibit corrosion to a higher degree than any other known cobalt-based coating. Moreover, the rinses and seals of the present invention inhibit corrosion to a degree comparable to commercial formulations based on hexavalent chromium. As used herein, the term "sealing bath" includes both sealing baths and rinsing baths and the term "seal" includes both seals and rinses.

The present invention utilizes "valency stabilization" of the trivalent (or tetravalent) cobalt ion in the as-formed coating to achieve corrosion resistance that is comparable to hexavalent chromium. More specifically, in order to achieve a high degree of corrosion resistance, a rinse or seal can result in a coating that exhibits the following characteristics:

1) The coating can contain an oxidizing species. The coatings that are subjected to rinsing and sealing (e.g., phosphate, anodic, or black oxide) do not contain oxidizing species. Therefore, the sealing or rinsing solution must supply these oxidizing species. Oxidizing species serve two important functions within the coating: a) they act to impede the flow of charged species through the coating, therefore helping reduce the transport of corrosion reactants, and b) if a scratch is formed in the coating, these oxidizing species act to "repair" the breach by oxidizing the underlying metal and quickly reforming an oxide barrier. The effectiveness of the oxidizing species is a function of its individual oxidation-reduction potential and the more highly oxidized species exhibit greater corrosion protection. An oxidation-reduction potential of approximately +0.80 V (at a pH of 0) appears to be the dividing line between inhibitors that offer some corrosion protection and those that do not. The trivalent cobalt ion, with an oxidation-reduction potential of +1.92 V (at a pH of 0), is an exceptionally good oxidizing species. The hydroxyl and oxygen liberated from water when trivalent cobalt is reduced will oxidize ("passivate") nearby bare metal.

2) A "valence stabilizer" for the trivalent cobalt can be employed to ensure that the ion will not be reduced quickly to the divalent state in solution or in the coating. The importance of stabilizing the cobalt ion in its trivalent (or tetravalent) state in a solid precipitate is important to the composition of rinsing and sealing formulations.

3) The trivalent cobalt species formed in the coating (e.g., in the pores) can be present as a "sparingly soluble" material. If the formed trivalent cobalt species is too soluble, then it will be washed away. If it is too insoluble, then insufficient trivalent cobalt is available to inhibit corrosion. A trivalent cobalt species that exhibits low solubility will not only fail to inhibit corrosion, but can also promote localized crevice corrosion and result in enhanced corrosion rates. In order to form an effective rinse or seal, the trivalent cobalt compounds formed in the coating pores must be in a "sparingly soluble" form. It is difficult to place specific solubility values to these optimum "sparingly soluble" coating materials because there appear to be several variables associated with what makes an optimum coating material. It appears that if the trivalent cobalt is incorporated in the coating in the form of a trivalent cobalt/valence stabilizer complex which exhibits a solubility in water of between about $5\times10^{-5}$ and about $5\times10^{-2}$ moles per liter of trivalent cobalt, then appreciable corrosion inhibition will be observed. Coatings that incorporate stabilized trivalent cobalt compounds that fall outside of this particular solubility range may also exhibit some corrosion inhibition. For example, compositions with solubilities as high as $5\times10^{-1}$ moles per liter or as low as $1\times10^{-5}$ moles per liter of trivalent cobalt exhibit some corrosion resistance, although not as great as those compounds which fall within the optimum solubility range. The degree of effectiveness will depend on the particular compound itself. The solubility characteristics of the trivalent cobalt in the pores of the coating can be controlled through the use of stabilizer materials, which form compounds that fall within a desired solubility range. In this way, a "controlled release" of trivalent cobalt can be achieved, much as a "timed release" of hexavalent chromium is achieved in the "state-of-the-art" systems.

4) The "valence stabilization" helps to establish an electrostatic barrier layer around the cation-stabilizer complex in aqueous solution. The nature and character of the electrostatic double-layer surrounding the cation-stabilizer complex may be controlled and modified by careful selection of stabilizer species. Characteristics such as the electrical dipole moment and the shape/conformation (for steric effects) of the stabilizer will influence the performance of the formed inhibitor species. In general, the electrostatic double layer formed acts to protect the cation from premature reaction with hydronium, hydroxide, and other ions in solution. The formation of electrostatic barrier layers also helps to impede the passage of corrosive ions through the coating to which the rinse or seal composition was applied, to the metallic surface.

This phenomenon is exhibited in some of the hexavalent chromium systems. For example, in rinses for phosphate coatings wherein some ferricyanide is added to the hexavalent chromium, the highly charged hexavalent chromium ion is surrounded by very polar ferricyanide ions in the as-formed complexes within the pores. The orientation of the dipoles of the ferricyanide ions with respect to the highly charged chromate ion serves to attract additional layers of ions in the aqueous solution. These ions form a protective shell around the chromium ion/ferricyanide complex.

5) The as-formed trivalent cobalt/valence stabilizer complex may also exhibit ion exchange behavior towards alkali species. This optional consideration is important because alkali ions (especially sodium) are notoriously corrosive towards alloys which contain metals such as aluminum, zinc, or magnesium. The hexavalent chromium-ferricyanide complex formed in some rinse formulations also exhibits this ion exchange phenomenon. The corrosion resistance of a number of phosphated steel and anodized aluminum alloys as tested using both ASTM B-1 17 and ASTM G-85 has been enhanced through the use of trivalent cobalt species. Their corrosion resistance is comparable to that of hexavalent chromium systems.

The valence stabilizers can be inorganic or organic. A multitude of organic and inorganic stabilizer materials have been used.

In one aspect, the invention comprises a mechanistic and chemical approach to the production of corrosion-resistant rinses and seals using trivalent cobalt. This approach uses stabilizer materials which form compounds with trivalent cobalt within the as-formed coating that are sparingly soluble in aqueous solution, typically around approximately $5\times10^{-2}$ to $5\times10^{-5}$ moles/liter of trivalent cobalt. This solubility range provides a release of trivalent cobalt from the coating at a rate sufficiently slow enough that protection will be provided for an extended period of time and fast enough to inhibit corrosion during conventional accelerated corrosion testing methods such as ASTM B-117 and G-85. Compounds that fall slightly outside of this solubility range (as high as $5\times10^{-1}$ to as low as $1\times10^{-5}$ moles/liter of trivalent cobalt) may also prove to be effective under certain conditions. However, formed compounds that exhibit aqueous solubilities far outside of the target range are unlikely to be effective corrosion inhibitors. The solubility of the formed trivalent cobalt compounds within the pores therefore plays a significant role in the effectiveness of the formed coating. Solubility control may be achieved using organic or inorganic stabilizer materials.

In another aspect, the invention is the achievement of corrosion-resistant coatings derived from rinses and seals using trivalent cobalt. This approach also utilizes stabilizer materials, which form compounds that exhibit dipoles so as to form electrostatic barrier layers composed of ions, such as hydronium ($H_3O^+$) or hydroxide ($OH^-$). The formation of these barrier layers through the use of stabilizer materials can be achieved using organic or inorganic materials.

In an optional aspect, the invention is the achievement of corrosion-resistant coatings derived from rinses and seals based on trivalent cobalt by the use of stabilizer materials which form compounds that exhibit ion exchange behavior towards alkali ions. The formation of this ion exchange behavior can be achieved through the use of inorganic or organic stabilizer materials.

In another aspect, the invention is the achievement of corrosion-resistant coatings based on rinses or seals containing trivalent cobalt that also uses optional preparative agents in conjunction with the cobalt to strip off some of the already-formed barrier film in the vicinity of the pores. The typical preparative agents for use with trivalent cobalt are fluorides and fluorine-containing chemicals. Acidic species or other halides such as chlorides, bromides, and iodides can be used, but are less effective than fluorides as preparative agents.

Accordingly, it is an object of the present invention to provide non-toxic rinses and seals based on trivalent cobalt and methods of making and using the same. These and other objects and advantages of the present invention will become apparent from the following detailed description and claims.

DETAILED DESCRIPTION OF THE INVENTION

A) Starting Materials

Five general starting materials are used for the rinse and sealing baths of the present invention. These include: a cobalt source; a valence stabilizer source; an oxidation source (optional if trivalent cobalt is already present in the rinse or sealing bath); a preparative agent source (optional); and additional solubility control agents (optional). These materials may be included as neat compounds in the rinse and sealing baths, or may be added to the baths as already-prepared solutions. Likewise, all of the described constituents do not necessarily have to be included within one solution, and in some instances (e.g., additional solubility control agents) it is typical that these constituents are used separately. Further enhancements to the formed coating may be imparted through the use of additional starting materials. Foremost among these are agents to improve the lubricity or color-fastness of the coating.

1) Cobalt Source a) Trivalent Cobalt

The cobalt precursor compounds can be almost any cobalt compound in which the cobalt is in either the divalent or trivalent oxidation state. Water-soluble precursors are typically used. Examples of inorganic divalent cobalt precursor compounds include, but are not restricted to: cobalt nitrate, cobalt sulfate, cobalt perchlorate, cobalt chloride, cobalt fluoride, cobalt bromide, cobalt iodide, cobalt bromate, cobalt chlorate, and complex fluorides such as cobalt fluosilicate, cobalt fluotitanate, cobalt fluozirconate, cobalt fluoborate, and cobalt fluoaluminate. Examples of organometallic divalent cobalt precursor compounds include, but are not restricted to: cobalt formate, cobalt acetate, cobalt propionate, cobalt butyrate, cobalt benzoate, cobalt glycolate, cobalt lactate, cobalt tartronate, cobalt malate, cobalt tartrate, cobalt citrate, cobalt benzenesulfonate, cobalt thiocyanate, and cobalt acetylacetonate. Examples of complex divalent cobalt precursor compounds include, but are not limited to ammonium cobalt sulfate, ammonium cobalt nitrate, ammonium cobalt chloride, and ammonium cobalt bromide.

The cobalt precursor may also be a compound wherein the cobalt is already in the trivalent oxidation state. Examples of these compounds include, but are not restricted to: hexaamminecobalt chloride, hexaamminecobalt bromide, hexaamminecobalt nitrate, pentaamminecobalt chloride, pentaamminecobalt bromide, pentaamminecobalt nitrate, lithium cobaltinitrite, sodium cobaltinitrite, tris(ethylenediamine) cobalt chloride, tris(ethylenediamine) cobalt nitrate, bipyridine complexes of trivalent cobalt, phenanthroline complexes of trivalent cobalt, cobalt (III) acetylacetonate, cobalticarbonates, cobalt (III) acetate, cobalt (III) chloride, and cobalt (III) sulfate.

While trivalent cobalt precursor compounds can be used for these rinses and seals, they are not recommended for the following reasons: 1) their cost is several orders of magnitude higher than divalent cobalt precursors; 2) in some instances (e.g., cobaltinitrite or cobalticarbonate compounds) they generate large quantities of gas ($NO_2$ or $CO_2$) when placed into acidic solutions; and 3) they lead to lower corrosion protection in the formed coatings because they are stabilized with additional materials which increase their solubility in water.

It may not be necessary to add a separate cobalt source for these rinse or sealing solutions if a cobalt-containing alloy is to be treated. The first unit operation in the process (phosphating, anodizing, or black oxiding) will dissolve much of the cobalt-containing substrate metal. This will result in divalent cobalt ions being present in the pores of the as-formed coating. A suitable oxidizer can then oxidize the divalent cobalt to the necessary trivalent oxidation state during rinsing or sealing.

b) Tetravalent Cobalt

The tetravalent cobalt ion ($Co^{+4}$) is an even better oxidizing species than $Co^{+3}$. It has a radius of 53 picometers, carries a charge of +4, and has a redox potential of over 2.0 V. However, it has a correspondingly lower stability both in and out of solution. Therefore, valence stabilization of this ion is required in order to use it effectively as an inhibitor species in the pores of a barrier film coating. Its very large redox potential makes it prone to rapid reduction, and few materials will effectively valence stabilize it in a sparingly soluble complex, which makes its routine application problematic. The presence of both trivalent and tetravalent cobalt in the as-formed coatings from the rinses and seals can be determined by their magnetic behavior. A combination of $Co^{+3}$ and $Co^{+4}$ is reportedly paramagnetic. Tetravalent cobalt can be made using chemical or electrolytic oxidation, as can trivalent cobalt. The difficulty of its formation or stabilization should not preclude the use of tetravalent cobalt in some rinses and seals. While it is not a typical species because of these difficulties, tetravalent cobalt can be incorporated either alone or in conjunction with trivalent cobalt by using tailored valence stabilizers.

2) Valence Stabilizers

Corrosion resistance comparable to that of hexavalent chromium can be achieved by the use of valence stabilized trivalent or tetravalent cobalt ions in the rinse or sealing baths. Valence stabilization has not been recognized previously as an important consideration in the development of effective corrosion-inhibiting rinses and seals. A variety of inorganic and organic stabilizers are available that can control such properties as solubility, mobility, ion exchange, and binder compatibility. The stabilizer complex can also act as an ion-exchange host and/or trap for alkali or halide ions in solution.

Cobalt is effective as an oxidative corrosion inhibitor if it can be supplied in sufficient quantities in the trivalent or tetravalent charge state when brought into contact with unprotected bare metal. The characteristics of the $Co^{+3}$ ion which are relevant to its use in rinsing or sealing applications include: 1) its valence is fairly stable in solution but is less stable on drying, 2) its compounds typically have large aqueous solubilities, 3) it is more stable in acidic or neutral pH aqueous solutions than in basic solutions, and 4) its radius of 61 picometers is slightly larger than the 44 picometers of the hexavalent chromium ion, and so it will have a correspondingly lower charge density (electrostatic field) per ion.

The need for "valence stabilization" of trivalent (or tetravalent) cobalt for corrosion inhibition has been indirectly noted in the general corrosion literature. Corrosion inhibition behavior of nitrogen-containing organics such as aniline or pyridine has been reported to be enhanced with the addition of cobalt. The exact nature of this "synergistic enhancement" has never been adequately explained. These "synergistic" mixtures of nitrogen-containing organics and cobalt have also been described as being "oxygen-scavengers", and the organics are frequently observed to "chemisorb" onto the substrate piece being protected.

This enhancement can be explained by our "valence stabilization" model of corrosion inhibition by trivalent (or tetravalent) cobalt. Nitrogen-containing organics and cobalt result in the formation of an organometallic complex where the central cobalt ion can be stabilized in a higher oxidation state. The observed "oxygen-scavenging" phenomenon associated with dissolved oxygen in aqueous solutions is easily explained by the oxidation of stabilized divalent cobalt to the trivalent state. "Sparingly soluble" $Co^{+3}$ complexes containing these organics are responsible for the corrosion-inhibiting activity, and these organics will appear to be "adsorbed" or "chemisorbed" from solution onto the metal piece being protected due to precipitation.

As noted in the Summary of the Invention, the valence stabilizer serves a number of important functions in the establishment of a successful rinse or sealing solution. First, the valence stabilizer, when used with trivalent cobalt, must result in a "sparingly soluble" $Co^{+3}$-valence stabilizer complex. Although the exact solubility of this complex can be slightly modified through the incorporation of different cations or anions (either through the dissolution of the coated metal, or by additional solubility control agents), appreciable corrosion inhibition will be observed if the trivalent cobalt is incorporated in the coating enhanced via rinsing or sealing as a $Co^{+3}$-stabilizer complex that exhibits a solubility in water of between about $5\times10^{-5}$ moles per liter and about $5\times10^{-2}$ moles per liter of available $Co^{+3}$. Therefore, any material (inorganic or organic) in the coating bath which complexes with trivalent (or tetravalent) cobalt and results in the formation of a $Co^{+3}$-containing complex which exhibits solubilities within or near this solubility range can serve as a valence stabilizer for trivalent cobalt.

Rinse or sealing solutions that contain valence stabilizers that result in the formation of stabilized cobalt compounds that fall outside of this particular solubility range may exhibit some degree of corrosion inhibition and may be effective under certain circumstances. Although not as effective as those compounds within the optimum solubility range, compositions with solubilities as high as about $5\times10^{-1}$ moles per liter or as low as about $1\times10^{-5}$ moles per liter of trivalent cobalt at standard temperature and pressure (about 25° C. and about 760 Torr) exhibited some corrosion resistance. For example, in situations where the substrate metal pieces are exposed to environments which require much more immediate corrosion exposure (e.g., sudden immersion in seawater), adequate corrosion protection can be achieved through the formation of a trivalent cobalt compound which exhibits a higher solubility in water (e.g., $5\times10^{-1}$ to $5\times10^{-3}$ moles/liter trivalent cobalt). In this way, a more "immediate" release of protective cobalt ions can be achieved, although the trivalent cobalt will be depleted faster from the coating. Trivalent cobalt solubilities that are lower than this optimum range (e.g., $1\times10^{-5}$ to $1\times10^{-3}$ moles/liter of trivalent cobalt) may be desirable for some situations (e.g., in nearly pure water with low aeration rates). However, compounds that exhibit solubilities far outside the target range are unlikely to be effective corrosion inhibitors.

The solubility characteristics of the trivalent cobalt in the rinsed or sealed coatings must be controlled with stabilizer materials that form compounds within the desired solubility range. The exact solubility will be strongly dependent on the application of the rinse or sealing solutions, the nature of the barrier film being treated, and the net aqueous solubility of the overlying paints and coatings.

The formation of coatings with the proper release rate of $Co^{+3}$ ions is problematic because of the instability of $Co^{+3}$ out of solution. Trivalent cobalt compounds such as acetate, sulfate, acetylacetonate, and hexaamine chloride are generally too soluble to serve as effective corrosion inhibitors if formed from a rinse or seal solution. Oxides and hydroxides of $Co^{+3}$ are much too insoluble in water to serve effectively as corrosion inhibitors in a coating.

One method of providing a useful source of trivalent cobalt at a metal surface is the creation of a sparingly soluble compound in which the $Co^{+3}$ is shielded from premature reduction during and after compound formation during the rinsing or sealing treatments. The assembly of a protective shell around the highly charged $Co^{+3}$ and its associated oxygen and hydroxyl species can help control the rate at which the cobalt is reduced and its oxygen is released. Proper selection of materials for forming the protective shell will allow solubility tailoring of the entire assembly to its intended application environment. Valence stabilizers are materials that, when assembled, modify the rate of reduction and solubility of the $Co^{+3}$ ion.

The electrostatic character of the complex may also be considered in order to create a $Co^{+3}$ stabilizer complex with optimal corrosion resistance. Valence stabilizers may also contribute to the development of a substantial electrostatic double layer. An electrostatic double layer of polar or charged species such as hydronium ($H_3O^+$) or hydroxide ($OH^-$) ions surrounding the stabilized cobalt complex will help control cobalt reduction and solubility and enhance the barrier properties of the treated coating. Valence stabilizers which form sparingly soluble cobalt complexes with enhanced electrostatic double layers will maximize the corrosion-inhibiting character of the rinsed or sealed coating.

The trivalent cobalt ion is slightly larger than the hexavalent chromium ion, with less charge density over the surface of the ion. Therefore, the valence stabilizers for $Co^{+3}$ must be more efficient in the establishment of dipole moments than the valence stabilizers typically used for hexavalent chromium so that comparable corrosion resistance can be achieved in relation to the state of the art $Cr^+$ compositions. Valence stabilizers which have a comparable dipole moment to the $Cr^{+6}$ stabilizers, or which exhibit even less of a dipole moment than the $Cr^{+6}$ stabilizers can also function as valence stabilizers, but the resultant corrosion resistance of the treated coatings will, in all probability, be less than for the current commercial hexavalent chromium-based rinses and seals.

Large spheres of hydration around corrosion inhibitors can act as electrostatic and physical barriers to the passage of large corrosive ions such as $Cl^-$ and $SO_4^{2-}$ through the coating to the metal surface. The size of the electrostatic double layer is a function of the electrostatic potential at the complex surface and is inversely proportional to the ionic strength of the surrounding solution. Compounds that can carry a charge, have a natural electrostatic dipole, or can have a dipole induced, will likely form an electrostatic double layer in aqueous solution. However, these compounds do not normally act as corrosion inhibitors because they have not been optimized for that purpose.

Optionally, the incorporation of the valence stabilizer (inorganic or organic) may result in the formation of a $Co^{+3}$-valence stabilizer compound which also exhibits ion exchange behavior towards alkali ions. As noted in the Summary of the Invention, this is not a requirement of the $Co^{+3}$-valence stabilizer complex, but it is a desirable characteristic for enhanced corrosion resistance. Some existing state of the art chromium systems exhibit this phenomenon, but complexes derived from rinse or sealing solutions that do not exhibit this phenomenon have been successfully demonstrated to inhibit corrosive attack.

Cobalt coordination chemistry, which has been the subject of numerous scientific studies for almost 100 years, identifies chemical binding preferences, structure stability, and physical properties of the resulting compounds. Producing effective $Co^{+3}$-valence stabilizer complexes requires understanding the electrostatic and structural influence of candidate species on the complex. Stabilizers can be designed that result in cobalt compounds with the necessary physical, electrical, and chemical properties to form corrosion inhibitors with this information. Property tailoring can also take place through selection of specific anions or cations bound to the $Co^{+3}$-valence stabilizer coordination complex.

The functional anatomy of inorganic stabilizers is simple because of the limited number of atoms and structural arrangements involved in their formation. The anatomy of organic stabilizers is not as simple. An organically stabilized cobalt complex may have one or more organic ligands that may have one or more bonding sites that can interact with the $Co^{+3}$ ion/oxide cluster. The bonding groups can be the same or different atoms or functional groups on an individual or a variety of ligands. An organic stabilizer can be modified in an unlimited number of ways to tailor its physical behavior with respect to such properties as chemical reactivity, solubility, electrostatic and polar character, and functional behavior.

The stability of the $Co^{+3}$-valence stabilizer complex is strongly influenced by the charge, polarity, and degree of polarizability of specific binding sites. Factors influencing compound stability include: 1) ion-pair interactions for charged ligands and $Co^{+3}$; 2) ion-dipole and ion-induced dipole interactions for neutral ligands; 3) hydrogen bonding; and 4) the hard-soft acid-base (HSAB) rules convention of coordination chemistry. HSAB rules help identify functional groups on ligands that might be effective as binding sites. Optimum binding for organic valence stabilizers to $Co^{+3}$ will involve ligands with soft bonding species such as those that contain sulfur or phosphorus. Certain coordination complexes of the hard base nitrogen are also effective for binding with $Co^{+3}$. HSAB rules can also help identify groups that might provide a degree of polarization to the stabilizer because of their large dipole moments.

The nature of bonding between the $Co^{+3}$ ion/oxide cluster and the stabilizer ligand can be altered by using a substituent group to modify the stabilizer. Specific interactions between the ligand and $Co^{+3}$ can be tailored by substituent group selection, coupled with altering the size or geometry of the complexing ligand. For example, some substituent groups have large dipole moments associated with them, which will increase the electrostatic barrier layers associated with the cobalt/valence stabilizer complexes. These include: ketones (═C═O), thioketones (═C═S), amides (—C[═O]—$NR_2$), thioamides (—C[═S]—$NR_2$), nitriles or cyano groups, (—CN), isocyanides (—NC), nitroso groups (—N═O), thionitroso groups (—N═S), nitro groups (—$NO_2$), azido groups (—$N_3$), cyanamide or cyanonitrene groups (═N—CN), cyanate groups (—O—CN), isocyanate groups (—N═C═O), thiocyanate groups (—S—CN), isothiocyanate groups (—N═C═S), nitrosamine groups (═N—N═O), thionitrosamine groups (═N—N═S), nitramine groups (═N—$NO_2$), thionitramine groups (═N—$NS_2$), carbonylnitrene groups (—CO—N), thiocarbonylnitrene groups (—CS—N), sulfenyl halides (—S—X), sulfoxides (═S═O), sulfones (═S[═O]$_2$), sulfinyl groups (—N═S═O), thiosulfinyl groups (—N═S═S), sulfenyl thiocyanato groups (—S—S—CN), sulfenyl cyanato groups (—S—O—CN), sulfodiimine groups (═S[═NH]$_2$), sulfur dihaloimido groups (—N═$SX_2$), sulfur oxide dihaloimido groups (—N═S[═O]$X_2$), aminosulfur oxide trihalide groups (═N—S[═O]$X_3$), sulfonyl azide groups (—S[═O]$_2N_3$), sulfonyl thiocyanate groups (—S[═O]$_2$SCN), sulfonyl cyanate groups (—S[═O]$_2$OCN), sulfonyl cyanide groups (—S[═O]$_2$CN), halosulfonate groups (—S[═O]$_2$OX), phosphonyl thiocyanate groups (—P[═O]OHSCN), phosphonyl cyanate groups (—P[═O]OHOCN), and phosphonyl cyanide groups (—P[═O]OHCN). The polarization of the $Co^{+3}$-stabilizer can therefore be optimized via evaluation of the effect of ligand type and substituents. The influence of the $Co^{+3}$ ion on the aqueous solution outside of, or external to, the valence stabilizer shell (or hydration sphere) may play an important role in the complexation properties of a given ligand. The electrostatic action of the $Co^{+3}$ ion on the aqueous solution will also control the diameter of the hydration shell around the $Co^{+3}$-stabilizer complex.

The number of binding sites available on the complexing ligand is important to the resulting $Co^{+3}$-stabilizer's properties. Several ligands are required to stabilize $Co^{+3}$ effectively if the chosen ligand has only one binding site. Six $NH_3$ ligands are needed to octahedrally coordinate $Co^{+3}$ in the hexaaminecobalt(III) complex because $NH_3$ has only one binding site. Bulky ligands with only one binding site, like pyridine, can be sterically hindered from packing tightly around the ion, which will result in decreased complex stability. Conversely, macrocyclic organic and polymeric inorganic ligands may have many suitable binding sites. However, instability will result if a $Co^{+3}$ ion is not completely embraced by all of the multiple macromolecular bonding sites on the ligand. For example, if a macromolecule surrounding the $Co^{+3}$ ion has an insufficient number of binding sites available for charge balance, then the $Co^{+3}$-stabilizer complex formed will be much less stable than with a macromolecule that contains an adequate number of sites.

The physical geometry of the binding sites is also important to the stability of the $Co^{+3}$-stabilizer complex. The influence of site geometry becomes evident when the solvation shell of a $Co^{+3}$ ion is replaced by the ligand donor atoms, as when rinse or sealing solutions are applied. The number of available ligand binding sites should be at least equal to the standard coordination number of the $Co^{+3}$ ion. The balance between solvation of the ligand and $Co^{+3}$, and their complexation where $Co^{+3}$ is solvated by a specific ligand is one factor in maintaining stability. $Co^{+3}$-ligand attraction increases with the number of binding sites on the ligand. However, with increasing number of binding sites, site-site repulsions will also increase, resulting in lower stability.

The $Co^{+3}$ ion generally favors complexation in the tetrahedral (coordination number 4) or octahedral (coordination number 6) arrangements. However, it will occasionally be found in a trigonal bipyramidal or square planar arrangement. Valence stabilizers (and stabilizer combinations) should be selected with the goal of achieving these coordinations.

Inorganic materials that tend to "polymerize" and form octahedra or tetrahedra (or a combination thereof) around ions such as $Co^{+3}$ are termed isopolyanions, and their resultant complexes with $Co^{+3}$ are termed heteropolyanions or heteropolymetallates. This polymerization of the inorganic valence stabilizer species results in stacks of octahedra or tetrahedra with central cavities, which can accommodate at least one $Co^{+3}$ ion, thereby stabilizing it.

Valence stabilizers and combinations of stabilizers can be manipulated by the selection of "shaping groups" and heteroatoms positioned at the binding site. Inorganic valence stabilizers are typically oxygen-containing coordination compounds. Saturated organic chains can form flexible ligands that wrap around $Co^{+3}$ and can enhance its stability. Unsaturated organics typically have less freedom to bend and contort and are less likely to be able to wrap around the $Co^{+3}$ ion. The addition of substituents onto an organic ligand may further restrict its freedom to flex.

The actual size of the valence stabilizer complex situated around the $Co^{+3}$ ion has an important role in solubility control. Solubility of the complex scales roughly with the inverse of its physical diameter. $Co^{+3}$ and its layer of negatively charged hydroxyl ions is very small and results in its high degree of aqueous solubility. The field strength of the complex also scales with the inverse of its physical diameter. Large complexes with an optimal degree of solubility will not necessarily be ideal with respect to the size of the electrostatic double layer. The size of the ligand must therefore be balanced against the desired electrical properties.

The addition (or subtraction) of functional groups on organic valence stabilizers can be used to modify the solubility of the formed $Co^{+3}$/valence stabilizer species. For example, the addition of sulfonated groups ($—SO_3^-$) to organic valence stabilizers will significantly increase the solubility in water. Other substituent groups that will increase the solubility in water include: carboxyl groups ($—CO_2—$), hydroxyl groups (—OH), ester groups ($—CO_3—$), carbonyl groups (=C=O), amine groups ($—NH_2$), nitrosamine groups (=N—N=O), carbonylnitrene groups (—CO—N), sulfoxide groups (=S=O), sulfone groups ($=S[=O]_2$), sulfinyl groups (—N=S=O), sulfodiimines ($=S[=NH]_2$), sulfonyl halide groups ($—S[=O]_2X$), sulfonamide groups ($—S[=O]_2NH_2$), monohalosulfonamide groups ($—S[=O]_2NHX$), dihalosulfonamide groups ($—S[=O]_2MX_2$), halosulfonate groups ($—S[=O]_2OX$), halosulfonate amide groups ($=N—S[=O]_2X$), aminosulfonate groups ($=N—S[=O]_2OH$), iminodisulfonate groups ($—N[SO_3^-]_2$), phosphonate groups ($—PO_3^{-2}$), phosphonamide groups ($—PO_2NH_2^-$), phosphondiamide groups ($—PO[NH_2]_2$), aminophosphonate groups ($=N—PO_3^{-2}$), and iminodiphosphonate groups ($—N[PO_3^{-2}]_2$). Conversely, addition of nitro groups ($—NO_2$), perfluoroalkyl groups ($—C_xF_{2x+1}$), perchloroalkyl groups ($—C_xCl_{2x+1}$), nitramine groups ($=N—NO_2$), thioketone groups (=C=S), sulfenyl halide groups (—S—X), or sulfur dihaloimide groups ($—N=SX_2$) to an organic valence stabilizer will lower its solubility in water. In this way, the solubility characteristics of valence stabilizers can be "tailored" to meet specific needs.

The physical, chemical, and electrostatic requirements for the design of effective $Co^{+3}$-stabilizer complexes result in lists of stabilizers that may be divided into wide band or narrow band stabilizer classes. The compounds listed here are general guides for the initial selection of a coordination compound and do not represent a complete or final list. New organic and inorganic compounds are continuously being developed, compound toxicity limits can change, and some currently available compounds may have been overlooked. Tailoring substituent groups and the selection of cations or anions for charge balance can influence whether a particular $Co^{+3}$-stabilizer complex will have a wide band or narrow band character.

Valence stabilizers for trivalent cobalt that embody the desirable characteristics of stabilizers as described above are typical when designing a rinse or seal solution for maximum effectiveness. These "wide band" stabilizers result in the formation of compounds that provide significant corrosion resistance when used with trivalent cobalt. Less typical valence stabilizers ("narrow band") result in satisfactory corrosion inhibition only under limited applications. Wide band rinse or sealing solutions for general purpose applications and narrow band derivatives for specific uses have been identified and developed. Wide band behavior (stability, solubility, and polarization) can be achieved by both inorganic and organic valence stabilizers, as can ion exchange capability.

In general, valence stabilizers that form cobalt complexes, which exhibit the necessary physical properties of stability, solubility, and polarization, may be achieved with both inorganic and organic valence stabilizers. Ion exchange behavior can also be achieved with both inorganic and organic coordination compounds.

2a) Wide Band Inorganic Valence Stabilizers

Wide band inorganic valence stabilizers are formed around the $Co^{+3}$ ion by polymerizing in the rinse or sealing solution near the barrier layer/substrate metal surface being treated. Acidic solutions can become basic near the work piece surface (and especially within the pores in the treated barrier film) where precipitation of the cobalt-stabilizer complex occurs during the rinsing or sealing process. Inorganic wide band valence stabilizers for $Co^{+3}$ include, but are not limited to: molybdates ($Mo^{+6}$, $Mo^{+5}$, or $Mo^{+4}$, for example $[Co^{+3}Mo_6O_{18}(OH)_6]^{3-}$ and $[Co^{+3}{}_2Mo_{10}O_{34}(OH)_4]^{6-}$), tungstates ($W^{+6}$, $W^{+5}$, or $W^{+4}$, for example $[Co^{+3}W_{12}O_{40}]^{5-}$), vanadates ($V^{+5}$ and $V^{+4}$, for example $[Co^{+3}V_{10}O_{28}]^{3-}$), niobates ($Nb^{+5}$ and $Nb^{+4}$, for example $[Co^{+3}Nb_4O_{12}(OH)_2]^{3-}$), tantalates ($Ta^{+5}$ and $Ta^{+4}$, for example $[Co^{+3}Ta_4O_{12}(OH)_2]^{3-}$), tellurates ($Te^{+6}$ and $Te^{+4}$), periodates ($I^{+7}$), iodates ($I^{+5}$, for example $[Co^{+3}(IO_3)_4]^{1-}$), carbonates ($C^{+4}$, for example $[Co^{+3}(CO_3)_3]^{3-}$), antimonates ($Sb^{+5}$ and $Sb^{+3}$), and stannates ($Sn^{+4}$). Many of these inorganics form octahedral and tetrahedral heteropolymetallate structures on precipitation from solution. For example, tellurate ions begin to polymerize in solution near pH 5 and will complex with $Co^{+3}$ ions near the work piece or within the treated barrier film pores as solution pH increases. The exact chemical nature of these valence stabilizers (i.e., chemical formulation and valence state of the atom in the center of the tetrahedra or octahedra) is highly dependent upon the specific pH and redox conditions.

The stability of the heteropolymetallates is a function of composition and structure. The relatively unstable $Co^{+3}$ ion is protected and stabilized within the surrounding octahedral and tetrahedral groups, although specific configurations of the heteropolymetallate anions differ from stabilizer to stabilizer (i.e., from molybdate to periodate to carbonate).

The dimensions of the octahedra and tetrahedra are controlled by the size of the heteroatom (e.g., Mo, W, Te) around which they are assembled. A $Co^{+3}$ ion trapped by the precipitation of these heteropolymetallates and its resulting "ion within a cage" structure can exhibit an even greater apparent volume due to the development of a large electrostatic double layer. This will influence both the valence stabilization of the $Co^{+3}$ as well as the solubility of the assembled complex. These compounds are also reported to be excellent ion exchange agents for alkali ions.

This caging structure serves to lower the solubility of the $Co^{+3}$ because the chemical elements typically associated with these valence stabilizers (e.g., I, Te, Mo, W) are all inherently less soluble in water than $Co^{+3}$. These materials can also establish oriented dipoles with the interior $Co^{+3}$ ion, thereby forming the desired barrier layers (e.g., of hydronium ions), much as ferricyanide or molybdate contributes to some hexavalent chrome systems. Finally, the elements associated with these valence stabilizers themselves can contain high valence ions, such as $V^{+5}$, $Te^{+6}$, or $Mo^{+6}$, which will also serve somewhat in corrosion protection, although not to the degree of $Co^{+3}$, due to their lower redox potential.

Water-soluble precursors for the formation of these valence stabilizers are desirable in order to ensure that sufficient material is available for coating deposition from aqueous solutions. Identification of suitable water-soluble precursors may be difficult, since many of the elements associated with these valence stabilizers (e.g., Mo, W, Te, etc.) do not typically form water-soluble compounds (hence, their beneficial use as a valence stabilizer). Representative examples of suitable precursors for "wide band" inorganic valence stabilizers are listed in Table 5.

The solubilities given in Table 5 are usually for the simplest salts of each compound. More complex, partially "polymerized" salts for each compound (e.g., para- or meta-polymorphs) can also be used as precursors, although these polymorphs typically exhibit slightly lower solubilities in water than the simple salts. Peroxo-salts of these compounds, especially percarbonates, permolybdates, pertungstates, and pervanadates can also be utilized as precursors. Formation of the chosen heteropolymetallates from precursors such as the fluorides, chlorides, bromides, nitrates, and perchlorates (e.g., $SnCl_4$ to form heterostannates, $SbF_5$ to form heteroantimonates, etc.) proved to be difficult, but may be acceptable under certain circumstances.

$Co^{+3}$ stabilized with a heteropolymolybdate complex is an example of a wide band inorganically stabilized cobalt complex. This complex is very stable and provides significant corrosion protection when it is formed from a rinsing or sealing solution. The size of the cavity developed at the center of a ligand with three or more bonding sites is important. A cavity that is too large or too small will tend to be less stable and less effective as a corrosion inhibitor.

The valence stabilizer can be a cross between two or more of the wide-band inorganic valence stabilizers listed above. For example, in some instances it may be desirable to form a valence stabilizer out of a periodate and a molybdate. During the coating process, both of these materials will polymerize to form a mixed periodate/molybdate valence stabilizer out of the rinsing or sealing solution.

2b) Wide Band Organic Valence Stabilizers

A variety of organic compounds meet the criteria to be typical valence stabilizers for $Co^{+3}$. These coordination ligands produce $Co^{+3}$ valence stabilized complexes, which fulfill the general requirements of a $Co^{+3}$ rinse or seal inhibitor material. Organic compounds can be very effective cobalt stabilizers and provide the greatest degree of freedom in designing new stabilizer species with new functionalities. There are many more possible organic valence stabilizer species than inorganic valence stabilizers because of the large number of organic compounds and functionalities which exist. Some of the typical organic valence stabilizer species are listed in Table 2 below.

The number of wide band (and narrow band) organic compounds that are acceptable as valence stabilizers for trivalent cobalt is limited. Common organic compounds such as alcohols, aldehydes, ketones, esters, ethers, alkyl or aromatic halides, most carboxylic acids, anhydrides, phenols, sulfonic acids, phosphonic acids, carbohydrates, waxes, fats, sugars, and oils are not as effective as the structural types described in these Tables to stabilize the trivalent cobalt ion. At best, some of the organic types described in these Tables may presently be used for other industrial applications, but their incorporation into corrosion-inhibiting blends to stabilize trivalent cobalt has heretofore been unrecognized.

The choice of substituent functional groups on these general classes of valence stabilizers will affect the physicochemical properties of the $Co^{+3}$-containing complex and the corrosion resistance achieved using that complex. For example, the addition of $—NH_2$ or $=O$ substituents increases the net polarization of the overall $Co^{+3}$-valence stabilizer complex, but this will also increase its water solubility. Careful molecular design of $Co^{+3}$ complexes is necessary to achieve desired performance characteristics.

In general, the bonding atoms in typical organic valence stabilizers are nitrogen, phosphorus, or sulfur, with oxygen being acceptable in some circumstances. Oxygen is complexed with $Co^{+3}$ most frequently in association with at least one of the other three. Bonding atoms such as carbon, silicon, tin, arsenic, selenium, and antimony are much less desirable due to problems with valence stability, toxicity, or solubility. These valence stabilizers all serve to stabilize the $Co^{+3}$ ion within a sparingly soluble complex that can exhibit a polar character in aqueous solution.

TABLE 2

Wide Band Organic Valence Stabilizers for the $Co^{+3}$ Ion

| General Structural Name (Type of Organic) | Structural Representation |
|---|---|
| N Valence Stabilizer #1: Monoamines (N Monodentates) | $NH_3$, $NH_2R$, $NHR_2$, and $NR_3$ where R represents H or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| N Valence Stabilizer #2: Diamines (N—N Bidentates) | R'—N—R—N—R", where R, R', and R" represent H or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| N Valence Stabilizer #3: Triamines (either N—N Bidentates or N—N Tridentates) | R—N—R'—N—R"—N—R'", where R, R', R", and R'" represent H or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| N Valence Stabilizer #4: Tetramines (N—N Bidentates, N—N Tridentates, or N—N Tetradentates) | R—N—R'—N—R"—N—R'"—N—R"", where R, R', R", R'", and R"" represent H or any organic functional group wherein the number of carbon atoms ranges from 0 to 40, optionally having |

TABLE 2-continued

Wide Band Organic Valence Stabilizers for the $Co^{+3}$ Ion

| General Structural Name (Type of Organic) | Structural Representation |
|---|---|
| | halogen or polarizing or water-insolubilizing/solubilizing groups attached. Ligand can also contain nonbinding N, O, S, or P atoms. |
| N Valence Stabilizer #5: Pentamines (N—N Bidentates, N—N Tridentates, or N—N Tetradentates) | R—N—R'—N—R''—N—R'''—N—R''''—N—R''''', where R, R', R'', R''', R'''', and R''''' represent H or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| N Valence Stabilizer #6: Hexamines (N—N Bidentates, N—N Tridentates, N—N Tetradentates, or N—N Hexadentates) | R—N—R'—N—R''—N—R'''—N—R''''—N—R'''''—N—R''''''', where R, R', R'', R''', R'''', R''''', and R''''''' represent H or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| N Valence Stabilizer #7: Five-Membered Heterocyclic Rings containing One, Two, Three, or Four Nitrogen Atoms wherein at least one Nitrogen Atom is a Binding Site (N Monodentates or N—N Bidentates) | Five membered heterocyclic ring containing one, two, three, or four nitrogen atoms, all of which may or may not function as binding sites. Can include other ring systems bound to this heterocyclic ring, but they do not coordinate with the stabilized, high valence metal ion. Ring can also contain O, S, or P atoms. This 5-membered ring and/or attached, uncoordinating rings may or may not have halogen or polarizing or water-insolubilizing/solubilizing groups attached. |
| N Valence Stabilizer #8: Six-Membered Heterocyclic Rings containing One, Two, Three, or Four Nitrogen Atoms wherein at least one Nitrogen Atom is a Binding Site (N Monodentates or N—N Bidentates) | Six membered heterocyclic ring containing one, two, three, or four nitrogen atoms, all of which may or may not function as binding sites. Can include other ring systems bound to this heterocyclic ring, but they do not coordinate with the stabilized, high valence metal ion. Ring can also contain O, S, or P atoms. This 6-membered ring and/or attached, uncoordinating rings may or may not have halogen or polarizing or water-insolubilizing/solubilizing groups attached. |
| N Valence Stabilizer #9: Five-Membered Heterocyclic Rings containing One, Two, Three, or Four Nitrogen Atoms and having at least one additional Nitrogen Atom Binding Site not in a Ring (N Monodentates, N—N Bidentates, N Tridentates, N—N Tetradentates, or N—N Hexadentates) | Five membered heterocyclic ring(s) containing one, two, three, or four nitrogen atoms. In addition, ligand contains additional nitrogen-containing substituents (usually amines) that constitute N binding sites. Can include other ring systems bound to the heterocyclic ring or to the N-containing substituent, but they do not coordinate with the stabilized, high valence metal ion. Ring(s) can also contain O, S, or P atoms. This 5-membered ring(s) and/or attached, uncoordinating rings and/or N-containing substituent(s) may or may not have halogen or polarizing or water-insolubilizing/solubilizing groups attached. |
| N Valence Stabilizer #10: Six-Membered Heterocyclic Rings containing One, Two, Three, or Four Nitrogen Atoms at least one additional Nitrogen Atom Binding Site not in a Ring (N Monodentates, N—N Bidentates, N—N Tridentates, N—N Tetradentates, or N—N Hexadentates) | Six membered heterocyclic ring(s) containing one, two, three, or four nitrogen atoms. In addition, ligand contains additional nitrogen-containing substituents (usually amines) that constitute N binding sites. Can include other ring systems bound to the heterocyclic ring or to the N-containing substituent, but they do not coordinate with the stabilized, high valence metal ion. Ring(s) can also contain O, S, or P atoms. This 6-membered ring(s) and/or attached, uncoordinating rings and/or N-containing substituent(s) may or may not have halogen or polarizing or water-insolubilizing/solubilizing groups attached. |
| N Valence Stabilizer #11: Five-Membered Heterocyclic Rings containing One, Two, Three, or Four Nitrogen Atoms at least one additional | Five membered heterocyclic ring(s) containing one, two, three, or four nitrogen atoms. In addition, ligand contains additional nitrogen-containing rings that constitute N binding sites. |

TABLE 2-continued

Wide Band Organic Valence Stabilizers for the $Co^{+3}$ Ion

| General Structural Name (Type of Organic) | Structural Representation |
|---|---|
| Nitrogen Atom Binding Site in a Separate Ring (N Monodentates, N—N Bidentates, N—N Tridentates, N—N Tetradentates) | Can include other ring systems bound to the N-containing heterocyclic rings, but they do not coordinate with the stabilized, high valence metal ion. Ring(s) can also contain O, S, or P atoms. This 5-membered ring(s) and/or additional N-containing ring(s) and/or attached, uncoordinating rings may or may not have halogen or polarizing or water-insolubilizing/solubilizing groups attached. |
| N Valence Stabilizer #12: Six-Membered Heterocyclic Rings containing One, Two, Three, or Four Nitrogen Atoms at least one additional Nitrogen Atom Binding Site in a Separate Ring (N Monodentates, N—N Bidentates, N—N Tridentates, N—N Tetradentates) | Six membered heterocyclic ring(s) containing one, two, three, or four nitrogen atoms. In addition, ligand contains additional nitrogen-containing rings that constitute N binding sites. Can include other ring systems bound to the N-containing heterocyclic rings, but they do not coordinate with the stabilized, high valence metal ion. Ring(s) can also contain O, S, or P atoms. This 6-membered ring(s) and/or additional N-containing ring(s) and/or attached, uncoordinating rings may or may not have halogen or polarizing or water-insolubilizing/solubilizing groups attached. |
| N Valence Stabilizer #13: Two-, Three-, Four-, Six-, Eight-, and Ten-Membered Macrocyclics, Macrobicyclics, and Macropolycyclics (including Catapinands, Cryptands, Cyclidenes, and Sepulchrates) wherein all Binding Sites are composed of Nitrogen (usually amine or imine groups) and are not contained in Component Heterocyclic Rings (N—N Bidentates, N—N Tridentates, N—N Tetradentates, and N—N Hexadentates) | Macrocyclic ligands containing two, three, four, six, eight, or ten nitrogen binding sites to valence stabilize the central metal ion. Can include other hydrocarbon or ring systems bound to this macrocyclic ligand, but they do not coordinate with the stabilized, high valence metal ion. This ligand and/or attached, uncoordinating hydrocarbons/rings may or may not have halogen or polarizing or water-insolubilizing/solubilizing groups attached. |
| N Valence Stabilizer #14: Four-, Six-, Eight-, or Ten-Membered Macrocyclics, Macrobicyclics, and Macropolycyclics (including Catapinands, Cryptands, Cyclidenes, and Sepulchrates) wherein all Binding Sites are composed of Nitrogen and are contained in Component 5-Membered Heterocyclic Rings (N—N Bidentates, N—N Tridentates, N—N Tetradentates, or N—N Hexadentates) | Macrocyclic ligands containing a total of four, six, eight, or ten five-membered heterocyclic rings containing nitrogen binding sites. Can include other hydrocarbon/ring systems bound to this macrocyclic ligand, but they do not coordinate with the stabilized, high valence metal ion. This ligand and/or attached, uncoordinating hydrocarbon/rings may or may not have halogen or polarizing or water-insolubilizing groups attached. |
| N Valence Stabilizer #15: Four-, Six-, Eight-, or Ten-Membered Macrocyclics, Macrobicyclics, and Macropolycyclics (including Catapinands, Cryptands, Cyclidenes, and Sepulchrates) wherein all Binding Sites are composed of Nitrogen and are contained in a Combination of 5-Membered Heterocyclic Rings and Amine or Imine Groups (N—N Bidentates, N—N Tridentates, N—N Tetradentates, or N—N Hexadentates) | Macrocyclic ligands containing at least one 5-membered heterocyclic ring. These heterocyclic rings provide nitrogen binding sites to valence stabilize the central metal ion. Other amine or imine binding sites can also be included in the macrocyclic ligand, so long as the total number of binding sites is four, six, eight, or ten. Can include other hydrocarbon/ring systems bound to this macrocyclic ligand, but they do not coordinate with the stabilized, high valence metal ion. This ligand and/or attached, uncoordinating hydrocarbon/rings may or may not have halogen or polarizing or water-insolubilizing groups attached. |
| N Valence Stabilizer #16: Four-, Six-, Eight-, or Ten-Membered Macrocyclics, Macrobicyclics, and Macropolycyclics (including Catapinands, Cryptands, Cyclidenes, and Sepulchrates) wherein all Binding Sites are composed of Nitrogen and are contained in Component 6-Membered Heterocyclic Rings (N—N Bidentates, N—N Tridentates, N—N Tetradentates, or N—N Hexadentates) | Macrocyclic ligands containing a total of four, six, eight, or ten six-membered heterocyclic rings containing nitrogen binding sites. Can include other hydrocarbon/ring systems bound to this macrocyclic ligand, but they do not coordinate with the stabilized, high valence metal ion. This ligand and/or attached, uncoordinating hydrocarbon/rings may or may not have halogen or polarizing or water-insolubilizing groups attached. |
| N Valence Stabilizer #17: Four-, Six-, Eight-, or Ten-Membered Macrocyclics, Macrobicyclics, and Macropolycyclics (including Catapinands, Cryptands, Cyclidenes, and Sepulchrates) wherein all Binding Sites are composed of | Macrocyclic ligands containing at least one 6-membered heterocyclic ring. These heterocyclic rings provide nitrogen binding sites to valence stabilize the central metal ion. Other amine or imine binding sites can also be included in the macrocyclic ligand, so long as |

TABLE 2-continued

Wide Band Organic Valence Stabilizers for the $Co^{+3}$ Ion

| General Structural Name (Type of Organic) | Structural Representation |
|---|---|
| Nitrogen and are contained in a Combination of 6-Membered Heterocyclic Rings and Amine or Imine Groups (N—N Bidentates, N—N Tridentates, N—N Tetradentates, or N—N Hexadentates) | the total number of binding sites is four, six, eight, or ten. Can include other hydrocarbon/ring systems bound to this macrocyclic ligand, but they do not coordinate with the stabilized, high valence metal ion. This ligand and/or attached, uncoordinating hydrocarbon/rings may or may not have halogen or polarizing or water-insolubilizing groups attached. |
| N Valence Stabilizer #18: Amidines and Diamidines (N—N Bidentates and N—N Tetradentates) | R'—NH—C(—R)═N—R", where R, R', and R" represent H or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| N Valence Stabilizer #19: Biguanides (Imidodicarbonimidic Diamides or Dihydrazides), Biguanidines, Imidotricarbonimidic Diamides or Dihydrazides, Imidotetracarbonimidic Diamides or Dihydrazides, Dibiguanides, Bis(biguanidines), Polybiguanides, and Poly(biguanidines) (N—N Bidentates, N—N Tridentates, N—N Tetradentates, and N—N Hexadentates) | RR'—N—C(═NH)—NR"—C(═NH)—NR'"R"" for biguanides, RR'—N—C(═NH)—NR"—NH—C(═NH)—NR'"R"" for biguanidines, where R, R', R", R'", and R"" represent H, $NH_2$, or any organic functional group wherein the number of carbon atoms ranges from 0 to 40, halogen or polarizing or water-insolubilizing/solubilizing groups attached. Ligand can also contain nonbinding N, O, S, or P atoms. |
| N Valence Stabilizer #20: Diamidinomethanes, Bis(amidinomethanes), and Poly(amidinomethanes) (N—N Bidentates, N—N Tridentates, N—N Tetradentates, and N—N Hexadentates) | RR'—N—C(═NH)—CR"R'"—C(═NH)—NR""R"", where R, R', R", R'", R"", and R"" represent H, $NH_2$, or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| N Valence Stabilizer #21: Imidoylguanidines, Amidinoguanidines, Bis(imidoylguanidines), Bis(amidinoguanidines), Poly(imidoylguanidines), and Poly(amidinoguanidines) (N—N Bidentates, N—N Tridentates, N—N Tetradentates) | RR'—N—C(═NH)—NR"—C(═NH)—R'" for imidoylguanidines, and RR'—N—C(═NH)—NR"—NH—C(═NH)—R'" for amidinoguanidines, where R, R', R", and R'" represent H, $NH_2$, or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| N Valence Stabilizer #22: Diformamidine oxides (Dicarbonimidic Diamides or Dihydrazides), Tricarbonimidic Diamides or Dihydrazides, Tetracarbonimidic Diamides or Dihydrazides, Bis(diformamidine oxides), and Poly(diformamidine oxides) (N—N Bidentates, N—N Tridentates, N—N Tetradentates) | RR'—N—C(═NH)—O—C(═NH)—NR"R'", where R, R', R", and R'" represent H, $NH_2$, or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| N Valence Stabilizer #23: Diformamidine Sulfides (Thiodicarbonimidic Diamides or Dihydrazides), Thiotricarbonimidic Diamides or Dihydrazides, Thiotetracarbonimidic Diamides or Dihydrazides, Bis(diformamidine sulfides), and Poly(diformamidine sulfides) (N—N Bidentates, N—N Tridentates, N—N Tetradentates) | RR'—N—C(═NH)—S—C(═NH)—NR"R'", where R, R', R", and R'" represent H, $NH_2$, or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| N Valence Stabilizer #24: Imidodicarbonimidic Acids, Diimidodicarbonimidic Acids, Imidotricarbonimidic Acids, Imidotetracarbonimidic Acids, and derivatives thereof (N—N Bidentates, N—N Tridentates, N—N Tetradentates, and N—N Hexadentates) | R—O—C(═NH)—NR'—C(═NH)—O—R" for imidodicarbomimidic acids, and R—O—C(═NH)—NR'—NH—C(═NH)—O—R" for diimidodicarbonimidic acids, where R, R', and R" represent H, $NH_2$, or any organic functional group wherein the number of carbon atoms ranges from 0 to 40, optionally having halogen or polarizing or water-insolubilizing/solubilizing groups attached. Ligand can also contain nonbinding N, O, S, or P atoms. |

TABLE 2-continued

Wide Band Organic Valence Stabilizers for the $Co^{+3}$ Ion

| General Structural Name (Type of Organic) | Structural Representation |
|---|---|
| N Valence Stabilizer #25: Thioimidodicarbonimidic Acids, Thiodiimidodicarbonimidic Acids, Thioimidotricarbonimidic Acids, Thioimidotetracarbonimidic Acids, and derivatives thereof (N—N Bidentates, N—N Tridentates, N—N Tetradentates, and N—N Hexadentates) | R—S—C(═NH)—NR'—C(═NH)—S—R" for thioimidodicarbonimidic acids, and R—S—C(═NH)—NR'—NH—C(═NH)—S—R" for thiodiimidodicarbonimidic acids, where R, R', and R" represent H, $NH_2$, or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| N Valence Stabilizer #26: Diimidoylimines, Diimidoylhydrazides, Bis(diimidoylimines), Bis(diimidoylhydrazides), Poly(diimidoylimines), and Poly(diimidoylhydrazides) (N—N Tridentates and N—N Hexadentates) | R—C(═NH)—NR'—C(═NH)—R" for diimidoylimines, and R—C(═NH)—NR'—NH—C(═NH)—R" for diimidoylhydrazides, where R, R', and R" represent H, $NH_2$, or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| N Valence Stabilizer #27: Imidosulfamides, Diimidosulfamides, Bis(imidosulfamides), Bis(diimidosulfamides), Poly(imidosulfamides), and Poly(diimidosulfamides) (N—N Bidentates, N—N Tridentates, N—N Tetradentates, and N—N Hexadentates) | RR'—N—S(═NH)(═O)—OR" or RR'—N—S(═NH)(═O)—N—R"R'" for imidosulfamides, and RR'—N—S(═NH)(═NH)—OR" or RR'—N—S(═NH)(═NH)—N—R"R'" for diimidosulfamides, where R, R', R", and R'" represent H, $NH_2$, or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| N Valence Stabilizer #28: Phosphoramidimidic Triamides, Bis(phosphoramidimidic triamides), and Poly(phosphoramidimidic triamides) and derivatives thereof (N—N Bidentates, N—N Tridentates, N—N Tetradentates, and N—N Hexadentates) | (NH═)P(—NRR')(—NR"R'")(—NR""R""), where R, R', R", R'", R"", and R""" represent H, $NH_2$, or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| N Valence Stabilizer #29: Phosphoramidimidic Acid, Phosphorodiamidimidic Acid, Bis(Phosphoramidimidic Acid), Bis(Phosphorodiamidimidic Acid), Poly(Phosphoramidimidic Acid), Poly(Phosphorodiamidimidic Acid), and derivatives thereof (N—N Bidentates, N—N Tridentates, N—N Tetradentates, and N—N Hexadentates) | (NH═)P(—NRR')$(OH)_2$ for phosphoramidimidic acid, and (NH═)P(—NRR')(—NR"R'")(OH) for phosphorodiamidimidic acid, where R, R', R", and R'" represent H, $NH_2$, or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| N Valence Stabilizer #30: Phosphoramidimidodithioic Acid, Phosphorodiamidimidothioic Acid, Bis(Phosphoramidimidodithioic Acid), Bis(Phosphorodiamidimidothioic Acid), Poly(Phosphoramidimidodithioic Acid), Poly(Phosphorodiamidimidothioic Acid), and derivatives thereof (N—N Bidentates, N—N Tridentates, N—N Tetradentates, and N—N Hexadentates) | (NH═)P(—NRR')$(SH)_2$ for phosphoramidimidodithioic acid, and (NH═)P(—NRR')(—NR"R'")(SH) for phosphorodiamidimidothioic acid, where R, R', R", and R'" represent H, $NH_2$, or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| N Valence Stabilizer #31: Azo compounds including triazenes with amino, imino, oximo, diazeno, or hydrazido substitution at the ortho- (for aryl) or alpha- or beta- (for alkyl) positions, Bis[o-($H_2N$—) or alpha- or beta-($H_2N$—)azo compounds], or Poly[o-($H_2N$—) or alpha- or beta-($H_2N$—)azo compounds) (N—N Bidentates, N—N Tridentates, N—N Tetradentates, or N—N Hexadentates) | R—N═N—R' for azo compounds, R—N═N—NH—R' for triazenes, where R, and R' represent H or any organic functional group wherein the number of carbon atoms ranges from 0 to 40, optionally having halogen or polarizing or water-insolubilizing/solubilizing groups attached. (Must include ortho-amino, imino, oximo, diazeno, or hydrazido substituted aryl azo compounds, and alpha- or beta-amino, imino, oximo, diazeno, or hydrazido alkyl azo compounds.) Ligand can also contain nonbinding N, O, S, or P atoms. |

TABLE 2-continued

Wide Band Organic Valence Stabilizers for the $Co^{+3}$ Ion

| General Structural Name (Type of Organic) | Structural Representation |
|---|---|
| N Valence Stabilizer #32: Diazeneformimidamides (Diazeneamidines), Diazeneacetimidamides (Diazene-alpha-amidinoalkanes(alkenes)), Bis(diazeneformimidamides), Bis(diazeneacetimidamides), Poly(diazeneformimidamides), and Poly(diazeneacetimidamides) (N—N Bidentates, N—N Tetradentates, and N—N Hexadentates) | R—N=N—C(=NH)—NR'R'' for diazeneformimidamides, and R—N=N—CR'R''—C(=NH)—NR'''R'''' for diazeneacetimidamides, where R, R', R'', R''', and R'''' represent H, $NH_2$, or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| N Valence Stabilizer #33: Diazeneformimidic Acid, Diazeneacetimidic Acid, Bis(diazeneformimidic acid), Bis(diazeneacetimidic acid), Poly(diazeneformimidic acid), Poly(diazeneacetimidic acid), and derivatives thereof (N—N Bidentates, N—N Tetradentates, and N—N Hexadentates) | R—N=N—C(=NH)—OR' for diazeneformimidic acid, and R—N=N—CR'R''—C(=NH)—OR''' for diazeneacetimidic acid, where R, R', R'', and R''' represent H, $NH_2$, or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| N Valence Stabilizer #34: Diazeneformimidothioic Acid, Diazeneacetimidothioic Acid, Bis(diazeneformimidothioic acid), Bis(diazeneacetimidothioic acid), Poly(diazeneformimidothioic acid), Poly(diazeneacetimidothioic acid), and derivatives thereof (N—N Bidentates, N—N Tetradentates, and N—N Hexadentates) | R—N=N—C(=NH)—SR' for diazeneformimidothioic acid, and R—N=N—CR'R''—C(=NH)—SR''' for diazeneacetimidothioic acid, where R, R', R'', and R''' represent H, $NH_2$, or any organic functional group wherein the number of carbon atoms ranges from 0 to 40, optionally having halogen or polarizing or water-insolubilizing/sohibilizing groups attached. Ligand can also contain nonbinding N, O, S, or P atoms. |
| N Valence Stabilizer #35: Imidoyldiazenes, Bis(imidoyldiazenes), and Poly(imidoyldiazenes), (N—N Bidentates, N—N Tetradentates and N—N Hexadentates) | R—N=N—C(=NH)—R' or R—N=N—CR'R''—C(=NH)—R''', where R, R', R'', and R''' represent H, $NH_2$, or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| N Valence Stabilizer #36: Diazenediformimidamides (1,2-Diazenediamidines), Diazenediacetimidamides (1,2-Diazene-di-alpha-amidinoalkanes(alkenes)), Bis(diazenediformimidamides), Bis(diazenediacetimidamides), Poly(diazenediformimidamides), and Poly(diazenediacetimidamides) (N—N Tridentates and N—N Hexadentates) | RR'—N—C(=NH)—N=N—C(=NH)—NR''R'''for diazenediformimidamides, and RR'—N—C(=NH)—CR''R'''—N=N—CR''''R''''—C(=NH)—NR'''''R''''''' for diazenediacetimidamides, where R, R', R'', R''', R'''', R''''', and R''''''' represent H, $NH_2$, or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| N Valence Stabilizer #37: Diazenediformimidic Acid, Diazenediacetimidic Acid, Bis(diazenediformimidic acid), Bis(diazenediacetimidic acid), Poly(diazenediformimidic acid), and Poly(diazenediacetimidic acid), and derivatives thereof (N—N Tridentates and N—N Hexadentates) | RO—C(=NH)—N=N—C(=NH)—OR' for diazenediformimidic acid, and RO—C(=NH)—CR'R''—N=N—CR'''R''''—C(=NH)—OR'''' for diazenediacetimidic acid, where R, R', R'', R''', R'''', and R''''' represent H, $NH_2$, or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| N Valence Stabilizer #38: Diazenediformimidothioic Acid, Diazenediacetimidothioic Acid, Bis(diazenediformimidothioic acid), Bis(diazenediacetimidothioic acid), Poly(diazenediformimidothioic acid), and Poly(diazenediacetimidothioic acid), and derivatives thereof (N—N Tridentates and N—N Hexadentates) | RS—C(=NH)—N=N—C(=NH)—SR' for diazenediformimidothioic acid, and RS—C(=NH)—CR'R''—N=N—CR'''R''''—C(=NH)—SR''''' for diazenediacetimidothioic acid, where R, R', R'', R''', R'''', and R''''' represent H, $NH_2$, or any organic functional group wherein the number of carbon atoms ranges from 0 to 40, optionally having halogen or polarizing or water-insolubilizing/solubilizing groups attached. Ligand can also contain nonbinding N, O, S, or P atoms. |

TABLE 2-continued

Wide Band Organic Valence Stabilizers for the $Co^{+3}$ Ion

| General Structural Name (Type of Organic) | Structural Representation |
|---|---|
| N Valence Stabilizer #39: Diimidoyldiazenes, Bis(diimidoyldiazenes), and Poly(diimidoyldiazenes), (N—N Tridentates and N—N Hexadentates) | R—C(=NH)—N=N—C(=NH)—R'' or R—C(=NH)—CR'R''—N=N—CR'''R''''—C(=NH)—R''''', where R, R', R'', R''', R'''', and R''''' represent H, $NH_2$, or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| N Valence Stabilizer #40: Ortho-amino (or -hydrazido) Substituted Formazans, Bis(o-amino or -hydrazido substituted formazans), and Poly(o-amino or -hydrazido substituted formazans) (N—N Bidentates, N—N Tridentates, N—N Tetradentates, and N—N Hexadentates) | R—N=N—CR'=N—NR''R''', where R, R', R'', and R''' represent H, or any organic functional group wherein the number of carbon atoms ranges from 0 to 40, optionally having halogen or polarizing or water-insolubilizing/solubilizing groups attached. (Must include ortho-amine or hydrazide substituted aryl R derivatives, and beta-amine or hydrazide substituted alkyl R derivatives.) Ligand can also contain nonbinding N, O, S, or P atoms. |
| N Valence Stabilizer #41: Ortho-amino (or -hydrazido) Substituted Azines (including ketazines), Bis(o-amino or hydrazido substituted azines), and Poly(o-amino or hydrazido substituted azines) (N—N Bidentates, N—N Tridentates, N—N Tetradentates, and N—N Hexadentates) | RR'C=N—N=CR''R''' or RR'C=N—NR''R''' (for ketazines), where R, R', R'', and R''' represent H, or any organic functional group wherein the number of carbon atoms ranges from 0 to 40, optionally having halogen or polarizing or water-insolubilizing/solubilizing groups attached. (Must include ortho-amine or hydrazide substituted aryl R derivatives, and beta-amine or hydrazide substituted alkyl R derivatives.) Ligand can also contain nonbinding N, O, S, or P atoms. |
| N Valence Stabilizer #42: Schiff Bases with one Imine (C=N) Group and with ortho- or alpha- or beta-amino or imino or oximo or diazeno or hydrazido substitution (N—N Bidentates, N—N Tridentates, N—N Tetradentates, N—N Pentadentates, or N—N Hexadentates). Also includes hydrazones with ortho—N substitution. | RR'C=N—R'', where R, R', and R'' represent H, or any organic functional group wherein the number of carbon atoms ranges from 0 to 40, optionally having halogen or polarizing or water-insolubilizing/solubilizing groups attached. (Must contain ortho- or alpha- or beta-amino or imino or oximo or diazeno or hydrazido substitution.) Ligand can also contain nonbinding N, O, S, or P atoms. |
| N Valence Stabilizer #43: Schiff Bases with two Imine (C=N) Groups and without ortho- (for aryl constituents) or alpha- or beta- (for alkyl constituents) hydroxy, carboxy, carbonyl, thiol, mercapto, thiocarbonyl, amino, imino, oximo, diazeno, or hydrazido substitution (N—N Bidentates). Also includes dihydrazones. | RR'C=N—R''—N=CR'''R'''' or R—N=C—R'—C=N—R' or R<u>C=N—R'—N=C</u>R'', where R, R', R'', R''', and R'''' represent H, or any organic functional group wherein the number of carbon atoms ranges from 0 to 40, optionally having halogen or polarizing or water-insolubilizing/solubilizing groups attached. (Not including ortho-, alpha-, or beta-hydroxy, carboxy, carbonyl, thiol, mercapto, thiocarbonyl, amino, imino, oximo, diazeno, or hydrazido substitution.) Ligand can also contain nonbinding N, O, S, or P atoms. |
| N Valence Stabilizer #44: Schiff Bases with two Imine (C=N) Groups and with ortho- or alpha- or beta-amino or imino or oximo or diazeno or hydrazido substitution (N—N Tridentates, N—N Tetradentates, N—N Pentadentates, or N—N Hexadentates). Also includes hydrazones with ortho-N substitution. | RR'C=N—R''—N=CR'''R'''' or R—N=C—R'—C=N—R' or R<u>C=N—R'—N=C</u>R'', where R, R', R'', R''', and R'''' represent H, or any organic functional group wherein the number of carbon atoms ranges from 0 to 40, optionally having halogen or polarizing or water-insolubilizmg/solubilizing groups attached. (Must contain ortho- or alpha- or beta-amino or imino or oximo or diazeno or hydrazido substitution.) Ligand can also contain nonbinding N, O, S, or P atoms. |
| N Valence Stabilizer #45: Schiff Bases with three Imine (C=N) Groups and without ortho- (for aryl constituents) or alpha- or beta- (for alkyl constituents) hydroxy, carboxy, carbonyl, thiol, mercapto, thiocarbonyl, amino, imino, oximo, diazeno, or hydrazido substitution (N—N Tridentates). Also includes trihydrazones. | $N(—R—N=CR'R'')_3$, where R, R', and R'' represent H, or any organic functional group wherein the number of carbon atoms ranges from 0 to 40, optionally having halogen or polarizing or water-insolubilizing/solubilizing groups attached. (Not including ortho-, alpha-, or beta-hydroxy, carboxy, carbonyl, thiol, mercapto, thiocarbonyl, amino, imino, oximo, diazeno, or hydrazido substitution.) Ligand can also contain nonbinding N, O, S, or P atoms. |

TABLE 2-continued

Wide Band Organic Valence Stabilizers for the $Co^{+3}$ Ion

| General Structural Name (Type of Organic) | Structural Representation |
|---|---|
| N Valence Stabilizer #46: Schiff Bases with three Imine (C═N) Groups and with ortho- or alpha- or beta-amino or imino or oximo or diazeno or hydrazido substitution (N—N Tetradentates, N—N Pentadentates, or N—N Hexadentates) | N(—R—N═CR'R'')$_3$, where R, R', and R'' represent H, or any organic functional group wherein the number of carbon atoms ranges from 0 to 40, optionally having halogen or polarizing or water-insolubilizing/solubilizing groups attached. (Must contain ortho- or alpha- or beta-amino or imino or oximo or diazeno or hydrazido substitution.) Ligand can also contain nonbinding N, O, S, or P atoms. |
| S Valence Stabilizer #1: Macrocyclic, Macrobicyclic, and Macropolycyclic Oligothioketones (including Catapinands, Cryptands, Cyclidenes, and Sepulchrates) wherein all Binding Sites are composed of Thioketones (typically in the beta position) (S—S Bidentates, S—S Tetradentates, and S—S Hexadentates) | Macrocyclic ligands containing two, four, or six thioketone binding sites to valence stabilize the central metal ion. Can include other hydrocarbon or ring systems bound to this macrocyclic ligand, but they do not coordinate with the stabilized, high valence metal ion. This ligand and/or attached, uncoordinating hydrocarbons/rings may or may not have halogen or polarizing or water-insolubilizing/solubilizing groups attached. |
| S Valence Stabilizer #2: Macrocyclic, Macrobicyclic, and Macropolycyclic Dithiolenes (including Catapinands, Cryptands, Cyclidenes, and Sepulchrates) wherein all Binding Sites are composed of alpha, alpha dithiols (meaning two thiol groups on a single carbon atom in the ring) (S—S Bidentates, S—S Tetradentates, and S—S Hexadentates) | Macrocyclic ligands containing two, four, six, or eight 1,1-dithiolene binding sites to valence stabilize the central metal ion. Can include other hydrocarbon or ring systems bound to this macrocyclic ligand, but they do not coordinate with the stabilized, high valence metal ion. This ligand and/or attached, uncoordinating hydrocarbons/rings may or may not have halogen or polarizing or water-insolubilizing/solubilizing groups attached. |
| S Valence Stabilizer #3: Dithioimidodialdehydes, Dithiohydrazidodialdehydes (thioacyl thiohydrazides), Bis(dithioimidodialdehydes), Bis(dithiohydrazidodialdehydes), Poly(dithioimidodialdehydes), and Poly(dithiohydrazidodialdehydes) (S—S Bidentates, S—S Tridentates, S—S Tetradentates) | RC(═S)—NR'—C(═S)—R'' for dithioimidodialdehydes, and RC(═S)—NR'—NH—C(═S)—R'' for dithiohydrazidodialdehydes (thioacyl thiohydrazides), where R, R', and R'' represent H, $NH_2$, or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| S Valence Stabilizer #4: Dithioimidodicarbonic acids, Dithiohydrazidodicarbonic acids, Bis(dithioimidodicarbonic acids), Bis(dithiohydrazidodicarbonic acids), Poly(dithioimidodicarbonic acids), Poly(dithiohydrazidodicarbonic acids) and derivatives thereof (S—S Bidentates, S—S Tridentates, S—S Tetradentates) | R—O—C(═S)—NR'—C(═S)—O—R'' or R—S—C(═S)—NR'—C(═S)—S—R'' for dithioimidodicarbonic acids, and R—O—C(═S)—NR'—NH—C(═S)—O—R'' or R—S—C(═S)—NR'—NH—C(═S)—S—R'' for dithiohydrazidodicarbonic acids, where R, R', and R'' represent H, $NH_2$, or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| S Valence Stabilizer #5: 1,3-Dithioketones (Dithio-beta-ketonates), 1,3,5-Trithioketones, Bis(1,3-Dithioketones), and Poly(1,3-Dithioketones) (S—S Bidentates, S—S Tridentates, S—S Tetradentates) | R—C(═S)—CR'R''—C(═S)—R''' where R, R', R'', and R''' represent H, $NH_2$, or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| S Valence Stabilizer #6: 1,2-Dithioketones (Dithiolenes, Dithio-alpha-ketonates), 1,2,3-Trithioketones, Dithiotropolonates, ortho-Dithioquinones, Bis(1,2-Dithioketones), and Poly(1,2-Dithioketones) (S—S Bidentates, S—S Tridentates, S—S Tetradentates) | R—C(═S)—C(═S)—R' where R and R' represent H, $NH_2$, or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| S Valence Stabilizer #7: Dithiomalonamides (Dithiomalonodiamides), Bis(dithiomalonamides), and Polydithiomalonamides (S—S Bidentates, S— | RR'—N—C(═S)—CR''R'''—C(═S)—N—R''''R''''' where R, R', R'', R''',R'''', and R''''' represent H, $NH_2$, or any organic functional group wherein the number of carbon atoms ranges from 0 to 40, optionally having halogen or polarizing or |

TABLE 2-continued

Wide Band Organic Valence Stabilizers for the $Co^{+3}$ Ion

| General Structural Name (Type of Organic) | Structural Representation |
|---|---|
| S Tridentates, S—S Tetradentates) | water-insolubilizing/solubilizing groups attached. Ligand can also contain nonbinding N, O, S, or P atoms. |
| S Valence Stabilizer #8: 2-Thioacylthioacetamides, Bis(2-thioacylthioacetamides), and Poly(2-thioacylthioacetamides) (S—S Bidentates, S—S Tridentates, S—S Tetradentates) | RR'—N—C(=S)—CR"R'"—C(=S)—R"" where R, R', R", R'", and R"" represent H, $NH_2$, or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| S Valence Stabilizer #9: Dithioacyl sulfides, Bis(dithioacyl sulfides), and Poly(dithioacyl sulfides) (S—S Bidentates, S—S Tridentates, S—S Tetradentates) | R—C(=S)—S—C(=S)—R' where R and R' represent H or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| S Valence Stabilizer #10: Trithiodicarbonic Diamides, Bis(trithiodicarbonic diamides), and Poly(trithiodicarbonic diamides) (S—S Bidentates, S—S Tridentates, S—S Tetradentates) | RR'—N—C(=S)—S—C(=S)—N—R"R'" where R, R', R", and R'" represent H, $NH_2$ or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| S Valence Stabilizer #11: Pentathio-, Tetrathio-, or Trithiodicarbonic Acids, Bis(pentathio-, tetrathio-, or trithiodicarbonic acids), Poly(pentathio-, tetrathio-, or trithiodicarbonic acids), and derivatives thereof (S—S Bidentates, S—S Tridentates, S—S Tetradentates) | R—S—C(=S)—S—C(=S)—S—R' for pentathiodicarbonic acids, R—O—C(=S)—S—C(=S)—S—R' for tetrathiodicarbonic acids, and R—O—C(=S)—S—C(=S)—O—R' for pentathiodicarbonic acids, where R and R' represent H, $NH_2$ or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| S Valence Stabilizer #12: Dithiohypophosphoric Acids, Bis(dithiohypophosphoric acids), and Poly(dithiohypophosphoric acids), and derivatives thereof (S—S Bidentates, S—S Tridentates, S—S Tetradentates) | (R—O—)(R'—O—)P(=S)—P(=S)(—O—R")(—O—R'"); (R—O—)(R'—S—)P(=S)—P(=S)(—S—R")(—O—R'"); or (R—S—)(R'—S—)P(=S)—P(=S)(—S—R")(—S—R'"), where R, R', R", and R'" represent H, $NH_2$ or any organic functional group wherein the number of carbon atoms ranges from 0 to 40, optionally having halogen or polarizing or water-insolubilizing/solubilizing groups attached. Ligand can also contain nonbinding N, O, S, or P atoms. Note: these ligands are not to be confused with hypophosphorous acid derivatives (hypophosphites) (R—O—)R"R'"P(=O) which are very reducing and therefore unacceptable for stabilization of high valence states in metal ions. |
| S Valence Stabilizer #13: Dithiohypophosphoramides, Bis(dithiohypophosphoramides), and Poly(dithiohypophosphoramides) (S—S Bidentates, S—S Tridentates, S—S Tetradentates) | (RR'—N—)(R"R'"—N—)P(=S)—P(=S)(—N—R""R""")(—N—R"""R"""""), where R, R', R", R'", R"", R""", R""", and R""" represent H, $NH_2$ or any organic functional group wherein the number of carbon atoms ranges from 0 to 40, optionally having halogen or polarizing or water-insolubilizing/solubilizing groups attached. Ligand can also contain nonbinding N, O, S, or P atoms. Note: these ligands are not to be confused with hypophosphorous acid derivatives (hypophosphites) (R—O—)R"R'"P(=O) which are very reducing and therefore unacceptable for stabilization of high valence states in metal ions. |
| S Valence Stabilizer #14: Dithioimidodiphosphoric Acids, Dithiohydrazidodiphosphoric Acids, Bis(dithioimidodiphosphoric Acids), Bis(dithiohydrazidodiphosphoric Acids), Poly(dithioimidodiphosphoric Acids), Poly(dithiohydrazidodiphosphoric Acids), and derivatives thereof (S—S Bidentates, S—S | (R—O—)(R'—O—)P(=S)—NH—P(=S)(—O—R")(—O—R'"); (R—O—)(R'—S—)P(=S)—NH—P(=S)(—S—R")(—O—R'"); or (R—S—)(R'—S—)P(=S)—NH—P(=S)(—S—R")(—S—R'") for dithioimidodiphosphoric acids, and —NH—NH— derivatives for dithiohydrazidodiphosphoric acids, where R, R', R", and R'" represent H, $NH_2$ or any organic functional group wherein the number of carbon |

TABLE 2-continued

Wide Band Organic Valence Stabilizers for the $Co^{+3}$ Ion

| General Structural Name (Type of Organic) | Structural Representation |
|---|---|
| Tridentates, S—S Tetradentates) | atoms ranges from 0 to 40, optionally having halogen or polarizing or water-insolubilizing/solubilizing groups attached. Ligand can also contain nonbinding N, O, S, or P atoms. |
| S Valence Stabilizer #15: Dithioimidodiphosphoramides, Dithiohydrazidodiphosphoramides, Bis(dithioimidodiphosphoramides), Bis(dithiohydrazidodiphosphoramides), Poly(dithioimidodiphosphoramides), and Poly(dithiohydrazidodiphosphoramides) (S—S Bidentates, S—S Tridentates, S—S Tetradentates) | (RR'—N—)(R"R'"—N—)P(═S)—NH—P(═S)(—N—R""R""")(—N—R"""R""""") for dithioimidophosphoramides, and (RR'—N—)(R"R'"—N—)P(═S)—NH—NH—P(═S)(—N—R""R""")(—N—R"""R""""") for dithiohydrazidodiphosphoramides, where R, R', R", R'", R"", R""", R""", and R""""" represent H, $NH_2$ or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| S Valence Stabilizer #16: Dithiodiphosphoramides, Bis(dithioiphosphoramides), and Poly(dithiodiphosphoramides) (S—S Bidentates, S—S Tridentates, S—S Tetradentates) | (RR'—N—)(R"R'"—N—)P(═S)—S—P(═S)(—N—R""R""")(—N—R"""R""""), or (RR'—N—)(R"R'"—N—)P(═S)—O—P(═S)(—N—R""R""")(—N—R"""R""""), where R, R', R", R'", R"", R""", R""", and R""""" represent H, $NH_2$ or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| S Valence Stabilizer #17: Dithiodiphosphoric Acids, Bis(dithioiphosphoric Acids), Poly(dithiodiphosphoric Acids), and derivatives thereof (S—S Bidentates, S—S Tridentates, S—S Tetradentates) | (R—O—)(R'—O—)P(═S)—O—P(═S)(—O—R")(—O—R'"); (R—O—)(R'—O—)P(═S)—S—P(═S)(—O—R")(—O—R'"); (R—O—)(R'—S—)P(═S)—O—P(═S)(—S—R")(—O—R'"); (R—O—)(R'—S—)P(═S)—S—P(═S)(—S—R")(—O—R'"); or (R—S—)(R'—S—)P(═S)—S—P(═S)(—S—R")(—S—R'"), where R, R', R", R'", R"", R""", R""", and R""""" represent H, $NH_2$ or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| S Valence Stabilizer #18: Trithiophosphoric Acids (Phosphorotrithioic Acids), Bis(trithiophosphoric acids), Poly(trithiophosphoric acids), and derivatives thereof (S—S Bidentates, S—S Tridentates, S—S Tetradentates) | (O═)P(—S—R)(—S—R')(—S—R") or (S═)P(—S—R)(—S—R')(—O—R"), where R, R', and R" represent H, $NH_2$ or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| S Valence Stabilizer #19: Dithiophosphoric Acids (Phosphorodithioic Acids), Bis(dithiophosphoric acids), Poly(dithiophosphoric acids), and derivatives thereof (S—S Bidentates, S—S Tridentates, S—S Tetradentates) | (O═)P(—S—R)(—S—R')(—O—R") or (S═)P(—S—R)(—O—R')(—O—R"), where R, R', and R" represent H, $NH_2$ or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| S Valence Stabilizer #20: Tetrathiophosphoric Acids (Phosphorotetrathioic Acids), Bis(tetrathiophosphoric acids), Poly(tetrathiophosphoric acids), and derivatives thereof (S—S Bidentates, S—S Tridentates, S—S Tetradentates) | (S═)P(—S—R)(—S—R')(—S—R"), where R, R', and R" represent H, $NH_2$ or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| S Valence Stabilizer #21: Phosphoro(dithioperoxo)dithioic Acids, Bis[phosphoro(dithioperoxo)dithioic Acids], Poly[phosphoro(dithioperoxo)dithioic | (O═)P(—S—S—R)(—S—R')(—S—R") or (S═)P(—S—S—R)(—S—R')(—O—R"), where R, R', and R" represent H, $NH_2$ or any organic functional group wherein the number of carbon atoms ranges from 0 to 40, optionally having halogen |

TABLE 2-continued

Wide Band Organic Valence Stabilizers for the $Co^{+3}$ Ion

| General Structural Name (Type of Organic) | Structural Representation |
|---|---|
| Acids], and derivatives thereof (S—S Bidentates, S—S Tridentates, S—S Tetradentates) | or polarizing or water-insolubilizing/solubilizing groups attached. Ligand can also contain nonbinding N, O, S, or P atoms. |
| S Valence Stabilizer #22: Phosphoro(dithioperoxo)thioic Acids, Bis[phosphoro(dithioperoxo)thioic Acids], Poly[phosphoro(dithioperoxo)thioic Acids], and derivatives thereof (S—S Bidentates, S—S Tridentates, S—S Tetradentates) | (O═)P(—S—S—R)(—S—R')(—O—R") or (S═)P(—S—S—R)(—O—R')(—O—R"), where R, R', and R" represent H, $NH_2$ or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| S Valence Stabilizer #23: Phosphoro(dithioperoxo)trithioic Acids, Bis[phosphoro(dithioperoxo)trithioic Acids], Poly[phosphoro(dithioperoxo)trithioic Acids], and derivatives thereof (S—S Bidentates, S—S Tridentates, S—S Tetradentates) | (S═)P(—S—S—R)(—S—R')(—S—R"), where R, R', and R" represent H, $NH_2$ or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| S Valence Stabilizer #24: Beta-Mercaptothioketones, Beta-Mercaptothioaldehydes, Bis(beta-mercaptothioketones), Bis(beta-mercaptothioaldehydes), Poly(beta-mercaptothioketones), and Poly(beta-mercaptothioaldehydes) (S—S Bidentates, S—S Tridentates, S—S Tetradentates) | R—CR'(—SH)—$CH_2$—C(═S)—R", where R, R', and R" represent H, $NH_2$ or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| S Valence Stabilizer #25: N—(Aminomethylthiol)thioureas [N—(Aminomercaptomethyl)thioureas], Bis[N—(aminomethylthiol)thioureas], and Poly[N—(aminomethylthiol)thioureas] (S—S Bidentates, S—S Tridentates, S—S Tetradentates) | RR'—N—CH(—SH)—NR"—C(═S)—NR'"R"", where R, R', R", R'", and R"" represent H, $NH_2$ or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| S Valence Stabilizer #26: Dithiooxamides, Bis(dithiooxamides), and Poly(dithiooxamides) (S—S Bidentates, S—S Tridentates, S—S Tetradentates) | RR'—N—C(═S)—C(═S)—N—R"R'", where R, R', R", and R'" represent H, $NH_2$ or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| S Valence Stabilizer #27: 1,1-Dithiolates, Bis(1,1-dithiolates), and Poly(1,1-dithiolates) (S—S Bidentates and S—S Tetradentates) | RR'—C═C(—$S^-$)(—$S^-$), where R and R' represent H, $NH_2$ or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| S Valence Stabilizer #28: Dithiomonocarboxylic Acids, Tri- and Tetrathiodicarboxylic Acids, Bis(dithiomonocarboxylic Acids), Bis(tri- and tetrathiodicarboxylic acids), Poly(dithiomonocarboxylic acids), Poly(tri- and tetrathiodicarboxylic acids), and derivatives thereof (S—S Bidentates and S—S Tetradentates) | R—C(═S)(—S—R') for dithiomonocarboxylic acids, and (R—S—)(S═)C—R'—C(═S)(—S—R") for tri- and tetrathiodicarboxylic acids, where R, R', and R" represent H, $NH_2$ or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| S Valence Stabilizer #29: Perthiomonocarboxylic Acids, Perthiodicarboxylic Acids, Bis(perthiomonocarboxylic acids), Bis(perthiodicarboxylic acids), Poly(perthiomonocarboxylic acids), Poly(perthiodicarboxylic acids), and derivatives thereof (S—S Bidentates and S—S Tetradentates) | R—C(═S)(—S—S—R') for perthiomonocarboxylic acids, and (R—S—S—)(S═)C—R'—C(═S)(—S—S—R") for perthiodicarboxylic acids, where R, R', and R" represent H, $NH_2$ or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| S Valence Stabilizer #30: Dithiocarbonates, Trithiocarbonates, | R—S—C(═S)—O—R' or R—S—C(═O)—S—R' for dithiocarbonates, R—S—C(═S)—S—R' for |

TABLE 2-continued

Wide Band Organic Valence Stabilizers for the $Co^{+3}$ Ion

| General Structural Name (Type of Organic) | Structural Representation |
|---|---|
| Perthiocarbonates, Bis(dithiocarbonates), Bis(trithiocarbonates), and Bis(perthiocarbonates) (S—S Bidentates and S—S Tetradentates) | trithiocarbonates, and R—S—S—C(=S)—S—R' for perthiocarbonates, where R, and R' represent H, $NH_2$ or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| S Valence Stabilizer #31: Dithiocarbamates, Bis(dithiocarbamates), and Poly(dithiocarbamates) (including N—hydroxydithiocarbamates and N—mercaptodithiocarbamates) (S—S Bidentates, S—S Tridentates, and S—S Tetradentates) | RR'$N^+$=C(SH)(SH), where R and R' represent H, OH, SH, OR"(R" = $C_1$–$C_{30}$ alkyl or aryl), SR" (R" = $C_1$–$C_{30}$ alkyl or aryl), $NH_2$ or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| S Valence Stabilizer #32: Dithiocarbazates (Dithiocarbazides), Bis(dithiocarbazates), and Poly(dithiocarbazates) (S—S Bidentates, S—S Tridentates, and S—S Tetradentates; or possibly N—S Bidentates, N—S Tridentates, and N—S Tetradentates) | RR'N—NR"—C(=S)(SH), where R and R' represent H, $NH_2$ or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| N—S Valence Stabilizer #1: Diformamidine Disulfides (Thioperoxydicarbonimidic Diamides or Dihydrazides), Thioperoxytricarbonimidic Diamides or Dihydrazides, Thioperoxytetracarbonimidic Diamides or Dihydrazides, Bis(diformamidine disulfides), and Poly(diformamidine disulfides) (N—S Bidentates, N—S Tridentates, N—S Tetradentates) | RR'—N—C(=NH)—S—S—C(=NH)—NR"R'", where R, R', R", and R'" represent H, $NH_2$, or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| N—S Valence Stabilizer #2: S—Amidinodithiocarbamates, Bis(S—amidinodithiocarbamates), and Poly(S—amidinodithiocarbamates) (N—S Bidentates and N—S Tetradentates) | RR'—N—C(=NH)—S—CS—NR"R'", where R, R', R", and R'" represent H, $NH_2$ or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| N—S Valence Stabilizer #3: O-Amidinothiocarbamates, Bis(O-amidinothiocarbamates), and Poly(O-amidinothiocarbamates) (N—S Bidentates and N—S Tetradentates) | RR'—N—C(=NH)—O—CS—NR"R'", where R, R', R", and R'" represent H, $NH_2$ or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| N—S Valence Stabilizer #4: S-Amidinoperoxythiocarbamates, Bis(S-amidinoperoxythiocarbamates), and Poly(S-amidinoperoxythiocarbamates) (N—S Bidentates and N—S Tetradentates) | RR'—N—C(=NH)—S—S—CS—NR"R'", where R, R', R", and R'" represent H, $NH_2$ or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| N—S Valence Stabilizer #5: Phosphorimidothioic Acid; Phosphorimidodithioic Acid; Phosphorimidotrithioic Acid; Bis(Phosphorimidothioic Acid); Bis(Phosphorimidodithioic Acid); Bis(Phosphorimidotrithioic Acid); Poly(Phosphorimidothioic Acid); Poly(Phosphorimidodithioic Acid); Poly(Phosphorimidotrithioic Acid); and derivatives thereof (N—S Bidentates and N—S Tetradentates) | (NH=)P(—SR)(—OR')(—OR") for phosphorimidothioic acid, (NH=)P(—SR)(—SR')(—OR") for phosphorimidodithioic acid, (NH=)P(—SR)(—SR')(—SR") for phosphorimidotrithioic acid, where R, R', and R" represent H, $NH_2$ or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| N—S Valence Stabilizer #6: Phosphorothioic Triamides, Bis(phosphorothioic triamides), and | (S=)P(—NRR')(—NR"R'")(—NR""R""'), where R, R', R", R'", R"", and R""' represent H, $NH_2$ or any organic functional group wherein the |

TABLE 2-continued

Wide Band Organic Valence Stabilizers for the $Co^{+3}$ Ion

| General Structural Name (Type of Organic) | Structural Representation |
|---|---|
| Poly(phosphorothioic triamides) (N—S Bidentates and N—S Tetradentates) | number of carbon atoms ranges from 0 to 40, optionally having halogen or polarizing or water-insolubilizing/solubilizing groups attached. Ligand can also contain nonbinding N, O, S, or P atoms. |
| N—S Valence Stabilizer #7: Phosphoramidotrithioic Acid, Phosphorodiamidodithioic Acid, Bis(phosphoramidotrithioic acid), Bis(phosphorodiamidodithioic acid), poly(phosphoramidotrithioic acid), poly(phosphorodiamidodithioic acid), and derivatives thereof (N—S Bidentates and N—S Tetradentates) | (S═)P(—NRR')(—SR")(—SR'") for phosphoramidotrithioic acid, and (S═)P(—NRR')(—NR"R'")(—SR"") for phosphorodiamidodithioic acid, where R, R', R", R'", and R"" represent H, $NH_2$ or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| N—S Valence Stabilizer #8: Phosphoramidothioic Acid, Phosphoramidodithioic Acid, Phosphorodiamidothioic Acid, Bis(Phosphoramidothioic Acid), Bis(Phosphoramidodithioic Acid), Bis(Phosphorodiamidothioic Acid), Poly(Phosphoramidothioic Acid), Poly(Phosphoramidodithioic Acid), and Poly(Phosphorodiamidothioic Acid) (N—S Bidentates and N—S Tetradentates) | (O═)P(—NRR')(—SR")(—OR'") or (S═)P(—NRR')(—OR")(—OR'") for phosphoramidothioic acid; (O═)P(—NRR')(—SR")(—SR'") or (S═)P(—NRR')(—SR")(—OR'") for phosphoramidodithioic acid; (O═)P(—NRR')(—NR"R'")(—SR"") or (S═)P(—NRR')(—NR"R'")(—OR"") for phosphorodiamidothioic acid, where R, R', R", R'", and R"" represent H, $NH_2$ or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| N—S Valence Stabilizer #9: N-Thioacyl 7-Aminobenzylidenimines (N—S Bidentates or N—S Tetradentates) | R'—C(═S)—N═C(—R)(—NHR"), where R is an aromatic derivative (i.e., $—C_6H_5$), and R' and R" represent H, $NH_2$, or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| N—S Valence Stabilizer #10: Thiohydroxamates (Thiohydroxylamines), Bis(thiohydroxamates), and Poly(thiohydroxamates) (N—S Bidentates, N—S Tetradentates, and N—S Hexadentates) | R—C(═S)—NR'—OH or R—C(—SH)═N—OH, where R and R' represent H, $NH_2$, or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| N—S Valence Stabilizer #11: Alpha- or ortho-Aminothiocarboxylic Acids, and alpha- or ortho-Aminothiodicarboxylic Acids, and derivatives thereof (N—S Bidentates, N—S Tridentates, and N—S Tetradentates) | R—CH(—NHR')—C(═S)(—OH) or R—CH(—NHR')—C(═S)(—SH) for aminothiocarboxylic acids, and (HO—)(S═)C—CH(—NHR)—R'—CH(—NHR")—C(═S)(—OH) or (HS—)(S═)C—CH(—NHR)—R'—CH(—NHR")—C(═S)(—SH) for aminothiodicarboxylic acids, where R, R', and R" represent any organic functional group wherein the number of carbon atoms ranges from 1 to 40, optionally having halogen or polarizing or water-insolubilizing/solubilizing groups attached. Ligand can also contain nonbinding N, O, S, or P atoms. |
| N—S Valence Stabilizer #12: Thiosemicarbazones, Bis(thiosemicarbazones), and Poly(thiosemicarbazones) (N—S Bidentates, N—S Tetradentates, and N—S Hexadentates) | RR'—N—C(═S)—NR"—N═CR'"R"", where R, R', R", R'", and R"" represent H, or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| N—S Valence Stabilizer #13: Thioacyl hydrazones, Bis(thioacyl hydrazones), and Poly(thioacyl hydrazones) | R—C(═S)—NR'—N═CR"R'", where R, R', R", and R'" represent H, or any organic functional group wherein the number of carbon atoms |

TABLE 2-continued

Wide Band Organic Valence Stabilizers for the $Co^{+3}$ Ion

| General Structural Name (Type of Organic) | Structural Representation |
|---|---|
| (N—S Bidentates, N—S Tetradentates, and N—S Hexadentates) | ranges from 0 to 40, optionally having halogen or polarizing or water-insolubilizing/solubilizing groups attached. Ligand can also contain nonbinding N, O, S, or P atoms. |
| N—S Valence Stabilizer #14: Thiocarbazones (Diazenecarbothioic hydrazides), Bis(thiocarbazones), and Poly(thiocarbazones) (N—S Bidentates, N—S Tetradentates, and N—S Hexadentates) | R—N═N—C(═S)—NR'—NR"R'", where R, R', R", and R'" represent H, or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| N—S Valence Stabilizer #15: Azo compounds including triazenes with thiol or mercapto or thiocarbonyl substitution at the ortho- (for aryl) or alpha- or beta- (for alkyl) positions, Bis[o-(HS—) or alpha- or beta-(HS—)azo compounds], or Poly[o-(HS—) or alpha- or beta-(HS—)azo compounds) (N—S Bidentates, N—S Tridentates, N—S Tetradentates, or N—S Hexadentates) | R—N═N—R'for azo compounds, R—N═N—NH—R' for triazenes, where R, and R' represent H or any organic functional group wherein the number of carbon atoms ranges from 0 to 40, optionally having halogen or polarizing or water-insolubilizing/solubilizing groups attached. (Must include ortho-thio, mercapto, or thiocarbonyl substituted aryl azo compounds, and alpha- or beta-thio, mercapto, or thiocarbonyl alkyl azo compounds.) Ligand can also contain nonbinding N, O, S, or P atoms. |
| N—S Valence Stabilizer #16: Diazeneformothioamides, Diazeneacetothioamides, Bis(diazeneformothioamides), Bis(diazeneacetothioamides), Poly(diazeneformothioamides), and Poly(diazeneacetothioamides) (N—S Bidentates, N—S Tetradentates, and N—S Hexadentates) | R—N═N—C(═S)—NR'R" for diazeneformothioamides, and R—N═N—CR'R"—C(═S)—NR'"R"" for diazeneacetothioamides, where R, R', R", R'", and R"" represent H, $NH_2$, or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| N—S Valence Stabilizer #17: Diazenecarbothioic acids, Diazenecarbodithioic acids, Bis(diazenecarbothioic acids), Bis(diazenecarbodithioic acids), Poly(diazenecarbothioic acids), Poly(diazenecarbodithioic acids) and derivatives thereof (N—S Bidentates, N—S Tetradentates, N—S Hexadentates) | R—N═N—C(═S)—O—R' or R—N═N—CR'R"—C(═S)—O—R'" for diazenecarbothioic acids, and R—N═N—C(═S)—S—R' or R—N═N—CR'R"—C(═S)—S—R'" for diazenecarbodithoic acids, where R, R', R", and R'" represent H, $NH_2$, or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| N—S Valence Stabilizer #18: Diazeneformothioaldehydes, Diazeneacetothioaldehydes, Bis(diazeneformothioaldehydes), Bis(diazeneacetothioaldehydes), Poly(diazeneformothioaldehydes), and Poly(diazeneacetothioaldehydes) (N—S Bidentates, N—S Tetradentates and N—S Hexadentates) | R—N═N—C(═S)—R' for diazeneformothioaldehydes, and R—N═N—CR'R"—C(═S)—R'" for diazeneacetothioaldehydes, where R, R', R", and R'" represent H, $NH_2$, or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| N—S Valence Stabilizer #19: Diazenediformothioamides, Diazenediacetothioamides, Bis(diazenediformothioamides), Bis(diazenediacetothioamides), Poly(diazenediformothioamides), and Poly(diazenediacetothioamides) (N—S Tridentates and N—S Hexadentates) | RR'—N—C(═S)—N═N—C(═S)—NR"R'" or RR'—N—C(═S)—N═N—C(═O)—NR"R'" for diazenediformothioamides, and RR'—N—C(═S)—CR"R'"—N═N—CR""R""—C(═S)—NR"""R""" or RR'—N—C(═S)—CR"R'"—N═N—CR""R""—C(═O)—NR"""R""" for diazenediacetothioamides, where R, R', R", R'", R"", R""", R""", and R""" represent H, $NH_2$, or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| N—S Valence Stabilizer #20: Diazenedicarbothioic acids, Diazenedicarbodithioic acids, | R—O—C(═S)—N═N—C(═S)—O—R', R—O—C(═S)—CR'R"—N═N—CR'"R""—C(═S)—O—R""', R—O—C(═S)—N═N—C(═O)—O—R', or R—O—C(═S)— |

TABLE 2-continued

Wide Band Organic Valence Stabilizers for the $Co^{+3}$ Ion

| General Structural Name (Type of Organic) | Structural Representation |
|---|---|
| Bis(diazenedicarbothioic acids), Bis(diazenedicarbodithioic acids), Poly(diazenedicarbothioic acids), Poly(diazenedicarbodithioic acids) and derivatives thereof (N—S Tridentates and N—S Hexadentates) | CR'R''—N=N—CR'''R''''—C(=O)—O—R''''' for diazenedicarbothioic acids, and R—S—C(=S)—N=N—C(=S)—S—R' or R—S—C(=S)—CR'R''—N=N—CR'''R''''—C(=S)—S—R''''' for diazenedicarbodithioic acids, where R, R', R'', R''', R'''', and R''''' represent H, $NH_2$, or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| N—S Valence Stabilizer #21: Diazenediformothioaldehydes, Diazenediacetothioaldehydes, Bis(diazenediformothioaldehydes), Bis(diazenediacetothioaldehydes), Poly(diazenediformothioaldehydes), and Poly(diazenediacetothioaldehydes) (N—S Tridentates and N—S Hexadentates) | RC(=S)—N=N—C(=S)—R' or RC(=S)—N=N—C(=O)—R' for diazenediformothioaldehydes, and RC(=S)—CR'R''—N=N—CR'''R''''—C(=S)—R''''' or RC(=S)—CR'R''—N=N—CR'''R''''—C(=O)—R''''' for diazenediacetothioaldehydes, where R, R', R'', R''', R'''', and R''''' represent H, $NH_2$, or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| N—S Valence Stabilizer #22: Ortho-thio (or -mercapto) Substituted Formazans, Bis(o-thio or -mercapto substituted formazans), and Poly(o-thio or -mercapto substituted formazans) (N—S Bidentates, N—S Tridentates, N—S Tetradentates, and N—S Hexadentates) | R—N=N—CR'=N—NR''R''', where R, R', R'', and R''' represent H, or any organic functional group wherein the number of carbon atoms ranges from 0 to 40, optionally having halogen or polarizing or water-insolubilizing/solubilizing groups attached. (Must include ortho-thio or mercapto substituted aryl R derivatives, and beta-thio or mercapto substituted alkyl R derivatives.) Ligand can also contain nonbinding N, O, S, or P atoms. |
| N—S Valence Stabilizer #23: Ortho-thio (or -mercapto) Substituted Azines (including ketazines), Bis(o-thio or mercapto substituted azines), and Poly(o-thio or mercapto substituted azines) (N—S Bidentates, N—S Tridentates, N—S Tetradentates, and N—S Hexadentates) | RR'C=N—N=CR''R''' or RR'C=N—NR''R''' (for ketazines), where R, R', R'', and R''' represent H, or any organic functional group wherein the number of carbon atoms ranges from 0 to 40, optionally having halogen or polarizing or water-insolubilizing/solubilizing groups attached. (Must include ortho-thio or mercapto substituted aryl R derivatives, and beta-thio or mercapto substituted alkyl R derivatives.) Ligand can also contain nonbinding N, O, S, or P atoms. |
| N—S Valence Stabilizer #24: Schiff Bases with one Imine (C=N) Group and with ortho- or alpha- or beta-thio or mercapto or thiocarbonyl substitution (N—S Bidentates, N—S Tridentates, N—S Tetradentates, N—S Pentadentates, or N—S Hexadentates). Also includes Schiff Bases derived from the reaction of carbonyl compounds with dithiocarbazates, and hydrazones with ortho—S substitution. | RR'C=N—R'', where R, R', and R'' represent H, or any organic functional group wherein the number of carbon atoms ranges from 0 to 40, optionally having halogen or polarizing or water-insolubilizing/solubilizing groups attached. (Must contain ortho- or alpha- or beta-thio or mercapto or thiocarbonyl substitution.) Ligand can also contain nonbinding N, O, S, or P atoms. |
| N—S Valence Stabilizer #25: Schiff Bases with two Imine (C=N) Groups and with ortho- or alpha- or beta-thio or mercapto or thiocarbonyl substitution (N—S Tridentates, N—S Tetradentates, N—S Pentadentates, or N—S Hexadentates). Also includes Schiff Bases derived from the reaction of carbonyl compounds with dithiocarbazates, and hydrazones with ortho-S substitution. | RR'C=N—R''—N=CR'''R'''' or R—N=C—R'—C=N—R' or R<u>C=N—R'—N=C</u>R'', where R, R', R'', R''', and R'''' represent H, or any organic functional group wherein the number of carbon atoms ranges from 0 to 40, optionally having halogen or polarizing or water-insolubilizing/solubilizing groups attached. (Must contain ortho- or alpha- or beta-thio or mercapto or thiocarbonyl substitution.) Ligand can also contain nonbinding N, O, S, or P atoms. |
| N—S Valence Stabilizer #26: Schiff Bases with three Imine (C=N) Groups and with ortho- or alpha- or beta-thio or mercapto or thiocarbonyl substitution (N—S Tetradentates, N—S Pentadentates, or N—S Hexadentates). Also includes Schiff Bases derived from the | $N(—R—N=CR'R'')_3$, where R, R', and R'' represent H, or any organic functional group wherein the number of carbon atoms ranges from 0 to 40, optionally having halogen or polarizing or water-insolubilizing/solubilizing groups attached. (Must contain ortho- or alpha- or beta-thio or mercapto or thiocarbonyl |

TABLE 2-continued

Wide Band Organic Valence Stabilizers for the $Co^{+3}$ Ion

| General Structural Name (Type of Organic) | Structural Representation |
|---|---|
| reaction of carbonyl compounds with dithiocarbazates, and hydrazones with ortho-S substitution. | substitution.) Ligand can also contain nonbinding N, O, S, or P atoms. |
| N—S Valence Stabilizer #27: Thioalkyl Amines (Aminothiols or Aminodisulfides) and Thioalkyl Imines (Iminothiols or Iminodisulfides) (N—S Bidentates, N—S Tridentates, N—S Tetradentates, and N—S Hexadentates) | $[R—CR'(—NR''R''')]_x—R''''—[C(—SR'''')R'''''R''''''']_y$, $[R—CR'(—NR''R''')]_x—R''''—[C(—S—S—R'''')R'''''R''''''']_y$, or $[R—CR'(—NR''R''')]_x—R''''—[C(=S)R''''']_y$ for thioalkyl amines; and $[R—C(=NR')]_x—R''—[C(—SR''')R''''R''''']_y$, $[R—C(=NR')]_x—R''—[C(—SR''')R''''R''''']_y$, or $[R—C(=NR')]_x—R''—[C(=S)R''']_y$ for thioalkyl imines, where R, R', R'', R''', R'''', R''''', and R'''''' represent H, $NH_2$, or any organic functional group wherein the number of carbon atoms ranges from 0 to 40, optionally having halogen or polarizing or water-insolubilizing/solubilizing groups attached, and x and y = 1–6. Ligand can also contain nonbinding N, O, S, or P atoms. |
| N—S Valence Stabilizer #28: Thioaryl Amines and Thioaryl Imines (N—S Bidentates, N—S Tridentates, N—S Tetradentates, and N—S Hexadentates) | $[R(—NR'R'')(—SR''')]$, $[R(—NR'R'')(—S—S—R''')]$, $[R(—NR'R'')(—C(=S)R''')]$, $[R(—NR'R'')_x]_2S$, $[R(—NR'R'')_x]_{2-3}R'''(—SR'''')_y$, $[R(—SR')_x]_{2-3}R''(—NR'''R'''')_y$, $[R(—NR'R'')_x]_2S_2$, and $[R(—NR'R'')_x]_2R'''(C(=S))_yR''''$ for thioaryl amines; and $[R(—SR')_x]_2NH$ or $[R(—SR')_x]_2NHNH$ for thioaryl imines, where R, R', R'', R''', and R'''' represent H, $NH_2$, or any organic functional group wherein the number of carbon atoms ranges from 0 to 40, optionally having halogen or polarizing or water-insolubilizing/solubilizing groups attached, and x = 0–2 and y = 1–4. Ligand can also contain nonbinding N, O, S, or P atoms. |
| N—S Valence Stabilizer #29: Five-Membered Heterocyclic Rings containing One, Two, Three, or Four Nitrogen Atoms at least one additional Sulfur Atom Binding Site not in a Ring (N—S Bidentates, N—S Tridentates, N—S Tetradentates, or N—S Hexadentates) | Five membered heterocyclic ring(s) containing one, two, three, or four nitrogen atoms. In addition, ligand contains additional sulfur-containing substituents (usually thiols, mercaptans, disulfides, or thiocarbonyls) that constitute S binding sites. Can include other ring systems bound to the heterocyclic ring or to the S-containing substituent, but they do not coordinate with the stabilized, high valence metal ion. Ring(s) can also contain O, S, or P atoms. This 5-membered ring(s) and/or attached, uncoordinating rings and/or S-containing substituent(s) may or may not have halogen or polarizing or water-insolubilizing/solubilizing groups attached. |
| N—S Valence Stabilizer #30: Six-Membered Heterocyclic Rings containing One, Two, Three, or Four Nitrogen Atoms at least one additional Sulfur Atom Binding Site not in a Ring (N—S Bidentates, N—S Tridentates, N—S Tetradentates, or N—S Hexadentates) | Six membered heterocyclic ring(s) containing one, two, three, or four nitrogen atoms. In addition, ligand contains additional sulfur-containing substituents (usually thiols, mercaptans, disulfides, or thiocarbonyls) that constitute S binding sites. Can include other ring systems bound to the heterocyclic ring or to the S-containing substituent, but they do not coordinate with the stabilized, high valence metal ion. Ring(s) can also contain O, S, or P atoms. This 6-membered ring(s) and/or attached, uncoordinating rings and/or S-containing substituent(s) may or may not have halogen or polarizing or water-insolubilizing/solubilizing groups attached. |
| N—S Valence Stabilizer #31: Five-Membered Heterocyclic Rings containing One or Two Sulfur Atoms at least one additional Nitrogen Atom Binding Site not in a Ring (N—S Bidentates, N—S Tridentates, N—S Tetradentates, or N—S Hexadentates) | Five membered heterocyclic ring(s) containing one or two sulfur atoms. In addition, ligand contains additional nitrogen-containing substituents (usually amines, imines, or hydrazides) that constitute N binding sites. Can include other ring systems bound to the heterocyclic ring or to the N-containing substituent, but they do not coordinate with the stabilized, high valence metal ion. Ring(s) can also contain O, S, or P atoms. This 5-membered ring(s) and/or attached, uncoordinating rings and/or N-containing substituent(s) may or may |

TABLE 2-continued

Wide Band Organic Valence Stabilizers for the $Co^{+3}$ Ion

| General Structural Name (Type of Organic) | Structural Representation |
|---|---|
| | not have halogen or polarizing or water-insolubilizing/solubilizing groups attached. |
| N—S Valence Stabilizer #32: Six-Membered Heterocyclic Rings containing One or Two Sulfur Atoms at least one additional Nitrogen Atom Binding Site not in a Ring (N—S Bidentates, N—S Tridentates, N—S Tetradentates, or N—S Hexadentates) | Six membered heterocyclic ring(s) containing one or two sulfur atoms. In addition, ligand contains additional nitrogen-containing substituents (usually amines, imines, or hydrazides) that constitute N binding sites. Can include other ring systems bound to the heterocyclic ring or to the N-containing substituent, but they do not coordinate with the stabilized, high valence metal ion. Ring(s) can also contain O, S, or P atoms. This 6-membered ring(s) and/or attached, uncoordinating rings and/or N-containing substituent(s) may or may not have halogen or polarizing or water-insolubilizing/solubilizing groups attached. |
| N—S Valence Stabilizer #33: Five-Membered Heterocyclic Rings containing One, Two, Three, or Four Nitrogen Atoms at least one additional Sulfur Atom Binding Site in a Separate Ring (N—S Bidentates, N—S Tridentates, N—S Tetradentates) | Five membered heterocyclic ring(s) containing one, two, three, or four nitrogen atoms. In addition, ligand contains additional sulfur-containing rings that constitute S binding sites. Can include other ring systems bound to the N- or S-containing heterocyclic rings, but they do not coordinate with the stabilized, high valence metal ion. Ring(s) can also contain O, S, or P atoms. This 5-membered ring(s) and/or additional S-containing ring(s) and/or attached, uncoordinating rings may or may not have halogen or polarizing or water-insolubilizing/solubilizing groups attached. |
| N—S Valence Stabilizer #34: Six-Membered Heterocyclic Rings containing One, Two, Three, or Four Nitrogen Atoms at least one additional Sulfur Atom Binding Site in a Separate Ring (N—S Bidentates, N—S Tridentates, N—S Tetradentates) | Six membered heterocyclic ring(s) containing one, two, three, or four nitrogen atoms. In addition, ligand contains additional sulfur-containing rings that constitute S binding sites. Can include other ring systems bound to the N- or S-containing heterocyclic rings, but they do not coordinate with the stabilized, high valence metal ion. Ring(s) can also contain O, S, or P atoms. This 6-membered ring(s) and/or additional S-containing ring(s) and/or attached, uncoordinating rings may or may not have halogen or polarizing or water-insolubilizing/solubilizing groups attached. |
| N—S Valence Stabilizer #35: Two-, Three-, Four-, Six-, Eight-, and Ten-Membered Macrocyclics, Macrobicyclics, and Macropolycyclics (including Catapinands, Cryptands, Cyclidenes, and Sepulchrates) wherein all Binding Sites are composed of Nitrogen (usually amine or imine groups) or Sulfur (usually thiols, mercaptans, or thiocarbonyls) and are not contained in Component Heterocyclic Rings (N—S Bidentates, N—S Tridentates, N—S Tetradentates, and N—S Hexadentates) | Macrocyclic ligands containing two, three, four, six, eight, or ten binding sites composed of nitrogen and sulfur to valence stabilize the central metal ion. Can include other hydrocarbon or ring systems bound to this macrocyclic ligand, but they do not coordinate with the stabilized, high valence metal ion. This ligand and/or attached, uncoordinating hydrocarbons/rings may or may not have halogen or polarizing or water-insolubilizing/solubilizing groups attached. |
| N—S Valence Stabilizer #36: Four-, Six-, Eight-, or Ten-Membered Macrocyclics, Macrobicyclics, and Macropolycyclics (including Catapinands, Cryptands, Cyclidenes, and Sepulchrates) wherein all Binding Sites are composed of Nitrogen or Sulfur and are contained in Component Heterocyclic Rings (N—S Bidentates, N—S Tridentates, N—S Tetradentates, or N—S Hexadentates) | Macrocyclic ligands containing a total of four, six, eight, or ten heterocyclic rings containing nitrogen or sulfur binding sites. Can include other hydrocarbon/ring systems bound to this macrocyclic ligand, but they do not coordinate with the stabilized, high valence metal ion. This ligand and/or attached, uncoordinating hydrocarbon/rings may or may not have halogen or polarizing or water-insolubilizing groups attached. |
| N—S Valence Stabilizer #37: Four-, Six-, Eight-, or Ten-Membered Macrocyclics, Macrobicyclics, and Macropolycyclics (including Catapinands, Cryptands, Cyclidenes, and Sepulchrates) wherein all Binding Sites are composed of Nitrogen or Sulfur and are contained in a Combination of Heterocyclic Rings and Amine, Imine, Thiol, Mercapto, or Thiocarbonyl Groups (N—S Bidentates, N—S | Macrocyclic ligands containing at least one heterocyclic ring. These heterocyclic rings provide nitrogen or sulfur binding sites to valence stabilize the central metal ion. Other amine, imine, thiol, mercapto, or thiocarbonyl binding sites can also be included in the macrocyclic ligand, so long as the total number of binding sites is four, six, eight, or ten. Can include other hydrocarbon/ring systems bound to this macrocyclic ligand, but they do not |

TABLE 2-continued

Wide Band Organic Valence Stabilizers for the $Co^{+3}$ Ion

| General Structural Name (Type of Organic) | Structural Representation |
|---|---|
| Tridentates, N—S Tetradentates, or N—S Hexadentates) | coordinate with the stabilized, high valence metal ion. This ligand and/or attached, uncoordinating hydrocarbon/rings may or may not have halogen or polarizing or water-insolubilizing groups attached. |
| N—O Valence Stabilizer #1: N-Hydroxy(or N,N'-dihydroxy)amidines and N-Hydroxy(or N,N'-dihydroxy)diamidines (N—O Bidentates, N—O Tridentates, or N—O Tetradentates) | R'—N(—OH)—C(—R)═N—R", where R, R', and R" represent H or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| N—O Valence Stabilizer #2: Guanylureas, Guanidinoureas, Bis(guanylureas), Bis(guanidinoureas), Poly(guanylureas), and Poly(guanidinoureas) (N—O Bidentates and N—O Tetradentates) | RR'—N—C(═NH)—NR"—CO—NR'"R"" for guanylureas, and RR'—N—C(═NH)—NR"—NH—CO—NR'"R"" for guanidinoureas, where R, R', R", R'", and R"" represent H, $NH_2$, or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| N—O Valence Stabilizer #3: Amidinoamides, Guanidinoamides, Bis(amidinoamides), Bis(guanidinoamides), Poly(amidinoamides), and Poly(guanidinoamides) (including both N—amidinoamides and 2-amidinoacetamides) (N—O Bidentates and N—O Tetradentates) | RR'—N—C(═NH)—NR"—CO—R'" for N—amidinoamides, or RR'—N—C(═NH)—CR"R'"—CO—N—R""R"" for 2-amidinoacetamides, and RR'—N—C(═NH)—NR"—NH—CO—R'" for guanidinoamides, where R, R', R", R'", R"", and R"" represent H, $NH_2$, or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| N—O Valence Stabilizer #4: Imidoylamides, Bis(imidoylamides), and Poly(imidoylamides) (N—O Bidentates and N—O Tetradentates) | R—C(═NH)—NR'—CO—R", where R, R', and R", represent H or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| N—O Valence Stabilizer #5: O-Amidinocarbamates, Bis(O-amidinocarbamates), and Poly(O-amidinocarbamates) (N—O Bidentates and N—O Tetradentates) | RR'—N—C(═NH)—O—CO—NR"R'", where R, R', R", and R'" represent H, $NH_2$, or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| N—O Valence Stabilizer #6: S-Amidinothiocarbamates, Bis(S-amidinothiocarbamates), and Poly(S-amidinothiocarbamates) (N—O Bidentates and N—O Tetradentates) | RR'—N—C(═NH)—S—CO—NR"R'", where R, R', R", and R'" represent H, $NH_2$, or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| N—O Valence Stabilizer #7: Diimidosulfuric Acid, Bis(diimidosulfuric acid), and derivatives thereof (N—O Bidentates and N—O Tetradentates) | (NH═)(NH═)P(OR)(OR'), where R, R', and R" represent H, $NH_2$, or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| N—O Valence Stabilizer #8: Phosphorimidic Acid, Bis(phosphorimidic acid); and Poly(phosphorimidic acid), and derivatives thereof (N—O Bidentates) | (NH═)P(—OR)(—OR')(—OR"), where R, R', and R" represent H, $NH_2$, or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| N—O Valence Stabilizer #9: | (O═)P(—NRR')(—NR"R'")(—NR""R""), where R, |

TABLE 2-continued

Wide Band Organic Valence Stabilizers for the $Co^{+3}$ Ion

| General Structural Name (Type of Organic) | Structural Representation |
|---|---|
| Phosphoric Triamides, Bis(phosphoric triamides), and Poly(phosphoric triamides) (N—O Bidentates and N—O Tetradentates) | R', R'', R''', R'''', and R''''' represent H, $NH_2$, or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| N—O Valence Stabilizer #10: Phosphoramidic Acid, Phosphorodiamidic Acid, Bis(phosphoramidic acid), Bis(phosphorodiamidic acid), Poly(phosphoramidic acid), Poly(phosphorodiamidic acid), and derivatives thereof (N—O Bidentates and N—O Tetradentates) | (O═)P(—NRR')(—OR'')(—OR''') for phosphoramidic acid and (O═)P(—NRR')(—NR''R''')(—OR'''') for phosphorodiamidic acid, where R, R', R'', R''', and R'''' represent H, $NH_2$, or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| N—O Valence Stabilizer #11: N-Acyl 7-Aminobenzylidenimines (N—O Bidentates or N—O Tetradentates) | R'—C(═O)—N═C(—R)(—NHR''), where R is an aromatic derivative (i.e., —$C_6H_5$), and R' and R'' represent H, $NH_2$, or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| N—O Valence Stabilizer #12: Oximes, Dioximes, and Poly(oximes) (N—O Bidentates, N—O Tridentates, and N—O Tetradentates) | R—C(═NOH)—R' for oximes, and R—C(═NOH)—C(═NOH)—R' for dioximes, where R and R' represent H, $NH_2$, or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| N—O Valence Stabilizer #13: Carbonyl oximes, Bis(carbonyl oximes), and Poly(carbonyl oximes) (N—O Bidentates, N—O Tridentates, and N—O Tetradentates) | R—C(═O)—C(═NOH)—R', where R and R' represent H, $NH_2$, or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| N—O Valence Stabilizer #14: Imine oximes, Bis(imine oximes), and Poly(imine oximes) (including 2-Nitrogen heterocyclic oximes) (N—O Bidentates, N—O Tridentates, N—O Tetradentates, and N—O Hexadentates) | R—C(═N—R'')—C(═NOH)—R', where R, R', and R'' represent H, $NH_2$, or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| N—O Valence Stabilizer #15: Hydroxy oximes, Bis(hydroxy oximes), and Poly(hydroxy oximes) (including 2-Oxygen heterocyclic oximes) (N—O Bidentates, N—O Tridentates, N—O Tetradentates, and N—O Hexadentates) | R—CH(—OH)—C(═NOH)—R', where R, R', and R'' represent H, $NH_2$, or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| N—O Valence Stabilizer #16: Amino oximes, Bis(amino oximes), and Poly(amino oximes) (N—O Bidentates, N—O Tridentates, N—O Tetradentates, and N—O Hexadentates) | RR'—C(—NH—R'')—C(═NOH)—R''', where R, R', R'', and R''' represent H, $NH_2$, or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| N—O Valence Stabilizer #17: Amido oximes, Bis(amido oximes), and Poly(amido oximes) (N—O Bidentates, N—O Tridentates, N—O Tetradentates, and N—O Hexadentates) | RR'—N—C(═NOH)—R'', where R, R', and R'' represent H, $NH_2$, or any organic functional group wherein the number of carbon atoms ranges from 0 to 40, optionally having halogen or polarizing or water-insolubilizing/solubilizing groups attached. Ligand can also contain nonbinding N, O, S, or |

TABLE 2-continued

Wide Band Organic Valence Stabilizers for the $Co^{+3}$ Ion

| General Structural Name (Type of Organic) | Structural Representation |
|---|---|
| | P atoms. |
| N—O Valence Stabilizer #18: Azo oximes, Bis(azo oximes), and Poly(azo oximes) (N—O Bidentates, N—O Tridentates, N—O Tetradentates, and N—O Hexadentates). Also includes hydrazone oximes. | R—N=N—C(=NOH)—R' or RR'C=N—NR"—C(=NOH)—R'", where R, R', R", and R'" represent H, $NH_2$, or any organic functional group wherein the number of carbon atoms ranges from 0 to 40, optionally having halogen or polarizing or water-insolubilizing/solubilizing groups attached. (R is typically an aryl group.) Ligand can also contain nonbinding N, O, S, or P atoms. |
| N—O Valence Stabilizer #19: 2-Nitrosophenols (o-Quinone monoximes) (N—O Bidentates) | o-(ON—)(HO—)Ar, where Ar represents an aromatic group or heterocyclic wherein the number of carbon atoms ranges from 6 to 40, optionally having halogen or polarizing or water-insolubilizing/solubilizing groups attached. Ligand can also contain nonbinding N, O, S, or P atoms. |
| N—O Valence Stabilizer #20: 2-Nitrophenols (N—O Bidentates) | o-($O_2N$—)(HO—)Ar, where Ar represents an aromatic group or heterocyclic wherein the number of carbon atoms ranges from 6 to 40, optionally having halogen or polarizing or water-insolubilizing/solubilizing groups attached. Ligand can also contain nonbinding N, O, S, or P atoms. |
| N—O Valence Stabilizer #21: Hydroxamates (Hydroxylamines), Bis(hydroxamates), and Poly(hydroxamates) (N—O Bidentates, N—O Tetradentates, and N—O Hexadentates) | R—C(=O)—NR'—OH or R—C(—OH)=N—OH, where R and R' represent H, $NH_2$, or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| N—O Valence Stabilizer #22: N-Nitrosohydroxylamines, Bis(N-nitrosohydroxylamines), and Poly(N-nitrosohydroxylamines) (N—O Bidentates, N—O Tetradentates, and N—O Hexadentates) | R—N(—NO)—OH, where R represents any organic functional group wherein the number of carbon atoms ranges from 1 to 40, optionally having halogen or polarizing or water-insolubilizing/solubilizing groups attached. (R is typically an aryl or heterocyclic group.) Ligand can also contain nonbinding N, O, S, or P atoms. |
| N—O Valence Stabilizer #23: Amino Acids and ortho-Aminocarboxylic Acids, Peptides, Polypeptides, and Proteins [N—O Bidentates, N—O Tridentates, and N—O Tetradentates; possibly S—O dentates for sulfur-contg. examples such as penicillamine and cystine] | R—CH(—NHR')—C(=O)(—OH) for amino acids and ortho-aminocarboxylic acids, and R—CH(—NHR')—C(=O)—(NR"—)CH(—R'")—C(=O)(—OH) for peptides, where R, R', R", and R'" represent any organic functional group wherein the number of carbon atoms ranges from 1 to 40, optionally having halogen or polarizing or water-insolubilizing/solubilizing groups attached. Ligand can also contain nonbinding N, O, S, or P atoms. |
| N—O Valence Stabilizer #24: Amides, Bis(amides), and Poly(amides), including lactams (N—O Bidentates, N—O Tridentates, and N—O Tetradentates) | RCONR'R", where R, R', and R" represent H, $NH_2$, or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| N—O Valence Stabilizer #25: Semicarbazones, Bis(semicarbazones), and Poly(semicarbazones) (N—O Bidentates, N—O Tetradentates, and N—O Hexadentates) | RR'—N—C(=O)—NR"—N=CR'"R"", where R, R', R", R'", and R"" represent H, or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| N—O Valence Stabilizer #26: Acyl hydrazones, Bis(acyl hydrazones), and Poly(acyl hydrazones) (N—O Bidentates, N—O Tetradentates, and N—O Hexadentates) | R—C(=O)—NR'—N=CR"R'", where R, R', R", and R'" represent H, or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| N—O Valence Stabilizer #27: | R—N=N—C(=O)—NR'—N—R"R'", where R, R', R", |

TABLE 2-continued

Wide Band Organic Valence Stabilizers for the $Co^{+3}$ Ion

| General Structural Name (Type of Organic) | Structural Representation |
|---|---|
| Carbazones (Diazenecarboxylic hydrazides), Bis(carbazones), and Poly(carbazones) (N—O Bidentates, N—O Tetradentates, and N—O Hexadentates) | and R''' represent H, or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| N—O Valence Stabilizer #28: Azo compounds with hydroxyl or carboxy or carbonyl substitution at the ortho- (for aryl) or alpha- or beta- (for alkyl) positions, Bis[o-(HO—) or alpha- or beta-(HO—)azo compounds], or Poly[o-(HO—) or alpha- or beta-(HO—)azo compounds) (N—O Bidentates, N—O Tridentates, N—O Tetradentates, or N—O Hexadentates) | R—N=N—R', where R, and R' represent H or any organic functional group wherein the number of carbon atoms ranges from 0 to 40, optionally having halogen or polarizing or water-insolubilizing/solubilizing groups attached. (Must include ortho-hydroxy or carboxy or carbonyl substituted aryl azo compounds, and alpha- or beta-hydroxy or carboxy or carbonyl alkyl azo compounds.) Ligand can also contain nonbinding N, O, S, or P atoms. |
| N—O Valence Stabilizer #29: Diazeneformamides, Diazeneacetamides, Bis(diazeneformamides), Bis(diazeneacetamides), Poly(diazeneformamides), and Poly(diazeneacetamides) (N—O Bidentates, N—O Tetradentates, and N—O Hexadentates) | R—N=N—C(=O)—NR'R'' for diazeneformamides, and R—N=N—CR'R''—C(=O)—NR'''R'''' for diazeneacetamides, where R, R', R'', R''', and R'''' represent H, $NH_2$, or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| N—O Valence Stabilizer #30: Diazeneformic acids, Diazeneacetic acids, Bis(diazeneformic acids), Bis(diazeneacetic acids), Poly(diazeneformic acids), Poly(diazeneacetic acids), and derivatives thereof (N—O Bidentates, N—O Tetradentates, N—O Hexadentates) | R—N=N—C(=O)—O—R' for diazeneformic acid, and R—N=N—CR'R''—C(=O)—O—R''' for diazeneacetic acid, where R, R', R'', and R''' represent H, $NH_2$, or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| N—O Valence Stabilizer #31: Diazeneformaldehydes, Diazeneacetaldehydes, Bis(diazeneformaldehydes), Bis(diazeneacetaldehydes), Poly(diazeneformaldehydes), and Poly(diazeneacetaldehydes) (N—O Bidentates, N—O Tetradentates and N—O Hexadentates) | R—N=N—C(=O)—R' for diazeneformaldehydes, and R—N=N—CR'R''—C(=O)—R''' for diazeneacetaldehydes, where R, R', R'', and R''' represent H, $NH_2$, or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| N—O Valence Stabilizer #32: Diazenediformamides, Diazenediacetamides, Bis(diazenediformamides), Bis(diazenediacetamides), Poly(diazenediformamides), and Poly(diazenediacetamides) (N—O Tridentates and N—O Hexadentates) | RR'—N—C(=O)—N=N—C(=O)—NR''R''' for diazenediformamides, and RR'—N—C(=O)—CR''R'''—N=N—CR''''R'''''—C(=O)—NR''''''R''''''' for diazenediacetamides, where R, R', R'', R''', R'''', R''''', R'''''', and R''''''' represent H, $NH_2$, or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| N—O Valence Stabilizer #33: Diazenediformic acids, Diazenediacetic acids, Bis(diazenediformic acids), Bis(diazenediacetic acids), Poly(diazenediformic acids), Poly(diazenediacetic acids) and derivatives thereof (N—O Tridentates and N—O Hexadentates) | R—O—C(=O)—N=N—C(=O)—O—R' for diazenediformic acid, and R—O—C(=O)—CR'R''—N=N—CR'''R''''—C(=O)—O—R''''' for diazenediacetic acid, where R, R', R'', R''', R'''', and R''''' represent H, $NH_2$, or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| N—O Valence Stabilizer #34: Diazenediformaldehydes, Diazenediacetaldehydes, Bis(diazenediformaldehydes), Bis(diazenediacetaldehydes), | RC(=O)—N=N—C(=O)—R' for diazenediformaldehydes, and RC(=O)—CR'R''—N=N—CR'''R''''—C(=O)—R''''' for diazenediacetaldehydes, where R, R', R'', R''', R'''', and R''''' represent H, $NH_2$, or any organic |

TABLE 2-continued

Wide Band Organic Valence Stabilizers for the $Co^{+3}$ Ion

| General Structural Name (Type of Organic) | Structural Representation |
|---|---|
| Poly(diazenediformaldehydes), and Poly(diazenediacetaldehydes) (N—O Tridentates and N—O Hexadentates) | functional group wherein the number of carbon atoms ranges from 0 to 40, optionally having halogen or polarizing or water-insolubilizing/solubilizing groups attached. Ligand can also contain nonbinding N, O, S, or P atoms. |
| N—O Valence Stabilizer #35: Ortho-hydroxy (or -carboxy) Substituted Formazans, Bis(o-hydroxy or -carboxy substituted formazans), and Poly(o-hydroxy or -carboxy substituted formazans) (N—O Bidentates, N—O Tridentates, N—O Tetradentates, and N—O Hexadentates) | R—N=N—CR'=N—NR''R''', where R, R', R'', and R''' represent H, or any organic functional group wherein the number of carbon atoms ranges from 0 to 40, optionally having halogen or polarizing or water-insolubilizing/solubilizing groups attached. (Must include ortho-hydroxy or carboxy substituted aryl R derivatives, and beta-hydroxy or carboxy substituted alkyl R derivatives.) Ligand can also contain nonbinding N, O, S, or P atoms. |
| N—O Valence Stabilizer #36: Ortho-hydroxy (or -carboxy) Substituted Azines (including ketazines), Bis(o-hydroxy or carboxy substituted azines), and Poly(o-hydroxy or carboxy substituted azines) (N—O Bidentates, N—O Tridentates, N—O Tetradentates, and N—O Hexadentates) | RR'C=N—N=CR''R''' or RR'C=N—NR''R''' (for ketazines), where R, R', R'', and R''' represent H, or any organic functional group wherein the number of carbon atoms ranges from 0 to 40, optionally having halogen or polarizing or water-insolubilizing/solubilizing groups attached. (Must include ortho-hydroxy or carboxy substituted aryl R derivatives, and beta-hydroxy or carboxy substituted alkyl R derivatives.) Ligand can also contain nonbinding N, O, S, or P atoms. |
| N—O Valence Stabilizer #37: Schiff Bases with one Imine (C=N) Group and with ortho- or alpha- or beta-hydroxy or carboxy or carbonyl substitution (N—O Bidentates, N—O Tridentates, N—O Tetradentates, N—O Pentadentates, or N—O Hexadentates). Also includes hydrazones with ortho-O substitution. | RR'C=N—R'', where R, R', and R'' represent H, or any organic functional group wherein the number of carbon atoms ranges from 0 to 40, optionally having halogen or polarizing or water-insolubilizing/solubilizing groups attached. (Must contain ortho- or alpha- or beta-hydroxy or carboxy or carbonyl substitution.) Ligand can also contain nonbinding N, O, S, or P atoms. |
| N—O Valence Stabilizer #38: Schiff Bases with two Imine (C=N) Groups and with ortho- or alpha- or beta-hydroxy or carboxy or carbonyl substitution (N—O Tridentates, N—O Tetradentates, N—O Pentadentates, or N—O Hexadentates). Also includes hydrazones with ortho-O substitution. | RR'C=N—R''—N=CR'''R'''' or R—N=C—R'—C=N—R' or RC=N—R'—N=CR'', where R, R', R'', R''', and R'''' represent H, or any organic functional group wherein the number of carbon atoms ranges from 0 to 40, optionally having halogen or polarizing or water-insolubilizing/solubilizing groups attached. (Must contain ortho- or alpha- or beta-hydroxy or carboxy or carbonyl substitution.) Ligand can also contain nonbinding N, O, S, or P atoms. |
| N—O Valence Stabilizer #39: Schiff Bases with three Imine (C=N) Groups and with ortho- or alpha- or beta-hydroxy or carboxy or carbonyl substitution (N—O Tetradentates, N—O Pentadentates, or N—O Hexadentates). Also includes hydrazones with ortho-O substitution. | $N(—R—N=CR'R'')_3$, where R, R', and R'' represent H, or any organic functional group wherein the number of carbon atoms ranges from 0 to 40, optionally having halogen or polarizing or water-insolubilizing/solubilizing groups attached. (Must contain ortho- or alpha- or beta-hydroxy or carboxy or carbonyl substitution.) Ligand can also contain nonbinding N, O, S, or P atoms. |
| N—O Valence Stabilizer #40: Silylaminoalcohols (N—O Bidentates, N—O Tridentates, N—O Tetradentates, and N—O Hexadentates) | $[R—C(NR'R'')]_x—R''—[Si(—OR''')_zR''''_{3-z}]_y$ where R, R', R'', R''', and R'''' represent H, $NH_2$, or any organic functional group wherein the number of carbon atoms ranges from 0 to 40, optionally having halogen or polarizing or water-insolubilizing/solubilizing groups attached, and x and y = 1–6, z = 1–3. Ligand can also contain nonbinding N, O, S, or P atoms. |
| N—O Valence Stabilizer #41: Hydroxyalkyl Imines (Imino Alcohols) (N—O Bidentates, N—O Tridentates, N—O Tetradentates, and N—O Hexadentates) | $[R—C(=NR')]_x—R''—[C(—OR''')R''''R'''''']_y$ or $[R—C(=NR')]_x—R''—[C(=O)R''']_y$, where R, R', R'', R''', R'''', and R''''' represent H, $NH_2$, or any organic functional group wherein the number of carbon atoms ranges from 0 to 40, optionally having halogen or polarizing or water-insolubilizing/solubilizing groups attached, and x and y = 1–6. Ligand can also contain nonbinding N, O, S, or P atoms. |

TABLE 2-continued

Wide Band Organic Valence Stabilizers for the $Co^{+3}$ Ion

| General Structural Name (Type of Organic) | Structural Representation |
|---|---|
| N—O Valence Stabilizer #42: Hydroxyaryl Amines and Hydroxyaryl Imines (N—O Bidentates, N—O Tridentates, N—O Tetradentates, and N—O Hexadentates) | [R(—NR'R'')(—OR''')], [R(—NR'R'')(—C(=O)R''')], $[R(—NR'R'')_x]_2O$, $[R(—NR'R'')_x]_{2-3}R'''(—OR'''')_y$, $[R(—OR')_x]_{2-3}R''(—NR'''R'''')_y$, and $[R(—NR'R'')_x]_2R'''(C(=O))_yR''''$ for hydroxyaryl amines; and $[R(—OR')_x]_2NH$ or $[R(—OR')_x]_2NHNH$ for hydroxyaryl imines, where R, R', R'', R''', and R'''' represent H, $NH_2$, or any organic functional group wherein the number of carbon atoms ranges from 0 to 40, optionally having halogen or polarizing or water-insolubilizing/solubilizing groups attached, and x = 0–2 and y = 1–4. Ligand can also contain nonbinding N, O, S, or P atoms. |
| N—O Valence Stabilizer #43: Five-Membered Heterocyclic Rings containing One, Two, Three, or Four Nitrogen Atoms with at least one additional Oxygen Atom Binding Site not in a Ring (N—O Bidentates, N—O Tridentates, N—O Tetradentates, or N—O Hexadentates) | Five membered heterocyclic ring(s) containing one, two, three, or four nitrogen atoms. In addition, ligand contains additional oxygen-containing substituents (usually hydroxy, carboxy or carbonyl groups) that constitute O binding sites. Can include other ring systems bound to the heterocyclic ring or to the O-containing substituent, but they do not coordinate with the stabilized, high valence metal ion. Ring(s) can also contain O, S, or P atoms. This 5-membered ring(s) and/or attached, uncoordinating rings and/or O-containing substituent(s) may or may not have halogen or polarizing or water-insolubilizing/solubilizing groups attached. |
| N—O Valence Stabilizer #44: Six-Membered Heterocyclic Rings containing One, Two, Three, or Four Nitrogen Atoms with at least one additional Oxygen Atom Binding Site not in a Ring (N—O Bidentates, N—O Tridentates, N—O Tetradentates, or N—O Hexadentates) | Six membered heterocyclic ring(s) containing one, two, three, or four nitrogen atoms. In addition, ligand contains additional oxygen-containing substituents (usually hydroxy, carboxy, or carbonyl groups) that constitute O binding sites. Can include other ring systems bound to the heterocyclic ring or to the O-containing substituent, but they do not coordinate with the stabilized, high valence metal ion. Ring(s) can also contain O, S, or P atoms. This 6-membered ring(s) and/or attached, uncoordinating rings and/or O-containing substiruent(s) may or may not have halogen or polarizing or water-insolubilizing/solubilizing groups attached. |
| N—O Valence Stabilizer #45: Five-Membered Heterocyclic Rings containing One or Two Oxygen Atoms with at least one additional Nitrogen Atom Binding Site not in a Ring (N—O Bidentates, N—O Tridentates, N—O Tetradentates, or N—O Hexadentates) | Five membered heterocyclic ring(s) containing one or two oxygen atoms. In addition, ligand contains additional nitrogen-containing substituents (usually amines, imines, or hydrazides) that constitute N binding sites. Can include other ring systems bound to the heterocyclic ring or to the N-containing substituent, but they do not coordinate with the stabilized, high valence metal ion. Ring(s) can also contain O, S, or P atoms. This 5-membered ring(s) and/or attached, uncoordinating rings and/or N-containing substituent(s) may or may not have halogen or polarizing or water-insolubilizing/solubilizing groups attached. |
| N—O Valence Stabilizer #46: Six-Membered Heterocyclic Rings containing One or Two Oxygen Atoms with at least one additional Nitrogen Atom Binding Site not in a Ring (N—O Bidentates, N—O Tridentates, N—O Tetradentates, or N—O Hexadentates) | Six membered heterocyclic ring(s) containing one or two oxygen atoms. In addition, ligand contains additional nitrogen-containing substituents (usually amines, imines, or hydrazides) that constitute N binding sites. Can include other ring systems bound to the heterocyclic ring or to the N-containing substituent, but they do not coordinate with the stabilized, high valence metal ion. Ring(s) can also contain O, S, or P atoms. This 6-membered ring(s) and/or attached, uncoordinating rings and/or N-containing substituent(s) may or may not have halogen or polarizing or water-insolubilizing/solubilizing groups attached. |
| N—O Valence Stabilizer #47: Five-Membered Heterocyclic Rings containing One, Two, Three, or Four | Five membered heterocyclic ring(s) containing one, two, three, or four nitrogen atoms. In addition, ligand contains additional oxygen- |

TABLE 2-continued

Wide Band Organic Valence Stabilizers for the $Co^{+3}$ Ion

| General Structural Name (Type of Organic) | Structural Representation |
|---|---|
| Nitrogen Atoms with at least one additional Oxygen Atom Binding Site in a Separate Ring (N—O Bidentates, N—O Tridentates, N—O Tetradentates) | containing rings that constitute O binding sites. Can include other ring systems bound to the N- or O-containing heterocyclic rings, but they do not coordinate with the stabilized, high valence metal ion. Ring(s) can also contain O, S, or P atoms. This 5-membered ring(s) and/or additional O-containing ring(s) and/or attached, uncoordinating rings may or may not have halogen or polarizing or water-insolubilizing/solubilizing groups attached. |
| N—O Valence Stabilizer #48: Six-Membered Heterocyclic Rings containing One, Two, Three, or Four Nitrogen Atoms with at least one additional Oxygen Atom Binding Site in a Separate Ring (N—O Bidentates, N—O Tridentates, N—O Tetradentates) | Six membered heterocyclic ring(s) containing one, two, three, or four nitrogen atoms. In addition, ligand contains additional oxygen-containing rings that constitute O binding sites. Can include other ring systems bound to the N- or O-containing heterocyclic rings, but they do not coordinate with the stabilized, high valence metal ion. Ring(s) can also contain O, S, or P atoms. This 6-membered ring(s) and/or additional O-containing ring(s) and/or attached, uncoordinating rings may or may not have halogen or polarizing or water-insolubilizing/solubilizing groups attached. |
| N—O Valence Stabilizer #49: Two-, Three-, Four-, Six-, Eight-, and Ten-Membered Macrocyclics, Macrobicyclics, and Macropolycyclics (including Catapinands, Cryptands, Cyclidenes, and Sepulchrates) wherein all Binding Sites are composed of Nitrogen (usually amine or imine groups) or Oxygen (usually hydroxy, carboxy, or carbonyl groupss) and are not contained in Component Heterocyclic Rings (N—O Bidentates, N—O Tridentates, N—O Tetradentates, and N—O Hexadentates) | Macrocyclic ligands containing two, three, four, six, eight, or ten binding sites composed of nitrogen and oxygen to valence stabilize the central metal ion. Can include other hydrocarbon or ring systems bound to this macrocyclic ligand, but they do not coordinate with the stabilized, high valence metal ion. This ligand and/or attached, uncoordinating hydrocarbons/rings may or may not have halogen or polarizing or water-insolubilizing/solubilizing groups attached. |
| N—O Valence Stabilizer #50: Four-, Six-, Eight-, or Ten-Membered Macrocyclics, Macrobicyclics, and Macropolycyclics (including Catapinands, Cryptands, Cyclidenes, and Sepulchrates) wherein all Binding Sites are composed of Nitrogen or Oxygen and are contained in Component Heterocyclic Rings (N—O Bidentates, N—O Tridentates, N—O Tetradentates, or N—O Hexadentates) | Macrocyclic ligands containing a total of four, six, eight, or ten heterocyclic rings containing nitrogen or oxygen binding sites. Can include other hydrocarbon/ring systems bound to this macrocyclic ligand, but they do not coordinate with the stabilized, high valence metal ion. This ligand and/or attached, uncoordinating hydrocarbon/rings may or may not have halogen or polarizing or water-insolubilizing groups attached. |
| N—O Valence Stabilizer #51: Four-, Six-, Eight-, or Ten-Membered Macrocyclics, Macrobicyclics, and Macropolycyclics (including Catapinands, Cryptands, Cyclidenes, and Sepulchrates) wherein all Binding Sites are composed of Nitrogen or Oxygen and are contained in a Combination of Heterocyclic Rings and Amine, Imine, Hydroxy, Carboxy, or Carbonyl Groups (N—O Bidentates, N—O Tridentates, N—O Tetradentates, or N—O Hexadentates) | Macrocyclic ligands containing at least one heterocyclic ring. These heterocyclic rings provide nitrogen or oxygen binding sites to valence stabilize the central metal ion. Other amine, imine, hydroxy, carboxy, or carbonyl binding sites can also be included in the macrocyclic ligand, so long as the total number of binding sites is four, six, eight, or ten. Can include other hydrocarbon/ring systems bound to this macrocyclic ligand, but they do not coordinate with the stabilized, high valence metal ion. This ligand and/or attached, uncoordinating hydrocarbon/rings may or may not have halogen or polarizing or water-insolubilizing groups attached. |
| S—O Valence Stabilizer #1: 1,3-Monothioketones (Monothio-beta-ketonates), 1,3,5-Monothioketones, 1,3,5-Dithioketones, Bis(1,3-Monothioketones), and Poly(1,3-Monothioketones) (S—O Bidentates, S—O Tridentates, S—O Tetradentates) | R—C(═S)—CR'R''—C(═O)—R''' where R, R', R'', and R''' represent H, $NH_2$, or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| S—O Valence Stabilizer #2: Thiomalonamides (Thiomalonodiamides), Bis(thiomalonamides), and | RR'—N—C(═S)—CR''R'''—C(═O)—N—R''''R''''' where R, R', R'', R''', R'''', and R''''' represent H, $NH_2$, or any organic functional group wherein |

TABLE 2-continued

Wide Band Organic Valence Stabilizers for the $Co^{+3}$ Ion

| General Structural Name (Type of Organic) | Structural Representation |
|---|---|
| Polythiomalonamides (S—O Bidentates, S—O Tridentates, S—O Tetradentates) | the number of carbon atoms ranges from 0 to 40, optionally having halogen or polarizing or water-insolubilizing/solubilizing groups attached. Ligand can also contain nonbinding N, O, S, or P atoms. |
| S—O Valence Stabilizer #3: 2-Thioacylacetamides, 2-Acylthioacetamides, Bis(2-thioacylacetamides), Bis(2acylthioacetamides), Poly(2-thioacylacetamides), and Poly(2-Acylthioacetamides) (S—O Bidentates, S—O Tridentates, S—O Tetradentates) | RR'—N—C(═O)—CR"R'"—C(═S)—R"" for 2-thioacylacetamides, and RR'—N—C(═S)—CR"R'"—C(═O)—R"" for 2-acylthioacetamides, where R, R', R", R'", and R"" represent H, $NH_2$, or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| S—O Valence Stabilizer #4: Dithiodicarbonic Diamides, Bis(dithiodicarbonic diamides), and Poly(dithiodicarbonic diamides) (S—O Bidentates, S—O Tridentates, S—O Tetradentates) | RR'—N—C(═S)—S—C(═O)—N—R"R'" where R, R', R", and R'" represent H, $NH_2$ or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| S—O Valence Stabilizer #5: Monothiohypophosphoric Acids, Bis(monothiohypophosphoric acids), and Poly(monothiohypophosphoric acids), and derivatives thereof (S—O Bidentates, S—O Tridentates, S—O Tetradentates) | (R—O—)(R'—O—)P(═S)—P(═O)(—O—R")(—O—R'"); (R—O—)(R'—S—)P(═S)—P(═O)(—S—R")(—O—R'"); or (R—S—)(R'—S—)P(═S)—P(═O)(—S—R")(—S—R'"), where R, R', R", and R'" represent H, $NH_2$ or any organic functional group wherein the number of carbon atoms ranges from 0 to 40, optionally having halogen or polarizing or water-insolubilizing/solubilizing groups attached. Ligand can also contain nonbinding N, O, S, or P atoms. Note: these ligands are not to be confused with hypophosphorous acid derivatives (hypophosphites) (R—O—)R"R'"P(═O) which are very reducing and therefore unacceptable for stabilization of high valence states in metal ions. |
| S—O Valence Stabilizer #6: Monothiohypophosphoramides, Bis(monothiohypophosphoramides), and Poly(monothiohypophosphoramides) (S—O Bidentates, S—O Tridentates, S—O Tetradentates) | (RR'—N—)(R"R'"—N—)P(═S)—P(═O)(—N—R""R"")(—N—R"""R""""), where R, R', R", R'", R"", R"""", R""", and R""" represent H, $NH_2$ or any organic functional group wherein the number of carbon atoms ranges from 0 to 40, optionally having halogen or polarizing or water-insolubilizing/solubilizing groups attached. Ligand can also contain nonbinding N, O, S, or P atoms. Note: these ligands are not to be confused with hypophosphorous acid derivatives (hypophosphites) (R—O—)R"R'"P(═O) which are very reducing and therefore unacceptable for stabilization of high valence states in metal ions. |
| S—O Valence Stabilizer #7: Monothioimidodiphosphoric Acids, Monothiohydrazidodiphosphoric Acids, Bis(monothioimidodiphosphoric Acids), Bis(monothiohydrazidodiphosphoric Acids), Poly(monothioimidodiphosphoric Acid), Poly(monothiohydrazidodiphosphoric Acids), and derivatives thereof (S—O Bidentates, S—O Tridentates, S—O Tetradentates) | (R—O—)(R'—O—)P(═S)—NH—P(═O)(—O—R")(—O—R'"); (R—O—)(R'—S—)P(═S)—NH—P(═O)(—S—R")(—O—R'"); or (R—S—)(R'—S—)P(═S)—NH—P(═O)(—S—R")(—S—R'") for monothioimidodiphosphoric acids, and —NH—NH— derivatives for monothiohydrazidodiphosphoric acids, where R, R', R", and R'" represent H, $NH_2$ or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| S—O Valence Stabilizer #8: Monothioimidodiphosphoramides, Monothiohydrazidodiphosphoramides, Bis(monothioimidodiphosphoramides), Bis(monothiohydrazidodiphosphoramides), Poly(monothioimidodiphosphoramides), and Poly(monothiohydrazidodiphosphoramides) | (RR'—N—)(R"R'"—N—)P(═S)—NH—P(═O)(—N—R""R"")(—N—R"""R""""") for monothioimidodiphosphoramides, and —NH—NH— derivatives for monothiohydrazidodiphosphoramides, where R, R', R", R'", R"", R"""", R""""", and R"""" represent H, $NH_2$ or any organic functional group wherein the number of carbon atoms |

TABLE 2-continued

Wide Band Organic Valence Stabilizers for the $Co^{+3}$ Ion

| General Structural Name (Type of Organic) | Structural Representation |
|---|---|
| (S—O Bidentates, S—O Tridentates, S—O Tetradentates) | ranges from 0 to 40, optionally having halogen or polarizing or water-insolubilizing/solubilizing groups attached. Ligand can also contain nonbinding N, O, S, or P atoms. |
| S—O Valence Stabilizer #9: Monothiodiphosphoramides, Bis(monothioiphosphoramides), and Poly(monothiodiphosphoramides) (S—O Bidentates, S—O Tridentates, S—O Tetradentates) | (RR'—N—)(R"R'"—N—)P(═S)—S—P(═O)(—N—R""R""")(—N—R"""R""""), or (RR'—N—)(R"R'"—N—)P(═S)—O—P(═O)(—N—R""R""")(—N—R"""R""""), where R, R', R", R'", R"", R""", R""", and R"""" represent H, $NH_2$ or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| S—O Valence Stabilizer #10: Monothiodiphosphoric Acids, Bis(monothioiphosphoric Acids), Poly(monothiodiphosphoric Acids), and derivatives thereof (S—O Bidentates, S—O Tridentates, S—O Tetradentates) | (R—O—)(R'—O—)P(═S)—O—P(═O)(—O—R")(—O—R'"); (R—O—)(R'—O—)P(═S)—S—P(═O)(—O—R")(—O—R'"); (R—O—)(R'—S—)P(═S)—O—P(═O)(—S—R")(—O—R'"); (R—O—)(R'—S—)P(═S)—S—P(═O)(—S—R")(—O—R'"); or (R—S—)(R'—S—)P(═S)—S—P(═O)(—S—R")(—S—R'"), where R, R', R", R'", R"", R""", R""", and R"""" represent H, $NH_2$ or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| S—O Valence Stabilizer #11: Monothiocarbamates, Bis(monothiocarbamates), and Poly(monothiocarbamates) (including N-hydroxymonothiocarbamates and N-mercaptomonothiocarbamates) (S—O Bidentates, S—O Tridentates, and S—O Tetradentates) | $RR'N^{+}$═C(OH)(SH), where R and R' represent H, OH, SH, OR" (R"═$C_1$–$C_{30}$ alkyl or aryl), SR" (R"═$C_1$–$C_{30}$ alkyl or aryl), $NH_2$ or any organic functional group wherein the number of carbon atoms ranges from 0 to 40, optionally having halogen or polarizing or water-insolubilizing/solubilizing groups attached. Ligand can also contain nonbinding N, O, S, or P atoms. |

N Valence Stabilizer #1: Examples of monoamines (N monodentates) that meet the requirements for use as "wide band" valence stabilizers for $Co^{+3}$ include, but are not limited to: ammonia, ethylamine, n-dodecylamine, octylamine, phenylamine, cyclohexylamine, diethylamine, dioctylamine, diphenylamine, dicyclohexylamine, azetidine, hexamethylenetetramine (Urotropin), aziridine, azepine, pyrrolidine, benzopyrrolidine, dibenzopyrrolidine, naphthopyrrolidine, piperidine, benzopiperidine, dibenzopiperidine, naphthopiperidine, azacycloheptane (hexamethyleneimine), aminonorbornane, adamantanamine, aniline, benzylamine, toluidine, phenethylamine, xylidine, cumidine, naphthylamine, polyalkylamines, polyanilines, and fluorenediamine.

N Valence Stabilizer #2: Examples of diamines (N—N bidentates) that meet the requirements for use as "wide band" valence stabilizers for $Co^{+3}$ include, but are not limited to: hydrazine, phenylhydrazine, 1,1-diphenylhydrazine, 1,2-diphenylhydrazine (hydrazobenzene), methanediamine, ethylenediamine(1,2-ethanediamine, en), trimethylenediamine(1,3-propanediamine), putrescine (1,4-butanediamine), cadaverine (1,5-pentanediamine), hexamethylenediamine(1,6-hexanediamine), 2,3-diaminobutane, stilbenediamine(1,2-diphenyl-1,2-ethanediamine), cyclohexane-1,2-diamine, cyclopentane-1,2-diamine, 1,3-diazacyclopentane, 1,3-diazacyclohexane, piperazine, benzopiperazine, dibenzopiperazine, naphthopiperazine, diazepine, thiadiazepine, oxodiazepine, sparteine (lupinidine), 2-(aminomethyl)azacyclohexane, 2-(aminomethyl)piperidine, 2-(aminomethyl)pyrrolidine, 2-(aminomethyl)azetidine, 2-(2-aminoethyl)aziridine, 1,2-diaminobenzene, benzidine, bis(2,2'-piperazino)-1,2-ethene, 1,4-diazabicyclo[2.2.2]octane, naphthylethylenediamine, and 1,2-dianilinoethane.

N Valence Stabilizer #3: Examples of triamines (N—N bidentates or N—N tridentates) that meet the requirements for use as "wide band" valence stabilizers for $Co^{+3}$ include, but are not limited to: N-(2-aminoethyl)-1,2-ethanediamine (dien, 2,2-tri); N-(2-aminoethyl)-1,3-propanediamine (2,3-tri); N-(3aminopropyl)-1,3-propanediamine(3,3-tri, dpt); N-(3-aminopropyl)-1,4-butanediamine(3,4-tri, spermidine); N-(2-aminoethyl)-1,4-butanediamine(2,4-tri); N-(6-hexyl)-1,6-hexanediamine(6,6-tri); 1,3,5-triaminocyclohexane (tach); 2-(aminomethyl)-1,3-propanediamine(tamm); 2-(aminomethyl)-2-methyl-1,3-propanediamine(tame); 2-(aminomethyl)-2-ethyl-1,3-propanediamine(tamp); 1,2,3-triaminopropane (tap); 2,3-(2-aminoethyl)aziridine; 2,4-(aminomethyl)azetidine; 2,5-(aminomethyl)pyrrolidine; 2,6-(aminomethyl)piperidine; di(2-aminobenzyl)amine; hexahydro-1,3,5-triazine; hexahydro-2,4,6-trimethyl-1,3,5-triazine; and 1,3,5-tris(aminomethyl)benzene.

N Valence Stabilizer #4: Examples of tetramines (N—N bidentates, N—N tridentates, or N—N tetradentates) that meet the requirements for use as "wide band" valence stabilizers for $Co^{+3}$ include, but are not limited to: N,N'-(2-aminoethyl)-1,2-ethanediamine(2,2,2-tet, trien (triethylenetetramine)); N,N'-(2-aminoethyl)-1,3-propanediamine(2,3,2-tet, entnen); N,N'-(3-aminopropyl)-1,2-ethanediamine(3,2,3-tet, tnentn); N-(2-aminoethyl)-N'-(3-aminopropyl)-1,2-ethanediamine(2,2,3-tet); N-(2-aminoethyl)-N'-(3-aminopropyl)-1,3-propanediamine(3,3,2-tet); N,N'-(3-aminopropyl)-1,3-propanediamine(3,3,3-tet); N,N'-(3-aminopropyl)-1,4-butanediamine(3,4,3-tet, spermine); tri(aminomethyl)amine(tren); tri(2-aminoethyl)amine(trtn); tri(3-aminopropyl)amine(trbn); 2,2-aminomethyl-1,3-propanediamine(tam); 1,2,3,4-tetraminobutane(tab); N,N'-(2-aminophenyl)-1,2-ethanediamine; and N,N'-(2-aminophenyl)-1,3-propanediamine.

N Valence Stabilizer #5: Examples of pentamines (N—N bidentates, N—N tridentates, or N—N tetradentates) that meet the requirements for use as "wide band" valence stabilizers for $Co^{+3}$ include, but are not limited to: N-[N-(2-aminoethyl)-2-aminoethyl]-N'-(2-aminoethyl)-1,2-ethanediamine(2,2,2,2-pent, tetren); N-[N-(3-aminopropyl)-2-aminoethyl]-N'-(3-aminopropyl)-1,2-ethanediamine(3,2,2,3-pent); N-[N-(3-aminopropyl)-3-aminopropyl]-N'-(3-aminopropyl)-1,3-propanediamine(3,3,3,3-pent, caldopentamine); N-[N-(2-aminobenzyl)-2-aminoethyl]-N'-(2-aminopropyl)-1,2-ethanediamine; N-[N-(2-aminoethyl)-2-aminoethyl]-N,N-(2-aminoethyl)amine(trenen); and N-[N-(2-aminopropyl)-2-aminoethyl]-N,N-(2-aminoethyl)amine(4-Me-trenen).

N Valence Stabilizer #6: Examples of hexamines (N—N bidentates, N—N tridentates, N—N tetradentates, or N—N—N—N—N—N hexadentates) that meet the requirements for use as "wide band" valence stabilizers for $Co^{+3}$ include, but are not limited to: N,N'-[N-(2-aminoethyl)-2-aminoethyl]-1,2-ethanediamine(2,2,2,2,2-hex, linpen); N,N'-[N-(2-aminoethyl)-3-aminopropyl]-1,2-ethanediamine (2,3,2,3,2-hex); N,N,N',N'-(2-aminoethyl)-1,2-ethanediamine (penten, ten); N,N,N',N'-(2-aminoethyl)-1-methyl-1,2-ethanediamine(tpn, R-5-Me-penten); N,N,N',N'-(2-aminoethyl)-1,3-propanediamine(ttn); N,N,N',N'-(2-aminoethyl)-1,4-butanediamine(tbn); N,N,N',N'-(2-aminoethyl)-1,3-dimethyl-1,3-propanediamine(R,R-tptn, R,S-tptn); N-(2-aminoethyl)-2,2-[N-(2-aminoethyl)aminomethyl-1-propaneamine(sen); and N-(3-aminopropyl)-2,2-[N-(3-aminopropyl)aminomethyl-1-propaneamine(stn).

N Valence Stabilizer #7a: Examples of 5-membered heterocyclic rings containing one nitrogen atom (N monodentates) that meet the requirements for use as "wide band" valence stabilizers for $Co^{+3}$ include, but are not limited to: 1-pyrroline, 2-pyrroline, 3-pyrroline, pyrrole, oxazole, isoxazole, thiazole, isothiazole, azaphosphole, benzopyrroline, benzopyrrole (indole), benzoxazole, benzisoxazole, benzothiazole, benzisothiazole, benzazaphosphole, dibenzopyrroline, dibenzopyrrole (carbazole), dibenzoxazole, dibenzisoxazole, dibenzothiazole, dibenzisothiazole, naphthopyrroline, naphthopyrrole, naphthoxazole, naphthisoxazole, naphthothiazole, naphthisothiazole, naphthazaphosphole, and polypyrroles.

N Valence Stabilizer #7b: Examples of 5-membered heterocyclic rings containing two nitrogen atoms (N monodentates or N—N bidentates) that meet the requirements for use as "wide band" valence stabilizers for $Co^{+3}$ include, but are not limited to: pyrazoline, imidazoline, imidazole (ia), pyrazole, oxadiazole, thiadiazole, diazaphosphole, benzopyrazoline, benzimidazoline, benzimidazole (azindole)(bia)(bz), benzopyrazole (indazole), benzothiadiazole (piazthiole), benzoxadiazole (benzofurazan), naphthopyrazoline, naphthimidazoline, naphthimidazole, naphthopyrazole, naphthoxadiazole, naphthothiadiazole, polybenzimidazole, and polyimidazoles (e.g. polyvinylimidazole (pvi)).

N Valence Stabilizer #7c: Examples of 5-membered heterocyclic rings containing three nitrogen atoms (N monodentates, N—N bidentates) that meet the requirements for use as "wide band" valence stabilizers for $Co^{+3}$ include, but are not limited to: triazole, oxatriazole, thiatriazole, benzotriazole (bta), tolyltriazole (tt), naphthotriazole, and triazolophthalazine.

N Valence Stabilizer #7d: Examples of 5-membered heterocyclic rings containing four nitrogen atoms (N monodentates or N—N bidentates) that meet the requirements for use as "wide band" valence stabilizers for $Co^{+3}$ include, but are not limited to: tetrazole.

N Valence Stabilizer #8a: Examples of 6-membered heterocyclic rings containing one nitrogen atom (N monodentates) that meet the requirements for use as "wide band" valence stabilizers for $Co^{+3}$ include, but are not limited to: pyridine, picoline, lutidine, γ-collidine, oxazine, thiazine, azaphosphorin, quinoline, isoquinoline, benzoxazine, benzothiazine, benzazaphosphorin, acridine, phenanthridine, phenothiazine (dibenzothiazine), dibenzoxazine, dibenzazaphosphorin, benzoquinoline (naphthopyridine), naphthoxazine, naphthothiazine, naphthazaphosphorin, and polypyridines.

N Valence Stabilizer #8b: Examples of 6-membered heterocyclic rings containing two nitrogen atoms (N monodentates or N—N bidentates) that meet the requirements for use as "wide band" valence stabilizers for $Co^{+3}$ include, but are not limited to: pyrazine, pyridazine, pyrimidine, oxadiazine, thiadiazine, diazaphosphorin, quinoxaline (benzopyrazine), cinnoline (benzo[c]pyridazine), quinazoline (benzopyrimidine), phthalazine (benzo[d]pyridazine), benzoxadiazine, benzothiadiazine, phenazine (dibenzopyrazine), dibenzopyridazine, naphthopyrazine, naphthopyridazine, naphthopyrimidine, naphthoxadiazine, naphthothiadiazine, and polyquinoxalines.

N Valence Stabilizer #8c: Examples of 6-membered heterocyclic rings containing three nitrogen atoms (N monodentates or N—N bidentates) that meet the requirements for use as "wide band" valence stabilizers for $Co^{+3}$ include, but are not limited to: 1,3,5-triazine, 1,2,3-triazine, benzo-1,2,3-triazine, naphtho-1,2,3-triazine, oxatriazine, thiatriazine, melamine, and cyanuric acid.

N Valence Stabilizer #8d: Examples of 6-membered heterocyclic rings containing four nitrogen atoms (N monodentates or N—N bidentates) that meet the requirements for use as "wide band" valence stabilizers for $Co^{+3}$ include, but are not limited to: tetrazine.

N Valence Stabilizer #9a: Examples of 5-membered heterocyclic rings containing one nitrogen atom and having at least one additional nitrogen atom binding site not contained in a ring (N Monodentates, N—N Bidentates, N—N Tridentates, N—N Tetradentates, or N—N Hexadentates) that meet the requirements for use as "wide band" valence stabilizers for $Co^{+3}$ include, but are not limited to: 2-(aminomethyl)-3-pyrroline; 2,5-(aminomethyl)-3-pyrroline; 2-(aminomethyl)pyrrole; 2,5-(aminomethyl)pyrrole; 3-(aminomethyl)isoxazole; 2-(aminomethyl)thiazole; 3-(aminomethyl)isothiazole; 2-(aminomethyl)indole; 2-aminobenzoxazole; 2-aminobenzothiazole(abt); 1,8-diaminocarbazole;

2-amino-6-methyl-benzothiazole(amebt); 2-amino-6-methoxybenzothiazole(ameobt); and 1,3-diiminoisoindoline.

N Valence Stabilizer #9b: Examples of 5-membered heterocyclic rings containing two nitrogen atoms at least one additional nitrogen atom binding site not contained in a ring (N Monodentates, N—N Bidentates, N—N Tridentates, N—N Tetradentates, or N—N Hexadentates) that meet the requirements for use as "wide band" valence stabilizers for $Co^{+3}$ include, but are not limited to: 2-aminoimidazoline; 1-(3-aminopropyl)imidazoline; 2-aminoimidazole; 1-(3-aminopropyl)imidazole; 4-(2-aminoethyl)imidazole[histamine]; 1-alkyl-4-(2-aminoethyl)imidazole; 3-(2-aminoethyl)pyrazole; 3,5-(2-aminoethyl)pyrazole; 1-(aminomethyl) pyrazole; 2-aminobenzimidazole; 7-(2-aminoethyl) benzimidazole; 1-(3-aminopropyl)benzimidazole; 3-(2-aminoethyl)indazole; 3,7-(2-aminoethyl)indazole; 1-(aminomethyl)indazole; 7-aminobenzothiadiazole; 4-(2-aminoethyl)benzothiadiazole; 7-aminobenzoxadiazole; 4-(2-aminoethyl)benzoxadiazole; ethylenediaminetetra(1-pyrazolylmethane)[edtp]; methylenenitrilotris(2-(1-methyl) benzimidazole)[mntb][tris(1-methyl-2-benzimidazolylmethane)amine]; bis(alkyl-1-pyrazolylmethane)amine; bis (alkyl-2-(1-pyrazolyl)ethane)amine; bis(N,N-(2-benzimidazolyl)-2-aminoethane)(2-benzimidazolylmethane)amine; bis(1-(3,5-dimethyl) pyrazolylmethane)phenylamine; tris(2-(1-(3,5-dimethyl) pyrazolyl)ethane)amine; 5-(dimethylamino)pyrazole; 5-(dimethylaminomethyl)pyrazole; 2-amino-1,3,4-thiadiazole; and 1-(2-aminoethyl)imidazoline.

N Valence Stabilizer #9c: Examples of 5-membered heterocyclic rings containing three nitrogen atoms at least one additional nitrogen atom binding site not contained in a ring (N Monodentates, N—N Bidentates, N—N—N Tridentates, N—N—N—N Tetradentates, or N—N—N—N—N—N Hexadentates) that meet the requirements for use as "wide band" valence stabilizers for $Co^{+3}$ include, but are not limited to: 3-amino-1,2,4-triazole(ata); 3,5-diamino-1,2,4-triazole(dat); 5-amino-1,2,4-triazole; 3-(2-aminoethyl)-1,2,4-triazole; 5-(2-aminoethyl)-1,2,4-triazole; 3,5-(2-aminoethyl)-1,2,4-triazole; 1-(aminomethyl)-1,2,4-triazole; 3,5-(aminomethyl)-4-amino-1,2,4-triazole; 4-(2-aminoethyl)-1,2,3-triazole; 5-(2-aminoethyl)-1,2,3-triazole; 7-aminobenzotriazole; 1-(aminomethyl)-1,2,3-triazole; 1-(2-aminoethyl)-1,2,3-triazole; 4-(3-aminopropyl)benzotriazole; N-(benzotriazolylalkyl)amine; dibenzotriazole-1-ylalkylamine; bis(5-amino-1,2,4-triazol-3-yl); bis(5-amino-1,2,4-triazol-3-yl)alkanes; and 1-(aminomethyl) benzotriazole.

N Valence Stabilizer #9d: Examples of 5-membered heterocyclic rings containing four nitrogen atoms at least one additional nitrogen atom binding site not contained in a ring (N Monodentates, N—N Bidentates, N—N Tridentates, N—N Tetradentates, or N—N Hexadentates) that meet the requirements for use as "wide band" valence stabilizers for $Co^{+3}$ include, but are not limited to: 5-(2-aminoethyl)-1H-tetrazole; 1-(aminomethyl)-1H-tetrazole; and 1-(2-aminoethyl)-1H-tetrazole.

N Valence Stabilizer #10a: Examples of 6-membered heterocyclic rings containing one nitrogen atom and having at least one additional nitrogen atom binding site not contained in a ring (N Monodentates, N—N Bidentates, N—N Tridentates, N—N Tetradentates, or N—N Hexadentates) that meet the requirements for use as "wide band" valence stabilizers for $Co^{+3}$ include, but are not limited to: 2-aminopyridine; 2,6-diaminopyridine; 2-(aminomethyl)pyridine; 2,6-(aminomethyl)pyridine; 2,6-(aminoethyl)pyridine; 2-amino-4-picoline; 2,6-diamino-4-picoline; 2-amino-3,5-lutidine; 2-aminoquinoline; 8-aminoquinoline; 2-aminoisoquinoline; acriflavine; 4-aminophenanthridine; 4,5-(aminomethyl)phenothiazine; 4,5-(aminomethyl)dibenzoxazine; 10-amino-7,8-benzoquinoline; bis(2-pyridylmethane) amine; tris(2-pyridyl)amine; bis(4-(2-pyridyl)-3-azabutane) amine; bis(N,N-(2-(2-pyridyl)ethane)aminomethane)amine; 4-(N,N-dialkylaminomethyl)morpholine; 6-aminonicotinic acid; 8-aminoacridine; and 2-hydrazinopyridine.

N Valence Stabilizer #10b: Examples of 6-membered heterocyclic rings containing two nitrogen atoms at least one additional nitrogen atom binding site not contained in a ring (N Monodentates, N—N Bidentates, N—N Tridentates, N—N Tetradentates, or N—N Hexadentates) that meet the requirements for use as "wide band" valence stabilizers for $Co^{+3}$ include, but are not limited to: 2-aminopyrazine; 2,6-diaminopyrazine; 2-(aminomethyl)pyrazine; 2,6-(aminomethyl)pyrazine; 3-(aminomethyl)pyridazine; 3,6-(aminomethyl)pyridazine; 3,6-(2-aminoethyl)pyridazine; 1-aminopyridazine; 1-(aminomethyl)pyridazine; 2-aminopyrimidine; 1-(2-aminoethyl)pyrimidine; 2-aminoquinoxaline; 2,3-diaminoquinoxaline; 2-aminocinnoline; 3-aminocinnoline; 3-(2-aminoethyl)cinnoline; 3,8-(2-aminoethyl)cinnoline; 2-aminoquinazoline; 1-(2-aminoethyl) quinazoline; 1-aminophthalazine; 1,4-(2-aminoethyl)phthalazine; 1,8-(aminomethyl)phenazine; 2-amino-4,6-dimethylpyrimidine (admp); dihydralazine; and hydralazine.

N Valence Stabilizer #10c: Examples of 6-membered heterocyclic rings containing three nitrogen atoms at least one additional nitrogen atom binding site not contained in a ring (N Monodentates, N—N Bidentates, N—N Tridentates, N—N Tetradentates, or N—N Hexadentates) that meet the requirements for use as "wide band" valence stabilizers for $Co^{+3}$ include, but are not limited to: 2-amino-1,3,5-triazine; 2-(aminomethyl)-1,3,5-triazine; 2,6-(aminomethyl)-1,3,5-triazine; 1-(3-aminopropyl)-1,3,5-triazine; 1,5-(3-aminopropyl)-1,3,5-triazine, polymelamines; melamine; and altretamine.

N Valence Stabilizer #10d: Examples of 6-membered heterocyclic rings containing four nitrogen atoms at least one additional nitrogen atom binding site not contained in a ring (N Monodentates, N—N Bidentates, N—N Tridentates, N—N Tetradentates, or N—N Hexadentates) that meet the requirements for use as "wide band" valence stabilizers for $Co^{+3}$ include, but are not limited to: 3,6-(2-aminoethyl)-1,2,4,5-tetrazine; 3,6-(1,3-diamino-2-propyl)-1,2,4,5-tetrazine; and 4,6-(aminomethyl)-1,2,3,5-tetrazine.

N Valence Stabilizer #11a: Examples of 5-membered heterocyclic rings containing one nitrogen atom and having at least one additional nitrogen atom binding site contained in a ring (N Monodentates, N—N Bidentates, N—N Tridentates, N—N Tetradentates) that meet the requirements for use as "wide band" valence stabilizers for $Co^{+3}$ include, but are not limited to: 2,2'-bi-3-pyrroline; 2,2'-bi-2-pyrroline; 2,2'-bi-1-pyrroline; 2,2'-bipyrrole; 2,2',2"-tripyrrole; 3,3'-biisoxazole; 2,2'-bioxazole; 3,3'-biisothiazole; 2,2'-bithiazole; 2,2'-biindole; 2,2'-bibenzoxazole; 2,2'-bibenzothiazole; bilirubin; biliverdine; and 7-azaindole.

N Valence Stabilizer #11b: Examples of 5-membered heterocyclic rings containing two nitrogen atoms at least one additional nitrogen atom binding site contained in a ring (N Monodentates, N—N Bidentates, N—N Tridentates, N—N Tetradentates) that meet the requirements for use as "wide band" valence stabilizers for $Co^{+3}$ include, but are not limited to: 2,2'-bi-2-imidazoline[2,2'-bi-2-imidazolinyl][bimd]; 2,2'-biimidazole[2,2'-biimidazolyl][biim$H_2$]; 5,5'-bipyrazole; 3,3'-bipyrazole; 4,4'-bipyrazole[4,4'-bipyrazolyl][bpz]; 2,2'-bioxadiazole; 2,2'-bithiadiazole; 2,2'-bibenzimidazole; 7,7'-biindazole; 5,5'-bibenzofurazan; 5,5'-bibenzothiadiazole; bis-1,2-(2-benzimidazole)ethane; bis(2-benzimidazole)methane; 1,2-(2-imidazolyl)benzene; 2-(2-thiazolyl)benzimidazole; 2-(2-imidazolyl)benzimidazole; benzimidazotriazine; 4-azabenzimidazole; and 2,6-bis(2-benzimidazolyl)pyridine.

N Valence Stabilizer #11c: Examples of 5-membered heterocyclic rings containing three nitrogen atoms at least one additional nitrogen atom binding site contained in a ring (N Monodentates, N—N Bidentates, N—N Tridentates, N—N Tetradentates) that meet the requirements for use as "wide band" valence stabilizers for $Co^{+3}$ include, but are not limited to: 5,5'-bi-1,2,4-triazole[btrz]; 3,3'-bi-1,2,4-triazole; 1,1'-bi-1,2,4-triazole; 1,1'-bi-1,2,3-triazole; 5,5'-bi-1,2,3-triazole; 7,7'-bibenzotriazole; 1,1'-bibenzotriazole; bis(pyridyl)aminotriazole (pat); and 8-azaadenine.

N Valence Stabilizer #11d: Examples of 5-membered heterocyclic rings containing four nitrogen atoms at least one additional nitrogen atom binding site contained in a ring (N Monodentates, N—N Bidentates, N—N Tridentates, N—N Tetradentates) that meet the requirements for use as "wide band" valence stabilizers for $Co^{+3}$ include, but are not limited to: 5,5'-bi-1H-tetrazole; and 1,1'-bi-1H-tetrazole.

N Valence Stabilizer #12a: Examples of 6-membered heterocyclic rings containing one nitrogen atom and having at least one additional nitrogen atom binding site contained in a ring (N Monodentates, N—N Bidentates, N—N Tridentates, N—N Tetradentates) that meet the requirements for use as "wide band" valence stabilizers for $Co^{+3}$ include, but are not limited to: 2,2'-bipyridine[bipy]; 2,2',2"-tripyridine [terpyridine][terpy]; 2,2',2",2'"-tetrapyridine[tetrapy]; 6,6'-bi-2-picoline; 6,6'-bi-3-picoline; 6,6'-bi-4-picoline; 6,6'-bi-2,3-lutidine; 6,6'-bi-2,4-lutidine; 6,6'-bi-3,4-lutidine; 6,6'-bi-2,3,4-collidine; 2,2'-biquinoline; 2,2'-biisoquinoline; 3,3'-bibenzoxazine; 3,3'-bibenzothiazine; 1,10-phenanthroline [phen]; 1,8-naphthyridine; bis-1,2-(6-(2,2'-bipyridyl)) ethane; bis-1,3-(6-(2,2'-bipyridyl))propane; 3,5-bis(3-pyridyl)pyrazole; 3,5-bis(2-pyridyl)triazole; 1,3-bis(2-pyridyl)-1,3,5-triazine; 1,3-bis(2-pyridyl)-5-(3-pyridyl)-1,3,5-triazine; 2,7-(N,N'-di-2-pyridyl)diaminobenzopyrroline; 2,7-(N,N'-di-2-pyridyl)diaminophthalazine; 2,6-di-(2-benzothiazolyl)pyridine; triazolopyrimidine; 2-(2-pyridyl)imidazoline; 7-azaindole; 1-(2-pyridyl)pyrazole; (1-imidazolyl)(2-pyridyl)methane; 4,5-bis(N,N'-(2-(2-pyridyl)ethyl) iminomethyl)imidazole; bathophenanthroline; 4-(2-benzimidazolyl)quinoline; 1,2-bis(2-pyridyl)ethane; 4,4'-diphenyl-2,2'-dipyridyl; neocuproine; nicotine; and nornicotine.

N Valence Stabilizer #12b: Examples of 6-membered heterocyclic rings containing two nitrogen atoms at least one additional nitrogen atom binding site contained in a ring (N Monodentates, N—N Bidentates, N—N Tridentates, N—N Tetradentates) that meet the requirements for use as "wide band" valence stabilizers for $Co^{+3}$ include, but are not limited to: 2,2'-bipyrazine; 2,2',2"-tripyrazine; 6,6'-bipyridazine; bis(3-pyridazinyl)methane; 1,2-bis(3-pyridazinyl) ethane; 2,2'-bipyrimidine; 2,2'-biquinoxaline; 8,8'-biquinoxaline; bis(3-cinnolinyl)methane; bis(3-cinnolinyl) ethane; 8,8'-bicinnoline; 2,2'-biquinazoline; 4,4'-biquinazoline; 8,8'-biquinazoline; 2,2'-biphthalazine; 1,1'-biphthalazine; 2-(2-pyridyl)benzimidazole; 8-azapurine; purine; adenine; guanine; hypoxanthine; 2,6-bis(N,N'-(2-(4-imidazolyl)ethyl)iminomethyl)pyridine; 2-(N-(2-(4-imidazolyl)ethyl)iminomethyl)pyridine; adenine (aminopurine); purine; and 2,3-bis(2-pyridyl)pyrazine.

N Valence Stabilizer #12c: Examples of 6-membered heterocyclic rings containing three nitrogen atoms at least one additional nitrogen atom binding site contained in a ring (N Monodentates, N—N Bidentates, N—N Tridentates, N—N Tetradentates) that meet the requirements for use as "wide band" valence stabilizers for $Co^{+3}$ include, but are not limited to: 2,2'-bi-1,3,5-triazine; 2,2',2"-tri-1,3,5-triazine; 4,4'-bi-1,2,3-triazine; and 4,4'-bibenzo-1,2,3-triazine; 2,4,6-tris(2-pyridyl)-1,3,5-triazine; and benzimidazotriazines.

N Valence Stabilizer #12d: Examples of 6-membered heterocyclic rings containing four nitrogen atoms at least one additional nitrogen atom binding site contained in a ring (N Monodentates, N—N Bidentates, N—N Tridentates, N—N Tetradentates) that meet the requirements for use as "wide band" valence stabilizers for $Co^{+3}$ include, but are not limited to: 3,3'-bi-1,2,4,5-tetrazine; and 4,4'-bi-1,2,3,5-tetrazine.

N Valence Stabilizer #13a: Examples of two-membered macrocyclics, macrobicyclics, and macropolycyclics (including catapinands, cryptands, cyclidenes, and sepulchrates) wherein both binding sites are composed of nitrogen (usually amine or imine groups) and are not contained in component heterocyclic rings (N—N Bidentates) that meet the requirements for use as "wide band" valence stabilizers for $Co^{+3}$ include, but are not limited to: diazacyclobutane ([4]ane$N_2$); diazacyclopentane ([5]ane$N_2$); diazacyclohexane ([6]ane$N_2$); diazacycloheptane ([7]ane$N_2$); diazacyclooctane ([8]ane$N_2$); piperazine; benzopiperazine; diazacyclobutene ([4]ene$N_2$); diazacyclopentene ([5]ene$N_2$); diazacyclohexene ([6]ene$N_2$); diazacycloheptene ([7]ene$N_2$); diazacyclooctene ([8]ene$N_2$); diazacyclobutadiene ([4]diene$N_2$); diazacyclopentadiene ([5]diene$N_2$); diazacyclohexadiene ([6]diene$N_2$); diazacycloheptadiene ([7]diene$N_2$); and diazacyclooctadiene ([8]diene$N_2$).

N Valence Stabilizer #13b: Examples of three-membered macrocyclics, macrobicyclics, and macropolycyclics (including catapinands, cryptands, cyclidenes, and sepulchrates) wherein all binding sites are composed of nitrogen (usually amine or imine groups) and are not contained in component heterocyclic rings (N—N Tridentates) that meet the requirements for use as "wide band" valence stabilizers for $Co^{+3}$ include, but are not limited to: triazacyclohexane (including hexahydro-1,3,5-triazine)([6]ane$N_3$); triazacycloheptane ([7]ane$N_3$); triazacyclooctane ([8]ane$N_3$); triazacyclononane ([9]ane$N_3$); triazacyclodecane ([10]ane$N_3$); triazacycloundecane ([11]ane$N_3$); triazacyclododecane ([12]ane$N_3$); triazacyclohexene ([6]ene$N_3$); triazacycloheptene ([7]ene$N_3$); triazacyclooctene ([8]ene$N_3$); triazacyclononene ([9]ene$N_3$); triazacyclodecene ([10]ene$N_3$); triazacycloundecene ([11]ene$N_3$); triazacyclododecene ([12]ene$N_3$); triazacyclohexatriene ([6]triene$N_3$); triazacycloheptatriene ([7]triene$N_3$); triazacyclooctatriene ([8]triene$N_3$); triazacyclononatriene ([9]triene$N_3$); triazacyclodecatriene ([10]triene$N_3$); triazacycloundecatriene ([11]triene$N_3$); and triazacyclododecatriene ([12]triene$N_3$).

N Valence Stabilizer #13c: Examples of four-membered macrocyclics, macrobicyclics, and macropolycyclics (including catapinands, cryptands, cyclidenes, and sepulchrates) wherein all binding sites are composed of nitrogen (usually amine or imine groups) and are not contained in component heterocyclic rings (N—N Tetradentates) that meet the requirements for use as "wide band" valence stabilizers for $Co^{+3}$ include, but are not limited to: tetraazacyclooctane ([8]aneN$_4$); tetraazacyclononane ([9]aneN$_4$); tetraazacyclodecane ([10]aneN$_4$); tetraazacycloundecane ([11]aneN$_4$); tetraazacyclododecane ([12]aneN$_4$); tetraazacyclotridecane ([13]aneN$_4$); tetraazacyclotetradecane ([114]aneN$_4$); tetraazacyclopentadecane ([15]aneN$_4$); tetraazacyclohexadecane ([16]aneN$_4$); tetraazacycloheptadecane ([17]aneN$_4$); tetraazacyclooctadecane ([18]aneN$_4$); tetraazacyclononadecane ([19]aneN$_4$); tetraazacycloeicosane ([20]aneN$_4$); tetraazacyclooctadiene ([8]dieneN$_4$); tetraazacyclononadiene ([9]dieneN$_4$); tetraazacyclodecadiene ([10]dieneN$_4$); tetraazacycloundecadiene ([11]dieneN$_4$); tetraazacyclododecadiene ([12]dieneN$_4$); tetraazacyclotridecadiene ([13]dieneN$_4$); tetraazacyclotetradecadiene ([14]dieneN$_4$); tetraazacyclopentadecadiene ([15]dieneN$_4$); tetraazacyclohexadecadiene ([16]dieneN$_4$); tetraazacycloheptadecadiene ([17]dieneN$_4$); tetraazacyclooctadecadiene ([18]dieneN$_4$); tetraazacyclononadecadiene ([19]dieneN$_4$); tetraazacycloeicosadiene ([20]dieneN$_4$); tetraazacyclooctatetradiene ([8]tetradieneN$_4$); tetraazacyclononatetradiene ([9]tetradieneN$_4$); tetraazacyclodecatetradiene ([10]tetradieneN$_4$); tetraazacycloundecatetradiene ([11]tetradieneN$_4$); tetraazacyclododecatetradiene ([12]tetradieneN$_4$); tetraazacyclotridecatetradiene ([13]tetradieneN$_4$); tetraazacyclotetradecatetradiene ([14]tetradieneN$_4$); tetraazacyclopentadecatetradiene ([15]tetradieneN$_4$); tetraazacyclohexadecatetradiene ([16]tetradieneN$_4$); tetraazacycloheptadecatetradiene ([17]tetradieneN$_4$); tetraazacyclooctadecatetradiene ([18]tetradieneN$_4$); tetraazacyclononadecatetradiene ([19]tetradieneN$_4$); and tetraazacycloeicosatetradiene ([20]tetradieneN$_4$).

N Valence Stabilizer #13d: Examples of six-membered macrocyclics, macrobicyclics, and macropolycyclics (including catapinands, cryptands, cyclidenes, and sepulchrates) wherein all binding sites are composed of nitrogen (usually amine or imine groups) and are not contained in component heterocyclic rings (N—N Tridentates, N—N Tetradentates, or N—N Hexadentates) that meet the requirements for use as "wide band" valence stabilizers for $Co^{+3}$ include, but are not limited to: hexaazacyclododecane ([12]aneN$_6$); hexaazacyclotridecane ([13]aneN$_6$); hexaazacyclotetradecane ([14]aneN$_6$); hexaazacyclopentadecane ([15]aneN$_6$); hexaazacyclohexadecane ([16]aneN$_6$); hexaazacycloheptadecane ([17]aneN$_6$); hexaazacyclooctadecane ([18]aneN$_6$); hexaazacyclononadecane ([19]aneN$_6$); hexaazacycloeicosane ([20]aneN$_6$); hexaazacycloheneicosane ([21]aneN$_6$); hexaazacyclodocosane ([22]aneN$_6$); hexaazacyclotricosane ([23]aneN$_6$); hexaazacyclotetracosane ([24]aneN$_6$); hexaazacyclododecatriene ([12]trieneN$_6$); hexaazacyclotridecatriene ([13]trieneN$_6$); hexaazacyclotetradecatriene ([14]trieneN$_6$); hexaazacyclopentadecatriene ([15]trieneN$_6$); hexaazacyclohexadecatriene ([16]trieneN$_6$); hexaazacycloheptadecatriene ([17]trieneN$_6$); hexaazacyclooctadecatriene ([18]trieneN$_6$); hexaazacyclononadecatriene ([19]trieneN$_6$); hexaazacycloeicosatriene ([20]trieneN$_6$); hexaazacycloheneicosatriene ([21]trieneN$_6$); hexaazacyclodocosatriene ([22]trieneN$_6$); hexaazacyclotricosatriene ([23]trieneN$_6$); and hexaazacyclotetracosatriene ([24]trieneN$_6$).

N Valence Stabilizer #13e: Examples of eight-membered macrocyclics, macrobicyclics, and macropolycyclics (including catapinands, cryptands, cyclidenes, and sepulchrates) wherein all binding sites are composed of nitrogen (usually amine or imine groups) and are not contained in component heterocyclic rings (N—N Tridentates, N—N Tetradentates, or N—N Hexadentates) that meet the requirements for use as "wide band" valence stabilizers for $Co^{+3}$ include, but are not limited to: octaazacyclohexadecane ([16]aneN$_8$); octaazacycloheptadecane ([17]aneN8); octaazacyclooctadecane ([18]aneN$_8$); octaazacyclononadecane ([19]aneN8); octaazacycloeicosane ([20]aneN8); octaazacycloheneicosane ([21]aneN$_8$); octaazacyclodocosane ([22]aneN$_8$); octaazacyclotricosane ([23]aneN$_8$); octaazacyclotetracosane ([24]aneN8); octaazacyclohexadecatetradiene ([16]tetradieneN$_8$); octaazacycloheptadecatetradiene ([17]tetradieneN$_8$); octaazacyclooctadecatetradiene ([18]tetradieneN$_8$); octaazacyclononadecatetradiene ([19]tetradieneN$_8$); octaazacycloeicosatetradiene ([20]tetradieneN$_8$); octaazacycloheneicosatetradiene ([21]tetradieneN$_8$); octaazacyclodocosatetradiene ([22]tetradieneN$_8$); octaazacyclotricosatetradiene ([23]tetradieneN$_8$); and octaazacyclotetracosatetradiene ([24]tetradieneN$_8$).

N Valence Stabilizer #13f: Examples of ten-membered macrocyclics, macrobicyclics, and macropolycyclics (including catapinands, cryptands, cyclidenes, and sepulchrates) wherein all binding sites are composed of nitrogen (usually amine or imine groups) and are not contained in component heterocyclic rings (N—N Tridentates, N—N Tetradentates, or N—N Hexadentates) that meet the requirements for use as "wide band" valence stabilizers for $Co^{+3}$ include, but are not limited to: decaazacycloeicosane ([20]aneN$_{10}$); decaazacycloheneicosane ([21]aneN$_{10}$); decaazacyclodocosane ([22]aneN$_{10}$); decaazacyclotricosane ([23]aneN$_{10}$); decaazacyclotetracosane ([24]aneN$_{10}$); decaazacyclopentacosane ([25]aneN$_{10}$); decaazacyclohexacosane ([26]aneN$_{10}$); decaazacycloheptacosane ([27]aneN$_{10}$); decaazacyclooctacosane ([28]aneN$_{10}$); decaazacyclononacosane ([29]aneN$_{10}$); decaazacyclotriacontane ([30]aneN$_{10}$); decaazacycloeicosapentadiene ([20]pentadieneN$_{10}$); decaazacycloheneicosapentadiene ([21]pentadieneN$_{10}$); decaazacyclodocosapentadiene ([22]pentadieneN$_{10}$); decaazacyclotricosapentadiene ([23]pentadieneN$_{10}$); decaazacyclotetracosapentadiene ([24]pentadieneN$_{10}$); decaazacyclopentacosapentadiene ([25]pentadieneN$_{10}$); decaazacyclohexacosapentadiene ([26]pentadieneN$_{10}$); decaazacycloheptacosapentadiene ([27]pentadieneN$_{10}$); decaazacyclooctacosapentadiene ([28]pentadieneN$_{10}$); decaazacyclononacosapentadiene ([29]pentadieneN$_{10}$); and decaazacyclotriacontapentadiene ([30]pentadieneN$_{10}$).

N Valence Stabilizer #14a: Examples of four-membered macrocyclics, macrobicyclics, and macropolycyclics (including catapinands, cryptands, cyclidenes, and sepulchrates) wherein all four binding sites are composed of nitrogen and are contained in component 5-membered heterocyclic rings (N—N Tetradentates) that meet the requirements for use as "wide band" valence stabilizers for $Co^{+3}$ include, but are not limited to: porphyrins (including tetraphenylporphine (tpp); "picket fence" porphyrins, "picket tail" porphyrins, "bispocket" porphyrins, "capped" porphyrins, cyclophane porphyrins, "pagoda" porphyrins, "pocket" porphyrins, "pocket tail" porphyrins, cofacial diporphyrins, "strapped" porphyrins, "hanging base" porphyrins, bridged porphyrins, chelated mesoporphyrins, homoporphyrins, chlorophylls, and pheophytins); porphodimethanes; porphyrinogens; chlorins; bacteriochlorins; isobacteriochlorins; corroles; corrins and corrinoids; didehydrocorrins; tetradehydrocorrins; hexadehydrocorrins; octadehydrocorrins; tetraoxazoles; tetraisooxazoles;

tetrathiazoles; tetraisothiazoles; tetraazaphospholes; tetraimidazoles; tetrapyrazoles; tetraoxadiazoles; tetrathiadiazoles; tetradiazaphospholes; tetratriazoles; tetraoxatriazoles; tetrathiatriazoles; coproporphyrin; etioporphyrin; and hematoporphyrin.

N Valence Stabilizer #14b: Examples of six-membered macrocyclics, macrobicyclics, and macropolycyclics (including catapinands, cryptands, cyclidenes, and sepulchrates) wherein all six binding sites are composed of nitrogen and are contained in component 5-membered heterocyclic rings (N—N Tridentates, N—N Tetradentates, or N—N Hexadentates) that meet the requirements for use as "wide band" valence stabilizers for $Co^{+3}$ include, but are not limited to: hexaphyrins (hexapyrroles); hexaoxazoles; hexaisooxazoles; hexathiazoles; hexaisothiazoles; hexaazaphospholes; hexaimidazoles; hexapyrazoles; hexaoxadiazoles; hexathiadiazoles; hexadiazaphospholes; hexatriazoles; hexaoxatriazoles; and hexathiatriazoles.

N Valence Stabilizer #14c: Examples of eight-membered macrocyclics, macrobicyclics, and macropolycyclics (including catapinands, cryptands, cyclidenes, and sepulchrates) wherein all eight binding sites are composed of nitrogen and are contained in component 5-membered heterocyclic rings (N—N Tridentates, N—N Tetradentates, or N—N Hexadentates) that meet the requirements for use as "wide band" valence stabilizers for $Co^{+3}$ include, but are not limited to: octaphyrins (octapyrroles); octaoxazoles; octaisooxazoles; octathiazoles; octaisothiazoles; octaazaphospholes; octaimidazoles; octapyrazoles; octaoxadiazoles; octathiadiazoles; octadiazaphospholes; octatriazoles; octaoxatriazoles; and octathiatriazoles.

N Valence Stabilizer #14d: Examples of ten-membered macrocyclics, macrobicyclics, and macropolycyclics (including catapinands, cryptands, cyclidenes, and sepulchrates) wherein all ten binding sites are composed of nitrogen and are contained in component 5-membered heterocyclic rings (N—N Tridentates, N—N Tetradentates, or N—N Hexadentates) that meet the requirements for use as "wide band" valence stabilizers for $Co^{+3}$ include, but are not limited to: decaphyrins (decapyrroles); decaoxazoles; decaisooxazoles; decathiazoles; decaisothiazoles; decaazaphospholes; decaimidazoles; decapyrazoles; decaoxadiazoles; decathiadiazoles; decadiazaphospholes; decatriazoles; decaoxatriazoles; and decathiatriazoles.

N Valence Stabilizer #15a: Examples of four-membered macrocyclics, macrobicyclics, and macropolycyclics (including catapinands, cryptands, cyclidenes, and sepulchrates) wherein all four binding sites are composed of nitrogen and are contained in a combination of 5-membered heterocyclic rings and amine or imine groups (N—N Tetradentates) that meet the requirements for use as "wide band" valence stabilizers for $Co^{+3}$ include, but are not limited to: porphyrazines; octahydrodiazaporphyrins; phthalocyanines; naphthalocyanines; anthracocyanines; and tetraazaporphyrins N Valence Stabilizer #15b: Examples of six-membered macrocyclics, macrobicyclics, and macropolycyclics (including catapinands, cryptands, cyclidenes, and sepulchrates) wherein all six binding sites are composed of nitrogen and are contained in a combination of 5-membered heterocyclic rings and amine or imine groups (N—N Tridentates, N—N Tetradentates, or N—N Hexadentates) that meet the requirements for use as "wide band" valence stabilizers for $Co^{+3}$ include, but are not limited to: diazahexaphyrins; tetraazahexaphyrins; hexaazahexaphyrins; diazahexapyrazoles; tetraazahexapyrazoles; hexaazahexapyrazoles; diazahexaimidazoles; tetraazahexaimidazoles; and hexaazahexaimidazoles.

N Valence Stabilizer #15c: Examples of eight-membered macrocyclics, macrobicyclics, and macropolycyclics (including catapinands, cryptands, cyclidenes, and sepulchrates) wherein all eight binding sites are composed of nitrogen and are contained in a combination of 5-membered heterocyclic rings and amine or imine groups (N—N Tridentates, N—N Tetradentates, or N—N Hexadentates) that meet the requirements for use as "wide band" valence stabilizers for $Co^{+3}$ include, but are not limited to: diazaoctaphyrins; tetraazaoctaphyrins; hexaazaoctaphyrins; octaazaoctaphyrins; diazaoctapyrazoles; tetraazaoctapyrazoles; hexaazaoctapyrazoles; octaazaoctapyrazoles; diazaoctaimidazoles; tetraazaoctaimidazoles; hexaazaoctaimidazoles; and octaazaoctaimidazoles.

N Valence Stabilizer #15d: Examples of ten-membered macrocyclics, macrobicyclics, and macropolycyclics (including catapinands, cryptands, cyclidenes, and sepulchrates) wherein all ten binding sites are composed of nitrogen and are contained in a combination of 5-membered heterocyclic rings and amine or imine groups (N—N Tridentates, N—N Tetradentates, or N—N Hexadentates) that meet the requirements for use as "wide band" valence stabilizers for $Co^{+3}$ include, but are not limited to: diazadecaphyrins; tetraazadecaphyrins; hexaazadecaphyrins; octaazadecaphyrins; decaazadecaphyrins; diazadecapyrazoles; tetraazadecapyrazoles; hexaazadecapyrazoles; octaazadecapyrazoles; decaazadecapyrazoles; diazadecaimidazoles; tetraazadecaimidazoles; hexaazadecaimidazoles; octaazadecaimidazoles; and decaazadecaimidazoles.

N Valence Stabilizer #16a: Examples of four-membered macrocyclics, macrobicyclics, and macropolycyclics (including catapinands, cryptands, cyclidenes, and sepulchrates) wherein all four binding sites are composed of nitrogen and are contained in component 6-membered heterocyclic rings (N—N Tetradentates) that meet the requirements for use as "wide band" valence stabilizers for $Co^{+3}$ include, but are not limited to: cyclotetrapyridines; cyclotetraoxazines; cyclotetrathiazines; cyclotetraphosphorins; cyclotetraquinolines; cyclotetrapyrazines; cyclotetrapyridazines; cyclotetrapyrimidines; cyclotetraoxadiazines; cyclotetrathiadiazines; cyclotetradiazaphosphorins; cyclotetraquinoxalines; cyclotetratriazines; cyclotetrathiatriazines; and cyclotetraoxatriazines.

N Valence Stabilizer #16b: Examples of six-membered macrocyclics, macrobicyclics, and macropolycyclics (including catapinands, cryptands, cyclidenes, and sepulchrates) wherein all six binding sites are composed of nitrogen and are contained in component 6-membered heterocyclic rings (N—N Tridentates, N—N Tetradentates, or N—N Hexadentates) that meet the requirements for use as "wide band" valence stabilizers for $Co^{+3}$ include, but are not limited to: cyclosexipyridines; cyclosexioxazines; cyclosexithiazines; cyclosexiphosphorins; cyclosexiquinolines; cyclosexipyrazines; cyclosexipyridazines; cyclosexipyrimidines; cyclosexioxadiazines; cyclosexithiadiazines; cyclosexidiazaphosphorins cyclosexiquinoxalines; cyclosexitriazines; cyclosexithiatriazines; and cyclosexioxatriazines.

N Valence Stabilizer #16c: Examples of eight-membered macrocyclics, macrobicyclics, and macropolycyclics (including catapinands, cryptands, cyclidenes, and sepulchrates) wherein all six binding sites are composed of nitrogen and are contained in component 6-membered heterocyclic rings (N—N Tridentates, N—N Tetradentates, or N—N Hexadentates) that meet the requirements for use as "wide band" valence stabilizers for $Co^{+3}$ include, but are not limited to: cyclooctapyridines; cyclooctaoxazines; cyclooctathiazines; cyclooctaphosphorins; cyclooctaquinolines; cyclooctapyrazines; cyclooctapyridazines; cyclooctapyrimidines; cyclooctaoxadiazines; cyclooctathiadiazines; cyclooctadiazaphosphorins; cyclooctaquinoxalines; cyclooctatriazines; cyclooctathiatriazines; and cyclooctaoxatriazines.

N Valence Stabilizer #16d: Examples of ten-membered macrocyclics, macrobicyclics, and macropolycyclics (including catapinands, cryptands, cyclidenes, and sepulchrates) wherein all six binding sites are composed of nitrogen and are contained in component 6-membered heterocyclic rings (N—N Tridentates, N—N Tetradentates, or N—N Hexadentates) that meet the requirements for use as "wide band" valence stabilizers for $Co^{+3}$ include, but are not limited to: cyclodecapyridines; cyclodecaoxazines; cyclodecathiazines; cyclodecaphosphorins; cyclodecaquinolines; cyclodecapyrazines; cyclodecapyridazines; cyclodecapyrimidines; cyclodecaoxadiazines; cyclodecathiadiazines; cyclodecadiazaphosphorins; cyclodecaquinoxalines; cyclodecatriazines; cyclodecathiatriazines; and cyclodecaoxatriazines.

N Valence Stabilizer #17a: Examples of four-membered macrocyclics, macrobicyclics, and macropolycyclics (including catapinands, cryptands, cyclidenes, and sepulchrates) wherein all four binding sites are composed of nitrogen and are contained in a combination of 6-membered heterocyclic rings and amine or imine groups (N—N Tetradentates) that meet the requirements for use as "wide band" valence stabilizers for $Co^{+3}$ include, but are not limited to: diazacyclotetrapyridines; tetraazacyclotetrapyridines; diazacyclotetraquinolines; tetraazacyclotetraquinolines; diazacyclotetrapyrazines; tetraazacyclotetrapyrazines; diazacyclotetrapyridazines; tetraazacyclotetrapyridazines; diazacyclotetrapyrimidines; tetraazacyclotetrapyrimidines; diazacyclotetratriazines; and tetraazacyclotetratriazines.

N Valence Stabilizer #17b: Examples of six-membered macrocyclics, macrobicyclics, and macropolycyclics (including catapinands, cryptands, cyclidenes, and sepulchrates) wherein all six binding sites are composed of nitrogen and are contained in a combination of 6-membered heterocyclic rings and amine or imine groups (N—N Tridentates, N—N Tetradentates, or N—N Hexadentates) that meet the requirements for use as "wide band" valence stabilizers for $Co^{+3}$ include, but are not limited to: diazacyclosexipyridines; triazacyclosexipyridines; diazacyclosexiquinolines; triazacyclosexiquinolines; diazacyclosexipyrazines; triazacyclosexipyrazines; diazacyclosexipyridazines; triazacyclosexipyridazines; diazacyclosexipyrimidines; triazacyclosexipyrimidines; diazacyclosexitriazines; and triazacyclosexitriazines.

N Valence Stabilizer #17c: Examples of eight-membered macrocyclics, macrobicyclics, and macropolycyclics (including catapinands, cryptands, cyclidenes, and sepulchrates) wherein all eight binding sites are composed of nitrogen and are contained in a combination of 6-membered heterocyclic rings and amine or imine groups (N—N Tridentates, N—N Tetradentates, or N—N Hexadentates) that meet the requirements for use as "wide band" valence stabilizers for $Co^{+3}$ include, but are not limited to: diazacyclooctapyridines; tetraazacyclooctapyridines; diazacyclooctaquinolines; tetraazacyclooctaquinolines; diazacyclooctapyrazines; tetraazacyclooctapyrazines; diazacyclooctapyridazines; tetraazacyclooctapyridazines; diazacyclooctapyrimidines; tetraazacyclooctapyrimidines; diazacyclooctatriazines; and tetraazacyclooctatriazines.

N Valence Stabilizer #17d: Examples of ten-membered macrocyclics, macrobicyclics, and macropolycyclics (including catapinands, cryptands, cyclidenes, and sepulchrates) wherein all ten binding sites are composed of nitrogen and are contained in a combination of 6-membered heterocyclic rings and amine or imine groups (N—N Tridentates, N—N Tetradentates, or N—N Hexadentates) that meet the requirements for use as "wide band" valence stabilizers for $Co^{+3}$ include, but are not limited to: diazacyclodecapyridines; pentaazacyclodecapyridines; diazacyclodecaquinolines; pentaazacyclodecaquinolines; diazacyclodecapyrazines; pentaazacyclodecapyrazines; diazacyclodecapyridazines; pentaazacyclodecapyridazines; diazacyclodecapyrimidines; pentaazacyclodecapyrimidines; diazacyclodecatriazines; and pentaazacyclodecatriazines.

N Valence Stabilizer #18: Examples of amidines and diamidines (N—N bidentates or N—N Tetradentates) that meet the requirements for use as "wide band" valence stabilizers for $Co^{+3}$ include, but are not limited to: N,N'-dimethylformamidine; N,N'-diethylformamidine; N,N'-diisopropylformamidine; N,N'-dibutylformamidine; N,N'-diphenylformamidine; N,N'-dibenzylformamidine; N,N'-dinaphthylformamidine; N,N'-dicyclohexylformamidine; N,N'-dinorbornylformamidine; N,N'-diadamantylformamidine; N,N'-dianthraquinonylformamidine; N,N'-dimethylacetamidine; N,N'-diethylacetamidine; N,N'-diisopropylacetamidine; N,N'-dibutylacetamidine; N,N'-diphenylacetamidine; N,N'-dibenzylacetamidine; N,N'-dinaphthylacetamidine; N,N'-dicyclohexylacetamidine; N,N'-dinorbornylacetamidine; N,N'-diadamantylacetamidine; N,N'-dimethylbenzamidine; N,N'-diethylbenzamidine; N,N'-diisopropylbenzamidine; N,N'-dibutylbenzamidine; N,N'-diphenylbenzamidine; N,N'-dibenzylbenzamidine; N,N'-dinaphthylbenzamidine; N,N'-dicyclohexylbenzamidine; N,N'-dinorbornylbenzamidine; N,N'-diadamantylbenzamidine; N,N'-dimethyltoluamidine; N,N'-diethyltoluamidine; N,N'-diisopropyltoluamidine; N,N'-dibutyltoluamidine; N,N'-diphenyltoluamidine; N,N'-dibenzyltoluamidine; N,N'-dinaphthyltoluamidine; N,N'-dicyclohexyltoluamidine; N,N'-dinorbornyltoluamidine; N,N'-diadamantyltoluamidine; oxalic diamidine; malonic diamidine; succinic diamidine; glutaric diamidine; adipic diamidine; pimelic diamidine; suberic diamidine; phthalic diamidine; terephthalic diamidine; isophthalic diamidine; piperazine diamidine; 2-iminopyrrolidine; 2-iminopiperidine; amidinobenzamide; benzamidine; chloroazodin; and debrisoquin.

N Valence Stabilizer #19: Examples of biguanides (imidodicarbonimidic diamides), biguanidines, imidotricarbonimidic diamides, imidotetracarbonimidic diamides, dibiguanides, bis(biguanidines), polybiguanides, and poly(biguanidines) (N—N bidentates, N—N tridentates, N—N tetradentates, and N—N hexadentates) that meet the requirements for use as "wide band" valence stabilizers for $Co^{+3}$ include, but are not limited to: biguanide (bigH); biguanidine, methylbiguanide; ethylbiguanide; isopropylbiguanide; butylbiguanide; benzylbiguanide; phenylbiguanide; tolylbiguanide; naphthylbiguanide; cyclohexylbiguanide; norbornylbiguanide; adamantylbiguanide; dimethylbiguanide; diethylbiguanide;

diisopropylbiguanide; dibutylbiguanide; dibenzylbiguanide; diphenylbiguanide; ditolylbiguanide; dinaphthylbiguanide; dicyclohexylbiguanide; dinorbornylbiguanide; diadamantylbiguanide; ethylenedibiguanide; propylenedibiguanide; tetramethylenedibiguanide; pentamethylenedibiguanide; hexamethylenedibiguanide; heptamethylenedibiguanide; octamethylenedibiguanide; phenylenedibiguanide; piperazinedibiguanide; oxalyldibiguanide; malonyldibiguanide; succinyldibiguanide; glutaryldibiguanide; adipyldibiguanide; pimelyldibiguanide; suberyldibiguanide; phthalyldibiguanide; paludrine; polyhexamethylene biguanide; 2-guanidinothiazole; 2-guanidinooxazole; 2-guanidinoimidazole; 3-guanidinopyrazole; 3-guanidino-1,2,4-triazole; 5-guanidinotetrazole; alexidine; buformin; and moroxydine.

N Valence Stabilizer #20: Examples of diamidinomethanes, bis(diamidinomethanes), and poly(diamidinomethanes) (N—N bidentates, N—N tridentates, N—N tetradentates, and N—N hexadentates) that meet the requirements for use as "wide band" valence stabilizers for $Co^{+3}$ include, but are not limited to: diamidinomethane; N-methyldiamidinomethane; N-ethyldiamidinomethane; N-isopropyldiamidinomethane; N-butyldiamidinomethane; N-benzyldiamidinomethane; N-phenyldiamidinomethane; N-tolyldiamidinomethane; N-naphthyldiamidinomethane; N-cyclohexyldiamidinomethane; N-norbornyldiamidinomethane; N-adamantyldiamidinomethane; dimethyldiamidinomethane; diethyldiamidinomethane; diisopropyldiamidinomethane; dibutyldiamidinomethane; dibenzyldiarnidinomethane; diphenyldiamidinomethane; ditolyldiamidinomethane; dinaphthyldiamidinomethane; dicyclohexyldiamidinomethane; dinorbornyldiamidinomethane; diadamantyldiamidinomethane; ethylenebisdiamidinomethane; propylenebisdiamidinomethane; tetramethylenebisdiamidinomethane; pentamethylenebisdiamidinomethane; hexamethylenebisdiamidinomethane; heptamethylenebisdiamidinomethane; octamethylenebisdiamidinomethane; phenylenebisdiamidinomethane; piperazinebisdiamidinomethane; oxalylbisdiamidinomethane; malonylbisdiamidinomethane; succinylbisdiamidinomethane; glutarylbisdiamidinomethane; phthalylbisdiamidinomethane; 2-amidinomethylthiazole; 2-amidinomethyloxazole; 2-amidinomethylimidazole; 3-amidinomethylpyrazole; 3-amidinomethyl-1,2,4-triazole; and 5-amidinomethyltetrazole.

N Valence Stabilizer #21: Examples of imidoylguanidines, amidinoguanidines, bis(imidoylguanidines), bis(amidinoguanidines), poly(imidoylguanidines), and poly(amidinoguanidines) (N—N bidentates, N—N tridentates, N—N tetradentates, and N—N hexadentates) that meet the requirements for use as "wide band" valence stabilizers for $Co^{+3}$ include, but are not limited to: acetimidoylguanidine; amidinoguanidine, benzimidoylguanidine; cyclohexylimidoylguanidine; pentafluorobenzimidoylguanidine; 2-N-imidoylaminothiazole; 2-N-imidoylaminooxazole; 2-N-imidoylaminoimidazole; 3-N-imidoylaminopyrazole; 3-N-imidoylamino-1,2,4-triazole; and 5-N-imidoylaminotetrazole.

N Valence Stabilizer #22: Examples of diformamidine oxides (dicarbonimidic diamides), tricarbonimidic diamides, tetracarbonirnidic diamides, bis(diformamidine oxides), and poly(diformamidine oxides) (N—N bidentates, N—N tridentates, or N—N tetradentates) that meet the requirements for use as "wide band" valence stabilizers for $Co^{+3}$ include, but are not limited to: diformamidine oxide; methyldiformamidine oxide; ethyldiformamidine oxide; isopropyldiformamidine oxide; butyldiformamidine oxide; benzyldiformamidine oxide; phenyldiformamidine oxide; tolyldiformamidine oxide; naphthyldiformamidine oxide; cyclohexyldiformamidine oxide; norbornyldiformamidine oxide; adamantyldiformamidine oxide; dimethyldiformamidine oxide; diethyldiformamidine oxide; diisopropyldiformamidine oxide; dibutyldiformamidine oxide; dibenzyldiformamidine oxide; diphenyldiformamidine oxide; ditolyldiformamidine oxide; dinaphthyldiformamidine oxide; dicyclohexyldiformamidine oxide; dinorbornyldiformamidine oxide; diadamantyldiformamidine oxide; 2-O-amidinohydroxythiazole; 2-O-amidinohydroxyoxazole; 2-O-amidinohydroxyimidazole; 3-O-amidinohydroxypyrazole; 3-O-amidinohydroxy-1,2,4-triazole; and 5-O-amidinohydroxytetrazole.

N Valence Stabilizer #23: Examples of diformamidine sulfides (thiodicarbonimidic diamides), thiotricarbonimidic diamides, thiotetracarbonimidic diamides, bis(diformamidine sulfides), and poly(diformamidine sulfides) (N—N bidentates, N—N tridentates, or N—N tetradentates) that meet the requirements for use as "wide band" valence stabilizers for $Co^{+3}$ include, but are not limited to: diformamidine sulfide; methyldiformamidine sulfide; ethyldiformamidine sulfide; isopropyldiformamidine sulfide; butyldiformamidine sulfide; benzyldiformamidine sulfide; phenyldiformamidine sulfide; tolyldiformamidine sulfide; naphthyldiformamidine sulfide; cyclohexyldiformamidine sulfide; norbornyldiformamidine sulfide; adamantyldiformamidine sulfide; dimethyldiformamidine sulfide; diethyldiformamidine sulfide; diisopropyldiformamidine sulfide; dibutyldiformamidine sulfide; dibenzyldiformamidine sulfide; diphenyldiformamidine sulfide; ditolyldiformamidine sulfide; dinaphthyldiformamidine sulfide; dicyclohexyldiformamidine sulfide; dinorbornyldiformamidine sulfide; diadamantyldiformamidine sulfide; phenylthiobisformamidine; 2-S-amidinomercaptothiazole; 2-S-amidinomercaptooxazole; 2-S-amidinomercaptoimidazole; 3-S-amidinomercaptopyrazole; 3-S-amidinomercapto-1,2,4-triazole; and 5-S-amidinomercaptotetrazole.

N Valence Stabilizer #24: Examples of imidodicarbonimidic acids, diinidodicarbonimidic acids, imidotricarbonimidic acids, imidotetracarbonimidic acids, and derivatives thereof (N—N Bidentates, N—N Tridentates, N—N Tetradentates, and N—N Hexadentates) that meet the requirements for use as "wide band" valence stabilizers for $Co^{+3}$ include, but are not limited to: imidodicarbonimidic acid, diimidodicarbonimidic acid, imidotricarbonimidic acid, imidotetracarbonimidic acid; O-methylimidodicarbonimidic acid; O-ethylimidodicarbonimidic acid; O-isopropylimidodicarbonimidic acid; O-phenylimidodicarbonirnidic acid; O-benzylimidodicarbonimidic acid; O-cyclohexylimidodicarbonimidic acid; O-naphthylimidodicarbonimidic acid; O-norbornylimidodicarbonimidic acid; O-adamantylimidodicarbonimidic acid; O,O'-dimethylimidodicarbonimidic acid; O,O'-diethylimidodicarbonimidic acid; O,O'-diisopropylimidodicarbonimidic acid; O,O'-diphenylimidodicarbonimidic acid; O,O'-dibenzylimidodicarbonimidic acid; O,O'-dicyclohexylimidodicarbonimidic acid; O,O'-dinaphthylimidodicarbonimidic acid; O,O'-dinorbornylimidodicarbonimidic acid; and O,O'-diadamantylimidodicarbonimidic acid.

N Valence Stabilizer #25: Examples of thioimidodicarbonimidic acids, thiodiimidodicarbonimidic acids, thioimidotricarbonimidic acids, thioimidotetracarbonimidic acids, and derivatives thereof (N—N Bidentates, N—N Tridentates, N—N Tetradentates, and N—N Hexadentates) that meet the requirements for use as "wide band" valence stabilizers for $Co^{+3}$ include, but are not limited to: thioimidodicarbonimidic acid, thiodiimidodicarbonimidic acid, thioimidotricarbonimidic acid, thioimidotetracarbonimidic acid; O-methylthioimidodicarbonimidic acid; O-ethylthioimidodicarbonimidic acid; O-isopropylthioimidodicarbonimidic acid; O-phenylthioimidodicarbonimidic acid; O-benzylthioimidodicarbonimidic acid; O-cyclohexylthioimidodicarbonimidic acid; O-naphthylthioimidodicarbonimidic acid; O-norbornylthioimidodicarbonimidic acid; O-adamantylthioimidodicarbonimidic acid; O,O'-dimethylthioimidodicarbonimidic acid; O,O'-diethylthioimidodicarbonimidic acid; O,O'-diisopropylthioimidodicarbonimidic acid; O,O'-diphenylthioimidodicarbonimidic acid; O,O'-dibenzylthioimidodicarbonimidic acid; O,O'-dicyclohexylthioimidodicarbonimidic acid; O,O'-dinaphthylthioimidodicarbonimidic acid; O,O'-dinorbornylthioimidodicarbonimidic acid; and O,O'-diadamantylthioimidodicarbonimidic acid.

N Valence Stabilizer #26: Examples of diimidoylimines, diimidoylhydrazides, bis(diimidoylimines), bis(diimidoylhydrazides), poly(diimidoylimines), and poly(diimidoylhydrazides) (N—N Tridentates and N—N Hexadentates) that meet the requirements for use as "wide band" valence stabilizers for $Co^{+3}$ include, but are not limited to: diacetimidoylimine; dibenzimidoylimine; and dicyclohexylimidoylimine.

N Valence Stabilizer #27: Examples of imidosulfamides, diimidosulfamides, bis(imidosulfamides), bis(diimidosulfamides), poly(imidosulfamides), and poly(diimidosulfamides) (N—N Bidentates, N—N Tridentates, N—N Tetradentates, and N—N Hexadentates) that meet the requirements for use as "wide band" valence stabilizers for $Co^{+3}$ include, but are not limited to: imidosulfamidic acid, diimidosulfamidic acid; O-phenylimidosulfamide; O-benzylimidosulfamide; N-phenylimidosulfamide; N-benzylimidosulfamide; O-phenyldiimidosulfamide; O-benzyldiimidosulfamide; N-phenyldiimidosulfamide; and N-benzyldiimidosulfamide.

N Valence Stabilizer #28: Examples of phosphoramidimidic triamides, bis(phosphoramidimidic triamides), and poly (phosphoramidimidic triamides) and derivatives thereof (N—N Bidentates, N—N Tridentates, N—N Tetradentates, and N—N Hexadentates) that meet the requirements for use as "wide band" valence stabilizers for $Co^{+3}$ include, but are not limited to: phosphoramidimidic triamide; N-phenylphosphoramidimidic triamide; N-benzylphosphoramidimidic triamide; N-naphthylphosphoramidimidic triamide; N-cyclohexylphosphoramidimidic triamide; N-norbornylphosphoramidimidic triamide; N,N'-diphenylphosphoramidimidic triamide; N,N'-dibenzylphosphorarnidimidic triamide; N,N'-dinaphthylphosphoramidimidic triamide; N,N'-dicyclohexylphosphoramidimidic triamide; and N,N'-dinorbornylphosphoramidimidic triamide.

N Valence Stabilizer #29: Examples of phosphoramidimidic acid, phosphorodiamidimidic acid, bis(phosphoramidimidic acid), bis(phosphorodiamidimidic acid), poly(phosphoramidimidic acid), poly(phosphorodiamidimidic acid), and derivatives thereof (N—N Bidentates, N—N Tridentates, N—N Tetradentates, and N—N Hexadentates) that meet the requirements for use as "wide band" valence stabilizers for $Co^{+3}$ include, but are not limited to: phosphoramidimidic acid, phosphorodiamidimidic acid, O-phenylphosphoramidimidic acid; O-benzylphosphoramidimidic acid; O-naphthylphosphoramidimidic acid; O-cyclohexylphosphoramidimidic acid; O-norbornylphosphoramidimidic acid; O,O'-diphenylphosphoramidimidic acid; O,O'-dibenzylphosphoramidimidic acid; O,O'-dinaphthylphosphoramidimidic acid; O,O'-dicyclohexylphosphoramidimidic acid; and O,O'-dinorbornylphosphoramidimidic acid.

N Valence Stabilizer #30: Examples of phosphoramidimidodithioic acid, phosphorodiamidimidothioic acid, bis(phosphoramidimidodithioic acid), bis(phosphorodiamidimidothioic acid), poly(phosphoramidimidodithioic acid), poly (phosphorodiamidimidothioic acid), and derivatives thereof (N—N Bidentates, N—N Tridentates, N—N Tetradentates, and N—N Hexadentates) that meet the requirements for use as "wide band" valence stabilizers for $Co^{+3}$ include, but are not limited to: phosphoramidimidodithioic acid, phosphorodiamidimidothioic acid, S-phenylphosphoramidimidodithioic acid; S-benzylphosphoramidimidodithoic acid; S-naphthylphosphoramidimidodithioic acid; S-cyclohexylphosphoramidimidodithioic acid; S-norbornylphosphoramidimidodithioic acid; S,S'-diphenylphosphoramidimidodithioic acid; S,S'-dibenzylphosphoramidimidodithioic acid; S,S'-dinaphthylphosphoramidimidodithioic acid; S,S'-dicyclohexylphosphoramidimidodithioic acid; and S,S'-dinorbornylphosphoramidimidodithioic acid.

N Valence Stabilizer #31: Examples of azo compounds with amino, imino, oximo, diazeno, or hydrazido substitution at the ortho- (for aryl) or alpha- or beta- (for alkyl) positions, bis[o-($H_2N$—) or alpha- or beta-($H_2N$—)azo compounds], or poly[o-($H_2N$—) or alpha- or beta-($H_2N$—)azo compounds) (N—N Bidentates, N—N Tridentates, N—N Tetradentates, or N—N Hexadentates) that meet the requirements for use as "wide band" valence stabilizers for $Co^{+3}$ include, but are not limited to: o-aminoazobenzene; o,o'-diaminoazobenzene; (2-pyridine)azobenzene; 1-phenylazo-2-naphthylamine; pyridineazo-2-naphthol (PAN); pyridineazoresorcinol (PAR); o-hydroxy-o'-(beta-aminoethylamino) azobenzene; Benzopurpurin 4B; Congo Red; Fat Brown RR; benzopurpurin; Congo Red; Direct Red 75; Mordant Brown 48; Nitro Red; 2-imidazolylazobenzene; 2-benzimidazolylazobenzene; 3-pyrazolylazobenzene; 3-(1,2,4-triazolyl) azobenzene; 2-pyridylazobenzene; 2-pyrazinylazobenzene; and 2-pyrimidinylazobenzene.

N Valence Stabilizer #32: Examples of diazeneformimidamides (diazeneamidines), diazeneacetimidamides (diazene-alpha-amidinoalkanes(alkenes)), bis(diazeneformimidamides), bis(diazeneacetimidamides), poly (diazeneformimidamides), and poly (diazeneacetimidamides) (N—N Bidentates, N—N Tetradentates, and N—N Hexadentates) that meet the requirements for use as "wide band" valence stabilizers for $Co^{+3}$ include, but are not limited to: diazeneformimidamide (diazeneamidine); diazeneacetimidamide(diazene-alpha-amidinomethane); phenyldiazenefommimidamide; triphenyldiazeneformimidamide; phenyldiazeneacetimidamide; and triphenyldiazeneacetimidamide.

N Valence Stabilizer #33: Examples of diazeneformimidic acid, diazeneacetimidic acid, bis(diazeneformimidic acid), bis(diazeneacetimidic acid), poly(diazeneformimidic acid), poly(diazeneacetimidic acid), and derivatives thereof (N—N Bidentates, N—N Tetradentates, and N—N Hexadentates) that meet the requirements for use as "wide band" valence stabilizers for $Co^{+3}$ include, but are not limited to: diazeneformimidic acid, diazeneacetimidic acid, phenyldiazeneformimidic acid, diphenyldiazeneformimidic acid, phenyldiazeneacetimidic acid, and diphenyldiazeneacetimidic acid.

N Valence Stabilizer #34: Examples of diazeneformimidothioic acid, diazeneacetimidothioic acid, bis(diazeneformimidothioic acid), bis(diazeneacetimidothioic acid), poly(diazeneformimidothioic acid), poly(diazeneacetimidothioic acid), and derivatives thereof (N—N Bidentates, N—N Tetradentates, and N—N Hexadentates) that meet the requirements for use as "wide band" valence stabilizers for $Co^{+3}$ include, but are not limited to: diazeneformimidothioic acid, diazeneacetimidothioic acid, phenyldiazeneformimidothioic acid, diphenyldiazeneformimidothioic acid, phenyldiazeneacetimidothioic acid, and diphenyldiazeneacetimidothioic acid.

N Valence Stabilizer #35: Examples of imidoyldiazenes, bis(imidoyldiazenes), and poly(imidoyldiazenes), (N—N Tridentates and N—N Hexadentates) that meet the requirements for use as "wide band" valence stabilizers for $Co^{+3}$ include, but are not limited to: acetimidoyldiazene; benzimidoyldiazene; and cyclohexylimidoyldiazene.

N Valence Stabilizer #36: Examples of diazenediformimidamides (1,2-diazenediamidines), diazenediacetimidamides (1,2-diazene-di-alpha-amidinoalkanes(alkenes)), bis(diazenediformimidamides), bis(diazenediacetimidamides), poly(diazenediformimidamides), and poly(diazenediacetimidamides) (N—N Tridentates and N—N Hexadentates) that meet the requirements for use as "wide band" valence stabilizers for $Co^{+3}$ include, but are not limited to: diazenediformimidamide(1,2-diazenediamidine), diazenediacetimidamide(1,2-diazene-di-alpha-amidinomethane); diphenyldiazenediformimidamide; tetraphenyldiazenediformimidamide; diphenyldiazenediacetimidamide; and tetraphenyldiazenediacetimidamide.

N Valence Stabilizer #37: Examples of diazenediformimidic acid, diazenediacetimidic acid, bis(diazenediformimidic acid), bis(diazenediacetimidic acid), poly(diazenediformimidic acid), and poly(diazenediacetimidic acid), and derivatives thereof (N—N Tridentates and N—N Hexadentates) that meet the requirements for use as "wide band" valence stabilizers for $Co^{+3}$ include, but are not limited to: diazenediformimidic acid, diazenediacetimidic acid, diphenyldiazenediformimidic acid, and diphenyldiazenediacetimidic acid.

N Valence Stabilizer #38: Examples of diazenediformimidothioic acid, diazenediacetimidothioic acid, bis(diazenediformimidothioic acid), bis(diazenediacetimidothioic acid), poly(diazenediformimidothioic acid), and poly(diazenediacetimidothioic acid), and derivatives thereof (N—N Tridentates and N—N Hexadentates) that meet the requirements for use as "wide band" valence stabilizers for $Co^{+3}$ include, but are not limited to: diazenediformimidothioic acid, diazenediacetimidothioic acid, diphenyldiazenediformimidothioic acid, and diphenyldiazenediacetimidothioic acid.

N Valence Stabilizer #39: Examples of diimidoyldiazenes, bis(diimidoyldiazenes), and poly(diimidoyldiazenes), (N—N Tridentates and N—N Hexadentates) that meet the requirements for use as "wide band" valence stabilizers for $Co^{+3}$ include, but are not limited to: diacetimidoyldiazene; dibenzimidoyldiazene; and dicyclohexylimidoyldiazene.

N Valence Stabilizer #40: Examples of ortho-amino (or -hydrazido) substituted formazans, bis(o-amino or -hydrazido substituted formazans), and poly(o-amino or -hydrazido substituted formazans) (N—N Bidentates, N—N Tridentates, N—N Tetradentates, and N—N Hexadentates) that meet the requirements for use as "wide band" valence stabilizers for $Co^{+3}$ include, but are not limited to: 1-(2-aminophenyl)-3,5-diphenylformazan; and 1,5-bis(2-aminophenyl)-3-phenylformazan.

N Valence Stabilizer #41: Examples of ortho-amino (or -hydrazido) substituted azines (including ketazines), bis(o-amino or hydrazido substituted azines), and poly(o-amino or hydrazido substituted azines) (N—N Bidentates, N—N Tridentates, N—N Tetradentates, and N—N Hexadentates) that meet the requirements for use as "wide band" valence stabilizers for $Co^{+3}$ include, but are not limited to: 2-amino-1-benzalazine; 2-amino-1-naphthalazine; and 2-amino-1-cyclohexanonazine.

N Valence Stabilizer #42: Examples of Schiff Bases with one Imine (C═N) Group and with ortho- or alpha- or beta-amino or imino or oximo or diazeno or hydrazido substitution (N—N Bidentates, N—N Tridentates, N—N Tetradentates, N—N Pentadentates, or N—N Hexadentates) that meet the requirements for use as "wide band" valence stabilizers for $Co^{+3}$ include, but are not limited to: N-(2-Aminobenzaldehydo)isopropylamine; N-(2-Pyridinecarboxaldehydo)isopropylamine; N-(2-Pyrrolecarboxaldehydo)isopropylamine; N-(2-Acetylpyridino)isopropylamine; N-(2-Acetylpyrrolo)isopropylamine; N-(2-Aminoacetophenono)isopropylamine; N-(2-Aminobenzaldehydo)cyclohexylamine; N-(2-Pyridinecarboxaldehydo)cyclohexylamine; N-(2-Pyrrolecarboxaldehydo)cyclohexylamine; N-(2-Acetylpyridino)cyclohexylamine; N-(2-Acetylpyrrolo)cyclohexylamine; N-(2-Aminoacetophenono)cyclohexylamine; N-(2-Aminobenzaldehydo)aniline; N-(2-Pyridinecarboxaldehydo)aniline; N-(2-Pyrrolecarboxaldehydo)aniline; N-(2-Acetylpyridino)aniline; N-(2-Acetylpyrrolo)aniline; N-(2-Aminoacetophenono)aniline; N-(2-Aminobenzaldehydo)aminonorbornane; N-(2-Pyridinecarboxaldehydo)aminonorbornane; N-(2-Pyrrolecarboxaldehydo)aminonorbornane; N-(2-Acetylpyridino)aminonorbornane; N-(2-Acetylpyrrolo)aminonorbornane; N-(2-Aminoacetophenono)aminonorbornane; 2-pyrrolecarboxaldehyde phenylhydrazone; 2-pyrrolecarboxaldehyde 2-pyridyl hydrazone; 2-aminobenzaldehyde phenylhydrazone (nitrin); and 2-aminobenzaldehyde 2-pyridyl hydrazone. Also includes hydrazones with ortho-N substitution.

N Valence Stabilizer #43: Examples of Schiff Bases with two Imine (C═N) Groups and without ortho- (for aryl constituents) or alpha- or beta- (for alkyl constituents) hydroxy, carboxy, carbonyl, thiol, mercapto, thiocarbonyl, amino, imino, oximo, diazeno, or hydrazido substitution (N—N Bidentates) that meet the requirements for use as "wide band" valence stabilizers for $Co^{+3}$ include, but are not limited to: N,N'-(Glyoxalo)diisopropylamine; N,N'-(Glyoxalo)dicyclohexylamine; N,N'-(Glyoxalo)dianiline; N,N'-(Glyoxalo)di-aminonorbornane; N,N'-(Malondialdehydo)diisopropylamine; N,N'-(Malondialdehydo)dicyclohexylamine; N,N'-(Malondialdehydo)dianiline; N,N'-(Malondialdehydo)di-aminonorbornane; N,N'-(Phthalicdialdehydo)diisopropylamine; N,N'-(Phthalicdialdehydo)dicyclohexylamine; N,N'-(Phthalicdialdehydo)dianiline; N,N'-(Phthalicdialdehydo)di-aminonorbornane; N,N'-(Formylcamphoro)diisopropylamine; N,N'-(Formylcamphoro)dicyclohexylamine; N,N'-(Formylcamphoro)dianiline; N,N'-(Formylcamphoro)di-aminonorbornane; N,N'-(Acetylacetonato)diisopropylamine; N,N'-(Acetylacetonato)dicyclohexylamine; N,N'-(Acetylacetonato)dianiline; N,N'-(Acetylacetonato)di-aminonorbornane; N,N'-(Diacetylbenzeno) diisopropylamine; N,N'-(Diacetylbenzeno) dicyclohexylamine; N,N'-(Diacetylbenzeno)dianiline; N,N'-(Diacetylbenzeno)di-aminonorbornane; N,N'-(1,2-Cyclohexanono)diisopropylamine; N,N'-(1,2-Cyclohexanono)dicyclohexylamine; N,N'-(1,2-Cyclohexanono)dianiline; N,N'-(1,2-Cyclohexanono)di-aminonorbornane; N,N'-(Camphorquinono) diisopropylamine; N,N'-(Camphorquinono) dicyclohexylamine; N,N'-(Camphorquinono)dianiline; N,N'-(Camphorquinono)di-aminonorbornane; N,N'-(Benzaldehydo)ethylenediamine; N,N'-(Naphthaldehydo)ethylenediamine; N,N'-(Acetophenono)ethylenediamine; N,N'-(Benzaldehydo)trimethylenediamine; N,N'-(Naphthaldehydo)trimethylenediamine; N,N'-(Acetophenono)trimethylenediamine; N,N'-(Benzaldehydo) cyclohexane-1,2-diamine; N,N'-(Naphthaldehydo) cyclohexane-1,2-diamine; N,N'-(Acetophenono) cyclohexane-1,2-diamine; N,N'-(Benzaldehydo)-1,2-diaminobenzene; N,N'-(Naphthaldehydo)-1,2-diaminobenzene; N,N'-(Acetophenono)-1,2-diaminobenzene; N,N'-(Acetylacetonato)ethylenediamine; N,N'-(Acetylacetonato)-1,2-cyclohexylenediamine; N,N'-(Acetylacetonato)-1,2-propylenediamine; N,N'-(Glyoxalo)-o-phenylenediamine; and N,N'-(Glyoxalo)ethylenediamine. Also includes dihydrazones.

N Valence Stabilizer #44: Examples of Schiff Bases with two Imine (C═N) Groups and with ortho- or alpha- or beta-amino or imino or oximo or diazeno or hydrazido substitution (N—N Bidentates, N—N Tridentates, N—N Tetradentates, N—N Pentadentates, or N—N Hexadentates) that meet the requirements for use as "wide band" valence stabilizers for $Co^{+3}$ include, but are not limited to: N,N'-(2,6-Pyridinedicarboxaldehydo)diisopropylamine; N,N'-(2,6-Pyridinedicarboxaldehydo)dicyclohexylamine; N,N'-(2,6-Pyridinedicarboxaldehydo)dianiline; N,N'-(2,6-Pyridinedicarboxaldehydo)di-aminonorbornane; N,N'-(2,5-Pyrroledicarboxaldehydo)diisopropylamine; N,N'-(2,5-Pyrroledicarboxaldehydo)dicyclohexylamine; N,N'-(2,5-Pyrroledicarboxaldehydo)dianiline; N,N'-(2,5-Pyrroledicarboxaldehydo)di-aminonorbornane; N,N'-(o-Aminophthalicdialdehydo)diisopropylamine; N,N'-(o-Aminophthalicdialdehydo)dicyclohexylamine; N,N'-(o-Aminophthalicdialdehydo)dianiline; N,N'-(o-Aminophthalicdialdehydo)di-aminonorbornane; N,N'-(o-Aminoformylcamphoro)diisopropylamine; N,N'-(o-Aminoformylcamphoro)dicyclohexylamine; N,N'-(o-Aminoformylcamphoro)dianiline; N,N'-(o-Aminoformylcamphoro)di-aminonorbornane; N,N'-(2,6-Diacetylpyridino)diisopropylamine; N,N'-(2,6-Diacetylpyridino)dicyclohexylamine; N,N'-(2,6-Diacetylpyridino)dianiline; N,N'-(2,6-Diacetylpyridino)di-aminonorbornane; N,N'-(o-Aminodiacetylbenzeno) diisopropylamine; N,N'-(o-Aminodiacetylbenzeno) dicyclohexylamine; N,N'-(o-Aminodiacetylbenzeno) dianiline; N,N'-(o-Aminodiacetylbenzeno)di-aminonorbornane; N,N'-(3,6-Diamino-1,2-cyclohexanono) diisopropylamine; N,N'-(3,6-Diamino-1,2-cyclohexanono) dicyclohexylamine; N,N'-(3,6-Diamino-1,2-cyclohexanono)dianiline; N,N'-(3,6-Diamino-1,2-cyclohexanono)di-aminonorbornane; N,N'-(2,5-Diacetylpyrrolo)diisopropylamine; N,N'-(2,5-Diacetylpyrrolo)dicyclohexylamine; N,N'-(2,5-Diacetylpyrrolo)dianiline; N,N'-(2,5-Diacetylpyrrolo)di-aminonorbornane; N,N'-(o-Aminobenzaldehydo) ethylenediamine; N,N'-(o-Aminonaphthaldehydo) ethylenediamine; N,N'-(o-Aminoacetophenono) ethylenediamine; N,N'-(o-Aminobenzaldehydo) trimethylenediamine; N,N'-(o-Aminonaphthaldehydo) trimethylenediamine; N,N'-(o-Aminoacetophenono) trimethylenediamine; N,N'-(o-Aminobenzaldehydo) cyclohexane-1,2-diamine; N,N'-(o-Aminonaphthaldehydo) cyclohexane-1,2-diamine; N,N'-(o-Aminoacetophenono) cyclohexane-1,2-diamine; N,N'-(o-Aminobenzaldehydo)-1,2-diaminobenzene; N,N'-(o-Aminonaphthaldehydo)-1,2-diaminobenzene; and N,N'-(o-Aminoacetophenono)-1,2-diaminobenzene. Also includes hydrazones with ortho-N substitution.

N Valence Stabilizer #45: Examples of Schiff Bases with three Imine (C═N) Groups and without ortho- (for aryl constituents) or alpha- or beta- (for alkyl constituents) hydroxy, carboxy, carbonyl, thiol, mercapto, thiocarbonyl, amino, imino, oximo, diazeno, or hydrazido substitution (N—N Tridentates) that meet the requirements for use as "wide band" valence stabilizers for $Co^{+3}$ include, but are not limited to: N,N',N"-(Benzaldehydo)tris(2-aminoethyl) amine; N,N',N"-(Naphthaldehydo)tris(2-aminoethyl)amine; and N,N',N"-(Acetophenono)tris(2-aminoethyl)amine. Also includes trihydrazones.

N Valence Stabilizer #46: Examples of Schiff Bases with three Imine (C═N) Groups and with ortho- or alpha- or beta-amino or imino or oximo or diazeno or hydrazido substitution (N—N Tridentates, N—N Tetradentates, N—N Pentadentates, or N—N Hexadentates) that meet the requirements for use as "wide band" valence stabilizers for $Co^{+3}$ include, but are not limited to: N,N',N"-(o-Aminobenzaldehydo)tris(2-aminoethyl)amine; N,N',N"-(o-Aminonaphthaldehydo)tris(2-aminoethyl)amine; and N,N',N"-(o-Aminoacetophenono)tris(2-aminoethyl)amine.

S Valence Stabilizer #1: Examples of macrocyclic, macrobicyclic, and macropolycyclic oligothioketones (including catapinands, cryptands, cyclidenes, and sepulchrates) wherein all binding sites are composed of thioketones (especially in the beta position) (S—S Bidentates, S—S Tetradentates, and S—S Hexadentates) that meet the requirements for use as "wide band" valence stabilizers for $Co^{+3}$ include, but are not limited to: hexathioketocyclotetracosane ([24]ane(═S)$_6$); hexathioketocycloheneicosane ([21]ane(═S)$_6$); hexathioketocyclooctadecane ([18]ane(═S)$_6$); hexathioketocyclopentadecane ([15]ane(═S)$_6$); tetrathioketocycloeicosane ([20]ane(═S)$_4$); tetrathioketocyclooctadecane ([18]ane(═S)$_4$); tetrathioketocyclohexadecane ([16]ane(═S)$_4$); tetrathioketocyclotetradecane ([14]ane(═S)$_4$); tetrathioketocyclododecane ([12]ane(═S)$_4$); dithioketocyclohexadecane ([16]ane(═S)$_2$); dithioketocyclotetraadecane ([14]ane(═S)$_2$); dithioketocyclododecane ([12]ane(═S)$_2$); dithioketocyclodecane ([10]ane(═S)$_2$); and dithioketocyclooctane ([8]ane(═S)$_2$).

S Valence Stabilizer #2: Examples of macrocyclic, macrobicyclic, and macropolycyclic dithiolenes (including catapinands, cryptands, cyclidenes, and sepulchrates) wherein all binding sites are composed of alpha-, alpha-dithiolenes (meaning two thiol groups on a single carbon atom in the ring) (S—S Bidentates, S—S Tetradentates, and S—S Hexadentates) that meet the requirements for use as "wide band" valence stabilizers for $Co^{+3}$ include, but are not limited to: hexathiolocyclotetracosane ([24]ane(—SH)$_6$); hexathiolocycloheneicosane ([21]ane(—SH)$_6$); hexathiolocyclooctadecane ([18]ane(—SH)$_6$); hexathiolocyclopentadecane ([15]ane(—SH)$_6$); tetrathiolocycloeicosane ([20]ane(—SH)$_4$); tetrathiolocyclooctadecane ([18]ane(—SH)$_4$); tetrathiolocyclohexadecane ([16]ane(—SH)$_4$); tetrathiolocyclotetradecane ([14]ane(—SH)$_4$); tetrathiolocyclododecane ([12]ane(—SH)$_4$); dithiolocyclohexadecane ([16]ane(—SH)$_2$); dithiolocyclotetraadecane ([14]ane(—SH)$_2$); dithiolocyclododecane ([12]ane(—SH)$_2$); dithiolocyclodecane ([10]ane(—SH)$_2$); and dithiolocyclooctane ([8]ane(—SH)$_2$).

S Valence Stabilizer #3: Examples of dithioimidodialdehydes, dithiohydrazidodialdehydes (thioacyl thiohydrazides), bis(dithioimidodialdehydes), bis(dithiohydrazidodialdehydes), poly(dithioimidodialdehydes), and poly(dithiohydrazidodialdehydes) (S—S Bidentates, S—S Tridentates, S—S Tetradentates) that meet the requirements for use as "wide band" valence stabilizers for $Co^{+3}$ include, but are not limited to: dithiodiacetamide, dithiodipropanamide, dithiodibutanamide, dithiodibenzamide, and dithiodicyclohexamide.

S Valence Stabilizer #4: Examples of dithioimidodicarbonic acids, dithiohydrazidodicarbonic acids, bis(dithioimidodicarbonic acids), bis(dithiohydrazidodicarbonic acids), poly(dithioimidodicarbonic acids), poly(dithiohydrazidodicarbonic acids) and derivatives thereof (S—S Bidentates, S—S Tridentates, S—S Tetradentates) that meet the requirements for use as "wide band" valence stabilizers for $Co^{+3}$ include, but are not limited to: dithioimidodicarbonic acid, dithiohydrazidodicarbonic acid, O-phenyldithioimidodicarbonic acid, O-benzyldithioimidodicarbonic acid, O-cyclohexyldithioimidodicarbonic acid, O-norbornyldithioimidodicarbonic acid, O,O'-diphenyldithioimidodicarbonic acid, O,O'-dibenzyldithioimidodicarbonic acid, O,O'-dicyclohexyldithioimidodicarbonic acid, and O,O'-norbornyldithioimidodicarbonic acid.

S Valence Stabilizer #5: Examples of 1,3-dithioketones (dithio-beta-ketonates), 1,3,5-trithioketones, bis(1,3-dithioketones), and poly(1,3-dithioketones) (S—S Bidentates, S—S Tridentates, S—S Tetradentates) that meet the requirements for use as "wide band" valence stabilizers for $Co^{+3}$ include, but are not limited to: hexafluoropentanedithione; 1,3-diphenyl-1,3-propanedithione; thiobenzoylthiopinacolone; dithiocyclohexoylmethane; diphenylpentanetrithionate; tetramethylnonanetrithionate; hexafluoroheptanetrithionate; trifluoroheptanetrithionate; 1-(2-thienyl)-1,3-butanedithione, 1-(2-naphthyl)-1,3-butanedithione, trifluorothioacetylthiocamphor; and 1,3-indandithione.

S Valence Stabilizer #6: Examples of 1,2-dithioketones (dithiolenes, dithio-alpha-ketonates), 1,2,3-trithioketones, dithiotropolonates, o-dithioquinones, bis(1,2-dithioketones), and poly(1,2-dithioketones) (S—S Bidentates, S—S Tridentates, S—S Tetradentates) that meet the requirements for use as "wide band" valence stabilizers for $Co^{+3}$ include, but are not limited to: dithiotropolone; 1,2-dithiobenzoquinone (o-dithioquinone)(o-benzenedithiolate)(bdt); di-tert-butyl-1,2-dithiobenzoquinone; hexafluoro-1,2-dithiobenzoquinone; 1,2-dithionaphthoquinone; 9,10-dithiophenanthroquinone; ethylenedithiolene(edt); maleonitriledithiolene(mnt); trifluoromethyldithiolene(tfd); carbomethoxydithiolene(cmt); trithionedithiolene(dmit); toluenedithiolate(tdt); dithiomanaldehyde(propenethionethiolate)(ptt); dithioacetylacetonate(SacSac); dijulolidinedithiolene; 2,3-piperazinedithiolate; di(4-aminophenyl)dithiolene; dimercaptoisotrithione(dmit); (4-octylphenyl)dithiolene; benzenetetrathiol; tetrathiosquaric acid; trithiodeltic acid; pentathiocroconic acid; dithiocroconic acid; hexathiorhodizonic acid; dithiorhodizonic acid; ethylenetetrathiol; trans-butadienetetrathiolate; tetrathiooxalic acid; 1,2-indandithione; naphthothioquinone; acenapthenethioquinone; aceanthrenethioquinone; and indole-2,3-dithione(thioisatin).

S Valence Stabilizer #7: Examples of dithiomalonamides (dithiomalonodiamides), bis(dithiomalonamides), and polydithiomalonamides (S—S Bidentates, S—S Tridentates, S—S Tetradentates) that meet the requirements for use as "wide band" valence stabilizers for $Co^{+3}$ include, but are not limited to: dithiomalonamide, N-phenyldithiomalonamide, N-benzyldithiomalonamide, N-pentafluorophenyldithiomalonamide, N-cyclohexyldithiomalonamide, N-norbornyldithiomalonamide, N,N'-diphenyldithiomalonamide, N,N'-dibenzyldithiomalonamide, N,N'-dipentafluorophenyldithiomalonamide, N,N'-dicyclohexyldithiomalonamide, and N,N'-norbornyldithiomalonamide.

S Valence Stabilizer #8: Examples of 2-thioacylthioacetamides, bis(2-thioacylthioacetamides), and poly(2-thioacylthioacetamides) (S—S Bidentates, S—S Tridentates, S—S Tetradentates) that meet the requirements for use as "wide band" valence stabilizers for $Co^{+3}$ include, but are not limited to: 2-thioacetothioacetamide, N-phenyl-2-thioacetothioacetamide, N-pentafluorophenyl-2-thioacetothioacetamide, N-benzyl-2-thioacetothioacetamide, N-cyclohexyl-2-thioacetothioacetamide, N-norbornyl-2-thioacetothioacetamide, N-phenyl-2-thiobenzothioacetamide, N-pentafluorophenyl-2-pentafluorothiobenzothioacetamide, and N-cyclohexyl-2-thiocyclohexothioacetamide.

S Valence Stabilizer #9: Examples of dithioacyl sulfides, bis(dithioacyl sulfides), and poly(dithioacyl sulfides), (S—S Bidentates, S—S Tridentates, S—S Tetradentates) that meet the requirements for use as "wide band" valence stabilizers for $Co^{+3}$ include, but are not limited to: dithioacetyl sulfide; dithiopropanoyl sulfide; dithiobenzoyl sulfide; and dithiopentafluorobenzoyl sulfide.

S Valence Stabilizer #10: Examples of trithiodicarbonic diamides, bis(trithiodicarbonic diamides), and poly(trithiodicarbonic diamides) (S—S Bidentates, S—S Tridentates, S—S Tetradentates) that meet the requirements for use as "wide band" valence stabilizers for $Co^{+3}$ include, but are not limited to: trithiodicarbonic diamide; N-phenyltrithiodicarbonic diamide; N-pentafluorophenyltrithiodicarbonic diamide; N-benzyltrithiodicarbonic diamide; N-cyclohexyltrithiodicarbonic diamide; N-norbornyltrithiodicarbonic diamide; N,N'-diphenyltrithiodicarbonic diamide; N,N'-dipentafluorophenyltrithiodicarbonic diamide; N,N'-dibenzyltrithiodicarbonic diamide; N,N'-dicyclohexyltrithiodicarbonic diamide; and N,N'-dinorbornyltrithiodicarbonic diamide.

S Valence Stabilizer #11: Examples of pentathio-, tetrathio-, or trithiodicarbonic acids, bis(pentathio-, tetrathio-, or trithiodicarbonic acids), poly(pentathio-, tetrathio-, or trithiodicarbonic acids), and derivatives thereof (S—S Bidentates, S—S Tridentates, S—S Tetradentates) that meet the requirements for use as "wide band" valence stabilizers for $Co^{+3}$ include, but are not limited to: pentathiodicarbonic acid, tetrathiodicarbonic acid, trithiodicarbonic acid, O-phenyltrithiodicarbonic acid, O-benzyltrithiodicarbonic acid, O-cyclohexyltrithiodicarbonic acid, O-norbornyltrithiodicarbonic acid, O,O'-diphenyltrithiodicarbonic acid, O,O'- dibenzyltrithiodicarbonic acid, O,O'-dicyclohexyltrithiodicarbonic acid, and O,O'-dinorbornyltrithiodicarbonic acid.

S Valence Stabilizer #12: Examples of dithiohypophosphoric acids, bis(dithiohypophosphoric acids), poly(dithiohypophosphoric acids), and derivatives thereof (S—S Bidentates, S—S Tridentates, S—S Tetradentates) that meet the requirements for use as "wide band" valence stabilizers for $Co^{+3}$ include, but are not limited to: dithiohypophosphoric acid, methyldithiohypophosphoric acid, isopropyldithiohypophosphoric acid, tert-butyldithiohypophosphoric acid, phenyldithiohypophosphoric acid, pentafluorophenyldithiohypophosphoric acid, benzyldithiohypophosphoric acid, cyclohexyldithiohypophosphoric acid, norbornyldithiohypophosphoric acid, dimethyldithiohypophosphoric acid, diisopropyldiothiohypophosphoric acid, di-tert-butyldithiohypophosphoric acid, diphenyldithiohypophosphoric acid, di-pentafluorophenyldithiohypophosphoric acid, dibenzyldithiohypophosphoric acid, dicyclohexyldithiohypophosphoric acid, and dinorbornyldithiohypophosphoric acid.

S Valence Stabilizer #13: Examples of dithiohypophosphoramides, bis(dithiohypophosphoramides), and poly (dithiohypophosphoramides) (S—S Bidentates, S—S Tridentates, S—S Tetradentates) that meet the requirements for use as "wide band" valence stabilizers for $Co^{+3}$ include, but are not limited to: dithiohypophosphoramide, N-methyldithiohypophosphoramide, N-isopropyldithiohypophosphoramide, N-tert-butyldithiohypophosphoramide, N-phenyldithiohypophosphoramide, N-pentafluorophenyldithiohypophosphoramide, N-benzyldithiohypophosphoramide, N-cyclohexyldithiohypophosphoramide, N-norbornyldithiohypophosphoramide, N,N'''-dimethyldithiohypophosphoramide, N,N'''-diisopropyldithiohypophosphoramide, N,N'''-di-tert-butyldithiohypophosphoramide, N,N'''-diphenyldithiohypophosphoramide, N,N'''-di-pentafluorophenyldithiohypophosphoramide, N,N'''-dibenzyldithiohypophosphoramide, N,N'''-dicyclohexyldithiohypophosphoramide, and N,N'''-dinorbornyldithiohypophosphoramide.

S Valence Stabilizer #14: Examples of dithioimidodiphosphoric acids, dithiohydrazidodiphosphoric acids, bis(dithioimidodiphosphoric acids), bis(dithiohydrazidodiphosphoric acids), poly(dithioimidodiphosphoric acids), poly(dithiohydrazidodiphosphoric acids), and derivatives thereof (S—S Bidentates, S—S Tridentates, S—S Tetradentates) that meet the requirements for use as "wide band" valence stabilizers for $Co^{+3}$ include, but are not limited to: dithioimidodiphosphoric acid, methyldithioimidodiphosphoric acid, isopropyldithioimidodiphosphoric acid, tert-butyldithioimidodiphosphoric acid, phenyldithioimidodiphosphoric acid, pentafluorophenyldithioimidodiphosphoric acid, benzyldithioimidodiphosphoric acid, cyclohexyldithioimidodiphosphoric acid, norbornyldithioimidodiphosphoric acid, dimethyldithioimidodiphosphoric acid, diisopropyldiothioimidodiphosphoric acid, di-tert-butyldithioimidodiphosphoric acid, diphenyldithioimidodiphosphoric acid, di-pentafluorophenyldithioimidodiphosphoric acid, dibenzyldithioimidodiphosphoric acid, dicyclohexyldithioimidodiphosphoric acid, and dinorbornyldithioimidodiphosphoric acid.

S Valence Stabilizer #15: Examples of dithioimidodiphosphoramides, dithiohydrazidodiphosphoramides, bis(dithioimidodiphosphoramides), bis(dithiohydrazidodiphosphoramides), poly(dithioimidodiphosphoramides), and poly (dithiohydrazidodiphosphoramides) (S—S Bidentates, S—S Tridentates, S—S Tetradentates) that meet the requirements for use as "wide band" valence stabilizers for $Co^{+3}$ include, but are not limited to: dithioimidodiphosphoramide, N-methyldithioimidodiphosphoramide, N-isopropyldithioimidodiphosphoramide, N-tert-butyldithioimidodiphosphoramide, N-phenyldithioimidodiphosphoramide, N-pentafluorophenyldithioimidodiphosphoramide, N-benzyldithioimidodiphosphoramide, N-cyclohexyldithioimidodiphosphoramide, N-norbornyldithioimidodiphosphoramide, N,N'''-dimethyldithioimidodiphosphoramide, N,N'''-diisopropyldithioimidodiphosphoramide, N,N'''-di-tert-butyldithioimidodiphosphoramide, N,N'''-diphenyldithioimidodiphosphoramide, N,N'''-di-pentafluorophenyldithioimidodiphosphoramide, N,N'''-dibenzyldithioimidodiphosphoramide, N,N'''-dicyclohexyldithioimidodiphosphoramide, and N,N'''-dinorbornyldithioimidodiphosphoramide.

S Valence Stabilizer #16: Examples of dithiodiphosphoramides, bis(dithiodiphosphoramides), and poly(dithiodiphosphoramides) (S—S Bidentates, S—S Tridentates, S—S Tetradentates) that meet the requirements for use as "wide band" valence stabilizers for $Co^{+3}$ include, but are not limited to: dithiodiphosphoramide, N-methyldithiodiphosphoramide, N-isopropyldithiodiphosphoramide, N-tert-butyldithiodiphosphoramide, N-phenyldithiodiphosphoramide, N-pentafluorophenyldithiodiphosphoramide, N-benzyldithiodiphosphoramide, N-cyclohexyldithiodiphosphoramide, N-norbornyldithiodiphosphoramide, N,N'''-dimethyldithiodiphosphoramide, N,N'''-diisopropyldithiodiphosphoramide, N,N'''-di-tert-butyldithiodiphosphoramide, N,N'''-diphenyldithiodiphosphoramide, N,N'''-di-pentafluorophenyldithiodiphosphoramide, N,N'''-dibenzyldithiodiphosphoramide, N,N'''-dicyclohexyldithiodiphosphoramide, and N,N'''-dinorbornyldithiodiphosphoramide.

S Valence Stabilizer #17: Examples of dithiodiphosphoric acids, bis(dithiodiphosphoric acids), poly(dithiodiphosphoric acids), and derivatives thereof (S—S Bidentates, S—S Tridentates, S—S Tetradentates) that meet the requirements for use as "wide band" valence stabilizers for $Co^{+3}$ include, but are not limited to: dithiodiphosphoric acid, methyldithiodiphosphoric acid, isopropyldithiodiphosphoric acid, tert-butyldithiodiphosphoric acid, phenyldithiodiphosphoric acid, pentafluorophenyldithiodiphosphoric acid, benzyldithiodiphosphoric acid, cyclohexyldithiodiphosphoric acid, norbornyldithiodiphosphoric acid, dimethyldithiodiphosphoric acid, diisopropyldiothiodiphosphoric acid, di-tert-butyldithiodiphosphoric acid, diphenyldithiodiphosphoric acid, di-pentafluorophenyldithiodiphosphoric acid, dibenzyldithiodiphosphoric acid, dicyclohexyldithiodiphosphoric acid, and dinorbornyldithiodiphosphoric acid.

S Valence Stabilizer #18: Examples of trithiophosphoric acids (phosphorotrithioic acids), bis(trithiophosphoric acids), poly(trithiophosphoric acids), and derivatives thereof (S—S Bidentates, S—S Tridentates, S—S Tetradentates) that meet the requirements for use as "wide band" valence stabilizers for $Co^{+3}$ include, but are not limited to: trithiophosphoric acid, O-phenyltrithiophosphoric acid, O-benzyltrithiophosphoric acid, O-cyclohexyltrithiophosphoric acid, O-norbornyltrithiophosphoric acid, O,S-diphenyltrithiophosphoric acid, O,S-dibenzyltrithiophosphoric acid, O,S-dicyclohexyltrithiophosphoric acid, and O,S-dinorbornyltrithiophosphoric acid.

S Valence Stabilizer #19: Examples of dithiophosphoric acids (phosphorodithioic acids), bis(dithiophosphoric acids), poly(dithiophosphoric acids), and derivatives thereof (S—S Bidentates, S—S Tridentates, S—S Tetradentates) that meet the requirements for use as "wide band" valence stabilizers for $Co^{+3}$ include, but are not limited to: dithiophosphoric acid, O- phenyldithiophosphoricacid, O-benzyldithiophosphoric acid, O-cyclohexyldithiophosphoric acid, O-norbornyldithiophosphoric acid, O,O-diphenyldithiophosphoric acid, O,O-dibenzyldithiophosphoricacid, O,O-dicyclohexyldithiophosphoric acid, and O,O-dinorbornyldithiophosphoricacid.

S Valence Stabilizer #20: Examples of tetrathiophosphoric acids (phosphorotetrathioic acids), bis(tetrathiophosphoric acids), poly(tetrathiophosphoric acids), and derivatives thereof (S—S Bidentates, S—S Tridentates, S—S Tetradentates) that meet the requirements for use as "wide band" valence stabilizers for $Co^{+3}$ include, but are not limited to: tetrathiophosphoric acid, S-phenyltetrathiophosphoric acid, S-benzyltetrathiophosphoric acid, S-cyclohexyltetrathiophosphoric acid, S-norbornyltetrathiophosphoric acid, S,S-diphenyltetrathiophosphoric acid, S,S-dibenzyltetrathiophosphoric acid, S,S-dicyclohexyltetrathiophosphoric acid, and S,S-dinorbornyltetrathiophosphoric acid.

S Valence Stabilizer #21: Examples of phosphoro(dithioperoxo)dithioic acids, bis[phosphoro(dithioperoxo)dithioic acids], poly[phosphoro(dithioperoxo)dithioic acids], and derivatives thereof (S—S Bidentates, S—S Tridentates, S—S Tetradentates) that meet the requirements for use as "wide band" valence stabilizers for $Co^{+3}$ include, but are not limited to: phosphoro(dithioperoxo)dithioic acid, O-phenylphosphoro(dithioperoxo)dithioic acid, O-benzylphosphoro(dithioperoxo)dithioic acid, O-cyclohexylphosphoro(dithioperoxo)dithioic acid, O-norbornylphosphoro(dithioperoxo)dithioic acid, O,S-diphenylphosphoro(dithioperoxo)dithioic acid, O,S-dibenzylphosphoro(dithioperoxo)dithioic acid, O,S-dicyclohexylphosphoro(dithioperoxo)dithioic acid, and O,S-dinorbornylphosphoro(dithioperoxo)dithioic acid.

S Valence Stabilizer #22: Examples of phosphoro(dithioperoxo)thioic acids, bis[phosphoro(dithioperoxo)thioic acids], poly[phosphoro(dithioperoxo)thioic acids], and derivatives thereof (S—S Bidentates, S—S Tridentates, S—S Tetradentates) that meet the requirements for use as "wide band" valence stabilizers for $Co^{+3}$ include, but are not limited to: phosphoro(dithioperoxo)thioic acid, O-phenylphosphoro(dithioperoxo)thioic acid, O-benzylphosphoro(dithioperoxo)thioic acid, O-cyclohexylphosphoro(dithioperoxo)thioic acid, O-norbornylphosphoro(dithioperoxo)thioic acid, O,S-diphenylphosphoro(dithioperoxo)thioic acid, O,S-dibenzylphosphoro(dithioperoxo)thioic acid, O,S-dicyclohexylphosphoro(dithioperoxo)thioic acid, and O,S-dinorbornylphosphoro(dithioperoxo)thioic acid.

S Valence Stabilizer #23: Examples of phosphoro(dithioperoxo)trithioic acids, bis[phosphoro(dithioperoxo)trithioic acids], poly[phosphoro(dithioperoxo)trithioic acids], and derivatives thereof (S—S Bidentates, S—S Tridentates, S—S Tetradentates) that meet the requirements for use as "wide band" valence stabilizers for $Co^{+3}$ include, but are not limited to: phosphoro(dithioperoxo)trithioic acid, O-phenylphosphoro(dithioperoxo)trithioic acid, O-benzylphosphoro(dithioperoxo)trithioic acid, O-cyclohexylphosphoro(dithioperoxo)trithioic acid, O-norbornylphosphoro(dithioperoxo)trithioic acid, O,S-diphenylphosphoro(dithioperoxo)trithioic acid, O,S-dibenzylphosphoro(dithioperoxo)trithioic acid, O,S-dicyclohexylphosphoro(dithioperoxo)trithioic acid, and O,S-dinorbornylphosphoro(dithioperoxo)trithioic acid.

S Valence Stabilizer #24: Examples of beta-mercaptothioketones, beta-mercaptothioaldehydes, bis(beta-mercaptothioketones), bis(beta-mercaptothioaldehydes), poly(beta-mercaptothioketones), and poly(beta-mercaptothioaldehydes) (S—S Bidentates, S—S Tridentates, S—S Tetradentates) that meet the requirements for use as "wide band" valence stabilizers for $Co^{+3}$ include, but are not limited to: 4-mercaptopentan-2-thione; 1,3-diphenyl-3-mercaptopropanethioaldehyde; 1,3-dibenzyl-3-mercaptopropanethioaldehyde; 1,3-dicyclohexyl-3-mercaptopropanethioaldehyde; 1,3-dinorbornyl-3-mercaptopropanethioaldehyde; 1,3-di(2-thienyl)-3-mercaptopropanethioaldehyde; 1,3-di(2-furyl)-3-mercaptopropanethioaldehyde; o-mercaptothioacetophenone; 5-mercapto-1,4-dithionaphthoquinone; 1-mercaptothioacridone; 1-mercaptodithioanthraquinone; 1,8-dimercaptodithioanthraquinone; and beta-mercaptothiobenzophenone.

S Valence Stabilizer #25: Examples of N-(aminomethylthiol)thioureas [N-(aminomercaptomethyl)thioureas], bis[N-(aminomethylthiol)thioureas], and poly[N-(aminomethylthiol)thioureas] (S—S Bidentates, S—S Tridentates, S—S Tetradentates) that meet the requirements for use as "wide band" valence stabilizers for $Co^{+3}$ include, but are not limited to: N'-(aminomercaptomethyl)thiourea; N,N"-dimethyl-N'-(aminomercaptomethyl)thiourea; N,N'-diethyl-N'-(aminomercaptomethyl)thiourea; N,N"-isopropyl-N'-(aminomercaptomethyl)thiourea; N,N"-diphenyl-N'-(aminomercaptomethyl)thiourea; N,N"-dibenzyl-N'-(aminonercaptomethyl)thiourea; N,N"-dicyclohexyl-N'-(aminomercaptomethyl)thiourea; and N,N"-dinorbornyl-N'-(aminomercaptomethyl)thiourea.

S Valence Stabilizer #26: Examples of dithiooxamides, bis(dithiooxamides), and poly(dithiooxamides) (S—S Bidentates, S—S Tridentates, S—S Tetradentates) that meet the requirements for use as "wide band" valence stabilizers for $Co^{+3}$ include, but are not limited to: dithiooxamide (rubeanic acid), N-methyldithiooxamide; N-ethyldithiooxamide; N-isopropyldithiooxamide; N-phenyldithiooxamide; N-benzyldithiooxamide; N-cyclohexyldithiooxamide; N-norbornyldithiooxamide; N,N'-dimethyldithiooxamide; N,N'-diethyldithiooxamide; N,N'-diisopropyldithiooxamide; N,N'-diphenyldithiooxamide; N,N'-dibenzyldithiooxamide; N,N'-dicyclohexyldithiooxamide; and N,N'-dinorbornyldithiooxamide.

S Valence Stabilizer #27: Examples of 1,1-dithiolates, bis(1,1-dithiolates), and poly(1,1-dithiolates) (S—S Bidentates and S—S Tetradentates) that meet the requirements for use as "wide band" valence stabilizers for $Co^{+3}$ include, but are not limited to: 1,1-dicyano-2,2-ethylene dithiolate (i-mnt); 1,1-dicarboalkoxy-2,2-ethylene dithiolate (DED); 1,1-di(trifluoromethyl)-2,2-ethylene dithiolate; 1,1-di(pentafluorophenyl)-2,2-ethylene dithiolate; 1-pentamethylene-2,2-ethylene dithiolate; and 1-nitroethylene dithiolate.

S Valence Stabilizer #28: Examples of dithiomonocarboxylic acids, tri- and tetrathiodicarboxylic Acids, bis(dithiomonocarboxylic acids), bis(tri- and tetrathiodicarboxylic acids), poly(dithiomonocarboxylic acids), poly(tri- and tetrathiodicarboxylic acids), and derivatives thereof (S—S Bidentates and S—S Tetradentates) that meet the requirements for use as "wide band" valence stabilizers for $Co^{+3}$ include, but are not limited to: dithioacetic acid; dithiopropionic acid; dithiobenzoic acid (dtb); dithiophenylacetic acid (dtpa); dithiocyclohexanoic acid; dithiofuroic acid; dithionaphthoic acid; phenyl dithioacetate; phenyl dithiopropionate; phenyl dithiobenzoate; phenyl dithiocyclohexanoate; phenyl dithiofuroate; phenyl dithionaphthoate; tetrathiooxalic acid; tetrathiomalonic acid; tetrathiosuccinic acid; trithiooxalic acid; trithiomalonic acid; trithiosuccinic acid; diphenyl tetrathiooxalate; diphenyl tetrathiomalonate; diphenyl tetrathiosuccinate; diphenyl trithiooxalate; diphenyl trithiomalonate; diphenyl trithiosuccinate; pyridine dithiocarboxylic acid; pyrrole dithiocarboxylic acid; thiophene dithiocarboxylic acid; dithionaphthoic acid; and tetrathiocamphonic acid.

S Valence Stabilizer #29: Examples of perthiomonocarboxylic acids, perthiodicarboxylic acids, bis(perthiomonocarboxylic acids), bis(perthiodicarboxylic acids), poly(perthiomonocarboxylic acids), poly(perthiodicarboxylic acids), and derivatives thereof (S—S Bidentates and S—S Tetradentates) that meet the requirements for use as "wide band" valence stabilizers for $Co^{+3}$ include, but are not limited to: perthioacetic acid; perthiopropionic acid; perthiobenzoic acid; perthiophenylacetic acid; perthiocyclohexanoic acid; perthiofuroic acid; perthionaphthoic acid; phenyl perthioacetate; phenyl perthiopropionate; phenyl perthiobenzoate; phenyl perthiocyclohexanoate; phenyl perthiofuroate; phenyl perthionaphthoate; perthiooxalic acid; perthiomalonic acid; perthiosuccinic acid; diphenyl perthiooxalate; diphenyl perthiomalonate; diphenyl perthiosuccinate; dithiole-3-thione(dithione-3-thione); and benzodithiole-3-thione(benzodithione-3-thione).

S Valence Stabilizer #30: Examples of dithiocarbonates, trithiocarbonates, perthiocarbonates, bis(dithiocarbonates), bis(trithiocarbonates), and bis(perthiocarbonates) (S—S Bidentates and S—S Tetradentates) that meet the requirements for use as "wide band" valence stabilizers for $Co^{+3}$ include, but are not limited to: S,S-diethyldithiocarbonate; S,S-diisopropyldithiocarbonate; S,S-diphenyldithiocarbonate; S,S-dibenzyldithiocarbonate; S,S-dicyclohexyldithiocarbonate; S,S-dinorbornyldithiocarbonate; diethyltrithiocarbonate; diisopropyltrithiocarbonate; diphenyltrithiocarbonate; dibenzyltrithiocarbonate; dicyclohexyltrithiocarbonate; and dinorbornyltrithiocarbonate.

S Valence Stabilizer #31: Examples of dithiocarbamates, bis(dithiocarbamates), and poly(dithiocarbamates) (including N-hydroxydithiocarbamates and N-mercaptodithiocarbamates) (S—S Bidentates, S—S Tridentates, and S—S Tetradentates) that meet the requirements for use as "wide band" valence stabilizers for $Co^{+3}$ include, but are not limited to: dimethyldithiocarbamate (dmdtc); di(trifluorodimethyl)dithiocarbamate; diethyldithiocarbamate (dedtc); dipropyldithiocarbamate; diisopropyldithiocarbamate; dibutyldithiocarbamate; ditertbutyldithiocarbamate; dicyanamidodithiocarbamate; azidothioformates; diphenyldithiocarbamate; di(pentafluorophenyl)dithiocarbamate; dibenzyldithiocarbamate; dinaphthyldithiocarbamate; dicyclohexyldithiocarbamate; dinorbornyldithiocarbamate; diadamantyldithiocarbamate; pyrrolidinodithiocarbamate (pyrdtc); piperidinodithiocarbamate (pipdtc); morpholinodithiocarbamate (mordtc); thiamorpholinodithiocarbamate; 3-pyrrolinodithiocarbamate; pyrrolodithiocarbamate; oxazolodithiocarbamate; isoxazolodithiocarbamate; thiazolodithiocarbamate; isothiazolodithiocarbamate; indolodithiocarbamate; carbazolodithiocarbamate; pyrazolinodithiocarbamate; imidazolinodithiocarbamate; pyrazolodithiocarbamate; imidazolodithiocarbamate; indazolodithiocarbamate; and triazolodithiocarbamate.

S Valence Stabilizer #32: Examples of dithiocarbazates (dithiocarbazides), bis(dithiocarbazates), and poly(dithiocarbazates) (S—S Bidentates, S—S Tridentates, and S—S Tetradentates; or possibly N—S Bidentates, N—S Tridentates, and N—S Tetradentates) that meet the requirements for use as "wide band" valence stabilizers for $Co^{+3}$ include, but are not limited to: N,N'-dimethyldithiocarbazate; N,N'-di(trifluoromethyl)dithiocarbazate; N,N'-diethyldithiocarbazate; N,N'-diphenyldithiocarbazate; N,N'-dibenzyldithiocarbazate; N,N'-di(pentafluorophenyl)dithiocarbazate; N,N'-dicyclohexyldithiocarbazate; and N,N'-dinorbornyldithiocarbazate.

N—S Valence Stabilizer #1: Examples of diformamidine disulfides (thioperoxydicarbonimidic diamides), thioperoxytricarbonimidic diamides, thioperoxytetracarbonimidic diamides, bis(diformamidine disulfides), and poly(diformamidine disulfides) (N—S bidentates, N—N—S tridentates, or N—S tetradentates) that meet the requirements for use as "wide band" valence stabilizers for $Co^{+3}$ include, but are not limited to: diformamidine disulfide; methyldiformamidine disulfide; ethyldiformamidine disulfide; isopropyldiformamidine disulfide; butyldiformamidine disulfide; benzyldiformamidine disulfide; phenyldiformamidine disulfide; tolyldiformamidine disulfide; naphthyldiformamidine disulfide; cyclohexyldiformamidine disulfide; norbornyldiformamidine disulfide; adamantyldiformamidine disulfide; dimethyldiformamidine disulfide; diethyldiformamidine disulfide; diisopropyldiformamidine disulfide; dibutyldiformamidine disulfide; dibenzyldiformamidine disulfide; diphenyldiformamidine disulfide; ditolyldiformamidine disulfide; dinaphthyldiformamidine disulfide; dicyclohexyldiformamidine disulfide; dinorbornyldiformamidine disulfide; diadamantyldiformamidine disulfide; 2-S-amidinodisulfidothiazole; 2-S-amidinodisulfidooxazole; 2-S-amidinodisulfidoimidazole; 3-S-amidinodisulfidopyrazole; 3-S-amidinodisulfido-1,2,4-triazole; and 5-S-amidinodisulfidotetrazole.

N—S Valence Stabilizer #2: Examples of S-amidinodithiocarbamates, bis(S-amidinodithiocarbamates), and poly(S-amidinodithiocarbamates) (N—S Bidentates and N—S Tetradentates) that meet the requirements for use as "wide band" valence stabilizers for $Co^{+3}$ include, but are not limited to: S-amidinodithiocarbamate; N-methyl-S-amidinodithiocarbamate; N-ethyl-S-amidinodithiocarbamate; N-isopropyl-S-amidinodithiocarbamate; N-butyl-S-amidinodithiocarbamate; N-benzyl-S-amidinodithiocarbamate; N-phenyl-S-amidinodithiocarbamate; N-tolyl-S-amidinodithiocarbamate; N-naphthyl-S-amidinodithiocarbamate; N-cyclohexyl-S-amidinodithiocarbamate; N-norbornyl-S-amidinodithiocarbamate; N-adamantyl-S-amidinodithiocarbamate; N,N'-dimethyl-S-amidinodithiocarbamate; N,N'-diethyl-S-amidinodithiocarbamate; N,N'-diisopropyl-S-amidinodithiocarbamate; N,N'-dibutyl-S-amidinodithiocarbamate; N,N'-dibenzyl-S-amidinodithiocarbamate; N,N'-diphenyl-S-amidinodithiocarbamate; N,N'-ditolyl-S-amidinodithiocarbamate; N,N'-dinaphthyl-S-amidinodithiocarbamate; N,N'-dicyclohexyl-S-amidinodithiocarbamate; N,N'-dinorbornyl-S-amidinodithiocarbamate; N,N'-diadamantyl-S-amidinodithiocarbamate; ethylenebis(S-amidinodithiocarbamate); propylenebis(S-amidinodithiocarbamate); phenylenebis(S-amidinodithiocarbamate); piperazinebis(S-amidinodithiocarbamate); oxalylbis(S-amidinodithiocarbamate); malonylbis(S-amidinodithiocarbamate); succinylbis(S-amidinodithiocarbamate); phthalylbis(S-amidinodithiocarbamate); 2-S-dithiocarbamatothiazole; 2-S-dithiocarbamatooxazole; 2-S-dithiocarbamatoimidazole; 3-S-dithiocarbamatopyrazole; 3-S-dithiocarbamato-1,2,4-triazole; and 5-S-dithiocarbamatotetrazole.

N—S Valence Stabilizer #3: Examples of O-amidinothiocarbamates, bis(O-amidinothiocarbamates), and poly(O-amidinothiocarbamates) (N—S Bidentates and N—S Tetradentates) that meet the requirements for use as "wide band" valence stabilizers for $Co^{+3}$ include, but are not limited to: O-amidinothiocarbamate; N-methyl-O-amidinothiocarbamate; N-ethyl-O-amidinothiocarbamate; N-isopropyl-O-amidinothiocarbamate; N-butyl-O-amidinothiocarbamate; N-benzyl-O-amidinothiocarbamate; N-phenyl-O-amidinothiocarbamate; N-tolyl-O-amidinothiocarbamate; N-naphthyl-O-amidinothiocarbamate; N-cyclohexyl-O-amidinothiocarbamate; N-norbornyl-O-amidinothiocarbamate; N-adamantyl-O-amidinothiocarbamate; N,N'-dimethyl-O-amidinothiocarbamate; N,N'-diethyl-O-amidinothiocarbamate; N,N'-diisopropyl-O-amidinothiocarbamate; N,N'-dibutyl-O-amidinothiocarbamate; N,N'-dibenzyl-O-amidinothiocarbamate; N,N'-diphenyl-O-amidinothiocarbamate; N,N'-ditolyl-O-amidinothiocarbamate; N,N'-dinaphthyl-O-amidinothiocarbamate; N,N'-dicyclohexyl-O-amidinothiocarbamate; N,N'-dinorbornyl-O-amidinothiocarbamate; N,N'-diadamantyl-O-amidinothiocarbamate; ethylenebis(O-amidinothiocarbamate); propylenebis(O-amidinothiocarbamate); phenylenebis(O-amidinothiocarbamate); piperazinebis(O-amidinothiocarbamate); oxalylbis(O-amidinothiocarbamate); malonylbis(O-amidinothiocarbamate); succinylbis(O-amidinothiocarbamate); phthalylbis(O-amidinothiocarbamate); 2-O-monothiocarbamatothiazole; 2-O-monothiocarbamatooxazole; 2-O-monothiocarbamatoimidazole; 3-O-monothiocarbamatopyrazole; 3-O-monothiocarbamato-1,2,4-triazole; 5-O-monothiocarbamatotetrazole.

N—S Valence Stabilizer #4: Examples of S-amidinoperoxythiocarbamates, bis(S-amidinoperoxythiocarbamates), and poly(S-amidinoperoxythiocarbamates) (N—S Bidentates and N—S Tetradentates) that meet the requirements for use as "wide band" valence stabilizers for $Co^{+3}$ include, but are not limited to: S-amidinoperoxythiocarbamate; N-methyl-S-amidinoperoxythiocarbamate; N-ethyl-S-amidinoperoxythiocarbamate; N-isopropyl-S-amidinoperoxythiocarbamate; N-butyl-S-amidinoperoxythiocarbamate; N-benzyl-S-amidinoperoxythiocarbamate; N-phenyl-S-amidinoperoxythiocarbamate; N-tolyl-S-amidinoperoxythiocarbamate; N-naphthyl-S-amidinoperoxythiocarbamate; N-cyclohexyl-S-amidinoperoxythiocarbamate; N-norbornyl-S-amidinoperoxythiocarbamate; N-adamantyl-S-amidinoperoxythiocarbamate; N,N'-dimethyl-S-amidinoperoxythiocarbamate; N,N'-diethyl-S-amidinoperoxythiocarbamate; N,N'-diisopropyl-S-amidinoperoxythiocarbamate; N,N'-dibutyl-S-amidinoperoxythiocarbamate; N,N'-dibenzyl-S-amidinoperoxythiocarbamate; N,N'-diphenyl-S-amidinoperoxythiocarbamate; N,N'-ditolyl-S-amidinoperoxythiocarbamate; N,N'-dinaphthyl-S-amidinoperoxythiocarbamate; N,N'-dicyclohexyl-S-amidinoperoxythiocarbamate; N,N'-dinorbornyl-S-amidinoperoxythiocarbamate; N,N'-diadamantyl-S-amidinoperoxythiocarbamate; ethylenebis(S-amidinoperoxythiocarbamate); propylenebis(S-amidinoperoxythiocarbamate); phenylenebis(S-amidinoperoxythiocarbamate); piperazinebis(S-amidinoperoxythiocarbamate); oxalylbis(S-amidinoperoxythiocarbamate); malonylbis(S-amidinoperoxythiocarbamate); succinylbis(S-amidinoperoxythiocarbamate); and phthalylbis(S-amidinoperoxythiocarbamate).

N—S Valence Stabilizer #5: Examples of phosphorimidothioic acid; phosphorimidodithioic acid; phosphorimidotrithioic acid; bis(phosphorimidothioic acid); bis(phosphorimidodithioic acid); bis(phosphorimidotrithioic acid); poly(phosphorimidothioic acid); poly(phosphorimidodithioic acid); poly(phosphorimidotrithioic acid); and derivatives thereof (N—S Bidentates and N—S Tetradentates) that meet the requirements for use as "wide band" valence stabilizers for $Co^{+3}$ include, but are not limited to: phosphorimidothioic acid; phosphorimidodithioic acid; phosphorimidotrithioic acid; O-phenylphosphorimidothioic acid; O-benzylphosphorimidothioic acid; O-cyclohexylphosphorimidothioic acid; O-norbornylphosphorimidothioic acid; O,O'-diphenylphosphorimidothioic acid; O,O'-dibenzylphosphorimidothioic acid; O,O'-dicyclohexylphosphorimidothioic acid; and O,O'-dinorbornylphosphorimidothioic acid.

N—S Valence Stabilizer #6: Examples of phosphorothioic triamides, bis(phosphorothioic triamides), and poly(phosphorothioic triamides) (N—S Bidentates and N—S Tetradentates) that meet the requirements for use as "wide band" valence stabilizers for $Co^{+3}$ include, but are not limited to: phosphorothioic triamide; phosphorothioic trihydrazide; phosphoramidothioic dihydrazide; N-phenylphosphorothioic triamide; N-benzylphosphorothioic triamide; N-cyclohexylphosphorothioic triamide; N-norbornylphosphorothioic triamide; N,N'-diphenylphosphorothioic triamide; N,N'-dibenzylphosphorothioic triamide; N,N'-dicyclohexylphosphorothioic triamide; and N,N'-dinorbornylphosphorothioic triamide.

N—S Valence Stabilizer #7: Examples of phosphoramidotrithioic acid, phosphorodiamidodithioic acid, bis(phosphoramidotrithioic acid), bis(phosphorodiamidodithioic acid), poly(phosphoramidotrithioic acid), poly(phosphorodiamidodithioic acid), and derivatives thereof (N—S Bidentates and N—S Tetradentates) that meet the requirements for use as "wide band" valence stabilizers for $Co^{+3}$ include, but are not limited to: phosphoramidotrithioic acid, phosphorodiamidodithioic acid, S-phenylphosphoramidotrithioic acid, S-benzylphosphoramidotrithioic acid, S-cyclohexylphosphoramidotrithioic acid, S-norbornylphosphoramidotrithioic acid, S,S'-diphenylphosphoramidotrithioic acid, S,S'-dibenzylphosphoramidotrithioic acid, S,S'-dicyclohexylphosphoramidotrithioic acid, and S,S'-dinorbornylphosphoramidotrithioic acid.

N—S Valence Stabilizer #8: Examples of phosphoramidothioic acid, phosphoramidodithioic acid, phosphorodiamidothioic acid, bis(phosphoramidothioic acid), bis(phosphoramidodithioic acid), bis(phosphorodiamidothioic acid), poly(phosphoramidothioic acid), poly(phosphoramidodithioic acid), and poly(phosphorodiamidothioic acid) (N—S Bidentates and N—S Tetradentates) that meet the requirements for use as "wide band" valence stabilizers for $Co^{+3}$ include, but are not limited to: phosphoramidothioic acid, phosphoramidodithioic acid, phosphorodiamidothioic acid, phosphorohydrazidothioic acid, phosphorohydrazidodithioic acid, phosphorodihydrazidothioic acid, phosphoramidohydrazidothioic acid, O-phenylphosphoramidothioic acid, O-benzylphosphoramidothioic acid, O-cyclohexylphosphoramidothioic acid, O-norbornylphosphoramidothioic acid, S-phenylphosphoramidodithioic acid, S-benzylphosphoramidodithioic acid, S-cyclohexylphosphoramidodithioic acid, and S-norbornylphosphoramidodithioic acid.

N—S Valence Stabilizer #9: Examples of N-thioacyl 7-aminobenzylidenimines (N—S Bidentates or N—S Tetradentates) that meet the requirements for use as "wide band" valence stabilizers for $Co^{+3}$ include, but are not limited to: N-thioacetyl 7-methylaminobenzylidenimine; N-thioacetyl 7-phenylaminobenzylidenimine; N-thiobenzoyl 7-methylaminobenzylidenimine; and N-thiobenzoyl 7-phenylaminobenzylidenimine.

N—S Valence Stabilizer #10: Examples of thiohydroxamates (thiohydroxylamines), bis(thiohydroxamates), and poly (thiohydroxamates) (N—S Bidentates, N—S Tetradentates, and N—S Hexadentates) that meet the requirements for use as "wide band" valence stabilizers for $Co^{+3}$ include, but are not limited to: acetothiohydroxamic acid; propianothiohydroxamic acid; butyrothiohydroxamic acid; crotonothiohydroxamic acid; sorbothiohydroxamic acid; benzothiohydroxamic acid; toluicthiohydroxamic acid; salicylthiohydroxamic acid; phenylacetothiohydroxamic acid; anthranilthiohydroxamic acid; nicotinethiohydroxamic acid; picolinethiohydroxamic acid; cyclohexanethiohydroxamic acid; quinoline 8-thiohydroxamic acid; cinnamylthiohydroxamic acid; oxaldithiohydroxamic acid; succinylbis-N-phenylthiohydroxamic acid; adipylbis-N-phenylthiohydroxamic acid; glyoxalthiohydroxamic acid; 2-thiophenethiocarbohydroxamic acid; thenoylthiohydroxamic acid; N-phenylbenzothiohydroxamic acid; N-tolylbenzothiohydroxamic acid; N-phenylacetothiohydroxamic acid; N-phenyl-2-thenoylthiohydroxamic acid; and N-tolyl-2-thenoylthiohydroxamic acid.

N—S Valence Stabilizer #11: Examples of alpha- or ortho-aminothiocarboxylic acids, and alpha- or ortho-aminothiodicarboxylic acids, and derivatives thereof (N—S Bidentates, N—S Tridentates, and N—S Tetradentates) that meet the requirements for use as "wide band" valence stabilizers for $Co^{+3}$ include, but are not limited to: 2-pyridinethiocarboxylic acid (thiopicolinic acid); 2-pyrazinethiocarboxylic acid; o-aminothiobenzoic acid; o-aminothionaphthoic acid; and 3,6-diaminothiophthalic acid.

N—S Valence Stabilizer #12: Examples of thiosemicarbazones, bis(thiosemicarbazones), and poly(thiosemicarbazones) (N—S Bidentates, N—S Tetradentates, and N—S Hexadentates) that meet the requirements for use as "wide band" valence stabilizers for $Co^{+3}$ include, but are not limited to: acetaldehyde thiosemicarbazone; acetone thiosemicarbazone; pinacolone thiosemicarbazone; benzaldehyde thiosemicarbazone; naphthaldehyde thiosemicarbazone; norbornanone thiosemicarbazone; camphor thiosemicarbazone; nopinone thiosemicarbazone; 2-pyridinaldehyde thiosemicarbazone; salicylaldehyde thiosemicarbazone; quinolinaldehyde thiosemicarbazone; isatin dithiosemicarbazone; camphorquinone dithiosemicarbazone; camphorquinone dithiosemicarbazone; picolinaldehyde thiosemicarbazone; dipyridyl glyoxal dithiosemicarbazone; di-2-pyridyl ketone thiosemicarbazone; methyl-2-pyridyl ketone thiosemicarbazone; glyoxal dithiosemicarbazone; acetophenone thiosemicarbazone; biacetyl monoxime thiosemicarbazone; acetamidobenzaldehyde thiosemicarbazone; thymolaldothiosemicarbazone; thiophene-2-aldehyde thiosemicarbazone; phthalaldehyde dithiosemicarbazone; phthalimide dithiosemicarbazone; furaldehyde thiosemicarbazone; naphthoquinone thiosemicarbazone; phenanthrequinone thiosemicarbazone; cyclohexanedione dithiosemicarbazone; ionone thiosemicarbazone; bisthiosemicarbazone of diethyl-3,4-dioxadioate; pyridoxal alkylthiosemicarbazones; benzylidene phenylthiosemicarbazones; lawsone thiosemicarbazone; and 1-benzoin-4-phenylthiosemicarbazone (bps).

N—S Valence Stabilizer #13: Examples of thioacyl hydrazones, bis(thioacyl hydrazones), and poly(thioacyl hydrazones) (N—S Bidentates, N—S Tetradentates, and N—S Hexadentates) that meet the requirements for use as "wide band" valence stabilizers for $Co^{+3}$ include, but are not limited to: acetaldehyde N-thioformylhydrazone; acetaldehyde N-thiobenzoylhydrazone; acetone N-thioformylhydrazone; acetone N-thiobenzoylhydrazone; pinacolone N-thioformylhydrazone; pinacolone N-thiobenzoylhydrazone; benzaldehyde N-thioformylhydrazone; benzaldehyde N-thiobenzoylhydrazone; naphthaldehyde N-thioformylhydrazone; naphthaldehyde N-thiobenzoylhydrazone; norbornanone N-thioformylhydrazone; norbornanone N-thiobenzoylhydrazone; camphor N-thioformylhydrazone; camphor N-thiobenzoylhydrazone; nopinone N-thioformylhydrazone; nopinone N-thiobenzoylhydrazone; 2-pyridinaldehyde N-thioformylhydrazone; 2-pyridinaldehyde N-thiobenzoylhydrazone; salicylaldehyde N-thioformylhydrazone; salicylaldehyde N-thiobenzoylhydrazone; quinolinaldehyde N-thioformylhydrazone; quinolinaldehyde N-thiobenzoylhydrazone; thiophene-2-aldehyde N-thioformylhydrazone; thiophene-2-aldehyde N-thiobenzoylhydrazone; naphthoquinone N-thioformylhydrazone; naphthoquinone N-thiobenzoylhydrazone; ionone N-thioformylhydrazone; ionone N-thiobenzoylhydrazone; benzaldehyde benzothiazolehydrazone; lawsone N-thioformylhydrazone; and lawsone N-thiobenzoylhydrazone.

N—S Valence Stabilizer #14: Examples of thiocarbazones (diazenecarbothioic hydrazides), bis(thiocarbazones), and poly(thiocarbazones) (N—S Bidentates, N—S Tetradentates, and N—S Hexadentates) that meet the requirements for use as "wide band" valence stabilizers for $Co^{+3}$ include, but are not limited to: diphenylthiocarbazone (dithizone); 2-phenylthiocarbazone; dinaphthylthiocarbazone; 2-naphthylthiocarbazone; and ambazone.

N—S Valence Stabilizer #15: Examples of azo compounds with thiol or mercapto or thiocarbonyl substitution at the ortho- (for aryl) or alpha- or beta- (for alkyl) positions, Bis[o-(HS—) or alpha- or beta-(HS—)azo compounds], or Poly[o-(HS—) or alpha- or beta-(HS—)azo compounds) (N—S Bidentates, N—S Tridentates, N—S Tetradentates, or N—S Hexadentates) that meet the requirements for use as "wide band" valence stabilizers for $Co^{+3}$ include, but are not limited to: 2-thiolazobenzene[1-(phenylazo)-2-thiophenol]; 2,2'-dithioazobenzene; (2-thiophene)azobenzene; 1-(4-nitrophenylazo)-2-thionaphthol; 2-thiazolylazobenzene; and 2-benzothiazolylazobenzene.

N—S Valence Stabilizer #16: Examples of diazeneformothioamides, diazeneacetothioamides, bis(diazeneformothioamides), bis(diazeneacetothioamides), poly(diazeneformothioamides), and poly(diazeneacetothioamides) (N—S Bidentates, N—S Tetradentates, and N—S Hexadentates) that meet the requirements for use as "wide band"

valence stabilizers for $Co^{+3}$ include, but are not limited to: diazeneformothioamide, diazeneacetothioamide, phenyldiazeneformothioamide, diphenyldiazeneformothioamide, phenyldiazeneacetothioamide, and diphenyldiazeneacetothioamide.

N—S Valence Stabilizer #17: Examples of diazenecarbothioic acids, diazenecarbodithioic acids, bis(diazenecarbothioic acids), bis(diazenecarbodithioic acids), poly(diazenecarbothioic acids), poly(diazenecarbodithioic acids) and derivatives thereof (N—S Bidentates, N—S Tetradentates, N—S Hexadentates) that meet the requirements for use as "wide band" valence stabilizers for $Co^{+3}$ include, but are not limited to: diazeneformothioic acid, diazeneacetothioic acid, phenyldiazeneformothioic acid, diphenyldiazeneformothioic acid, phenyldiazeneacetothioic acid, and diphenyldiazeneacetothioic acid.

N—S Valence Stabilizer #18: Examples of diazeneformothioaldehydes, diazeneacetothioaldehydes, bis(diazeneformothioaldehydes), bis(diazeneacetothioaldehydes), poly(diazeneformothioaldehydes), and poly(diazeneacetothioaldehydes) (N—S Bidentates, N—S Tetradentates and N—S Hexadentates) that meet the requirements for use as "wide band" valence stabilizers for $Co^{+3}$ include, but are not limited to: diazeneformothioaldehyde, diazeneacetothioaldehyde, phenyldiazeneformothioaldehyde, diphenyldiazeneformothioaldehyde, phenyldiazeneacetothioaldehyde, and diphenyldiazeneacetothioaldehyde.

N—S Valence Stabilizer #19: Examples of diazenediformothioamides, diazenediacetothioamides, bis(diazenediformothioamides), bis(diazenediacetothioamides), poly(diazenediformothioamides), and poly(diazenediacetothioamides) (N—S Tridentates and N—S Hexadentates) that meet the requirements for use as "wide band" valence stabilizers for $Co^{+3}$ include, but are not limited to: diazenediformodithioamide, diazenediacetodithioamide, diphenydiazenediformodithioamide, tetraphenyldiazenediformodithioamide, diphenyldiazenediacetodithioamide, and tetraphenyldiazenediacetodithioamide.

N—S Valence Stabilizer #20: Examples of diazenedicarbothioic acids, diazenedicarbodithioic acids, bis(diazenedicarbothioic acids), bis(diazenedicarbodithioic acids), poly(diazenedicarbothioic acids), poly(diazenedicarbodithioic acids) and derivatives thereof (N—S Tridentates and N—S Hexadentates) that meet the requirements for use as "wide band" valence stabilizers for $Co^{+3}$ include, but are not limited to: diazenediformothioic acid, diazenediacetodithioic acid, phenyldiazenediformothioic acid, diphenyldiazenediformothioic acid, phenyldiazenediacetodithioic acid, and diphenyldiazenediacetodithioic acid.

N—S Valence Stabilizer #21: Examples of diazenediformothioaldehydes, diazenediacetothioaldehydes, bis(diazenediformothioaldehydes), bis(diazenediacetothioaldehydes), poly(diazenediformothioaldehydes), and poly(diazenediacetothioaldehydes) (N—S Tridentates and N—S Hexadentates) that meet the requirements for use as "wide band" valence stabilizers for $Co^{+3}$ include, but are not limited to: diazenediformothioaldehyde, diazenediacetothioaldehyde, diphenyldiazenediformothioaldehyde, and diphenyldiazenediacetothioaldehyde.

N—S Valence Stabilizer #22: Examples of ortho-thio (or -mercapto) substituted formazans, bis(o-thio or -mercapto substituted formazans), and poly(o-thio or -mercapto substituted formazans) (N—S Bidentates, N—S Tridentates, N—S Tetradentates, and N—S Hexadentates) that meet the requirements for use as "wide band" valence stabilizers for $Co^{+3}$ include, but are not limited to: 1-(2-thiophenyl)-3,5-diphenylformazan; 1-(2-methylmercaptophenyl)-3,5-diphenylformazan; 1,5-bis(2-thiophenyl)-3-phenylformazan; and 5-bis(2-methylmercaptophenyl)-3-phenylformazan.

N—S Valence Stabilizer #23: Examples of ortho-thio (or -mercapto) substituted azines (including ketazines), bis(o-thio or mercapto substituted azines), and poly(o-thio or mercapto substituted azines) (N—S Bidentates, N—S Tridentates, N—S Tetradentates, and N—S Hexadentates) that meet the requirements for use as "wide band" valence stabilizers for $Co^{+3}$ include, but are not limited to: 2-mercapto-1-benzalazine; 2-mercapto-1-naphthalazine; and 2-mercapto-1-cyclohexanonazine.

N—S Valence Stabilizer #24: Examples of Schiff Bases with one Imine (C═N) Group and with ortho- or alpha- or beta-thio or mercapto or thiocarbonyl substitution (N—S Bidentates, N—S Tridentates, N—S Tetradentates, N—S Pentadentates, or N—S Hexadentates) that meet the requirements for use as "wide band" valence stabilizers for $Co^{+3}$ include, but are not limited to: N-(Thiosalicylaldehydo)isopropylamine; N-(2-thiophenecarboxaldehydo)isopropylamine; N-(2-Acetylthiopheno)isopropylamine; N-(2-Thioacetophenono)isopropylamine; N-(Thiosalicylaldehydo)cyclohexylamine; N-(2-Thiophenecarboxaldehydo)cyclohexylamine; N-(2-Acetylthiopheno)cyclohexylamine; N-(2-Thioacetophenono)cyclohexylamine; N-(Thiosalicylaldehydo)aniline; N-(2-Thiophenecarboxaldehydo)aniline; N-(2-Acetylthiopheno)aniline; N-(2-Thioacetophenono)aniline; N-(Thiosalicylaldehydo)aminonorbornane; N-(2-Thiocarboxaldehydo)aminonorbornane; N-(2-Acetylthiopheno)aminonorbornane; N-(2-Thioacetophenono)aminonorbornane; 4-aminobenzylidene-3-propyl-5-mercapto-1,2,4-triazole; 4-aminocinnamalidene-3-propyl-5-mercapto-1,2,4-triazole (acpmt); 4-aminosalicylidene-3-propyl-5-mercapto-1,2,4-triazole (aspmt); 4-aminovanillidene-3-propyl-5-mercapto-1,2,4-triazole; 4-aminodimethylaminobenzylidene-3-propyl-5-mercapto-1,2,4-triazole (adpmt); cinnamylideneaminophenylthiazole; N-(2-mercaptophenyl)salicylidenimine; 2-thiophenecarboxaldehyde phenylhydrazone; 2-thiophenecarboxaldehyde 2-pyridyl hydrazone; 2-mercaptobenzaldehyde phenylhydrazone; and 2-mercaptobenzaldehyde 2-pyridyl hydrazone. Also includes Schiff Bases derived from the reaction of carbonyl compounds with dithiocarbazates, and hydrazones with ortho-S substitution.

N—S Valence Stabilizer #25: Examples of Schiff Bases with two Imine (C═N) Groups and with ortho- or alpha- or beta-thio or mercapto or thiocarbonyl substitution (N—S Tridentates, N—S Tetradentates, N—S Pentadentates, or N—S Hexadentates) that meet the requirements for use as "wide band" valence stabilizers for $Co^{+3}$ include, but are not limited to: N,N'-(2,5-Thiophenedicarboxaldehydo)diisopropylamine; N,N'-(2,5-Thiophenedicarboxaldehydo)dicyclohexylamine; N,N'-(2,5-Thiophenedicarboxaldehydo)dianiline; N,N'-(2,5-Thiophenedicarboxaldehydo)diaminonorbornane; N,N'-(o-Thiophthalicdialdehydo)diisopropylamine; N,N'-(o-Thiophthalicdialdehydo)dicyclohexylamine; N,N'-(o-Thiophthalicdialdehydo)dianiline; N,N'-(o-Thiophthalicdialdehydo)diaminonorbornane; N,N'-(o-Thioformylcamphoro)diisopropylamine; N,N'-(o-Thioformylcamphoro)dicyclohexylamine; N,N'-(o-Thioformylcamphoro)dianiline; N,N'-(o-Thioformylcamphoro)diaminonorbornane; N,N'-(o-Thiodiacetylbenzeno)

diisopropylamine; N,N'-(o-Thiodiacetylbenzeno) dicyclohexylamine; N,N'-(o-Thiodiacetylbenzeno)dianiline; N,N'-(o-Thiodiacetylbenzeno)di-aminonorbornane; N,N'-(3,6-Dithio-1,2-cyclohexanono)diisopropylamine; N,N'-(3,6-Dithio-1,2-cyclohexanono)dicyclohexylamine; N,N'-(3,6-Dithio-1,2-cyclohexanono)dianiline; N,N'-(3,6-Dithio-1,2-cyclohexanono)di-aminonorbornane; N,N'-(2,5-Diacetylthiopheno)diisopropylamine; N,N'-(2,5-Diacetylthiopheno)dicyclohexylamine; N,N'-(2,5-Diacetylthiopheno)dianiline; N,N'-(2,5-Diacetylthiopheno) di-aminonorbornane; N,N'-(Thiosalicylaldehydo) ethylenediamine; N,N'-(o-Thionaphthaldehydo) ethylenediamine; N,N'-(o-Thioacetophenono) ethylenediamine; N,N'-(Thiosalicylaldehydo) trimethylenediamine; N,N'-(o-Thionaphthaldehydo) trimethylenediamine; N,N'-(o-Thioacetophenono) trimethylenediamine; N,N'-(Thiosalicylaldehydo) cyclohexane-1,2-diamine; N,N'-(o-Thionaphthaldehydo) cyclohexane-1,2-diamine; N,N'-(o-Thioacetophenono) cyclohexane-1,2-diamine; N,N'-(Thiosalicylaldehydo)-1,2-diaminobenzene; N,N'-(o-Thionaphthaldehydo)-1,2-diaminobenzene; and N,N'-(o-Thioacetophenono)-1,2-diaminobenzene. Also includes Schiff Bases derived from the reaction of carbonyl compounds with dithiocarbazates, and hydrazones with ortho-S substitution.

N—S Valence Stabilizer #26: Examples of Schiff Bases with three Imine (C═N) Groups and with ortho- or alpha- or beta-thio or mercapto or thiocarbonyl substitution (N—S Tetradentates, N—S Pentadentates, or N—S Hexadentates) that meet the requirements for use as "wide band" valence stabilizers for $Co^{+3}$ include, but are not limited to: N,N',N"-(Thiosalicylaldehydo)tris(2-aminoethyl)amine; N,N',N"-(o-Thionaphthaldehydo)tris(2-aminoethyl)amine; and N,N',N"-(o-Thioacetophenono)tris(2-aminoethyl)amine. Also includes Schiff Bases derived from the reaction of carbonyl compounds with dithiocarbazates, and hydrazones with ortho-S substitution.

N—S Valence Stabilizer #27: Examples of thioalkyl amines (aminothiols or aminodisulfides) and thioalkyl imines (iminothiols or iminodisulfides) (N—S Bidentates, N—S Tridentates, N—S Tetradentates, and N—S Hexadentates) that meet the requirements for use as "wide band" valence stabilizers for $Co^{+3}$ include, but are not limited to: 2-mercapto-1-aminoethane; 2-methylmercapto-1-aminoethane; 3-mercapto-1-aminopropane; 1-mercapto-2-amino-2-methylpropane; 2-mercaptocyclohexylamine; 3-mercapto-2-aminonorbornane; 1,3-dimercapto-2-aminopropane; 1,5-dimercapto-3-aminopentane; 2,2'-diaminodiethyl sulfide; 3,3'-diaminodipropyl sulfide; 2,2'-diaminodicyclohexyl sulfide; 1,6-dimercapto-3,4-diaminohexane; 1,7-dimercapto-3,5-diaminoheptane; 1,6-diamino-3,4-dimercaptohexane; 1,7-diamino-3,5-dimercaptoheptane; tri(mercaptomethyl)amine; tri(2-mercaptoethyl)amine; dithiooxamide (rubeanic acid); 2,2'-diaminodiethyl disulfide; 3,3'-diaminodipropyl disulfide; 2,2'-diaminodicyclohexyl disulfide; 3-amino-1,5-pentanedithiodialdehyde; 3,4-diamino-1,6-hexanedithiodialdehyde; 3,5-diamino-1,7-heptanedithiodialdehyde; iminobisacetic acid; iminobispropionic acid; and bis(hydroxyethyl)aminoalkyl sulfide.

N—S Valence Stabilizer #28: Examples of thioaryl amines and thioaryl imines (N—S Bidentates, N—S Tridentates, N—S Tetradentates, and N—S Hexadentates) that meet the requirements for use as "wide band" valence stabilizers for $Co^{+3}$ include, but are not limited to: 2-aminothiophenol (2-aminobenzenethiol); 2-aminothiobenzoic acid (thioanthranilic acid); 2-aminothioanisole; 2-(methanamine)benzyl mercaptan[(2-aminomethyl)-alpha-toluenethiol][(2-mercaptomethyl)-alpha-aminotoluene]; 1-amino-2-naphthalenethiol; 2-amino-1-naphthalenethiol; 2-amino-1-(methyldisulfido)benzene; 2,2'-di(aminomethyl)diphenylthioketone; di(2-amino)phenyl sulfide; di(2-amino)phenyl disulfide (di-ortho-aminophenyl disulfide (doapd)); 1,3-di(2-amino)phenyl-2-mercaptopropane; 1,3-di(3-amino)phenyl-2-mercaptopropane; 1,3-di(2-mercapto)phenyl-2-aminopropane; 1,3-di(3-mercapto)phenyl-2-aminopropane; 2,2'-dimercaptoiminodibenzyl; 2,2'-iminodibenzothioic acid; 2,2'-dimercaptoiminostilbene; and poly(o-aminothiophenol).

N—S Valence Stabilizer #29: Examples of five-membered heterocyclic rings containing one, two, three, or four nitrogen atoms and having at least one additional sulfur atom binding site not in a ring (N—S Bidentates, N—S Tridentates, N—S Tetradentates, or N—S Hexadentates) that meet the requirements for use as "wide band" valence stabilizers for $Co^{+3}$ include, but are not limited to: 2-mercaptopyrrole; 2-(methylthio)methylpyrrole; 2,5-(thiomethyl)pyrrole; 2,5-(methylthiomethyl)pyrrole; 2,6-(methyldisulfidomethyl) pyrrole; imidazoline-2-thione (2-mercaptoimidazole); 2-mercaptothiazoline; 2-mercaptobenzimidazole; 2-mercaptobenzothiazole; 2-mercaptobenzoxazole; 2-thiohydantoin; di-2-pyridylthioglyoxal (2,2'-thiopyridil); bis((1-pyrazolyl) methane)sulfide; bis((1-pyrazolyl)methane)disulfide; bis(2-(1-pyrazolyl)ethane)sulfide; bis(2-(1-pyrazolyl)ethane)disulfide; bis(benzimindazolylmethane)sulfide; bis (benzimidazolylethane)sulfide; bis(benzimidazolylmethane) disulfide; bis(benzimidazolylethane)disulfide; tris (imidazolyl)methanethiol; tris(imidazolylmethane) methanethiol; N-thiomethyl-N,N-(benzimidazolylmethane) amine; N-(2-thioethyl)-N,N-(benzimidazolylmethane) amine; N,N'-di(benzimidazolylmethane)-1,3-diamino-2-mercaptopropane; N,N,N',N'-tetrakis (benzimidazolylmethane)-1,3-diamino-2-mercaptopropane; bis(N,N-((4-imidazolyl)methane)2-aminoethane)sulfide; bis (N,N-((4-imidazolyl)methane)2-aminoethane)disulfide; 2-aminobenzothiazole (abt); 2-phenylaminothiazole; thiohydantoin; thioxohydropyrazole; 2-mercaptobenzothiazole (mbt); 2-mercapto-1,3,4-thiadiazole; 2,5-dimercapto-1,3,4-thiadiazole (bismuthiol); 2,5-bis(alkylthio)-1,3,4-thiadiazole; 2-amino-5-mercapto-1,3,4-thiadiazole (amt); 5-mercaptotetrazole; 1-phenyl-5-mercaptotetrazole (pmt)(5-mptt); 5-mercaptotriazole; 3-mercaptotriazole; (2-benzothiazolyl) thioacetic acid; (2-benzothiazolyl)thiopropionic acid; (alkylthio)benzotriazoles; (arylthio)benzotriazoles; 2-mercaptopyrimidine; bis(5-mercapto-1,2,4-triazol-3-yl); bis(5-mercapto-1,2,4-triazol-3-yl)alkanes; 2-aminothiazolidine; thiazolidine-2-thione; 2-mercaptothiazolidine; 1-(2-mercaptoethyl)imidazoline; imidazolidine-2-thione; 4,5-dihydroxyimidazolidine-2-thione; 4-amino-5-mercapto-1,2,4-triazole; (2-benzimidazolylthio)carboxylic acids; (2-benzoxazolylthio)carboxylic acids; (2-benzothiazolylthio)carboxylic acids; (2-benzimidazolylthio)hydroxyalkyl(aryl)s; (2-benzoxazolylthio)hydroxyalkyl(aryl)s; (2-benzothiazolylthio)hydroxyalkyl(aryl)s; 2-(phenylmethylthio)benzothiazole; 2,5-bis(hydrocarbyldithio)-1,3,4-thiadiazoles; 2-(hydrocarbyldithio)-5-mercapto-1,3,4-thiadiazoles; bis (dithiobisthiadiazole); benzothiazolethione; 3-hydrazino-5-thio-1,2,4-triazole; imidazolidine-2,4-dithione; dimercaptobenzothiazole; 2-aminothiazole (atz); thiadiazole-2-thione; 5-mercaptothiadiazole-2-thione; 1,1-thiocarbonyldiimidazole; phosphosphonomethylenethio-1,3-benzothiazole (pmtbt); 4,5-dihydroxyimidazolidine-2-thione; imidazolidine-2-thione; 1,1'-thiocarbonyldiimidazole; 2,2'-dithiobis (benzothiazole); and 5,5'-dithiobis(tetrazole).

N—S Valence Stabilizer #30: Examples of six-membered heterocyclic rings containing one, two, three, or four nitrogen atoms and having at least one additional sulfur atom binding site not in a ring (N—S Bidentates, N—S Tridentates, N—S Tetradentates, or N—S Hexadentates) that meet the requirements for use as "wide band" valence stabilizers for $Co^{+3}$ include, but are not limited to: 4-aminomethyl-3-pyridinemethanethiol (including thiopyridoxamine); 2-mercaptopyridine; 2-(methylthio)methylpyridine; 2-(2-(methylthio)ethyl)pyridine; 2,6-(thiomethyl)pyridine; 2,6-(methylthiomethyl)pyridine; 2,6-(methyldisulfidomethyl) pyridine; 2-mercaptopyrimidine; 2-dithiomethylpyrimidine; 2-mercaptoquinoline; 8-mercaptoquinoline (thioxine); 8-methylthioquinoline; 2-mercaptoquinazoline; thioorotic acid (1,2,3,6-tetrahydro-2,6-dithiono-4-pyrimidinecarboxylic acid) (6-thiouracilcarboxylic acid); 1-methylpyrimidine-2-thione; 2-thiouracil; 2,4-dithiouracil; 6-mercaptopurine; bis(N,N,N',N'-tetra(2-(2-pyridyl)ethane)aminomethane)sulfide; bis(N,N,N',N'-tetra(2-(2-pyridyl)ethane)aminomethane)disulfide; bis(N,N,N',N'-tetra(2-(2-pyridyl) ethane)aminoethane)sulfide; bis(N,N,N',N'-tetra(2-(2-pyridyl)ethane)aminoethane)disulfide; 1,3,5-triazine-6-thione; 2-benzylmercapto-1,3,5-triazine; triazine dithiols [i.e., 6-(phenylamino)-1,3,5-triazine-2,4-dithiol (ptd); 6-aniline-1,3,5-triazine-2,4-dithiol (atd); and 2-(N,N-dialkylamino)-1,3,5-triazine-4,6-dithiol]; 2-thioquinazoline; 2-thioquinazolin-4-one; thiomorpholin-3-thione; [2-(aminomethyl)thio]pyridine; 6-mercaptopurine; dithiouracil; and 2,2'-dithiodipyridine (2,2'-dipyridyl disulfide).

N—S Valence Stabilizer #31: Examples of five-membered heterocyclic rings containing one or two sulfur atoms and having at least one additional nitrogen atom binding site not in a ring (N—S Bidentates, N—S Tridentates, N—S Tetradentates, or N—S Hexadentates) that meet the requirements for use as "wide band" valence stabilizers for $Co^{+3}$ include, but are not limited to: 2-aminothiophene; 2,5-diaminothiophene; 2-aminomethylthiophene; 2,5-di(aminomethyl)thiophene; 2-aminobenzothiophene; and 2-iminothiolane.

N—S Valence Stabilizer #32: Examples of six-membered heterocyclic rings containing one or two sulfur atoms and having at least one additional nitrogen atom binding site not in a ring (N—S Bidentates, N—S Tridentates, N—S Tetradentates, or N—S Hexadentates) that meet the requirements for use as "wide band" valence stabilizers for $Co^{+3}$ include, but are not limited to: 2-aminothiopyran; 2,6-diaminothiopyran; 2-aminomethylthiopyran; 2,6-di(aminomethyl)thiopyran; and 2-aminobenzothiopyran.

N—S Valence Stabilizer #33: Examples of five-membered heterocyclic rings containing one, two, three, or four nitrogen atoms and having at least one additional sulfur atom binding site in a separate ring (N—S Bidentates, N—S Tridentates, N—S Tetradentates) that meet the requirements for use as "wide band" valence stabilizers for $Co^{+3}$ include, but are not limited to: 2-(2-thiophene)pyrrole; 2,5-di(2-thiophene)pyrrole; 2-(2-thiopyran)pyrrole; 2,5-di(2-thiopyran)pyrrole; 2,5-di(2-pyrrole)thiophene; 2,6-di(2-pyrrole) thiopyran; and 3,5-bis(2-thienyl)-4-amino-1,2,4-triazole (2-tat).

N—S Valence Stabilizer #34: Examples of six-membered heterocyclic rings containing one, two, three, or four nitrogen atoms and having at least one additional sulfur atom binding site in a separate ring (N—S Bidentates, N—S Tridentates, N—S Tetradentates) that meet the requirements for use as "wide band" valence stabilizers for $Co^{+3}$ include, but are not limited to: 2-(2-thiadiazolyl)benzimidazole; 2-(2-thiophene)pyridine; 2,6-di(2-thiophene)pyridine; 2-(2-thiopyran)pyridine; 2,6-di(2-thiopyran)pyridine; 2,5-di(2-pyridyl)thiophene; 2,6-di(2-pyridyl)thiopyran; and 2-(4-thiazolyl)benzimidazole.

N—S Valence Stabilizer #35: Examples of two-, three-, four-, six-, eight-, and ten-membered macrocyclics, macrobicyclics, and macropolycyclics (including catapinands, cryptands, cyclidenes, and sepulchrates) wherein all binding sites are composed of nitrogen (usually amine or imine groups) or sulfur (usually thiols, mercaptans, or thiocarbonyls) and are not contained in component heterocyclic rings (N—S Bidentates, N—S Tridentates, N—S Tetradentates, and N—S Hexadentates) that meet the requirements for use as "wide band" valence stabilizers for $Co^{+3}$ include, but are not limited to: azathiacyclobutane ([4]aneNS); azathiacyclopentane ([5]aneNS); azathiacyclohexane ([6]aneNS); azathiacycloheptane ([7]aneNS); azathiacyclooctane ([8]aneNS); azathiacyclobutene ([4]eneNS); azathiacyclopentene ([5]eneNS); azathiacyclohexene ([6]eneNS); azathiacycloheptene ([7]eneNS); azathiacyclooctene ([8]eneNS); azathiacyclobutadiene ([4]dieneNS); azathiacyclopentadiene ([5]dieneNS); azathiacyclohexadiene ([6]dieneNS); azathiacycloheptadiene ([7]dieneNS); azathiacyclooctadiene ([8]dieneNS); diazathiacyclohexane ([6]ane$SN_2$); diazathiacycloheptane ([7]ane$SN_2$); diazathiacyclooctane ([8]ane$SN_2$); diazathiacyclononane ([9]ane$SN_2$); diazathiacyclodecane ([10]ane$SN_2$); diazathiacycloundecane ([11]ane$SN_2$); diazathiacyclododecane ([12]ane$SN_2$); diazathiacyclohexene ([6]ene$SN_2$); diazathiacycloheptene ([7]ene$SN_2$); diazathiacyclooctene ([8]ene$SN_2$); diazathiacyclononene ([9]ene$SN_2$); diazathiacyclodecene ([10]ene$SN_2$); diazathiacycloundecene ([1]ene$SN_2$); diazathiacyclododecene ([12]ene$SN_2$); diazadithiacyclooctane ([8]ane$S_2N_2$); diazadithiacyclononane ([9]ane$S_2N_2$); diazadithiacyclodecane ([10]ane$S_2N_2$); diazadithiacycloundecane ([11]ane$S_2N_2$); diazadithiacyclododecane ([12]ane$S_2N_2$); diazadithiacyclotridecane ([13]ane$S_2N_2$); diazadithiacyclotetradecane ([14]ane$S_2N_2$); diazadithiacyclopentadecane ([15]ane$S_2N_2$); diazadithiacyclohexadecane ([16]ane$S_2N_2$); diazadithiacycloheptadecane ([17]ane$S_2N_2$); diazadithiacyclooctadecane ([18]ane$S_2N_2$); diazadithiacyclononadecane ([19]ane$S_2N_2$); diazadithiacycloeicosane ([20]ane$S_2N_2$); diazadithiacyclooctadiene ([8]diene$S_2N_2$); diazadithiacyclononadiene ([9]diene$S_2N_2$); diazadithiacyclodecadiene ([10]diene$S_2N_2$); diazadithiacycloundecadiene ([11]diene$S_2N_2$); diazadithiacyclododecadiene ([12]diene$S_2N_2$); diazadithiacyclotridecadiene ([13]diene$S_2N_2$); diazadithiacyclotetradecadiene ([14]diene$S_2N_2$); diazadithiacyclopentadecadiene ([15]diene$S_2N_2$); diazadithiacyclohexadecadiene ([16]diene$S_2N_2$); diazadithiacycloheptadecadiene ([17]diene$S_2N_2$); diazadithiacyclooctadecadiene ([18]diene$S_2N_2$); diazadithiacyclononadecadiene ([19]diene$S_2N_2$); diazadithiacycloeicosadiene ([20]diene$S_2N_2$); and tetramethyldithiahexaazacyclobidecanehexaene (mtab).

N—S Valence Stabilizer #36: Examples of four-, six-, eight-, or ten-membered macrocyclics, macrobicyclics, and macropolycyclics (including catapinands, cryptands, cyclidenes, and sepulchrates) wherein all binding sites are composed of nitrogen or sulfur and are contained in component heterocyclic rings (N—S Bidentates, N—S Tridentates, N—S Tetradentates, or N—S Hexadentates) that meet the requirements for use as "wide band" valence stabilizers for $Co^{+3}$ include, but are not limited to: dithiopyrandipyridines; dithiophenedipyrroles; trithiopyrantripyridines; trithiophenetripyrroles; tetrathiopyrantetrapyridines; and tetrathiophenetetrapyrroles.

N—S Valence Stabilizer #37: Examples of four-, six-, eight-, or ten-membered macrocyclics, macrobicyclics, and macropolycyclics (including catapinands, cryptands, cyclidenes, and sepulchrates) wherein all binding sites are composed of nitrogen or sulfur and are contained in a combination of heterocyclic rings and amine, imine, thiol, mercapto, or thiocarbonyl groups (N—S Bidentates, N—S Tridentates, N—S Tetradentates, or N—S Hexadentates) that meet the requirements for use as "wide band" valence stabilizers for $Co^{+3}$ include, but are not limited to: azathiatetraphyrins; diazadithiatetraphyrins; azathiahexaphyrins; diazadithiahexaphyrins; and triazatrithiahexaphyrins.

N—O Valence Stabilizer #1: Examples of N-hydroxy(or N,N'-dihydroxy)amidines and N-hydroxy(or N,N'-dihydroxy)diamidines (N—O bidentates, N—O tridentates, or N—O tetradentates) that meet the requirements for use as "wide band" valence stabilizers for $Co^{+3}$ include, but are not limited to: N-hydroxy-N,N'-dimethylformamidine; N-hydroxy-N,N'-diethylformamidine; N-hydroxy-N,N'-diisopropylformamidine; N-hydroxy-N,N'-dibutylformamidine; N-hydroxy-N,N'-diphenylformamidine; N-hydroxy-N,N'-dibenzylformamidine; N-hydroxy-N,N'-dinaphthylformamidine; N-hydroxy-N,N'-dicyclohexylformamidine; N-hydroxy-N,N'-dinorbornylformamidine; N-hydroxy-N,N'-diadamantylformamidine; N-hydroxy-N,N'-dianthraquinonylformamidine; N-hydroxy-N,N'-dimethylacetamidine; N-hydroxy-N,N'-diethylacetamidine; N-hydroxy-N,N'-diisopropylacetamidine; N-hydroxy-N,N'-dibutylacetamidine; N-hydroxy-N,N'-diphenylacetamidine; N-hydroxy-N,N'-dibenzylacetamidine; N-hydroxy-N,N'-dinaphthylacetamidine; N-hydroxy-N,N'-dicyclohexylacetamidine; N-hydroxy-N,N'-dinorbornylacetamidine; N-hydroxy-N,N'-diadamantylacetamidine; N-hydroxy-N,N'-dimethylbenzamidine; N-hydroxy-N,N'-diethylbenzamidine; N-hydroxy-N,N'-diisopropylbenzamidine; N-hydroxy-N,N'-dibutylbenzamidine; N-hydroxy-N,N'-diphenylbenzamidine; N-hydroxy-N,N'-dibenzylbenzamidine; N-hydroxy-N,N'-dinaphthylbenzamidine; N-hydroxy-N,N'-dicyclohexylbenzamidine; N-hydroxy-N,N'-dinorbornylbenzamidine; N-hydroxy-N,N'-diadamantylbenzamidine; N-hydroxy-N,N'-dimethyltoluamidine; N-hydroxy-N,N'-diethyltoluamidine; N-hydroxy-N,N'-diisopropyltoluamidine; N-hydroxy-N,N'-dibutyltoluamidine; N-hydroxy-N,N'-diphenyltoluamidine; N-hydroxy-N,N'-dibenzyltoluamidine; N-hydroxy-N,N'-dinaphthyltoluamidine; N-hydroxy-N,N'-dicyclohexyltoluamidine; N-hydroxy-N,N'-dinorbornyltoluamidine; N-hydroxy-N,N'-diadamantyltoluamidine; N,N-dihydroxyoxalic diamidine; N,N'-dihydroxymalonic diamidine; N,N'-dihydroxysuccinic diamidine; N,N'-dihydroxyglutaric diamidine; N,N'-dihydroxyadipic diamidine; N,N'-dihydroxypimelic diamidine; N,N'-dihydroxysuberic diamidine; N,N'-dihydroxyphthalic diamidine; N,N'-dihydroxyterephthalic diamidine; N,N'-dihydroxyisophthalic diamidine; N,N'-dihydroxypiperazine diamidine.

N—O Valence Stabilizer #2: Examples of guanylureas, guanidinoureas, bis(guanylureas), bis(guanidinoureas), poly(guanylureas), and poly(guanidinoureas) (N—O Bidentates and N—O Tetradentates) that meet the requirements for use as "wide band" valence stabilizers for $Co^{+3}$ include, but are not limited to: guanylurea (amidinourea)(dicyandiamidine); guanidinourea; methylguanylurea; ethylguanylurea; isopropylguanylurea; butylguanylurea; benzylguanylurea; phenylguanylurea; tolylguanylurea; naphthylguanylurea; cyclohexylguanylurea; norbornylguanylurea; adamantylguanylurea; dimethylguanylurea; diethylguanylurea; diisopropylguanylurea; dibutylguanylurea; dibenzylguanylurea; diphenylguanylurea; ditolylguanylurea; dinaphthylguanylurea; dicyclohexylguanylurea; dinorbornylguanylurea; diadamantylguanylurea; ethylenebis(guanylurea); propylenebis(guanylurea); phenylenebis(guanylurea); piperazinebis(guanylurea); oxalylbis(guanylurea); malonylbis(guanylurea); succinylbis(guanylurea); phthalylbis(guanylurea); 2-ureidothiazole; 2-ureidooxazole; 2-ureidoimidazole; 3-ureidopyrazole; 3-ureido-1,2,4-triazole; and 5-ureidotetrazole.

N—O Valence Stabilizer #3: Examples of amidinoamides, guanidinoamides, bis(amidinoamides), bis(guanidinoamides), poly(amidinoamides), and poly(guanidinoamides) (including both N-amidinoamides and 2-amidinoacetamides) (N—O Bidentates, N—O Tridentates, and N—O Tetradentates) that meet the requirements for use as "wide band" valence stabilizers for $Co^{+3}$ include, but are not limited to: amidinoacetamide(1-acetylguanidine); guanidinoacetamide; amidinopropanamide; amidinobutanamide; amidinobenzamide; amidinotoluamide; amidinocyclohexamide; N-methylamidinoacetamide; N-ethylamidinopropanamide; N-propylamidinobutanamide; N-phenylamidinobenzamide; N-tolylamidinotoluamide; N-cyclohexylamidinocyclohexamide; bis(amidinooxamide); bis(amidinomalonamide); bis(amidinosuccinamide); bis(amidinophthalamide); 2-amidinoacetamide(malonamamidine); N-methyl-2-amidinoacetamide; N-ethyl-2-amidinoacetamide; N-phenyl-2-amidinoacetamide; N-benzyl-2-amidinoacetamide; N-cyclohexyl-2-amidinoacetamide; N,N'-dimethyl-2-amidinoacetamide; N,N'-diethyl-2-amidinoacetamide; N,N'-diphenyl-2-amidinoacetamide; N,N'-dibenzyl-2-amidinoacetamide; N,N'-dicyclohexyl-2-amidinoacetamide; 2-N-acylaminothiazole; 2-N-acylaminooxazole; 2-N-acylaminoimidazole; 3-N-acylaminopyrazole; 3-N-acylamino-1,2,4-triazole; and 5-N-acylaminotetrazole.

N—O Valence Stabilizer #4: Examples of imidoylamides, bis(imidoylamides), and poly(imidoylamides) (N—O Bidentates, N—O Tridentates, and N—O Tetradentates) that meet the requirements for use as "wide band" valence stabilizers for $Co^{+3}$ include, but are not limited to: acetimidoylacetamide; acetimidoylpropanamide; acetimidoylbutanamide; acetimidoylbenzamide; acetimidolytoluamide; acetimidoylcyclohexamide; propimidoylpropanamide; butimidoylbutanamide; benzimidoylbenzamide; ethylenebis(acetimidoylacetamide); propylenebis(acetimidoylacetamide); and phenylenebis(acetimidoylacetamide).

N—O Valence Stabilizer #5: Examples of O-amidinocarbamates, bis(O-amidinocarbamates), and poly(O-amidinocarbamates) (N—O Bidentates and N—O Tetradentates) that meet the requirements for use as "wide band" valence stabilizers for $Co^{+3}$ include, but are not limited to: O-amidinocarbamate; N-methyl-O-amidinocarbamate; N-ethyl-O-amidinocarbamate; N-isopropyl-O-amidinocarbamate; N-butyl-O-amidinocarbamate; N-benzyl-O-amidinocarbamate; N-phenyl-O-amidinocarbamate; N-tolyl-O-amidinocarbamate; N-naphthyl-O-amidinocarbamate; N-cyclohexyl-O-amidinocarbamate; N-norbornyl-O-amidinocarbamate; N-adamantyl-O-amidinocarbamate;

N,N'-dimethyl-O-amidinocarbamate; N,N'-diethyl-O-amidinocarbamate; N,N'-diisopropyl-O-amidinocarbamate; N,N'-dibutyl-O-amidinocarbamate; N,N'-dibenzyl-O-amidinocarbamate; N,N'-diphenyl-O-amidinocarbamate; N,N'-ditolyl-O-amidinocarbamate; N,N'-dinaphthyl-O-amidinocarbamate; N,N'-dicyclohexyl-O-amidinocarbamate; N,N'-dinorbornyl-O-amidinocarbamate; N,N'-diadamantyl-O-amidinocarbamate; ethylenebis(O-amidinocarbamate); propylenebis(O-amidinocarbamate); phenylenebis(O-amidinocarbamate); piperazinebis(O-amidinocarbamate); oxalylbis(O-amidinocarbamate); malonylbis(O-amidinocarbamate); succinylbis(O-amidinocarbamate); phthalylbis(O-amidinocarbamate); 2-O-carbamatothiazole; 2-O-carbamatooxazole; 2-O-carbamatoimidazole; 3-O-carbamatopyrazole; 3-O-carbamato-1,2,4-triazole; and 5-carbamatotetrazole.

N—O Valence Stabilizer #6: Examples of S-amidinothiocarbamates, bis(S-amidinothiocarbamates), and poly(S-amidinothiocarbamates) (N—O Bidentates and N—O Tetradentates) that meet the requirements for use as "wide band" valence stabilizers for $Co^{+3}$ include, but are not limited to: S-amidinothiocarbamate; N-methyl-S-amidinothiocarbamate; N-ethyl-S-amidinothiocarbamate; N-isopropyl-S-amidinothiocarbamate; N-butyl-S-amidinothiocarbamate; N-benzyl-S-amidinothiocarbamate; N-phenyl-S-amidinothiocarbamate; N-tolyl-S-amidinothiocarbamate; N-naphthyl-S-amidinothiocarbamate; N-cyclohexyl-S-amidinothiocarbamate; N-norbornyl-S-amidinothiocarbamate; N-adamantyl-S-amidinothiocarbamate; N,N'-dimethyl-S-amidinothiocarbamate; N,N'-diethyl-S-amidinothiocarbamate; N,N'-diisopropyl-S-amidinothiocarbamate; N,N'-dibutyl-S-amidinothiocarbamate; N,N'-dibenzyl-S-amidinothiocarbamate; N,N'-diphenyl-S-amidinothiocarbamate; N,N'-ditolyl-S-amidinothiocarbamate; N,N'-dinaphthyl-S-amidinothiocarbamate; N,N'-dicyclohexyl-S-amidinothiocarbamate; N,N'-dinorbornyl-S-amidinothiocarbamate; N,N'-diadamantyl-S-amidinothiocarbamate; ethylenebis(S-amidinothiocarbamate); propylenebis(S-amidinothiocarbamate); phenylenebis(S-amidinothiocarbamate); piperazinebis(S-amidinothiocarbamate); oxalylbis(S-amidinothiocarbamate); malonylbis(S-amidinothiocarbamate); succinylbis(S-amidinothiocarbamate); phthalylbis(S-amidinothiocarbamate); 2-O-monothiocarbamatothiazole; 2-O-monothiocarbamatooxazole; 2-O-monothiocarbamatoimidazole; 3-O-monothiocarbamatopyrazole; 3-O-monothiocarbamato-1,2,4-triazole; and 5-O-monothiocarbamatotetrazole.

N—O Valence Stabilizer #7: Examples of diimidosulfuric acid, bis(diimidosulfuric acid), and derivatives thereof (N—O Bidentates and N—O Tetradentates) that meet the requirements for use as "wide band" valence stabilizers for $Co^{+3}$ include, but are not limited to: diimidosulfuric acid; O-phenyldiimidosulfuric acid; O-benzyldiimidosulfuric acid, O-cyclohexyldiimidosulfuric acid, O-norbornyldiimidosulfuric acid, O,O'-diphenyldiimidosulfuric acid; O,O'-dibenzyldiimidosulfuric acid, O,O'-dicyclohexyldiimidosulfuric acid, and O,O'-dinorbornyldiimidosulfuric acid.

N—O Valence Stabilizer #8: Examples of phosphorimidic acid, bis(phosphorimidic acid); and poly(phosphorimidic acid), and derivatives thereof (N—O Bidentates, N—O Tetradentates) that meet the requirements for use as "wide band" valence stabilizers for $Co^{+3}$ include, but are not limited to: phosphorimidic acid; O-phenylphosphorimidic acid; O-benzylphosphorimidic acid; O-cyclohexylphosphorimidic acid; O-norbornylphosphorimidic acid; O,O'-diphenylphosphorimidic acid; O,O'-dibenzylphosphorimidic acid; O,O'-dicyclohexylphosphorimidic acid; and O,O'-dinorbornylphosphorimidic acid.

N—O Valence Stabilizer #9: Examples of phosphoric triamides, bis(phosphoric triamides), and poly(phosphoric triamides) (N—O Bidentates and N—O Tetradentates) that meet the requirements for use as "wide band" valence stabilizers for $Co^{+3}$ include, but are not limited to: phosphoric triamide; phosphoramidic dihydrazide; N-phenylphosphoric triamide, N-benzylphosphoric triamide; N-cyclohexylphosphoric triamide; N-norbornylphosphoric triamide; N,N'-diphenylphosphoric triamide, N,N'-dibenzylphosphoric triamide; N,N'-dicyclohexylphosphoric triamide; and N,N'-dinorbornylphosphoric triamide.

N—O Valence Stabilizer #10: Examples of phosphoramidic acid, phosphorodiamidic acid, bis(phosphoramidic acid), bis(phosphorodiamidic acid), poly(phosphoramidic acid), poly(phosphorodiamidic acid), and derivatives thereof (N—O Bidentates and N—O Tetradentates) that meet the requirements for use as "wide band" valence stabilizers for $Co^{+3}$ include, but are not limited to: phosphoramidic acid, phosphorodiamidic acid, phosphoramidohydrazidic acid; phosphorohydrazidic acid; phosphorodihydrazidic acid; O-phenylphosphoramidic acid; O-benzylphosphoramidic acid; O-cyclohexylphosphoramidic acid; O-norbornylphosphoramidic acid; O,O'-diphenylphosphoramidic acid; O,O'-dibenzylphosphoramidic acid; O,O'-dicyclohexylphosphoramidic acid; and O,O'-dinorbornylphosphoramidic acid.

N—O Valence Stabilizer #11: Examples of N-acyl 7-aminobenzylidenimines (N—O Bidentates or N—O Tetradentates) that meet the requirements for use as "wide band" valence stabilizers for $Co^{+3}$ include, but are not limited to: N-acetyl 7-methylaminobenzylidenimine; N-acetyl 7-phenylaminobenzylidenimine; N-benzoyl 7-methylaminobenzylidenimine; and N-benzoyl 7-phenylaminobenzylidenirmine.

N—O Valence Stabilizer #12: Examples of oximes, dioximes, and poly(oximes) (N—O Bidentates, N—O Tridentates, and N—O Tetradentates) that meet the requirements for use as "wide band" valence stabilizers for $Co^{+3}$ include, but are not limited to: acetaldoxime (Hado); acetoxime (acetone oxime)(Hato); butanone oxime; pentanone oxime; hexanone oxime; pinacolone oxime; heptanone oxime; octanone oxime; cyclopentanone oxime; cyclohexanone oxime; cycloheptanone oxime; cyclooctanone oxime; cyclopentanedione dioxime; cyclohexanedione dioxime; cycloheptanedione dioxime; cyclooctanedione dioxime; isatin dioxime; benzaldehyde oxime; naphthaldehyde oxime; norbornanone oxime; camphor oxime; dimethylglyoxime ($H_2DMG$); diethylglyoxime; diisopropylglyoxime; ditertbutylglyoxime; dicyanoglyoxime; dicyanamidoglyoxime; diphenylglyoxime (Hdfg); dibenzylglyoxime; dicyclohexylglyoxime; dinorbornylglyoxime; camphorquinone dioxime (Hcqd); nopinoquinone dioxime (Hnqd); butyraldoxime; propionaldoxime; furildioxime; and thienyldioxime.

N—O Valence Stabilizer #13: Examples of carbonyl oximes, bis(carbonyl oximes), and poly(carbonyl oximes) (N—O Bidentates, N—O Tridentates, and N—O Tetradentates) that meet the requirements for use as "wide band" valence stabilizers for $Co^{+3}$ include, but are not limited to: diacetyl monoxime (2,3-butanedione monoxime); benzil monoxime (1,2-diphenylethanedione monoxime); 1,2-dicyclohexylethanedione monoxime; 1,2-(trifluoromethyl) ethanedione monoxime; 1,2-dinorbornylethanedione monoxime; cyclopentanedione monoxime; cyclohexanedione monoxime; cycloheptanedione monoxime; cyclooctanedione monoxime; camphorquinone oxime; 3-hydroxyiminopentane-2,4-dione; and 4-isonitrosopyralozone.

N—O Valence Stabilizer #14: Examples of imine oximes, bis(imine oximes), and poly(imine oximes) (including 2-nitrogen heterocyclic oximes) (N—O Bidentates, N—O Tridentates, N—O Tetradentates, and N—O Hexadentates) that meet the requirements for use as "wide band" valence stabilizers for $Co^{+3}$ include, but are not limited to: 3-(methylimino)butan-2-one oxime; 4-(methylimino)hexan-3-one oxime; 1,2-diphenyl-2-(methylimino)ethan-1-one oxime; 1,2-diphenyl-2-(phenylimino)ethan-1-one oxime; 1,2-dicyclohexyl-2-(methylimino)ethan-1-one oxime; 1,2-dicyclohexyl-2-(cyclohexylimino)ethan-1-one oxime; 1,2-dinorbornyl-2-(methylimino)ethan-1-one oxime; N,N'-methylenebis-(3-iminobutan-2-one oxime); N,N'-methylenebis-(4-iminohexan-3-one oxime); N,N'-methylenebis-(1,2-diphenyl-2-iminoethan-1-one oxime); N,N'-methylenebis-(1,2-dicyclohexyl-2-iminoethan-1-one oxime); N,N'-methylenebis-(1,2-dinorbornyl-2-iminoethan-1-one oxime); N,N'-ethylenebis-(3-iminobutan-2-one oxime); N,N'-ethylenebis-(4-iminohexan-3-one oxime); N,N'-ethylenebis-(1,2-diphenyl-2-iminoethan-1-one oxime); N,N'-ethylenebis-(1,2-dicyclohexyl-2-iminoethan-1-one oxime); N,N'-ethylenebis-(1,2-dinorbornyl-2-iminoethan-1-one oxime); N,N'-propylenebis-(3-iminobutan-2-one oxime); N,N'-propylenebis-(4-iminohexan-3-one oxime); N,N'-propylenebis-(1,2-diphenyl-2-iminoethan-1-one oxime); N,N'-propylenebis-(1,2-dicyclohexyl-2-iminoethan-1-one oxime); N,N'-propylenebis-(1,2-dinorbornyl-2-iminoethan-1-one oxime); diacetylazine oxime (Hazio); 2-pyridinaldoxime (Hpao); methyl 2-pyridyl ketone oxime; ethyl 2-pyridyl ketoxime; phenyl 2-pyridyl ketone oxime (Hppk); benzyl 2-pyridyl ketoxime; di(2-pyridyl)ketone oxime; methyl 2-pyrrolyl ketone oxime; ethyl 2-pyrrolyl ketone oxime; phenyl 2-pyrrolyl ketone oxime; di(2-pyrrolyl)ketone oxime; and tris(2-aldoximo-6-pyridyl)phosphine.

N—O Valence Stabilizer #15: Examples of hydroxy oximes, bis(hydroxy oximes), and poly(hydroxy oximes) (including 2-oxygen heterocyclic oximes) (N—O Bidentates, N—O Tridentates, N—O Tetradentates, and N—O Hexadentates) that meet the requirements for use as "wide band" valence stabilizers for $Co^{+3}$ include, but are not limited to: 3-hydroxybutan-2-one oxime; 4-hydroxyhexan-3-one oxime; benzoin oxime (bo)(1,2-diphenyl-2-hydroxyethanone oxime); 1,2-di(trifluoromethyl)-2-hydroxyethanone oxime; 1,2-dicyclohexyl-2-hydroxyethanone oxime; 1,2-dinorbornyl-2-hydroxyethanone oxime; salicylaldoxime (so)(saldox); 2-hydroxy-1-naphthaldehyde oxime; 2-furanaldoxime; furildioxime; methyl 2-furanyl ketone oxime; ethyl 2-furanyl ketoxime; phenyl 2-furanyl ketone oxime; benzyl 2-furanyl ketoxime; di(2-furanyl)ketone oxime; and 2,5-(oximinomethyl)phenol.

N—O Valence Stabilizer #16: Examples of amino oximes, bis(amino oximes), and poly(amino oximes) (N—O Bidentates, N—O Tridentates, N—O Tetradentates, and N—O Hexadentates) that meet the requirements for use as "wide band" valence stabilizers for $Co^{+3}$ include, but are not limited to: 3-(methylamino)butan-2-one oxime (HMeabo); 4-(methylamino)hexan-3-one oxime (HEtabo); 1,2-diphenyl-2-(methylamino)ethanone oxime (HPhabo); 1,2-diphenyl-2-(phenylamino)ethanone oxime; 1,2-dicyclohexyl-2-(methylamino)ethanone oxime (HcyHxabo); 1,2-dicyclohexyl-2-(cyclohexylamino)ethanone oxime; 1,2-di(trifluoromethyl)-2-(methylamino)ethanone oxime; 1,2-dinorbornyl-2-(methylamino)ethanone oxime (HNorbabo); N,N'-ethylenebis-(3-aminobutan-2-one oxime)(Haboen); N,N'-ethylenebis-(4-aminohexan-3-one oxime); N,N'-ethylenebis-(1,2-diphenyl-2-aminoethanone oxime); N,N'-ethylenebis-(1,2-dicyclohexyl-2-aminoethanone oxime); N,N'-ethylenebis-(1,2-di(trifluoromethyl)-2-aminoethanone oxime); N,N'-ethylenebis-(1,2-dinorbornyl-2-aminoethanone oxime); N,N'-propylenebis-(3-aminobutan-2-one oxime)(Habopn); N,N'-propylenebis-(4-aminohexan-3-one oxime); N,N'-propylenebis-(1,2-diphenyl-2-aminoethanone oxime); N,N'-propylenebis-(1,2-dicyclohexyl-2-aminoethanone oxime); N,N'-propylenebis-(1,2-di(trifluoromethyl)-2-aminoethanone oxime); N,N'-propylenebis-(1,2-dinorbornyl-2-aminoethanone oxime); 2,2'-iminobis (acetamidoxime); 1-diethylamino-3-butanoxime; and di-2-pyridyl ketone oxime.

N—O Valence Stabilizer #17: Examples of amido oximes, bis(amido oximes), and poly(amido oximes) (N—O Bidentates, N—O Tridentates, N—O Tetradentates, and N—O Hexadentates) that meet the requirements for use as "wide band" valence stabilizers for $Co^{+3}$ include, but are not limited to: formamide oxime; acetamide oxime; propanamide oxime; butanamide oxime; benzamide oxime (Hbamox); naphthamide oxime; diformamide dioxime; salicylamide oxime; and 4-imidazolamide oxime.

N—O Valence Stabilizer #18: Examples of azo oximes, bis(azo oximes), and poly(azo oximes) (N—O Bidentates, N—O Tridentates, N—O Tetradentates, and N—O Hexadentates) that meet the requirements for use as "wide band" valence stabilizers for $Co^{+3}$ include, but are not limited to: acetaldehyde phenylhydrazone oxime; propionaldehyde phenylhydrazone oxime; and benzaldehyde phenylhydrazone oxime. Also includes hydrazone oximes.

N—O Valence Stabilizer #19: Examples of 2-nitrosophenols (o-quinone monoximes) (N—O Bidentates) that meet the requirements for use as "wide band" valence stabilizers for $Co^{+3}$ include, but are not limited to: 2-nitrosophenol; 1-nitroso-2-naphthol (Honn); 2-nitroso-1-naphthol (Htnn); 3-nitrosopyrocatechol; 3,6-dinitrosopyrocatechol; 2-nitrosoresorcinol; 2,4-dinitrosoresorcinol; 2,4,6-trinitrosoresorcinol; 2-nitrosohydroquinone; 2,6-dinitrosohydroquinone; 2,3,5,6-tetranitrosohydroquinone; 4-nitrosopyrogallol; 4,6-dinitrosopyrogallol; 2-nitrosophloroglucinol; 2,4,6-trinitrosophloroglucinol; 7-nitroso-6-hydroxyindazole; Pigment Green 12 (C.I. 10020); Naphthol Green; and nitroso-R-salt.

N—O Valence Stabilizer #20: Examples of 2-nitrophenols (N—O Bidentates) that meet the requirements for use as "wide band" valence stabilizers for $Co^{+3}$ include, but are not limited to: 2-nitrophenol; 2,3-dinitrophenol; 2,4-dinitrophenol; 2,5-dinitrophenol; 2,6-dinitrophenol; 2,4,6-trinitrophenol (picric acid); 2-amino-4,6-dinitrophenol (picramic acid); 1-nitro-2-naphthol; 2-nitro-1-naphthol; 3-nitropyrocatechol; 3,6-dinitropyrocatechol; 2-nitroresorcinol; 2,4-dinitroresorcinol; 2,4,6-trinitroresorcinol (styphnic acid); 2-nitrohydroquinone; 2,6-dinitrohydroquinone; 2,3,5,6-tetranitrohydroquinone; 4-nitropyrogallol; 4,6-dinitropyrogallol; 2-nitrophloroglucinol; 2,4,6-trinitrophloroglucinol; dinitrocresol; 7-nitro-6-hydroxyindazole; Dinoseb; Eosin; Naphthol Yellow; and Martius Yellow.

N—O Valence Stabilizer #21: Examples of hydroxamates (hydroxylamines), bis(hydroxamates), and poly(hydroxamates) (N—O Bidentates, N—O Tetradentates, and N—O Hexadentates) that meet the requirements for use as "wide band" valence stabilizers for $Co^{+3}$ include, but are not limited to: acetohydroxamic acid; propianohydroxamic acid; butyrohydroxamic acid; crotonohydroxamic acid; sorbohydroxamic acid; benzohydroxamic acid ($BH_2$); toluichydroxamic acid; salicylhydroxamic acid ($SH_2$); phenylacetohydroxamic acid ($PhH_2$); anthranilhydroxamic acid ($AnH_2$); nicotinehydroxamic acid ($NiCH_2$); picolinehydroxamic acid; cyclohexanehydroxamic acid ($CH_2$); quinoline 8-hydroxamic acid ($QH_2$); cinnamylhydroxamic acid ($CnH_2$); oxaldihydroxamic acid ($OxalH_2$); succinylbis-N-phenylhydroxamic acid ($SuH_2$); adipylbis-N-phenylhydroxamic acid ($AdH_2$); glyoxalhydroxamic acid ($GH_2$); 2-thiophenecarbohydroxarnic acid; thenoylhydroxamic acid; N-phenylbenzohydroxamic acid; N-tolylbenzohydroxamic acid; N-phenylacetohydroxamic acid; N-phenyl-2-thenoylhydroxamic acid; N-tolyl-2-thenoylhydroxamic acid; and polyhydroxamic acids.

N—O Valence Stabilizer #22: Examples of N-nitrosohydroxylamines, bis(N-nitrosohydroxylamines), and poly(N-nitrosohydroxylamines) (N—O Bidentates, N—O Tetradentates, and N—O Hexadentates) that meet the requirements for use as "wide band" valence stabilizers for $Co^{+3}$ include, but are not limited to: N-nitrosophenylhydroxylamine (cupferron); N-nitrosonaphthylhydroxylamine(neocupferron); N-nitrosoanthracylhydroxylamine; N-nitroso(2-pyridyl)hydroxylamine; and N-nitroso(2-thiophenyl)hydroxylamine.

N—O Valence Stabilizer #23: Examples of amino acids, ortho-aminocarboxylic acids, peptides, polypeptides, and proteins [N—O Bidentates, N—O Tridentates, and N—O Tetradentates; possibly S—O dentates for sulfur-contg. examples such as penicillamine and cystine] that meet the requirements for use as "wide band" valence stabilizers for $Co^{+3}$ include, but are not limited to: alanine (Ala); arginine (Arg); asparagine (Asn); aspartic acid (Asp); cysteine (Cys); cystine (Cys or Cys.Cys); dihydroxyphenylalanine (Dopa); glutamic acid (Glu); glutamine (Gln); glycine (Gly); histidine (His); isoleucine (Ile); leucine (Leu); lysine (Lys); methionine (Met); penicillamine (Pen); phenylalanine (Phe); tolylalanine (tala); proline (Pro); sarcosine; serine (Ser); threonine (Thr); tryptophan (Trp); tyrosine (Tyr); and valine (Val) as amino acid examples; 2-pyridinecarboxylic acid (picolinic acid), 2-pyrazinecarboxylic acid, 2,3-dicarboxypyrazine, and anthranilic acid as ortho-aminocarboxylic acid examples; Gly-GluO; Hgly-Gly; Gly-MetO; Met-GlyO; Gly-TyrO; Ala-H is O; Gly-His-GlyO; Gly-Gly-His; Gly-Leu-TyrO; penta-GlyO; His-His; triaminoisobutyrate; tetra-GlyO; Pro-Gly; and Gly-Met as peptide examples; and azurin, carbonic anhydrase C; carboxypeptidase; concanavalin A; cytochrome b; cytochrome c; erythrocruorin; ferredoxin; haemerythrin; haemoglobin; myoglobin; parvalbumin; albumin; plastocyanin; rubredoxin; superoxide dismutase; thermolysin; and trysin as protein examples; N-acylamino acids; aminocaproic acid; and 3,5-diiodotyrosine.

N—O Valence Stabilizer #24: Examples of amides, bis (amides), and poly(amides), including lactams (N—O bidentates, N—O tridentates, and N—O tetradentates) that meet the requirements for use as "narrow band" valence stabilizers for $Co^{+3}$ include, but are not limited to: acetamide; propionamide; butanamide; benzamide(benzoylamide)(1-phenylformamide); 1-naphthylformamide; toluamide; 1-cyclohexylformamide); 1-norbornylformamide; 1-adamantylformamide; N,N-dimethylformamide (DMF) (DMFA); N,N-dimethylacetamide (DMAC); N,N-dimethylbenzamide; N,N-diethylformamide; N,N-diethylacetamide; decanamide; dodecanamide; tetradecanamide; hexadecanamide; octadecanamide; lactobionic acid amide; (hydroxyalkylthio)succinamides; (mercaptoalkoxy)succinamides; bis (1,1'-benzotriazolyl)dicarboxamide; nicotinamide; acetanilide(N-phenylacetamide); formanilide (N-phenylformamide); benzanilide(N-phenylbenzamide); polycaproamides; glycinamide; aminoalkylanilides; amidopolyamines (apa); bis(1-phenylethylamide); oxalic semiamide; malonic semiamide; succinic semiamide; N-methylformanilide; acetanilide; nicotinanilide; 4'-hydroxyacetanilide (acetaminophen); 2-pyrrolidone; methyl-2-pyrrolidone (NMP); 2-piperidone (valerolactam); caprolactam; polymethylenepolyamine dipropionamide; polyacrylamides; polypyrrolidones [including polyvinylpyrrolidone (povidone)(PVP)]; pyrazolidinones; pyrazolones; diazepinones; N-alkylazaalkene lactams; and N-(2-hydroxyalkyl)azaalkene lactams.

N—O Valence Stabilizer #25: Examples of semicarbazones, bis(semicarbazones), and poly(semicarbazones) (N—O Bidentates, N—O Tetradentates, and N—O Hexadentates) that meet the requirements for use as "wide band" valence stabilizers for $Co^{+3}$ include, but are not limited to: acetaldehyde semicarbazone; acetone semicarbazone; pinacolone semicarbazone; benzaldehyde semicarbazone; naphthaldehyde semicarbazone; norbornanone semicarbazone; camphor semicarbazone; nopinone semicarbazone; 2-pyridinaldehyde semicarbazone; salicylaldehyde semicarbazone; quinolinaldehyde semicarbazone; isatin disemicarbazone; camphorquinone disemicarbazone; camphorquinone disemicarbazone; picolinaldehyde semicarbazone; dipyridyl glyoxal disemicarbazone; di-2-pyridyl ketone semicarbazone; methyl-2-pyridyl ketone semicarbazone; glyoxal disemicarbazone; acetophenone semicarbazone; biacetyl monoxime semicarbazone; acetamidobenzaldehyde semicarbazone; thymolaldosemicarbazone; thiophene-2-aldehyde semicarbazone; phthalaldehyde disemicarbazone; phthalimide disemicarbazone; furaldehyde semicarbazone; naphthoquinone semicarbazone; phenanthrequinone semicarbazone; cyclohexanedione disemicarbazone; ionone semicarbazone; bissemicarbazone of diethyl-3,4-dioxadioate; and lawsone semicarbazone.

N—O Valence Stabilizer #26: Examples of acyl hydrazones, bis(acyl hydrazones), and poly(acyl hydrazones) (N—O Bidentates, N—O Tetradentates, and N—O Hexadentates) that meet the requirements for use as "wide band" valence stabilizers for $Co^{+3}$ include, but are not limited to: acetaldehyde N-formylhydrazone; acetaldehyde N-benzoylhydrazone; acetone N-formylhydrazone; acetone N-benzoylhydrazone; pinacolone N-formylhydrazone; pinacolone N-benzoylhydrazone; benzaldehyde N-formylhydrazone; benzaldehyde N-benzoylhydrazone; naphthaldehyde N-formylhydrazone; naphthaldehyde N-benzoylhydrazone; norbornanone N-formylhydrazone; norbornanone N-benzoylhydrazone; camphor N-formylhydrazone; camphor N-benzoylhydrazone; nopinone N-formylhydrazone; nopinone N-benzoylhydrazone; 2-pyridinaldehyde N-formylhydrazone; 2-pyridinaldehyde N-benzoylhydrazone; salicylaldehyde N-formylhydrazone; salicylaldehyde N-benzoylhydrazone; quinolinaldehyde N-formylhydrazone; quinolinaldehyde N-benzoylhydrazone; furan-2-aldehyde N-formylhydrazone; furan-2-aldehyde N-benzoylhydrazone; naphthoquinone N-formylhydrazone; naphthoquinone N-benzoylhydrazone; ionone N-formylhydrazone; ionone N-benzoylhydrazone; lawsone N-formylhydrazone; and lawsone N-benzoylhydrazone.

N—O Valence Stabilizer #27: Examples of carbazones (diazenecarboxylic hydrazides), bis(carbazones), and poly (carbazones) (N—O Bidentates, N—O Tetradentates, and N—O Hexadentates) that meet the requirements for use as "wide band" valence stabilizers for $Co^{+3}$ include, but are not limited to: diphenylcarbazone; 2-phenylcarbazone; dinaphthylcarbazone; and 2-naphthylcarbazone.

N—O Valence Stabilizer #28: Examples of azo compounds with hydroxyl or carboxy or carbonyl substitution at the ortho- (for aryl) or alpha- or beta- (for alkyl) positions, Bis[o-(HO—) or alpha- or beta-(HO—)azo compounds], or Poly[o-(HO—) or alpha- or beta-(HO—)azo compounds) (N—O Bidentates, N—O Tridentates, N—O Tetradentates, or N—O Hexadentates) that meet the requirements for use as "wide band" valence stabilizers for $Co^{+3}$ include, but are not limited to: 2-hydroxyazobenzene[1-(phenylazo)-2-phenol]; 2,2'-dihydroxyazobenzene (o,o'-dihydroxyazobenzene); (2-furan)azobenzene; Direct Blue 2B; 1-(4-nitrophenylazo)-2-naphthol; 1-(2-hydroxyphenylazo)-2-naphthol; 1-(2-methoxyphenylazo)-2-naphthol; pyridineazo-2-naphthol (PAN); pyridineazoresorcinol (PAR); 1-phenyl-4-(2-hydroxyphenylazo)-5-pyrazolone; 1-phenyl-4-(2-methoxyphenylazo)-5-pyrazolone; o-hydroxy-o'-(beta-aminoethylamino)azobenzene; 2-hydroxy-2'-methoxymethyleneoxyazobenzene; methyl red; turquoise blue (reactive blue); sunset yellow; amaranth; tartrazine; Eriochrome Black T; tropeolins; Allura Red; amaranth; Acid Alizarin Violet N; Acid Blue 29; Acid Orange 8, 63, and 74; Acid Red 1, 4, 8, 37, 88, 97, 114, 151, and 183; Acid Violet 7; Acid Yellow 25, 29, 34, 42, 76, and 99; Brilliant Black BN; Brilliant Crocein; Bordeaux R; Calcion; Chicago Sky Blue; Chromotrope; Cibacron Brilliant Red; Cibacron Brilliant Yellow; Crocein Orange; Crystal Scarlet; Calmagite; Direct Blue 71; Direct Red 23, 80, and 81; Direct Violet 51; Direct Yellow 8 and 27; Fast Black; Flavazin; Mordant Blue 9; Mordant Brown 1 and 33; Napthol Blue Black; New Coccine; Nitrazine Yellow; Nitrosulfonazo III; Orange II; Orange G, OT, and B; Ponceau 3R and SX; Polar Yellow; 2-oxazolylazobenzene; and 2-benzoxazolylazobenzene.

N—O Valence Stabilizer #29: Examples of diazeneformamides, diazeneacetamides, bis(diazeneformamides), bis(diazeneacetamides), poly(diazeneformamides), and poly(diazeneacetamides) (N—O Bidentates, N—O Tetradentates, and N—O Hexadentates) that meet the requirements for use as "wide band" valence stabilizers for $Co^{+3}$ include, but are not limited to: diazeneformamide, diazeneacetamide, phenyldiazeneformamide, diphenyldiazeneformamide, phenyldiazeneacetamide, and diphenyldiazeneacetamide.

N—O Valence Stabilizer #30: Examples of diazeneformic acids, diazeneacetic acids, bis(diazeneformic acids), bis (diazeneacetic acids), poly(diazeneformic acids), poly(diazeneacetic acids) and derivatives thereof (N—O Bidentates, N—O Tetradentates, N—O Hexadentates) that meet the requirements for use as "wide band" valence stabilizers for $Co^{+3}$ include, but are not limited to: diazeneformic acid, diazeneacetic acid, phenyldiazeneformic acid, diphenyldiazeneformic acid, phenyldiazeneacetic acid, and diphenyldiazeneacetic acid.

N—O Valence Stabilizer #31: Examples of diazeneformaldehydes, diazeneacetaldehydes, bis(diazeneformaldehydes), bis(diazeneacetaldehydes), poly(diazeneformaldehydes), and poly(diazeneacetaldehydes) (N—O Bidentates, N—O Tetradentates and N—O Hexadentates) that meet the requirements for use as "wide band" valence stabilizers for $Co^{+3}$ include, but are not limited to: diazeneformaldehyde, diazeneacetaldehyde, phenyldiazeneformaldehyde, diphenyldiazeneformaldehyde, phenyldiazeneacetaldehyde, and diphenyldiazeneacetaldehyde.

N—O Valence Stabilizer #32: Examples of diazenediformamides, diazenediacetamides, bis(diazenediformamides), bis (diazenediacetamides), poly(diazenediformamides), and poly(diazenediacetamides) (N—O Tridentates and N—O Hexadentates) that meet the requirements for use as "wide band" valence stabilizers for $Co^{+3}$ include, but are not limited to: diazenediformamide, diazenediacetamide, diphenydiazenediformamide, tetraphenyldiazenediformamide, diphenyldiazenediacetamide, and tetraphenyldiazenediacetamide.

N—O Valence Stabilizer #33: Examples of diazenediformic acids, diazenediacetic acids, bis(diazenediformic acids), bis (diazenediacetic acids), poly(diazenediformic acids), poly (diazenediacetic acids) and derivatives thereof (N—O Tridentates and N—O Hexadentates) that meet the requirements for use as "wide band" valence stabilizers for $Co^{+3}$ include, but are not limited to: diazenediformic acid, diazenediacetic acid, phenyldiazenediformic acid, diphenyldiazenediformic acid, phenyldiazenediacetic acid, and diphenyldiazenediacetic acid.

N—O Valence Stabilizer #34: Examples of diazenediformaldehydes, diazenediacetaldehydes, bis(diazenediformaldehydes), bis(diazenediacetaldehydes), poly(diazenediformaldehydes), and poly(diazenediacetaldehydes) (N—O Tridentates and N—O Hexadentates) that meet the requirements for use as "wide band" valence stabilizers for $Co^{+3}$ include, but are not limited to: diazenediformaldehyde, diazenediacetaldehyde, diphenyldiazenediformaldehyde, and diphenyldiazenediacetaldehyde.

N—O Valence Stabilizer #35: Examples of ortho-hydroxy (or -carboxy) substituted formazans, bis(o-hydroxy or -carboxy substituted formazans), and poly(o-hydroxy or -carboxy substituted formazans) (N—O Bidentates, N—O Tridentates, N—O Tetradentates, and N—O Hexadentates) that meet the requirements for use as "wide band" valence stabilizers for $Co^{+3}$ include, but are not limited to: 1-(2-hydroxyphenyl)-3,5-diphenylformazan; 1-(2-methoxyphenyl)-3,5-diphenylformazan; 1,5-bis(2-hydroxyphenyl)-3-phenylformazan; and 5-bis(2-methoxyphenyl)-3-phenylformazan.

N—O Valence Stabilizer #36: Examples of ortho-hydroxy (or -carboxy) substituted azines (including ketazines), bis (o-hydroxy or carboxy substituted azines), and poly(o-hydroxy or carboxy substituted azines) (N—O Bidentates, N—O Tridentates, N—O Tetradentates, and N—O Hexadentates) that meet the requirements for use as "wide band" valence stabilizers for $Co^{+3}$ include, but are not limited to: 2-hydroxy-1-benzalazine; 2-hydroxy-1-naphthalazine; and 2-hydroxy-1-cyclohexanonazine.

N—O Valence Stabilizer #37: Examples of Schiff Bases with one Imine (C═N) Group and with ortho- or alpha- or beta-hydroxy or carboxy or carbonyl substitution (N—O Bidentates, N—O Tridentates, N—O Tetradentates, N—O Pentadentates, or N—O Hexadentates) that meet the requirements for use as "wide band" valence stabilizers for $Co^{+3}$ include, but are not limited to: N-(Salicylaldehydo)isopropylamine; N-(2-Furfuralo)isopropylamine; N-(2-Acetylfurano)isopropylamine; N-(2-Hydroxyacetophenono)isopropylamine; N-(Pyridoxalo)isopropylamine; N-(Salicylaldehydo)cyclohexylamine; N-(2-Furfuralo)cyclohexylamine; N-(2-Acetylfurano)cyclohexylamine; N-(2-Hydroxyacetophenono)cyclohexylamine; N-(Pyridoxalo)cyclohexylamine; N-(Salicylaldehydo)aniline; N-(2-Furfuralo)aniline (Stenhauz salt); N-(2-Acetylfurano)aniline; N-(2-Hydroxyacetophenono)aniline; N-(Pyridoxalo)aniline; N-(Salicylaldehydo)aminonorbornane; N-(2-Furfuralo)aminonorbornane; N-(2-Acetylfurano)aminonorbornane; N-(2-Hydroxyacetophenono)aminonorbornane; N-(Pyridoxalo)aminonorbornane; (Salicylaldehydo)anisidine; 2-salicylideneiminobenzothiazole; (Salicylaldehydo)sulfamethazine; N'-histidine-3-methoxysalicylidenimine (V-his); N-(o-carboxybenzaldehydo)-2-aminophenol; N-(salicylaldehydo)isatin; N-(2-furfuralo)isatin; N-(2-acetylfurano)isatin; N-(pyridoxalo)isatin; N-(2-hydroxyacetophenono)isatin; hydrofuramide; 2-furancarboxaldehyde phenylhydrazone; 2-furancarboxaldehyde 2-pyridyl hydrazone; salicylaldehyde phenylhydrazone; and salicylaldehyde 2-pyridyl hydrazone. Also includes hydrazones with ortho-O substitution.

N—O Valence Stabilizer #38: Examples of Schiff Bases with two Imine (C═N) Groups and with ortho- or alpha- or beta-hydroxy or carboxy or carbonyl substitution (N—O Tridentates, N—O Tetradentates, N—O Pentadentates, or N—O Hexadentates) that meet the requirements for use as "wide band" valence stabilizers for $Co^{+3}$ include, but are not limited to: N,N'-(2,5-Furandicarboxaldehydo)diisopropylamine; N,N'-(2,5-Furandicarboxaldehydo)dicyclohexylamine; N,N'-(2,5-Furandicarboxaldehydo)dianiline; N,N'-(2,5-Furandicarboxaldehydo)di-aminonorbornane; N,N'-(o-Hydroxyphthalicdialdehydo)diisopropylamine; N,N'-(o-Hydroxyphthalicdialdehydo)dicyclohexylamine; N,N'-(o-Hydroxyphthalicdialdehydo)dianiline; N,N'-(o-Hydroxyphthalicdialdehydo)di-aminonorbornane; N,N'-(o-Hydroxyformylcamphoro)diisopropylamine; N,N'-(o-Hydroxyformylcamphoro)dicyclohexylamine; N,N'-(o-Hydroxyformylcamphoro)dianiline; N,N'-(o-Hydroxyformylcamphoro)di-aminonorbornane; N,N'-(o-Hydroxydiacetylbenzeno)diisopropylamine; N,N'-(o-Hydroxydiacetylbenzeno)dicyclohexylamine; N,N'-(o-Hydroxydiacetylbenzeno)dianiline; N,N'-(o-Hydroxydiacetylbenzeno)di-aminonorbornane; N,N'-(3,6-Dihydroxy-1,2-cyclohexanono)diisopropylamine; N,N'-(3,6-Dihydroxy-1,2-cyclohexanono)dicyclohexylamine; N,N'-(3,6-Dihydroxy-1,2-cyclohexanono)dianiline; N,N'-(3,6-Dihydroxy-1,2-cyclohexanono)di-aminonorbornane; N,N'-(2,5-Diacetylfurano)diisopropylamine; N,N'-(2,5-Diacetylfurano)dicyclohexylamine; N,N'-(2,5-Diacetylfurano)dianiline; N,N'-(2,5-Diacetylfurano)di-aminonorbornane; N,N'-(Salicylaldehydo)ethylenediamine; N,N'-(o-Hydroxynaphthaldehydo)ethylenediamine; N,N'-(o-Hydroxyacetophenono)ethylenediamine; N,N'-(Salicylaldehydo)trimethylenediamine; N,N'-(o-Hydroxynaphthaldehydo)trimethylenediamine; N,N'-(o-Hydroxyacetophenono)trimethylenediamine; N,N'-(Salicylaldehydo)cyclohexane-1,2-diamine; N,N'-(o-Hydroxynaphthaldehydo)cyclohexane-1,2-diamine; N,N'-(o-Hydroxyacetophenono)cyclohexane-1,2-diamine; N,N'-(Salicylaldehydo)-1,2-diaminobenzene; N,N'-(o-Hydroxynaphthaldehydo)-1,2-diaminobenzene; N,N'-(o-Hydroxyacetophenono)-1,2-diaminobenzene; N,N'-bis(salicylaldehydo)-1,12-diaminododecane (Saldn); N,N'-bis(3-methoxysalicylaldehydo)-o-phenyldiamine; N,N'-bis(3,4-difluorobenzaldehydo)-4,4'-benzidine; and N,N'-phenylenebis(3-methoxysalicylidenimine) (V-ph-V). Also includes hydrazones with ortho-O substitution.

N—O Valence Stabilizer #39: Examples of Schiff Bases with three Imine (C═N) Groups and with ortho- or alpha- or beta-hydroxy or carboxy or carbonyl substitution (N—O Tetradentates, N—O Pentadentates, or N—O Hexadentates) that meet the requirements for use as "wide band" valence stabilizers for $Co^{+3}$ include, but are not limited to: N,N',N"-(Salicylaldehydo)tris(2-aminoethyl)amine; N,N',N"-(o-Hydroxynaphthaldehydo)tris(2-aminoethyl)amine; and N,N',N"-(o-Hydroxyacetophenono)tris(2-aminoethyl)amine. Also includes hydrazones with ortho-O substitution.

N—O Valence Stabilizer #40: Examples of silylaminoalcohols (N—O Bidentates, N—O Tridentates, N—O Tetradentates, and N—O Hexadentates) that meet the requirements for use as "wide band" valence stabilizers for $Co^{+3}$ include, but are not limited to: silatranes.

N—O Valence Stabilizer #41: Examples of hydroxyalkyl imines (imino alcohols) (N—O Bidentates, N—O Tridentates, N—O Tetradentates, and N—O Hexadentates) that meet the requirements for use as "wide band" valence stabilizers for $Co^{+3}$ include, but are not limited to: 2-hydroxycyclohexylimine; 3-hydroxy-2-iminonorbornane; 2,2'-diiminodicyclohexyl ether; oxamide; 3-imino-1,5-pentanedialdehyde; iminodiacetic acid; and iminodipropionic acid.

N—O Valence Stabilizer #42: Examples of hydroxyaryl amines and hydroxyaryl imines (N—O Bidentates, N—O Tridentates, N—O Tetradentates, and N—O Hexadentates) that meet the requirements for use as "wide band" valence stabilizers for $Co^{+3}$ include, but are not limited to: 2-aminophenol; 2-aminobenzoic acid (anthranilic acid); 2-aminoanisole; o-phenetidine; o-anisidine; 2-hydroxymethyl)-alpha-aminotoluene; 1-amino-2-naphthol; 2-amino-1-naphthol; 2,2'-di(aminomethyl)diphenylketone; isophoronediamine; tris-2,4,6-dimethylaminomethyl phenol; di(2-amino)phenyl ether; 1,3-di(2-amino)phenyl-2-hydroxypropane; 1,3-di(3-amino)phenyl-2-hydroxypropane; 1,3-di(2-hydroxy)phenyl-2-aminopropane; 1,3-di(3-hydroxy)phenyl-2-aminopropane; 2,2'-dihydroxyiminodibenzyl; 2,2'-iminodibenzoic acid; 2,2'-dihydroxyiminostilbene; poly(o-phenetidine); poly(o-aminophenol); poly(o-anisidine); and 3-(anilino)propionamide.

N—O Valence Stabilizer #43: Examples of five-membered heterocyclic rings containing one, two, three, or four nitrogen atoms and having at least one additional oxygen atom binding site not in a ring (N—O Bidentates, N—O Tridentates, N—O Tetradentates, or N—O Hexadentates) that meet the requirements for use as "wide band" valence stabilizers for $Co^{+3}$ include, but are not limited to: 2-hydroxypyrrole; 2-(methylhydroxy)methylpyrrole; 2,5-(hydroxymethyl)pyrrole; 2,5-(methylhydroxymethyl)pyrrole; imidazoline-2-one (2-hydroxyimidazole); 2-hydroxythiazoline; 2-hydroxybenzimidazole; 2-hydroxybenzothiazole; 2-hydroxybenzoxazole; 2-hydantoin; di-2-pyridylglyoxal (2,2'-pyridil); bis((1-pyrazolyl)methane)ether; bis(2-(1-pyrazolyl)ethane)ether; bis(benzimidazolylmethane)ether; bis(benzimidazolylethane)ether; tris(imidazolyl)methanol; tris(imidazolylmethane)methanol; N-hydroxymethyl-N,N-(benzimidazolylmethane)amine; N-(2-hydroxyethyl)-N,N-(benzimidazolylmethane)amine; N,N'-di(benzimidazolylmethane)-1,3-diamino-2-hydroxypropane; N,N,N',N'-tetrakis(benzimidazolylmethane)-1,3-diamino-2-hydroxypropane; bis(N,N-((4-imidazolyl)methane)2-aminoethane)ether; 4-carboxybenzotriazole; antipyrine; 4-aminoantipyrine (aap); hydantoin; aminoalkylhydantoins; 2,5-oxazolidinedione; benzyldibenzoyltriazole (bdbt); 5-hydroxymethylimidazole; dicarboxyalkylbenzotriazoles; bis(hydroxyphenyl)aminotriazoles; pyrrole-2-carboxaldehyde; (oxopyrrolidinylalkyl)triazoles; alkoxybenzotriazoles; aryloxybenzotriazoles; 3-salicylamido-4,5-dihydro-1,2,4-triazole; 5-(alkoxy)benzotriazole; (polyoxyalkylene)oxazolidines; 1-(dialkylaminomethyl)-5-carboxyalkylbenzotriazole; 1-(2-hydroxyethyl)imidazoline; 1-acetoxyimidazole; 1-acetylimidazole; benzotriazolecarboxylic acid; poly(oxyalkylated)pyrazoles; poly(oxyalkylated)thiadiazoles; 1,2,4-triazole-3-carboxylic acid; 5-hydroxypyrazole; 3-phenyl-1,2,4-triazol-5-one (ptr); 1-acetylbenzimidazole; 1-[(acetoxy)ethyl]benzimidazole; creatinine; indole-2-carboxylic acid; pyrrole-2-carboxylic acid; imidazole-2-carboxylic acid; pyrazole-2-carboxylic acid; and 1,1'-oxalyldiimidazole.

N—O Valence Stabilizer #44: Examples of six-membered heterocyclic rings containing one, two, three, or four nitrogen atoms and having at least one additional oxygen atom binding site not in a ring (N—O Bidentates, N—O Tridentates, N—O Tetradentates, or N—O Hexadentates) that meet the requirements for use as "wide band" valence stabilizers for $Co^{+3}$ include, but are not limited to: 4-aminomethyl-3-pyridinemethanol (including pyridoxamine); 2-hydroxypyridine; 2-(methylhydroxy)methylpyridine; 2-(2-(methylhydroxy)ethyl)pyridine; 2,6-(hydroxymethyl)pyridine; 2,6-(methylhydroxymethyl)pyridine; 2-hydroxypyrimidine; 2-dihydroxymethylpyrimidine; 2-hydroxyquinoline; 8-hydroxyquinoline (oxine); 8-methylhydroxyquinoline; 2-hydroxyquinazoline; orotic acid (1,2,3,6-tetrahydro-2,6-dioxo-4-pyrimidinecarboxylic acid) (6-uracilcarboxylic acid); 1-methylpyrimidine-2-one; uracil; 6-hydroxypurine; bis(N,N,N',N'-tetra(2-(2-pyridyl)ethane)aminomethane)ether; bis(N,N,N',N'-tetra(2-(2-pyridyl)ethane)aminoethane)ether; quinazol-4-one; quinazol-2-one; 5-azathymine; 2-hydroxybenzimidazole (2-hbz); guanine; 1,3,5-triazin-6-one; 6-hydroxy-1,3,5-triazine; 4,6-dihydroxy-1,3,5-triazine; triazine carboxylic acids; 2,3-dihydroxypyridine; thiomorpholin-3-one; hydroxytetrahydropyrimidines; 2-piperazinones; 2-piperidinones; dilituric acid; actinoquinol; caffeine; citrazinic acid; picolinic acid; 2-quinolol; 2,6-dimethoxypyridine; quinoxaline-2-carboxylic acid; flucytosine; hypoxanthine; hexamethylolmelamine; hydroorotic acid; isoorotic acid; xanthine; leucopterin; nitroorotic acid; 8-azaguanine; and cyanuric acid.

N—O Valence Stabilizer #45: Examples of five-membered heterocyclic rings containing one or two oxygen atoms and having at least one additional nitrogen atom binding site not in a ring (N—O Bidentates, N—O Tridentates, N—O Tetradentates, or N—O Hexadentates) that meet the requirements for use as "wide band" valence stabilizers for $Co^{+3}$ include, but are not limited to: 2-aminofuran; 2,5-diaminofuran; 2-aminomethylfuran; 2,5-di(aminomethyl)furan; 2-aminobenzofuran; and 2-amino-1,3-dioxolane.

N—O Valence Stabilizer #46: Examples of six-membered heterocyclic rings containing one or two oxygen atoms and having at least one additional nitrogen atom binding site not in a ring (N—O Bidentates, N—O Tridentates, N—O Tetradentates, or N—O Hexadentates) that meet the requirements for use as "wide band" valence stabilizers for $Co^{+3}$ include, but are not limited to: 2-aminopyran; 2,6-diaminopyran; 2-aminomethylpyran; 2,6-di(aminomethyl)pyran; and 2-aminobenzopyran.

N—O Valence Stabilizer #47: Examples of five-membered heterocyclic rings containing one, two, three, or four nitrogen atoms and having at least one additional oxygen atom binding site in a separate ring (N—O Bidentates, N—O Tridentates, N—O Tetradentates) that meet the requirements for use as "wide band" valence stabilizers for $Co^{+3}$ include, but are not limited to: 2-(2-furan)pyrrole; 2,5-di(2-furan)pyrrole; 2-(2-pyran)pyrrole; 2,5-di(2-pyran)pyrrole; 2,5-di(2-pyrrole)furan; and 2,6-di(2-pyrrole)pyran.

N—O Valence Stabilizer #48: Examples of six-membered heterocyclic rings containing one, two, three, or four nitrogen atoms and having at least one additional oxygen atom binding site in a separate ring (N—O Bidentates, N—O Tridentates, N—O Tetradentates) that meet the requirements for use as "wide band" valence stabilizers for $Co^{+3}$ include, but are not limited to: 2-(2-furan)pyridine; 2,6-di(2-furan)pyridine; 2-(2-pyran)pyridine; 2,6-di(2-pyran)pyridine; 2,5-di(2-pyridyl)furan; 2,6-di(2-pyridyl)pyran; and drometrizole.

N—O Valence Stabilizer #49: Examples of two-, three-, four-, six-, eight-, and ten-membered macrocyclics, macrobicyclics, and macropolycyclics (including catapinands, cryptands, cyclidenes, and sepulchrates) wherein all binding sites are composed of nitrogen (usually amine or imine groups) or oxygen (usually hydroxy, carboxy, or carbonyl groups) and are not contained in component heterocyclic rings (N—O Bidentates, N—O Tridentates, N—O Tetradentates, and N—O Hexadentates) that meet the requirements for use as "wide band" valence stabilizers for $Co^{+3}$ include, but are not limited to: azaoxacyclobutane ([4]aneNO); azaoxacyclopentane ([5]aneNO); azaoxacyclohexane ([6]aneNO); azaoxacycloheptane ([7]aneNO); azaoxacyclooctane ([8]aneNO); azaoxacyclobutene ([4]eneNO); azaoxacyclopentene ([5]eneNO); azaoxacyclohexene ([6]eneNO); azaoxacycloheptene ([7]eneNO); azaoxacyclooctene ([8]eneNO); azaoxacyclobutadiene ([4]dieneNO); azaoxacyclopentadiene ([5]dieneNO); azaoxacyclohexadiene ([6]dieneNO); azaoxacycloheptadiene ([7]dieneNO); azaoxacyclooctadiene ([8]dieneNO); diazaoxacyclohexane ([6]aneON$_2$); diazaoxacycloheptane ([7]aneON$_2$); diazaoxacyclooctane ([8]aneON$_2$); diazaoxacyclononane ([9]aneON$_2$); diazaoxacyclodecane ([10]aneON$_2$); diazaoxacycloundecane ([11]aneON$_2$); diazaoxacyclododecane ([12]aneON$_2$); diazaoxacyclohexene ([6]eneON$_2$); diazaoxacycloheptene ([7]eneON$_2$); diazaoxacyclooctene ([8]eneON$_2$); diazaoxacyclononene ([9]eneON$_2$); diazaoxacyclodecene ([10]eneON$_2$); diazaoxacycloundecene ([11]eneON$_2$); diazaoxacyclododecene ([12]eneON$_2$); diazadioxacyclooctane ([8]aneO$_2$N$_2$); diazadioxacyclononane ([9]aneO$_2$N$_2$); diazadioxacyclodecane ([10]aneO$_2$N$_2$); diazadioxacycloundecane ([11]aneO$_2$N$_2$); diazadioxacyclododecane ([12]aneO$_2$N$_2$); diazadioxacyclotridecane ([13]aneO$_2$N$_2$); diazadioxacyclotetradecane ([14]aneO$_2$N$_2$); diazadioxacyclopentadecane ([15]aneO$_2$N$_2$); diazadioxacyclohexadecane ([16]aneO$_2$N$_2$); diazadioxacycloheptadecane ([17]aneO$_2$N$_2$); diazadioxacyclooctadecane ([18]aneO$_2$N$_2$); diazadioxacyclononadecane ([19]aneO$_2$N$_2$); diazadioxacycloeicosane ([20]aneO$_2$N$_2$); diazadioxacyclooctadiene ([8]dieneO$_2$N$_2$); diazadioxacyclononadiene ([9]dieneO$_2$N$_2$); diazadioxacyclodecadiene ([10]dieneO$_2$N$_2$); diazadioxacycloundecadiene ([11]dieneO$_2$N$_2$); diazadioxacyclododecadiene ([12]dieneO$_2$N$_2$); diazadioxacyclotridecadiene ([13]dieneO$_2$N$_2$); diazadioxacyclotetradecadiene ([14]dieneO$_2$N$_2$); diazadioxacyclopentadecadiene ([15]dieneO$_2$N$_2$); diazadioxacyclohexadecadiene ([16]dieneO$_2$N$_2$); diazadioxacycloheptadecadiene ([17]

dieneO$_2$N$_2$); diazadioxacyclooctadecadiene ([18] dieneO$_2$N$_2$); diazadioxacyclononadecadiene ([19] dieneO$_2$N$_2$); and diazadioxacycloeicosadiene ([20] dieneO$_2$N$_2$).

N—O Valence Stabilizer #50: Examples of four-, six-, eight-, or ten-membered macrocyclics, macrobicyclics, and macropolycyclics (including catapinands, cryptands, cyclidenes, and sepulchrates) wherein all binding sites are composed of nitrogen or oxygen and are contained in component heterocyclic rings (N—O Bidentates, N—O Tridentates, N—O Tetradentates, or N—O Hexadentates) that meet the requirements for use as "wide band" valence stabilizers for $Co^{+3}$ include, but are not limited to: dipyrandipyridines; difurandipyrroles; tripyrantripyridines; trifurantripyrroles; tetrapyrantetrapyridines; and tetrafurantetrapyrroles.

N—O Valence Stabilizer #51: Examples of four-, six-, eight-, or ten-membered macrocyclics, macrobicyclics, and macropolycyclics (including catapinands, cryptands, cyclidenes, and sepulchrates) wherein all binding sites are composed of nitrogen or oxygen and are contained in a combination of heterocyclic rings and amine, imine, hydroxy, carboxy, or carbonyl groups (N—O Bidentates, N—O Tridentates, N—O Tetradentates, or N—O Hexadentates) that meet the requirements for use as "wide band" valence stabilizers for $Co^{+3}$ include, but are not limited to: azaoxatetraphyrins; diazadioxatetraphyrins; azaoxahexaphyrins; diazadioxahexaphyrins; and triazatrioxahexaphyrins.

S—O Valence Stabilizer #1: Examples of 1,3-monothioketones (monothio-beta-ketonates), 1,3,5-monothioketones, 1,3,5-dithioketones, bis(1,3-monothioketones), and poly(1,3-monothioketones) (S—O Bidentates, S—O Tridentates, S—O Tetradentates) that meet the requirements for use as "wide band" valence stabilizers for $Co^{+3}$ include, but are not limited to: hexafluoropenta-2-thione-4-ketone; 1,3-diphenyl-1,3-propana-1-thione-3-ketone; benzoylthiopinacolone; cyclohexoylthiocyclohexoylmethane; diphenylpentanedithionate; tetramethylnonanedithionate; hexafluoroheptanedithionate; trifluoroheptanedithionate; 1-(2-thienyl)-butan-1-thione-3-ketone, 1-(2-naphthyl)-butan-1-thione-3-ketone, and trifluoroacetylthiocamphor.

S—O Valence Stabilizer #2: Examples of thiomalonamides (thiomalonodiamides), bis(thiomalonamides), and polythiomalonamides (S—O Bidentates, S—O Tridentates, S—O Tetradentates) that meet the requirements for use as "wide band" valence stabilizers for $Co^{+3}$ include, but are not limited to: thiomalonamide, N-phenylthiomalonamide, N-benzylthiomalonamide, N-pentafluorophenylthiomalonamide, N-cyclohexylthiomalonamide, N-norbornylthiomalonamide, N,N'-diphenylthiomalonamide, N,N'-dibenzylthiomalonamide, N,N'-dipentafluorophenylthiomalonamide, N,N'-dicyclohexylthiomalonamide, and N,N'-norbornylthiomalonamide.

S—O Valence Stabilizer #3: Examples of 2-thioacylacetamides, 2-acylthioacetamides, bis(2-thioacylacetamides), bis(2acylthioacetamides), poly(2-thioacylacetamides), and poly(2-Acylthioacetamides) (S—O Bidentates, S—O Tridentates, S—O Tetradentates) that meet the requirements for use as "wide band" valence stabilizers for $Co^{+3}$ include, but are not limited to: 2-acetothioacetamide, 2-thioacetoacetamide, N-phenyl-2-acetothioacetamide, N-pentafluorophenyl-2-acetothioacetamide, N-benzyl-2-acetothioacetamide, N-cyclohexyl-2-acetothioacetamide, N-norbornyl-2-acetothioacetamide, N-phenyl-2-benzothioacetamide, N-pentafluorophenyl-2-pentafluorobenzothioacetamide, and N-cyclohexyl-2-cyclohexothioacetamide.

S—O Valence Stabilizer #4: Examples of dithiodicarbonic diamides, bis(dithiodicarbonic diamides), and poly(dithiodicarbonic diamides) (S—O Bidentates, S—O Tridentates, S—O Tetradentates) that meet the requirements for use as "wide band" valence stabilizers for $Co^{+3}$ include, but are not limited to: dithiodicarbonic diamide; N-phenyldithiodicarbonic diamide; N-pentafluorophenyldithiodicarbonic diamide; N-benzyldithiodicarbonic diamide; N-cyclohexyldithiodicarbonic diamide; N-norbornyldithiodicarbonic diamide; N,N'-diphenyldithiodicarbonic diamide; N,N'-dipentafluorophenyldithiodicarbonic diamide; N,N'-dibenzyldithiodicarbonic diamide; N,N'-dicyclohexyldithiodicarbonic diamide; and N,N'-dinorbornyldithiodicarbonic diamide.

S—O Valence Stabilizer #5: Examples of monothiohypophosphoric acids, bis(monothiohypophosphoric acids), poly(monothiohypophosphoric acids), and derivatives thereof (S—O Bidentates, S—O Tridentates, S—O Tetradentates) that meet the requirements for use as "wide band" valence stabilizers for $Co^{+3}$ include, but are not limited to: monothiohypophosphoric acid, methylmonothiohypophosphoric acid, isopropylmonothiohypophosphoric acid, tert-butylmonothiohypophosphoric acid, phenylmonothiohypophosphoric acid, pentafluorophenylmonothiohypophosphoric acid, benzylmonothiohypophosphoric acid, cyclohexylmonothiohypophosphoric acid, norbornylmonothiohypophosphoric acid, dimethylmonothiohypophosphoric acid, diisopropylmonothiohypophosphoric acid, di-tert-butylmonothiohypophosphoric acid, diphenylmonothiohypophosphoric acid, di-pentafluorophenylmonothiohypophosphoric acid, dibenzylmonothiohypophosphoric acid, dicyclohexylmonothiohypophosphoric acid, and dinorbornylmonothiohypophosphoric acid.

S—O Valence Stabilizer #6: Examples of monothiohypophosphoramides, bis(monothiohypophosphoramides), and poly(monothiohypophosphoramides) (S—O Bidentates, S—O Tridentates, S—O Tetradentates) that meet the requirements for use as "wide band" valence stabilizers for $Co^{+3}$ include, but are not limited to: monothiohypophosphoramide, N-methylmonothiohypophosphoramide, N-isopropylmonothiohypophosphoramide, N-tert-butylmonothiohypophosphoramide, N-phenylmonothiohypophosphoramide, N-pentafluorophenylmonothiohypophosphoramide, N-benzylmonothiohypophosphoramide, N-cyclohexylmonothiohypophosphoramide, N-norbornylmonothiohypophosphoramide, N,N'''-dimethylmonothiohypophosphoramide, N,N'''-diisopropylmonothiohypophosphoramide, N,N'''-di-tert-butylmonothiohypophosphoramide, N,N'''-diphenylmonothiohypophosphoramide, N,N'''-dipentafluorophenylmonothiohypophosphoramide, N,N'''-dibenzylmonothiohypophosphoramide, N,N'''-dicyclohexylmonothiohypophosphoramide, and N,N'''-dinorbornylmonothiohypophosphoramide.

S—O Valence Stabilizer #7: Examples of monothioimidodiphosphoric acids, monothiohydrazidodiphosphoric acids, bis(monothioimidodiphosphoric acids), bis(monothiohydrazidodiphosphoric acids), poly(monothioimidodiphosphoric acids), poly(monothiohydrazidodiphosphoric acids), and derivatives thereof (S—O Bidentates, S—O Tridentates, S—O Tetradentates) that meet the requirements for use as "wide band" valence stabilizers for $Co^{+3}$ include, but are not limited to: monothioimidodiphosphoric acid, methylmonothioimidodiphosphoric acid, isopropylmonothioimidodiphosphoric acid, tert-butylmonothioimidodiphosphoric acid, phenylmonothioimidodiphosphoric acid, pentafluorophenylmonothioimidodiphosphoric acid, benzylmonothioimidodiphosphoric acid, cyclohexylmonothioimidodiphosphoric acid, norbornylmonothioimidodiphosphoric acid, dimethylmonothioimidodiphosphoric acid, diisopropylmonothioimidodiphosphoric acid, di-tert-butylmonothioimidodiphosphoric acid, diphenylmonothioimidodiphosphoric acid, di-pentafluorophenylmonothioimidodiphosphoric acid, dibenzylmonothioimidodiphosphoric acid, dicyclohexylmonothioimidodiphosphoric acid, and dinorbornylmonothioimidodiphosphoric acid.

S—O Valence Stabilizer #8: Examples of monothioimidodiphosphoramides, monothiohydrazidodiphosphoramides, bis(monothioimidodiphosphoramides), bis(monothiohydrazidodiphosphoramides), poly(monothioimidodiphosphoramides), and poly(monothiohydrazidodiphosphoramides) (S—O Bidentates, S—O Tridentates, S—O Tetradentates) that meet the requirements for use as "wide band" valence stabilizers for $Co^{+3}$ include, but are not limited to: monothioimidodiphosphoramide, N-methylmonothioimidodiphosphoramide, N-isopropylmonothioimidodiphosphoramide, N-tert-butylmonothioimidodiphosphoramide, N-phenylmonothioimidodiphosphoramide, N-pentafluorophenylmonothioimidodiphosphoramide, N-benzylmonothioimidodiphosphoramide, N-cyclohexylmonothioimidodiphosphoramide, N-norbornylmonothioimidodiphosphoramide, N,N'''-dimethylmonothioimidodiphosphoramide, N,N'''-diisopropylmonothioimidodiphosphoramide, N,N'''-di-tert-butylmonothioimidodiphosphoramide, N,N'''-diphenylmonothioimidodiphosphoramide, N,N'''-di-pentafluorophenylmonothioimidodiphosphoramide, N,N'''-dibenzylmonothioimidodiphosphoramide, N,N'''-dicyclohexylmonothioimidodiphosphoramide, and N,N'''-dinorbornylmonothioimidodiphosphoramide.

S—O Valence Stabilizer #9: Examples of monothiodiphosphoramides, bis(monothiodiphosphoramides), and poly (monothiodiphosphoramides) (S—O Bidentates, S—O Tridentates, S—O Tetradentates) that meet the requirements for use as "wide band" valence stabilizers for $Co^{+3}$ include, but are not limited to: monothiodiphosphoramide, N-methylmonothiodiphosphoramide, N-isopropylmonothiodiphosphoramide, N-tert-butylmonothiodiphosphoramide, N-phenylmonothiodiphosphoramide, N-pentafluorophenylmonothiodiphosphoramide, N-benzylmonothiodiphosphoramide, N-cyclohexylmonothiodiphosphoramide, N-norbornylmonothiodiphosphoramide, N,N'''-dimethylmonothiodiphosphoramide, N,N'''-diisopropylmonothiodiphosphoramide, N,N'''-di-tert-butylmonothiodiphosphoramide, N,N'''-diphenylmonothiodiphosphoramide, N,N'''-di-pentafluorophenylmonothiodiphosphoramide, N,N'''-dibenzylmonothiodiphosphoramide, N,N'''-dicyclohexylmonothiodiphosphoramide, and N,N'''-dinorbornylmonothiodiphosphoramide.

S—O Valence Stabilizer #10: Examples of monothiodiphosphoric acids, bis(monothiodiphosphoric acids), poly(monothiodiphosphoric acids), and derivatives thereof (S—O Bidentates, S—O Tridentates, S—O Tetradentates) that meet the requirements for use as "wide band" valence stabilizers for $Co^{+3}$ include, but are not limited to: monothiodiphosphoric acid, methylmonothiodiphosphoric acid, isopropylmonothiodiphosphoric acid, tert-butylmonothiodiphosphoric acid, phenylmonothiodiphosphoric acid, pentafluorophenylmonothiodiphosphoric acid, benzylmonothiodiphosphoric acid, cyclohexylmonothiodiphosphoric acid, norbornylmonothiodiphosphoric acid, dimethylmonothiodiphosphoric acid, diisopropylmonothiodiphosphoric acid, di-tert-butylmonothiodiphosphoric acid, diphenylmonothiodiphosphoric acid, di-pentafluorophenylmonothiodiphosphoric acid, dibenzylmonothiodiphosphoric acid, dicyclohexylmonothiodiphosphoric acid, and dinorbornylmonothiodiphosphoric acid.

S—O Valence Stabilizer #11: Examples of monothiocarbamates, bis(monothiocarbamates), and poly(monothiocarbamates) (including N-hydroxymonothiocarbamates and N-mercaptomonothiocarbamates) (S—O Bidentates, S—O Tridentates, and S—O Tetradentates) that meet the requirements for use as "wide band" valence stabilizers for $Co^{+3}$ include, but are not limited to: dimethylmonothiocarbamate (dmmtc); di(trifluorodimethyl)monothiocarbamate; diethylmonothiocarbamate (demtc); dipropylmonothiocarbamate; diisopropylmonothiocarbamate; dibutylmonothiocarbamate; ditertbutylmonothiocarbamate; dicyanamidomonothiocarbamate; diphenylmonothiocarbamate; di(pentafluorophenyl)monothiocarbamate; dibenzylmonothiocarbamate; dinaphthylmonothiocarbamate; dicyclohexylmonothiocarbamate; dinorbornylmonothiocarbamate; diadamantylmonothiocarbamate; pyrrolidinomonothiocarbamate (pyrmtc); piperidinomonothiocarbamate (pipmtc); morpholinomonothiocarbamate (mormtc); thiamorpholinomonothiocarbamate; 3-pyrrolinomonothiocarbamate; pyrrolomonothiocarbamate; oxazolomonothiocarbamate; isoxazolomonothiocarbamate; thiazolomonothiocarbamate; isothiazolomonothiocarbamate; indolomonothiocarbamate; carbazolomonothiocarbamate; pyrazolinomonothiocarbamate; imidazolinomonothiocarbamate; pyrazolomonothiocarbamate; imidazolomonothiocarbamate; indazolomonothiocarbamate; and triazolomonothiocarbamate.

Water-soluble precursors for the organic valence stabilizers are typically used to ensure that sufficient material is available for deposition from aqueous solutions. Identification of suitable water soluble precursors can be difficult because many of these organics do not form a wide range of water-soluble compounds.

As with the inorganic valence stabilizers, crosses between two or more organic valence stabilizers can be used to stabilize $Co^{+3}$ for corrosion protection. For example, in some instances it may be desirable to form a valence stabilizer out of a nitrogen-containing heterocyclic and an amine ligand. Both of these materials can complex to form a mixed nitrogen heterocyclic/amine valence stabilizer out of the rinsing or sealing solution during the coating process.

2c) Narrow Band Inorganic Valence Stabilizers

Narrow band valence stabilizers can be used to stabilize $Co^{+3}$ for corrosion protection, but they are less typical. Narrow band valence stabilizers exhibit some limitation in their use when compared to wide band stabilizers. They may be toxic or may complex $Co^{+3}$ only with difficulty. These narrow band stabilizers include, but are not limited to, bismuthates, germanates, arsenates, titanates, zirconates, and hafnates. For example, valence stabilizers using arsenate are less desirable because their inherent toxicity is very large (greater than $Cr^{+6}$), although they may be very effective at inhibiting corrosion when used with $Co^{+3}$. Arsenates can be used as valence stabilizers for $Co^{+3}$ when the toxicity of the rinse or sealing solution is not a factor in its use.

Other narrow band stabilizers may result in $Co^{+3}$-stabilizer complexes with limited stability, an undesirable solubility range, or limited electrostatic characteristics, and they would be useful only in limited applications. Formation of a protective shell of octahedra or tetrahedra with phosphates ($P^{+5}$), borates ($B^{+3}$), aluminates ($Al^{+3}$), and silicates ($Si^{-4}$) around the $Co^{+3}$ ion is difficult but possible. These compounds are known to form octahedra or tetrahedra, but tend to polymerize in chain-like structures when precipitated from aqueous solution under ambient conditions. These and other narrow band stabilizers can provide some degree of corrosion protection when complexed with $Co^{+3}$, but will not necessarily perform with the same efficiency as the wide band stabilizers by themselves. Combinations of these materials, such as phosphosilicates, aluminosilicates, or borosilicates may also function as narrow band inorganic valence stabilizers.

Narrow band inorganic stabilizers used in combination with wide band inorganic stabilizers described above can be used to provide significant corrosion protection. Conversely, modifications of wide band inorganic valence stabilizers can result in a complex with reduced corrosion inhibition. For example, heteropolymetallates can contain ions in addition to the desired $Co^{+3}$ ion.

The central cavity of the heteropolymetallates can contain ions in addition to the desired $Co^{+3}$ ion. For example, the use of silicomolybdates, phosphomolybdates, silicotungstates, and phosphotungstates is possible. In these $Co^{+3}$-valence stabilizer complexes, $Si^{+4}$ or $P^{+5}$ ions also occupy the central cavity of the complex with the $Co^{+3}$ ion. The inclusion of additional ions in the central cavity reduces the stability of the complex, and thereby leads to lower corrosion protection. Nonetheless, these complexes also demonstrated some corrosion-inhibiting activity.

The additional ions that can be included within the central cavity of the heteropolymetallates described above depend upon the size of the central cavity, which in turn depends upon the specific chemistry exhibited by an inorganic valence stabilizer (e.g., molybdate, tungstate, periodate, carbonate, etc.). In general, these additional ions must also be small so as to ensure the stability of the formed $Co^{+3}$-valence stabilized complex. Examples of small additional ions include, but are not limited to: $B^{+3}$, $Al^{+3}$, $Si^{+4}$, $p^{+5}$, $Ti^{+4}$, $V^{+5}$, $V^{+4}$, $Cr^{+6}$, $Cr^{+4}$, $Cr^{+3}$, $Mn^{+4}$, $Mn^{+3}$, $Mn^{+2}$, $Fe^{+3}$, $Fe^{+2}$, $Ni^{+2}$, $Ni^{+3}$, $Ni^{+4}$, $Cu^{+2}$, $Cu^{+3}$, $Zn^{+2}$, $Ga^{+3}$, $Ge^{+4}$, $As^{+5}$, $As^{+3}$, $Zr^{+4}$, and $Ce^{+4}$.

Water-soluble precursors for these materials are desirable. Typically, the free acids (e.g., silicomolybdic acid, phosphotungstic acid, borotungstic acid, etc.) offer the most water-soluble precursors for these materials.

2d) Narrow Band Organic Valence Stabilizers

Narrow band organic valence stabilizers include those general classes of chemical compounds that result in $Co^{+3}$-valence stabilizer complexes that are either less stable, more soluble in water, or more toxic than the wide band organic stabilizers. As discussed above, the properties of a particular $Co^{+3}$-containing complex can be altered by changing the substituent groups on these general classes of valence stabilizers. This can influence the effectiveness of corrosion inhibition normally achieved using that specific complex.

TABLE 3

Narrow Band Organic Valence Stabilizers for the $Co^{+3}$ ion

| General Structural Name (Type of Organic) | Structural Representation |
|---|---|
| N Valence Stabilizer #1: Five-, Seven-, or Nine-Membered Macrocyclics, Macrobicyclics, and Macropolycyclics (including Catapinands, Cryptands, Cyclidenes, and Sepulchrates) wherein all Binding Sites are composed of Nitrogen (usually amine or imine groups) and are not contained in Component Heterocyclic Rings (N—N Tridentates, N—N Tetradentates, and N—N Hexadentates) | Macrocyclic ligands containing five, seven, or nine nitrogen binding sites to valence stabilize the central metal ion. Can include other hydrocarbon or ring systems bound to this macrocyclic ligand, but they do not coordinate with the stabilized, high valence metal ion. This ligand and/or attached, uncoordinating hydrocarbons/rings may or may not have halogen or polarizing or water-insolubilizing/solubilizing groups attached. |
| N Valence Stabilizer #2: Five-, or Seven-Membered Macrocyclics, Macrobicyclics, and Macropolycyclics (including Catapinands, Cryptands, Cyclidenes, and Sepulchrates) wherein all Binding Sites are composed of Nitrogen and are contained in Component 5-Membered Heterocyclic Rings (N—N Tridentates, N—N Tetradentates, or N—N Hexadentates) | Macrocyclic ligands containing a total of five or seven five-membered heterocyclic rings containing nitrogen binding sites. Can include other hydrocarbon/ring systems bound to this macrocyclic ligand, but they do not coordinate with the stabilized, high valence metal ion. This ligand and/or attached, uncoordinating hydrocarbon/rings may or may not have halogen or polarizing or water-insolubilizing groups attached. |
| N Valence Stabilizer #3: Five-, Seven-, or Nine-Membered Macrocyclics, Macrobicyclics, and Macropolycyclics (including Catapinands, Cryptands, Cyclidenes, and Sepulchrates) wherein all Binding Sites are composed of Nitrogen and are contained in a Combination of 5-Membered Heterocyclic Rings and Amine or Imine Groups (N—N Tridentates, N—N Tetradentates, or N—N Hexadentates) | Macrocyclic ligands containing at least one 5-membered heterocyclic ring. These heterocyclic rings provide nitrogen binding sites to valence stabilize the central metal ion. Other amine or imine binding sites can also be included in the macrocyclic ligand, so long as the total number of binding sites is five, seven, or nine. Can include other hydrocarbon/ring systems bound to this macrocyclic ligand, but they do not coordinate with the stabilized, high valence metal ion. This ligand and/or attached, uncoordinating hydrocarbon/rings may or may not have halogen or polarizing or water-insolubilizing groups attached. |

TABLE 3-continued

Narrow Band Organic Valence Stabilizers for the $Co^{+3}$ ion

| General Structural Name (Type of Organic) | Structural Representation |
|---|---|
| N Valence Stabilizer #4: Five- or Seven-Membered Macrocyclics, Macrobicyclics, and Macropolycyclics (including Catapinands, Cryptands, Cyclidenes, and Sepulchrates) wherein all Binding Sites are composed of Nitrogen and are contained in Component 6-Membered Heterocyclic Rings (N—N Tridentates, N—N Tetradentates, or N—N Hexadentates) | Macrocyclic ligands containing a total of five or seven six-membered heterocyclic rings containing nitrogen binding sites. Can include other hydrocarbon/ring systems bound to this macrocyclic ligand, but they do not coordinate with the stabilized, high valence metal ion. This ligand and/or attached, uncoordinating hydrocarbon/rings may or may not have halogen or polarizing or water-insolubilizing groups attached. |
| N Valence Stabilizer #5: Five-, Seven-, or Nine-Membered Macrocyclics, Macrobicyclics, and Macropolycyclics (including Catapinands, Cryptands, Cyclidenes, and Sepulchrates) wherein all Binding Sites are composed of Nitrogen and are contained in a Combination of 6-Membered Heterocyclic Rings and Amine or Imine Groups (N—N Tridentates, N—N Tetradentates, or N—N Hexadentates) | Macrocyclic ligands containing at least one 6-membered heterocyclic ring. These heterocyclic rings provide nitrogen binding sites to valence stabilize the central metal ion. Other amine or imine binding sites can also be included in the macrocyclic ligand, so long as the total number of binding sites is five, seven, or nine. Can include other hydrocarbon/ring systems bound to this macrocyclic ligand, but they do not coordinate with the stabilized, high valence metal ion. This ligand and/or attached, uncoordinating hydrocarbon/rings may or may not have halogen or polarizing or water-insolubilizing groups attached. |
| N Valence Stabilizer #6: Silylamines and Silazanes, including Macrocyclic Derivatives, wherein at least one Nitrogen Atom is a Binding Site (N Monodentates, N—N Bidentates, N—N Tridentates, N—N Tetradentates, and N—N Hexadentates) | $N(SiR_3)_3$, $R'N(SiR_3)_2$, or $R'R''N(SiR_3)$ for silylamines; and $[RR''Si—NR']_x$ (x = 1–10) for silazanes where R, R', and R'' represents H or any organic functional group wherein the number of carbon atoms ranges from 0 to 35, optionally having halogen or polarizing or water-insolubilizing/solubilizing groups attached. Ligand can also contain nonbinding N, P, As, O, S, or Se atoms. |
| N Valence Stabilizer #7: Guanidines, Diguanidines, and Polyguanidines (N—N Bidentates, N—N Tridentates, N—N Tetradentates, and N—N Hexadentates) | RR'—N—C(=NH)NR''R''', where R, R', R'', and R''' represent H or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| N Valence Stabilizer #8: Phosphonitrile Amides, and Bis(phosphonitrile amides) (N—N Bidentates, N—N Tetradentates) | RR'—N—P(=N)—N—R''R''', where R, R', R'', and R''' represent H or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| N Valence Stabilizer #9: Phosphonimidic Diamides, Bis(Phosphonimidic Diamides), and Poly(Phosphonimidic Diamides) (N—N Bidentates, N—N Tetradentates) | (NH=)PR''''(—NRR')(—NR''R'''), where R, R', R'', R''', and R'''' represent H or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| N Valence Stabilizer #10: Phosphonamidimidic Acid, Phosphonamidimidothioic Acid, Bis(Phosphonamidimidic Acid), Bis(Phosphonamidimidothioic Acid), Poly(Phosphonamidimidic Acid), Poly(Phosphonamidimidothioic Acid), and derivatives thereof (N—N Bidentates, and N—N Tetradentates) | (NH=)PR'''(—NRR')(—OR'') for phosphonamidimidic acid and (NH=)PR'''(—NRR')(—SR'') for phosphonamidimidothioic acid, where R, R', R'', and R''' represent H or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| N Valence Stabilizer #11: Pyridinaldimines, Bis(pyridinaldimines), and Poly(pyridinaldimines) (N—N Bidentates, N—N Tridentates, and N—N Tetradentates) | $C_5H_5N—CR=NR'$, where $C_5H_5N$ is a pyridine derivative, R is typically an aromatic constituent (i.e., $—C_6H_5$), and R' represents H or any organic functional group wherein the number of carbon atoms ranges from 0 to 40, optionally having halogen or polarizing or water-insolubilizing/solubilizing groups attached. Ligand can also contain nonbinding N, O, S, or P atoms. |

TABLE 3-continued

Narrow Band Organic Valence Stabilizers for the $Co^{+3}$ ion

| General Structural Name (Type of Organic) | Structural Representation |
|---|---|
| N Valence Stabilizer #12: Hydrazones, Bis(hydrazones), and Poly(hydrazones) (N Monodentates, N—N Bidentates, N—N Tridentates, and N—N Tetradentates) | R—NH—N=R', where R and R' represent H or any organic functional group wherein the number of carbon atoms ranges from 0 to 40, optionally having halogen or polarizing or water-insolubilizing/solubilizing groups attached. (Either R or R' is typically an aryl group.) Ligand can also contain nonbinding N, O, S, or P atoms. |
| N Valence Stabilizer #13: Azo compounds including triazenes without chelate substitution at the ortho- (for aryl) or alpha- or beta- (for alkyl) positions, Bis(azo compounds), or Poly(azo compounds) (N Monodentates, N—N Bidentates, or N—N—N Tridentates) | R—N=N—R' for azo compounds, R—N=N—NH—R' for triazenes, where R, and R' represent H or any organic functional group wherein the number of carbon atoms ranges from 0 to 40, optionally having halogen or polarizing or water-insolubilizing/solubilizing groups attached. (Not including ortho- chelate substituted aryl azo compounds, and alpha- or beta-Substituted alkyl azo compounds.) Ligand can also contain nonbinding N, O, S, or P atoms. |
| N Valence Stabilizer #14: Formazans, Bis(formazans), and Poly(formazans) without ortho- hydroxy, carboxy, thiol, mercapto, amino, or hydrazido substitution (N—N Bidentates, N—N Tetradentates, and N—N Hexadentates) | R—N=N—CR'=N—NR"R'", where R, R', R", and R'" represent H, or any organic functional group wherein the number of carbon atoms ranges from 0 to 40, optionally having halogen or polarizing or water-insolubilizing/solubilizing groups attached. (Not including ortho- hydroxy, carboxy, thiol, mercapto, amino, or hydrazido substitution.) Ligand can also contain nonbinding N, O, S, or P atoms. |
| N Valence Stabilizer #15: Hydramides (N—N Bidentates) | R—CH=N—CHR'—N=CHR", where R, R', and R" represent H, or any organic functional group wherein the number of carbon atoms ranges from 0 to 40, optionally having halogen or polarizing or water-insolubilizing/solubilizing groups attached. (R, R', and R" are typically aryl derivatives.) Ligand can also contain nonbinding N, O, S, or P atoms. |
| N Valence Stabilizer #16: Azines (including ketazines), Bis(azines), and Poly(azines) without ortho- hydroxy, carboxy, thiol, mercapto, amino, or hydrazido substitution (N—N Bidentates, N—N Tetradentates, and N—N Hexadentates) | RR'C=N—N=CR"R'" or RR'C=N—NR"R'" (for ketazines), where R, R', R", and R'" represent H, or any organic functional group wherein the number of carbon atoms ranges from 0 to 40, optionally having halogen or polarizing or water-insolubilizing/solubilizing groups attached. (Not including ortho- hydroxy, carboxy, thiol, mercapto, amino, or hydrazido substitution.) Ligand can also contain nonbinding N, O, S, or P atoms. |
| N Valence Stabilizer #17: Schiff Bases with one Imine (C=N) Group and without ortho- (for aryl constituents) or alpha- or beta- (for alkyl constituents) hydroxy, carboxy, carbonyl, thiol, mercapto, thiocarbonyl, amino, imino, oximo, diazeno, or hydrazido substitution (N Monodentates) | RR'C=N—R", where R, R', and R" represent H, or any organic functional group wherein the number of carbon atoms ranges from 0 to 40, optionally having halogen or polarizing or water-insolubilizing/solubilizing groups attached. (Not including ortho-, alpha-, or beta-hydroxy, carboxy, carbonyl, thiol, mercapto, thiocarbonyl, amino, imino, oximo, diazeno, or hydrazido substitution.) Ligand can also contain nonbinding N, O, S, or P atoms. |
| N Valence Stabilizer #18: Isocyanide and Cyanamide and related ligands (N Monodentates) | Isocyanides, cyanamides, and related ligands where the nitrogen atom is directly complexed to the high valence metal ion. |
| N Valence Stabilizer #19: Nitrosyl and Nitrite and related ligands (N Monodentates) | Nitrosyl, nitrite, and related ligands where the nitrogen atom is bound directly to the high valence metal ion. |
| N Valence Stabilizer #20: Nitriles, Dinitriles, and Polynitriles (N Monodentates, N—N Bidentates, and N—N—N Tridentates) | R—CN, R—$(CN)_2$, R—$(CN)_x$, etc. where R represents H or any organic functional group wherein the number of carbon atoms ranges from 0 to 40, optionally having halogen or polarizing or water-insolubilizing/solubilizing groups attached. |
| N Valence Stabilizer #21: Azide ligands (N Monodentates, or N—N Bidentates) | Azide (—$N_3$) ligands bound directly to the high valence metal ion. Also includes organoazide derivatives (R—$N_3$), triazenido compounds (R—$N_3$—R'), phosphonyl azides (R—$PO_2H$—$N_3$), phosphoryl azides (O—$PO_2H$—N3), and sulfonyl |

TABLE 3-continued

Narrow Band Organic Valence Stabilizers for the $Co^{+3}$ ion

| General Structural Name (Type of Organic) | Structural Representation |
|---|---|
| | azides (R—$SO_2$—$N_3$) where R and R' represent H or any organic functional group wherein the number of carbon atoms ranges from 0 to 35, optionally having halogen or polarizing or water-insolubilizing/solubilizing groups attached |
| S Valence Stabilizer #1: Monothioethers (S Monodentates) wherein at least one Sulfur Atom is a Binding Site | $SH_2$, SHR, $SR_2$, where R represents H or any organic functional group wherein the number of carbon atoms ranges from 0 to 35, optionally having halogen or polarizing or water-insolubilizing/solubilizing groups attached. Ligand can also contain nonbinding N, P, O, S, or Se atoms. |
| S Valence Stabilizer #2: Disulfides (S Monodentates) wherein at least one Sulfur Atom is a Binding Site | R—S—S—R', where R and R' represents H or any organic functional group wherein the number of carbon atoms ranges from 0 to 35, optionally having halogen or polarizing or water-insolubilizing/solubilizing groups attached. Ligand can also contain nonbinding N, P, O, S, or Se atoms. |
| S Valence Stabilizer #3: Dithioethers (S—S Bidentates) wherein at least one Sulfur Atom is a Binding Site | R—S—R'—S—R", where R, R', and R" represents H or any organic functional group wherein the number of carbon atoms ranges from 0 to 35, optionally having halogen or polarizing or water-insolubilizing/solubilizing groups attached. Ligand can also contain nonbinding N, P, O, S, or Se atoms. |
| S Valence Stabilizer #4: Trithioethers (S—S Bidentates or S—S Tridentates) wherein at least one Sulfur Atom is a Binding Site | R—S—R'—S—R"—S—R'", where R, R', R", and R'" represents H or any organic functional group wherein the number of carbon atoms ranges from 0 to 35, optionally having halogen or polarizing or water-insolubilizing/solubilizing groups attached. Ligand can also contain nonbinding N, P, O, S, or Se atoms. |
| S Valence Stabilizer #5: Tetrathioethers (S—S Bidentates, S—S Tridentates, or S—S Bidentates) wherein at least one Sulfur Atom is a Binding Site | R—S—R"—S—R'—S—R'"—S—R"", where R, R', R", R'", and R"" represents H or any organic functional group wherein the number of carbon atoms ranges from 0 to 35, optionally having halogen or polarizing or water-insolubilizing/solubilizing groups attached. Ligand can also contain nonbinding N, P, O, S, or Se atoms. |
| S Valence Stabilizer #6: Hexathioethers (S—S Bidentates, S—S Tridentates, S—S Tetradentates, or S—S Hexadentates) wherein at least one Sulfur Atom is a Binding Site | R—S—R'—S—R'—S—R'"—S—R""—S—R"""—S—R""", where R, R', R", R'", R"", R"""", and R""" represents H or any organic functional group wherein the number of carbon atoms ranges from 0 to 35, optionally having halogen or polarizing or water-insolubilizing/solubilizing groups attached. Ligand can also contain nonbinding N, P, O, S, or Se atoms. |
| S Valence Stabilizer #7: Five-Membered Heterocyclic Rings containing One or Two Sulfur Atoms wherein at least one Sulfur Atom is a Binding Site (S Monodentates or S—S Bidentates) | Five membered heterocyclic ring containing one or two sulfur atoms, both of which may function as binding sites. Can include other ring systems bound to this heterocyclic ring, but they do not coordinate with the stabilized, high valence metal ion. Ring can also contain O, N, P, As, or Se atoms. This 5-membered ring and/or attached, uncoordinating rings may or may not have halogen or polarizing or water-insolubilizing/solubilizing groups attached. |
| S Valence Stabilizer #8: Six-Membered Heterocyclic Rings containing One or Two Sulfur Atoms wherein at least one Sulfur Atom is a Binding Site (S Monodentates or S—S Bidentates) | Six membered heterocyclic ring containing just one or two sulfur atoms, both of which may function as binding sites. Can include other ring systems bound to this heterocyclic ring, but they do not coordinate with the stabilized, high valence metal ion. Ring can also contain O, N, P, As, or Se atoms. This 5-membered ring and/or attached, uncoordinating rings may or may not have halogen or polarizing or water-insolubilizing/solubilizing groups attached. |
| S Valence Stabilizer #9: Five-Membered Heterocyclic Rings containing One or Two Sulfur Atoms and having at least one additional Sulfur Atom | Five membered heterocyclic ring(s) containing one or two sulfur atoms. In addition, ligand contains additional sulfur-containing substituents (usually thiols or thioethers) that |

TABLE 3-continued

Narrow Band Organic Valence Stabilizers for the $Co^{+3}$ ion

| General Structural Name (Type of Organic) | Structural Representation |
|---|---|
| Binding Site not in a Ring (S Monodentates, S—S Bidentates, S—S Tridentates, S—S Tetradentates, or S—S Hexadentates) | constitute S binding sites. Can include other ring systems bound to the heterocyclic ring or to the S-Containing substituent, but they do not coordinate with the stabilized, high valence metal ion. Ring(s) can also contain O, N, P, As or Se atoms. This 5-membered ring(s) and/or attached, uncoordinating rings and/or S-containing substituent(s) may or may not have halogen or polarizing or water-insolubilizing/solubilizing groups attached. |
| S Valence Stabilizer #10: Six-Membered Heterocyclic Rings containing One or Two Sulfur Atoms and having at least one additional Sulfur Atom Binding Site not in a Ring (S Monodentates, S—S Bidentates, S—S Tridentates, S—S Tetradentates, or S—S Hexadentates) | Six membered heterocyclic ring(s) containing one or two sulfur atoms. In addition, ligand contains additional sulfur-containing substituents (usually thiols or thioethers) that constitute S binding sites. Can include other ring systems bound to the heterocyclic ring or to the S-Containing substituent, but they do not coordinate with the stabilized, high valence metal ion. Ring(s) can also contain O, N, P, As or Se atoms. This 6-membered ring(s) and/or attached, uncoordinating rings and/or S-containing substituent(s) may or may not have halogen or polarizing or water-insolubilizing/solubilizing groups attached. |
| S Valence Stabilizer #11: Five-Membered Heterocyclic Rings containing One or Two Sulfur Atoms and having at least one additional Sulfur Atom Binding Site in a separate Ring (S Monodentates, S—S Bidentates, S—S Tridentates, S—S Tetradentates, or S—S Hexadentates) | Five membered heterocyclic ring(s) containing one or two sulfur atoms. In addition, ligand contains additional sulfur-containing rings that constitute S binding sites. Can include other ring systems bound to the S-containing heterocyclic rings, but they do not coordinate with the stabilized, high valence metal ion. Ring(s) can also contain O, N, P, As, or Se atoms. This 5-membered ring(s) and/or additional S-Containing ring(s) and/or attached, uncoordinating rings may or may not have halogen or polarizing or water-insolubilizing/solubilizing groups attached. |
| S Valence Stabilizer #12: Six-Membered Heterocyclic Rings containing One or Two Sulfur Atoms and having at least one additional Sulfur Atom Binding Site in a separate Ring (S Monodentates, S—S Bidentates, S—S Tridentates, S—S Tetradentates, or S—S Hexadentates) | Six membered heterocyclic ring(s) containing one or two sulfur atoms. In addition, ligand contains additional sulfur-containing rings that constitute S binding sites. Can include other ring systems bound to the S-containing heterocyclic rings, but they do not coordinate with the stabilized, high valence metal ion. Ring(s) can also contain O, N, P, As, or Se atoms. This 6-membered ring(s) and/or additional S-containing ring(s) and/or attached, uncoordinating rings may or may not have halogen or polarizing or water-insolubilizing/solubilizing groups attached. |
| S Valence Stabilizer #13: Two-, Three-, Four-, Five-, Six-, Seven-, Eight-, Nine-, and Ten-Membered Macrocyclics, Macrobicyclics, and Macropolycyclics (including Catapinands, Cryptands, Cyclidenes, and Sepulchrates) wherein all Binding Sites are composed of Sulfur (usually thiol or thioether groups) and are not contained in Component Heterocyclic Rings (S—S Bidentates, S—S Tridentates, S—S Tetradentates, and S—S Hexadentates) | Macrocyclic ligands containing two to ten sulfur binding sites to valence stabilize the central metal ion. Can include other hydrocarbon or ring systems bound to this macrocyclic ligand, but they do not coordinate with the stabilized, high valence metal ion. This ligand and/or attached, uncoordinating hydrocarbons/rings may or may not have halogen or polarizing or water-insolubilizing/solubilizing groups attached. |
| S Valence Stabilizer #14: Four-, Five-, Six-, Seven-, Eight-, Nine-, or Ten-Membered Macrocyclics, Macrobicyclics, and Macropolycyclics (including Catapinands, Cryptands, Cyclidenes, and Sepulchrates) wherein all Binding Sites are composed of Sulfur and are contained in Component 5-Membered Heterocyclic Rings (S—S Tridentates, S—S Tetradentates or S—S Hexadentates) | Macrocyclic ligands containing a total of four to ten five-membered heterocyclic rings containing sulfur binding sites. Can include other hydrocarbon/ring systems bound to this macrocyclic ligand, but they do not coordinate with the stabilized, high valence metal ion. This ligand and/or attached, uncoordinating hydrocarbon/rings may or may not have halogen or polarizing or water-insolubilizing groups attached. |
| S Valence Stabilizer #15: Four-, Five-, Six-, Seven-, Eight-, Nine-, or | Macrocyclic ligands containing at least one 5-membered heterocyclic ring. These |

TABLE 3-continued

Narrow Band Organic Valence Stabilizers for the $Co^{+3}$ ion

| General Structural Name (Type of Organic) | Structural Representation |
|---|---|
| Ten-Membered Macrocyclics, Macrobicyclics, and Macropolycyclics (including Catapinands, Cryptands, Cyclidenes, and Sepulchrates) wherein all Binding Sites are composed of Sulfur and are contained in a Combination of 5-Membered Heterocyclic Rings and Thiol, Thioether, or Thioketo Groups (S—S Tridentates, S—S Tetradentates, or S—S Hexadentates) | heterocyclic rings provide sulfur binding sites to valence stabilize the central metal ion. Other thiol, thioether, or thioketo binding sites can also be included in the macrocyclic ligand, so long as the total number of binding sites is four to ten. Can include other hydrocarbon/ring systems bound to this macrocyclic ligand, but they do not coordinate with the stabilized, high valence metal ion. This ligand and/or attached, uncoordinating hydrocarbon/rings may or may not have halogen or polarizing or water-insolubilizing groups attached. |
| S Valence Stabilizer #16: Four-, Five-, Six-, Seven-, Eight-, Nine-, or Ten-Membered Macrocyclics, Macrobicyclics, and Macropolycyclics (including Catapinands, Cryptands, Cyclidenes, and Sepulchrates) wherein all Binding Sites are composed of Sulfur and are contained in Component 6-Membered Heterocyclic Rings (S—S Tridentates, S—S Tetradentates, or S—S Hexadentates) | Macrocyclic ligands containing a total of four to ten six-membered heterocyclic rings containing sulfur binding sites. Can include other hydrocarbon/ring systems bound to this macrocyclic ligand, but they do not coordinate with the stabilized, high valence metal ion. This ligand and/or attached, uncoordinating hydrocarbon/rings may or may not have halogen or polarizing or water-insolubilizing groups attached. |
| S Valence Stabilizer #17: Four-, Five-, Six-, Seven-, Eight-, Nine-, or Ten-Membered Macrocyclics, Macrobicyclics, and Macropolycyclics (including Catapinands, Cryptands, Cyclidenes, and Sepulchrates) wherein all Binding Sites are composed of Sulfur and are contained in a Combination of 6-Membered Heterocyclic Rings and Thiol, Thioether, or Thioketo Groups (S—S Tridentates, S—S Tetradentates, or S—S Hexadentates) | Macrocyclic ligands containing at least one 6-membered heterocyclic ring. These heterocyclic rings provide sulfur binding sites to valence stabilize the central metal ion. Other thiol, thioether, or thioketo binding sites can also be included in the macrocyclic ligand, so long as the total number of binding sites is four to ten. Can include other hydrocarbon/ring systems bound to this macrocyclic ligand, but they do not coordinate with the stabilized, high valence metal ion. This ligand and/or attached, uncoordinating hydrocarbon/rings may or may not have halogen or polarizing or water-insolubilizing groups attached. |
| S Valence Stabilizer #18: Dithiobiurets (Dithioimidodicarbonic Diamides), Dithioisobiurets, Dithiobiureas, Trithiotriurets, Trithiotriureas, Bis(dithiobiurets), Bis(dithioisobiurets), Bis(dithiobiureas), Poly(dithiobiurets), Poly(dimioisobiurets), and Poly(dithiobiureas) (S—S Bidentates, S—S Tridentates, S—S Tetradentates) | RR'—N—C(=S)—NR''—C(=S)—NR'''R'''' for dithiobiurets, and RR'—N—C(=S)—NR''—NH—C(=S)—NR'''R'''' for dimiobiureas, where R, R', R'', R''', and R'''' represent H, $NH_2$, or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| S Valence Stabilizer #19: Thioacylthioureas, Thioaroylmioureas, Bis(thioacylthioureas), Bis(thioaroylthioureas), Poly(thioacylthioureas), and Poly(thioaroylthioureas) (S—S Bidentates, S—S Tridentates, S—S Tetradentates) | RR'—N—C(=S)—NR''—C(=S)—R''' where R, R', R'', and R''' represent H, $NH_2$, or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| S Valence Stabilizer #20: Dithioacyl disulfides, Bis(dithioacyl disulfides), and Poly(dithioacyl disulfides) (S—S Bidentates, S—S Tridentates, S—S Tetradentates) | R—C(=S)—S—S—C(=S)—R' where R, and R' represent H or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| S Valence Stabilizer #21: Tetrathioperoxydicarbonic Diamides, Bis(tetrathioperoxydicarbonic diamides), and poly(tetrathioperoxydicarbonic diamides) (S—S Bidentates, S—S Tridentates, S—S Tetradentates) | RR'—N—C(=S)—S—S—C(=S)—N—R''R''' where R, R', R'', R''' represent H or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| S Valence Stabilizer #22: Hexathio, Pentathio-, and Tetrathioperoxydicarbonic Acids, Bis(hexathio-, pentathio-, and tetrathioperoxydicarbonic acids), | R—S—C(=S)—S—S—C(=S)—S—R' for hexathioperoxydicarbonic acids, R—O—C(=S)—S—S—C(=S)—S—R' for pentathioperoxydicarbonic acids, and R—O—C(=S)—S—S—C(=S)—O—R' for tetrathioperoxydicarbonic acids, where R and R' |

TABLE 3-continued

Narrow Band Organic Valence Stabilizers for the $Co^{+3}$ ion

| General Structural Name (Type of Organic) | Structural Representation |
|---|---|
| poly(hexathio-, pentathio-, and tetrathioperoxydicarbonic acids), and derivatives thereof (S—S Bidentates, S—S Tridentates, S—S Tetradentates) | represent H, $NH_2$ or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| S Valence Stabilizer #23: Dithioperoxydiphosphoramide, Bis(dithioperoxyphosphoramide), and Poly(dithioperoxydiphosphoramide) (S—S Bidentates, S—S Tridentates, S—S Tetradentates) | (RR'—N—)(R"R'"—N—)P(═S)—S—S—P(═S)(—N—R""R""")(—N—R"""R""""), where R, R', R", R'", R"", R""", R""", and R""""" represent H, $NH_2$ or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| S Valence Stabilizer #24: Dithioperoxydiphosphoric Acids, Bis(dithioperoxyphosphoric Acids), Poly(dithioperoxydiphosphoric Acids), and derivatives thereof (S—S Bidentates, S—S Tridentates, S—S Tetradentates) | (R—O—)(R'—O—)P(═S)—S—S—P(═S)(—0—R")(—O—R'"); (R—O—)(R'—S—)P(═S)—S—S—P(═S)(—S—R")(—O—R'"); or (R—S—)(R'—S—)P(═S)—S—S—P(═S)(—S—R")(—S—R'"), where R, R', R", R'", R'", R""", R""", and R""""" represent H, $NH_2$ or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| S Valence Stabilizer #25: Dithioimidodiphosphonic Acids, Dithiohydrazidodiphosphonic Acids, Bis(dithioimidodiphosphonic acids), Bis(dithiohydrazidodiphosphonic acids), Poly(dithioimidodiphosphonic acids), Poly(dithiohydrazidodiphosphonic acids), and derivatives thereof (S—S Bidentates, S—S Tridentates, and S—S Tetradentates) | (R—O—)(R'—)P(═S)—NH—P(═S)(—R")(—O—R'"); (R—S—)(R'—)P(═S)—NH—P(═S)(—R")(—O—R'"); or (R—S—)(R'—)P(═S)—NH—P(═S)(—R")(—S—R'") for dithioimidodiphosphonic acids, and —NH—NH— derivatives for dithiohydrazidodiphosphonic acids, where R, R', R", and R'" represent H, $NH_2$ or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| S Valence Stabilizer #26: Dithioimidodiphosphonamides, Dithiohydrazidodiphosphonamides, Bis(dithioimidodiphosphonamides), Bis(dithiohydrazidodiphosphonamides), Poly(dithioimidodiphosphonamides), and Poly(dithiohydrazidodiphosphonamides) (S—S Bidentates, S—S Tridentates, S—S Tetradentates) | (RR'—N—)(R"—)P(═S)—NH—P(═S)(—R'")(—N—R""R""") for dithioimidophosphonamides, and (RR'—N—)(R"—)P(═S)—NH—NH—P(═S)(—R'")(—N—R""R""") for dithiohydrazidodiphosphonamides, where R, R', R", R'", R"", and R""" represent H, $NH_2$ or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| S Valence Stabilizer #27: Dithiodiphosphonamides, Bis(dithiophosphonamides), and Poly(dithiodiphosphonamides) (S—S Bidentates, S—S Tridentates, S—S Tetradentates) | (RR'—N—)(R"—)P(═S)—S—P(═S)(—R'")(—N—R""R""), or (RR'—N—)(R"—)P(═S)—O—P(═S)(—R'")(—N—R""R""), where R, R', R", R'", R"", and R""" represent H, $NH_2$ or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| S Valence Stabilizer #28: Dithiodiphosphonic Acids, Bis(dithioiphosphonic Acids), Poly(dithiodiphosphonic Acids), and derivatives thereof (S—S Bidentates, S—S Tridentates, S—S Tetradentates) | (R—O—)(R'—)P(═S)—O—P(═S)(—R")(—O—R'"); (R—O—)(R'—)P(═S)—S—P(═S)(—R")(—O—R'"); (R—S—)(R'—)P(═S)—O—P(═S)(—R")(—S—R'"); or (R—S—)(R'—)P(═S)—S—P(═S)(—R")(—S—R'"); where R, R', R", and R'" represent H, $NH_2$ or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| S Valence Stabilizer #29: Dithioperoxydiphosphonamide, | (RR'—N—)(R"—)P(═S)—S—S—P(═S)(—R'")(—N—R""R""), where R, R', R", R'", R"", and R""" |

TABLE 3-continued

Narrow Band Organic Valence Stabilizers for the $Co^{+3}$ ion

| General Structural Name (Type of Organic) | Structural Representation |
|---|---|
| Bis(dithioperoxyphosphonamide), and Poly(dithioperoxydiphosphonamide) (S—S Bidentates, S—S Tridentates, S—S Tetradentates) | represent H, $NH_2$ or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| S Valence Stabilizer #30: Dithioperoxydiphosphonic Acids, Bis(dithioperoxyphosphonic Acids), Poly(dithioperoxydiphosphonic Acids), and derivatives thereof (S—S Bidentates, S—S Tridentates, S—S Tetradentates) | (R—O—)(R'—)P(=S)—S—S—P(=S)(—R'')(—O—R'''); or (R—S—)(R'—)P(=S)—S—S—P(=S)(—R'')(—S—R'''), where R, R', R'', and R''' represent H, $NH_2$ or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| S Valence Stabilizer #31: Dithiophosphonic Acids (Phosphonodithioic Acids), Bis(dithiophosphonic Acids), Poly(dithiophosphonic Acids), and derivatives thereof (S—S Bidentates, S—S Tridentates, S—S Tetradentates) | (O=)PR(—S—R')(—S—R'') or (S=)PR(—S—R')(—O—R''), where R, R', and R'' represent H, $NH_2$ or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| S Valence Stabilizer #32: Trithiophosphonic Acids (Phosphonotrithioic Acids), Bis(trithiophosphonic Acids), Poly(trithiophosphonic Acids), and derivatives thereof (S—S Bidentates, S—S Tridentates, S—S Tetradentates) | (S=)PR(—S—R')(—S—R''), where R, R', and R'' represent H, $NH_2$ or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| S Valence Stabilizer #33: Phosphono(dithioperoxo)thioic Acids), Bis[phosphono(dithioperoxo)thioic Acids], Poly[phosphono(dithioperoxo)thioic Acids], and derivatives thereof (S—S Bidentates, S—S Tridentates, S—S Tetradentates) | (O=)PR(—S—S—R')(—S—R'') or (S=)PR(—S—S—R')(—O—R''), where R, R', and R'' represent H, $NH_2$ or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| S Valence Stabilizer #34: Phosphono(dithioperoxo)dithioic Acids), Bis[phosphono(dithioperoxo)dithioic Acids], Poly[phosphono(dithioperoxo)dithioic Acids], and derivatives thereof (S—S Bidentates, S—S Tridentates, S—S Tetradentates) | (S=)PR(—S—S—R')(—S—R''), where R, R', and R'' represent H, $NH_2$ or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| S Valence Stabilizer #35: S-(Alkylthio)thiocarboxylic Acids, S-(Arylthio)thiocarboxylic Acids, and S,S-thiobisthiocarboxylic Acids (S—S Bidentates and S—S Tridentates) | R—S—R'CSOH or R—S—R'CSSH for S-(alkylthio)thiocarboxylic and S (arylthio)thiocarboxylic acids, and HSOCR—S—R'COSH or HSSCR—S—R'CSSH for S,S-thiobisthiocarboxylic acids, where R and R' represent H or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| S Valence Stabilizer #36: S-(Alkyldisulfido)thiocarboxylic Acids, S-(Aryldisulfido)thiocarboxylic Acids, and S,S'-Disulfidobisthiocarboxylic Acids (S—S Bidentates and S—S Tridentates) | R—S—S—R'CSOH or R—S—S—R'CSSH for S-(alkyldisulfido)thiocarboxylic and S-(aryldisulfido)thiocarboxylic acids, and HSOCR—S—S—R'COSH or HSSCR—S—S—R'CSSH for S,S'-disulfidobisthiocarboxylic acids, where R and R' represent H or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| S Valence Stabilizer #37: 1,2-Dithiolates, Bis(1,2-dithiolates), and Poly(1,2-dithiolates) (S—S Bidentates, S—S | R—CH(—SR'')—CH(—SR''')—R', and R—C(—SR'')=C(—SR''')—R', where R, R', R'', and R''' represent H, $NH_2$ or any organic functional |

TABLE 3-continued

Narrow Band Organic Valence Stabilizers for the $Co^{+3}$ ion

| General Structural Name (Type of Organic) | Structural Representation |
|---|---|
| Tridentates, S—S Tetradentates) | group wherein the number of carbon atoms ranges from 0 to 40, optionally having halogen or polarizing or water-insolubilizing/solubilizing groups attached. Ligand can also contain nonbinding N, O, S, or P atoms. |
| S Valence Stabilizer #38: Rhodanines and Bis(rhodanines) (S—S Bidentates and S—S Tetradentates) | RN—C(═O)—CHR'—S—C(═S) for rhodanines, and R—[N—C(═O)—CHR'—S—C═S)]$_2$ for bis(rhodanines), where R and R' represent H, $NH_2$ or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| S Valence Stabilizer #39: Dithiocarbimates, Bis(dithiocarbimates), and Poly(dithiocarbimates) (S—S Bidentates, S—S Tridentates, and S—S Tetradentates) | RN═C(SH)(SH), where R represents H, $NH_2$ or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| S Valence Stabilizer #40: Thioxanthates, Bis(thioxanthates), and Poly(thioxanthates) (S—S Bidentates and S—S Tetradentates) | $RS^+$═C(SH)(SH) or RS—C(═S)(SH), where R represents H, $NH_2$ or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| S Valence Stabilizer #41: Xanthates, Bis(xanthates), and Poly(xanthates) (S—S Bidentates and S—S Tetradentates) | $RO^+$═C(SH)(SH) or RO—C(═S)(SH), where R represents H, $NH_2$ or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| S Valence Stabilizer #42: Phosphinodithioformates (S—S Bidentates) | Typically RR'R"P═C(SH)(SH) [pentavalent P], although RR'P—C(═S)(SH) [trivalent P] may be acceptable in some situations, where R, R', and R" represent H, $NH_2$ or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| S Valence Stabilizer #43: Alky]- and Aryl-Dithioborates, Trithioborates, Perthioborates, Bis(dithioborates), Bis(trithioborates), and Bis(perthioborates) (S—S Bidentates and S—S Tetradentates) | R—S—C(—S—R")—O—R' for dithioborates, R—S—C(—S—R")—S—R' for trithioborates, and R—S—S—C(—S—R")—S—R' for perthioborates, where R, R', and R" represent H, $NH_2$ or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| S Valence Stabilizer #44: Alkyl- and Aryl-Dithioboronates, and Bis(dithioboronates) (S—S Bidentates and S—S Tetradentates) | R—C(—S—R")—S—R', where R, R', and R" represent H, $NH_2$ or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| S Valence Stabilizer #45: Trithioarsonic Acids (Arsonotrithioic Acids), Dithioarsonic Acids (Arsonodithioic Acids), Tetrathioarsonic Acids (Arsonotetrathioic Acids), and derivatives thereof (S—S Bidentates, S—S Tridentates, S—S Tetradentates) | (O═)As(—S—R)(—S—R')(—S—R") or (S═)As(—S—R)(—S—R')(—O—R") for trithioarsonic acid; (O═)As(—O—R)(—S—R')(—S—R") or (S═)As(—S—R)(—O—R')(—O—R") for dithioarsonic acid, or (S═)As(—S—R)(—S—R')(—S—R") for tetrathioarsonic acid, where R, R', and R" represent H, $NH_2$ or any organic functional group wherein the number of carbon atoms ranges from 0 to 40, optionally having |

TABLE 3-continued

Narrow Band Organic Valence Stabilizers for the $Co^{+3}$ ion

| General Structural Name (Type of Organic) | Structural Representation |
|---|---|
| | halogen or polarizing or water-insolubilizing/solubilizing groups attached. Ligand can also contain nonbinding N, O, S, or P atoms. |
| S Valence Stabilizer #46: Trithioantimonic Acids (Stibonotrithioic Acids), Dithioantimonic Acids (Stibonodithioic Acids), Tetrathioantimonic Acids (Stibonotetrathioic Acids), and derivatives thereof (S—S Bidentates, S—S Tridentates, S—S Tetradentates) | (O═)Sb(—S—R)(—S—R')(—S—R") or (S═)Sb(—S—R)(—S—R')(—O—R") for trithioantimonic acid; (O═)Sb(—O—R)(—S—R')(—S—R") or (S═)Sb(—S—R)(—O—R')(—O—R") for dithioantimonic acid, or (S═)Sb(—S—R)(—S—R')(—S—R") for tetrathioantimonic acid, where R, R', and R" represent H, $NH_2$ or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| S Valence Stabilizer #47: Phosphine P-Sulfides and Amino-substituted Phosphine sulfides (S Monodentates) | RR'R"P═S for phosphine P-Sulfides, and (RR'N)(R"R'"N)(R""R"""N)P═S for amino-substituted phosphine sulfides, where R, R', R", R'", R"", and R""" represent H, Cl, Br, $NH_2$ or any organic functional group wherein the number of carbon atoms ranges from 0 to 40, optionally having halogen or polarizing or water-insolubilizing/solubilizing groups attached. (Rs are typically aromatic or heterocyclic for phosphine P-Sulfides.) Ligand can also contain nonbinding N, O, S, or P atoms. |
| S Valence Stabilizer #48: Arsine As-Sulfides and Amino-Substituted Arsine sulfides (S Monodentates) | RR'R"As═S for arsine As-Sulfides, and (RR'N)(R"R'"N)(R""R"""N)As═S for amino-substituted arsine sulfides, where R, R', R", R'", R"", and R""" represent H, Cl, Br, $NH_2$ or any organic functional group wherein the number of carbon atoms ranges from 0 to 40, optionally having halogen or polarizing or water-insolubilizing/solubilizing groups attached. (Rs are typically aromatic or heterocyclic for arsine As-Sulfides.) Ligand can also contain nonbinding N, O, S, or P atoms. |
| S Valence Stabilizer #49: Thiocyanate ligands (S Monodentates) | Thiocyanates bound directly to the high valence metal ion. |
| S Valence Stabilizer #50: Thiolates (S Monodentates) | Thiols (HS—R, HS—R—SH, etc.), where R and R' represent H or any organic functional group wherein the number of carbon atoms ranges from 0 to 35, optionally having halogen or polarizing or water-insolubilizing/solubilizing groups attached. |
| S Valence Stabilizer #51: Sulfide ligands (S Monodentates) | Sulfide ($—S^{2—}$) ligands bound directly to the high valence metal ion. |
| P Valence Stabilizer #1: Monophosphines (P Monodentates) wherein at least one Phosphorus Atom is a Binding Site | $PH_3$, $PH_2R$, $PHR_2$, and $PR_3$ where R represents H or any organic functional group wherein the number of carbon atoms ranges from 0 to 35, optionally having halogen or polarizing or water-insolubilizing/solubilizing groups attached. Ligand can also contain nonbinding N, P, As, O, S, or Se atoms. |
| P Valence Stabilizer #2: Diphosphines (a P—P Bidentate) wherein at least one Phosphorus Atom is a Binding Site | R'—P—R—P—R", where R, R', and R" represent H or any organic functional group wherein the number of carbon atoms ranges from 0 to 35, optionally having halogen or polarizing or water-insolubilizing/solubilizing groups attached. Ligand can also contain nonbinding N, P, As, O, S, or Se atoms. |
| P Valence Stabilizer #3: Triphosphines (either P—P Bidentates or P—P—P Tridentates) wherein at least one Phosphorus Atom is a Binding Site | R—P—R'—P—R"—P—R'", where R, R', R", and R'" represent H or any organic functional group wherein the number of carbon atoms ranges from 0 to 35, optionally having halogen or polarizing or water-insolubilizing/solubilizing groups attached. Ligand can also contain nonbinding N, P, As, O, S, or Se atoms. |
| P Valence Stabilizer #4: Tetraphosphines (P—P Bidentates, P—P Tridentates, or P—P Tetradentates) wherein | R—P—R'—P—R"—P—R'"—P—R"",where R, R', R", R'", and R"" represent H or any organic functional group wherein the number of carbon |

TABLE 3-continued

Narrow Band Organic Valence Stabilizers for the $Co^{+3}$ ion

| General Structural Name (Type of Organic) | Structural Representation |
|---|---|
| at least one Phosphorus Atom is a Binding Site | atoms ranges from 0 to 35, optionally having halogen or polarizing or water-insolubilizing/solubilizing groups attached. Ligand can also contain nonbinding N, P, As, O, S, or Se atoms. |
| P Valence Stabilizer #5: Pentaphosphines (P—P Bidentates, P—P Tridentates, or P—P Tetradentates) wherein at least one Phosphorus Atom is a Binding Site | R—P—R'—P—R''—P—R'''—P—R''''—P—R''''', where R, R', R'', R''', R'''', and R''''' represent H or any organic functional group wherein the number of carbon atoms ranges from 0 to 35, optionally having halogen or polarizing or water-insolubilizing/solubilizing groups attached. Ligand can also contain nonbinding N, P, As, O, S, or Se atoms. |
| P Valence Stabilizer #6: Hexaphosphines (P—P Bidentates, P—P Tridentates, P—P Tetradentates, or P—P Hexadentates) wherein at least one Phosphorus Atom is a Binding Site | R—P—R'—P—R''—P—R'''—P—R''''—P—R'''''—P—R''''''', where R, R', R'', R''', R'''', R''''', and R''''''' represent H or any organic functional group wherein the number of carbon atoms ranges from 0 to 35, optionally having halogen or polarizing or water-insolubilizing/solubilizing groups attached. Ligand can also contain nonbinding N, P, As, O, S, or Se atoms. |
| P Valence Stabilizer #7: Five-Membered Heterocyclic Rings containing One, Two, or Three Phosphorus Atoms wherein at least one Phosphorus Atom is a Binding Site (P Monodentates or P—P Bidentates) | Five membered heterocyclic ring containing one, two, or three phosphorus atoms, all of which may or may not function as binding sites. Can include other ring systems bound to this heterocyclic ring, but they do not coordinate with the stabilized, high valence metal ion. Ring can also contain O, S, N, As, or Se atoms. This 5-membered ring and/or attached, uncoordinating rings may or may not have halogen or polarizing or water-insolubilizing/solubilizing groups attached. |
| P Valence Stabilizer #8: Six-Membered Heterocyclic Rings containing One, Two, or Three Phosphorus Atoms wherein at least one Phosphorus Atom is a Binding Site (P Monodentates or P—P Bidentates) | Six membered heterocyclic ring containing one, two, or three phosphorus atoms, all of which may or may not function as binding sites. Can include other ring systems bound to this heterocyclic ring, but they do not coordinate with the stabilized, high valence metal ion. Ring can also contain O, S, N, As, or Se atoms. This 6-membered ring and/or attached, uncoordinating rings may or may not have halogen or polarizing or water-insolubilizing/solubilizing groups attached. |
| P Valence Stabilizer #9: Five-Membered Heterocyclic Rings containing One, Two, or Three Phosphorus Atoms at least one additional Phosphorus Atom Binding Site not in a Ring (P Monodentates, P—P Bidentates, P—P Tridentates, P—P Tetradentates, or P—P Hexadentates) | Five membered heterocyclic ring(s) containing one, two, or three phosphorus atoms. In addition, ligand contains additional phosphorus-containing substituents (usually phosphines) that constitute P binding sites. Can include other ring systems bound to the heterocyclic ring or to the P-containing substituent, but they do not coordinate with the stabilized, high valence metal ion. Ring(s) can also contain O, N, S, As or Se atoms. This 5-membered ring(s) and/or attached, uncoordinating rings and/or P-containing substituent(s) may or may not have halogen or polarizing or water-insolubilizing/solubilizing groups attached. |
| P Valence Stabilizer #10: Six-Membered Heterocyclic Rings containing One, Two, or Three Phosphorus Atoms at least one additional Phosphorus Atom Binding Site not in a Ring (P Monodentates, P—P Bidentates, P—P Tridentates, P—P Tetradentates, or P—P Hexadentates) | Six membered heterocyclic ring(s) containing one, two, or three phosphorus atoms. In addition, ligand contains additional phosphorus-containing substituents (usually phosphines) that constitute P binding sites. Can include other ring systems bound to the heterocyclic ring or to the P-containing substituent, but they do not coordinate with the stabilized, high valence metal ion. Ring(s) can also contain O, N, S, As or Se atoms. This 6-membered ring(s) and/or attached, uncoordinating rings and/or P-containing substituent(s) may or may not have halogen or polarizing or water-insolubilizing/solubilizing groups attached. |
| P Valence Stabilizer #11: Five-Membered Heterocyclic Rings containing One, Two, or Three Phosphorus | Five membered heterocyclic ring(s) containing one, two, or three phosphorus atoms. In addition, ligand contains additional phosphorus- |

TABLE 3-continued

Narrow Band Organic Valence Stabilizers for the $Co^{+3}$ ion

| General Structural Name (Type of Organic) | Structural Representation |
|---|---|
| Atoms at least one additional Phosphorus Atom Binding Site in a separate Ring (P Monodentates, P—P Bidentates, P—P Tridentates, P—P Tetradentates, or P—P Hexadentates) | containing rings that constitute P binding sites. Can include other ring systems bound to the P-containing heterocyclic rings, but they do not coordinate with the stabilized, high valence metal ion. Ring(s) can also contain O, N, S, As, or Se atoms. This 5-membered ring(s) and/or additional P-containing ring(s) and/or attached, uncoordinating rings may or may not have halogen or polarizing or water-insolubilizing/solubilizing groups attached. |
| P Valence Stabilizer #12: Six-Membered Heterocyclic Rings containing One, Two, or Three Phosphorus Atoms at least one additional Phosphorus Atom Binding Site in a separate Ring (P Monodentates, P—P Bidentates, P—P Tridentates, P—P Tetradentates, or P—P Hexadentates) | Six membered heterocyclic ring(s) containing one, two, or three phosphorus atoms. In addition, ligand contains additional phosphorus-containing rings that constitute P binding sites. Can include other ring systems bound to the P-containing heterocyclic rings, but they do not coordinate with the stabilized, high valence metal ion. Ring(s) can also contain O, N, S, As, or Se atoms. This 6-membered ring(s) and/or additional P-containing ring(s) and/or attached, uncoordinating rings may or may not have halogen or polarizing or water-insolubilizing/solubilizing groups attached. |
| P Valence Stabilizer #13: Two-, Three-, Four-, Five-, Six-, and Eight-Membered Macrocyclics, Macrobicyclics, and Macropolycyclics (including Catapinands, Cryptands, Cyclidenes, and Sepulchrates) wherein all Binding Sites are composed of Phosphorus and are not contained in Component Heterocyclic Rings (P—P Bidentates, P—P Tridentates, P—P Tetradentates, and P—P Hexadentates) | Macrocyclic ligands containing two, three, four, five, six, or eight phosphorus binding sites to valence stabilize the central metal ion. Can include other hydrocarbon or ring systems bound to this macrocyclic ligand, but they do not coordinate with the stabilized, high valence metal ion. This ligand and/or attached, uncoordinating hydrocarbons/rings may or may not have halogen or polarizing or water-insolubilizing/solubilizing groups attached. |
| P Valence Stabilizer #14: Four-, Six-, or Eight-Membered Macrocyclics, Macrobicyclics, and Macropolycyclics (including Catapinands, Cryptands, Cyclidenes, and Sepulchrates) wherein all Binding Sites are composed of Phosphorus and are contained in Component 5-Membered Heterocyclic Rings (P—P Tridentates, P—P Tetradentates, or P—P Hexadentates) | Macrocyclic ligands containing a total of four, six, or eight five-membered heterocyclic rings containing phosphorus binding sites. Can include other hydrocarbon/ring systems bound to this macrocyclic ligand, but they do not coordinate with the stabilized, high valence metal ion. This ligand and/or attached, uncoordinating hydrocarbon/rings may or may not have halogen or polarizing or water-insolubilizing groups attached. |
| P Valence Stabilizer #15: Four-, Six-, or Eight-Membered Macrocyclics, Macrobicyclics, and Macropolycyclics (including Catapinands, Cryptands, Cyclidenes, and Sepulchrates) wherein all Binding Sites are composed of Phosphorus and are contained in a Combination of 5-Membered Heterocyclic Rings and Phosphine Groups (P—P Tridentates, P—P Tetradentates, or P—P Hexadentates) | Macrocyclic ligands containing at least one 5-membered heterocyclic ring. These heterocyclic rings provide phosphorus binding sites to valence stabilize the central metal ion. Other phosphine binding sites can also be included in the macrocyclic ligand, so long as the total number of binding sites is four, six, or eight. Can include other hydrocarbon/ring systems bound to this macrocyclic ligand, but they do not coordinate with the stabilized, high valence metal ion. This ligand and/or attached, uncoordinating hydrocarbon/rings may or may not have halogen or polarizing or water-insolubilizing groups attached. |
| P Valence Stabilizer #16: Four-, Six-, or Eight-Membered Macrocyclics, Macrobicyclics, and Macropolycyclics (including Catapinands, Cryptands, Cyclidenes, and Sepulchrates) wherein all Binding Sites are composed of Phosphorus and are contained in Component 6-Membered Heterocyclic Rings (P—P Tridentates, P—P Tetradentates, or P—P Hexadentates) | Macrocyclic ligands containing a total of four, six, or eight six-membered heterocyclic rings containing phosphorus binding sites. Can include other hydrocarbon/ring systems bound to this macrocyclic ligand, but they do not coordinate with the stabilized, high valence metal ion. This ligand and/or attached, uncoordinating hydrocarbon/rings may or may not have halogen or polarizing or water-insolubilizing groups attached. |
| P Valence Stabilizer #17: Four-, Six-, or Eight-Membered Macrocyclics, Macrobicyclics, and Macropolycyclics (including Catapinands, Cryptands, Cyclidenes, and Sepulchrates) wherein all Binding Sites are composed of Phosphorus and are contained in a | Macrocyclic ligands containing at least one 6-membered heterocyclic ring. These heterocyclic rings provide phosphorus binding sites to valence stabilize the central metal ion. Other phosphine binding sites can also be included in the macrocyclic ligand, so long as the total number of binding sites is four, six, or |

TABLE 3-continued

Narrow Band Organic Valence Stabilizers for the $Co^{+3}$ ion

| General Structural Name (Type of Organic) | Structural Representation |
|---|---|
| Combination of 6-Membered Heterocyclic Rings and Phosphine Groups (P—P Tridentates, P—P Tetradentates, or P—P Hexadentates) | eight. Can include other hydrocarbon/ring systems bound to this macrocyclic ligand, but they do not coordinate with the stabilized, high valence metal ion. This ligand and/or attached, uncoordinating hydrocarbon/rings may or may not have halogen or polarizing or water-insolubilizing groups attached. |
| O Valence Stabilizer #1: Biurets (Imidodicarbonic Diamides), Isobiurets, Biureas, Triurets, Triureas, Bis(biurets), Bis(isobiurets), Bis(biureas), Poly(biurets), Poly(isobiurets), and Poly(biureas) (O—O Bidentates, O—O Tridentates, O—O Tetradentates) | RR'—N—C(═O)—NR"—C(═O)—NR'"R"" for biurets, and RR'—N—C(═O)—NR"—NH—C(═O)-NR'"R"" for biureas, where R, R', R", R'", and R"" represent H, $NH_2$, or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| O Valence Stabilizer #2: Acylureas, Aroylureas, Bis(acylureas), Bis(aroylureas), Poly(acylureas), and Poly(aroylureas) (O—O Bidentates, O—O Tridentates, O—O Tetradentates) | RR'—N—C(═O)—NR"—C(═O)—R'" where R, R', R", and R'" represent H, $NH_2$, or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| O Valence Stabilizer #3: Imidodialdehydes, Hydrazidodialdehydes (Acyl hydrazides), Bis(imidodialdehydes), Bis(hydrazidodialdehydes), Poly(imidodialdehydes), and Poly(hydrazidodialdehydes) (O—O Bidentates, O—O Tridentates, O—O Tetradentates) | RC(═O)—NR'—C(═O)—R" for imidodialdehydes, and RC(═O)—NR'—NH—C(═O)—R" for hydrazidodialdehydes (acyl hydrazides), where R, R', and R" represent H, $NH_2$, or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| O Valence Stabilizer #4: Imidodicarbonic acids, Hydrazidodicarbonic acids, Bis(imidodicarbonic acids), Bis(hydrazidodicarbonic acids), Poly(imidodicarbonic acids), Poly(hydrazidodicarbonic acids) and derivatives thereof (O—O Bidentates, O—O Tridentates, O—O Tetradentates) | R—O—C(═O)—NR'—C(═O)—O—R" for imidodicarbonic acids, and R—O—C(═O)—NR'—NH—C(—O)—O—R" for hydrazidodicarbonic acids, where R, R', and R" represent H, $NH_2$, or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| O Valence Stabilizer #5: Imidodisulfamic Acid, Imidodisulfuric Acid, Bis(Imidodisulfamic Acid), Bis(Imidodisulfuric Acid), Poly(Imidodisulfamic Acid), and Poly(Imidodisulfuric Acid) and derivatives thereof (O—O Bidentates, O—O Tridentates, O—O Tetradentates) | RR'—N—S(═O)(═O)—NR"—S(═O)(═O)—NR'"R"" for imidodisulfamic acid, and R—O—S(═O)(═O)—NR'—S(═O)(═O)—OR" for imidosulfuric acid, where R, R', and R" represent H, $NHNH_2$, or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| O Valence Stabilizer #6: 1,3-Diketones (Beta-Diketonates), 1,3,5-Triketones, Bis(1,3-Diketones), and Poly(1,3-Diketones), all with a Molecular Weight Greater than 125 (O—O Bidentates, O—O Tridentates, O—O Tetradentates) | R—C(═O)—CR'R"—C(═O)—R'" where R, R', R", and R'" represent H, $NH_2$, or any organic functional group wherein the number of carbon atoms ranges from 0 to 40, optionally having halogen or polarizing or water-insolubilizing/solubilizing groups attached. Ligand can also contain nonbinding N, O, S, or P atoms. If these ligands exhibit a molecular weight less than or equal to 125, the solubility of the resultant $Co^{+3}$-diketonate complex will be too high. |
| O Valence Stabilizer #7: 1,2-Diketones (Alpha-Diketonates), 1,2,3-Triketones, Tropolonates, ortho-Quinones, Bis(1,2-Diketones), and Poly(1,2-Diketones), all with a Molecular Weight Greater than 100 (O—O Bidentates, O—O Tridentates, O—O Tetradentates) | R—C(═O)—C(═O)—R' where R and R' represent H, $NH_2$, or any organic functional group wherein the number of carbon atoms ranges from 0 to 40, optionally having halogen or polarizing or water-insolubilizing/solubilizing groups attached. Ligand can also contain nonbinding N, O, S, or P atoms. If these ligands exhibit a molecular weight less than or equal to |

TABLE 3-continued

Narrow Band Organic Valence Stabilizers for the $Co^{+3}$ ion

| General Structural Name (Type of Organic) | Structural Representation |
|---|---|
| | 100, the solubility of the resultant $Co^{+3}$-diketonate complex will be too high. |
| O Valence Stabilizer #8: Malonamides (Malonodiamides), Bis(malonamides), and Polymalonamides (O—O Bidentates, O—O Tridentates, O—O Tetradentates) | RR'—N—C(═O)—CR"R'"—C(═O)—N—R""R"" where R, R', R", R'",R"", and R"" represent H, $NH_2$, or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| O Valence Stabilizer #9: 2-Acylacetamides, Bis(2-acylacetamides), and Poly(2-acylacetamides) (O—O Bidentates, O—O Tridentates, O—O Tetradentates) | RR'—N—C(═O)—CR"R'"—C(═O)—R"" where R, R', R", R'", and R"" represent H, $NH_2$, or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| O Valence Stabilizer #10: Monothiodicarbonic Diamides, Bis(monothiodicarbonic diamides), and Poly(monothiodicarbonic diamides) (O—O Bidentates, O—O Tridentates, O—O Tetradentates) | RR'—N—C(═O)—S—C(—O)—N—R"R'" where R, R', R", and R'" represent H, $NH_2$ or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| O Valence Stabilizer #11: Monothiodicarbonic Acids, Bis(monothiodicarbonic acids), Poly(monothiodicarbonic acids), and derivatives thereof (O—O Bidentates, O—O Tridentates, O—O Tetradentates) | R—O—C(═O)—S—C(═O)—O—R', where R and R' represent H, $NH_2$ or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| O Valence Stabilizer #12: Dithioperoxydicarbonic Acids, Bis(dithioperoxydicarbonic acids), poly(dithioperoxydicarbonic acids), and derivatives thereof (O—O Bidentates, O—O Tridentates, O—O Tetradentates) | R—O—C(═O)—S—S—C(═O)—O—R', where R and R' represent H, $NH_2$ or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| O Valence Stabilizer #13: Trithionic acid, Bis(trithionic acid), Poly(trithionic acid), and derivatives thereof (O—O Bidentates, O—O Tridentates, O—O Tetradentates) | R—O—S(═O)(═O)—S—S(═O)(═O)—O—R', where R and R' represent H, $NH_2$ or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| O Valence Stabilizer #14: Hypophosphoric Acids, Bis(hypophosphoric acids), and Poly(hypophosphoric acids), and derivatives thereof (O—O Bidentates, O—O Tridentates, O—O Tetradentates) | (R—O—)(R'—O—)P(═O)—P(═O)(—O—R")(—O—R'"), where R, R', R", and R'" represent H, $NH_2$ or any organic functional group wherein the number of carbon atoms ranges from 0 to 40, optionally having halogen or polarizing or water-insolubilizing/solubilizing groups attached. Ligand can also contain nonbinding N, O, S, or P atoms. Note: these ligands are not to be confused with hypophosphorous acid derivatives (hypophosphites) (R—O—) R"R'"P(═O) which are very reducing and therefore unacceptable for stabilization of high valence states in metal ions. |
| O Valence Stabilizer #15: Hypophosphoramides, Bis(hypophosphoramides), and Poly(hypophosphoramides) (O—O Bidentates, O—O Tridentates, O—O Tetradentates) | (RR'—N—)(R"R'"—N—)P(═O)—P(═O)(—N—R""R"")(—N—R""R""), where R, R', R", R'", R"", R'"", R"", and R"" represent H, $NH_2$ or any organic functional group wherein the number of carbon atoms ranges from 0 to 40, optionally having halogen or polarizing or water-insolubilizing/solubilizing groups attached. Ligand can also contain nonbinding N, O, S, or P atoms. Note: these ligands are not to be confused with hypophosphorous acid derivatives (hypophosphites) (R—O—) |

TABLE 3-continued

Narrow Band Organic Valence Stabilizers for the $Co^{+3}$ ion

| General Structural Name (Type of Organic) | Structural Representation |
|---|---|
| | R"R'"P(═O) which are very reducing and therefore unacceptable for stabilization of high valence states in metal ions. |
| O Valence Stabilizer #16: Imidodiphosphoric Acids, Hydrazidodiphosphoric Acids, Bis(imidodiphosphoric Acids), Bis(hydrazidodiphosphoric Acids), Poly(imidodiphosphoric Acids), Poly(hydrazidodiphosphoric Acids), and derivatives thereof (O—O Bidentates, O—O Tridentates, O—O Tetradentates) | (R—O—)(R'—O—)P(═O)—NH—P(═O)(—O—R")(—O—R'") for imidodiphosphoric acids, and (R—O—)(R'—O—)P(═O)—NH—NH—P(═O)(—O—R")(—O—R'") for hydrazidodiphosphoric acids; where R, R', R", and R'" represent H, $NH_2$ or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| O Valence Stabilizer #17: Imidodiphosphoramides, Hydrazidodiphosphoramides, Bis(imidodiphosphoramides), Bis(hydrazidodiphosphoramides), Poly(imidodiphosphoramides), and Poly(hydrazidodiphosphoramides) (O—O Bidentates, O—O Tridentates, O—O Tetradentates) | (RR'—N—)(R"R'"—N—)P(═O)—NH—P(═O)(—N—R""R""")(—N—R"""R""") for imidodiphosphoramides, and —NH—NH— derivatives for hydrazidodiphosphoramides, where R, R', R", R'", R"", R""", R""", and R""" represent H, $NH_2$ or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| O Valence Stabilizer #18: Diphosphoramides, Bis(diphosphoramides), and Poly(diphosphoramides) (O—O Bidentates, O—O Tridentates, O—O Tetradentates) | (RR'—N—)(R"R'"—N—)P(═O)—O—P(═O)(—N—R""R""")(—N—R"""R""""), where R, R', R", R'", R"", R""", R""", and R""" represent H, $NH_2$ or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| O Valence Stabilizer #19: Imidodiphosphonic Acids, Hydrazidodiphosphonic Acids, Bis(imidodiphosphonic Acids), Bis(hydrazidodiphosphonic Acids), Poly(imidodiphosphonic Acids), Poly(hydrazidodiphosphonic Acids), and derivatives thereof (O—O Bidentates, O—O Tridentates, O—O Tetradentates) | (R—O—)(R'—)P(═O)—NH—P(═O)(—R")(—O—R'")for imidodiphosphonic acids, and (R—O—)(R'—)P(═O)—NH—NH—P(═O)(—R")(—O—R'")for hydrazidodiphosphonic acids; where R, R', R", and R'" represent H, $NH_2$ or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| O Valence Stabilizer #20: Imidodiphosphonamides, Hydrazidodiphosphonamides, Bis(imidodiphosphonamides), Bis(hydrazidodiphosphonamides), Poly(imidodiphosphonamides), and Poly(hydrazidodiphosphonamides) (O—O Bidentates, O—O Tridentates, O—O Tetradentates) | (RR'—N—)(R"—)P(═O)—NH—P(═O)(—R'")(—N—R""R""") for imidodiphosphonamides, and —NH—NH— derivatives for hydrazidodiphosphonamides, where R, R', R", R'", R"", and R""" represent H, $NH_2$ or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| O Valence Stabilizer #21: Diphosphonamides, Bis(diphosphonamides), and Poly(diphosphonamides) (O—O Bidentates, O—O Tridentates, O—O Tetradentates) | (RR'—N—)(R"—)P(═O)—O—P(═O)(—R'")(—N—R""R"""), where R, R', R", R'", R"", and R""" represent H, $NH_2$ or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| O Valence Stabilizer #22: Beta-Hydroxyketones, Beta-Hydroxyaldehydes, Bis(beta-hydroxyketones), Bis(beta-hydroxyaldehydes), Poly(beta-hydroxyketones), and Poly(beta-hydroxyaldehydes) (O—O Bidentates, O—O Tridentates, O—O Tetradentates) | R—CR'(—OH)—$CH_2$—C(═O)—R", where R, R', and R" represent H, $NH_2$ or any organic functional group wherein the number of carbon atoms ranges from 0 to 40, optionally having halogen or polarizing or water-insolubilizing/solubilizing groups attached. Ligand can also contain nonbinding N, O, S, or P atoms. |

TABLE 3-continued

Narrow Band Organic Valence Stabilizers for the $Co^{+3}$ ion

| General Structural Name (Type of Organic) | Structural Representation |
|---|---|
| O Valence Stabilizer #23: N-(Aminomethylol)ureas [N-(Aminohydroxymethyl)ureas], Bis[N-(aminomethylol)ureas], and Poly[N-(aminomethylol)ureas] (O—O Bidentates, O—O Tridentates, O—O Tetradentates) | RR'—N—CH(—OH)—NR''—C(=O)—NR'''R'''', where R, R', R'', R''', and R'''' represent H, $NH_2$ or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| O Valence Stabilizer #24: Oxamides, Bis(oxamides), and Poly(oxamides) (O—O Bidentates, O—O Tridentates, O—O Tetradentates) | RR'—N—C(=O)—C(=O)—N—R''R''', where R, R', R'', and R''' represent H, $NH_2$ or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| O Valence Stabilizer #25: Squaric Acids and derivatives thereof (O—O Bidentates) | —C(—OH)=C(—OH)—, where the two carbon atoms supporting the hydroxy groups are included within a cyclic hydrocarbon moiety, optionally having halogen or polarizing or water-insolubilizing/solubilizing groups attached. Ligand can also contain nonbinding N, O, S, or P atoms. |
| O Valence Stabilizer #26: Dicarboxylic Acids, Bis(dicarboxylic acids), Poly(dicarboxylic acids), and derivatives thereof (O—O Bidentates and O—O Tetradentates) | (R—O—)(O=)C—R'—C(=O)(—O—R''), where R, R', and R'' represent H, $NH_2$ or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| O Valence Stabilizer #27: Carbonates and Bis(carbonates) (O—O Bidentates and O—O Tetradentates) | R—O—C(=O)—O—R', where R, and R' represent H, $NH_2$ or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| O Valence Stabilizer #28: Carbamates, Bis(carbamates), and Poly(carbamates) (including N-hydroxycarbamates and N-mercaptocarbamates) (O—O Bidentates, O—O Tridentates, and O—O Tetradentates) | $RR'N^+$=C(OH)(OH), where R and R' represent H, OH, SH, OR'' (R''=$C_1$—$C_{30}$ alkyl or aryl), SR'' (R''=$C_1$—$C_{30}$ alkyl or aryl), $NH_2$ or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| O Valence Stabilizer #29: Carbazates (carbazides), Bis(carbazates), and Poly(carbazates) (O—O Bidentates, O—O Tridentates, and O—O Tetradentates; or possibly N—O Bidentates, N—O Tridentates, and N—O Tetradentates) | RR'N—NR''—C(=O)(OH), where R and R' represent H, $NH_2$ or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| O Valence Stabilizer #30: Carbimates, Bis(carbimates), and Poly(carbimates) (O—O Bidentates, O—O Tridentates, and O—O Tetradentates) | RN=C(OH)(OH), where R represents H, $NH_2$ or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| O Valence Stabilizer #31: Arsonic Acids, Bis(arsonic acids), Poly(arsonic acids), and derivatives thereof (O—O Bidentates, O—O Tridentates, O—O Tetradentates) | (O=)As(—O—R)(—O—R')(—O—R''), where R, R', and R'' represent H, $NH_2$ or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| O Valence Stabilizer #32: Alkyl- and Aryl- Borates and Bis(borates) (O—O Bidentates and O—O Tetradentates) | R—O—C(—O—R'')—O—R', where R, R', and R'' represent H, $NH_2$ or any organic functional group wherein the number of carbon atoms ranges from 0 to 40, optionally having halogen |

TABLE 3-continued

Narrow Band Organic Valence Stabilizers for the $Co^{+3}$ ion

| General Structural Name (Type of Organic) | Structural Representation |
|---|---|
| | or polarizing or water-insolubilizing/solubilizing groups attached. Ligand can also contain nonbinding N, O, S, or P atoms. |
| O Valence Stabilizer #33: Alkyl- and Aryl- Boronates and Bis(boronates) (O—O Bidentates and O—O Tetradentates) | R—C(—O—R'')—O—R', where R, R', and R'' represent H, $NH_2$ or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| O Valence Stabilizer #34: Phosphine P-Oxides and Amino-Substituted Phosphine oxides (O Monodentates) | RR'R''P═O for phosphine P-oxides, and (RR'N)(R''R'''N)(R''''R'''''N)P═O for amino-substituted phosphine oxides, where R, R', R'', R''', R'''', and R''''' represent H, Cl, Br, $NH_2$ or any organic functional group wherein the number of carbon atoms ranges from 0 to 40, optionally having halogen or polarizing or water-insolubilizing/solubilizing groups attached. (Rs are typically aromatic or heterocyclic for phosphine P-oxides.) Ligand can also contain nonbinding N, O, S, or P atoms. |
| O Valence Stabilizer #35: Arsine As-oxides and Amino-Substituted Arsine oxides (O Monodentates) | RR'R''As═O for arsine As-oxides, and (RR'N)(R''R'''N)(R''''R'''''N)As═O for amino-substituted arsine oxides, where R, R', R'', R''', R'''', and R''''' represent H, Cl, Br, $NH_2$ or any organic functional group wherein the number of carbon atoms ranges from 0 to 40, optionally having halogen or polarizing or water-insolubilizing/solubilizing groups attached. (Rs are typically aromatic or heterocyclic for arsine As-oxides.) Ligand can also contain nonbinding N, O, S, or P atoms. |
| O Valence Stabilizer #36: Cyanate ligands (O Monodentates) | Cyanates bound directly to the high valence metal ion. |
| N—S Valence Stabilizer #1: Thioimidates, Dithioimidates, Polythioimidates, and Derivatives of Thioimidic Acid (N—S Bidentates and N—S Tetradentates) | RC(═NH)SR', where R and R' represent H or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| N—S Valence Stabilizer #2: Thioguanylureas, Guanidinothioureas, Bis(thioguanylureas), Bis(guanidinothioureas), Poly(thioguanylureas), and Poly(guanidinothioureas) (N—S Bidentates and N—S Tetradentates) | RR'—N—C(═NH)—NR''—CS—NR'''R'''' for thioguanylureas, and RR'—N—C(═NH)—NR''—NH—CS—NR'''R'''' for guanidinothioureas, where R, R', R'', R''', and R'''' represent H, $NH_2$, or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| N—S Valence Stabilizer #3: Amidinothioamides, Guanidinothioamides, Bis(amidinothioamides), Bis(guanidinothioamides), Poly(amidinothioamides), and Poly(guanidinothioamides) (including both N-amidinothioamides and 2-amidinothioacetamides) (N—S Bidentates and N—S Tetradentates) | RR'—N—C(═NH)—NR''—CS—R''' for N—amidinothioamides, or RR'—N—C(═NH)—CR''R'''—CS—N—R''''R''''' for 2-amidinothioacetamides, and RR'—N—C(═NH)—NR''—NH—CS—R''' for guanidinothioamides, where R, R', R'', R''', R'''', and R''''' represent H, $NH_2$, or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| N—S Valence Stabilizer #4: Imidoylthioamides, Bis(imidoylthioamides), and Poly(imidoylthioamides) (N—S Bidentates and N—S Tetradentates) | R—C(═NH)—NR'—CS—R'', where R, R', and R'', represent H or any organic functional group wherein the number of carbon atoms ranges from 0 to 40, optionally having halogen or polarizing or water-insolubilizing/solubilizing groups attached. Ligand can also contain nonbinding N, O, S, or P atoms. |

TABLE 3-continued

Narrow Band Organic Valence Stabilizers for the $Co^{+3}$ ion

| General Structural Name (Type of Organic) | Structural Representation |
|---|---|
| N—S Valence Stabilizer #5: Thioureas, Bis(thioureas), and Poly(thioureas), including Thiourylene Complexes (N—S Bidentates, N—S Tridentates, and N—S Tetradentates) | RR'NCSNR''R''', where R, R', R'', and R''' represent H, $NH_2$, or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| N—S Valence Stabilizer #6: Thiocarboxamides, Bis(thiocarboxamides), and Poly(thiocarboxamides) (N—S Bidentates, N—S Tridentates, and N—S Tetradentates) | RCSNR'R'', where R, R', and R'' represent H, $NH_2$, or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| N—S Valence Stabilizer #7: Imidosulfurous Diamides and Bis(imidosulfurous diamides) (N—S Bidentates, N—S Tridentates, and N—S Tetradentates) | RR'—N—S(═NH)—N—R''R''', where R, R', R'', and R''' represent H or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| N—S Valence Stabilizer #8: Sulfurdiimines, Bis(sulfiirdiimines), and Poly(sulfurdiimines) (N—S Bidentates, N—S Tridentates, and N—S Tetradentates) | R—N═S═N—R', where R and R' represent H or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| N—S Valence Stabilizer #9: Phosphonimidothioic Acid, Phosphonimidodithioic Acid, Bis(Phosphonimidothioic acid); Bis(Phosphonimidodithioic acid), and derivatives thereof (N—S Bidentates, N—S Tetradentates) | (NH═)PR(OR')(SR'') for phosphonimidothioic acid and (NH═)PR(SR')(SR'') for phosphonimidodithioic acid, where R, R', and R'' represent H or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| N—S Valence Stabilizer #10: Phosphonothioic Diamides, Bis(phosphonothioic diamides), and Poly(phosphonothioic diamides) (N—S Bidentates and N—S Tetradentates) | (S═)PR(—NR'R'')(—NR'''R''''), where R, R', R'', R''', and R'''' represent H or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| N—S Valence Stabilizer #11: Phosphonamidothioic Acid, Phosphonamidimidodithioic Acid, Bis(phosphonamidothioic acid), Bis(phosphonamidimidodithioic acid), poly(phosphonamidothioic acid), and poly(phosphonamidimidodithioic acid), and derivatives thereof (N—S Bidentates and N—S Tetradentates) | (S═)PR(—NR'R'')(—OR''') or (O═)PR(—NR'R'')(—SR''') for phosphonamidothioic acid, (S═)PR(—NR'R'')(—SR''') for phosphonamidimidodithioic acid, where R, R', R'', and R''' represent H or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| N—S Valence Stabilizer #12: Beta-Aminothiones (N-Substituted 3-amino-2-propenethioaldehydes), Bis(beta-aminothiones), and Poly(beta-aminothiones) (N—S Bidentates and N—S Tetradentates) | R—C(═S)—CR'═CR''—NHR''', where R, R', R'', and R''' represent H, or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| N—S Valence Stabilizer #13: 3-Aminothioacrylamides (3-Amino-2-thiopropenamides), 3,3-Diaminothioacrylamides, Bis(3-aminothioacrylamides), Bis(3,3-diaminoacrylamides), Poly(3-aminothioacrylamides), and Poly(3,3- | RR'—N—C(═S)—CR''═C(—NHR''')R'''' for 3-aminothioacrylamides, and RR'—N—C(═S)—CR''═C(—NHR''')(—NR''''R''''') for 3,3-diaminothioacrylamides, where R, R', R'', R''', R'''', R''''' represent H, $NH_2$, or any organic functional group wherein the number of carbon atoms ranges from 0 to 40, optionally having |

TABLE 3-continued

Narrow Band Organic Valence Stabilizers for the $Co^{+3}$ ion

| General Structural Name (Type of Organic) | Structural Representation |
|---|---|
| diaminothioacrylamides) (N—S Bidentates and N—S Tetradentates) | halogen or polarizing or water-insolubilizing/solubilizing groups attached. Ligand can also contain nonbinding N, O, S, or P atoms. |
| N—S Valence Stabilizer #14: 3-Aminothioacrylic Acids (3-Amino-2-thiopropenoic acids), 3-Mercapto-3-aminothioacrylic acids, Bis(3-aminothioacrylic acids), Bis(3-Hydroxy-3-aminothioacrylic acids), Poly(3-aminothioacrylic acids), and Poly(3-Hydroxy-3-aminothioacrylic acids), and derivatives thereof (N—S Bidentates and N—S Tetradentates) | R—O—C(═S)—CR'═C(—NHR")R"' or R—S—C(═S)—CR'═C(—NHR")R"' for 3-aminothioacrylic acids, and R—O—C(═S)—CR'═C(—NHR")(—S—R"') or R—S—C(═S)—CR'═C(—NHR")(—S—R"') for 3-mercapto-3-aminothioacrylic acids, where R, R', R", and R"' represent H, $NH_2$, or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| N—S Valence Stabilizer #15: N—Thioacyl Benzylidenimines, Bis(N-thioacyl benzylidenimines), and Poly(N-thioacyl benzylidenimines) (N—S Bidentates and N—S Tetradentates) | R—C(═S)—N═CHR', where R' represents an aromatic derivative (i.e., —$C_6H_5$), and R represent H, $NH_2$, or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| N—S Valence Stabilizer #16: Thiocarbonyl oximes, Bis(thiocarbonyl oximes), and Poly(thiocarbonyl oximes) (N—S Bidentates, N—S Tridentates, and N—S Tetradentates) | R—C(═S)—C(═NOH)—R', where R and R' represent H, $NH_2$, or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| N—S Valence Stabilizer #17: Mercapto oximes, Bis(mercapto oximes), and Poly(mercapto oximes) (including 2-sulfur heterocyclic oximes) (N—S Bidentates, N—S Tridentates, N—S Tetradentates, and N—S Hexadentates) | R—CH(—SH)—C(═NOH)—R', where R, R', and R" represent H, $NH_2$, or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| N—S Valence Stabilizer #18: 2-Nitrothiophenols(2-Nitrobenzenethiols) (N—S Bidentates) | o-($O_2N$—)(HS—)Ar, where Ar represents an aromatic group or heterocyclic wherein the number of carbon atoms ranges from 6 to 40, optionally having halogen or polarizing or water-insolubilizing/solubilizing groups attached. Ligand can also contain nonbinding N, O, S, or P atoms. |
| N—S Valence Stabilizer #19: 2-Nitrilothiophenols (N—S Bidentates) | o-(NC—$(CH_2)_{0-1}$)(HS—)Ar, where Ar represents an aromatic group or heterocyclic wherein the number of carbon atoms ranges from 6 to 40, optionally having halogen or polarizing or water-insolubilizing/solubilizing groups attached. Ligand can also contain nonbinding N, O, S, or P atoms. |
| N—S Valence Stabilizer #20: Thiohydrazides, Bis(thiohydrazides), and Poly(thiohydrazides) (N—S Bidentates and N—S Tetradentates) | R—C(═S)—NHNR'R", where R, R', and R" represent H or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| N—S Valence Stabilizer #21: Thiosemicarbazides, Bis(thiosemicarbazides), and Poly(thiosemicarbazides) (N—S Bidentates, N—S Tetradentates, and N—S Hexadentates) | RR'—N—C(═S)—NHNR"R"', where R, R', and R" represent H or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| N—S Valence Stabilizer #22: Five-, Seven-, or Nine-Membered Macrocyclics, Macrobicyclics, and Macropolycyclics (including Catapinands, Cryptands, Cyclidenes, and Sepulchrates) | Macrocyclic ligands containing five, seven, or nine binding sites composed of nitrogen and sulfur to valence stabilize the central metal ion. Can include other hydrocarbon or ring systems bound to this macrocyclic ligand, but they do |

TABLE 3-continued

Narrow Band Organic Valence Stabilizers for the $Co^{+3}$ ion

| General Structural Name (Type of Organic) | Structural Representation |
|---|---|
| wherein all Binding Sites are composed of Nitrogen (usually amine or imine groups) or Sulfur (usually thiols, mercaptans, or thiocarbonyls) and are not contained in Component Heterocyclic Rings (N—S Tridentates, N—S Tetradentates, and N—S Hexadentates) | not coordinate with the stabilized, high valence metal ion. This ligand and/or attached, uncoordinating hydrocarbons/rings may or may not have halogen or polarizing or water-insolubilizing/solubilizing groups attached. |
| N—S Valence Stabilizer #23: Five-, or Seven-Membered Macrocyclics, Macrobicyclics, and Macropolycyclics (including Catapinands, Cryptands, Cyclidenes, and Sepulchrates) wherein all Binding Sites are composed of Nitrogen or Sulfur and are contained in Component Heterocyclic Rings (N—S Tridentates, N—S Tetradentates, or N—S Hexadentates) | Macrocyclic ligands containing a total of five or seven heterocyclic rings containing nitrogen or sulfur binding sites. Can include other hydrocarbon/ring systems bound to this macrocyclic ligand, but they do not coordinate with the stabilized, high valence metal ion. This ligand and/or attached, uncoordinating hydrocarbon/rings may or may not have halogen or polarizing or water-insolubilizing groups attached. |
| N—S Valence Stabilizer #24: Five-, Seven-, or Nine-Membered Macrocyclics, Macrobicyclics, and Macropolycyclics (including Catapinands, Cryptands, Cyclidenes, and Sepulchrates) wherein all Binding Sites are composed of Nitrogen or Sulfur and are contained in a Combination of Heterocyclic Rings and Amine, Imine, Thiol, Mercapto, or Thiocarbonyl Groups (N—S Tridentates, N—S Tetradentates, or N—S Hexadentates) | Macrocyclic ligands containing at least one heterocyclic ring. These heterocyclic rings provide nitrogen or sulfur binding sites to valence stabilize the central metal ion. Other amine, imine, thiol, mercapto, or thiocarbonyl binding sites can also be included in the macrocyclic ligand, so long as the total number of binding sites is five, seven, or nine. Can include other hydrocarbon/ring systems bound to this macrocyclic ligand, but they do not coordinate with the stabilized, high valence metal ion. This ligand and/or attached, uncoordinating hydrocarbon/rings may or may not have halogen or polarizing or water-insolubilizing groups attached. |
| N—O Valence Stabilizer #1: Imidates, Diimidates, Polyimidates, and Derivatives of Imidic Acid (N—O Bidentates and N—O Tetradentates) | RC(═NH)OR', where R and R' represent H or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| N—O Valence Stabilizer #2: Pseudoureas, bis(pseudoureas), and poly(pseudoureas) (N—O Bidentates and N—O Tetradentates) | RR'NC(═NH)OR", where R, R', and R" represent H, $NH_2$, or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| N—O Valence Stabilizer #3: 2-Amidinoacetates, Bis(2-amidinoacetates), and Poly(2-amidinoacetates) (N—O Bidentates and N—O Tetradentates) | RR'NC(═NH)CR"R'"(CO)OR"", where R, R', R", R'", and R"" represent H, $NH_2$, or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| N—O Valence Stabilizer #4: Ureas, Bis(ureas), and Poly(ureas), including Urylene Complexes (N—O Bidentates, N—O Tridentates, and N—O Tetradentates) | RR'NCONR"R'", where R, R', R", and R'" represent H, $NH_2$, or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| N—O Valence Stabilizer #5: Phosphonimidic Acid, Bis(phosphonimidic acid), Poly(phosphonimidic acid), and derivatives thereof (N—O Bidentates and N—O Tetradentates) | (NH═)PR(OR')(OR"), where R, R', and R" represent H, $NH_2$, or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| N—O Valence Stabilizer #6: Phosphonamidic Acid, Phosphonic Diamide, Bis(Phosphonamidic Acid), | (O═)PR(—NR'R")(—OR'") for phosphonamidic acid and (O═)PR(—NR'R")(—NR'"R"") for phosphonic diamide, where R, R', R", R'", and |

TABLE 3-continued

Narrow Band Organic Valence Stabilizers for the $Co^{+3}$ ion

| General Structural Name (Type of Organic) | Structural Representation |
|---|---|
| Bis(Phosphonic Diamide), Poly(phosphonamidic acid), poly(phosphonic diamide), and derivatives thereof (N—O Bidentates and N—O Tetradentates) | R'''' represent H, $NH_2$, or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| N—O Valence Stabilizer #7: Beta-Ketoamines (N-Substituted 3-amino-2-propenals), Bis(beta-ketoamines), and Poly(beta-ketoamines) (N—O Bidentates and N—O Tetradentates) | R—C(═O)—CR'═C(—NHR'')R''', where R, R', R'', and R''' represent H, or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| N—O Valence Stabilizer #8: 3-Aminoacrylamides (3-Amino-2-propenamides), 3,3-Diaminoacrylamides, Bis(3-aminoacrylamides), Bis(3,3-diaminoacrylamides), Poly(3-aminoacrylamides), and Poly(3,3-diaminoacrylamides) (N—O Bidentates and N—O Tetradentates) | RR'—N—C(═O)—CR''═C(—NHR''')R'''' for 3-aminoacrylamides, and RR'—N—C(═O)—CR''═C(—NHR''')(—NR''''R''''') for 3,3-diaminoacrylarnides, where R, R', R'', R''', R'''', and R''''' represent H, $NH_2$, or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| N—O Valence Stabilizer #9: 3-Aminoacrylic Acids (3-Amino-2-propenoic acids), 3-Hydroxy-3-aminoacrylic acids, Bis(3-aminoacrylic acids), Bis(3-Hydroxy-3-aminoacrylic acids), Poly(3-aminoacrylic acids), and Poly(3-Hydroxy-3-aminoacrylic acids), and derivatives thereof (N—O Bidentates and N—O Tetradentates) | R—O—C(═O)—CR'═C(—NHR'')R''' for 3-aminoacrylic acids, and R—O—C(═O)—CR'═C(—NHR'')(—O—R''') for 3-hydroxy-3-aminoacrylic acids, where R, R', R'', and R''' represent H, $NH_2$, or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| N—O Valence Stabilizer #10: N-Acyl Benzylidenimines, Bis(N-acyl benzylidenimines), and Poly(N-acyl benzylidenimines) (N—O Bidentates and N—O Tetradentates) | R—C(═O)—N═CHR', where R' represents an aromatic derivative (i.e., —$C_6H_5$), and R represent H, $NH_2$, or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| N—O Valence Stabilizer #11: 2-Nitroanilines (N—O Bidentates) | o-($O_2N$—)(RR'N—)Ar, where Ar represents an aromatic group or heterocyclic wherein the number of carbon atoms ranges from 6 to 40, and R and R' represent H, $NH_2$, or alkyl or aryl hydrocarbon groups wherein the number of carbon atoms range from 0 to 25, optionally having halogen or polarizing or water-insolubilizing/solubilizing groups attached. Ligand can also contain nonbinding N, O, S, or P atoms. |
| N—O Valence Stabilizer #12: 2-Nitrilophenols (N—O Bidentates). Also includes acylcyanamides. | o-(NC—$(CH2)_{0-1}$)(HO—)Ar, where Ar represents an aromatic group or heterocyclic wherein the number of carbon atoms ranges from 6 to 40, optionally having halogen or polarizing or water-insolubilizing/solubilizing groups attached. Ligand can also contain nonbinding N, O, S, or P atoms. |
| N—O Valence Stabilizer #13: Amine N-Oxides and Diazine N-Oxides (Azoxy componds) (N—O Bidentates, N—O Tridentates, and N—O Tetradentates) | $HetN^+$—O'' for amine N-oxides, and R—N═$N^+$(—$O^-$)—R' for diazine N-oxides (azoxy compounds), where Het represents a nitrogen—Containing heterocyclic derivative wherein the number of carbon atoms ranges from 4 to 40, and R and R' represent separate or the same aromatic functionalities, both Het and R,R' optionally having halogen or polarizing or water-insolubilizing/solubilizing groups attached. Ligand can also contain nonbinding N, O, S, or P atoms. |

TABLE 3-continued

Narrow Band Organic Valence Stabilizers for the $Co^{+3}$ ion

| General Structural Name (Type of Organic) | Structural Representation |
|---|---|
| N—O Valence Stabilizer #14: Hydrazides, Bis(hydrazides), and Poly(hydrazides) (N—O Bidentates and N—O Tetradentates) | R—C(=O)—NHNR'R", where R, R', and R" represent H or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| N—O Valence Stabilizer #15: Semicarbazides, Bis(semicarbazides), and Poly(semicarbazides) (N—O Bidentates, N—O Tetradentates, and N—O Hexadentates) | RR'—N—C(=O)—NHNR"R'", where R, R', and R" represent H or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| N—O Valence Stabilizer #16: Five-, Seven-, or Nine-Membered Macrocyclics, Macrobicyclics, and Macropolycyclics (including Catapinands, Cryptands, Cyclidenes, and Sepulchrates) wherein all Binding Sites are composed of Nitrogen (usually amine or imine groups) or Oxygen (usually hydroxy, carboxy, or carbonyl groups) and are not contained in Component Heterocyclic Rings (N—O Tridentates, N—O Tetradentates, and N—O Hexadentates) | Macrocyclic ligands containing five, seven, or nine binding sites composed of nitrogen and oxygen to valence stabilize the central metal ion. Can include other hydrocarbon or ring systems bound to this macrocyclic ligand, but they do not coordinate with the stabilized, high valence metal ion. This ligand and/or attached, uncoordinating hydrocarbons/rings may or may not have halogen or polarizing or water-insolubilizing/solubilizing groups attached. |
| N—O Valence Stabilizer #17: Five-, or Seven-Membered Macrocyclics, Macrobicyclics, and Macropolycyclics (including Catapinands, Cryptands, Cyclidenes, and Sepulchrates) wherein all Binding Sites are composed of Nitrogen or Oxygen and are contained in Component Heterocyclic Rings (N—O Tridentates, N—O Tetradentates, or N—O Hexadentates) | Macrocyclic ligands containing a total of five or seven heterocyclic rings containing nitrogen or oxygen binding sites. Can include other hydrocarbon/ring systems bound to this macrocyclic ligand, but they do not coordinate with the stabilized, high valence metal ion. This ligand and/or attached, uncoordinating hydrocarbon/rings may or may not have halogen or polarizing or water-insolubilizing groups attached. |
| N—O Valence Stabilizer #18: Five-, Seven-, or Nine-Membered Macrocyclics, Macrobicyclics, and Macropolycyclics (including Catapinands, Cryptands, Cyclidenes, and Sepulchrates) wherein all Binding Sites are composed of Nitrogen or Oxygen and are contained in a Combination of Heterocyclic Rings and Amine, Imine, Hydroxy, Carboxy, or Carbonyl Groups (N—O Tridentates, N—O Tetradentates, or N—O Hexadentates) | Macrocyclic ligands containing at least one heterocyclic ring. These heterocyclic rings provide nitrogen or oxygen binding sites to valence stabilize the central metal ion. Other amine, imine, hydroxy, carboxy, or carbonyl binding sites can also be included in the macrocyclic ligand, so long as the total number of binding sites is five, seven, or nine. Can include other hydrocarbon/ring systems bound to this macrocyclic ligand, but they do not coordinate with the stabilized, high valence metal ion. This ligand and/or attached, uncoordinating hydrocarbon/rings may or may not have halogen or polarizing or water-insolubilizing groups attached. |
| S—O Valence Stabilizer #1: Thiobiurets (Thioimidodicarbonic Diamides), Thioisobiurets, Thiobiureas, Thiotriurets, Thiotriureas, Bis(thiobiurets), Bis(thioisobiurets), Bis(thiobiureas), Poly(thiobiurets), Poly(thioisobiurets), Poly(thiobiureas) (S—O Bidentates, S—O Tridentates, S—O Tetradentates), and (3-formamidino thiocarbamides). | RR'—N—C(=S)—NR"—C(=O)—NR'"R"" for thiobiurets, and RR'—N—C(=S)—NR"—NH—C(=O)—NR'"R"" for thiobiureas, where R, R', R", R'", and R"" represent H, $NH_2$, or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| S—O Valence Stabilizer #2: Acylthioureas, Aroylthioureas, Thioacylureas, Thioaroylureas, Bis(acylthioureas), Bis(aroylthioureas), Bis(thioacylureas), Bis(thioaroylureas), Poly(thioacylthioureas), Poly(thioaroylthioureas), Poly(thioacylureas), and Poly(thioaroylureas) (S—O Bidentates, S—O Tridentates, S—O Tetradentates) | RR'—N—C(=S)—NR"—C(=O)—R'" for acyl- and aroylthioureas, and RR'—N—C(=O)—NR"—C(=S)—R'" for thioacyl- and thioaroylureas, where R, R', R", and R'" represent H, $NH_2$, or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| S—O Valence Stabilizer #3: Thiomidodialdehydes, Thiohydrazidodialdehydes (thioacyl | RC(=S)—NR'—C(=O)—R" for thioimidodialdehydes, and RC(=S)—NR'—NH—C(=O)—R" for thiohydrazidodialdehydes |

TABLE 3-continued

Narrow Band Organic Valence Stabilizers for the $Co^{+3}$ ion

| General Structural Name (Type of Organic) | Structural Representation |
|---|---|
| hydrazides), Bis(thioimidodialdehydes), Bis(thiohydrazidodialdehydes), Poly(thioimidodialdehydes), and Poly(thiohydrazidodialdehydes)(S—O Bidentates, S—O Tridentates, S—O Tetradentates) | (thioacyl hydrazides), where R, R', and R'' represent H, $NH_2$, or any organic functional group wherein the number of carbon atoms ranges from 0 to 40, optionally having halogen or polarizing or water-insombilizing/solubilizing groups attached. Ligand can also contain nonbinding N, O, S, or P atoms. |
| S—O Valence Stabilizer #4: Thioimidodicarbonic acids, Thiohydrazidodicarbonic acids, Bis(thioimidodicarbonic acids), Bis(thiohydrazidodicarbonic acids), Poly(thioimidodicarbonic acids), Poly(thiohydrazidodicarbonic acids) and derivatives thereof (S—O Bidentates, S—O Tridentates, S—O Tetradentates) | R—O—C(═S)—NR'—C(═O)—O—R'' or R—S—C(═S)—NR'—C(═O)—S—R'' for thioimidodicarbonic acids, and R—O—C(═S)—NR'—NH—C(═O)—O—R'' or R—S—C(═S)—NR'—NH—C(═O)—S—R'' for thiohydrazidodicarbonic acids, where R, R', and R'' represent H, $NH_2$, or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| S—O Valence Stabilizer #5: 1,2-Monothioketones (Monothiolenes, Monothio-alpha-ketonates), 1,2,3-Monothioketones, 1,2,3-Dithioketones, Monothiotropolonates, ortho-Monothioquinones, Bis(1,2-Monothioketones), and Poly(1,2-Monothioketones) (S—O Bidentates, S—O Tridentates, S—O Tetradentates) | R—C(═S)—C(═O)—R' where R and R' represent H, $NH_2$, or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| S—O Valence Stabilizer #6: Trithioperoxydicarbonic Diamides, Dithioperoxydicarbonic Diamides, Bis(trithioperoxydicarbonic diamides), Bis(dithioperoxydicarbonic diamides), poly(trithioperoxydicarbonic diamides) and poly(dithioperoxydicarbonic diamides) (S—O Bidentates, S—O Tridentates, S—O Tetradentates) | RR'—N—C(═S)—S—S—C(═O)—N—R''R''' for trithioperoxydicarbonic diamides, and RR'—N—C(═O)—S—S—C(═O)—N—R''R''' for dithioperoxydicarbonic diamides, where R, R', R'', R''' represent H or any organic functional group wherein the number of carbon atoms ranges from 0 to 40, optionally having halogen or polarizing or water-insolubilizing/solubilizing groups attached. Ligand can also contain nonbindmg N, O, S, or P atoms. |
| S—O Valence Stabilizer #7: Diithiodicarbonic Acids, Bis(dithiodicarbonic acids), Poly(dithiodicarbonic acids), and derivatives thereof (S—O Bidentates, S—O Tridentates, S—O Tetradentates) | R—O—C(═S)—S—C(═O)—O—R', where R and R' represent H, $NH_2$ or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| S—O Valence Stabilizer #8: Trithioperoxydicarbonic Acids, Bis(trithioperoxydicarbonic acids), poly(trithioperoxydicarbonic acids), and derivatives thereof (S—O Bidentates, S—O Tridentates, S—O Tetradentates) | R—O—C(═S)—S—S—C(═O)—O—R', where R and R' represent H, $NH_2$ or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| S—O Valence Stabilizer #9: Monothioperoxydiphosphoramide, Bis(monothioperoxyphosphoramide), and Poly(monothioperoxydiphosphoramide)(S—O Bidentates, S—O Tridentates, S—O Tetradentates) | (RR'—N—)(R''R'''—N—)P(═S)—S—S—P(═O)(—N—R''''R''''')(—N—R''''''R''''''), where R, R', R'', R''', R'''', R''''', R''''''', and R''''''' represent H, $NH_2$ or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| S—O Valence Stabilizer #10: Monothioperoxydiphosphoric Acids, Bis(monothioperoxyphosphoric Acids), Poly(monothioperoxydiphosphoric Acids), and derivatives thereof (S—O Bidentates, S—O Tridentates, S—O Tetradentates) | (R—O—)(R'—O—)P(═S)—S—S—P(═O)(—O—R'')(—O—R'''); (R—O—)(R'—S—)P(═S)—S—S—P(═O)(—S—R'')(—O—R'''); or (R—S—)(R'—S—)P(═S)—S—S—P(—O)(—S—R'')(—S—R'''), where R, R', R'', R''', R'''', R''''', R''''''', and R''''''' represent H, $NH_2$ or any organic functional group wherein the number of carbon atoms ranges from 0 to 40, optionally having halogen or polarizing or water-insolubilizing/solubilizing groups attached. |

TABLE 3-continued

Narrow Band Organic Valence Stabilizers for the $Co^{+3}$ ion

| General Structural Name (Type of Organic) | Structural Representation |
|---|---|
| | Ligand can also contain nonbinding N, O, S, or P atoms. |
| S—O Valence Stabilizer #11: Monothioimidodiphosphonic Acids, Monothiohydrazidodiphosphonic Acids, Bis(monothioimidodiphosphonic Acids), Bis(monothiohydrazidodiphosphonic Acids), Poly(monothioimidodiphosphonic Acid), Poly(monothiohydrazidodiphosphonic Acids), and derivatives thereof (S—O Bidentates, S—O Tridentates, S—O Tetradentates) | (R—O—)(R'—)P(═S)—NH—P(═O)(—R'')(—O—R'''); (R—S—)(R'—)P(═S)—NH—P(═O)(—R'')(—O—R'''); or (R—S—)(R'—)P(═S)—NH—P(═O)(—R'')(—S—R''')for monothioimidodiphosphonic acids, and —NH—NH— derivatives for monothiohydrazidodiphosphonic acids, where R, R', R'', and R''' represent H, $NH_2$ or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| S—O Valence Stabilizer #12: Monothioimidodiphosphonamides, Monothiohydrazidodiphosphonamides, Bis(monothioimidodiphosphonamides), Bis(monothiohydrazidodiphosphonamides) Poly(monothioimidodiphosphonamides), and Poly(monothiohydrazidodiphosphonamides) (S—O Bidentates, S—O Tridentates, S—O Tetradentates) | (RR'—N—)(R''—)P(═S)—NH—P(═O)(—R''')(—N—R''''R''''') for monothioimidodiphosphonamides, and —NH—NH— derivatives for monothiohydrazidodiphosphonamides, where R, R', R'', R''', R'''', and R''''', represent H, $NH_2$ or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| S—O Valence Stabilizer #13: Monothiodiphosphonamides, Bis(monothioiphosphonamides), and Poly(monothiodiphosphonamides) (S—O Bidentates, S—O Tridentates, S—O Tetradentates) | (RR'—N—)(R''—)P(═S)—S—P(═O)(—R''')(—N—R''''R''''), or (RR'—N—)(R''—)P(═S)—O—P(═O)(—R''')(—N—R''''R''''), where R, R', R'', R''', R'''', and R''''' represent H, $NH_2$ or any organic functional group wherein the number of carbon atoms ranges from 0 to 40, optionally having halogen or polarizing or water-insolubilizmg/solubilizing groups attached. Ligand can also contain nonbinding N, O, S, or P atoms. |
| S—O Valence Stabilizer #14: Monothiodiphosphonic Acids, Bis(monothioiphosphonic Acids), Poly(monothiodiphosphonic Acids), and derivatives thereof (S—O Bidentates, S—O Tridentates, S—O Tetradentates) | (R—O—)(R'—)P(═S)—O—P(═O)(—R'')(—O—R'''); (R—O—)(R'—)P(═S)—S—P(═O)(—R'')(—O—R'''); (R—S—)(R'—)P(═S)-O—P(═O)(—R'')(—S—R'''); or (R—S—)(R'—)P(═S)—S—P(═O)(—R'')(—S—R'''), where R, R', R'', and R''' represent H, $NH_2$ or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| S—O Valence Stabilizer #15: Monothioperoxydiphosphonamide, Bis(monothioperoxyphosphonamide), and Poly(monothioperoxydiphosphonamide)(S—O Bidentates, S—O Tridentates, S—O Tetradentates) | (RR'—N—)(R''—)P(═S)—S—S—P(═O)(—R''')(—N—R''''R''''), where R, R', R'', R''', R'''', and R''''' represent H, $NH_2$ or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| S—O Valence Stabilizer #16: Monothioperoxydiphosphonic Acids, Bis(monothioperoxyphosphonic Acids), Poly(monothioperoxydiphosphonic Acids), and derivatives thereof (S—O Bidentates, S—O Tridentates, S—O Tetradentates) | (R—O—)(R'—)P(═S)—S—S—P(═O)(—R'')(—O—R'''); or (R—S—)(R'—)P(═S)—S—S—P(═O)(—R'')(—S—R'''), where R, R', R'', and R''' represent H, $NH_2$ or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| S—O Valence Stabilizer #17: Monothiophosphoric Acids (Phosphorothioic Acids), Bis(monothiophosphoric acids), Poly(monothiophosphoric acids), and derivatives thereof (S—O Bidentates, S—O Tridentates, S—O Tetradentates) | (O═)P(—S—R)(—O—R')(—O—R'') or (S═)P(—O—R)(—O—R')(—O—R''), where R, R', and R'' represent H, $NH_2$ or any organic functional group wherein the number of carbon atoms ranges from 0 to 40, optionally having halogen or polarizing or water-insombilizing/solubilizing groups attached. Ligand can also contain nonbinding N, O, S, or P atoms. |

TABLE 3-continued

Narrow Band Organic Valence Stabilizers for the $Co^{+3}$ ion

| General Structural Name (Type of Organic) | Structural Representation |
|---|---|
| S—O Valence Stabilizer #18: Phosphoro(dithioperoxoic) Acids, Bis[phosphoro(dithioperoxoic) acids], Poly[phosphoro(dithioperoxoic) acids], and derivatives thereof (S—O Bidentates, S—O Tridentates, S—O Tetradentates) | (O═)P(—S—S—R)(—O—R')(—O—R''), where R, R', and R'' represent H, $NH_2$ or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| S—O Valence Stabilizer #19: Monothiophosphonic Acids (Phosphonothioic Acids), Bis(monothiophosphonic Acids), Poly(monothiophosphonic Acids), and derivatives thereof (S—O Bidentates, S—O Tridentates, S—O Tetradentates) | (O═)PR(—S—R')(—O—R'') or (S═)PR(—O—R')(—O—R''), where R, R', and R'' represent H, $NH_2$ or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| S—O Valence Stabilizer #20: Phosphono(dithioperoxoic) Acids, Bis[phosphono(dithioperoxoic) Acids], Poly[phosphono(dithioperoxoic) Acids], and derivatives thereof (S—O Bidentates, S—O Tridentates, S—O Tetradentates) | (O═)PR(—S—S—R')(—O—R''), where R, R', and R'' represent H, $NH_2$ or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| S—O Valence Stabilizer #21: Beta-Hydroxythioketones, Beta-Hydroxythioaldehydes, Bis(beta-hydroxythioketones), Bis(beta-hydroxythioaldehydes), Poly(beta-hydroxythioketones), and Poly(beta-hydroxythioaldehydes) (S—O Bidentates, S—O Tridentates, S—O Tetradentates) | R—CR'(—OH)—$CH_2$—C(═S)—R'', where R, R', and R'' represent H, $NH_2$ or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| S—O Valence Stabilizer #22: Beta-Mercaptoketones, Beta-Mercaptoaldehydes, Bis(beta-mercaptoketones), Bis(beta-mercaptoaldehydes), Poly(beta-mercaptoketones), and Poly(beta-mercaptoaldehydes) (S—O Bidentates, S—O Tridentates, S—O Tetradentates) | R—CR'(—SH)—$CH_2$—C(═O)—R'', where R, R', and R'' represent H, $NH_2$ or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| S—O Valence Stabilizer #23: N-(Aminomethylol)thioureas [N-(Aminohydroxymethyl)thioureas], Bis[N-(aminomethylol)thioureas], and Poly[N-(aminomethylol)thioureas] (S—O Bidentates, S—O Tridentates, S—O Tetradentates) | RR'—N—CH(—OH)—NR''—C(═S)—NR'''R'''', where R, R', R'', R''', and R'''' represent H, $NH_2$ or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| S—O Valence Stabilizer #24: N-(Aminomethylthiol)ureas [N-(Aminomercaptomethyl)ureas], Bis[N-(aminomethylthiol)ureas], and Poly[N-(aminomethylthiol)ureas] (S—O Bidentates, S—O Tridentates, S—O Tetradentates) | RR'—N—CH(—SH)—NR''—C(═O)—NR'''R'''', where R, R', R'', R''', and R'''' represent H, $NH_2$ or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| S—O Valence Stabilizer #25: Monothiooxamides, Bis(monothiooxamides), and Poly(monothiooxamides) (S—O Bidentates, S—O Tridentates, S—O Tetradentates) | RR'—N—C(═S)—C(═O)—N—R''R''', where R, R', R'', and R''' represent H, $NH_2$ or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| S—O Valence Stabilizer #26: Beta-Mercapto Carboxylic Acids, Bis(Beta-Mercapto Carboxylic Acids), Poly(Beta-Mercapto Carboxylic Acids), and derivatives thereof (S—O Bidentates, S—O Tridentates, S—O Tetradentates) | R—CR'(—SH)—CR''R'''—C(═O)(—O—R''''), where R, R', R'', R''', and R'''' represent H, $NH_2$ or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| S—O Valence Stabilizer #27: Beta-Mercapto Thiocarboxylic Acids, | R—CR'(—SH)—CR''R'''—C(═O)(—S—R''''), where R, R', R'', R''', and R'''' represent H, $NH_2$ or any |

TABLE 3-continued

Narrow Band Organic Valence Stabilizers for the $Co^{+3}$ ion

| General Structural Name (Type of Organic) | Structural Representation |
|---|---|
| Bis(Beta-Mercapto Thiocarboxylic Acids), Poly(Beta-Mercapto Thiocarboxylic Acids), and derivatives thereof (S—O Bidentates, S—O Tridentates, S—O Tetradentates) | organic functional group wherein the number of carbon atoms ranges from 0 to 40, optionally having halogen or polarizing or water-insolubilizing/solubilizing groups attached. Ligand can also contain nonbinding N, O, S, or P atoms. |
| S—O Valence Stabilizer #28: Beta-Hydroxy Thiocarboxylic Acids, Bis(Beta-Hydroxy Thiocarboxylic Acids), Poly(Beta-Hydroxy Thiocarboxylic Acids), and derivatives thereof (S—O Bidentates, S—O Tridentates, S—O Tetradentates) | R—CR'(—OH)—CR"R'"—C(=O)(—S—R""), where R, R', R", R'", and R"" represent H, $NH_2$ or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| S—O Valence Stabilizer #29: Beta-Mercapto Carboxamides, Bis(Beta-Mercapto Carboxamides), Poly(Beta-Mercapto Carboxamides), and derivatives thereof (S—O Bidentates, S—O Tridentates, S—O Tetradentates) | R—CR'(—SH)—CR"R'"—C(—O)(—NH—R""), where R, R', R", R'", and R"" represent H, $NH_2$ or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| S—O Valence Stabilizer #30: S—Alkylthiocarboxylic Acids, S—Arylthiocarboxylic Acids, and S,S—thiobiscarboxylic Acids (S—O Bidentates and S—O Tridentates) | R—S—R'COOH for S-alkylthiocarboxylic and S-arylthiocarboxylic acids, and HOOCR—S—R'COOH for S,S-thiobiscarboxylic acids, where R and R' represent H or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| S—O Valence Stabilizer #31: S-Alkyldisulfidocarboxylic Acids, S-Aryldisulfidocarboxylic Acids, and S,S'-Disulfidobiscarboxylic Acids (S—O Bidentates and S—O Tridentates) | R—S—S—R'COOH for S-alkyldisulfidocarboxylic and S-aryldisulfidocarboxylic acids, and HOOCR—S—S—R'COOH for S,S'-disulfidobiscarboxylic acids, where R and R' represent H or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| S—O Valence Stabilizer #32: Monothiomonocarboxylic Acids, Dithiodicarboxylic Acids, Bis(monothiomonocarboxylic Acids), Bis(dithiodicarboxylic acids), Poly(monothiomonocarboxylic acids), Poly(dithiodicarboxylic acids), and derivatives thereof (S—O Bidentates and S—O Tetradentates) | R—C(=O)(—S—R') for monothiomonocarboxylic acids, and (R—S—)(O=)C—R'—C(=O)(—S—R") or (R—S—)(O=)C—R'—C(=O)(—O—R") for dithiodicarboxylic acids, where R, R', and R" represent H, $NH_2$ or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| S—O Valence Stabilizer #33: Monothiocarbonates and Bis(monothiocarbonates) (S—O Bidentates and S—O Tetradentates) | R—O—C(—S)—O—R', where R, and R' represent H, $NH_2$ or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| S—O Valence Stabilizer #34: Monothiocarbazates (Monothiocarbazides), Bis(monothiocarbazates), and Poly(monothiocarbazates) (S—O Bidentates, S—O Tridentates, and S—O Tetradentates; or possibly N—S Bidentates, N—S Tridentates, and N—S Tetradentates) | RR'N—NR"—C(—0)(SH), where R and R' represent H, $NH_2$ or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| S—O Valence Stabilizer #35: Mercapto Alcohols and Silylmercaptoalcohols, Bis(mercapto alcohols and Silylmercaptoalcohols), and Poly(mercapto alcohols and Silylmercaptoalcohols) (S—O Bidentates, S— | R—CH(—SH)—CH(—OH)—R' for alpha-mercapto alcohols, R—CH(—SH)—Si(—OR')$_x$—R"$_{3-x}$ for alpha-silylmercaptoalcohols, R—CH(—SH)—R'—CH(—OH)—R" for beta-mercapto alcohols, and R—CH(—SH)—R'—Si(—OR")$_x$—R'"$_{3-x}$ for beta-silylmercaptoalcohols, etc., where R, R', R", |

TABLE 3-continued

Narrow Band Organic Valence Stabilizers for the $Co^{+3}$ ion

| General Structural Name (Type of Organic) | Structural Representation |
|---|---|
| O Tridentates, S—O Tetradentates) | and R''' represent H, $NH_2$ or any organic functional group wherein the number of carbon atoms ranges from 0 to 40, optionally having halogen or polarizing or water-insolubilizing/solubilizing groups attached. x = 1–3. Ligand can also contain nonbinding N, O, S, or P atoms. |
| S—O Valence Stabilizer #36: Monothiocarbimates, Bis(monothiocarbimates), and Poly(monothiocarbimates) (S—O Bidentates, S—O Tridentates, and S—O Tetradentates) | RN═C(OH)(SH), where R represents H, $NH_2$ or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| S—O Valence Stabilizer #37: Alkyl- and Aryl- Monothioborates and Bis(monothioborates) (S—O Bidentates and S—O Tetradentates) | R—O—C(—S—R'')—O—R', where R, R', and R'' represent H, $NH_2$ or any organic functional group wherein the number of carbon atoms ranges from 0 to 40, optionally having halogen or polarizing or water-msombilizing/solubilizing groups attached. Ligand can also contain nonbinding N, O, S, or P atoms. |
| S—O Valence Stabilizer #38: Alkyl- and Aryl- Monothioboronates and Bis(monothioboronates) (S—O Bidentates and S—O Tetradentates) | R—C(—S—R'')—O—R', where R, R', and R'' represent H, $NH_2$ or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| S—O Valence Stabilizer #39: Monothioarsonic Acids (Arsonothioic Acids), Bis(monothioarsonic acids), Poly(monothioarsonic acids), and derivatives thereof (S—O Bidentates, S—O Tridentates, S—O Tetradentates) | (O═)As(—S—R)(—O—R')(—O—R'') or (S═)As(—O—R)(—O—R')(—O—R''), where R, R', and R'' represent H, $NH_2$ or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| S—O Valence Stabilizer #40: Heterocyclic Rings containing One or Two Sulfur Atoms at least one additional Oxygen Atom Binding Site not in a Ring (S—O Bidentates, S—O Tridentates, S—O Tetradentates, or S—O Hexadentates) | Heterocyclic ring(s) containing one or two sulfur atoms. In addition, ligand contains additional oxygen-containing substituents (usually hydroxy, carboxy, or carbonyl groups) that constitute O binding sites. Can include other ring systems bound to the heterocyclic ring or to the O-containing substituent, but they do not coordinate with the stabilized, high valence metal ion. Ring(s) can also contain O, N, P, As or Se atoms. This 5-membered ring(s) and/or attached, uncoordinating rings and/or O-containing substituent(s) may or may not have halogen or polarizing or water-insolubilizing/solubilizing groups attached. |
| S—O Valence Stabilizer #41: Heterocyclic Rings containing One or Two Oxygen Atoms at least one additional Sulfur Atom Binding Site not in a Ring (S—O Bidentates, S—O Tridentates, S—O Tetradentates, or S—O Hexadentates) | Heterocyclic ring(s) containing one or two oxygen atoms. In addition, ligand contains additional sulfur-containing substituents (usually thio, mercapto, or thiocarbonyl groups) that constitute S binding sites. Can include other ring systems bound to the heterocyclic ring or to the S-containing substituent, but they do not coordinate with the stabilized, high valence metal ion. Ring(s) can also contain O, N, P, As or Se atoms. This 5-membered ring(s) and/or attached, uncoordinating rings and/or S-containing substituent(s) may or may not have halogen or polarizing or water-insolubilizing/solubilizing groups attached. |
| S—O Valence Stabilizer #42: Heterocyclic Rings containing One or Two Sulfur Atoms at least one additional Oxygen Atom Binding Site in a separate Ring (S—O Bidentates, S—O Tridentates, S—O Tetradentates, or S—O Hexadentates) | Heterocyclic ring(s) containing one or two sulfur atoms. In addition, ligand contains additional oxygen-containing rings that constitute O binding sites. Can include other ring systems bound to the O-containing heterocyclic rings, but they do not coordinate with the stabilized, high valence metal ion. |

TABLE 3-continued

Narrow Band Organic Valence Stabilizers for the $Co^{+3}$ ion

| General Structural Name (Type of Organic) | Structural Representation |
|---|---|
| | Ring(s) can also contain O, N, P, As, or Se atoms. This 5-membered ring(s) and/or additional O-containing ring(s) and/or attached, uncoordinating rings may or may not have halogen or polarizing or water-insolubilizing/solubilizing groups attached. |
| S—O Valence Stabilizer #43: Two-, Three-, Four-, Five-, Six-, Seven-, Eight-, Nine-, and Ten-Membered Macrocyclics, Macrobicyclics, and Macropolycyclics (including Catapinands, Cryptands, Cyclidenes, and Sepulchrates) wherein all Binding Sites are composed of Sulfur (usually thiol, mercapto, or thiocarbonyl groups) or Oxygen (hydroxy, carboxy, or carbonyl groups) and are not contained in Component Heterocyclic Rings (S—O Bidentates, S—O Tridentates, S—O Tetradentates, and S—O Hexadentates) | Macrocyclic ligands containing two to ten sulfur or oxygen binding sites to valence stabilize the central metal ion. Can include other hydrocarbon or ring systems bound to this macrocyclic ligand, but they do not coordinate with the stabilized, high valence metal ion. This ligand and/or attached, uncoordinating hydrocarbons/rings may or may not have halogen or polarizing or water-insolubilizing/solubilizing groups attached. |
| S—O Valence Stabilizer #44: Four-, Five-, Six-, Seven-, Eight-, Nine-, or Ten-Membered Macrocyclics, Macrobicyclics, and Macropolycyclics (including Catapinands, Cryptands, Cyclidenes, and Sepulchrates) wherein all Binding Sites are composed of Sulfur or Oxygen and are contained in Component 5-Membered Heterocyclic Rings (S—O Tridentates, S—O Tetradentates or S—O Hexadentates) | Macrocyclic ligands containing a total of four to ten five-membered heterocyclic rings containing sulfur or oxygen binding sites. Can include other hydrocarbon/ring systems bound to this macrocyclic ligand, but they do not coordinate with the stabilized, high valence metal ion. This ligand and/or attached, uncoordinating hydrocarbon/rings may or may not have halogen or polarizing or water-insolubilizing groups attached. |
| S—O Valence Stabilizer #45: Four-, Five-, Six-, Seven-, Eight-, Nine-, or Ten-Membered Macrocyclics, Macrobicyclics, and Macropolycyclics (including Catapinands, Cryptands, Cyclidenes, and Sepulchrates) wherein all Binding Sites are composed of Sulfur or Oxygen and are contained in a Combination of Heterocyclic Rings and Thiol, Mercapto, Thiocarbonyl, Hydroxy, Carboxy, and Carbonyl Groups (S—O Tridentates, S—O Tetradentates, or S—O Hexadentates) | Macrocyclic ligands containing at least one heterocyclic ring. These heterocyclic rings provide sulfur or oxygen binding sites to valence stabilize the central metal ion. Other thiol, mercapto, thiocarbonyl, hydroxy, carboxy, or carbonyl binding sites can also be included in the macrocyclic ligand, so long as the total number of binding sites is four to ten. Can include other hydrocarbon/ring systems bound to this macrocyclic ligand, but they do not coordinate with the stabilized, high valence metal ion. This ligand and/or attached, uncoordinating hydrocarbon/rings may or may not have halogen or polarizing or water-insolubilizing groups attached. |
| S—O Valence Stabilizer #46: Sulfoxides (S—O Bidentates) | Sulfoxides (R—SO—R'), where R and R' represent H or any organic functional group wherein the number of carbon atoms ranges from 0 to 35, optionally having halogen or polarizing or water-insolubilizing/solubilizing groups attached. |
| S—O Valence Stabilizer #47: Sulfones (S—O Bidentates) | Sulfones ($R—SO_2—R'$), where R and R' represent H or any organic functional group wherein the number of carbon atoms ranges from 0 to 35, optionally having halogen or polarizing or water-insolubilizing/solubilizing groups attached. |
| S—O Valence Stabilizer #48: Sulfur dioxide ($SO_2$) ligands (S—O Bidentates) | Sulfur dioxide ligands ($—SO_2$) bound directly to the high valence metal ion. |
| N—P Valence Stabilizer #1: Aminoaryl Phosphines and Iminoaryl Phosphines (N—P Bidentates, N—P Tridentates, and N—P Tetradentates) | $[R(—NR'R'')(—PR'''R'''')]$, $[R(—NR'R'')_x]]_{1-3}P$, $[R(—NR'R'')_x]_{1-3}PX$, or $[R(—PR'R'')x]_{1-3}N$, where X = O or S and R, R', R'', R''', and R'''' represents H, $NH_2$ or any organic functional group wherein the number of carbon atoms ranges from 0 to 35, optionally having halogen or polarizing or water-insolubilizing/solubilizing groups attached. Ligand can also contain nonbinding N, P, O, S, or Se atoms. |
| N—P Valence Stabilizer #2: Heterocyclic Rings containing One, Two, Three, or Four Nitrogen Atoms and having at least one additional Phosphorus Atom Binding Site not in a Ring (N—P Bidentates, | Five membered heterocyclic ring(s) containing one, two, three, or four nitrogen atoms. In addition, ligand contains additional phosphorus-containing substituents that constitute P binding sites. Can include other ring systems bound to |

TABLE 3-continued

Narrow Band Organic Valence Stabilizers for the $Co^{+3}$ ion

| General Structural Name (Type of Organic) | Structural Representation |
|---|---|
| N—P Tridentates, N—P Tetradentates, or N—P Hexadentates) | the heterocyclic ring or to the P-containing substituent, but they do not coordinate with the stabilized, high valence metal ion. Ring(s) can also contain O, S, or P atoms. This ring(s) and/or attached, uncoordinating rings and/or P-containing substituent(s) may or may not have halogen or polarizing or water-insolubilizing/solubilizing groups attached. |
| N—P Valence Stabilizer #3: Heterocyclic Rings containing One, Two, or Three Phosphorus Atoms and having at least one additional Nitrogen Atom Binding Site not in a Ring (N—P Bidentates, N—P Tridentates, N—P Tetradentates, or N—P Hexadentates) | Five membered heterocyclic ring(s) containing one, two, or three phosphorus atoms. In addition, ligand contains additional nitrogen-containing substituents (usually amines, imines, or hydrazides) that constitute N binding sites. Can include other ring systems bound to the heterocyclic ring or to the N-containing substituent, but they do not coordinate with the stabilized, high valence metal ion. Ring(s) can also contain O, S, or P atoms. This ring(s) and/or attached, uncoordinating rings and/or N-containing substituent(s) may or may not have halogen or polarizing or water-insolubilizing/solubilizing groups attached. |
| N—P Valence Stabilizer #4: Heterocyclic Rings containing One, Two, Three, or Four Nitrogen Atoms and having at least one additional Phosphorus Atom Binding Site in a Separate Ring (N—P Bidentates, N—P Tridentates, N—P Tetradentates) | Heterocyclic ring(s) containing one, two, three, or four nitrogen atoms. In addition, ligand contains additional phosphorus-containing rings that constitute P binding sites. Can include other ring systems bound to the N- or P-containing heterocyclic rings, but they do not coordinate with the stabilized, high valence metal ion. Ring(s) can also contain O, S, or P atoms. This ring(s) and/or additional P-containing ring(s) and/or attached, uncoordinating rings may or may not have halogen or polarizing or water-insolubilizing/solubilizing groups attached. |
| N—P Valence Stabilizer #5: Two-, Three-, Four-, Five-, Six-, Seven-, Eight-, Nine-, and Ten-Membered Macrocyclics, Macrobicyclics, and Macropolycyclics (including Catapinands, Cryptands, Cyclidenes, and Sepulchrates) wherein all Binding Sites are composed of Nitrogen (usually amine or imine groups) or Phosphorus and are not contained in Component Heterocyclic Rings (N—P Bidentates, N—P Tridentates, N—P Tetradentates, and N—P Hexadentates) | Macrocyclic ligands containing two, three, four, five, six, seven, eight, nine, or ten binding sites composed of nitrogen and phosphorus to valence stabilize the central metal ion. Can include other hydrocarbon or ring systems bound to this macrocyclic ligand, but they do not coordinate with the stabilized, high valence metal ion. This ligand and/or attached, uncoordinating hydrocarbons/rings may or may not have halogen or polarizing or water-insolubilizing/solubilizing groups attached. |
| N—P Valence Stabilizer #6: Four-, Five-, Six-, Seven-, Eight-, Nine-, or Ten-Membered Macrocyclics, Macrobicyclics, and Macropolycyclics (including Catapinands, Cryptands, Cyclidenes, and Sepulchrates) wherein all Binding Sites are composed of Nitrogen or Phosphorus and are contained in Component Heterocyclic Rings (N—P Bidentates, N—P Tridentates, N—P Tetradentates, or N—P Hexadentates) | Macrocyclic ligands containing a total of four, five, six, seven, eight, nine, or ten heterocyclic rings containing nitrogen or phosphorus binding sites. Can include other hydrocarbon/ring systems bound to this macrocyclic ligand, but they do not coordinate with the stabilized, high valence metal ion. This ligand and/or attached, uncoordinating hydrocarbon/rings may or may not have halogen or polarizing or water-insolubilizing groups attached. |
| N—P Valence Stabilizer #7: Four-, Five-, Six-, Seven-, Eight-, Nine-, or Ten-Membered Macrocyclics, Macrobicyclics, and Macropolycyclics (including Catapinands, Cryptands, Cyclidenes, and Sepulchrates) wherein all Binding Sites are composed of Nitrogen or Phosphorus and are contained in a Combination of Heterocyclic Rings and Amine, Imine, and Phosphine Groups (N—P Bidentates, N—P Tridentates, N—P Tetradentates, or N—P Hexadentates) | Macrocyclic ligands containing at least one heterocyclic ring. These heterocyclic rings provide nitrogen or phosphorus binding sites to valence stabilize the central metal ion. Other amine, imine, or phosphine binding sites can also be included in the macrocyclic ligand, so long as the total number of binding sites is four, five, six, seven, eight, nine, or ten. Can include other hydrocarbon/ring systems bound to this macrocyclic ligand, but they do not coordinate with the stabilized, high valence metal ion. This ligand and/or attached, uncoordinating hydrocarbon/rings may or may not have halogen or polarizing or water-insolubilizing groups attached. |

TABLE 3-continued

Narrow Band Organic Valence Stabilizers for the $Co^{+3}$ ion

| General Structural Name (Type of Organic) | Structural Representation |
|---|---|
| S—P Valence Stabilizer #1: Thioaryl Phosphines (S—P Bidentates, S—P Tridentates, and S—P Tetradentates) | $[R(—SR')_x]_{1-3}P$, $[R(—SR')_x]_{1-3}PX$, [R(—PR'R")(—SR'")], [R(—PR'R")(—S—S—R'")], [R(—PR'R")(—C(=S)R'"], $[R(—PR'R")_x]_2S$, $[R(—PR'R")_x]_{2-3}R'"(—SR'")_y$, $[R(—SR')_x]_{2-3}R"(—PR'"R'")y$, $[R(—PR'R")_x]_2S_2$, and $[R(—PR'R")_x]_2R'"(C(—S))_yR'"$, where X = O or S, and R, R', R", R'", and R'" represent H, $NH_2$, or any organic functional group wherein the number of carbon atoms ranges from 0 to 40, optionally having halogen or polarizing or water-insolubilizing/solubilizing groups attached, and x = 1–2 and y = 1–4. Ligand can also contain nonbinding N, O, S, or P atoms. |
| S—P Valence Stabilizer #2: Heterocyclic Rings containing One or Two Sulfur Atoms and having at least one additional Phosphorus Atom Binding Site not in a Ring (P—S Bidentates, P—S Tridentates, P—S Tetradentates, or P—S Hexadentates) | Heterocyclic ring(s) containing one or two sulfur atoms. In addition, ligand contains additional phosphorus-containing substituents that constitute P binding sites. Can include other ring systems bound to the heterocyclic ring or to the P-containing substituent, but they do not coordinate with the stabilized, high valence metal ion. Ring(s) can also contain O, S, or P atoms. This ring(s) and/or attached, uncoordinating rings and/or P-containing substituent(s) may or may not have halogen or polarizing or water-insolubilizing/solubilizing groups attached. |
| S—P Valence Stabilizer #3: Heterocyclic Rings containing One, Two, or Three Phosphorus Atoms and having at least one additional Sulfur Atom Binding Site not in a Ring (S—P Bidentates, S—P Tridentates, S—P Tetradentates, or S—P Hexadentates) | Heterocyclic ring(s) containing one, two, or three phosphorus atoms. In addition, ligand contains additional sulfur-containing substituents (usually thiol, mercapto, or thiocarbonyl groups) that constitute S binding sites. Can include other ring systems bound to the heterocyclic ring or to the S-containing substituent, but they do not coordinate with the stabilized, high valence metal ion. Ring(s) can also contain O, S, or P atoms. This ring(s) and/or attached, uncoordinating rings and/or S-containing substituent(s) may or may not have halogen or polarizing or water-insolubilizing/solubilizing groups attached. |
| S—P Valence Stabilizer #4: Heterocyclic Rings containing One or Two Sulfur Atoms and having at least one additional Phosphorus Atom Binding Site in a Separate Ring (S—P Bidentates, S—P Tridentates, S—P Tetradentates) | Heterocyclic ring(s) containing one or two sulfur atoms. In addition, ligand contains additional phosphorus-containing rings that constitute P binding sites. Can include other ring systems bound to the S- or P-containing heterocyclic rings, but they do not coordinate with the stabilized, high valence metal ion. Ring(s) can also contain O, S, or P atoms. This ring(s) and/or additional P-containing ring(s) and/or attached, uncoordinating rings may or may not have halogen or polarizing or water-insolubilizing/solubilizing groups attached. |
| S—P Valence Stabilizer #5: Two-, Three-, Four-, Five-, Six-, Seven-, Eight-, Nine-, and Ten-Membered Macrocyclics, Macrobicyclics, and Macropolycyclics (including Catapinands, Cryptands, Cyclidenes, and Sepulchrates) wherein all Binding Sites are composed of Sulfur (usually thiol, mercapto, or thiocarbonyl groups) or Phosphorus and are not contained in Component Heterocyclic Rings (S—P Bidentates, S—P Tridentates, S—P Tetradentates, and S—P Hexadentates) | Macrocyclic ligands containing two, three, four, five, six, seven, eight, nine, or ten binding sites composed of sulfur and phosphorus to valence stabilize the central metal ion. Can include other hydrocarbon or ring systems bound to this macrocyclic ligand, but they do not coordinate with the stabilized, high valence metal ion. This ligand and/or attached, uncoordinating hydrocarbons/rings may or may not have halogen or polarizing or water-insolubilizing/solubilizing groups attached. |
| S—P Valence Stabilizer #6: Four-, Five-, Six-, Seven-, Eight-, Nine-, or Ten-Membered Macrocyclics, Macrobicyclics, and Macropolycyclics (including Catapinands, Cryptands, Cyclidenes, and Sepulchrates) wherein all Binding Sites are composed of Sulfur or Phosphorus and are contained in Component Heterocyclic Rings (S—P Bidentates, S—P Tridentates, S—P | Macrocyclic ligands containing a total of four, five, six, seven, eight, nine, or ten heterocyclic rings containing sulfur or phosphorus binding sites. Can include other hydrocarbon/ring systems bound to this macrocyclic ligand, but they do not coordinate with the stabilized, high valence metal ion. This ligand and/or attached, uncoordinating hydrocarbon/rings may or may not have halogen or polarizing or water-insolubilizing groups attached. |

TABLE 3-continued

Narrow Band Organic Valence Stabilizers for the $Co^{+3}$ ion

| General Structural Name (Type of Organic) | Structural Representation |
|---|---|
| Tetradentates, or S—P Hexadentates) | |
| S—P Valence Stabilizer #7: Four-, Five-, Six-, Seven-, Eight-, Nine-, or Ten-Membered Macrocyclics, Macrobicyclics, and Macropolycyclics (including Catapinands, Cryptands, Cyclidenes, and Sepulchrates) wherein all Binding Sites are composed of Sulfur or Phosphorus and are contained in a Combination of Heterocyclic Rings and Thiol, Mercapto, Thiocarbonyl or Phosphine Groups (S—P Bidentates, S—P Tridentates, S—P Tetradentates, or S—P Hexadentates) | Macrocyclic ligands containing at least one heterocyclic ring. These heterocyclic rings provide sulfur or phosphorus binding sites to valence stabilize the central metal ion. Other thiol, mercapto, or thiocarbonyl, or phosphine binding sites can also be included in the macrocyclic ligand, so long as the total number of binding sites is four, five, six, seven, eight, nine, or ten. Can include other hydrocarbon/ring systems bound to this macrocyclic ligand, but they do not coordinate with the stabilized, high valence metal ion. This ligand and/or attached, uncoordinating hydrocarbon/rings may or may not have halogen or polarizing or water-insolubilizing groups attached. |
| P—O Valence Stabilizer #1: Hydroxyaryl Phosphines (P—O Bidentates, P—O Tridentates, and P—O Tetradentates) | $[R(—OR')_x]_{1–3}P$, $[R(—OR')_x]_{1–3}PX$, $[R(—PR'R'')(—OR''')]$, $[R(—PR'R'')(—C(=O)R''')]$, $[R(—PR'R'')_x]_2O$, $[R(—PR'R'')_x]_{2–3}R'''(—OR'''')_y$, $[R(—OR')_x]_{2–3}R''(—PR'''R'''')_y$, and $[R(—PR'R'')_x]_2R'''(C(=O))_yR''''$, where X = O or S, and R, R', R'', R''', and R'''' represent H, $NH_2$, or any organic functional group wherein the number of carbon atoms ranges from 0 to 40, optionally having halogen or polarizing or water-insolubilizing/solubilizing groups attached, and x = 1–2 and y = 1–4. Ligand can also contain nonbinding N, O, S, or P atoms. |
| P—O Valence Stabilizer #2: Heterocyclic Rings containing One or Two Oxygen Atoms and having at least one additional Phosphorus Atom Binding Site not in a Ring (P—O Bidentates, P—O Tridentates, P—O Tetradentates, or P—O Hexadentates) | Heterocyclic ring(s) containing one or two oxygen atoms. In addition, ligand contains additional phosphorus-containing substituents that constitute P binding sites. Can include other ring systems bound to the heterocyclic ring or to the P-containing substituent, but they do not coordinate with the stabilized, high valence metal ion. Ring(s) can also contain O, S, or P atoms. This ring(s) and/or attached, uncoordinating rings and/or P-containing substituent(s) may or may not have halogen or polarizing or water-insolubilizing/solubilizing groups attached. |
| P—O Valence Stabilizer #3: Heterocyclic Rings containing One, Two, or Three Phosphorus Atoms and having at least one additional Oxygen Atom Binding Site not in a Ring (P—O Bidentates, P—O Tridentates, P—O Tetradentates, or P—O Hexadentates) | Heterocyclic ring(s) containing one, two, or three phosphorus atoms. In addition, ligand contains additional oxygen-containing substituents (usually hydroxy, carboxy, or carbonyl groups) that constitute O binding sites. Can include other ring systems bound to the heterocyclic ring or to the O-containing substituent, but they do not coordinate with the stabilized, high valence metal ion. Ring(s) can also contain O, S, or P atoms. This ring(s) and/or attached, uncoordinating rings and/or O-containing substituent(s) may or may not have halogen or polarizing or water-insolubilizing/solubilizing groups attached. |
| P—O Valence Stabilizer #4: Heterocyclic Rings containing One or Two Oxygen Atoms at least one additional Phosphorus Atom Binding Site in a Separate Ring (P—O Bidentates, P—O Tridentates, P—O Tetradentates) | Heterocyclic ring(s) containing one or two oxygen atoms. In addition, ligand contains additional phosphorus-containing rings that constitute P binding sites. Can include other ring systems bound to the O- or P-containing heterocyclic rings, but they do not coordinate with the stabilized, high valence metal ion. Ring(s) can also contain O, S, or P atoms. This ring(s) and/or additional P-containing ring(s) and/or attached, uncoordinating rings may or may not have halogen or polarizing or water-insolubilizing/solubilizing groups attached. |
| P—O Valence Stabilizer #5: Two-, Three-, Four-, Five-, Six-, Seven-, Eight-, Nine-, and Ten-Membered Macrocyclics, Macrobicyclics, and Macropolycyclics (including Catapinands, Cryptands, Cyclidenes, and Sepulchrates) | Macrocyclic ligands containing two, three, four, five, six, seven, eight, nine, or ten binding sites composed of oxygen and phosphorus to valence stabilize the central metal ion. Can include other hydrocarbon or ring systems bound to this macrocyclic ligand, but they do not coordinate |

TABLE 3-continued

Narrow Band Organic Valence Stabilizers for the $Co^{+3}$ ion

| General Structural Name (Type of Organic) | Structural Representation |
|---|---|
| wherein all Binding Sites are composed of Oxygen (usually hydroxy, carboxy, or carbonyl groups) or Phosphorus and are not contained in Component Heterocyclic Rings (P—O Bidentates, P—O Tridentates, P—O Tetradentates, and P—O Hexadentates) | with the stabilized, high valence metal ion. This ligand and/or attached, uncoordinating hydrocarbons/rings may or may not have halogen or polarizing or water-insolubilizing/solubilizing groups attached. |
| P—O Valence Stabilizer #6: Four-, Five-, Six-, Seven-, Eight-, Nine-, or Ten-Membered Macrocyclics, Macrobicyclics, and Macropolycyclics (including Catapinands, Cryptands, Cyclidenes, and Sepulchrates) wherein all Binding Sites are composed of Oxygen or Phosphorus and are contained in Component Heterocyclic Rings (P—O Bidentates, P—O Tridentates, P—O Tetradentates, or P—O Hexadentates) | Macrocyclic ligands containing a total of four, five, six, seven, eight, nine, or ten heterocyclic rings containing oxygen or phosphorus binding sites. Can include other hydrocarbon/ring systems bound to this macrocyclic ligand, but they do not coordinate with the stabilized, high valence metal ion. This ligand and/or attached, uncoordinating hydrocarbon/rings may or may not have halogen or polarizing or water-insolubilizing groups attached. |
| P—O Valence Stabilizer #7: Four-, Five-, Six-, Seven-, Eight-, Nine-, or Ten-Membered Macrocyclics, Macrobicyclics, and Macropolycyclics (including Catapinands, Cryptands, Cyclidenes, and Sepulchrates) wherein all Binding Sites are composed of Oxygen or Phosphorus and are contained in a Combination of Heterocyclic Rings and Hydroxy, Carboxy, Carbonyl or Phosphine Groups (P—O Bidentates, P—O Tridentates, P—O Tetradentates, or P—O Hexadentates) | Macrocyclic ligands containing at least one heterocyclic ring. These heterocyclic rings provide oxygen or phosphorus binding sites to valence stabilize the central metal ion. Other hydroxy, carboxy, carbonyl, or phosphine binding sites can also be included in the macrocyclic ligand, so long as the total number of binding sites is four, five, six, seven, eight, nine, or ten. Can include other hydrocarbon/ring systems bound to this macrocyclic ligand, but they do not coordinate with the stabilized, high valence metal ion. This ligand and/or attached, uncoordinating hydrocarbon/rings may or may not have halogen or polarizing or water-insolubilizing groups attached. |
| As Valence Stabilizer #1: Monoarsines (As Monodentates) wherein at least one Arsenic Atom is a Binding Site | $AsH_3$, $AsH_2R$, $AsHR_2$, where R represents H or any organic functional group wherein the number of carbon atoms ranges from 0 to 25, optionally having halogen or polarizing or water-insolubilizing/solubilizing groups attached. Ligand can also contain nonbinding N, P, As, O, S, or Se atoms. |
| As Valence Stabilizer #2: Diarsines (an As—As Bidentate) wherein at least one Arsenic Atom is a Binding Site | R'—As—R—As—R'', where R, R', and R'' represent H or any organic functional group wherein the number of carbon atoms ranges from 0 to 25, optionally having halogen or polarizing or water-insolubilizing/solubilizing groups attached. Ligand can also contain nonbinding N, P, As, O, S, or Se atoms. |
| As Valence Stabilizer #3: Triarsines (either As—As Bidentates or As—As Tridentates) wherein at least one Arsenic Atom is a Binding Site | R—As—R'—As—R'—As—R''', where R, R', R'', and R''' represent H or any organic functional group wherein the number of carbon atoms ranges from 0 to 25, optionally having halogen or polarizing or water-insolubilizing/solubilizing groups attached. Ligand can also contain nonbinding N, P, As, O, S, or Se atoms. |
| As Valence Stabilizer #4: Tetraarsines (As—As Bidentates, As—As Tridentates, or As—As Tetradentates) wherein at least one Arsenic Atom is a Binding Site | R—As—R'—As—R''—As—R'''—As—R'''', where R, R', R'', R''', and R'''' represent H or any organic functional group wherein the number of carbon atoms ranges from 0 to 25, optionally having halogen or polarizing or water-insolubilizing/solubilizing groups attached. Ligand can also contain nonbinding N, P, As, O, S, or Se atoms. |
| As Valence Stabilizer #5: Pentaarsines (As—As Bidentates, As—As Tridentates, or As—As Tetradentates) wherein at least one Arsenic Atom is a Binding Site | R—As—R'—As—R''—As—R'''—As—R'''—As—R'''', where R, R', R'', R''', R'''', and R''''' represent H or any organic functional group wherein the number of carbon atoms ranges from 0 to 25, optionally having halogen or polarizing or water-insolubilizing/solubilizing groups attached. Ligand can also contain nonbinding N, P, As, O, S, or Se atoms. |
| As Valence Stabilizer #6: Hexaarsines (As—As Bidentates, As—As Tridentates, As—As Tetradentates, or As—As | R—As—R'—As—R''—As—R'''—As—R'''—As—R''''—As-R''''', where R, R', R'', R''', R'''', R''''', and R'''''' represent H or any organic functional |

TABLE 3-continued

Narrow Band Organic Valence Stabilizers for the $Co^{+3}$ ion

| General Structural Name (Type of Organic) | Structural Representation |
|---|---|
| Hexadentates) wherein at least one Arsenic Atom is a Binding Site | group wherein the number of carbon atoms ranges from 0 to 25, optionally having halogen or polarizing or water-insolubilizing/solubilizing groups attached. Ligand can also contain nonbinding N, P, As, O, S, or Se atoms. |
| As Valence Stabilizer #7: Five-Membered Heterocyclic Rings containing One Arsenic Atom wherein the Arsenic Atom is the Binding Site (As Monodentates) | Five membered heterocyclic ring containing just one arsenic binding site. Can include other ring systems bound to this heterocyclic ring, but they do not coordinate with the stabilized, high valence metal ion. Ring can also contain O, S, N, P, or Se atoms. This 5-membered ring and/or attached, uncoordinating rings may or may not have halogen or polarizing or water-insolubilizing/solubilizing groups attached. |
| As Valence Stabilizer #8: Six-Membered Heterocyclic Rings containing One Arsenic Atom wherein the Arsenic Atom is the Binding Site (As Monodentates) | Six membered heterocyclic ring containing just one arsenic binding site. Can include other ring systems bound to this heterocyclic ring, but they do not coordinate with the stabilized, high valence metal ion. Ring can also contain O, S, N, P, or Se atoms. This 6-membered ring and/or attached, uncoordinating rings may or may not have halogen or polarizing or water-insolubilizing/solubilizing groups attached. |
| As Valence Stabilizer #9: Five-Membered Heterocyclic Rings containing One Arsenic Atom and having at least one additional Arsenic Atom Binding Site not in a Ring (As Monodentates, As—As Bidentates, As—As Tridentates, As—As Tetradentates, or As—As Hexadentates) | Five membered heterocyclic ring(s) containing one arsenic atom. In addition, ligand contains additional arsenic-containing substituents (usually arsines) that constitute As binding sites. Can include other ring systems bound to the heterocyclic ring or to the As-containing substituent, but they do not coordinate with the stabilized, high valence metal ion. Ring(s) can also contain O, N, S, P or Se atoms. This 5-membered ring(s) and/or attached, uncoordinating rings and/or As-containing substituent(s) may or may not have halogen or polarizing or water-insolubilizing/solubilizing groups attached. |
| As Valence Stabilizer #10: Six-Membered Heterocyclic Rings containing One Arsenic Atom and having at least one additional Arsenic Atom Binding Site not in a Ring (As Monodentates, As—As Bidentates, As—As Tridentates, As—As Tetradentates, or As—As Hexadentates) | Six membered heterocyclic ring(s) containing one arsenic atom. In addition, ligand contains additional arsenic-containing substituents (usually arsines) that constitute As binding sites. Can include other ring systems bound to the heterocyclic ring or to the As-containing substituent, but they do not coordinate with the stabilized, high valence metal ion. Ring(s) can also contain O, N, S, P or Se atoms. This 6-membered ring(s) and/or attached, uncoordinating rings and/or As-containing substituent(s) may or may not have halogen or polarizing or water-insolubilizing/solubilizing groups attached. |
| As Valence Stabilizer #11: Five-Membered Heterocyclic Rings containing One Arsenic Atom and having at least one additional Arsenic Atom Binding Site in a separate Ring (As Monodentates, As—As Bidentates, As—As Tridentates, As—As Tetradentates, or As—As Hexadentates) | Five membered heterocyclic ring(s) containing one arsenic atom. In addition, ligand contains additional arsenic-containing rings that constitute As binding sites. Can include other ring systems bound to the As-containing heterocyclic rings, but they do not coordinate with the stabilized, high valence metal ion. Ring(s) can also contain O, N, S, P, or Se atoms. This 5-membered ring(s) and/or additional As-containing ring(s) and/or attached, uncoordinating rings may or may not have halogen or polarizing or water-insolubilizing/solubilizing groups attached. |
| As Valence Stabilizer #12: Six-Membered Heterocyclic Rings containing One Arsenic Atom and having at least one additional Arsenic Atom Binding Site in a separate Ring (As Monodentates, As—As Bidentates, As—As Tridentates, As—As Tetradentates, or As—As Hexadentates) | Six membered heterocyclic ring(s) containing one arsenic atom. In addition, ligand contains additional arsenic-containing rings that constitute As binding sites. Can include other ring systems bound to the As-containing heterocyclic rings, but they do not coordinate with the stabilized, high valence metal ion. Ring(s) can also contain O, N, S, P, or Se atoms. This 6-membered ring(s) and/or |

TABLE 3-continued

Narrow Band Organic Valence Stabilizers for the $Co^{+3}$ ion

| General Structural Name (Type of Organic) | Structural Representation |
|---|---|
| | additional As-containing ring(s) and/or attached, uncoordinating rings may or may not have halogen or polarizing or water-insolubilizing/solubilizing groups attached. |
| As Valence Stabilizer #13: Two-, Three-, Four-, and Six-Membered Macrocyclics, Macrobicyclics, and Macropolycyclics (including Catapinands, Cryptands, Cyclidenes, and Sepulchrates) wherein all Binding Sites are composed of Arsenic and are not contained in Component Heterocyclic Rings (As—As Bidentates, As—As Tridentates, As—As Tetradentates, and As—As Hexadentates) | Macrocyclic ligands containing two, three, four, or six arsenic binding sites to valence stabilize the central metal ion. Can include other hydrocarbon or ring systems bound to this macrocyclic ligand, but they do not coordinate with the stabilized, high valence metal ion. This ligand and/or attached, uncoordinating hydrocarbons/rings may or may not have halogen or polarizing or water-insolubilizing/solubilizing groups attached. |
| As Valence Stabilizer #14: Four-, or Six-Membered Macrocyclics, Macrobicyclics, and Macropolycyclics (including Catapinands, Cryptands, Cyclidenes, and Sepulchrates) wherein all Binding Sites are composed of Arsenic and are contained in Component 5-Membered Heterocyclic Rings (As—As Tridentates, As—As Tetradentates, or As—As Hexadentates) | Macrocyclic ligands containing a total of four or six five-membered heterocyclic rings containing arsenic binding sites. Can include other hydrocarbon/ring systems bound to this macrocyclic ligand, but they do not coordinate with the stabilized, high valence metal ion. This ligand and/or attached, uncoordinating hydrocarbon/rings may or may not have halogen or polarizing or water-insolubilizing groups attached. |
| As Valence Stabilizer #15: Four-, or Six-Membered Macrocyclics, Macrobicyclics, and Macropolycyclics (including Catapinands, Cryptands, Cyclidenes, and Sepulchrates) wherein all Binding Sites are composed of Arsenic and are contained in a Combination of 5-Membered Heterocyclic Rings and Arsine Groups (As—As Tridentates, As—As Tetradentates, or As—As Hexadentates) | Macrocyclic ligands containing at least one 5-membered heterocyclic ring. These heterocyclic rings provide arsenic binding sites to valence stabilize the central metal ion. Other arsine binding sites can also be included in the macrocyclic ligand, so long as the total number of binding sites is four or eight. Can include other hydrocarbon/ring systems bound to this macrocyclic ligand, but they do not coordinate with the stabilized, high valence metal ion. This ligand and/or attached, uncoordinating hydrocarbon/rings may or may not have halogen or polarizing or water-insolubilizing groups attached. |
| As Valence Stabilizer #16: Four-, or Six-Membered Macrocyclics, Macrobicyclics, and Macropolycyclics (including Catapinands, Cryptands, Cyclidenes, and Sepulchrates) wherein all Binding Sites are composed of Arsenic and are contained in Component 6-Membered Heterocyclic Rings (As—As Tridentates, As—As Tetradentates, or As—As Hexadentates) | Macrocyclic ligands containing a total of four or six six-membered heterocyclic rings containing arsenic binding sites. Can include other hydrocarbon/ring systems bound to this macrocyclic ligand, but they do not coordinate with the stabilized, high valence metal ion. This ligand and/or attached, uncoordinating hydrocarbon/rings may or may not have halogen or polarizing or water-insolubilizing groups attached. |
| As Valence Stabilizer #17: Four-, or Six-Membered Macrocyclics, Macrobicyclics, and Macropolycyclics (including Catapinands, Cryptands, Cyclidenes, and Sepulchrates) wherein all Binding Sites are composed of Arsenic and are contained in a Combination of 6-Membered Heterocyclic Rings and Arsine Groups (As—As Tridentates, As—As Tetradentates, or As—As Hexadentates) | Macrocyclic ligands containing at least one 6-membered heterocyclic ring. These heterocyclic rings provide arsenic binding sites to valence stabilize the central metal ion. Other arsine binding sites can also be included in the macrocyclic ligand, so long as the total number of binding sites is four or six. Can include other hydrocarbon/ring systems bound to this macrocyclic ligand, but they do not coordinate with the stabilized, high valence metal ion. This ligand and/or attached, uncoordinating hydrocarbon/rings may or may not have halogen or polarizing or water-insolubilizing groups attached. |
| Se Valence Stabilizer #1: Monoselenoethers (Se Monodentates) wherein at least one Selenium Atom is a Binding Site | $SeH_2$, SeHR, $SeR_2$, where R represents H or any organic functional group wherein the number of carbon atoms ranges from 0 to 25, optionally having halogen or polarizing or water-insolubilizing/solubilizing groups attached. Ligand can also contain nonbinding N, P, O, S, or Se atoms. |
| Se Valence Stabilizer #2: Diselenoethers (Se—Se Bidentates) wherein at least one Selenium Atom is a Binding Site | R—Se—R'—Se—R", where R, R', and R" represents H or any organic functional group wherein the number of carbon atoms ranges from 0 to 25, optionally having halogen or polarizing or water-insolubilizing/solubilizing groups |

TABLE 3-continued

Narrow Band Organic Valence Stabilizers for the $Co^{+3}$ ion

| General Structural Name (Type of Organic) | Structural Representation |
|---|---|
| | attached. Ligand can also contain nonbinding N, P, O, S, or Se atoms. |
| Se Valence Stabilizer #3: Triselenoethers (Se—Se Bidentates or Se—Se Tridentates) wherein at least one Selenium Atom is a Binding Site | R—Se—R'—Se—R'—Se—R'", where R, R', R", and R'" represents H or any organic functional group wherein the number of carbon atoms ranges from 0 to 25, optionally having halogen or polarizing or water-insolubilizing/solubilizing groups attached. Ligand can also contain nonbinding N, P, O, S, or Se atoms. |
| Se Valence Stabilizer #4: Tetraselenoethers (Se—Se Bidentates, Se—Se Tridentates, or Se—Se Tetradentates) wherein at least one Selenium Atom is a Binding Site | R—Se—R'—Se—R"—Se—R'"—Se—R"", where R, R', R", R'", and R"" represents H or any organic functional group wherein the number of carbon atoms ranges from 0 to 25, optionally having halogen or polarizing or water-insolubilizing/solubilizing groups attached. Ligand can also contain nonbinding N, P, O, S, or Se atoms. |
| Se Valence Stabilizer #5: Five-Membered Heterocyclic Rings containing One or Two Selenium Atoms wherein at least one Selenium Atom is a Binding Site (Se Monodentates or Se—Se Bidentates) | Five membered heterocyclic ring containing one or two selenium atoms, both of which may function as binding sites. Can include other ring systems bound to this heterocyclic ring, but they do not coordinate with the stabilized, high valence metal ion. Ring can also contain O, N, P, As, or S atoms. This 5-membered ring and/or attached, uncoordinating rings may or may not have halogen or polarizing or water-insolubilizing/solubilizing groups attached. |
| Se Valence Stabilizer #6: Six-Membered Heterocyclic Rings containing One or Two Selenium Atoms wherein at least one Selenium Atom is a Binding Site (Se Monodentates or Se—Se Bidentates) | Six membered heterocyclic ring containing one or two selenium atoms, both of which may function as binding sites. Can include other ring systems bound to this heterocyclic ring, but they do not coordinate with the stabilized, high valence metal ion. Ring can also contain O, N, P, As, or S atoms. This 5-membered ring and/or attached, uncoordinating rings may or may not have halogen or polarizing or water-insolubilizing/solubilizing groups attached. |
| Se Valence Stabilizer #7: Five-Membered Heterocyclic Rings containing One Selenium Atom and having at least one additional Selenium Atom Binding Site not in a Ring (Se Monodentates, Se—Se Bidentates, Se—Se Tridentates, Se—Se Tetradentates, or Se—Se Hexadentates) | Five membered heterocyclic ring(s) containing one selenium atom. In addition, ligand contains additional selenium-containing substituents (usually selenols or selenoethers) that constitute Se binding sites. Can include other ring systems bound to the heterocyclic ring or to the Se-containing substituent, but they do not coordinate with the stabilized, high valence metal ion. Ring(s) can also contain O, N, P, As or S atoms. This 5-membered ring(s) and/or attached, uncoordinating rings and/or Se-containing substituent(s) may or may not have halogen or polarizing or water-insolubilizing/solubilizing groups attached. |
| Se Valence Stabilizer #8: Six-Membered Heterocyclic Rings containing One Selenium Atom and having at least one additional Selenium Atom Binding Site not in a Ring (Se Monodentates, Se—Se Bidentates, Se—Se Tridentates, Se—Se Tetradentates, or Se—Se Hexadentates) | Six membered heterocyclic ring(s) containing one selenium atom. In addition, ligand contains additional selenium-containing substituents (usually selenols or selenoethers) that constitute Se binding sites. Can include other ring systems bound to the heterocyclic ring or to the Se-containing substituent, but they do not coordinate with the stabilized, high valence metal ion. Ring(s) can also contain O, N, P, As or S atoms. This 6-membered ring(s) and/or attached, uncoordinating rings and/or Se-containing substituent(s) may or may not have halogen or polarizing or water-insolubilizing/solubilizing groups attached. |
| Se Valence Stabilizer #9: Five-Membered Heterocyclic Rings containing One Selenium Atom and having at least one additional Selenium Atom Binding Site in a separate Ring (Se Monodentates, Se—Se Bidentates, Se—Se Tridentates, Se—Se Tetradentates, or Se—Se Hexadentates) | Five membered heterocyclic ring(s) containing one selenium atom. In addition, ligand contains additional selenium-containing rings that constitute Se binding sites. Can include other ring systems bound to the Se-containing heterocyclic rings, but they do not coordinate with the stabilized, high valence metal ion. Ring(s) can also contain O, N, P, As, or S |

TABLE 3-continued

Narrow Band Organic Valence Stabilizers for the $Co^{+3}$ ion

| General Structural Name (Type of Organic) | Structural Representation |
|---|---|
| | atoms. This 5-membered ring(s) and/or additional Se-containing ring(s) and/or attached, uncoordinating rings may or may not have halogen or polarizing or water-insolubilizing/solubilizing groups attached. |
| Se Valence Stabilizer #10: Six-Membered Heterocyclic Rings containing One Selenium Atom and having at least one additional Selenium Atom Binding Site in a separate Ring (Se Monodentates, Se—Se Bidentates, Se—Se Tridentates, Se—Se Tetradentates, or Se—Se Hexadentates) | Six membered heterocyclic ring(s) containing one selenium atom. In addition, ligand contains additional selenium-containing rings that constitute Se binding sites. Can include other ring systems bound to the Se-containing heterocyclic rings, but they do not coordinate with the stabilized, high valence metal ion. Ring(s) can also contain O, N, P, As, or S atoms. This 6-membered ring(s) and/or additional Se-containing ring(s) and/or attached, uncoordinating rings may or may not have halogen or polarizing or water-insolubilizing/solubilizing groups attached. |
| Se Valence Stabilizer #11: Two-, Three-, Four-, or Six-Membered Macrocyclics, Macrobicyclics, and Macropolycyclics (including Catapinands, Cryptands, Cyclidenes, and Sepulchrates) wherein all Binding Sites are composed of Selenium (usually selenol or selenoether groups) and are not contained in Component Heterocyclic Rings (Se—Se Bidentates, Se—Se Tridentates, Se—Se Tetradentates, or Se—Se Hexadentates) | Macrocyclic ligands containing two, three, four, or six selenium binding sites to valence stabilize the central metal ion. Can include other hydrocarbon or ring systems bound to this macrocyclic ligand, but they do not coordinate with the stabilized, high valence metal ion. This ligand and/or attached, uncoordinating hydrocarbons/rings may or may not have halogen or polarizing or water-insolubilizing/solubilizing groups attached. |
| Se Valence Stabilizer #12: Four-, or Six-Membered Macrocyclics, Macrobicyclics, and Macropolycyclics (including Catapinands, Cryptands, Cyclidenes, and Sepulchrates) wherein all Binding Sites are composed of Selenium and are contained in Component 5-Membered Heterocyclic Rings (Se—Se Tridentates, Se—Se Tetradentates or Se—Se Hexadentates) | Macrocyclic ligands containing a total of four or six five-membered heterocyclic rings containing selenium binding sites. Can include other hydrocarbon/ring systems bound to this macrocyclic ligand, but they do not coordinate with the stabilized, high valence metal ion. This ligand and/or attached, uncoordinating hydrocarbon/rings may or may not have halogen or polarizing or water-insolubilizing groups attached. |
| Se Valence Stabilizer #13: Four-, or Six-Membered Macrocyclics, Macrobicyclics, and Macropolycyclics (including Catapinands, Cryptands, Cyclidenes, and Sepulchrates) wherein all Binding Sites are composed of Selenium and are contained in a Combination of 5-Membered Heterocyclic Rings and Selenol or Selenoether Groups (Se—Se Tridentates, Se—Se Tetradentates, or Se—Se Hexadentates) | Macrocyclic ligands containing at least one 5-membered heterocyclic ring. These heterocyclic rings provide selenium binding sites to valence stabilize the central metal ion. Other selenol or selenoether binding sites can also be included in the macrocyclic ligand, so long as the total number of binding sites is four or six. Can include other hydrocarbon/ring systems bound to this macrocyclic ligand, but they do not coordinate with the stabilized, high valence metal ion. This ligand and/or attached, uncoordinating hydrocarbon/rings may or may not have halogen or polarizing or water-insolubilizing groups attached. |
| Se Valence Stabilizer #14: Four-, or Six-Membered Macrocyclics, Macrobicyclics, and Macropolycyclics (including Catapinands, Cryptands, Cyclidenes, and Sepulchrates) wherein all Binding Sites are composed of Selenium and are contained in Component 6-Membered Heterocyclic Rings (Se—Se Tridentates, Se—Se Tetradentates, or Se—Se Hexadentates) | Macrocyclic ligands containing a total of four or six six-membered heterocyclic rings containing selenium binding sites. Can include other hydrocarbon/ring systems bound to this macrocyclic ligand, but they do not coordinate with the stabilized, high valence metal ion. This ligand and/or attached, uncoordinating hydrocarbon/rings may or may not have halogen or polarizing or water-insolubilizing groups attached. |
| Se Valence Stabilizer #15: Four-, or Six-Membered Macrocyclics, Macrobicyclics, and Macropolycyclics (including Catapinands, Cryptands, Cyclidenes, and Sepulchrates) wherein all Binding Sites are composed of Selenium and are contained in a Combination of 6-Membered Heterocyclic Rings and Selenol or Selenoether Groups (Se—Se Tridentates, Se—Se Tetradentates, or Se—Se Hexadentates) | Macrocyclic ligands containing at least one 6-membered heterocyclic ring. These heterocyclic rings provide selenium binding sites to valence stabilize the central metal ion. Other selenol or selenoether binding sites can also be included in the macrocyclic ligand, so long as the total number of binding sites is four or six. Can include other hydrocarbon/ring systems bound to this macrocyclic ligand, but they do not coordinate with the stabilized, high valence metal ion. This ligand and/or attached, |

TABLE 3-continued

Narrow Band Organic Valence Stabilizers for the $Co^{+3}$ ion

| General Structural Name (Type of Organic) | Structural Representation |
|---|---|
| | uncoordinating hydrocarbon/rings may or may not have halogen or polarizing or water-insolubilizing groups attached. |
| Se Valence Stabilizer #16: 1,3-Diselenoketones (Diseleno-beta-ketonates), 1,3,5-Triselenoketones, Bis(1,3-Diselenoketones), and Poly(1,3-Diselenoketones) (S—S Bidentates, S—S Tridentates, S—S Tetradentates) | R—C(=Se)—CR'R"—C(=Se)—R'" where R, R', R", and R'" represent H, $NH_2$, or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| Se Valence Stabilizer #17: 1,1-Diselenolates, Bis(1,1-diselenolates), and Poly(1,1-diselenolates) (Se—Se Bidentates and Se—Se Tetradentates) | RR'—C=C(—$Se^-$)(—$Se^-$), where R and R' represent H, $NH_2$ or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| Se Valence Stabilizer #18: Diselenocarbamates, Bis(diselenocarbamates), and Poly(diselenocarbamates) (including N—hydroxydiselenocarbamates and N—mercaptodiselenocarbamates) (Se—Se Bidentates, Se—Se Tridentates, and Se—Se Tetradentates) | RR'$N^+$=C(SeH)(SeH), where R and R' represent H, OH, SH, OR" (R"=$C_1$—$C_{30}$ alkyl or aryl), SR" (R"= $C_1$—$C_{30}$ alkyl or aryl), $NH_2$ or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| Se Valence Stabilizer #19: Triselenophosphoric Acids (Phosphorotriselenoic Acids), Bis(triselenophosphoric acids), Poly(triselenophosphoric acids), and derivatives thereof (Se—Se Bidentates, Se—Se Tridentates, Se—Se Tetradentates) | (O=)P(—Se—R)(—Se—R')(—Se—R") or (Se=)P(—Se-R)(—Se—R')(—O—R"), where R, R', and R" represent H, $NH_2$ or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| Se Valence Stabilizer #20: Diselenophosphoric Acids (Phosphorodiselenoic Acids), Bis(diselenophosphoric acids), Poly(diselenophosphoric acids), and derivatives thereof (Se—Se Bidentates, Se—Se Tridentates, Se—Se Tetradentates) | (O=)P(—Se—R)(—Se—R')(—O—R") or (Se=)P(—Se-R)(—O—R')(—O—R"), where R, R', and R" represent H, $NH_2$ or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| Se Valence Stabilizer #21: Tetraselenophosphoric Acids (Phosphorotetraselenoic Acids), Bis(tetraselenophosphoric acids), Poly(tetraselenophosphoric acids), and derivatives thereof (Se—Se Bidentates, Se—Se Tridentates, Se—Se Tetradentates) | (Se=)P(—Se—R)(—Se—R')(—Se—R"), where R, R', and R" represent H, $NH_2$ or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| Se Valence Stabilizer #22: Diselenocarbonates, Triselenocarbonates, Bis(diselenocarbonates), and Bis(triselenocarbonates), (Se—Se Bidentates and Se—Se Tetradentates) | R—Se—C(=Se)—O—R' or R—Se—C(=O)—Se—R' for diselenocarbonates, and R—Se—C(=Se)—Se—R' for triselenocarbonates, where R, and R' represent H, $NH_2$ or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| Se Valence Stabilizer #23: Selenocyanates (Se Monodentates) | Selenocyanates bound directly to the high valence metal ion. |
| Se Valence Stabilizer #24: Selenolates (Se Monodentates) | Selenolates (HSe—R, HSe—R—SeH, etc.), where R and R' represent H or any organic functional group wherein the number of carbon atoms ranges from 0 to 35, optionally having halogen or polarizing or water-insolubilizing/solubilizing groups attached. |
| Miscellaneous Valence Stabilizer #1: Diene or bicyclic or tricyclic hydrocarbon ligands | Dialkenes or bicyclic or tricyclic hydrocarbons bound directly to the high valence metal ion. |

TABLE 3-continued

| Narrow Band Organic Valence Stabilizers for the $Co^{+3}$ ion | |
|---|---|
| General Structural Name (Type of Organic) | Structural Representation |
| Miscellaneous Valence Stabilizer #2: Cyanide and related ligands | Cyanide and cyanate and related ligands bound directly to the high valence metal ion. |
| Miscellaneous Valence Stabilizer #3: Carbonyl ligands | Carbonyl (—CO) ligands bound directly to the high valence metal ion. |
| Miscellaneous Valence Stabilizer #4: Halogen ligands | Halogen (X) atoms bound directly to the high valence metal ion. |
| Miscellaneous Valence Stabilizer #5: Hydroxo and Oxo Ligands | Hydroxo and oxo ligands bound directly to the high valence metal ion. |

N Valence Stabilizer #1a: Examples of five-membered macrocyclics, macrobicyclics, and macropolycyclics (including catapinands, cryptands, cyclidenes, and sepulchrates) wherein all binding sites are composed of nitrogen (usually amine or imine groups) and are not contained in component heterocyclic rings (N—N Tridentates or N—N Tetradentates) that meet the requirements for use as "narrow band" valence stabilizers for $Co^{+3}$ include, but are not limited to: pentaazacyclodecane ([10]aneN$_5$); pentaazacycloundecane ([1]aneN$_5$); pentaazacyclododecane ([12]aneN$_5$); pentaazacyclotridecane ([13]aneN$_5$); pentazaacyclotetradecane ([14]aneN$_5$); pentaazacyclopentadecane ([15]aneN$_5$); pentaazacyclodecatriene ([10]trieneN$_5$); pentaazacycloundecatriene ([11]trieneN$_5$); pentaazacyclododecatriene ([12]trieneN$_5$); pentaazacyclotridecatriene ([13]trieneN$_5$); pentazaacyclotetradecatriene ([14]trieneN$_5$); and pentaazacyclopentadecatriene ([15]trieneN$_5$).

N Valence Stabilizer #1b: Examples of seven-membered macrocyclics, macrobicyclics, and macropolycyclics (including catapinands, cryptands, cyclidenes, and sepulchrates) wherein all binding sites are composed of nitrogen (usually amine or imine groups) and are not contained in component heterocyclic rings (N—N Tridentates, N—N Tetradentates, or N—N Hexadentates) that meet the requirements for use as "narrow band" valence stabilizers for $Co^{+3}$ include, but are not limited to: heptaazacyclotetradecane ([14]aneN$_7$); heptaazacyclopentadecane ([15]aneN$_7$); heptaazacyclohexadecane ([16]aneN$_7$); heptaazacycloheptadecane ([17]aneN$_7$); heptaazacyclooctadecane ([18]aneN$_7$); heptaazacyclononadecane ([19]aneN$_7$); heptaazacycloeicosane ([20]aneN$_7$); heptaazacycloheneicosane ([21]aneN$_7$); heptaazacyclotetradecatriene ([14]trieneN$_7$); heptaazacyclopentadecatriene ([15]trieneN$_7$); heptaazacyclohexadecatriene ([16]trieneN$_7$); heptaazacycloheptadecatriene ([17]trieneN$_7$); heptaazacyclooctadecatriene ([18]trieneN$_7$); heptaazacyclononadecatriene ([19]trieneN$_7$); heptaazacycloeicosatriene ([20]trieneN$_7$); and heptaazacycloheneicosatriene ([21]trieneN$_7$).

N Valence Stabilizer #1c: Examples of nine-membered macrocyclics, macrobicyclics, and macropolycyclics (including catapinands, cryptands, cyclidenes, and sepulchrates) wherein all binding sites are composed of nitrogen (usually amine or imine groups) and are not contained in component heterocyclic rings (N—N Tridentates, N—N Tetradentates, or N—N Hexadentates) that meet the requirements for use as "narrow band" valence stabilizers for $Co^{+3}$ include, but are not limited to: nonaazacyclooctadecane ([18]aneN$_9$); nonaazacyclononadecane ([19]aneN$_9$); nonaazacycloeicosane ([20]aneN$_9$); nonaazacycloheneicosane ([21]aneN$_9$); nonaazacyclodocosane ([22]aneN$_9$); nonaazacyclotricosane ([23]aneN$_9$); nonaazacyclotetracosane ([24]aneN$_9$); nonaazacyclopentacosane ([25]aneN$_9$); nonaazacyclohexacosane ([26]aneN$_9$); nonaazacycloheptacosane ([27]aneN$_9$); nonaazacyclooctadecatetradiene ([18]tetradieneN$_9$); nonaazacyclononadecatetradiene ([19]tetradieneN$_9$); nonaazacycloeicosatetradiene ([20]tetradieneN$_9$); nonaazacycloheneicosatetradiene ([21]tetradieneN$_9$); nonaazacyclodocosatetradiene ([22]tetradieneN$_9$); nonaazacyclotricosatetradiene ([23]tetradieneN$_9$); nonaazacyclotetracosatetradiene ([24]tetradieneN$_9$); nonaazacyclopentacosatetradiene ([25]tetradieneN$_9$); nonaazacyclohexacosatetradiene ([26]tetradieneN$_9$); and nonaazacycloheptacosatetradiene ([27]tetradieneN$_9$).

N Valence Stabilizer #2a: Examples of five-membered macrocyclics, macrobicyclics, and macropolycyclics (including catapinands, cryptands, cyclidenes, and sepulchrates) wherein all five binding sites are composed of nitrogen and are contained in component 5-membered heterocyclic rings (N—N Tetradentates) that meet the requirements for use as "narrow band" valence stabilizers for $Co^{+3}$ include, but are not limited to: pentaphyrins (pentapyrroles); sapphyrins; smaragdyrins; pentaoxazoles; pentaisooxazoles; pentathiazoles; pentaisothiazoles; pentaazaphospholes; pentaimidazoles; pentapyrazoles; pentaoxadiazoles; pentathiadiazoles; pentadiazaphospholes; pentatriazoles; pentaoxatriazoles; and pentathiatriazoles.

N Valence Stabilizer #2b: Examples of seven-membered macrocyclics, macrobicyclics, and macropolycyclics (including catapinands, cryptands, cyclidenes, and sepulchrates) wherein all seven binding sites are composed of nitrogen and are contained in component 5-membered heterocyclic rings (N—N Tetradentates) that meet the requirements for use as "narrow band" valence stabilizers for $Co^{+3}$ include, but are not limited to: heptaphyrins (heptapyrroles); heptaoxazoles; heptaisooxazoles; heptathiazoles; heptaisothiazoles; heptaazaphospholes; heptaimidazoles; heptapyrazoles; heptaoxadiazoles; heptathiadiazoles; heptadiazaphospholes; heptatriazoles; heptaoxatriazoles; and heptathiatriazoles.

N Valence Stabilizer #3a: Examples of five-membered macrocyclics, macrobicyclics, and macropolycyclics (including catapinands, cryptands, cyclidenes, and sepulchrates) wherein all five binding sites are composed of nitrogen and are contained in a combination of 5-membered heterocyclic rings and amine or imine groups (N—N Tridentates or N—N Tetradentates) that meet the requirements for use as "narrow band" valence stabilizers for $Co^{+3}$ include, but are not limited to: superphthalocyanine; supemaphthalocyanine; diazapentaphyrins; tetraazapentaphyrins; pentaazapentaphyrins; diazapentapyrazoles; tetraazapentapyrazoles; pentaazapentapyrazoles; diazapentaimidazoles; tetraazapentaimidazoles; and pentaazapentaimidazoles.

N Valence Stabilizer #3b: Examples of seven-membered macrocyclics, macrobicyclics, and macropolycyclics (including catapinands, cryptands, cyclidenes, and sepulchrates) wherein all seven binding sites are composed of nitrogen and are contained in a combination of 5-membered heterocyclic rings and amine or imine groups (N—N Tridentates, N—N Tetradentates, or N—N Hexadentates) that meet the requirements for use as "narrow band" valence stabilizers for $Co^{+3}$ include, but are not limited to: diazaheptaphyrins; tetraazaheptaphyrins; hexaazaheptaphyrins; diazaheptapyrazoles; tetraazaheptapyrazoles; hexaazaheptapyrazoles; diazaheptaimidazoles; tetraazaheptaimidazoles; and hexaazaheptaimidazoles.

N Valence Stabilizer #3c: Examples of nine-membered macrocyclics, macrobicyclics, and macropolycyclics (including catapinands, cryptands, cyclidenes, and sepulchrates) wherein all nine binding sites are composed of nitrogen and are contained in a combination of 5-membered heterocyclic rings and amine or imine groups (N—N Tridentates, N—N Tetradentates, or N—N Hexadentates) that meet the requirements for use as "narrow band" valence stabilizers for $Co^{+3}$ include, but are not limited to: diazanonaphyrins; tetraazanonaphyrins; hexaazanonaphyrins; diazanonapyrazoles; tetraazanonapyrazoles; hexaazanonapyrazoles; diazanonaimidazoles; tetraazanonaimidazoles; and hexaazanonaimidazoles.

N Valence Stabilizer #4a: Examples of five-membered macrocyclics, macrobicyclics, and macropolycyclics (including catapinands, cryptands, cyclidenes, and sepulchrates) wherein all five binding sites are composed of nitrogen and are contained in component 6-membered heterocyclic rings (N—N Tetradentates) that meet the requirements for use as "narrow band" valence stabilizers for $Co^{+3}$ include, but are not limited to: cyclopentapyridines; cyclopentaoxazines; cyclopentathiazines; cyclopentaphosphorins; cyclopentaquinolines; cyclopentapyrazines; cyclopentapyridazines; cyclopentapyrimidines; cyclopentaoxadiazines; cyclopentathiadiazines; cyclopentadiazaphosphorins cyclopentaquinoxalines; cyclopentatriazines; cyclopentathiatriazines; and cyclopentaoxatriazines.

N Valence Stabilizer #4b: Examples of seven-membered macrocyclics, macrobicyclics, and macropolycyclics (including catapinands, cryptands, cyclidenes, and sepulchrates) wherein all seven binding sites are composed of nitrogen and are contained in component 6-membered heterocyclic rings (N—N Tetradentates) that meet the requirements for use as "narrow band" valence stabilizers for $Co^{+3}$ include, but are not limited to: cycloheptapyridines; cycloheptaoxazines; cycloheptathiazines; cycloheptaphosphorins; cycloheptaquinolines; cycloheptapyrazines; cycloheptapyridazines; cycloheptapyrimidines; cycloheptaoxadiazines; cycloheptathiadiazines; cycloheptadiazaphosphorins cycloheptaquinoxalines; cycloheptatriazines; cycloheptathiatriazines; and cycloheptaoxatriazines.

N Valence Stabilizer #5a: Examples of five-membered macrocyclics, macrobicyclics, and macropolycyclics (including catapinands, cryptands, cyclidenes, and sepulchrates) wherein all five binding sites are composed of nitrogen and are contained in a combination of 6-membered heterocyclic rings and amine or imine groups (N—N Tridentates or N—N Tetradentates) that meet the requirements for use as "narrow band" valence stabilizers for $Co^{+3}$ include, but are not limited to: diazacyclopentapyridines; tetraazacyclopentapyridines; diazacyclopentaquinolines; tetraazacyclopentaquinolines; diazacyclopentapyrazines; tetraazacyclopentapyrazines; diazacyclopentapyridazines; tetraazacyclopentapyridazines; diazacyclopentapyrimidines; tetraazacyclopentapyrimidines; diazacyclopentatriazines; and tetraazacyclopentatriazines.

N Valence Stabilizer #5b: Examples of seven-membered macrocyclics, macrobicyclics, and macropolycyclics (including catapinands, cryptands, cyclidenes, and sepulchrates) wherein all seven binding sites are composed of nitrogen and are contained in a combination of 6-membered heterocyclic rings and amine or imine groups (N—N Tridentates, N—N Tetradentates, or N—N Hexadentates) that meet the requirements for use as "narrow band" valence stabilizers for $Co^{+3}$ include, but are not limited to: diazacycloheptapyridines; tetraazacycloheptapyridines; diazacycloheptaquinolines; tetraazacycloheptaquinolines; diazacycloheptapyrazines; tetraazacycloheptapyrazines; diazacycloheptapyridazines; tetraazacycloheptapyridazines; diazacycloheptapyrimidines; tetraazacycloheptapyrimidines; diazacycloheptatriazines; and tetraazacycloheptatriazines.

N Valence Stabilizer #5c: Examples of nine-membered macrocyclics, macrobicyclics, and macropolycyclics (including catapinands, cryptands, cyclidenes, and sepulchrates) wherein all nine binding sites are composed of nitrogen and are contained in a combination of 6-membered heterocyclic rings and amine or imine groups (N—N Tridentates, N—N Tetradentates, or N—N Hexadentates) that meet the requirements for use as "narrow band" valence stabilizers for $Co^{+3}$ include, but are not limited to: diazacyclononapyridines; tetraazacyclononapyridines; diazacyclononaquinolines; tetraazacyclononaquinolines; diazacyclononapyrazines; tetraazacyclononapyrazines; diazacyclononapyridazines; tetraazacyclononapyridazines; diazacyclononapyrimidines; tetraazacyclononapyrimidines; diazacyclononatriazines; and tetraazacyclononatriazines.

N Valence Stabilizer #6: Examples of silylamines and silazanes (N Monodentates, N—N Bidentates, N—N Tridentates, N—N Tetradentates, and N—N Hexadentates) that meet the requirements for use as "narrow band" valence stabilizers for $Co^{+3}$ include, but are not limited to: trisilylamine; N-methyldisilazane(disilylmethylamine); N,N-dimethylsilylamine; (silyldimethylamine); tris(trimethylsilyl) amine; triethylsilylamine(triethylaminosilane) (triethylsilazane); N-ethyltriethylsilylamine(triethyl-N-ethylaminosilane); di-tert-butylsilanediamine (di-tert-butyldiaminosilane); bis(methylamino)diethylsilane; tris(dimethylamino)ethylsilane; hexamethyldisilazane; N-methylhexaphenyldisilazane; hexamethylcyclotrisilazane; and octaphenylcyclotetrasilazane. [Note: Silylamines and silazanes are notably weaker ligands than their carbonaceous derivatives, although replacement of one or two $SiR_3$ groups with $CR_3$ will enhance the donor power of the ligand. Thus, $N(CR_3)_2(SiR_3)$ is a better ligand than $N(CR_3)(SiR_3)_2$, etc.]

N Valence Stabilizer #7: Examples of guanidines, diguanidines, and polyguanidines (N—N bidentates, N—N tridentates, N—N tetradentates, and N—N hexadentates) that meet the requirements for use as "narrow band" valence stabilizers for $Co^{+3}$ include, but are not limited to: guanidine; methylguanidine; ethylguanidine; isopropylguanidine; butylguanidine; benzylguanidine; phenylguanidine;

tolylguanidine; naphthylguanidine; cyclohexylguanidine; norbornylguanidine; adamantylguanidine; dimethylguanidine; diethylguanidine; diisopropylguanidine; dibutylguanidine; dibenzylguanidine; diphenylguanidine; ditolylguanidine; dinaphthylguanidine; dicyclohexylguanidine; dinorbornylguanidine; diadamantylguanidine; ethylenediguanidine; propylenediguanidine; tetramethylenediguanidine; pentamethylenediguanidine; hexamethylenediguanidine; heptamethylenediguanidine; octamethylenediguanidine; phenylenediguanidine; piperazinediguanidine; oxalyldiguanidine; malonyldiguanidine; succinyldiguanidine; glutaryldiguanidine; adipyldiguanidine; pimelyldiguanidine; suberyldiguanidine; phthalyldiguanidine; benzimidazoleguanidine; aminoguanidine; nitroaminoguanidine; dicyandiamide(cyanoguanidine); dodecylguanidine; and nitrovin.

N Valence Stabilizer #8: Examples of phosphonitrile amides and bis(phosphonitrile amides) (N—N Bidentates and N—N Tetradentates) that meet the requirements for use as "narrow band" valence stabilizers for $Co^{+3}$ include, but are not limited to: phosphononitrile amide; N-phenylphosphonitrile amide; N-benzylphosphonitrile amide; N-cyclohexylphosphonitrile amide; N-norbornylphosphonitrile amide; N,N'-diphenylphosphonitrile amide; N,N'-dibenzylphosphonitrile amide; N,N'-dicyclohexylphosphonitrile amide; and N,N'dinorbornylphosphonitrile amide. [Note: The phosphite ($P^{+3}$) valence of the phosphorus atom makes stabilization of high valence metal ions much more difficult, though still possible.]

N Valence Stabilizer #9: Examples of phosphonimidic diamides, bis(phosphonimidic diamides), and poly(phosphonimidic diamides) (N—N bidentates and N—N tetradentates) that meet the requirements for use as "narrow band" valence stabilizers for $Co^{+3}$ include, but are not limited to: phosphonimidic diamide; N-benzylphosphonimidic diamide; N-phenylphosphonimidic diamide; N-cyclohexylphosphonimidic diamide; N-norbornylphosphonimidic diamide; N,N-dibenzylphosphonimidic diamide; N,N-diphenylphosphonimidic diamide; N,N-dicyclohexylphosphonimidic diamide; and N,N-dinorbornylphosphonimidic diamide. [Note: The phosphite ($P^{+3}$) valence of the phosphorus atom makes stabilization of high valence metal ions much more difficult, though still possible.]

N Valence Stabilizer #10: Examples of phosphonamidimidic acid, phosphonamidimidothioic acid, bis(phosphonamidimidic acid), bis(phosphonamidimidothioic acid), poly(phosphonamidimidic acid), poly(phosphonamidimidothioic acid), and derivatives thereof (N—N Bidentates, and N—N Tetradentates) that meet the requirements for use as "narrow band" valence stabilizers for $Co^{+3}$ include, but are not limited to: phosphonamidimidic acid, phosphonamidimidothioic acid; O-phenylphosphonamidimidic acid; O-benzylphosphonamidimidic acid; O-cyclohexylphosphonamidimidic acid; O-norbornylphosphonarnidimidic acid; S-phenylphosphonamidimidothioic acid; S-benzylphosphonamidimidothioic acid; S-cyclohexylphosphonamidimidothioic acid; and S-norbornylphosphonamidimidothioic acid. [Note: The phosphite ($P^{+3}$) valence of the phosphorus atom makes stabilization of high valence metal ions much more difficult, though still possible.]

N Valence Stabilizer #11: Examples of pyridinaldimines, bis(pyridinaldimines), and poly(pyridinaldimines) (N—N Bidentates, N—N Tridentates, and N—N Tetradentates) that meet the requirements for use as "narrow band" valence stabilizers for $Co^{+3}$ include, but are not limited to: pyridylideneaniline[N-(pyridylmethylene)benzenamine]; and (2-pyridyl)benzylideneaniline.

N Valence Stabilizer #12: Examples of hydrazones, bis(hydrazones), and poly(hydrazones) (N Monodentates, N—N Bidentates, N—N Tridentates, and N—N Tetradentates) that meet the requirements for use as "narrow band" valence stabilizers for $Co^{+3}$ include, but are not limited to: acetaldehyde hydrazone; acetaldehyde phenylhydrazone; acetone hydrazone; acetone phenylhydrazone; pinacolone hydrazone; pinacolone phenylhydrazone; benzaldehyde hydrazone; benzaldehyde phenylhydrazone; naphthaldehyde hydrazone; naphthaldehyde phenylhydrazone; norbornanone hydrazone; norbornanone phenylhydrazone; camphor hydrazone; camphor phenylhydrazone; nopinone hydrazone; nopinone phenylhydrazine; 2-pyridinaldehyde hydrazone; 2-pyridinealdehyde phenylhydrazone; salicylaldehyde hydrazone; salicylaldehyde phenylhydrazone; quinolinaldehyde hydrazone; quinolinaldehyde phenylhydrazone; isatin dihydrazone; isatin di(phenylhydrazone); camphorquinone dihydrazone; camphorquinone di(phenylhydrazone); and 2-hydrazinobenzimidazole hydrazone.

N Valence Stabilizer #13: Examples of azo compounds without chelate substitution at the ortho- (for aryl) or alpha- or beta- (for alkyl) positions, bis(azo compounds), or poly(azo compounds) (N Monodentates, N—N Bidentates, or N—N Tridentates) that meet the requirements for use as "narrow band" valence stabilizers for $Co^{+3}$ include, but are not limited to: azobenzene (diphenyldiazene); p-diaminoazobenzene; p-dimethylaminoazobenzene (butter yellow); methyl orange; Fast Garnet GBC (4'-amino-2,3'-dimethylazobenzene)[Note: non-bonding methyl group in the o-position.]; and Alizarin Yellow R. [Note: Azo compounds without chelate substitution at the ortho- (for aryl) or beta- (for alkyl) positions tend to stabilize lower oxidation states in metal ions.]

N Valence Stabilizer #14: Examples of formazans, bis(formazans), and poly(formazans) without ortho-hydroxy, carboxy, thiol, mercapto, amino, or hydrazido substitution (N—N Bidentates, N—N Tetradentates, and N—N Hexadentates) that meet the requirements for use as "narrow band" valence stabilizers for $Co^{+3}$ include, but are not limited to: 1,3,5-triphenylformazan; and 1,3,5-naphthylformazan.

N Valence Stabilizer #15: Examples of hydramides (N—N Bidentates) that meet the requirements for use as "narrow band" valence stabilizers for $Co^{+3}$ include, but are not limited to: hydrobenzamide; hydronaphthamide; and hydrosalicylamide.

N Valence Stabilizer #16: Examples of azines (including ketazines), bis(azines), and poly(azines) without ortho-hydroxy, carboxy, thiol, mercapto, amino, or hydrazido substitution (N—N Bidentates, N—N Tetradentates, and N—N Hexadentates) that meet the requirements for use as "narrow band" valence stabilizers for $Co^{+3}$ include, but are not limited to: benzalazine; naphthalazine; cyclohexanonazine; and norbornonazine.

N Valence Stabilizer #17: Examples of Schiff Bases with one Imine (C═N) Group and without ortho- (for aryl constituents) or alpha- or beta- (for alkyl constituents) hydroxy, carboxy, carbonyl, thiol, mercapto, thiocarbonyl, amino, imino, oximo, diazeno, or hydrazido substitution (N Monodentates) that meet the requirements for use as "narrow band" valence stabilizers for $Co^{+3}$ include, but are not limited to: N-(Benzaldehydo)isopropylamine; N-(Naphthaldehydo)isopropylamine; N-(Acetophenono)isopropylamine; N-(Propiophenono)isopropylamine; N-(Benzaldehydo)cyclohexylamine; N-(Naphthaldehydo)cyclohexylamine; N-(Acetophenono)cyclohexylamine; N-(Propiophenono)cyclohexylamine; N-(Benzaldehydo)aniline (BAAN); N-(Naphthaldehydo)aniline; N-(Acetophenono)aniline; N-(Propiophenono)aniline; N-(Benzaldehydo)aminonorbornane; N-(Naphthaldehydo)aminonorbornane; N-(Acetophenono)aminonorbornane; N-(Propiophenono)aminonorbornane; (Vanillino)anisidine; (Cinnamaldehydo)anisidine; N-(o-carboxycinnamaldehydo)aniline; N-(cinnamaldehydo)aniline; N-(cinnamaldehydo)m- or p-anisidine; and N-(o-carboxycinnamaldehydo)m- or p-anisidine.

N Valence Stabilizer #18: Examples of isocyanide and cyanamide and related ligands (N Monodentates) that meet the requirements for use as "narrow band" valence stabilizers for $Co^{+3}$ include, but are not limited to: isocyanate (—NCO); isothiocyanate (—NCS); isoselenocyanate (—NCSe); and cyanamide (—NCN). [Note: the nitrogen atom is directly complexed to the high valence metal ion.]

N Valence Stabilizer #19: Examples of nitrosyls and nitrites and related ligands (N Monodentates) that meet the requirements for use as "narrow band" valence stabilizers for $Co^{+3}$ include, but are not limited to: nitrosyl (—NO); thionitrosyl (—NS); nitrite (—$NO_2$); thionitrite (sulfinylamide)(thiazate)(—NSO); nitrosamine (═NN═O); thionitrosamine (═NN═S); nitramine (═$NNO_2$); and thionitramine (═$NNS_2$) ligands.

N Valence Stabilizer #20: Examples of nitriles, dinitriles, and polynitriles (N Monodentates, N—N Bidentates, N—N Tridentates) that meet the requirements for use as "narrow band" valence stabilizers for $Co^{+3}$ include, but are not limited to: benzonitrile; naphthonitrile; cyanonaphthalene; cyclohexyl nitrile; cyanopyridine; cyanopurine; cyanophenol; cyanothiophenol; adamantane nitrile; norbornyl nitrile; cinnamonitrile; dicyanobenzene; dicyanobutene; dicyanoimidazole; dicyanopyridine; cyanotolunitrile; tetracyanoethylene (TCNE); tetracyanoquinodimethane (TCNQ); diethylaminopropionitrile (deapn), and polyacrylonitriles.

N Valence Stabilizer #21: Examples of azide ligands (N monodentates) that meet the requirements for use as "narrow band" valence stabilizers for $Co^{+3}$ include, but are not limited to: azide (—$N_3$) ions; methyl azide; ethyl azide; phenyl azide; diphenyltriazene; and phenyl sulfonyl azide.

S Valence Stabilizer #1: Examples of monothioethers (S monodentates) that meet the requirements for use as "narrow band" valence stabilizers for $Co^{+3}$ include, but are not limited to: hydrogen sulfide, dimethyl sulfide, diethyl sulfide, dioctyl sulfide, diphenyl sulfide, dicyclohexyl sulfide, tetramethylene sulfide (tetrahydrothiophene, tht), trimethylene sulfide, dimethylene sulfide (ethylene sulfide), pentamethylene sulfide, 1,4-thioxane, oxathiolane, cyclohexene sulfide, cyclooctene sulfide, benzotetrahydrothiophene, dibenzothiophene, naphthotetrahydrothiophene, and thiabicycloheptane.

S Valence Stabilizer #2: Examples of disulfides (S monodentates) that meet the requirements for use as "narrow band" valence stabilizers for $Co^{+3}$ include, but are not limited to: methyl disulfide, ethyl disulfide, phenyl disulfide, nitrophenide, and 1,2-dithiacyclohexane.

S Valence Stabilizer #3: Examples of dithioethers (S monodentates or S—S bidentates) that meet the requirements for use as "narrow band" valence stabilizers for $Co^{+3}$ include, but are not limited to: 1,3-dithiane, 1,4-dithiane, benzodithiane, dibenzodithiane, naphthodithiane, 2,5-dithiahexane (dth); 3,6-dithiaoctane (dto); 2,5-dimethyl-3,6-dithiaoctane; 3,7-dithianonane; 2,6-dithiaheptane; 1,6-diphenyl-2,5-dithiahexane; 1,4-diphenyl-1,4-dithiabutane; 1,3-dithiolane; 1,4-dithiane (1,4-dithiacyclohexane); 1,4-dithiacycloheptane (dtch); 1,5-dithiacyclooctane (dtco); o-phenylenebis(2-thiapropane); o-phenylenebis(2-thiabutane); 2,2'-(thiamethyl)biphenyl, and 2,2'-(thiaethyl)biphenyl.

S Valence Stabilizer #4: Examples of trithioethers (S monodentates, S—S bidentates, or S—S tridentates) that meet the requirements for use as "narrow band" valence stabilizers for $Co^{+3}$ include, but are not limited to: 1,3,5-trithiane; 1,3,5-tris(methylthia)cyclohexane; 1,3,5-tris(ethylthia)cyclohexane; 1,3,5-tris(phenylthia)cyclohexane; 2,5,8-trithianonane; 3,6,9-trithiaundecane; and 2,6,10-trithiaundecane.

S Valence Stabilizer #5: Examples of tetrathioethers (S monodentates, S—S bidentates, S—S tridentates, or S—S tetradentates) that meet the requirements for use as "narrow band" valence stabilizers for $Co^{+3}$ include, but are not limited to: 1,4,10,13-tetrathiatridecane; 2,6,10,14-tetrathiapentadecane; 2,5,8,11-tetrathiadodecane; 2,5,9,12-tetrathiatridecane; 2,6,9,13-tetrathiatetradecane; 1,4-(o-thiomethyl)phenyl-1,4-dithiabutane; 1,5-(o-thiomethyl)phenyl-1,5-dithiapentane; 1,6-(o-thiomethyl)phenyl-1,6-dithiahexane; 1,4-(o-thiomethyl)phenyl-1,4-dithiabut-2-ene; and polythioethers.

S Valence Stabilizer #6: Examples of hexathioethers (S monodentates, S—S bidentates, S—S tridentates, S—S tetradentates, or S—S hexadentates) that meet the requirements for use as "narrow band" valence stabilizers for $Co^{+3}$ include, but are not limited to: tri(2-((o-thiomethyl)phenyl)ethyl)amine; and tri((o-thiomethyl)phenyl)methylamine.

S Valence Stabilizer #7a: Examples of 5-membered heterocyclic rings containing one sulfur atom (S monodentates) that meet the requirements for use as "narrow band" valence stabilizers for $Co^{+3}$ include, but are not limited to: dihydrothiophene, thiophene, thiazole, thiapyrroline, thiaphospholene, thiaphosphole, oxathiole, thiadiazole, thiatriazole, benzodihydrothiophene, benzothiophene, benzothiazole, benzothiaphosphole, dibenzothiophene, and naphthothiophene.

S Valence Stabilizer #7b: Examples of 5-membered heterocyclic rings containing two sulfur atoms (S monodentates or S—S bidentates) that meet the requirements for use as "narrow band" valence stabilizers for $Co^{+3}$ include, but are not limited to: dithiole, benzodithiole, and naphthodithiole.

S Valence Stabilizer #8a: Examples of 6-membered heterocyclic rings containing one sulfur atom (S monodentates) that meet the requirements for use as "narrow band" valence stabilizers for $Co^{+3}$ include, but are not limited to: dihydrothiopyran, thiopyran, thiazine, thiadiazine, thiaphosphorin, thiadiphosphorin, oxathiin, benzothiopyran, dibenzothiopyran, and naphthothiopyran.

S Valence Stabilizer #8b: Examples of 6-membered heterocyclic rings containing two sulfur atoms (S monodentates or S—S bidentates) that meet the requirements for use as "narrow band" valence stabilizers for $Co^{+3}$ include, but are not limited to: dihydrodithiin, dithiin, benzodithiin, dibenzodithiin (thianthrene), and naphthodithiin.

S Valence Stabilizer #9a: Examples of 5-membered heterocyclic rings containing one sulfur atom and having at least one additional sulfur atom binding site not contained in a ring (S Monodentates, S—S Bidentates, S—S Tridentates, S—S Tetradentates, or S—S Hexadentates) that meet the requirements for use as "narrow band" valence stabilizers for $Co^{+3}$ include, but are not limited to: 2,5-dimercapto-2,5-dihydrothiophene; 2,5-bis(thiomethyl)-2,5-dihydrothiophene; 2,5-bis(2-thiophenyl)-2,5-dihydrothiophene; 2,5-dimercaptothiophene; 2,5-bis(thiomethyl)thiophene; 2,5-bis(2-thiophenyl)thiophene; 2,5-dimercatothiazole; 2,5-bis(thiomethyl)thiazole; 2,5-bis(2-thiophenyl)thiazole; 2,5-dimercapto-1,3,4-thiadiazole[bismuththiol]; 2-mercaptothianaphthene; 7-(thiomethyl)thianaphthene; 1,8-dimercaptodibenzothiophene; 2-mercaptobenzothiazole; 2-mercapro-1,3,4-thiadiazole; 2-amino-5-mercapto-1,3,4-thiadiazole; 2,5-bis(alkylthio)-1,3,4-thiadiazole; and 7-(thiomethyl)benzothiazole.

S Valence Stabilizer #9b: Examples of 5-membered heterocyclic rings containing two sulfur atoms and having at least one additional sulfur atom binding site not contained in a ring (S Monodentates, S—S Bidentates, S—S Tridentates, S—S Tetradentates, or S—S Hexadentates) that meet the requirements for use as "narrow band" valence stabilizers for $Co^{+3}$ include, but are not limited to: 2-mercapto-1,3-dithiole; 2-(dimercaptomethyl)-1,3-dithiole; 4,5-dimercapto-1,3-dithiole; 4,5-bis(2-thiophenyl)-1,3-dithiole; 2-mercaptobenzodithiole; and 7-mercaptobenzodithiole.

S Valence Stabilizer #10a: Examples of 6-membered heterocyclic rings containing one sulfur atom and having at least one additional sulfur atom binding site not contained in a ring (S Monodentates, S—S Bidentates, S—S Tridentates, S—S Tetradentates, or S—S Hexadentates) that meet the requirements for use as "narrow band" valence stabilizers for $Co^{+3}$ include, but are not limited to: 2,6-dimercapto-2,5-dihydrothiopyran; 2,6-bis(thiomethyl)-2,5-dihydrothiopyran; 2,6-bis(2-thiophenyl)-2,5-dihydrothiopyran; 2,6-dimercaptothiopyran; 2,6-bis(thiomethyl)thiopyran; 2,6-bis(2-thiophenyl)thiopyran; 2,6-dimercaptothiazine; 2,6-bis(thiomethyl)thiazine; 2,6-bis(2-thiophenyl)thiazine; 2,6-dimercapto-1,3,5-thiadiazine; 2-mercapto-1-benzothiopyran; 8-mercapto-1-benzothiopyran; and 1,9-dimercaptodibenzothiopyran.

S Valence Stabilizer #10b: Examples of 6-membered heterocyclic rings containing two sulfur atoms and having at least one additional sulfur atom binding site not contained in a ring (S Monodentates, S—S Bidentates, S—S Tridentates, S—S Tetradentates, or S—S Hexadentates) that meet the requirements for use as "narrow band" valence stabilizers for $Co^{+3}$ include, but are not limited to: 2-mercapto-1,4-dithiin; 2,6-dimercapto-1,4-dithiin; 2,6-bis(2-thiophenyl)-1,4-dithiin; 2,3-dimercapto-1,4-benzodithiin; 5,8-dimercapto-1,4-benzodithiin; 1,8-dimercaptothianthrene; and 1,4,5,8-tetramercaptothianthrene.

S Valence Stabilizer #11a: Examples of 5-membered heterocyclic rings containing one sulfur atom and having at least one additional sulfur atom binding site contained in a ring (S Monodentates, S—S Bidentates, S—S Tridentates, S—S Tetradentates) that meet the requirements for use as "narrow band" valence stabilizers for $Co^{+3}$ include, but are not limited to: 2,2'-bi-2,5-dihydrothiophene; 2,2',2"-tri-2,5-dihydrothiophene; 2,2'-bithiophene; 2,2',2"-trithiophene; 2,2'-bithiazole; 5,5'-bithiazole; 2,2'-bioxathiole; 2,2'-bi-1,3,4-thiadiazole; 2,2'-bithianaphthene; 2,2'-bibenzothiazole; 1,1'-bis(dibenzothiophene); and polythiophenes.

S Valence Stabilizer #11b: Examples of 5-membered heterocyclic rings containing two sulfur atoms and having at least one additional sulfur atom binding site contained in a ring (S Monodentates, S—S Bidentates, S—S Tridentates, S—S Tetradentates) that meet the requirements for use as "narrow band" valence stabilizers for $Co^{+3}$ include, but are not limited to: 2,2'-bi-1,3-dithiole; 4,4'-bi-1,3-dithiole; 7,7'-bi-1,2-benzodithiole; 3,3'-bi-1,2-benzodithiole; and tetrathiofulvalene.

S Valence Stabilizer #12a: Examples of 6-membered heterocyclic rings containing one sulfur atom and having at least one additional sulfur atom binding site contained in a ring (S Monodentates, S—S Bidentates, S—S Tridentates, S—S Tetradentates) that meet the requirements for use as "narrow band" valence stabilizers for $Co^{+3}$ include, but are not limited to: 2,2'-bi-2,5-dihydrothiopyran; 2,2',2"-tri-2,5-dihydrothiopyran; 2,2'-bithiopyran; 2,2',2"-trithiopyran; 2,2'-bi-1,4-thiazine; 2,2'-bi-1,3,5-thiadiazine; 2,2'-bi-1-benzothiopyran; and 1,1'-bis(dibenzothiopyran)

S Valence Stabilizer #12b: Examples of 6-membered heterocyclic rings containing two sulfur atoms and having at least one additional sulfur atom binding site contained in a ring (S Monodentates, S—S Bidentates, S—S Tridentates, S—S Tetradentates) that meet the requirements for use as "narrow band" valence stabilizers for $Co^{+3}$ include, but are not limited to: 2,2'-bi-1,4-dithiin; 2,2'-bi-1,3-dithiin; 5,5'-bi-1,4-benzodithiin; 2,2'-bi-1,3-benzodithiin; and 1,1'-bithianthrene.

S Valence Stabilizer #13a: Examples of two-membered macrocyclics, macrobicyclics, and macropolycyclics (including catapinands, cryptands, cyclidenes, and sepulchrates) wherein both binding sites are composed of sulfur (usually thiol or thioether groups) and are not contained in component heterocyclic rings (S—S Bidentates) that meet the requirements for use as "narrow band" valence stabilizers for $Co^{+3}$ include, but are not limited to: dithiacyclobutane ([4]ane$S_2$); dithiacyclopentane ([5]ane$S_2$); dithiacyclohexane ([6]ane$S_2$); dithiacycloheptane ([7]ane$S_2$); dithiacyclooctane ([8]ane$S_2$); dithiacyclobutene ([4]ene$S_2$); dithiacyclopentene ([5]ene$S_2$); dithiacyclohexene ([6]ene$S_2$); dithiacycloheptene ([7]ene$S_2$); dithiacyclooctene ([8]ene$S_2$); dithiacyclobutadiene ([4]diene$S_2$); dithiacyclopentadiene ([5]diene$S_2$); dithiacyclohexadiene ([6]diene$S_2$); dithiacycloheptadiene ([7]diene$S_2$); and dithiacyclooctadiene ([8]diene$S_2$).

S Valence Stabilizer #13b: Examples of three-membered macrocyclics, macrobicyclics, and macropolycyclics (including catapinands, cryptands, cyclidenes, and sepulchrates) wherein all binding sites are composed of sulfur (usually thiol or thioether groups) and are not contained in component heterocyclic rings (S—S Tridentates) that meet the requirements for use as "narrow band" valence stabilizers for $Co^{+3}$ include, but are not limited to: trithiacyclohexane ([6]ane$S_3$); trithiacycloheptane ([7]ane$S_3$); trithiacyclooctane ([8]ane$S_3$); trithiacyclononane ([9]ane$S_3$); trithiacyclodecane ([10]ane$S_3$); trithiacycloundecane ([11]ane$S_3$); trithiacyclododecane ([12]ane$S_3$); trithiacyclohexene ([6]ene$S_3$); trithiacycloheptene ([7]ene$S_3$); trithiacyclooctene ([8]ene$S_3$); trithiacyclononene ([9]ene$S_3$); trithiacyclodecene ([10]ene$S_3$); trithiacycloundecene ([11]ene$S_3$); trithiacyclododecene ([12]ene$S_3$); trithiacyclohexatriene ([6]triene$S_3$); trithiacycloheptatriene ([7]triene$S_3$); trithiacyclooctatriene ([8]triene$S_3$); trithiacyclononatriene ([9]triene$S_3$); trithiacyclodecatriene ([10]trieneS$_3$); trithiacycloundecatriene ([11]trieneS$_3$); and trithiacyclododecatriene ([12]trieneS$_3$).

S Valence Stabilizer #13c: Examples of four-membered macrocyclics, macrobicyclics, and macropolycyclics (including catapinands, cryptands, cyclidenes, and sepulchrates) wherein all binding sites are composed of sulfur (usually thiol or thioether groups) and are not contained in component heterocyclic rings (S—S Tetradentates) that meet the requirements for use as "narrow band" valence stabilizers for $Co^{+3}$ include, but are not limited to: tetrathiacyclooctane ([8]aneS$_4$); tetrathiacyclononane ([9]aneS$_4$); tetrathiacyclodecane ([10]aneS$_4$); tetrathiacycloundecane ([11]aneS$_4$); tetrathiacyclododecane ([12]aneS$_4$); tetrathiacyclotridecane ([13]aneS$_4$); tetrathiacyclotetradecane ([14]aneS$_4$); tetrathiacyclopentadecane ([15]aneS$_4$); tetrathiacyclohexadecane ([16]aneS$_4$); tetrathiacycloheptadecane ([17]aneS$_4$); tetrathiacyclooctadecane ([18]aneS$_4$); tetrathiacyclononadecane ([19]aneS$_4$); tetrathiacycloeicosane ([20]aneS$_4$); tetrathiacyclooctadiene ([8]dieneS$_4$); tetrathiacyclononadiene ([9]dieneS$_4$); tetrathiacyclodecadiene ([10]dieneS$_4$); tetrathiacycloundecadiene ([11]dieneS$_4$); tetrathiacyclododecadiene ([12]dieneS$_4$); tetrathiacyclotridecadiene ([13]dieneS$_4$); tetrathiacyclotetradecadiene ([14]dieneS$_4$); tetrathiacyclopentadecadiene ([15]dieneS$_4$); tetrathiacyclohexadecadiene ([16]dieneS$_4$); tetrathiacycloheptadecadiene ([17]dieneS$_4$); tetrathiacyclooctadecadiene ([18]dieneS$_4$); tetrathiacyclononadecadiene ([19]dieneS$_4$); tetrathiacycloeicosadiene ([20]dieneS$_4$); tetrathiacyclooctatetradiene ([8]tetradieneS$_4$); tetrathiacyclononatetradiene ([9]tetradieneS$_4$); tetrathiacyclodecatetradiene ([10]tetradieneS$_4$); tetrathiacycloundecatetradiene ([11]tetradieneS$_4$); tetrathiacyclododecatetradiene ([12]tetradieneS$_4$); tetrathiacyclotridecatetradiene ([13]tetradieneS$_4$); tetrathiacyclotetradecatetradiene ([14]tetradieneS$_4$); tetrathiacyclopentadecatetradiene ([15]tetradieneS$_4$); tetrathiacyclohexadecatetradiene ([16]tetradieneS$_4$); tetrathiacycloheptadecatetradiene ([17]tetradieneS$_4$); tetrathiacyclooctadecatetradiene ([18]tetradieneS$_4$); tetrathiacyclononadecatetradiene ([19]tetradieneS$_4$); and tetrathiacycloeicosatetradiene ([20]tetradieneS$_4$).

S Valence Stabilizer #13d: Examples of five-membered macrocyclics, macrobicyclics, and macropolycyclics (including catapinands, cryptands, cyclidenes, and sepulchrates) wherein all binding sites are composed of sulfur (usually thiol or thioether groups) and are not contained in component heterocyclic rings (S—S Tridentates or S—S Tetradentates) that meet the requirements for use as "narrow band" valence stabilizers for $Co^{+3}$ include, but are not limited to: pentathiacyclodecane ([10]aneS$_5$); pentathiacycloundecane ([11]aneS$_5$); pentathiacyclododecane ([12]aneS$_5$); pentathiacyclotridecane ([13]aneS$_5$); pentathiacyclotetradecane ([14]aneS$_5$); pentathiacyclopentadecane ([15]aneS$_5$); pentathiacyclodecatriene ([10]trieneS$_5$); pentathiacycloundecatriene ([11]trieneS$_5$); pentathiacyclododecatriene ([12]trieneS$_5$); pentathiacyclotridecatriene ([13]trieneS$_5$); pentathiacyclotetradecatriene ([14]trieneS$_5$); and pentathiacyclopentadecatriene ([15]trieneS$_5$).

S Valence Stabilizer #13e: Examples of six-membered macrocyclics, macrobicyclics, and macropolycyclics (including catapinands, cryptands, cyclidenes, and sepulchrates) wherein all binding sites are composed of sulfur (usually thiol or thioether groups) and are not contained in component heterocyclic rings (S—S Tridentates, S—S Tetradentates, or S—S Hexadentates) that meet the requirements for use as "narrow band" valence stabilizers for $Co^{+3}$ include, but are not limited to: hexathiacyclododecane ([12]aneS$_6$); hexathiacyclotridecane ([13]aneS$_6$); hexathiacyclotetradecane ([14]aneS$_6$); hexathiacyclopentadecane ([15]aneS$_6$); hexathiacyclohexadecane ([16]aneS$_6$); hexathiacycloheptadecane ([17]aneS$_6$); hexathiacyclooctadecane ([18]aneS$_6$); hexathiacyclononadecane ([19]aneS$_6$); hexathiacycloeicosane ([20]aneS$_6$); hexathiacycloheneicosane ([21]aneS$_6$); hexathiacyclodocosane ([22]aneS$_6$); hexathiacyclotricosane ([23]aneS$_6$); hexathiacyclotetracosane ([24]aneS$_6$); hexathiacyclododecatriene ([12]trieneS$_6$); hexathiacyclotridecatriene ([13]trieneS$_6$); hexathiacyclotetradecatriene ([14]trieneS$_6$); hexathiacyclopentadecatriene ([15]trieneS$_6$); hexathiacyclohexadecatriene ([16]trieneS$_6$); hexathiacycloheptadecatriene ([17]trieneS$_6$); hexathiacyclooctadecatriene ([18]trieneS$_6$); hexathiacyclononadecatriene ([19]trieneS$_6$); hexathiacycloeicosatriene ([20]trieneS$_6$); hexathiacycloheneicosatriene ([21]trieneS$_6$); hexathiacyclodocosatriene ([22]trieneS$_6$); hexathiacyclotricosatriene ([23]trieneS$_6$); and hexathiacyclotetracosatriene ([24]trieneS$_6$).

S Valence Stabilizer #13f: Examples of seven-membered macrocyclics, macrobicyclics, and macropolycyclics (including catapinands, cryptands, cyclidenes, and sepulchrates) wherein all binding sites are composed of sulfur (usually thiol or thioether groups) and are not contained in component heterocyclic rings (S—S Tridentates, S—S Tetradentates, or S—S Hexadentates) that meet the requirements for use as "narrow band" valence stabilizers for $Co^{+3}$ include, but are not limited to: heptathiacyclotetradecane ([14]aneS$_7$); heptathiacyclopentadecane ([15]aneS$_7$); heptathiacyclohexadecane ([16]aneS$_7$); heptathiacycloheptadecane ([17]aneS$_7$); heptathiacyclooctadecane ([18]aneS$_7$); heptathiacyclononadecane ([19]aneS$_7$); heptathiacycloeicosane ([20]aneS$_7$); heptathiacycloheneicosane ([21]aneS$_7$); heptathiacyclotetradecatriene ([14]trieneS$_7$); heptathiacyclopentadecatriene ([15]trieneS$_7$); heptathiacyclohexadecatriene ([16]trieneS$_7$); heptathiacycloheptadecatriene ([17]trieneS$_7$); heptathiacyclooctadecatriene ([18]trieneS$_7$); heptathiacyclononadecatriene ([19]trieneS$_7$); heptathiacycloeicosatriene ([20]trieneS$_7$); and heptathiacycloheneicosatriene ([21]trieneS$_7$).

S Valence Stabilizer #13g: Examples of eight-membered macrocyclics, macrobicyclics, and macropolycyclics (including catapinands, cryptands, cyclidenes, and sepulchrates) wherein all binding sites are composed of sulfur (usually thiol or thioether groups) and are not contained in component heterocyclic rings (S—S Tridentates, S—S Tetradentates, or S—S Hexadentates) that meet the requirements for use as "narrow band" valence stabilizers for $Co^{+3}$ include, but are not limited to: octathiacyclohexadecane ([16]aneS$_8$); octathiacycloheptadecane ([17]aneS$_8$); octathiacyclooctadecane ([18]aneS$_8$); octathiacyclononadecane ([19]aneS$_8$); octathiacycloeicosane ([20]aneS$_8$); octathiacycloheneicosane ([21]aneS$_8$); octathiacyclodocosane ([22]aneS$_8$); octathiacyclotricosane ([23]aneS$_8$); octathiacyclotetracosane ([24]aneS$_8$); octathiacyclohexadecatetradiene ([16]tetradieneS$_8$); octathiacycloheptadecatetradiene ([17]tetradieneS$_8$); octathiacyclooctadecatetradiene ([18]tetradieneS$_8$); octathiacyclononadecatetradiene ([19]tetradieneS$_8$); octathiacycloeicosatetradiene ([20]tetradieneS$_8$); octathiacycloheneicosatetradiene ([21]tetradieneS$_8$); octathiacyclodocosatetradiene ([22]tetradieneS$_8$); octathiacyclotricosatetradiene ([23]tetradieneS$_8$); and octathiacyclotetracosatetradiene ([24]tetradieneS$_8$).

S Valence Stabilizer #13h: Examples of nine-membered macrocyclics, macrobicyclics, and macropolycyclics (including catapinands, cryptands, cyclidenes, and sepulchrates) wherein all binding sites are composed of sulfur (usually thiol or thioether groups) and are not contained in component heterocyclic rings (S—S Tridentates, S—S Tetradentates, or S—S Hexadentates) that meet the requirements for use as "narrow band" valence stabilizers for $Co^{+3}$ include, but are not limited to: nonathiacyclooctadecane ([18]ane$S_9$); nonathiacyclononadecane ([19]ane$S_9$); nonathiacycloeicosane ([20]ane$S_9$); nonathiacycloheneicosane ([21]ane$S_9$); nonathiacyclodocosane ([22]ane$S_9$); nonathiacyclotricosane ([23]ane$S_9$); nonathiacyclotetracosane ([24]ane$S_9$); nonathiacyclopentacosane ([25]ane$S_9$); nonathiacyclohexacosane ([26]ane$S_9$); nonathiacycloheptacosane ([27]ane$S_9$); nonathiacyclooctadecatetradiene ([18]tetradiene$S_9$); nonathiacyclononadecatetradiene ([19]tetradiene$S_9$); nonathiacycloeicosatetradiene ([20]tetradiene$S_9$); nonathiacycloheneicosatetradiene ([21]tetradiene$S_9$); nonathiacyclodocosatetradiene ([22]tetradiene$S_9$); nonathiacyclotricosatetradiene ([23]tetradiene$S_9$); nonathiacyclotetracosatetradiene ([24]tetradiene$S_9$); nonathiacyclopentacosatetradiene ([25]tetradiene$S_9$); nonathiacyclohexacosatetradiene ([26]tetradiene$S_9$); and nonathiacycloheptacosatetradiene ([27]tetradiene$S_9$).

S Valence Stabilizer #13i: Examples of ten-membered macrocyclics, macrobicyclics, and macropolycyclics (including catapinands, cryptands, cyclidenes, and sepulchrates) wherein all binding sites are composed of sulfur (usually thiol or thioether groups) and are not contained in component heterocyclic rings (S—S Tridentates, S—S Tetradentates, or S—S Hexadentates) that meet the requirements for use as "narrow band" valence stabilizers for $Co^{+3}$ include, but are not limited to: decathiacycloeicosane ([20]ane$S_{10}$); decathiacycloheneicosane ([21]ane$S_{10}$); decathiacyclodocosane ([22]ane$S_{10}$); decathiacyclotricosane ([23]ane$S_{10}$); decathiacyclotetracosane ([24]ane$S_{10}$); decathiacyclopentacosane ([25]ane$S_{10}$); decathiacyclohexacosane ([26]ane$S_{10}$); decathiacycloheptacosane ([27]ane$S_{10}$); decathiacyclooctacosane ([28]ane$S_{10}$); decathiacyclononacosane ([29]ane$S_{10}$); decathiacyclotriacontane ([30]ane$S_{10}$); decathiacycloeicosapentadiene ([20]pentadiene$S_{10}$); decathiacycloheneicosapentadiene ([21]pentadiene$S_{10}$); decathiacyclodocosapentadiene ([22]pentadiene$S_{10}$); decathiacyclotricosapentadiene ([23]pentadiene$S_{10}$); decathiacyclotetracosapentadiene ([24]pentadiene$S_{10}$); decathiacyclopentacosapentadiene ([25]pentadiene$S_{10}$); decathiacyclohexacosapentadiene ([26]pentadiene$S_{10}$); decathiacycloheptacosapentadiene ([27]pentadiene$S_{10}$); decathiacyclooctacosapentadiene ([28]pentadiene$S_{10}$); decathiacyclononacosapentadiene ([29]pentadiene$S_{10}$); and decathiacyclotriacontapentadiene ([30]pentadiene$S_{10}$).

S Valence Stabilizer #14a: Examples of four-membered macrocyclics, macrobicyclics, and macropolycyclics (including catapinands, cryptands, cyclidenes, and sepulchrates) wherein all four binding sites are composed of sulfur and are contained in component 5-membered heterocyclic rings (S—S Tetradentates) that meet the requirements for use as "narrow band" valence stabilizers for $Co^{+3}$ include, but are not limited to: tetrathiophenes; tetrathiazoles; tetrathiaphospholes; tetraoxathioles; tetrathiadiazoles; tetrathiatriazoles; and tetradithioles.

S Valence Stabilizer #14b: Examples of five-membered macrocyclics, macrobicyclics, and macropolycyclics (including catapinands, cryptands, cyclidenes, and sepulchrates) wherein all five binding sites are composed of sulfur and are contained in component 5-membered heterocyclic rings (S—S Tridentates or S—S Tetradentates) that meet the requirements for use as "narrow band" valence stabilizers for $Co^{+3}$ include, but are not limited to: pentathiophenes; pentathiazoles; pentathiaphospholes; pentaoxathioles; pentathiadiazoles; pentathiatriazoles; and pentadithioles.

S Valence Stabilizer #14c: Examples of six-membered macrocyclics, macrobicyclics, and macropolycyclics (including catapinands, cryptands, cyclidenes, and sepulchrates) wherein all six binding sites are composed of sulfur and are contained in component 5-membered heterocyclic rings (S—S Tridentates, S—S Tetradentates, or S—S Hexadentates) that meet the requirements for use as "narrow band" valence stabilizers for $Co^{+3}$ include, but are not limited to: hexathiophenes; hexathiazoles; hexathiaphospholes; hexaoxathioles; hexathiadiazoles; hexathiatriazoles; and hexadithioles.

S Valence Stabilizer #14d: Examples of seven-membered macrocyclics, macrobicyclics, and macropolycyclics (including catapinands, cryptands, cyclidenes, and sepulchrates) wherein all seven binding sites are composed of sulfur and are contained in component 5-membered heterocyclic rings (S—S Tridentates, S—S Tetradentates, or S—S Hexadentates) that meet the requirements for use as "narrow band" valence stabilizers for $Co^{+3}$ include, but are not limited to: heptathiophenes; heptathiazoles; heptathiaphospholes; heptaoxathioles; heptathiadiazoles; heptathiatriazoles; and heptadithioles.

S Valence Stabilizer #14e: Examples of eight-membered macrocyclics, macrobicyclics, and macropolycyclics (including catapinands, cryptands, cyclidenes, and sepulchrates) wherein all eight binding sites are composed of sulfur and are contained in component 5-membered heterocyclic rings (S—S Tridentates, S—S Tetradentates, or S—S Hexadentates) that meet the requirements for use as "narrow band" valence stabilizers for $Co^{+3}$ include, but are not limited to: octathiophenes; octathiazoles; octathiaphospholes; octaoxathioles; octathiadiazoles; octathiatriazoles; and octadithioles.

S Valence Stabilizer #14f: Examples of nine-membered macrocyclics, macrobicyclics, and macropolycyclics (including catapinands, cryptands, cyclidenes, and sepulchrates) wherein all nine binding sites are composed of sulfur and are contained in component 5-membered heterocyclic rings (S—S Tridentates, S—S Tetradentates, or S—S Hexadentates) that meet the requirements for use as "narrow band" valence stabilizers for $Co^{+3}$ include, but are not limited to: nonathiophenes; nonathiazoles; nonathiaphospholes; nonaoxathioles; nonathiadiazoles; nonathiatriazoles; and nonadithioles.

S Valence Stabilizer #14g: Examples of ten-membered macrocyclics, macrobicyclics, and macropolycyclics (including catapinands, cryptands, cyclidenes, and sepulchrates) wherein all ten binding sites are composed of sulfur and are contained in component 5-membered heterocyclic rings (S—S Tridentates, S—S Tetradentates, or S—S Hexadentates) that meet the requirements for use as "narrow band" valence stabilizers for $Co^{+3}$ include, but are not limited to: decathiophenes; decathiazoles; decathiaphospholes; decaoxathioles; decathiadiazoles; decathiatriazoles; and decadithioles.

S Valence Stabilizer #15a: Examples of four-membered macrocyclics, macrobicyclics, and macropolycyclics (including catapinands, cryptands, cyclidenes, and sepulchrates) wherein all four binding sites are composed of sulfur and are contained in a combination of 5-membered heterocyclic rings and thiol, thioether, or thioketo groups (S—S Tetradentates) that meet the requirements for use as "narrow band" valence stabilizers for $Co^{+3}$ include, but are not limited to: dithiatetrathiophenes; tetrathiatetrathiophenes; dithiatetradithioles; and tetrathiatetradithioles.

S Valence Stabilizer #15b: Examples of five-membered macrocyclics, macrobicyclics, and macropolycyclics (including catapinands, cryptands, cyclidenes, and sepulchrates) wherein all five binding sites are composed of sulfur and are contained in a combination of 5-membered heterocyclic rings and thiol, thioether, or thioketo groups (S—S Tridentates or S—S Tetradentates) that meet the requirements for use as "narrow band" valence stabilizers for $Co^{+3}$ include, but are not limited to: dithiapentathiophenes; tetrathiapentathiophenes; dithiapentadithioles; and tetrathiapentadithioles.

S Valence Stabilizer #15c: Examples of six-membered macrocyclics, macrobicyclics, and macropolycyclics (including catapinands, cryptands, cyclidenes, and sepulchrates) wherein all six binding sites are composed of sulfur and are contained in a combination of 5-membered heterocyclic rings and thiol, thioether, or thioketo groups (S—S Tridentates, S—S Tetradentates, or S—S Hexadentates) that meet the requirements for use as "narrow band" valence stabilizers for $Co^{+3}$ include, but are not limited to: dithiahexaathiophenes; trithiahexathiophenes; dithiahexadithioles; and trithiahexadithioles.

S Valence Stabilizer #15d: Examples of seven-membered macrocyclics, macrobicyclics, and macropolycyclics (including catapinands, cryptands, cyclidenes, and sepulchrates) wherein all seven binding sites are composed of sulfur and are contained in a combination of 5-membered heterocyclic rings and thiol, thioether, or thioketo groups (S—S Tridentates, S—S Tetradentates, or S—S Hexadentates) that meet the requirements for use as "wide band" valence stabilizers for $Co^{+3}$ include, but are not limited to: dithiaheptathiophenes; tetrathiaheptathiophenes; dithiaheptadithioles; and tetrathiaheptadithioles.

S Valence Stabilizer #15e: Examples of eight-membered macrocyclics, macrobicyclics, and macropolycyclics (including catapinands, cryptands, cyclidenes, and sepulchrates) wherein all eight binding sites are composed of sulfur and are contained in a combination of 5-membered heterocyclic rings and thiol, thioether, or thioketo groups (S—S Tridentates, S—S Tetradentates, or S—S Hexadentates) that meet the requirements for use as "narrow band" valence stabilizers for $Co^{+3}$ include, but are not limited to: dithiaoctathiophenes; tetrathiaoctathiophenes; dithiaoctadithioles; and tetrathiaoctadithioles.

S Valence Stabilizer #15f: Examples of nine-membered macrocyclics, macrobicyclics, and macropolycyclics (including catapinands, cryptands, cyclidenes, and sepulchrates) wherein all nine binding sites are composed of sulfur and are contained in a combination of 5-membered heterocyclic rings and thiol, thioether, or thioketo groups (S—S Tridentates, S—S Tetradentates, or S—S Hexadentates) that meet the requirements for use as "narrow band" valence stabilizers for $Co^{+3}$ include, but are not limited to: trithianonathiophenes; hexathianonathiophenes; trithianonadithioles; and hexathianonadithioles.

S Valence Stabilizer #15g: Examples of ten-membered macrocyclics, macrobicyclics, and macropolycyclics (including catapinands, cryptands, cyclidenes, and sepulchrates) wherein all ten binding sites are composed of sulfur and are contained in a combination of 5-membered heterocyclic rings and thiol, thioether, or thioketo groups (S—S Tridentates, S—S Tetradentates, or S—S Hexadentates) that meet the requirements for use as "narrow band" valence stabilizers for $Co^{+3}$ include, but are not limited to: dithiadecathiophenes; pentathiadecathiophenes; dithiadecadithioles; and pentathiadecadithioles.

S Valence Stabilizer #16a: Examples of four-membered macrocyclics, macrobicyclics, and macropolycyclics (including catapinands, cryptands, cyclidenes, and sepulchrates) wherein all four binding sites are composed of sulfur and are contained in component 6-membered heterocyclic rings (S—S Tetradentates) that meet the requirements for use as "narrow band" valence stabilizers for $Co^{+3}$ include, but are not limited to: tetrathiopyrans; tetrathiazines; tetrathiaphosphorins; tetrathiadiphosphorins; tetraoxathiins; and tetradithiins.

S Valence Stabilizer #16b: Examples of five-membered macrocyclics, macrobicyclics, and macropolycyclics (including catapinands, cryptands, cyclidenes, and sepulchrates) wherein all five binding sites are composed of sulfur and are contained in component 6-membered heterocyclic rings (S—S Tridentates or S—S Tetradentates) that meet the requirements for use as "narrow band" valence stabilizers for $Co^{+3}$ include, but are not limited to: pentathiopyrans; pentathiazines; pentathiaphosphorins; pentathiadiphosphorins; pentaoxathiins; and pentadithiins.

S Valence Stabilizer #16c: Examples of six-membered macrocyclics, macrobicyclics, and macropolycyclics (including catapinands, cryptands, cyclidenes, and sepulchrates) wherein all six binding sites are composed of sulfur and are contained in component 6-membered heterocyclic rings (S—S Tridentates, S—S Tetradentates, or S—S Hexadentates) that meet the requirements for use as "narrow band" valence stabilizers for $Co^{+3}$ include, but are not limited to: hexathiopyrans; hexathiazines; hexathiaphosphorins; hexathiadiphosphorins; hexaoxathiins; and hexadithiins.

S Valence Stabilizer #16d: Examples of seven-membered macrocyclics, macrobicyclics, and macropolycyclics (including catapinands, cryptands, cyclidenes, and sepulchrates) wherein all seven binding sites are composed of sulfur and are contained in component 6-membered heterocyclic rings (S—S Tridentates, S—S Tetradentates, or S—S Hexadentates) that meet the requirements for use as "narrow band" valence stabilizers for $Co^{+3}$ include, but are not limited to: heptathiopyrans; heptathiazines; heptathiaphosphorins; heptathiadiphosphorins; heptaoxathiins; and heptadithiins.

S Valence Stabilizer #16e: Examples of eight-membered macrocyclics, macrobicyclics, and macropolycyclics (including catapinands, cryptands, cyclidenes, and sepulchrates) wherein all eight binding sites are composed of sulfur and are contained in component 6-membered heterocyclic rings (S—S Tridentates, S—S Tetradentates, or S—S Hexadentates) that meet the requirements for use as "narrow band" valence stabilizers for $Co^{+3}$ include, but are not limited to: octathiopyrans; octathiazines; octathiaphosphorins; octathiadiphosphorins; octaoxathiins; and octadithiins.

S Valence Stabilizer #16f: Examples of nine-membered macrocyclics, macrobicyclics, and macropolycyclics (including catapinands, cryptands, cyclidenes, and sepulchrates) wherein all nine binding sites are composed of sulfur and are contained in component 6-membered heterocyclic rings (S—S Tridentates, S—S Tetradentates, or S—S Hexadentates) that meet the requirements for use as "narrow band" valence stabilizers for $Co^{+3}$ include, but are not limited to: nonathiopyrans; nonathiazines; nonathiaphosphorins; nonathiadiphosphorins; nonaoxathiins; and nonadithiins.

S Valence Stabilizer #16g: Examples of ten-membered macrocyclics, macrobicyclics, and macropolycyclics (including catapinands, cryptands, cyclidenes, and sepulchrates) wherein all ten binding sites are composed of sulfur and are contained in component 6-membered heterocyclic rings (S—S Tridentates, S—S Tetradentates, or S—S Hexadentates) that meet the requirements for use as "narrow band" valence stabilizers for $Co^{+3}$ include, but are not limited to: decathiopyrans; decathiazines; decathiaphosphorins; decathiadiphosphorins; decaoxathiins; and decadithiins.

S Valence Stabilizer #17a: Examples of four-membered macrocyclics, macrobicyclics, and macropolycyclics (including catapinands, cryptands, cyclidenes, and sepulchrates) wherein all four binding sites are composed of sulfur and are contained in a combination of 6-membered heterocyclic rings and thiol, thioether, or thioketo groups (S—S Tetradentates) that meet the requirements for use as "narrow band" valence stabilizers for $Co^{+3}$ include, but are not limited to: dithiatetrathiopyrans; tetrathiatetrathiopyrans; dithiatetrathiazines; tetrathiatetrathiazines; dithiatetrathiaphosphorins; tetrathiatetrathiaphosphorins; dithiatetraoxathiins; tetrathiatetraoxathiins; dithiatetradithiins; and tetrathiatetradithiins.

S Valence Stabilizer #17b: Examples of five-membered macrocyclics, macrobicyclics, and macropolycyclics (including catapinands, cryptands, cyclidenes, and sepulchrates) wherein all five binding sites are composed of sulfur and are contained in a combination of 6-membered heterocyclic rings and thiol, thioether, or thioketo groups (S—S Tridentates or S—S Tetradentates) that meet the requirements for use as "narrow band" valence stabilizers for $Co^{+3}$ include, but are not limited to: dithiapentathiopyrans; tetrathiapentathiopyrans; dithiapentathiazines; tetrathiapentathiazines; dithiapentathiaphosphorins; tetrathiapentathiaphosphorins; dithiapentaoxathiins; tetrathiapentaoxathiins; dithiapentadithiins; and tetrathiapentadithiins.

S Valence Stabilizer #17c: Examples of six-membered macrocyclics, macrobicyclics, and macropolycyclics (including catapinands, cryptands, cyclidenes, and sepulchrates) wherein all six binding sites are composed of sulfur and are contained in a combination of 6-membered heterocyclic rings and thiol, thioether, or thioketo groups (S—S Tridentates, S—S Tetradentates, or S—S Hexadentates) that meet the requirements for use as "narrow band" valence stabilizers for $Co^{+3}$ include, but are not limited to: dithiahexathiopyrans; trithiahexathiopyrans; dithiahexathiazines; trithiahexathiazines; dithiahexathiaphosphorins; trithiahexathiaphosphorins; dithiahexaoxathiins; trithiahexaoxathiins; dithiahexadithiins; and trithiahexadithiins.

S Valence Stabilizer #17d: Examples of seven-membered macrocyclics, macrobicyclics, and macropolycyclics (including catapinands, cryptands, cyclidenes, and sepulchrates) wherein all seven binding sites are composed of sulfur and are contained in a combination of 6-membered heterocyclic rings and thiol, thioether, or thioketo groups (S—S Tridentates, S—S Tetradentates, or S—S Hexadentates) that meet the requirements for use as "narrow band" valence stabilizers for $Co^{+3}$ include, but are not limited to: dithiaheptathiopyrans; tetrathiaheptathiopyrans; dithiaheptathiazines; tetrathiaheptathiazines; dithiaheptathiaphosphorins; tetrathiaheptathiaphosphorins; dithiaheptaoxathiins; tetrathiaheptaoxathiins; dithiaheptadithiins; and tetrathiaheptadithiins.

S Valence Stabilizer #17e: Examples of eight-membered macrocyclics, macrobicyclics, and macropolycyclics (including catapinands, cryptands, cyclidenes, and sepulchrates) wherein all eight binding sites are composed of sulfur and are contained in a combination of 6-membered heterocyclic rings and thiol, thioether, or thioketo groups (S—S Tridentates, S—S Tetradentates, or S—S Hexadentates) that meet the requirements for use as "narrow band" valence stabilizers for $Co^{+3}$ include, but are not limited to: dithiaoctathiopyrans; tetrathiaoctathiopyrans; dithiaoctathiazines; tetrathiaoctathiazines; dithiaoctathiaphosphorins; tetrathiaoctathiaphosphorins; dithiaoctaoxathiins; tetrathiaoctaoxathiins; dithiaoctadithiins; and tetrathiaoctadithiins.

S Valence Stabilizer #17f: Examples of nine-membered macrocyclics, macrobicyclics, and macropolycyclics (including catapinands, cryptands, cyclidenes, and sepulchrates) wherein all nine binding sites are composed of sulfur and are contained in a combination of 6-membered heterocyclic rings and thiol, thioether, or thioketo groups (S—S Tridentates, S—S Tetradentates, or S—S Hexadentates) that meet the requirements for use as "narrow band" valence stabilizers for $Co^{+3}$ include, but are not limited to: trithianonathiopyrans; hexathianonathiopyrans; trithianonathiazines; hexathianonathiazines; trithianonathiaphosphorins; hexathianonathiaphosphorins; trithianonaoxathiins; hexathianonaoxathiins; trithianonadithiins; and hexathianonadithiins.

S Valence Stabilizer #17g: Examples of ten-membered macrocyclics, macrobicyclics, and macropolycyclics (including catapinands, cryptands, cyclidenes, and sepulchrates) wherein all ten binding sites are composed of sulfur and are contained in a combination of 6-membered heterocyclic rings and thiol, thioether, or thioketo groups (S—S Tridentates, S—S Tetradentates, or S—S Hexadentates) that meet the requirements for use as "narrow band" valence stabilizers for $Co^{+3}$ include, but are not limited to: dithiadecathiopyrans; pentathiadecathiopyrans; dithiadecathiazines; pentathiadecathiazines; dithiadecathiaphosphorins; pentathiadecathiaphosphorins; dithiadecaoxathiins; pentathiadecaoxathiins; dithiadecadithiins; and pentathiadecadithiins.

S Valence Stabilizer #18: Examples of dithiobiurets (dithioimidodicarbonic diamides), dithioisobiurets, dithiobiureas, trithiotriurets, trithiotriureas, bis(dithiobiurets), bis(dithioisobiurets), bis(dithiobiureas), poly(dithiobiurets), poly(dithioisobiurets), and poly(dithiobiureas) (S—S Bidentates, S—S Tridentates, S—S Tetradentates) that meet the requirements for use as "narrow band" valence stabilizers for $Co^{+3}$ include, but are not limited to: dithiobiuret, dithioisobiuret, dithiobiurea, trithiotriuret, trithiotriurea, nitrodithiobiuret, dinitrodithiobiuret, aminodithiobiuret, diaminodithiobiuret, oxydithiobiuret, dioxydithiobiuret, cyanodithiobiuret, methyldithiobiuret, ethyldithiobiuret, isopropyldithiobiuret, phenyldithiobiuret, benzyldithiobiuret, cyclohexyldithiobiuret, norbornyldithiobiuret, adamantyldithiobiuret, dimethyldithiobiuret, diethyldithiobiuret, diisopropyldithiobiuret, diphenyldithiobiuret, dibenzyldithiobiuret, dicyclohexyldithiobiuret, dinorbornyldithiobiuret, and diadamantyldithiobiuret.

S Valence Stabilizer #19: Examples of thioacylthioureas, thioaroylthioureas, bis(thioacylthioureas), bis(thioaroylthioureas), poly(thioacylthioureas), and poly(thioaroylthioureas) (S—S Bidentates, S—S Tridentates, S—S Tetradentates) that meet the requirements for use as "narrow band" valence stabilizers for $Co^{+3}$ include, but are not limited to: thioformylthiourea, thioacetylthiourea, thiobenzoylthiourea, thiocyclohexoylthiourea, pentafluorothiobenzoylthiourea, N-methylthioacetylthiourea, N-phenylthiobenzoylthiourea, and N-cyclohexylthiocyclohexoylthiourea.

S Valence Stabilizer #20: Examples of dithioacyl disulfides, bis(dithioacyl disulfides), and poly(dithioacyl disulfides), (S—S Bidentates, S—S Tridentates, S—S Tetradentates) that meet the requirements for use as "narrow band" valence stabilizers for $Co^{+3}$ include, but are not limited to: dithioacetyl disulfide; dithiopropanoyl disulfide; dithiobenzoyl disulfide; and dithiopentafluorobenzoyl disulfide.

S Valence Stabilizer #21: Examples of tetrathioperoxydicarbonic diamides, bis(tetrathioperoxydicarbonic diamides), and poly(tetrathioperoxydicarbonic diamides) (S—S Bidentates, S—S Tridentates, S—S Tetradentates) that meet the requirements for use as "narrow band" valence stabilizers for $Co^{+3}$ include, but are not limited to: tetrathioperoxydicarbonic diamide; N-phenyltetrathioperoxydicarbonic diamide; N-benzyltetrathioperoxydicarbonic diamide; N-cyclohexyltetrathioperoxydicarbonic diamide; N-norbornyltetrathioperoxydicarbonic diamide; N,N'-diphenyltetrathioperoxydicarbonic diamide; N,N'-dibenzyltetrathioperoxydicarbonic diamide; N,N'-dicyclohexyltetrathioperoxydicarbonic diamide; and N,N'-dinorbornyltetrathioperoxydicarbonic diamide.

S Valence Stabilizer #22: Examples of hexathio-, pentathio-, and tetrathioperoxydicarbonic acids, bis(hexathio-, pentathio-, and tetrathioperoxydicarbonic acids), poly (hexathio-, pentathio-, and tetrathioperoxydicarbonic acids), and derivatives thereof (S—S Bidentates, S—S Tridentates, S—S Tetradentates) that meet the requirements for use as "narrow band" valence stabilizers for $Co^{+3}$ include, but are not limited to: hexathioperoxydicarbonic acid, pentathioperoxydicarbonic acid, tetrathioperoxydicarbonic acid, S-phenylhexathioperoxydicarbonic acid; S-benzylhexathioperoxydicarbonic acid; S-cyclohexylhexathioperoxydicarbonic acid; S-norbornylhexathioperoxydicarbonic acid; S,S'-diphenylhexathioperoxydicarbonic acid; S,S'-dibenzylhexathioperoxydicarbonic acid; S,S'-dicyclohexylhexathioperoxydicarbonic acid; and S,S'-dinorbornylhexathioperoxydicarbonic acid.

S Valence Stabilizer #23: Examples of dithioperoxydiphosphoramides, bis(dithioperoxydiphosphoramides), and poly (dithioperoxydiphosphoramides) (S—S Bidentates, S—S Tridentates, S—S Tetradentates) that meet the requirements for use as "narrow band" valence stabilizers for $Co^{+3}$ include, but are not limited to: dithioperoxydiphosphoramide, N-methyldithioperoxydiphosphoramide, N-isopropyldithioperoxydiphosphoramide, N-tert-butyldithioperoxydiphosphoramide, N-phenyldithioperoxydiphosphoramide, N-pentafluorophenyldithioperoxydiphosphoramide, N-benzyldithioperoxydiphosphoramide, N-cyclohexyldithioperoxydiphosphoramide, N-norbornyldithioperoxydiphosphoramide, N,N'''-dimethyldithioperoxydiphosphoramide, N,N'''-diisopropyldithioperoxydiphosphoramide, N,N'''-di-tert-butyldithioperoxydiphosphoramide, N,N'''-diphenyldithioperoxydiphosphoramide, N,N'''-di-pentafluorophenyldithioperoxydiphosphoramide, N,N'''-dibenzyldithioperoxydiphosphoramide, N,N'''-dicyclohexyldithioperoxydiphosphoramide, and N,N'''-dinorbornyldithioperoxydiphosphoramide.

S Valence Stabilizer #24: Examples of dithioperoxydiphosphoric acids, bis(dithioperoxydiphosphoric acids), poly (dithioperoxydiphosphoric acids), and derivatives thereof (S—S Bidentates, S—S Tridentates, S—S Tetradentates) that meet the requirements for use as "narrow band" valence stabilizers for $Co^{+3}$ include, but are not limited to: dithioperoxydiphosphoric acid, methyldithioperoxydiphosphoric acid, isopropyldithioperoxydiphosphoric acid, tert-butyldithioperoxydiphosphoric acid, phenyldithioperoxydiphosphoric acid, pentafluorophenyldithioperoxydiphosphoric acid, benzyldithioperoxydiphosphoric acid, cyclohexyldithioperoxydiphosphoric acid, norbornyldithioperoxydiphosphoric acid, dimethyldithioperoxydiphosphoric acid, diisopropyldithioperoxydiphosphoric acid, di-tert-butyldithioperoxydiphosphoric acid, diphenyldithioperoxydiphosphoric acid, di-pentafluorophenyldithioperoxydiphosphoric acid, dibenzyldithioperoxydiphosphoric acid, dicyclohexyldithioperoxydiphosphoric acid, and dinorbornyldithioperoxydiphosphoric acid.

S Valence Stabilizer #25: Examples of dithioimidodiphosphonic acids, dithiohydrazidodiphosphonic acids, bis (dithioimidodiphosphonic acids), bis(dithiohydrazidodiphosphonic acids), poly(dithioimidodiphosphonic acids), poly(dithiohydrazidodiphosphonic acids), and derivatives thereof (S—S Bidentates, S—S Tridentates, S—S Tetradentates) that meet the requirements for use as "narrow band" valence stabilizers for $Co^{+3}$ include, but are not limited to: dithioimidodiphosphonic acid, methyldithioimidodiphosphonic acid, isopropyldithioimidodiphosphonic acid, tert-butyldithioimidodiphosphonic acid, phenyldithioimidodiphosphonic acid, pentafluorophenyldithioimidodiphosphonic acid, benzyldithioimidodiphosphonic acid, cyclohexyldithioimidodiphosphonic acid, norbornyldithioimidodiphosphonic acid, dimethyldithioimidodiphosphonic acid, diisopropyldiothioimidodiphosphonic acid, di-tert-butyldithioimidodiphosphonic acid, diphenyldithioimidodiphosphonic acid, di-pentafluorophenyldithioimidodiphosphonic acid, dibenzyldithioimidodiphosphonic acid, dicyclohexyldithioimidodiphosphonic acid, and dinorbornyldithioimidodiphosphonic acid. [Note: The phosphite ($P^{+3}$) valence of the phosphorus atom makes stabilization of high valence metal ions much more difficult, though still possible.]

S Valence Stabilizer #26: Examples of dithioimidodiphosphonamides, dithiohydrazidodiphosphonamides, bis(dithioimidodiphosphonamides), bis(dithiohydrazidodiphosphonamides), poly(dithioimidodiphosphonamides), and poly (dithiohydrazidodiphosphonamides) (S—S Bidentates, S—S Tridentates, S—S Tetradentates) that meet the requirements for use as "narrow band" valence stabilizers for $Co^{+3}$ include, but are not limited to: dithioimidodiphosphonamide, N-methyldithioimidodiphosphonamide, N-isopropyldithioimidodiphosphonamide, N-tert-butyldithioimidodiphosphonamide, N-phenyldithioimidodiphosphonamide, N-pentafluorophenyldithioimidodiphosphonamide, N-benzyldithioimidodiphosphonamide, N-cyclohexyldithioimidodiphosphonamide, N-norbornyldithioimidodiphosphonamide, N,N'''-dimethyldithioimidodiphosphonamide, N,N'''-diisopropyldithioimidodiphosphonamide, N,N'''-di-tert-butyldithioimidodiphosphonamide, N,N'''-diphenyldithioimidodiphosphonamide, N,N'''-di-pentafluorophenyldithioimidodiphosphonamide, N,N'''-dibenzyldithioimidodiphosphonamide, N,N'''-dicyclohexyldithioimidodiphosphonamide, and N,N'''-dinorbornyldithioimidodiphosphonamide. [Note: The phosphite ($P^{+3}$) valence of the phosphorus atom makes stabilization of high valence metal ions much more difficult, though still possible.]

S Valence Stabilizer #27: Examples of dithiodiphosphonamides, bis(dithiodiphosphonamides), and poly(dithiodiphosphonamides) (S—S Bidentates, S—S Tridentates, S—S Tetradentates) that meet the requirements for use as "narrow band" valence stabilizers for $Co^{+3}$ include, but are not limited to: dithiodiphosphonamide, N-methyldithiodiphosphonamide, N-isopropyldithiodiphosphonamide, N-tert-butyldithiodiphosphonamide, N-phenyldithiodiphosphonamide, N-pentafluorophenyldithiodiphosphonamide, N-benzyldithiodiphosphonamide, N-cyclohexyldithiodiphosphonamide, N-norbornyldithiodiphosphonamide, N,N'''-dimethyldithiodiphosphonamide, N,N'''-diisopropyldithiodiphosphonamide, N,N'''-di-tert-butyldithiodiphosphonamide, N,N'''-diphenyldithiodiphosphonamide, N,N'''-di-pentafluorophenyldithiodiphosphonamide, N,N'''-dibenzyldithiodiphosphonamide, N,N'''-dicyclohexyldithiodiphosphonamide, and N,N'''-dinorbornyldithiodiphosphonamide. [Note: The phosphite ($P^{+3}$) valence of the phosphorus atom makes stabilization of high valence metal ions much more difficult, though still possible.]

S Valence Stabilizer #28: Examples of dithiodiphosphonic acids, bis(dithiodiphosphonic acids), poly(dithiodiphosphonic acids), and derivatives thereof (S—S Bidentates, S—S Tridentates, S—S Tetradentates) that meet the requirements for use as "narrow band" valence stabilizers for $Co^{+3}$ include, but are not limited to: dithiodiphosphonic acid, methyldithiodiphosphonic acid, isopropyldithiodiphosphonic acid, tert-butyldithiodiphosphonic acid, phenyldithiodiphosphonic acid, pentafluorophenyldithiodiphosphonic acid, benzyldithiodiphosphonic acid, cyclohexyldithiodiphosphonic acid, norbornyldithiodiphosphonic acid, dimethyldithiodiphosphonic acid, diisopropyldiothiodiphosphonic acid, di-tert-butyldithiodiphosphonic acid, diphenyldithiodiphosphonic acid, di-pentafluorophenyldithiodiphosphonic acid, dibenzyldithiodiphosphonic acid, dicyclohexyldithiodiphosphonic acid, and dinorbornyldithiodiphosphonic acid. [Note: The phosphite ($P^{+3}$) valence of the phosphorus atom makes stabilization of high valence metal ions much more difficult, though still possible.]

S Valence Stabilizer #29: Examples of dithioperoxydiphosphonamides, bis(dithioperoxydiphosphonamides), and poly(dithioperoxydiphosphonamides) (S—S Bidentates, S—S Tridentates, S—S Tetradentates) that meet the requirements for use as "narrow band" valence stabilizers for $Co^{+3}$ include, but are not limited to: dithioperoxydiphosphonamide, N-methyldithioperoxydiphosphonamide, N-isopropyldithioperoxydiphosphonamide, N-tert-butyldithioperoxydiphosphonamide, N-phenyldithioperoxydiphosphonamide, N-pentafluorophenyldithioperoxydiphosphonamide, N-benzyldithioperoxydiphosphonamide, N-cyclohexyldithioperoxydiphosphonamide, N-norbornyldithioperoxydiphosphonamide, N,N'''-dimethyldithioperoxydiphosphonamide, N,N'''-diisopropyldithioperoxydiphosphonamide, N,N'''-di-tert-butyldithioperoxydiphosphonamide, N,N'''-diphenyldithioperoxydiphosphonamide, N,N'''-di-pentafluorophenyldithioperoxydiphosphonamide, N,N'''-dibenzyldithioperoxydiphosphonamide, N,N'''-dicyclohexyldithioperoxydiphosphonamide, and N,N'''-dinorbornyldithioperoxydiphosphonamide. [Note: The phosphite ($P^{+3}$) valence of the phosphorus atom makes stabilization of high valence metal ions much more difficult, though still possible.]

S Valence Stabilizer #30: Examples of dithioperoxydiphosphonic acids, bis(dithioperoxydiphosphonic acids), poly(dithioperoxydiphosphonic acids), and derivatives thereof (S—S Bidentates, S—S Tridentates, S—S Tetradentates) that meet the requirements for use as "narrow band" valence stabilizers for $Co^{+3}$ include, but are not limited to: dithioperoxydiphosphonic acid, methyldithioperoxydiphosphonic acid, isopropyldithioperoxydiphosphonic acid, tert-butyldithioperoxydiphosphonic acid, phenyldithioperoxydiphosphonic acid, pentafluorophenyldithioperoxydiphosphonic acid, benzyldithioperoxydiphosphonic acid, cyclohexyldithioperoxydiphosphonic acid, norbornyldithioperoxydiphosphonic acid, dimethyldithioperoxydiphosphonic acid, diisopropyldithioperoxydiphosphonic acid, di-tert-butyldithioperoxydiphosphonic acid, diphenyldithioperoxydiphosphonic acid, di-pentafluorophenyldithioperoxydiphosphonic acid, dibenzyldithioperoxydiphosphonic acid, dicyclohexyldithioperoxydiphosphonic acid, and dinorbornyldithioperoxydiphosphonic acid. [Note: The phosphite ($P^{+3}$) valence of the phosphorus atom makes stabilization of high valence metal ions much more difficult, though still possible.]

S Valence Stabilizer #31: Examples of dithiophosphonic acids (phosphonodithioic acids), bis(dithiophosphonic acids), poly(dithiophosphonic acids), and derivatives thereof (S—S Bidentates, S—S Tridentates, S—S Tetradentates) that meet the requirements for use as "narrow band" valence stabilizers for $Co^{+3}$ include, but are not limited to: dithiophosphonic acid, O-phenyldithiophosphonic acid, O-benzyldithiophosphonic acid, O-cyclohexyldithiophosphonic acid, O-norbornyldithiophosphonic acid, O,P-diphenyldithiophosphonic acid, O,P-dibenzyldithiophosphonic acid, O,P-dicyclohexyldithiophosphonic acid, and O,P-dinorbornyldithiophosphonic acid. [Note: The phosphite ($P^{+3}$) valence of the phosphorus atom makes stabilization of high valence metal ions much more difficult, though still possible.]

S Valence Stabilizer #32: Examples of trithiophosphonic acids (phosphonotrithioic acids), bis(trithiophosphonic acids), poly(trithiophosphonic acids), and derivatives thereof (S—S Bidentates, S—S Tridentates, S—S Tetradentates) that meet the requirements for use as "narrow band" valence stabilizers for $Co^{+3}$ include, but are not limited to: trithiophosphonic acid, S-phenyltrithiophosphonic acid, S-benzyltrithiophosphonic acid, S-cyclohexyltrithiophosphonic acid, S-norbornyltrithiophosphonic acid, S,P-diphenyltrithiophosphonic acid, S,P-dibenzyltrithiophosphonic acid, S,P-dicyclohexyltrithiophosphonic acid, and S,P-dinorbornyltrithiophosphonic acid. [Note: The phosphite ($p^{+3}$) valence of the phosphorus atom makes stabilization of high valence metal ions much more difficult, though still possible.]

S Valence Stabilizer #33: Examples of phosphono(dithioperoxo)thioic acids, bis[phosphono(dithioperoxo)thioic acids], poly[phosphono(dithioperoxo)thioic acids], and derivatives thereof (S—S Bidentates, S—S Tridentates, S—S Tetradentates) that meet the requirements for use as "narrow band" valence stabilizers for $Co^{+3}$ include, but are not limited to: phosphono(dithioperoxo)thioic acid, O-phenylphosphono(dithioperoxo)thioic acid, O-benzylphosphono(dithioperoxo)thioic acid, O-cyclohexylphosphono(dithioperoxo)thioic acid, O-norbornylphosphono(dithioperoxo)thioic acid, O,P-diphenylphosphono(dithioperoxo)thioic acid, O,P-dibenzylphosphono(dithioperoxo)thioic acid, O,P-dicyclohexylphosphono(dithioperoxo)thioic acid, and O,P-dinorbornylphosphono(dithioperoxo)thioic acid. [Note: The phosphite ($P^{+3}$) valence of the phosphorus atom makes stabilization of high valence metal ions much more difficult, though still possible.]

S Valence Stabilizer #34: Examples of phosphono(dithioperoxo)dithioic acids, bis[phosphono(dithioperoxo)dithioic acids], poly[phosphono(dithioperoxo)dithioic acids], and derivatives thereof (S—S Bidentates, S—S Tridentates, S—S Tetradentates) that meet the requirements for use as "narrow band" valence stabilizers for $Co^{+3}$ include, but are not limited to: phosphono(dithioperoxo)dithioic acid, S-phenylphosphono(dithioperoxo)dithioic acid, S-benzylphosphono(dithioperoxo)dithioic acid, S-cyclohexylphosphono(dithioperoxo)dithioic acid, S-norbornylphosphono(dithioperoxo)dithioic acid, S,P-diphenylphosphono(dithioperoxo)dithioic acid, S,P-dibenzylphosphono(dithioperoxo)dithioic acid, S,P-dicyclohexylphosphono(dithioperoxo)dithioic acid, and S,P-dinorbornylphosphono(dithioperoxo)dithioic acid. [Note: The phosphite ($P^{+3}$) valence of the phosphorus atom makes stabilization of high valence metal ions much more difficult, though still possible.]

S Valence Stabilizer #35: Examples of S-(alkylthio)thiocarboxylic acids, S-(arylthio)thiocarboxylic acids, and S,S-thiobisthiocarboxylic Acids (S—S Bidentates and S—S Tridentates) that meet the requirements for use as "narrow band" valence stabilizers for $Co^{+3}$ include, but are not limited to: (methylthio)thioacetic acid; (methylthio)thiobenzoic acid; (methylthio)thionicotinic acid; (methylthio)thionapthoic acid; (phenylthio)thioacetic acid; (phenylthio)thiobenzoic acid; (phenylthio)thionaphthoic acid; (norbornylthio)thioacetic acid; (norbornylthio)thiobenzoic acid; (norbornylthio)thionapthoic acid; thiobisthioacetic acid; thiobisthiobenzoic acid; and thiobisthionapthoic acid.

S Valence Stabilizer #36: Examples of S-(alkyldisulfido)thiocarboxylic acids, S-(aryldisulfido)thiocarboxylic acids, and S,S'-disulfidobisthiocarboxylic acids (S—S Bidentates and S—S Tridentates) that meet the requirements for use as "narrow band" valence stabilizers for $Co^{+3}$ include, but are not limited to: (methyldisulfido)thioacetic acid; (methyldisulfido)thiobenzoic acid; (methyldisulfido)thionicotinic acid; (methyldisulfido)thionapthoic acid; (phenyldisulfido)thioacetic acid; (phenyldisulfido)thiobenzoic acid; (phenyldisulfido)thionaphthoic acid; (norbornyldisulfido)thioacetic acid; (norbornyldisulfido)thiobenzoic acid; (norbornyldisulfido)thionapthoic acid; S,S'-disulfidobisthioacetic acid; S,S'-disulfidobisthiobenzoic acid; and S,S'-disulfidobisthionapthoic acid.

S Valence Stabilizer #37: Examples of 1,2-dithiolates, bis(1,2-dithiolates), and poly(1,2-dithiolates) (S—S Bidentates, S—S Tridentates, S—S Tetradentates) that meet the requirements for use as "narrow band" valence stabilizers for $Co^{+3}$ include, but are not limited to: 2,3-butanedithiol; 1,2-diphenyl-1,2-ethanedithiol; 1,2-di(pentafluorophenyl)-1,2-ethanedithio; 1,2-dicyclohexyl-1,2-ethanedithiol; 1,2-dinorbornyl-1,2-ethanedithiol; 2,3-dimercaptopropanol; 2,3-dimercaptosuccinic acid; poly[bis(arylthio)acetylene]s; and poly[bis(alkylylthio)acetylene]s.

S Valence Stabilizer #38: Examples of rhodanines and bis(rhodanines) (S—S Bidentates and S—S Tetradentates) that meet the requirements for use as "narrow band" valence stabilizers for $Co^{+3}$ include, but are not limited to: 3-methylrhodanine; 3-ethylrhodanine; 3-isopropylrhodanine; 3-phenylrhodanine; 3-benzylrhodanine; 3-cyclohexylrhodanine; 3-norbornylrhodanine; 5-methylrhodanine; 5-ethylrhodanine; 5-isopropylrhodanine; 5-phenylrhodanine; 5-benzylrhodanine; 5-cyclohexylrhodanine; 5-norbornylrhodanine; 3,3'-ethylenebisrhodanine; 3,3'-propylenerhodanine; 3,3'-butylenerhodanine; 5,5'-ethylenebisrhodanine; 5,5'-propylenerhodanine; and 5,5'-butylenerhodanine. [Note: rhodanines and bis(rhodanines) tend to stabilize lower oxidation states in metal ions.]

S Valence Stabilizer #39: Examples of dithiocarbimates, bis(dithiocarbimates), and poly(dithiocarbimates) (S—S Bidentates, S—S Tridentates, and S—S Tetradentates) that meet the requirements for use as "narrow band" valence stabilizers for $Co^{+3}$ include, but are not limited to: methyldithiocarbimate; trifluoromethyldithiocarbimate; ethyldithiocarbimate; propyldithiocarbimate; isopropyldithiocarbimate; butyldithiocarbimate; tertbutyldithiocarbimate; cyanodithiocarbimate (CDC); cyanamidodithiocarbimate; azidodithiocarbimate; phenyldithiocarbimate; pentafluorophenyldithiocarbimate; benzyldithiocarbimate; naphthyldithiocarbimate; cyclohexyldithiocarbimate; norbornyldithiocarbimate; and adamantyldithiocarbimate. [Note: Carbimates tend to stabilize lower oxidation states in metal ions.]

S Valence Stabilizer #40: Examples of thioxanthates, bis(thioxanthates), and poly(thioxanthates) (S—S Bidentates and S—S Tetradentates) that meet the requirements for use as "narrow band" valence stabilizers for $Co^{+3}$ include, but are not limited to: methyl thioxanthate (MeSxan); ethyl thioxanthate (EtSxan); isopropyl thioxanthate (iPrSxan); trifluoromethyl thioxanthate ($CF_3$Sxan); cyanothioxanthate; cyanamidothioxanthate; phenyl thioxanthate (PhSxan); benzyl thioxanthate (BzSxan); pentafluorophenyl thioxanthate; cyclohexyl thioxanthate (cHxSxan); and norbornyl thioxanthate. [Note: Thioxanthates tend to stabilize lower oxidation states in metal ions.]

S Valence Stabilizer #41: Examples of xanthates, bis(xanthates), and poly(xanthates) (S—S Bidentates and S—S Tetradentates) that meet the requirements for use as "narrow band" valence stabilizers for $Co^{+3}$ include, but are not limited to: methyl xanthate (Mexan); ethyl xanthate (Etxan); isopropyl xanthate (iPrxan); trifluoromethyl xanthate ($CF_3$xan); cyanoxanthate; cyanamidoxanthate; phenyl xanthate (Phxan); benzyl xanthate (Bzxan); pentafluorophenyl xanthate; cyclohexyl xanthate (cHxxan); and norbornyl xanthate. [Note: Xanthates tend to stabilize lower oxidation states in metal ions.]

S Valence Stabilizer #42: Examples of phosphinodithioformates (S—S Bidentates) that meet the requirements for use as "narrow band" valence stabilizers for $Co^{+3}$ include, but are not limited to: trimethylphosphinodithioformate; triethylphosphinodithioformate; triphenylphosphinodithioformate; tricyclohexylphosphinodithioformate; dimethylphosphinodithioformate; diethylphosphinodithioformate; diphenylphosphinodithioformate; and dicyclohexylphosphinodithioformate.

S Valence Stabilizer #43: Examples of alkyl- and aryl-dithioborates, trithioborates, perthioborates, bis(dithioborates), bis(trithioborates), and bis(perthioborates) (S—S Bidentates and S—S Tetradentates) that meet the requirements for use as "narrow band" valence stabilizers for $Co^{+3}$ include, but are not limited to: S,O-diethyl dithioborate; S,O-diisopropyl dithioborate; S,O-diphenyl dithioborate; S,O-dibenzyl dithioborate; S,O-dicyclohexyl dithioborate; S,O-dinorbornyl dithioborate; diethyl trithioborate; diisopropyl trithioborate; diphenyl trithioborate; dibenzyl trithioborate; dicyclohexyl trithioborate; and dinorbornyl trithioborate.

S Valence Stabilizer #44: Examples of alkyl- and aryl-dithioboronates and bis(dithioboronates) (S—S Bidentates and S—S Tetradentates) that meet the requirements for use as "narrow band" valence stabilizers for $Co^{+3}$ include, but are not limited to: diethyl dithioboronate; diisopropyl dithioboronate; diphenyl dithioboronate; dibenzyl dithioboronate; dicyclohexyl dithioboronate; and dinorbornyl dithioboronate. [Note: boronates tend to stabilize lower oxidation states in metal ions.]

S Valence Stabilizer #45: Examples of trithioarsonic acids (arsonotrithioic acids), dithioarsonic acids (arsonodithioic acids), tetrathioarsonic acids (arsonotetrathioic acids), and derivatives thereof (S—S Bidentates, S—S Tridentates, S—S Tetradentates) that meet the requirements for use as "narrow band" valence stabilizers for $Co^{+3}$ include, but are not limited to: trithioarsonic acid, O-phenyltrithioarsonic acid, O-benzyltrithioarsonic acid, O-cyclohexyltrithioarsonic acid, O-norbornyltrithioarsonic acid, O,S-diphenyltrithioarsonic acid, O,S-dibenzyltrithioarsonic acid, O,S-dicyclohexyltrithioarsonic acid, O,S-dinorbornyltrithioarsonic acid; dithioarsonic acid, O-phenyldithioarsonic acid, O-benzyldithioarsonic acid, O-cyclohexyldithioarsonic acid, O-norbornyldithioarsonic acid, O,O-diphenyldithioarsonic acid, O,O-dibenzyldithioarsonic acid, O,O-dicyclohexyldithioarsonic acid, and O,O-dinorbornyldithioarsonic acid.

S Valence Stabilizer #46: Examples of trithioantimonic acids (stibonotrithioic acids), dithioantimonic acids (stibonodithioic acids), tetrathioantimonic acids (stibonotetrathioic acids), and derivatives thereof (S—S Bidentates, S—S Tridentates, S—S Tetradentates) that meet the requirements for use as "narrow band" valence stabilizers for $Co^{+3}$ include, but are not limited to: trimethyltrithioantimonate; triethyltrithioantimonate; and triphenyltrithioantimonate.

S Valence Stabilizer #47: Examples of phosphine P-sulfides and amino-substituted phosphine sulfides (S Monodentates) that meet the requirements for use as "narrow band" valence stabilizers for $Co^{+3}$ include, but are not limited to: trimethylphosphine sulfide (TMPS); triethylphosphine sulfide (TEPS); triphenylphosphine sulfide (TPhPS); tribenzylphosphine sulfide (TBzPS); tricyclohexylphosphine sulfide (TcHxPS); and trinorbornylphosphine sulfide for phosphine P-sulfides; and tris(dimethylamino)phosphine sulfide; trimorpholinophosphine sulfide; tripiperidinophosphine sulfide; tripyrrolidinophosphine sulfide; and tri(cyclohexylamino)phosphine sulfide for amino-substituted phosphine sulfides.

S Valence Stabilizer #48: Examples of arsine As-sulfides and amino-substituted arsine sulfides (S Monodentates) that meet the requirements for use as "narrow band" valence stabilizers for $Co^{+3}$ include, but are not limited to: trimethylarsine sulfide; triethylarsine sulfide; triphenylarsine sulfide; tribenzylarsine sulfide; tricyclohexylarsine sulfide; and trinorbornylarsine sulfide for arsine As-sulfides; and tris(dimethylamino)arsine sulfide; trimorpholinoarsine sulfide; tripiperidinoarsine sulfide; tripyrrolidinoarsine sulfide; and tri(cyclohexylamino)arsine sulfide for amino-substituted arsine sulfides.

S Valence Stabilizer #49: Examples of thiocyanate ligands (S monodentates) that meet the requirements for use as "narrow band" valence stabilizers for $Co^{+3}$ include, but are not limited to: selenocyanate (—SCN).

S Valence Stabilizer #50: Examples of thiolates that meet the requirements for use as "narrow band" valence stabilizers for $Co^{+3}$ include, but are not limited to: thiophenol; naphthalenethiol; 1-dodecanethion; hexadecyl mercaptan; benzenethiol (bt); polybenzenethiols; and polythioarylenes.

S Valence Stabilizer #51: Examples of sulfide that meet the requirements for use as "narrow band" valence stabilizers for $Co^{+3}$ include, but are not limited to: sulfides ($—S^{2-}$); disulfides ($—S_2^{2-}$): and polysulfides ($—S_x^{2-}$).

P Valence Stabilizer #1: Examples of monophosphines (P monodentates) that meet the requirements for use as "narrow band" valence stabilizers for $Co^{+3}$ include, but are not limited to: phosphine, phenylphosphine, diphenylphosphine, triphenylphosphine, tricyclohexylphosphine, phenyldimethylphosphine, phenyldiethylphosphine, methyldiphenylphosphine, ethyldiphenylphosphine, phosphirane, phosphetane, phospholane, phosphorinane, benzophospholane, benzophosphorinane, dibenzophospholane, dibenzophosphorinane, naphthophospholane, naphthophosphorinane, phosphinonorbornane, and phosphinoadamantane.

P Valence Stabilizer #2: Examples of diphosphines (P monodentates or P—P bidentates) that meet the requirements for use as "narrow band" valence stabilizers for $Co^{+3}$ include, but are not limited to: diphospholane, benzodiphospholane, naphthodiphospholane, diphosphorinane, benzodiphosphorinane, dibenzodiphosphorinane, naphthodiphosphorinane, bis(diphenylphosphino)methane, bis(diphenylphosphino)ethane, bis(diphenylphosphino)propane, bis(diphenylphosphino)butane, bis(diphenylphosphino)pentane, 1,2-bis(diphenylphosphino)ethylene, and o-phenylenebis(diphenylphosphine). (Note: the aryl derivatives are air-stable, whereas the alkyl derivatives are air-sensitive and therefore unsuitable for these applications.)

P Valence Stabilizer #3: Examples of triphosphines (P monodentates, P—P bidentates, or P—P tridentates) that meet the requirements for use as "narrow band" valence stabilizers for $Co^{+3}$ include, but are not limited to: triphosphorinane, P,P'-tetraphenyl-2-methyl-2-(P-diphenyl)phosphinomethyl-1,3-propanediphosphine; P,P-[2-(P-diphenyl)phosphinoethyl]diethyl-P-phenylphosphine; P,P-[2-(P-diphenyl)phosphino]diphenyl-P-phenylphosphine; and hexahydro-2,4,6-trimethyl-1,3,5-triphosphazine. (Note: the aryl derivatives are air-stable, whereas the alkyl derivatives are air-sensitive and therefore unsuitable for these applications.)

P Valence Stabilizer #4: Examples of tetraphosphines (P monodentates, P—P bidentates, P—P tridentates, and P—P tetradentates) that meet the requirements for use as "narrow band" valence stabilizers for $Co^{+3}$ include, but are not limited to: P,P'-tetraphenyl-2,2-[(P-diphenyl)phosphinomethyl]-1,3-propanediphosphine; tri[o-(P-diphenyl)phosphinophenyl]phosphine; and 1,1,4,7,10,10-hexaphenyl-1,4,7,10-tetraphosphadecane. (Note: the aryl derivatives are air-stable, whereas the alkyl derivatives are air-sensitive and therefore unsuitable for these applications.)

P Valence Stabilizer #5: Examples of pentaphosphines (P monodentates, P—P bidentates, P—P tridentates, and P—P tetradentates) that meet the requirements for use as "narrow band" valence stabilizers for $Co^{+3}$ include, but are not limited to: 4-[2-(P-diphenyl)phosphinoethyl]-1,1,7,10,10-pentaphenyl-1,4,7,10-tetraphosphadecane. (Note: the aryl derivatives are air-stable, whereas the alkyl derivatives are air-sensitive and therefore unsuitable for these applications.)

P Valence Stabilizer #6: Examples of hexaphosphines (P—P bidentates, P—P tridentates, P—P tetradentates, and P—P hexadentates) that meet the requirements for use as "narrow band" valence stabilizers for $Co^{+3}$ include, but are not limited to: 1,1,10,10-tetraphenyl-4,7-[2-(P,P-diphenyl)phosphinoethyl]-1,4,7,10-tetraphosphadecane. (Note: the aryl derivatives are air-stable, whereas the alkyl derivatives are air-sensitive and therefore unsuitable for these applications.)

P Valence Stabilizer #7a: Examples of 5-membered heterocyclic rings containing one phosphorus atom (P monodentates) that meet the requirements for use as "narrow band" valence stabilizers for $Co^{+3}$ include, but are not limited to: 1-phospholene, 2-phospholene, 3-phospholene, phosphole, oxaphosphole, thiaphosphole, benzophospholene, benzophosphole, benzoxaphosphole, benzothiaphosphole, dibenzophospholene, dibenzophosphole, naphthophospholene, naphthophosphole, naphthoxaphosphole, naphthothiaphosphole.

P Valence Stabilizer #7b: Examples of 5-membered heterocyclic rings containing two phosphorus atoms (P monodentates or P—P bidentates) that meet the requirements for use as "narrow band" valence stabilizers for $Co^{+3}$ include, but are not limited to: diphospholene, diphosphole, oxadiphospholene, thiadiphospholene, benzodiphospholene, benzodiphosphole, naphthodiphospholene, and naphthodiphosphole.

P Valence Stabilizer #7c: Examples of 5-membered heterocyclic rings containing three phosphorus atoms (P monodentates or P—P bidentates) that meet the requirements for use as "narrow band" valence stabilizers for $Co^{+3}$ include, but are not limited to: triphosphole.

P Valence Stabilizer #8a: Examples of 6-membered heterocyclic rings containing one phosphorus atom (P monodentates) that meet the requirements for use as "narrow band" valence stabilizers for $Co^{+3}$ include, but are not limited to: phosphorin, oxaphosphorin, thiaphosphorin, benzophosphorin, benzoxaphosphorin, benzothiaphosphorin, acridophosphine, phosphanthridine, dibenzoxaphosphorin, dibenzothiaphosphorin, naphthophosphorin, naphthoxaphosphorin, and naphthothiaphosphorin.

P Valence Stabilizer #8b: Examples of 6-membered heterocyclic rings containing two phosphorus atoms (P monodentates or P—P bidentates) that meet the requirements for use as "narrow band" valence stabilizers for $Co^{+3}$ include, but are not limited to: o-diphosphorin, m-diphosphorin, p-diphosphorin, oxadiphosphorin, thiadiphosphorin, benzodiphosphorin, benzoxadiphosphorin, benzothiadiphosphorin, dibenzodiphosphorin, dibenzoxadiphosphorin, dibenzothiadiphosphorin, naphthodiphosphorin, naphthoxadiphosphorin, and naphthothiadiphosphorin.

P Valence Stabilizer #8c: Examples of 6-membered heterocyclic rings containing three phosphorus atoms (P monodentates or P—P bidentates) that meet the requirements for use as "narrow band" valence stabilizers for $Co^{+3}$ include, but are not limited to: 1,3,5-triphosphorin, 1,2,3-triphosphorin, benzo-1,2,3-triphosphorin, and naphtho-1,2,3-triphosphorin.

P Valence Stabilizer #9a: Examples of 5-membered heterocyclic rings containing one phosphorus atom and having at least one additional phosphorus atom binding site not contained in a ring (P Monodentates, P—P Bidentates, P—P Tridentates, P—P Tetradentates, or P—P Hexadentates) that meet the requirements for use as "narrow band" valence stabilizers for $Co^{+3}$ include, but are not limited to: 2-(P-phenylphosphino)-1-phospholene; 2,5-(P-phenylphosphino)-1-phospholene; 2-(P-phenylphosphino)-3-phospholene; 2,5-(P-phenylphosphino)-3-phospholene; 2-(P-phenylphosphino)phosphole; 2,5-(P-phenylphosphino)phosphole; 2-(P-phenylphosphino)benzophosphole; 7-(P-phenylphosphino)benzophosphole; and 1,8-(P-phenylphosphino)dibenzophosphole.

P Valence Stabilizer #9b: Examples of 5-membered heterocyclic rings containing two phosphorus atoms and having at least one additional phosphorus atom binding site not contained in a ring (P Monodentates, P—P Bidentates, P—P Tridentates, P—P Tetradentates, or P—P Hexadentates) that meet the requirements for use as "narrow band" valence stabilizers for $Co^{+3}$ include, but are not limited to: 2-(P-phenylphosphino)-1,3-diphospholene; 2,5-(P-phenylphosphino)-1,3-diphospholene; 2-(P-phenylphosphino)-1,3-diphosphole; 2,5-(P-phenylphosphino)-1,3-diphosphole; 2-(P-phenylphosphino)benzodiphosphole; and 7-(P-phenylphosphino)benzodiphosphole.

P Valence Stabilizer #9c: Examples of 5-membered heterocyclic rings containing three phosphorus atoms and having at least one additional phosphorus atom binding site not contained in a ring (P Monodentates, P—P Bidentates, P—P Tridentates, P—P Tetradentates, or P—P Hexadentates) that meet the requirements for use as "narrow band" valence stabilizers for $Co^{+3}$ include, but are not limited to: 2-(P-phenylphosphino)-1,3,4-triphosphole; and 2,5-(P-phenylphosphino)-1,3,4-triphosphole.

P Valence Stabilizer #10a: Examples of 6-membered heterocyclic rings containing one phosphorus atom and having at least one additional phosphorus atom binding site not contained in a ring (P Monodentates, P—P Bidentates, P—P Tridentates, P—P Tetradentates, or P—P Hexadentates) that meet the requirements for use as "narrow band" valence stabilizers for $Co^{+3}$ include, but are not limited to: 2-(P-phenylphosphino)phosphorin; 2,5-(P-phenylphosphino)phosphorin; 2-(P-phenylphosphino)benzophosphorin; 7-(P-phenylphosphino)benzophosphorin; and 1,9-(P-phenylphosphino)acridophosphine.

P Valence Stabilizer #10b: Examples of 6-membered heterocyclic rings containing two phosphorus atoms and having at least one additional phosphorus atom binding site not contained in a ring (P Monodentates, P—P Bidentates, P—P Tridentates, P—P Tetradentates, or P—P Hexadentates) that meet the requirements for use as "narrow band" valence stabilizers for $Co^{+3}$ include, but are not limited to: 2-(P-phenylphosphino)-4-diphosphorin; 2,6-(P-phenylphosphino)-4-diphosphorin; 2,3,5,6-(P-phenylphosphino)-4-diphosphorin; 2-(P-phenylphosphino)benzo-1,4-diphosphorin; 2,3-(P-phenylphosphino)benzo-1,4-diphosphorin; 2,8-(P-phenylphosphino)benzo-1,4-diphosphorin; 2,3,5,8-(P-phenylphosphino)benzo-1,4-diphosphorin; 1,9-(P-phenylphosphino) dibenzodiphosphorin; and 1,4,6,9-(P-phenylphosphino) dibenzodiphosphorin.

P Valence Stabilizer #10c: Examples of 6-membered heterocyclic rings containing three phosphorus atoms and having at least one additional phosphorus atom binding site not contained in a ring (P Monodentates, P—P Bidentates, P—P Tridentates, P—P Tetradentates, or P—P Hexadentates) that meet the requirements for use as "narrow band" valence stabilizers for $Co^{+3}$ include, but are not limited to: 2-(P-phenylphosphino)-1,3,5-triphosphorin; 2,6-(P-phenylphosphino)-1,3,5-triphosphorin; 4-(P-phenylphosphino)-1,2,3-triphosphorin; and 8-(P-phenylphosphino)benzo-1,2,3-triphosphorin.

P Valence Stabilizer #11a: Examples of 5-membered heterocyclic rings containing one phosphorus atom and having at least one additional phosphorus atom binding site contained in a ring (P Monodentates, P—P Bidentates, P—P Tridentates, P—P Tetradentates) that meet the requirements for use as "narrow band" valence stabilizers for $Co^{+3}$ include, but are not limited to: 2,2'-bi-1-phospholene; 2,2', 2"-tri-1-phospholene; 2,2'-bi-3-phospholene; 2,2', 2"-tri-3-phospholene; 2,2'-biphosphole; 2,2',2"-triphosphole; and 2,2'-bibenzophosphole.

P Valence Stabilizer #11b: Examples of 5-membered heterocyclic rings containing two phosphorus atoms and having at least one additional phosphorus atom binding site contained in a ring (P Monodentates, P—P Bidentates, P—P Tridentates, P—P Tetradentates) that meet the requirements for use as "narrow band" valence stabilizers for $Co^{+3}$ include, but are not limited to: 2,2'-bi-1,3-diphospholene; 2,2'-bi-1,3-diphosphole; and 2,2'-bibenzo-1,3-diphosphole.

P Valence Stabilizer #11c: Examples of 5-membered heterocyclic rings containing three phosphorus atoms and having at least one additional phosphorus atom binding site contained in a ring (P Monodentates, P—P Bidentates, P—P Tridentates, P—P Tetradentates) that meet the requirements for use as "narrow band" valence stabilizers for $Co^{+3}$ include, but are not limited to:2,2'-bi-1,3,4-triphosphole; and 2,2',2"-tri-1,3,4-triphosphole.

P Valence Stabilizer #12a: Examples of 6-membered heterocyclic rings containing one phosphorus atom and having at least one additional phosphorus atom binding site contained in a ring (P Monodentates, P—P Bidentates, P—P Tridentates, P—P Tetradentates) that meet the requirements for use as "narrow band" valence stabilizers for $Co^{+3}$ include, but are not limited to: 2,2'-biphosphorin; 2,2',2"-triphosphorin; 2,2',2",2'"-tetraphosphorin; 2,2'-bibenzophosphorin; and 8,8'-bibenzophosphorin.

P Valence Stabilizer #12b: Examples of 6-membered heterocyclic rings containing two phosphorus atoms and having at least one additional phosphorus atom binding site contained in a ring (P Monodentates, P—P Bidentates, P—P Tridentates, P—P Tetradentates) that meet the requirements for use as "narrow band" valence stabilizers for $Co^{+3}$ include, but are not limited to: 3,3'-bi-1,2-diphosphorin; 3,3',3"-tri-1,2-diphosphorin; 2,2'-bi-1,4-diphosphorin; 2,2', 2"-tri-1,4-diphosphorin; 3,3'-bibenzo-1,2-diphosphorin; 8,8'-bibenzo-1,2-diphosphorin; 2,2'-bibenzo-1,4-diphosphorin; and 8,8'-bibenzo-1,4-diphosphorin.

P Valence Stabilizer #12c: Examples of 6-membered heterocyclic rings containing three phosphorus atoms and having at least one additional phosphorus atom binding site contained in a ring (P Monodentates, P—P Bidentates, P—P Tridentates, P—P Tetradentates) that meet the requirements for use as "narrow band" valence stabilizers for $Co^{+3}$ include, but are not limited to: 2,2'-bi-1,3,5-triphosphorin; 2,2',2"-tri-1,3,5-triphosphorin; 4,4'-bi-1,2,3-triphosphorin; 4,4'-bibenzo-1,2,3-triphosphorin; and 8,8'-bibenzo-1,2,3-triphosphorin.

P Valence Stabilizer #13a: Examples of two-membered macrocyclics, macrobicyclics, and macropolycyclics (including catapinands, cryptands, cyclidenes, and sepulchrates) wherein both binding sites are composed of phosphorus and are not contained in component heterocyclic rings (P—P Bidentates) that meet the requirements for use as "narrow band" valence stabilizers for $Co^{+3}$ include, but are not limited to: P,P-diphenyldiphosphacyclobutane ([4]$aneP_2$); P,P-diphenyldiphosphacyclopentane ([5]$aneP_2$); P,P-diphenyldiphosphacyclohexane ([6]$aneP_2$); P,P-diphenyldiphosphacycloheptane ([7]$aneP_2$); P,P-diphenyldiphosphacyclooctane ([8]$aneP_2$); P,P-diphenyldiphosphacyclobutene ([4]$eneP_2$); P,P-diphenyldiphosphacyclopentene ([5]$eneP_2$); P,P-diphenyldiphosphacyclohexene ([6]$eneP_2$); P,P-diphenyldiphosphacycloheptene ([7]$eneP_2$); and P,P-diphenyldiphosphacyclooctene ([8]$eneP_2$).

P Valence Stabilizer #13b: Examples of three-membered macrocyclics, macrobicyclics, and macropolycyclics (including catapinands, cryptands, cyclidenes, and sepulchrates) wherein all binding sites are composed of phosphorus and are not contained in component heterocyclic rings (P—P Tridentates) that meet the requirements for use as "narrow band" valence stabilizers for $Co^{+3}$ include, but are not limited to: P,P,P-triphenyltriphosphacyclohexane ([6]$aneP_3$); P,P,P-triphenyltriphosphacycloheptane ([7]$aneP_3$); P,P,P-triphenyltriphosphacyclooctane ([8]$aneP_3$); P,P,P-triphenyltriphosphacyclononane ([9]$aneP_3$); P,P,P-triphenyltriphosphacyclodecane ([10]$aneP_3$); P,P,P-triphenyltriphosphacycloundecane ([11]$aneP_3$); P,P,P-triphenyltriphosphacyclododecane ([12]$aneP_3$); P,P,P-triphenyltriphosphacyclohexatriene ([6]$trieneP_3$); P,P,P-triphenyltriphosphacycloheptatriene ([7]$trieneP_3$); P,P,P-triphenyltriphosphacyclooctatriene ([8]$trieneP_3$); P,P,P-triphenyltriphosphacyclononatriene ([9]$trieneP_3$); P,P,P-triphenyltriphosphacyclodecatriene ([10]$trieneP_3$); P,P,P-triphenyltriphosphacycloundecatriene ([11]$trieneP_3$); and P,P,P-triphenyltriphosphacyclododecatriene ([12]$trieneP_3$).

P Valence Stabilizer #13c: Examples of four-membered macrocyclics, macrobicyclics, and macropolycyclics (including catapinands, cryptands, cyclidenes, and sepulchrates) wherein all binding sites are composed of phosphorus and are not contained in component heterocyclic rings (P—P Tetradentates) that meet the requirements for use as "narrow band" valence stabilizers for $Co^{+3}$ include, but are not limited to: P,P,P,P-tetraphenyltetraphosphacyclooctane ([8]$aneP_4$); P,P,P,P-tetraphenyltetraphosphacyclononane ([9]$aneP_4$); P,P,P,P-tetraphenyltetraphosphacyclodecane ([10]$aneP_4$); P,P,P,P-tetraphenyltetraphosphacycloundecane ([11]$aneP_4$); P,P,P,P-tetraphenyltetraphosphacyclododecane ([12]$aneP_4$); P,P,P,P-tetraphenyltetraphosphacyclotridecane ([13]$aneP_4$); P,P,P,P-tetraphenyltetraphosphacyclotetradecane ([14]$aneP_4$); P,P,P,P-tetraphenyltetraphosphacyclopentadecane ([15]$aneP_4$); P,P,P,P-tetraphenyltetraphosphacyclohexadecane ([16]$aneP_4$); P,P,P,P-tetraphenyltetraphosphacycloheptadecane ([17]$aneP_4$); P,P,P,P-tetraphenyltetraphosphacyclooctadecane ([18]$aneP_4$); P,P,P, P-tetraphenyltetraphosphacyclononadecane ([19]aneP$_4$); and P,P,P,P-tetraphenyltetraphosphacycloeicosane ([20]aneP$_4$).

P Valence Stabilizer #13d: Examples of five-membered macrocyclics, macrobicyclics, and macropolycyclics (including catapinands, cryptands, cyclidenes, and sepulchrates) wherein all binding sites are composed of phosphorus and are not contained in component heterocyclic rings (P—P Tridentates, or P—P Tetradentates) that meet the requirements for use as "narrow band" valence stabilizers for $Co^{+3}$ include, but are not limited to: P,P,P,P,P-pentaphenylpentaphosphacyclodecane ([10]aneP$_5$); P,P,P,P,P-pentaphenylpentaphosphacycloundecane ([11]aneP$_5$); P,P,P,P,P-pentaphenylpentaphosphacyclododecane ([12]aneP$_5$); P,P,P,P,P-pentaphenylpentaphosphacyclotridecane ([13]aneP$_5$); P,P,P,P,P-pentaphenylpentaphosphacyclotetradecane ([14]aneP$_5$); and P,P,P,P,P-pentaphenylpentaphosphacyclopentadecane ([15]aneP$_5$).

P Valence Stabilizer #13e: Examples of six-membered macrocyclics, macrobicyclics, and macropolycyclics (including catapinands, cryptands, cyclidenes, and sepulchrates) wherein all binding sites are composed of phosphorus and are not contained in component heterocyclic rings (P—P—P Tridentates, P—P—P—P Tetradentates, or P—P—P—P—P—P Hexadentates) that meet the requirements for use as "narrow band" valence stabilizers for $Co^{+3}$ include, but are not limited to: P,P,P,P,P,P-hexaphenylhexaphosphacyclododecane ([12]aneP$_6$); P,P,P,P,P,P-hexaphenylhexaphosphacyclotridecane ([13]aneP$_6$); P,P,P,P,P,P-hexaphenylhexaphosphacyclotetradecane ([14]aneP$_6$); P,P,P,P,P,P-hexaphenylhexaphosphacyclopentadecane ([15]aneP$_6$); P,P,P,P,P,P-hexaphenylhexaphosphacyclohexadecane ([16]aneP$_6$); P,P,P,P,P,P-hexaphenylhexaphosphacycloheptadecane ([17]aneP$_6$); P,P,P,P,P,P-hexaphenylhexaphosphacyclooctadecane ([18]aneP$_6$); P,P,P,P,P,P-hexaphenylhexaphosphacyclononadecane ([19]aneP$_6$); P,P,P,P,P,P-hexaphenylhexaphosphacycloeicosane ([20]aneP$_6$); P,P,P,P,P,P-hexaphenylhexaphosphacycloheneicosane ([21]aneP$_6$); P,P,P,P,P,P-hexaphenylhexaphosphacyclodocosane ([22]aneP$_6$); P,P,P,P,P,P-hexaphenylhexaphosphacyclotricosane ([23]aneP$_6$); P,P,P,P,P,P-hexaphenylhexaphosphacyclotetracosane ([24]aneP$_6$).

P Valence Stabilizer #13f: Examples of eight-membered macrocyclics, macrobicyclics, and macropolycyclics (including catapinands, cryptands, cyclidenes, and sepulchrates) wherein all binding sites are composed of phosphorus and are not contained in component heterocyclic rings (P—P Tridentates, P—P Tetradentates, or P—P Hexadentates) that meet the requirements for use as "narrow band" valence stabilizers for $Co^{+3}$ include, but are not limited to: P,P,P,P,P,P,P,P-octaphenyloctaphosphacyclohexadecane ([16]aneP$_8$); P,P,P,P,P,P,P,P-octaphenyloctaphosphacycloheptadecane ([17]aneP$_8$); P,P,P,P,P,P,P,P-octaphenyloctaphosphacyclooctadecane ([18]aneP$_8$); P,P,P,P,P,P,P,P-octaphenyloctaphosphacyclononadecane ([19]aneP$_8$); P,P,P,P,P,P,P,P-octaphenyloctaphosphacycloeicosane ([20]aneP$_8$); P,P,P,P,P,P,P,P-octaphenyloctaphosphacycloheneicosane ([21]aneP$_8$); P,P,P,P,P,P,P,P-octaphenyloctaphosphacyclodocosane ([22]aneP$_8$); P,P,P,P,P,P,P,P-octaphenyloctaphosphacyclotricosane ([23]aneP$_8$); and P,P,P,P,P,P,P,P-octaphenyloctaphosphacyclotetracosane ([24]aneP$_8$).

P Valence Stabilizer #14a: Examples of four-membered macrocyclics, macrobicyclics, and macropolycyclics (including catapinands, cryptands, cyclidenes, and sepulchrates) wherein all four binding sites are composed of phosphorus and are contained in component 5-membered heterocyclic rings (P—P Tetradentates) that meet the requirements for use as "narrow band" valence stabilizers for $Co^{+3}$ include, but are not limited to: tetraphospholenes; tetraphospholes; tetraoxaphospholes; tetradiphospholenes; tetradiphospholes; and tetraoxadiphospholes.

P Valence Stabilizer #14b: Examples of six-membered macrocyclics, macrobicyclics, and macropolycyclics (including catapinands, cryptands, cyclidenes, and sepulchrates) wherein all six binding sites are composed of phosphorus and are contained in component 5-membered heterocyclic rings (P—P Tetradentates and P—P Hexadentates) that meet the requirements for use as "narrow band" valence stabilizers for $Co^{+3}$ include, but are not limited to: hexaphospholenes; hexaphospholes; hexaoxaphospholes; hexadiphospholenes; hexadiphospholes; and hexaoxadiphospholes.

P Valence Stabilizer #14c: Examples of eight-membered macrocyclics, macrobicyclics, and macropolycyclics (including catapinands, cryptands, cyclidenes, and sepulchrates) wherein all eight binding sites are composed of phosphorus and are contained in component 5-membered heterocyclic rings (P—P Tridentates; P—P Tetradentates; or P—P Hexadentates) that meet the requirements for use as "narrow band" valence stabilizers for $Co^{+3}$ include, but are not limited to: octaphospholenes; octaphospholes; octaoxaphospholes; octadiphospholenes; octadiphospholes; and octaoxadiphospholes.

P Valence Stabilizer #15a: Examples of four-membered macrocyclics, macrobicyclics, and macropolycyclics (including catapinands, cryptands, cyclidenes, and sepulchrates) wherein all four binding sites are composed of phosphorus and are contained in a combination of 5-membered heterocyclic rings and phosphine groups (P—P Tridentates, P—P Tetradentates) that meet the requirements for use as "narrow band" valence stabilizers for $Co^{+3}$ include, but are not limited to: diphosphatetraphospholenes; tetraphosphatetraphospholenes; diphosphatetraphospholes; tetraphosphatetraphospholes; diphoshatetradiphospholes; and tetraphosphatetradiphospholes.

P Valence Stabilizer #15b: Examples of six-membered macrocyclics, macrobicyclics, and macropolycyclics (including catapinands, cryptands, cyclidenes, and sepulchrates) wherein all six binding sites are composed of phosphorus and are contained in a combination of 5-membered heterocyclic rings and phosphine groups (P—P Tridentates, P—P Tetradentates, and P—P Hexadentates) that meet the requirements for use as "narrow band" valence stabilizers for $Co^{+3}$ include, but are not limited to: diphosphahexaphospholenes; triaphosphahexaphospholenes; diphosphahexaphospholes; triphosphahexaphospholes; diphoshahexadiphospholes; and triphosphahexadiphospholes.

P Valence Stabilizer #15c: Examples of eight-membered macrocyclics, macrobicyclics, and macropolycyclics (including catapinands, cryptands, cyclidenes, and sepulchrates) wherein all eight binding sites are composed of phosphorus and are contained in a combination of 5-membered heterocyclic rings and phosphine groups (P—P Tridentates, P—P Tetradentates, and P—P Hexadentates) that meet the requirements for use as "narrow band" valence stabilizers for $Co^{+3}$ include, but are not limited to: diphosphaoctaphospholenes; tetraphosphaoctaphospholenes;

diphosphaoctaphospholes; tetraphosphaoctaphospholes; diphoshaoctadiphospholes; and tetraphosphaoctadiphospholes.

P Valence Stabilizer #16a: Examples of four-membered macrocyclics, macrobicyclics, and macropolycyclics (including catapinands, cryptands, cyclidenes, and sepulchrates) wherein all four binding sites are composed of phosphorus and are contained in component 6-membered heterocyclic rings (P—P Tetradentates) that meet the requirements for use as "narrow band" valence stabilizers for $Co^{+3}$ include, but are not limited to: cyclotetraphosphorins; cyclotetraaoxaphosphorins; cyclotetradiphosphorins; and cyclotetraoxadiphosphorins.

P Valence Stabilizer #16b: Examples of six-membered macrocyclics, macrobicyclics, and macropolycyclics (including catapinands, cryptands, cyclidenes, and sepulchrates) wherein all six binding sites are composed of phosphorus and are contained in component 6-membered heterocyclic rings (P—P Tridentates, P—P Tetradentates, and P—P Hexadentates) that meet the requirements for use as "narrow band" valence stabilizers for $Co^{+3}$ include, but are not limited to: cyclohexaphosphorins; cyclohexaoxaphosphorins; cyclohexadiphosphorins; and cyclohexaoxadiphosphorins.

P Valence Stabilizer #16c: Examples of eight-membered macrocyclics, macrobicyclics, and macropolycyclics (including catapinands, cryptands, cyclidenes, and sepulchrates) wherein all eight binding sites are composed of phosphorus and are contained in component 6-membered heterocyclic rings (P—P Tridentates, P—P Tetradentates, and P—P Hexadentates) that meet the requirements for use as "narrow band" valence stabilizers for $Co^{+3}$ include, but are not limited to: cyclooctaphosphorins; cyclooctaoxaphosphorins; cyclooctadiphosphorins; and cyclooctaoxadiphosphorins.

P Valence Stabilizer #17a: Examples of four-membered macrocyclics, macrobicyclics, and macropolycyclics (including catapinands, cryptands, cyclidenes, and sepulchrates) wherein all four binding sites are composed of phosphorus and are contained in a combination of 6-membered heterocyclic rings and phosphine groups (P—P Tridentates, P—P Tetradentates, or P—P Hexadentates) that meet the requirements for use as "narrow band" valence stabilizers for $Co^{+3}$ include, but are not limited to: diphosphacyclotetraphosphorins; tetraphosphacyclotetraphosphorins; diphosphacyclotetraoxaphosphorins; tetraphosphacyclotetraoxaphosphorins; diphosphacyclotetradiphosphorins; tetraphosphacyclotetradiphosphorins; diphosphacyclotetraoxadiphosphorins; and tetraphosphacyclotetraoxadiphosphorins.

P Valence Stabilizer #17b: Examples of six-membered macrocyclics, macrobicyclics, and macropolycyclics (including catapinands, cryptands, cyclidenes, and sepulchrates) wherein all six binding sites are composed of phosphorus and are contained in a combination of 6-membered heterocyclic rings and phosphine groups (P—P Tridentates, P—P Tetradentates, or P—P Hexadentates) that meet the requirements for use as "narrow band" valence stabilizers for $Co^{+3}$ include, but are not limited to: diphosphacyclohexaphosphorins; triphosphacyclohexaphosphorins; diphosphacyclohexaoxaphosphorins; triphosphacyclohexaoxaphosphorins; diphosphacyclohexadiphosphorins; triphosphacyclohexadiphosphorins; diphosphacyclohexaoxadiphosphorins; and triphosphacyclohexaoxadiphosphorins.

P Valence Stabilizer #17c: Examples of eight-membered macrocyclics, macrobicyclics, and macropolycyclics (including catapinands, cryptands, cyclidenes, and sepulchrates) wherein all eight binding sites are composed of phosphorus and are contained in a combination of 6-membered heterocyclic rings and phosphine groups (P—P Tridentates, P—P Tetradentates, or P—P Hexadentates) that meet the requirements for use as "narrow band" valence stabilizers for $Co^{+3}$ include, but are not limited to: diphosphacyclooctaphosphorins; tetraphosphacyclooctaphosphorins; diphosphacyclooctaoxaphosphorins; tetraphosphacyclooctaoxaphosphorins; diphosphacyclooctadiphosphorins; tetraphosphacyclooctadiphosphorins; diphosphacyclooctaoxadiphosphorins; and tetraphosphacyclooctaoxadiphosphorins.

O Valence Stabilizer #1: Examples of biurets (imidodicarbonic diamides), isobiurets, biureas, triurets, triureas, bis(biurets), bis(isobiurets), bis(biureas), poly(biurets), poly(isobiurets), and poly(biureas) (O—O Bidentates, O—O Tridentates, O—O Tetradentates) that meet the requirements for use as "narrow band" valence stabilizers for $Co^{+3}$ include, but are not limited to: biuret, isobiuret, biurea, triuret, triurea, nitrobiuret, dinitrobiuret, aminobiuret, diaminobiuret, oxybiuret, dioxybiuret, cyanobiuret, methylbiuret, ethylbiuret, isopropylbiuret, phenylbiuret, benzylbiuret, cyclohexylbiuret, norbornylbiuret, adamantylbiuret, dimethylbiuret, diethylbiuret, diisopropylbiuret, diphenylbiuret, dibenzylbiuret, dicyclohexylbiuret, dinorbornylbiuret, and diadamantylbiuret.

O Valence Stabilizer #2: Examples of acylureas, aroylureas, bis(acylureas), bis(aroylureas), poly(acylureas), and poly(aroylureas) (O—O Bidentates, O—O Tridentates, O—O Tetradentates) that meet the requirements for use as "narrow band" valence stabilizers for $Co^{+3}$ include, but are not limited to: formylurea, acetylurea, benzoylurea, cyclohexoylurea, pentafluorobenzoylurea, N-methylacetylurea, N-phenylbenzoylurea, and N-cyclohexylcyclohexoylurea.

O Valence Stabilizer #3: Examples of imidodialdehydes, hydrazidodialdehydes (acyl hydrazides), bis(imidodialdehydes), bis(hydrazidodialdehydes), poly(imidodialdehydes), and poly(hydrazidodialdehydes) (O—O Bidentates, O—O Tridentates, O—O Tetradentates) that meet the requirements for use as "narrow band" valence stabilizers for $Co^{+3}$ include, but are not limited to: diacetamide, dipropanamide, dibutanamide, dibenzamide, and dicyclohexamide.

O Valence Stabilizer #4: Examples of imidodicarbonic acids, hydrazidodicarbonic acids, bis(imidodicarbonic acids), bis(hydrazidodicarbonic acids), poly(imidodicarbonic acids), poly(hydrazidodicarbonic acids) and derivatives thereof (O—O Bidentates, O—O Tridentates, O—O Tetradentates) that meet the requirements for use as "narrow band" valence stabilizers for $Co^{+3}$ include, but are not limited to: imidodicarbonic acid, hydrazidodicarbonic acid, O-phenylimidodicarbonic acid, O-benzylimidodicarbonic acid, O-cyclohexylimidodicarbonic acid, O-norbornylimidodicarbonic acid, O,O'-diphenylimidodicarbonic acid, O,O'-dibenzylimidodicarbonic acid, O,O'-dicyclohexylimidodicarbonic acid, and O,O'-dinorbornylimidodicarbonic acid.

O Valence Stabilizer #5: Examples of imidodisulfamic acid, imidodisulfuric acid, bis(imidodisulfamic acid), bis(imidodisulfuric acid), poly(imidodisulfamic acid), and poly(imidodisulfuric acid) and derivatives thereof (O—O Bidentates, O—O Tridentates, O—O Tetradentates) that meet the requirements for use as "narrow band" valence stabilizers for $Co^{+3}$ include, but are not limited to: imidodisulfamic acid, imidodisulfuric acid, N-phenylimidodisulfamic acid, N-benzylimidodisulfamic acid, N-cyclohexylimidodisulfamic acid, N-norbornylimidodisulfamic acid, N,N'-diphenylimidodisulfamic acid, N,N'-dibenzylimidodisulfamic acid, N,N'-dicyclohexylimidodisulfamic acid, and N,N'-norbornylimidodisulfamic acid.

O Valence Stabilizer #6: Examples of 1,3-diketones (beta-diketonates), 1,3,5-triketones, bis(1,3-diketones), and poly (1,3-diketones), all with a molecular weight greater than 125 (O—O Bidentates, O—O Tridentates, O—O Tetradentates) that meet the requirements for use as "narrow band" valence stabilizers for $Co^{+3}$ include, but are not limited to: hexafluoropentanedione; dibenzoylmethane(1,3-diphenyl-1,3-propanedione); benzoylpinacolone; dicyclohexoylmethane; diphenylpentanetrionate; dibenzoylacetone; benzoylacetylacetone; dibenzoylacetylacetone; tetramethylnonanetrionate; hexafluoroheptanetrionate; trifluoroheptanetrionate; trifluoroacetylcamphor (facam); and 1,3-indandione.

O Valence Stabilizer #7: Examples of 1,2-diketones (alpha-diketonates), 1,2,3-triketones, tropolonates, o-quinones, bis (1,2-diketones), and poly(1,2-diketones), all with a molecular weight greater than 100 (O—O Bidentates, O—O Tridentates, O—O Tetradentates) that meet the requirements for use as "narrow band" valence stabilizers for $Co^{+3}$ include, but are not limited to: tropolone; 1,2-benzoquinone (o-quinone); di-tert-butyl-1,2-benzoquinone; hexafluoro-1,2-benzoquinone; 1,2-naphthoquinone; 9,10-phenanthroquinone; and 1,2-indandione.

O Valence Stabilizer #8: Examples of malonamides (malonodiamides), bis(malonamides), and polymalonamides (O—O Bidentates, O—O Tridentates, O—O Tetradentates) that meet the requirements for use as "narrow band" valence stabilizers for $Co^{+3}$ include, but are not limited to: malonamide, N-phenylmalonamide, N-benzylmalonamide, N-pentafluorophenylmalonamide, N-cyclohexylmalonamide, N-norbornylmalonamide, N,N'-diphenylmalonamide, N,N'-dibenzylmalonamide, N,N'-dipentafluorophenylmalonamide, N,N'-dicyclohexylmalonamide, and N,N'-norbornylmalonamide.

O Valence Stabilizer #9: Examples of 2-acylacetamides, bis(2-acylacetamides), and poly(2-acylacetamides) (O—O Bidentates, O—O Tridentates, O—O Tetradentates) that meet the requirements for use as "narrow band" valence stabilizers for $Co^{+3}$ include, but are not limited to: 2-acetoacetamide, N-phenyl-2-acetoacetamide, N-pentafluorophenyl-2-acetoacetamide, N-benzyl-2-acetoacetamide, N-cyclohexyl-2-acetoacetamide, N-norbornyl-2-acetoacetamide, N-phenyl-2-benzoacetamide, N-pentafluorophenyl-2-pentafluorobenzoacetamide, and N-cyclohexyl-2-cyclohexoacetamide.

O Valence Stabilizer #10: Examples of monothiodicarbonic diamides, bis(monothiodicarbonic diamides), and poly (monothiodicarbonic diamides) (O—O Bidentates, O—O Tridentates, O—O Tetradentates) that meet the requirements for use as "narrow band" valence stabilizers for $Co^{+3}$ include, but are not limited to: monothiodicarbonic diamide; N-phenylmonothiodicarbonic diamide; N-pentafluorophenylmonothiodicarbonic diamide; N-benzylmonothiodicarbonic diamide; N-cyclohexylmonothiodicarbonic diamide; N-norbornylmonothiodicarbonic diamide; N,N'-diphenylmonothiodicarbonic diamide; N,N'-dipentafluorophenylmonothiodicarbonic diamide; N,N'-dibenzylmonothiodicarbonic diamide; N,N'-dicyclohexylmonothiodicarbonic diamide; and N,N'-dinorbornylmonothiodicarbonic diamide.

O Valence Stabilizer #11: Examples of monothiodicarbonic acids, bis(monothiodicarbonic acids), poly(monothiodicarbonic acids), and derivatives thereof (O—O Bidentates, O—O Tridentates, O—O Tetradentates) that meet the requirements for use as "narrow band" valence stabilizers for $Co^{+3}$ include, but are not limited to: monothiodicarbonic acid, O-phenylmonothiodicarbonic acid, O-benzylmonothiodicarbonic acid, O-cyclohexylmonothiodicarbonic acid, O-norbornylmonothiodicarbonic acid, O,O'-diphenylmonothiodicarbonic acid, O,O'-dibenzylmonothiodicarbonic acid, O,O'-dicyclohexylmonothiodicarbonic acid, and O,O'-dinorbornylmonothiodicarbonic acid.

O Valence Stabilizer #12: Examples of dithioperoxydicarbonic acids, bis(dithioperoxydicarbonic acids), poly(dithioperoxydicarbonic acids), and derivatives thereof (O—O Bidentates, O—O Tridentates, O—O Tetradentates) that meet the requirements for use as "narrow band" valence stabilizers for $Co^{+3}$ include, but are not limited to: dithioperoxydicarbonic acid, O-phenyldithioperoxydicarbonic acid; O-benzyldithioperoxydicarbonic acid; O-cyclohexyldithioperoxydicarbonic acid; O-norbornyldithioperoxydicarbonic acid; O,O'-diphenyldithioperoxydicarbonic acid; O,O'-dibenzyldithioperoxydicarbonic acid; O,O'-dicyclohexyldithioperoxydicarbonic acid; and O,O'-dinorbornyldithioperoxydicarbonic acid.

O Valence Stabilizer #13: Examples of trithionic acid, bis(trithionic acid), poly(trithionic acid), and derivatives thereof (O—O Bidentates, O—O Tridentates, O—O Tetradentates) that meet the requirements for use as "narrow band" valence stabilizers for $Co^{+3}$ include, but are not limited to: diphenyl trithionate, dipentafluorodiphenyl trithionate, dicyclohexyl trithionate, and dinorbornyl trithionate.

O Valence Stabilizer #14: Examples of hypophosphoric acids, bis(hypophosphoric acids), and poly(hypophosphoric acids), and derivatives thereof (O—O Bidentates, O—O Tridentates, O—O Tetradentates) that meet the requirements for use as "narrow band" valence stabilizers for $Co^{+3}$ include, but are not limited to: hypophosphoric acid, O-methylhypophosphoric acid, O-isopropylhypophosphoric acid, O-tert-butylhypophosphoric acid, O-phenylhypophosphoric acid, O-pentafluorophenylhypophosphoric acid, O-benzylhypophosphoric acid, O-cyclohexylhypophosphoric acid, O-norbornylhypophosphoric acid, O,O"-dimethylhypophosphoric acid, O,O"-diisopropylhypophosphoric acid, O,O"-di-tert-butylhypophosphoric acid, O,O"-diphenylhypophosphoric acid, O,O"-di-pentafluorophenylhypophosphoric acid, O,O"-dibenzylhypophosphoric acid, O,O"-dicyclohexylhypophosphoric acid, and O,O"-dinorbornylhypophosphoric acid.

O Valence Stabilizer #15: Examples of hypophosphoramides, bis(hypophosphoramides), and poly(hypophosphoramides) (O—O Bidentates, O—O Tridentates, O—O Tetradentates) that meet the requirements for use as "narrow band" valence stabilizers for $Co^{+3}$ include, but are not limited to: hypophosphoramide, N-methylhypophosphoramide, N-isopropylhypophosphoramide, N-tert-butylhypophosphoramide, N-phenylhypophosphoramide, N-pentafluorophenylhypophosphoramide, N-benzylhypophosphoramide, N-cyclohexylhypophosphoramide, N-norbornylhypophosphoramide, N,N'''-dimethylhypophosphoramide, N,N'''-diisopropylhypophosphoramide, N,N'''-di-tert-butylhypophosphoramide, N,N'''-diphenylhypophosphoramide, N,N'''-di-pentafluorophenylhypophosphoramide, N,N'''-dibenzylhypophosphoramide, N,N'''-dicyclohexylhypophosphoramide, and N,N'''-dinorbornylhypophosphoramide.

O Valence Stabilizer #16: Examples of imidodiphosphoric acids, hydrazidodiphosphoric acids, bis(imidodiphosphoric acids), bis(hydrazidodiphosphoric acids), poly(imidodiphosphoric acids), poly(hydrazidodiphosphoric acids), and derivatives thereof (O—O Bidentates, O—O Tridentates, O—O Tetradentates) that meet the requirements for use as "narrow band" valence stabilizers for $Co^{+3}$ include, but are not limited to: imidodiphosphoric acid, methylimidodiphosphoric acid, isopropylimidodiphosphoric acid, tert-butylimidodiphosphoric acid, phenylimidodiphosphoric acid, pentafluorophenylimidodiphosphoric acid, benzylimidodiphosphoric acid, cyclohexylimidodiphosphoric acid, norbornylimidodiphosphoric acid, dimethylimidodiphosphoric acid, diisopropylimidodiphosphoric acid, di-tert-butylimidodiphosphoric acid, diphenylimidodiphosphoric acid, di-pentafluorophenylimidodiphosphoric acid, dibenzylimidodiphosphoric acid, dicyclohexylimidodiphosphoric acid, and dinorbornylimidodiphosphoric acid.

O Valence Stabilizer #17: Examples of imidodiphosphoramides, hydrazidodiphosphoramides, bis(imidodiphosphoramides), bis(hydrazidodiphosphoramides), poly(imidodiphosphoramides), and poly(hydrazidodiphosphoramides) (O—O Bidentates, O—O Tridentates, O—O Tetradentates) that meet the requirements for use as "narrow band" valence stabilizers for $Co^{+3}$ include, but are not limited to: imidodiphosphoramide, N-methylimidodiphosphoramide, N-isopropylimidodiphosphoramide, N-tert-butylimidodiphosphoramide, N-phenylimidodiphosphoramide, N-pentafluorophenylimidodiphosphoramide, N-benzylimidodiphosphoramide, N-cyclohexylimidodiphosphoramide, N-norbornylimidodiphosphoramide, N,N'''-dimethylimidodiphosphoramide, N,N'''-diisopropylimidodiphosphoramide, N,N'''-di-tert-butylimidodiphosphoramide, N,N'''-diphenylimidodiphosphoramide, N,N'''-di-pentafluorophenylimidodiphosphoramide, N,N'''-dibenzylimidodiphosphoramide, N,N'''-dicyclohexylimidodiphosphoramide, and N,N'''-dinorbornylimidodiphosphoramide.

O Valence Stabilizer #18: Examples of diphosphoramides, bis(diphosphoramides), and poly(diphosphoramides) (O—O Bidentates, O—O Tridentates, O—O Tetradentates) that meet the requirements for use as "narrow band" valence stabilizers for $Co^{+3}$ include, but are not limited to: diphosphoramide, N-methyldiphosphoramide, N-isopropyldiphosphoramide, N-tert-butyldiphosphoramide, N-phenyldiphosphoramide, N-pentafluorophenyldiphosphoramide, N-benzyldiphosphoramide, N-cyclohexyldiphosphoramide, N-norbornyldiphosphoramide, N,N'''-dimethyldiphosphoramide, N,N'''-diisopropyldiphosphoramide, N,N'''-di-tert-butyldiphosphoramide, N,N'''-diphenyldiphosphoramide, N,N'''-di-pentafluorophenyldiphosphoramide, N,N'''-dibenzyldiphosphoramide, N,N'''-dicyclohexyldiphosphoramide, and N,N'''-dinorbornyldiphosphoramide.

O Valence Stabilizer #19: Examples of imidodiphosphonic acids, hydrazidodiphosphonic acids, bis(imidodiphosphonic acids), bis(hydrazidodiphosphonic acids), poly(imidodiphosphonic acids), poly(hydrazidodiphosphonic acids), and derivatives thereof (O—O Bidentates, O—O Tridentates, O—O Tetradentates) that meet the requirements for use as "narrow band" valence stabilizers for $Co^{+3}$ include, but are not limited to: imidodiphosphonic acid, methylimidodiphosphonic acid, isopropylimidodiphosphonic acid, tert-butylimidodiphosphonic acid, phenylimidodiphosphonic acid, pentafluorophenylimidodiphosphonic acid, benzylimidodiphosphonic acid, cyclohexylimidodiphosphonic acid, norbornylimidodiphosphonic acid, dimethylimidodiphosphonic acid, diisopropylimidodiphosphonic acid, di-tert-butylimidodiphosphonic acid, diphenylimidodiphosphonic acid, di-pentafluorophenylimidodiphosphonic acid, dibenzylimidodiphosphonic acid, dicyclohexylimidodiphosphonic acid, and dinorbornylimidodiphosphonic acid. [Note: The phosphite ($P^{+3}$) valence of the phosphorus atom makes stabilization of high valence metal ions much more difficult, though still possible.]

O Valence Stabilizer #20: Examples of imidodiphosphonamides, hydrazidodiphosphonamides, bis(imidodiphosphonamides), bis(hydrazidodiphosphonamides), poly(imidodiphosphonamides), and poly(hydrazidodiphosphonamides) (O—O Bidentates, O—O Tridentates, O—O Tetradentates) that meet the requirements for use as "narrow band" valence stabilizers for $Co^{+3}$ include, but are not limited to: imidodiphosphonamide, N-methylimidodiphosphonamide, N-isopropylimidodiphosphonamide, N-tert-butylimidodiphosphonamide, N-phenylimidodiphosphonamide, N-pentafluorophenylimidodiphosphonamide, N-benzylimidodiphosphonamide, N-cyclohexylimidodiphosphonamide, N-norbornylimidodiphosphonamide, N,N'''-dimethylimidodiphosphonamide, N,N'''-diisopropylimidodiphosphonamide, N,N'''-di-tert-butylimidodiphosphonamide, N,N'''-diphenylimidodiphosphonamide, N,N'''-di-pentafluorophenylimidodiphosphonamide, N,N'''-dibenzylimidodiphosphonamide, N,N'''-dicyclohexylimidodiphosphonamide, and N,N'''-dinorbornylimidodiphosphonamide. [Note: The phosphite ($P^{+3}$) valence of the phosphorus atom makes stabilization of high valence metal ions much more difficult, though still possible.]

O Valence Stabilizer #21: Examples of diphosphonamides, bis(diphosphonamides), and poly(diphosphonamides) (O—O Bidentates, O—O Tridentates, O—O Tetradentates) that meet the requirements for use as "narrow band" valence stabilizers for $Co^{+3}$ include, but are not limited to: diphosphonamide, N-methyldiphosphonamide, N-isopropyldiphosphonamide, N-tert-butyldiphosphonamide, N-phenyldiphosphonamide, N-pentafluorophenyldiphosphonamide, N-benzyldiphosphonamide, N-cyclohexyldiphosphonamide, N-norbornyldiphosphonamide, N,N'''-dimethyldiphosphonamide, N,N'''-diisopropyldiphosphonamide, N,N'''-di-tert-butyldiphosphonamide, N,N'''-diphenyldiphosphonamide, N,N'''-di-pentafluorophenyldiphosphonamide, N,N'''-dibenzyldiphosphonamide, N,N'''-dicyclohexyldiphosphonamide, and N,N'''-dinorbornyldiphosphonamide. [Note: The phosphite ($P^{+3}$) valence of the phosphorus atom makes stabilization of high valence metal ions much more difficult, though still possible.]

O Valence Stabilizer #22: Examples of beta-hydroxyketones, beta-hydroxyaldehydes, bis(beta-hydroxyketones), bis(beta-hydroxyaldehydes), poly(beta-hydroxyketones), and poly(beta-hydroxyaldehydes) (O—O Bidentates, O—O Tridentates, O—O Tetradentates) that meet the requirements for use as "narrow band" valence stabilizers for $Co^{+3}$ include, but are not limited to: 4-hydroxypentan-2-one; 1,3-diphenyl-3-hydroxypropanal; 1,3-dibenzyl-3-hydroxypropanal; 1,3-dicyclohexyl-3-hydroxypropanal; 1,3-dinorbornyl-3-hydroxypropanal; 1,3-di(2-thienyl)-3-hydroxypropanal; 1,3-di(2-furyl)-3-hydroxypropanal; o-hydroxyacetophenone; juglone; alizarin; 1-hydroxyanthraquinone; 1,8-hydroxyanthraquinone; 1-hydroxyacridone; and beta-hydroxybenzophenone.

O Valence Stabilizer #23: Examples of N-(aminomethylol) ureas [N-(aminohydroxymethyl)ureas], bis[N-(aminomethylol)ureas], and poly[N-(aminomethylol)ureas] (O—O Bidentates, O—O Tridentates, O—O Tetradentates) that meet the requirements for use as "narrow band" valence stabilizers for $Co^{+3}$ include, but are not limited to: N'-(aminohydroxymethyl)urea; N,N"-dimethyl-N'-(aminohydroxymethyl)urea; N,N'-diethyl-N'-(aminohydroxymethyl) urea; N,N"-isopropyl-N'-(aminohydroxymethyl)urea; N,N"-diphenyl-N'-(aminohydroxymethyl)urea; N,N"-dibenzyl-N'-(aminohydroxymethyl)urea; N,N"-dicyclohexyl-N'-(aminohydroxymethyl)urea; and N,N"-dinorbornyl-N'-(aminohydroxymethyl)urea.

O Valence Stabilizer #24: Examples of oxamides, bis(oxamides), and poly(oxamides) (O—O Bidentates, O—O Tridentates, O—O Tetradentates) that meet the requirements for use as "narrow band" valence stabilizers for $Co^{+3}$ include, but are not limited to: oxamide, N-methyloxamide; N-ethyloxamide; N-isopropyloxamide; N-phenyloxamide; N-benzyloxamide; N-cyclohexyloxamide; N-norbornyloxamide; N,N'-dimethyloxamide; N,N'-diethyloxamide; N,N'-diisopropyloxamide; N,N'-diphenyloxamide; N,N'-dibenzyloxamide; N,N'-dicyclohexyloxamide; and N,N'-dinorbornyloxamide.

O Valence Stabilizer #25: Examples of squaric acids and derivatives thereof (O—O Bidentates) that meet the requirements for use as "narrow band" valence stabilizers for $Co^{+3}$ include, but are not limited to: deltic acid; squaric acid; croconic acid; and rhodizonic acid.

O Valence Stabilizer #26: Examples of dicarboxylic acids, bis(dicarboxylic acids), poly(dicarboxylic acids), and derivatives thereof (O—O Bidentates and O—O Tetradentates) that meet the requirements for use as "narrow band" valence stabilizers for $Co^{+3}$ include, but are not limited to: oxalic acid; malonic acid; succinic acid; diphenyl oxalate; diphenyl malonate; and diphenyl succinate.

O Valence Stabilizer #27: Examples of carbonates and bis(carbonates) (O—O Bidentates and O—O Tetradentates) that meet the requirements for use as "narrow band" valence stabilizers for $Co^{+3}$ include, but are not limited to: carbonate; bicarbonate; O,O-diethylcarbonate; diisopropylcarbonate; diphenylcarbonate; dibenzylcarbonate; dicyclohexylcarbonate; and dinorbornylcarbonate.

O Valence Stabilizer #28: Examples of carbamates, bis (carbamates), and poly(carbamates) (including N-hydroxycarbamates and N-mercaptocarbamates) (O—O Bidentates, O—O Tridentates, and O—O Tetradentates) that meet the requirements for use as "narrow band" valence stabilizers for $Co^{+3}$ include, but are not limited to: dimethylcarbamate (dmc); di(trifluorodimethyl)carbamate; ethyl carbamate; diethylcarbamate (dec); dipropylcarbamate; diisopropylcarbamate; dibutylcarbamate; ditertbutylcarbamate; dicyanamidocarbamate; diphenylcarbamate; di(pentafluorophenyl) carbamate; dibenzylcarbamate; dinaphthylcarbamate; dicyclohexylcarbamate; dinorbornylcarbamate; diadamantylcarbamate; pyrrolidinocarbamate (pyrc); piperidinocarbamate (pipc); morpholinocarbamate (morc); thiamorpholinocarbamate; 3-pyrrolinocarbamate; pyrrolocarbamate; oxazolocarbamate; isoxazolocarbamate; thiazolocarbamate; isothiazolocarbamate; indolocarbamate; carbazolocarbamate; pyrazolinocarbamate; imidazolinocarbamate; pyrazolocarbamate; imidazolocarbamate; indazolocarbamate; and triazolocarbamate.

O Valence Stabilizer #29: Examples of carbazates (carbazides), bis(carbazates), and poly(carbazates) (O—O Bidentates, O—O Tridentates, and O—O Tetradentates; or possibly N—O Bidentates, N—O Tridentates, and N—O Tetradentates) that meet the requirements for use as "narrow band" valence stabilizers for $Co^{+3}$ include, but are not limited to: N,N'-dimethylcarbazate; N,N'-di(trifluoromethyl)carbazate; N,N'-diethylcarbazate; N,N'-diphenylcarbazate; N,N'-dibenzylcarbazate; N,N'-di(pentafluorophenyl) carbazate; N,N'-dicyclohexylcarbazate; and N,N'-dinorbornylcarbazate.

O Valence Stabilizer #30: Examples of carbimates, bis (carbimates), and poly(carbimates) (O—O Bidentates, O—O Tridentates, and O—O Tetradentates) that meet the requirements for use as "narrow band" valence stabilizers for $Co^{+3}$ include, but are not limited to: methylcarbimate; trifluoromethylcarbimate; ethylcarbimate; propylcarbimate; isopropylcarbimate; butylcarbimate; tertbutylcarbimate; cyanocarbimate; cyanamidocarbimate; azidocarbimate; phenylcarbimate; pentafluorophenylcarbimate; benzylcarbimate; naphthylcarbimate; cyclohexylcarbimate; norbornylcarbimate; and adamantylcarbimate. [Note: Carbimates tend to stabilize lower oxidation states in metal ions.]

O Valence Stabilizer #31: Examples of arsonic acids, bis (arsonic acids), poly(arsonic acids), and derivatives thereof (O—O Bidentates, O—O Tridentates, O—O Tetradentates) that meet the requirements for use as "narrow band" valence stabilizers for $Co^{+3}$ include, but are not limited to: arsonic acid, O-phenylarsonic acid, O-benzylarsonic acid, O-cyclohexylarsonic acid, O-norbornylarsonic acid, O,O-diphenylarsonic acid, O,O-dibenzylarsonic acid, O,O-dicyclohexylarsonicacid, O,O-dinorbornylarsonic acid, and aminophenylarsonic acids.

O Valence Stabilizer #32: Examples of alkyl- and arylborates and bis(borates) (O—O Bidentates and O—O Tetradentates) that meet the requirements for use as "narrow band" valence stabilizers for $Co^{+3}$ include, but are not limited to: triethyl borate; diisopropyl borate; diphenyl borate; dibenzyl borate; dicyclohexyl borate; and dinorbornyl borate.

O Valence Stabilizer #33: Examples of alkyl- and arylboronates and bis(boronates) (O—O Bidentates and O—O Tetradentates) that meet the requirements for use as "narrow band" valence stabilizers for $Co^{+3}$ include, but are not limited to: diethyl boronate; diisopropyl boronate; diphenyl boronate; dibenzyl boronate; dicyclohexyl boronate; and dinorbornyl boronate. [Note: boronates tend to stabilize lower oxidation states in metal ions.]

O Valence Stabilizer #34: Examples of phosphine P-oxides and amino-substituted phosphine oxides (O Monodentates) that meet the requirements for use as "narrow band" valence stabilizers for $Co^{+3}$ include, but are not limited to: trimethylphosphine oxide (TMPO); triethylphosphine oxide (TEPO); triphenylphosphine oxide (TPhPO); tribenzylphosphine oxide (TBzPO); tricyclohexylphosphine oxide (TcHxPO); and trinorbornylphosphine oxide for phosphine P-oxides; and hexamethylphosphoramide (HMPA); trimorpholinophosphine oxide (TMrPO); tripiperidinophosphine oxide; tripyrrolidinophosphine oxide; and tri(cyclohexylamino)phosphine oxide for amino-substituted phosphine oxides.

O Valence Stabilizer #35: Examples of arsine As-oxides and amino-substituted arsine oxides (O Monodentates) that meet the requirements for use as "narrow band" valence stabilizers for $Co^{+3}$ include, but are not limited to: trimethylarsine oxide (TMAsO); triethylarsine oxide (TEAsO); triphenylarsine oxide (TPhAsO); tribenzylarsine oxide (TBzAsO); tricyclohexylarsine oxide (TcHxAsO); and trinorbornylarsine oxide for arsine As-oxides; and hexamethylarsonamide; trimorpholinoarsine oxide; tripiperidinoarsine oxide; tripyrrolidinoarsine oxide; and tri(cyclohexylamino)arsine oxide for amino-substituted arsine oxides.

O Valence Stabilizer #36: Examples of cyanate ligands (O monodentates) that meet the requirements for use as "narrow band" valence stabilizers for $Co^{+3}$ include, but are not limited to: cyanate (—OCN).

N—S Valence Stabilizer #1: Examples of thioimidates, dithioimidates, polythioimidates, and derivatives of thioimidic acid (N—S bidentates and N—S tetradentates) that meet the requirements for use as "narrow band" valence stabilizers for $Co^{+3}$ include, but are not limited to: S-methyl formathioimidate; S-ethyl formathioimidate; S-methyl acetathioimidate; S-ethyl acetathioimidate; S-methyl benzthioimidate; S-ethyl benzthioimidate; S-methyl cyclohexylthioimidate; S-ethyl cyclohexylthioimidate; S-methyl pentafluorobenzthioimidate; S-ethyl pentafluorobenzthioimidate; S-methyl 2-pyridylthioimidate; S-ethyl 2-pyridylthioimidate; S,S'-dimethyl benzdithioimidate; S,S'-dimethyl tetrafluorobenzdithioimidate; 2-iminothiolane; and 2-iminotetrahydrothiopyran. [Note: Many thioimidate complexes are decomposed by water, but their stability can be enhanced through the use of fluorinated solubility control anions (e.g., $PF_6^-$).]

N—S Valence Stabilizer #2: Examples of thioguanylureas, guanidinothioureas, bis(thioguanylureas), bis(guanidinothioureas, poly(thioguanylureas), and poly(guanidinothioureas) (N—S Bidentates and N—S Tetradentates) that meet the requirements for use as "narrow band" valence stabilizers for $Co^{+3}$ include, but are not limited to: thioguanylurea (amidinothiourea); guanidinothiourea; methylthioguanylurea; ethylthioguanylurea; isopropylthioguanylurea; butylthioguanylurea; benzylthioguanylurea; phenylthioguanylurea; tolylthioguanylurea; naphthylthioguanylurea; cyclohexylthioguanylurea; norbornylthioguanylurea; adamantylthioguanylurea; dimethylthioguanylurea; diethylthioguanylurea; diisopropylthioguanylurea; dibutylthioguanylurea; dibenzylthioguanylurea; diphenylthioguanylurea; ditolylthioguanylurea; dinaphthylthioguanylurea; dicyclohexylthioguanylurea; dinorbornylthioguanylurea; diadamantylthioguanylurea; ethylenebis(thioguanylurea); propylenebis(thioguanylurea); phenylenebis(thioguanylurea); piperazinebis(thioguanylurea); oxalylbis(thioguanylurea); malonylbis(thioguanylurea); succinylbis(thioguanylurea); and phthalylbis(thioguanylurea). [Note: thioguanylureas generally tend to favor lower oxidation states in complexed metals.]

N—S Valence Stabilizer #3: Examples of amidinothioamides, guanidinothioamides, bis(amidinothioamides), bis(guanidinothioamides), poly(amidinothioamides), and poly(guanidinothioamides) (including both N-amidinothioamides and 2-amidinothioacetamides) (N—S Bidentates, N—S Tridentates, and N—S Tetradentates) that meet the requirements for use as "narrow band" valence stabilizers for $Co^{+3}$ include, but are not limited to: amidinothioacetamide; guanidinothioamide, amidinothiopropanamide; amidinothiobutanamide; amidinothiobenzamide; amidinothiotoluamide; amidinothiocyclohexamide; N-methylamidinothioacetamide; N-ethylamidinothiopropanamide; N-propylamidinothiobutanamide; N-phenylamidinothiobenzamide; N-tolylamidinothiotoluamide; N-cyclohexylamidinothiocyclohexamide; bis(amidinothiooxamide); bis(amidinothiomalonamide); bis(amidinothiosuccinamide); bis(amidinothiophthalamide); 2-amidinothioacetamide(thiomalonamamidine); N-methyl-2-amidinothioacetamide; N-ethyl-2-amidinothioacetamide; N-phenyl-2-amidinothioacetamide; N-benzyl-2-amidinothioacetamide; N-cyclohexyl-2-amidinothioacetamide; N,N'-dimethyl-2-amidinothioacetamide; N,N'-diethyl-2-amidinothioacetamide; N,N'-diphenyl-2-amidinothioacetamide; N,N'-dibenzyl-2-amidinothioacetamide; and N,N'-dicyclohexyl-2-amidinothioacetamide. [Note: arnidinothioamides generally tend to favor lower oxidation states in complexed metals.]

N—S Valence Stabilizer #4: Examples of imidoylthioamides, bis(imidoylthioamides), and poly(imidoylthioamides) (N—S Bidentates, N—S Tridentates, and N—S Tetradentates) that meet the requirements for use as "narrow band" valence stabilizers for $Co^{+3}$ include, but are not limited to: acetimidoylthioacetamide; acetimidoylthiopropanamide; acetimidoylthiobutanamide; acetimidoylthiobenzamide; acetimidolylthiotoluamide; acetimidoylthiocyclohexamide; propimidoylthiopropanamide; butimidoylthiobutanamide; benzimidoylthiobenzamide; ethylenebis(acetimidoylthioacetamide); propylenebis(acetimidoylthioacetamide); and phenylenebis(acetimidoylthioacetamide). [Note: imidoylthioamides generally tend to favor lower oxidation states in complexed metals.]

N—S Valence Stabilizer #5: Examples of thioureas, bis(thioureas), and poly(thioureas), including thiourylene complexes (N—S bidentates and N—S tetradentates) that meet the requirements for use as "narrow band" valence stabilizers for $Co^{+3}$ include, but are not limited to: thiourea; methylthiourea; ethylthiourea; isopropylthiourea; benzylthiourea; phenylthiourea; cyclohexylthiourea; naphthylthiourea (ntu); biphenylthiourea; norbornylthiourea; adamantylthiourea; N,N'-dimethylthiourea; N,N'-diethylthiourea; N,N'-diisopropylthiourea; N,N'-dibenzylthiourea; N,N'-dicyclohexylthiourea; N,N'dinapthylthiourea; N,N'-dibiphenylthiourea; N,N'-dinorbornylthiourea; N,N'-diadamantylthiourea; tetramethylthiourea; ethylenethiourea (2-imidazolidinethione)(etu); 4,5-dihydroxy-2-imidazolinethione (dhetu); propylenethiourea; N-(thiazol-2-yl)thiourea; diphenylphosphinothioyl thioureas; allylthiourea; N-allyl-N'-pyridylthiourea; N-allyl-N'-anisylthiourea; N-allyl-N'-naphthylthiourea; N-allyl-N'-phenylthiourea; thioglycoluril (acetylenethiourea); and bis(pyridylmethyl)thiourea. [Note: thioureas generally tend to favor lower oxidation states in complexed metals.]

N—S Valence Stabilizer #6: Examples of thiocarboxamides, bis(thiocarboxamides), and poly(thiocarboxamides), (N—S bidentates, N—S tridentates, and N—S tetradentates) that meet the requirements for use as "narrow band" valence stabilizers for $Co^{+3}$ include, but are not limited to: thiocarbamide (tu); thioacetamide (taa); thiopropionamide; thiobutanamide; thiobenzamide (1-phenylthioformamide)(tba); 1-naphthylthioformamide; 1-cyclohexylthioformamide); 1-norbornylthioformamide; 1-adamantylthioformamide; N,N-dimethylthioformamide; N,N-dimethylthioacetamide;

pyridine-2-thiocarboxamide(thiopicolinamide); pyrazine-2, 3-dithiocarboxamide; thionicotinamide; 2-thiophenethiocarboxamide; N,N-dimethylthiobenzamide; N-ethylthiocarbamide (N-etu); tetramethylthiocarbamide (tmtu); 2-thioacetamidothiazole (tatz); and polythioacrylamides. [Note: thiocarboxamides generally tend to favor lower oxidation states in complexed metals.]

N—S Valence Stabilizer #7: Examples of imidosulfurous diamides and bis(imidosulfurous diamides) (N—S Bidentates, N—S Tridentates, and N—S Tetradentates) that meet the requirements for use as "narrow band" valence stabilizers for $Co^{+3}$ include, but are not limited to: N,N'-diphenylimidosulfurous diamide; N,N'-dibenzylimidosulfurous diamide; and phenylenebis(imidosulfurous diamide). [Note: These complexes tend to hydrolyze unless stabilized with a fluorinated anionic solubility control agent. The sulfite ($S^{+4}$) valence of the sulfur atom makes stabilization of high valence metal ions much more difficult, though still possible.]

N—S Valence Stabilizer #8: Examples of sulfurdiimines, bis(sulfurdiimines), and poly(sulfurdiimines) (N—S Bidentates, N—S Tridentates, and N—S Tetradentates) that meet the requirements for use as "narrow band" valence stabilizers for $Co^{+3}$ include, but are not limited to: N,N'-diphenylsulfurdiimine; N,N'-dibenzylsulfurdiimine; and phenylenebis(sulfurdiimine). [Note: These complexes tend to hydrolyze unless stabilized with a fluorinated anionic solubility control agent. The sulfite ($S^{+4}$) valence of the sulfur atom makes stabilization of high valence metal ions much more difficult, though still possible.]

N—S Valence Stabilizer #9: Examples of phosphonimidothioic acid, phosphonimidodithioic acid, bis(phosphonimidothioic acid); bis(phosphonimidodithioic acid), and derivatives thereof (N—S Bidentates, N—S Tetradentates) that meet the requirements for use as "narrow band" valence stabilizers for $Co^{+3}$ include, but are not limited to: phosphonimidothioic acid, phosphonimidodithioic acid; O-phenylphosphonimidothioic acid; O-benzylphosphonimidothioic acid; O-cyclohexylphosphonimidothioic acid; O-norbornylphosphonimidothioic acid; S-phenylphosphonimidodithioic acid; S-benzylphosphonimidodithioic acid; S-cyclohexylphosphonimidodithioic acid; and S-norbornylphosphonimidodithioic acid. [Note: The phosphite ($p^{+3}$) valence of the phosphorus atom makes stabilization of high valence metal ions much more difficult, though still possible.]

N—S Valence Stabilizer #10: Examples of phosphonothioic diamides, bis(phosphonothioic diamides), and poly (phosphonothioic diamides) (N—S Bidentates and N—S Tetradentates) that meet the requirements for use as "narrow band" valence stabilizers for $Co^{+3}$ include, but are not limited to: phosphonothioic diamide, phosphonothioic dihydrazide, phosphonamidothioic hydrazide, N-phenylphosphonothioic diamide, N-benzylphosphonothioic diamide, N-cyclohexylphosphonothioic diamide, and N-norbornylphosphonothioic diamide. [Note: The phosphite ($p^{+3}$) valence of the phosphorus atom makes stabilization of high valence metal ions much more difficult, though still possible.]

N—S Valence Stabilizer #11: Examples of phosphonamidothioic acid, phosphonamidimidodithioic acid, bis(phosphonamidothioic acid), bis(phosphonamidimidodithioic acid), poly(phosphonamidothioic acid), and poly(phosphonamidimidodithioic acid), and derivatives thereof (N—S Bidentates and N—S Tetradentates) that meet the requirements for use as "narrow band" valence stabilizers for $Co^{+3}$ include, but are not limited to: phosphonamidothioic acid, phosphonamidimidodithioic acid, phosphonohydrazidodithioic acid, phosphonohydrazidothioic acid, S-phenylphosphonamidimidodithioic acid, S-benzylphosphonamidimidodithioic acid, S-cyclohexylphosphonamidimidodithioic acid, and S-norbornylphosphonamidimidodithioic acid. [Note: The phosphite ($P^{+3}$) valence of the phosphorus atom makes stabilization of high valence metal ions much more difficult, though still possible.]

N—S Valence Stabilizer #12: Examples of beta-aminothiones (N-substituted 3-amino-2-propenethioaldehydes), bis(beta-aminothiones), and poly(beta-aminothiones) (N—S Bidentates and N—S Tetradentates) that meet the requirements for use as "narrow band" valence stabilizers for $Co^{+3}$ include, but are not limited to: 4-methylamino-3-penten-2-thione; 4-ethylamino-3-penten-2-thione; 4-isopropylamino-3-penten-2-thione; 4-phenylamino-3-penten-2-thione; 4-naphthylamino-3-penten-2-thione; 4-cyclohexylamino-3-penten-2-thione; 4-norbornylamino-3-penten-2-thione; 4-hydroxyamino-3-penten-2-thione; 3-methylamino-1-phenyl-2-butenethioaldehydel; 3-ethylamino-1-phenyl-2-butenethioaldehyde; 3-isopropylamino-1-phenyl-2-butenethioaldehyde; 3-phenylamino-1-phenyl-2-butenethioaldehyde; 3-naphthylamino-1-phenyl-2-butenethioaldehyde; 3-cyclohexylamino-1-phenyl-2-butenethioaldehyde; 3-norbornylamino-1-phenyl-2-butenethioaldehyde; 3-hydroxyamino-1-phenyl-2-butenethioaldehyde; 3-phenylamino-1,3-diphenyl-2-propenethioaldehyde; 3-cyclohexylamino-1,3-dicyclohexyl-2-propenethioaldehyde; and 3-norbornylamino-1,3-dinorbornyl-2-propenethioaldehyde.

N—S Valence Stabilizer #13: Examples of 3-aminothioacrylamides (3-amino-2-thiopropenamides), 3,3-diaminothioacrylamides, bis(3-aminothioacrylamides), bis(3,3-diaminothioacrylamides), poly(3-aminothioacrylamides), and poly(3,3-diaminothioacrylamides) (N—S Bidentates and N—S Tetradentates) that meet the requirements for use as "narrow band" valence stabilizers for $Co^{+3}$ include, but are not limited to: 3-methylaminothioacrylamide; 3-ethylaminothioacrylamide, 3-isopropylaminothioacrylamide, 3-phenylaminothioacrylamide; 3-naphthylaminothioacrylamide; 3-cyclohexylaminothioacrylamide; 3-norbornylaminothioacrylamide; 3-hydroxyaminothioacrylamide; N-methyl-3-methylaminothioacrylamide; N-ethyl-3-ethylaminothioacrylamide, N-isopropyl-3-isopropylaminothioacrylamide, N-phenyl-3-phenylaminothioacrylamide; N-naphthyl-3-naphthylaminothioacrylamide; N-cyclohexyl-3-cyclohexylaminothioacrylamide; N-norbornyl-3-norbornylaminothioacrylamide; 3-amino-3-methylaminothioacrylamide; 3-amino-3-ethylaminothioacrylamide, 3-amino-3-isopropylaminothioacrylamide, 3-amino-3-phenylaminothioacrylamide; 3-amino-3-naphthylaminothioacrylamide; 3-amino-3-cyclohexylaminothioacrylamide; 3-amino-3-norbornylaminothioacrylamide; and 3-amino-3-hydroxyaminothioacrylamide.

N—S Valence Stabilizer #14: Examples of 3-aminothioacrylic acids (3-amino-2-thiopropenoic acids), 3-mercapto-3-aminothioacrylic acids, bis(3-aminothioacrylic acids), bis (3-mercapto-3-aminothioacrylic acids), poly(3-aminothioacrylic acids), and poly(3-mercapto-3-aminothioacrylic acids), and derivatives thereof (N—S Bidentates and N—S Tetradentates) that meet the requirements for use as "narrow band" valence stabilizers for $Co^{+3}$ include, but are not limited to: 3-aminothioacrylic acid; 3-mercapto-3-aminothioacrylic acid; 3-methylaminothioacrylic acid; 3-ethylaminothioacrylic acid; 3-isopropylaminothioacrylic acid; 3-phenylaminothioacrylic acid; 3-naphthylaminothioacrylic acid; 3-cyclohexylaminothioacrylic acid; 3-norbornylaminothioacrylic acid; 3-hydroxyaminothioacrylic acid; methyl 3-methylaminothioacrylate; ethyl 3-ethylaminothioacrylate; isopropyl 3-isopropylaminothioacrylate; benzyl 3-phenylaminothioacrylate; naphthyl 3-naphthylaminothioacrylate; cyclohexyl 3-cyclohexylaminothioacrylate; and norbornyl 3-norbornylaminothioacrylate.

N—S Valence Stabilizer #15: Examples of N-thioacyl benzylidenimines, bis(N-thioacyl benzylidenimines), and poly (N-thioacyl benzylidenimines) (N—S Bidentates and N—S Tetradentates) that meet the requirements for use as "narrow band" valence stabilizers for $Co^{+3}$ include, but are not limited to: N-thioformyl benzylidenimine, N-thioacetyl benzylidenimine; N-thiobenzoyl benzylidenimine; and N-pentafluorothiobenzoyl benzylidenimine.

N—S Valence Stabilizer #16: Examples of thiocarbonyl oximes, bis(thiocarbonyl oximes), and poly(thiocarbonyl oximes) (N—S Bidentates, N—S Tridentates, and N—S Tetradentates) that meet the requirements for use as "narrow band" valence stabilizers for $Co^{+3}$ include, but are not limited to: butane-3-thione-2-one monoxime); and diphenylethane-2-thione-1-one monoxime.

N—S Valence Stabilizer #17: Examples of mercapto oximes, bis(mercapto oximes), and poly(mercapto oximes) (including 2-sulfur heterocyclic oximes) (N—S Bidentates, N—S Tridentates, N—S Tetradentates, and N—S Hexadentates) that meet the requirements for use as "narrow band" valence stabilizers for $Co^{+3}$ include, but are not limited to: 3-mercaptobutan-2-one oxime; 4-mercaptohexan-3-one oxime; (1,2-diphenyl-2-mercaptoethanone oxime); 1,2-di(trifluoromethyl)-2-mercaptoethanone oxime; 1,2-dicyclohexyl-2-mercaptoethanone oxime; 1,2-dinorbornyl-2-mercaptoethanone oxime; 2-mercaptobenzaldehyde oxime; 2-mercapto-1-naphthaldehyde oxime; thiophene-2-aldoxime; methyl 2-thiophenyl ketoxime; and phenyl 2-thiophenyl ketoxime.

N—S Valence Stabilizer #18: Examples of 2-nitrothiophenols (2-nitrobenzenethiols) (N—S Bidentates) that meet the requirements for use as "narrow band" valence stabilizers for $Co^{+3}$ include, but are not limited to: 2-nitrothiophenol; 2,3-dinitrothiophenol; 2,4-dinitrothiophenol; 2,5-dinitrothiophenol; 2,6-dinitrothiophenol; 1-nitro-2-naphthalenethiol; and 2-nitro-1-naphthalenethiol.

N—S Valence Stabilizer #19: Examples of 2-nitrilothiophenols (2-nitrilobenzenethiols) (N—S Bidentates) that meet the requirements for use as "narrow band" valence stabilizers for $Co^{+3}$ include, but are not limited to: 2-cyanothiophenol; 2,3-dicyanothiophenol; 2,4-dicyanothiophenol; 2,5-dicyanothiophenol; 2,6-dicyanothiophenol; 1-cyano-2-naphthalenethiol; and 2-cyano-1-naphthalenethiol.

N—S Valence Stabilizer #20: Examples of thiohydrazides, bis(thiohydrazides), and poly(thiohydrazides) (N—S Bidentates and N—S Tetradentates) that meet the requirements for use as "narrow band" valence stabilizers for $Co^{+3}$ include, but are not limited to: thioformic hydrazide; thioacetic hydrazide; thiopropionic hydrazide; thiobenzoic hydrazide; thiophthalhydrazide; thiosalicylic hydrazide; thionaphthoic hydrazides; thionorbornaneacetic hydrazide; thionicotinic hydrazide; and thioisonicotinic hydrazide. [Note: Thiohydrazides prefer complexation with lower oxidation states in metal ions.]

N—S Valence Stabilizer #21: Examples of thiosemicarbazides, bis(thiosemicarbazides), and poly(thiosemicarbazides) (N—S Bidentates, N—S Tetradentates, and N—S Hexadentates) that meet the requirements for use as "narrow band" valence stabilizers for $Co^{+3}$ include, but are not limited to: thiosemicarbazide (tsc); thiosemicarbazide diacetic acid (tsda); 1-methylthiosemicarbazide (1mts); 1-ethylthiosemicarbazide; 1-isopropylthiosemicarbazide; 1-phenylthiosemicarbazide (1pts) (cryogenine); 1-benzylthiosemicarbazide; 1-cyclohexylthiosemicarbazide; 1-norbornylthiosemicarbazide; 4-methylthiosemicarbazide (4mts); 4-ethylthiosemicarbazide; 4-isopropylthiosemicarbazide; 4-phenylthiosemicarbazide (4-pts); 4-benzylthiosemicarbazide; 4-cyclohexylthiosemicarbazide; 4-norbornylthiosemicarbazide; nicotinic thiosemicarbazide; isonicotinic thiosemicarbazide; and 4-phenyl-1-benzenesulfonyl-3-thiosemicarbazide (pbst). [Note: Thiosemicarbazides prefer complexation with lower oxidation states in metal ions.]

N—S Valence Stabilizer #22: Examples of five-, seven-, or nine-membered macrocyclics, macrobicyclics, and macropolycyclics (including catapinands, cryptands, cyclidenes, and sepulchrates) wherein all binding sites are composed of nitrogen (usually amine or imine groups) or sulfur (usually thiols, mercaptans, or thiocarbonyls) and are not contained in component heterocyclic rings (N—S Tridentates, N—S Tetradentates, and N—S Hexadentates) that meet the requirements for use as "narrow band" valence stabilizers for $Co^{+3}$ include, but are not limited to: triazadithiacyclodecane ([10]ane$S_2N_3$); triazadithiacycloundecane ([11]ane$S_2N_3$); triazadithiacyclododecane ([12]ane$S_2N_3$); triazadithiacyclotridecane ([13]ane$S_2N_3$); triazadithiacyclotetradecane ([14]ane$S_2N_3$); triazadithiacyclopentadecane ([15]ane$S_2N_3$); thiomorpholine; and thiazolidine.

N—S Valence Stabilizer #23: Examples of five- or seven-membered macrocyclics, macrobicyclics, and macropolycyclics (including catapinands, cryptands, cyclidenes, and sepulchrates) wherein all binding sites are composed of nitrogen or sulfur and are contained in component heterocyclic rings (N—S Bidentates, N—S Tridentates, N—S Tetradentates, or N—S Hexadentates) that meet the requirements for use as "narrow band" valence stabilizers for $Co^{+3}$ include, but are not limited to: dithiopyrantripyridines; dithiophenetripyrroles; trithiopyrantetrapyridines; and trithiophenetetrapyrroles.

N—S Valence Stabilizer #24: Examples of five-, seven-, or nine-membered macrocyclics, macrobicyclics, and macropolycyclics (including catapinands, cryptands, cyclidenes, and sepulchrates) wherein all binding sites are composed of nitrogen or sulfur and are contained in a combination of heterocyclic rings and amine, imine, thiol, mercapto, or thiocarbonyl groups (N—S Bidentates, N—S Tridentates, N—S Tetradentates, or N—S Hexadentates) that meet the requirements for use as "narrow band" valence stabilizers for $Co^{+3}$ include, but are not limited to: azathiapentaphyrins; diazadithiapentaphyrins; azathiapentaphyrins; and diazadithiapentaphyrins.

N—O Valence Stabilizer #1: Examples of imidates, diimidates, polyimidates, and derivatives of imidic acid (N—O bidentates and N—O tetradentates) that meet the requirements for use as "narrow band" valence stabilizers for $Co^{+3}$ include, but are not limited to: O-methyl formimidate; O-ethyl formimidate; O-methyl acetimidate; O-ethyl acetimidate; O-methyl benzimidate; O-ethyl benzimidate; O-methyl cyclohexylimidate; O-ethyl cyclohexylimidate; O-methyl pentafluorobenzimidate; O-ethyl pentafluorobenzimidate; O-methyl 2-pyridylimidate; O-ethyl 2-pyridylimidate; O,O'-dimethyl benzdiimidate; O,O'-dimethyl tetrafluorobenzdiimidate; 2-iminotetrahydrofuran; and 2-iminotetrahydropyran. [Note: Most imidate complexes are decomposed by water, but their stability can be enhanced through the use of fluorinated solubility control anions (e.g., $PF_6^-$).]

N—O Valence Stabilizer #2: Examples of pseudoureas, bis(pseudoureas), and poly(pseudoureas) (N—O bidentates and N—O tetradentates) that meet the requirements for use as "narrow band" valence stabilizers for $Co^{+3}$ include, but are not limited to: O-methyl pseudourea; O-ethyl pseudourea; O-isopropyl pseudourea; O-benzyl pseudourea; O-cyclohexyl pseudourea; O-norbornyl pseudourea; O-pentafluorobenzyl pseudourea; N-methyl pseudourea; N-ethyl pseudourea; N-isopropyl pseudourea; N-benzyl pseudourea; N-cyclohexyl pseudourea; N-norbornyl pseudourea; and N-pentafluorobenzyl pseudourea.

N—O Valence Stabilizer #3: Examples of 2-amidinoacetates, bis(2-amidinoacetates), and poly(2-amidinoacetates) (N—O Bidentates and N—O Tetradentates) that meet the requirements for use as "narrow band" valence stabilizers for $Co^{+3}$ include, but are not limited to: N-methyl-2-amidinoacetate; O-methyl-2-amidinoacetate; N-benzyl-2-amidinoacetate; and O-benzyl-2-amidinoacetate. [Note: many 2-amidinoacetates tend to hydrolyze in water. This can be minimized through the use of fluorinated solubility control anions such as $PF_6^-$.]

N—O Valence Stabilizer #4: Examples of ureas, bis(ureas), and poly(ureas), including urylene complexes (N—O bidentates and N—O tetradentates) that meet the requirements for use as "narrow band" valence stabilizers for $Co^{+3}$ include, but are not limited to: urea; methylurea; ethylurea; isopropylurea; benzylurea; cyclohexylurea; naphthylurea; biphenylurea; norbornylurea; adamantylurea; N,N'-dimethylurea; N,N'-diethylurea; N,N'-diisopropylurea; N,N'-dibenzylurea; N,N'-dicyclohexylurea; N,N'dinapthylurea; N,N'-dibiphenylurea; N,N'-dinorbornylurea; N,N'-diadamantylurea; ethyleneurea (2-imidazolidone); propyleneurea; glycoluril (acetyleneurea); and N,N'-bis(4-nitrophenyl)urea.

N—O Valence Stabilizer #5: Examples of phosphonimidic acid, bis(phosphonimidic acid), poly(phosphonimidic acid), and derivatives thereof (N—O Bidentates and N—O Tetradentates) that meet the requirements for use as "narrow band" valence stabilizers for $Co^{+3}$ include, but are not limited to: phosphonimidic acid; O-phenylphosphonimidic acid; O-benzylphosphonimidic acid; O-cyclohexylphosphonimidic acid; and O-norbornylphosphonimidic acid. [Note: The phosphite ($P^{+3}$) valence of the phosphorus atom makes stabilization of high valence metal ions much more difficult, though still possible.]

N—O Valence Stabilizer #6: Examples of phosphonamidic acid, phosphonic diamide, bis(phosphonamidic acid), bis (phosphonic diamide), poly(phosphonamidic acid), poly (phosphonic diamide), and derivatives thereof (N—O Bidentates and N—O Tetradentates) that meet the requirements for use as "narrow band" valence stabilizers for $Co^{+3}$ include, but are not limited to: phosphonamidic acid, phosphonic diamide, phosphonamidic hydrazide, phosphonic dihydrazide, O-phenylphosphonamidic acid, O-benzylphosphonamidic acid, O-cyclohexylphosphonamidic acid, O-norbornylphosphonamidic acid, N-benzylphosphonic diamide, N-phenylphosphonic diamide, N-cyclohexylphosphonic diamide, and N-norbornylphosphonic diamide. [Note: The phosphite ($p^{+3}$) valence of the phosphorus atom makes stabilization of high valence metal ions much more difficult, though still possible.]

N—O Valence Stabilizer #7: Examples of beta-ketoamines (N-substituted 3-amino-2-propenals), bis(beta-ketoamines), and poly(beta-ketoamines) (N—O Bidentates and N—O Tetradentates) that meet the requirements for use as "narrow band" valence stabilizers for $Co^{+3}$ include, but are not limited to: 4-methylamino-3-penten-2-one; 4-ethylamino-3-penten-2-one; 4-isopropylamino-3-penten-2-one; 4-phenylamino-3-penten-2-one; 4-naphthylamino-3-penten-2-one; 4-cyclohexylamino-3-penten-2-one; 4-norbornylamino-3-penten-2-one; 4-hydroxyamino-3-penten-2-one; 3-methylamino-1-phenyl-2-butenal; 3-ethylamino-1-phenyl-2-butenal; 3-isopropylamino-1-phenyl-2-butenal; 3-phenylamino-1-phenyl-2-butenal; 3-naphthylamino-1-phenyl-2-butenal; 3-cyclohexylamino-1-phenyl-2-butenal; 3-norbornylamino-1-phenyl-2-butenal; 3-hydroxyamino-1-phenyl-2-butenal; 3-phenylamino-1,3-diphenyl-2-propenal; 3-cyclohexylamino-1,3-dicyclohexyl-2-propenal; 3-norbornylamino-1,3-dinorbornyl-2-propenal; 2,2'-pyridil; alpha-pyridoin; 4-aminoantipyrine (aap); beta-phenylaminopropiophenone; and polyaminoquinones (PAQs).

N—O Valence Stabilizer #8: Examples of 3-aminoacrylamides (3-amino-2-propenamides), 3,3-diaminoacrylamides, bis(3-aminoacrylamides), bis(3,3-diaminoacrylamides), poly(3-aminoacrylamides), and poly(3,3-diaminoacrylamides) (N—O Bidentates and N—O Tetradentates) that meet the requirements for use as "narrow band" valence stabilizers for $Co^{+3}$ include, but are not limited to: 3-methylaminoacrylamide; 3-ethylaminoacrylamide, 3-isopropylaminoacrylamide, 3-phenylaminoacrylamide; 3-naphthylaminoacrylamide; 3-cyclohexylaminoacrylamide; 3-norbornylaminoacrylamide; 3-hydroxyaminoacrylamide; N-methyl-3-methylaminoacrylamide; N-ethyl-3-ethylaminoacrylamide, N-isopropyl-3-isopropylaminoacrylamide, N-phenyl-3-phenylaminoacrylamide; N-naphthyl-3-naphthylaminoacrylamide; N-cyclohexyl-3-cyclohexylaminoacrylamide; N-norbornyl-3-norbornylaminoacrylamide; 3-amino-3-methylaminoacrylamide; 3-amino-3-ethylaminoacrylamide, 3-amino-3-isopropylaminoacrylamide, 3-amino-3-phenylaminoacrylamide; 3-amino-3-naphthylaminoacrylamide; 3-amino-3-cyclohexylaminoacrylamide; 3-amino-3-norbornylaminoacrylamide; and 3-amino-3-hydroxyaminoacrylamide.

N—O Valence Stabilizer #9: Examples of 3-aminoacrylic acids (3-amino-2-propenoic acids), 3-hydroxy-3-aminoacrylic acids, bis(3-aminoacrylic acids), bis(3-hydroxy-3-aminoacrylic acids), poly(3-aminoacrylic acids), and poly (3-hydroxy-3-aminoacrylic acids), and derivatives thereof (N—O Bidentates and N—O Tetradentates) that meet the requirements for use as "narrow band" valence stabilizers for $Co^{+3}$ include, but are not limited to: 3-aminoacrylic acid; 3-hydroxy-3-aminoacrylic acid; 3-methylaminoacrylic acid; 3-ethylaminoacrylic acid; 3-isopropylaminoacrylic acid; 3-phenylaminoacrylic acid; 3-naphthylaminoacrylic acid; 3-cyclohexylaminoacrylic acid; 3-norbornylaminoacrylic acid; 3-hydroxyaminoacrylic acid; methyl 3-methylaminoacrylate; ethyl 3-ethylaminoacrylate; isopropyl 3-isopropylaminoacrylate; benzyl 3-phenylaminoacrylate; naphthyl 3-naphthylaminoacrylate; cyclohexyl 3-cyclohexylaminoacrylate; and norbornyl 3-norbornylaminoacrylate.

N—O Valence Stabilizer #10: Examples of N-acyl benzylidenimines, bis(N-acyl benzylidenimines), and poly(N-acyl benzylidenimines) (N—O Bidentates and N—O Tetradentates) that meet the requirements for use as "narrow band" valence stabilizers for $Co^{+3}$ include, but are not limited to: N-formyl benzylidenimine, N-acetyl benzylidenimine; N-benzoyl benzylidenimine; and N-pentafluorobenzoyl benzylidenimine.

N—O Valence Stabilizer #11: Examples of 2-nitroanilines (N—O Bidentates) that meet the requirements for use as "narrow band" valence stabilizers for $Co^{+3}$ include, but are not limited to: 2-nitroaniline; 2,6-dintroaniline; 2-nitrophenylenediamine; 2-nitrophenylenetriamine; 2-nitro-1-aminonaphthalene; 1-nitro-2-aminonaphthalene; nitrodiaminonaphthalene; and dipicrylamine.

N—O Valence Stabilizer #12: Examples of 2-nitrilophenols (N—O Bidentates) that meet the requirements for use as "narrow band" valence stabilizers for $Co^{+3}$ include, but are not limited to: 2-cyanophenol; 2,3-dicyanophenol; 2,4-dicyanophenol; 2,5-dicyanophenol; 2,6-dicyanophenol; 1-cyano-2-naphthol; and 2-cyano-1-naphthol. Also includes acylcyanamides.

N—O Valence Stabilizer #13: Examples of amine N-oxides and N-diazine oxides (azoxy compounds) (N—O Bidentates, N—O Tridentates, and N—O Tetradentates) that meet the requirements for use as "narrow band" valence stabilizers for $Co^{+3}$ include, but are not limited to: pyridine N-oxide (pyNO or PNO); picoline N-oxide (picNO); lutidine N-oxide (lutNO or LNO); collidine N-oxide (collNO or CNO); quinoline N-oxide (QuinNO or QNO); isoquinoline N-oxide (isoQuinNO or IQNO); acridine N-oxide (AcrNO or ANO); picolinic acid N-oxide (PicANO); pyridinethiolate N-oxide (PTNO); adenine N-oxide; adenosine N-oxide; 1,10-phenanthroline mono-N-oxide (phenNO); 1,10-phenanthroline N,N-dioxide (phen2NO); bipyridyl mono-N-oxide (bipyNO); bipyridyl N,N-dioxide (bipy2NO); pyrazine mono-N-oxide (pyzNO); pyrazine N,N-dioxide (pyz2NO); pyrimidine mono-N-oxide (pymNO); pyrimidine N,N-dioxide (pym2NO); pyridazine mono-N-oxide (pdzNO); pyridazine N,N-dioxide (pdz2NO); quinoxaline mono-N-oxide (qxNO); quinoxaline N,N-dioxide (qx2NO); phenazine mono-N-oxide (phzNO); phenazine N,N-dioxide (phz2NO); 2,3-di(pyridine N-oxide)quinoxaline (dpoq); inosine N-oxide; 4,4'-bipyridine N,N-dioxide; 1-hydroxypyrazole 2-oxide; 1-hydroxyimidazole 3-oxide; 2,2'-diimidazyl 3,3'-dioxide; imidazole N-oxides (i.e., 1-hydroxyimidazole-3-N-oxides); N-benzylidine aniline N-oxide; N-(naphthylidene) aniline N-oxide; N-(hydroxybenzylidene) aniline N-oxide; and 2,2'-dibenzimidazyl 3,3'-dioxide (indigo N,N-dioxide) for amine N-oxides; and azoxybenzene; phthalazine N-oxide; benzocinnoline N-oxide; and bipyrazinyl N-oxide as N-diazine oxide examples.

N—O Valence Stabilizer #14: Examples of hydrazides, bis(hydrazides), and poly(hydrazides) (N—O Bidentates and N—O Tetradentates) that meet the requirements for use as "narrow band" valence stabilizers for $Co^{+3}$ include, but are not limited to: formic hydrazide; acetic hydrazide; propionic hydrazide; benzoic hydrazide; phthalhydrazide; salicylic hydrazide; naphthoic hydrazides; norbornaneacetic hydrazide; nicotinic hydrazide; and isonicotinic hydrazide (isoniazid). [Note: Hydrazides prefer complexation with lower oxidation states in metal ions.]

N—O Valence Stabilizer #15: Examples of semicarbazides, bis(semicarbazides), and poly(semicarbazides) (N—O Bidentates, N—O Tetradentates, and N—O Hexadentates) that meet the requirements for use as "narrow band" valence stabilizers for $Co^{+3}$ include, but are not limited to: semicarbazide (sc); semicarbazide diacetic acid (sda); 1-methylsemicarbazide; 1-ethylsemicarbazide; 1-isopropylsemicarbazide; 1-phenylsemicarbazide; 1-benzylsemicarbazide; 1-cyclohexylsemicarbazide; 1-norbornylsemicarbazide; 4-methylsemicarbazide; 4-ethylsemicarbazide; 4-isopropylsemicarbazide; 4-phenylsemicarbazide; 4-benzylsemicarbazide; 4-cyclohexylsemicarbazide; 4-norbornylsemicarbazide; nicotinic semicarbazide; and isonicotinic semicarbazide. [Note: Semicarbazides prefer complexation with lower oxidation states in metal ions.]

N—O Valence Stabilizer #16: Examples of five-, seven-, or nine-membered macrocyclics, macrobicyclics, and macropolycyclics (including catapinands, cryptands, cyclidenes, and sepulchrates) wherein all binding sites are composed of nitrogen (usually amine or imine groups) or oxygen (usually hydroxy, carboxy, or carbonyl groups) and are not contained in component heterocyclic rings (N—O Tridentates, N—O Tetradentates, and N—O Hexadentates) that meet the requirements for use as "narrow band" valence stabilizers for $Co^{+3}$ include, but are not limited to: triazadioxacyclodecane ([10]ane$O_2N_3$); triazadioxacycloundecane ([11]ane$O_2N_3$); triazadioxacyclododecane ([12]ane$O_2N_3$); triazadioxacyclotridecane ([13]ane$O_2N_3$); triazadioxacyclotetradecane ([14]ane$O_2N_3$); and triazadioxacyclopentadecane ([15]ane$O_2N_3$).

N—O Valence Stabilizer #17: Examples of five- or seven-membered macrocyclics, macrobicyclics, and macropolycyclics (including catapinands, cryptands, cyclidenes, and sepulchrates) wherein all binding sites are composed of nitrogen or oxygen and are contained in component heterocyclic rings (N—O Bidentates, N—O Tridentates, N—O Tetradentates, or N—O Hexadentates) that meet the requirements for use as "narrow band" valence stabilizers for $Co^{+3}$ include, but are not limited to: dipyrantripyridines; difurantripyrroles; tripyrantetrapyridines; and trifurantetrapyrroles.

N—O Valence Stabilizer #18: Examples of five-, seven-, or nine-membered macrocyclics, macrobicyclics, and macropolycyclics (including catapinands, cryptands, cyclidenes, and sepulchrates) wherein all binding sites are composed of nitrogen or oxygen and are contained in a combination of heterocyclic rings and amine, imine, hydroxy, carboxy, or carbonyl groups (N—O Bidentates, N—O Tridentates, N—O Tetradentates, or N—O Hexadentates) that meet the requirements for use as "narrow band" valence stabilizers for $Co^{+3}$ include, but are not limited to: azaoxapentaphyrins; diazadioxapentaphyrins; azaoxapentaphyrins; and diazadioxapentaphyrins.

S—O Valence Stabilizer #1: Examples of thiobiurets (thioimidodicarbonic diamides), thioisobiurets, thiobiureas, thiotriurets, thiotriureas, bis(thiobiurets), bis(thioisobiurets), bis(thiobiureas), poly(thiobiurets), poly(thioisobiurets), and poly(thiobiureas) (S—O Bidentates, S—O Tridentates, S—O Tetradentates) that meet the requirements for use as "narrow band" valence stabilizers for $Co^{+3}$ include, but are not limited to: thiobiuret, thioisobiuret, thiobiurea, thiotriuret, thiotriurea, nitrothiobiuret, dinitrothiobiuret, aminothiobiuret, diaminothiobiuret, oxythiobiuret, dioxythiobiuret, cyanothiobiuret, methylthiobiuret, ethylthiobiuret, isopropylthiobiuret, phenylthiobiuret, benzylthiobiuret, cyclohexylthiobiuret, norbornylthiobiuret, adamantylthiobiuret, dimethylthiobiuret, diethylthiobiuret, diisopropylthiobiuret, diphenylthiobiuret, dibenzylthiobiuret, dicyclohexylthiobiuret, dinorbornylthiobiuret, diadamantylthiobiuret; and (3-formamidino thiocarbamides).

S—O Valence Stabilizer #2: Examples of acylthioureas, aroylthioureas, thioacylureas, thioaroylureas, bis(acylthioureas), bis(aroylthioureas), bis(thioacylureas), bis(thioaroylureas), poly(thioacylthioureas), poly(thioaroylthioureas), poly(thioacylureas), and poly(thioaroylureas) (S—O Bidentates, S—O Tridentates, S—O Tetradentates) that meet the requirements for use as "narrow band" valence stabilizers for $Co^{+3}$ include, but are not limited to: thioformylurea, thioacetylurea, thiobenzoylurea, thiocyclohexoylurea, pentafluorothiobenzoylurea, acetylthiourea, benzoylthiourea, and cyclohexoylthiourea.

S—O Valence Stabilizer #3: Examples of thioimidodialdehydes, thiohydrazidodialdehydes (thioacyl hydrazides), bis(thioimidodialdehydes), bis(thiohydrazidodialdehydes), poly(thioimidodialdehydes), and poly(thiohydrazidodialdehydes) (S—O Bidentates, S—O Tridentates, S—O Tetradentates) that meet the requirements for use as "narrow band" valence stabilizers for $Co^{+3}$ include, but are not limited to: thiodiacetamide, thiodipropanamide, thiodibutanamide, thiodibenzamide, and thiodicyclohexamide.

S—O Valence Stabilizer #4: Examples of thioimidodicarbonic acids, thiohydrazidodicarbonic acids, bis(thioimidodicarbonic acids), bis(thiohydrazidodicarbonic acids), poly(thioimidodicarbonic acids), poly(thiohydrazidodicarbonic acids) and derivatives thereof (S—O Bidentates, S—O Tridentates, S—O Tetradentates) that meet the requirements for use as "narrow band" valence stabilizers for $Co^{+3}$ include, but are not limited to: thioimidodicarbonic acid, thiohydrazidodicarbonic acid, O-phenylthioimidodicarbonic acid, O-benzylthioimidodicarbonic acid, O-cyclohexylthioimidodicarbonic acid, O-norbornylthioimidodicarbonic acid, O,O'-diphenylthioimidodicarbonic acid, O,O'-dibenzylthioimidodicarbonic acid, O,O'-dicyclohexylthioimidodicarbonic acid, O,O'-dinorbornylthioimidodicarbonic acid.

S—O Valence Stabilizer #5: Examples of 1,2-monothioketones (monothiolenes, monothio-alpha-ketonates), 1,2,3-monothioketones, 1,2,3-dithioketones, monothiotropolonates, ortho-monothioquinones, bis(1,2-monothioketones), and poly(1,2-monothioketones) (S—O Bidentates, S—O Tridentates, S—O Tetradentates) that meet the requirements for use as "narrow band" valence stabilizers for $Co^{+3}$ include, but are not limited to: monothiotropolone; 1,2-monothiobenzoquinone (o-monothioquinone); di-tert-butyl-1,2-monothiobenzoquinone; hexafluoro-1,2-monothiobenzoquinone; 1,2-monothionaphthoquinone; 9,10-monothiophenanthroquinone; monothiosquaric acid; monothiodeltic acid; monothiocroconic acid; and monothiorhodizonic acid.

S—O Valence Stabilizer #6: Examples of trithioperoxydicarbonic diamides, bis(trithioperoxydicarbonic diamides), and poly(trithioperoxydicarbonic diamides) (S—O Bidentates, S—O Tridentates, S—O Tetradentates) that meet the requirements for use as "narrow band" valence stabilizers for $Co^{+3}$ include, but are not limited to: trithioperoxydicarbonic diamide; N-phenyltrithioperoxydicarbonic diamide; N-benzyltrithioperoxydicarbonic diamide; N-cyclohexyltrithioperoxydicarbonic diamide; N-norbornyltrithioperoxydicarbonic diamide; N,N'-diphenyltrithioperoxydicarbonic diamide; N,N'-dibenzyltrithioperoxydicarbonic diamide; N,N'-dicyclohexyltrithioperoxydicarbonic diamide; and N,N'-dinorbornyltrithioperoxydicarbonic diamide.

S—O Valence Stabilizer #7: Examples of dithiodicarbonic acids, bis(dithiodicarbonic acids), poly(dithiodicarbonic acids), and derivatives thereof (S—O Bidentates, S—O Tridentates, S—O Tetradentates) that meet the requirements for use as "narrow band" valence stabilizers for $Co^{+3}$ include, but are not limited to: dithiodicarbonic acid, O-phenyldithiodicarbonic acid, O-benzyldithiodicarbonic acid, O-cyclohexyldithiodicarbonic acid, O-norbornyldithiodicarbonic acid, O,O'-diphenyldithiodicarbonic acid, O,O'-dibenzyldithiodicarbonic acid, O,O'-dicyclohexyldithiodicarbonic acid, and O,O'-dinorbornyldithiodicarbonic acid.

S—O Valence Stabilizer #8: Examples of trithioperoxydicarbonic acids, bis(trithioperoxydicarbonic acids), poly(trithioperoxydicarbonic acids), and derivatives thereof (S—O Bidentates, S—O Tridentates, S—O Tetradentates) that meet the requirements for use as "narrow band" valence stabilizers for $Co^{+3}$ include, but are not limited to: trithioperoxydicarbonic acid, O-phenyltrithioperoxydicarbonic acid; O-benzyltrithioperoxydicarbonic acid; O-cyclohexyltrithioperoxydicarbonic acid; O-norbornyltrithioperoxydicarbonic acid; O,O'-diphenyltrithioperoxydicarbonic acid; O,O'-dibenzyltrithioperoxydicarbonic acid; O,O'-dicyclohexyltrithioperoxydicarbonic acid; and O,O'-dinorbornyltrithioperoxydicarbonic acid.

S—O Valence Stabilizer #9: Examples of monothioperoxydiphosphoramides, bis(monothioperoxydiphosphoramides), and poly(monothioperoxydiphosphoramides) (S—O Bidentates, S—O Tridentates, S—O Tetradentates) that meet the requirements for use as "narrow band" valence stabilizers for $Co^{+3}$ include, but are not limited to: monothioperoxydiphosphoramide, N-methylmonothioperoxydiphosphoramide, N-isopropylmonothioperoxydiphosphoramide, N-tert-butylmonothioperoxydiphosphoramide, N-phenylmonothioperoxydiphosphoramide, N-pentafluorophenylmonothioperoxydiphosphoramide, N-benzylmonothioperoxydiphosphoramide, N-cyclohexylmonothioperoxydiphosphoramide, N-norbornylmonothioperoxydiphosphoramide, N,N'''-dimethylmonothioperoxydiphosphoramide, N,N'''-diisopropylmonothioperoxydiphosphoramide, N,N'''-di-tert-butylmonothioperoxydiphosphoramide, N,N'''-diphenylmonothioperoxydiphosphoramide, N,N'''-dipentafluorophenylmonothioperoxydiphosphoramide, N,N'''-dibenzylmonothioperoxydiphosphoramide, N,N'''-dicyclohexylmonothioperoxydiphosphoramide, and N,N'''-dinorbornylmonothioperoxydiphosphoramide.

S—O Valence Stabilizer #10: Examples of monothioperoxydiphosphoric acids, bis(monothioperoxydiphosphoric acids), poly(monothioperoxydiphosphoric acids), and derivatives thereof (S—O Bidentates, S—O Tridentates, S—O Tetradentates) that meet the requirements for use as "narrow band" valence stabilizers for $Co^{+3}$ include, but are not limited to: monothioperoxydiphosphoric acid, methylmonothioperoxydiphosphoric acid, isopropylmonothioperoxydiphosphoric acid, tert-butylmonothioperoxydiphosphoric acid, phenylmonothioperoxydiphosphoric acid, pentafluorophenylmonothioperoxydiphosphoric acid, benzylmonothioperoxydiphosphoric acid, cyclohexylmonothioperoxydiphosphoric acid, norbornylmonothioperoxydiphosphoric acid, dimethylmonothioperoxydiphosphoric acid, diisopropylmonothioperoxydiphosphoric acid, di-tert-butylmonothioperoxydiphosphoric acid, diphenylmonothioperoxydiphosphoric acid, di-pentafluorophenylmonothioperoxydiphosphoric acid, dibenzylmonothioperoxydiphosphoric acid, dicyclohexylmonothioperoxydiphosphoric acid, and dinorbornylmonothioperoxydiphosphoric acid.

S—O Valence Stabilizer #11: Examples of monothioimidodiphosphonic acids, monothiohydrazidodiphosphonic acids, bis(monothioimidodiphosphonic acids), bis(monothiohydrazidodiphosphonic acids), poly(monothioimidodiphosphonic acids), poly(monothiohydrazidodiphosphonic acids), and derivatives thereof (S—O Bidentates, S—O Tridentates, S—O Tetradentates) that meet the requirements for use as "narrow band" valence stabilizers for $Co^{+3}$ include, but are not limited to: monothioimidodiphosphonic acid, methylmonothioimidodiphosphonic acid, isopropylmonothioimidodiphosphonic acid, tert-butylmonothioimidodiphosphonic acid, phenylmonothioimidodiphosphonic acid, pentafluorophenylmonothioimidodiphosphonic acid, benzylmonothioimidodiphosphonic acid, cyclohexylmonothioimidodiphosphonic acid, norbornylmonothioimidodiphosphonic acid, dimethylmonothioimidodiphosphonic acid, diisopropylmonothioimidodiphosphonic acid, di-tert-butylmonothioimidodiphosphonic acid, diphenylmonothioimidodiphosphonic acid, di-pentafluorophenylmonothioiniidodiphosphonic acid, dibenzylmonothioimidodiphosphonic acid, dicyclohexylmonothioimidodiphosphonic acid, and dinorbornylmonothioimidodiphosphonic acid. [Note: The phosphite ($P^{+3}$) valence of the phosphorus atom makes stabilization of high valence metal ions much more difficult, though still possible.]

S—O Valence Stabilizer #12: Examples of monothioimidodiphosphonamides, monothiohydrazidodiphosphonamides, bis(monothioimidodiphosphonamides), bis(monothiohydrazidodiphosphonamides), poly(monothioimidodiphosphonamides), and poly(monothiohydrazidodiphosphonamides) (S—O Bidentates, S—O Tridentates, S—O Tetradentates) that meet the requirements for use as "narrow band" valence stabilizers for $Co^{+3}$ include, but are not limited to: monothioimidodiphosphonamide, N-methylmonothioimidodiphosphonamide, N-isopropylmonothioimidodiphosphonamide, N-tert-butylmonothioimidodiphosphonamide, N-phenylmonothioimidodiphosphonamide, N-pentafluorophenylmonothioimidodiphosphonamide, N-benzylmonothioimidodiphosphonamide, N-cyclohexylmonothioimidodiphosphonamide, N-norbornylmonothioimidodiphosphonamide, N,N'''-dimethylmonothioimidodiphosphonamide, N,N'''-diisopropylmonothioimidodiphosphonamide, N,N'''-di-tert-butylmonothioimidodiphosphonamide, N,N'''-diphenylmonothioimidodiphosphonamide, N,N'''-di-pentafluorophenylmonothioimidodiphosphonamide, N,N'''-dibenzylmonothioimidodiphosphonamide, N,N'''-dicyclohexylmonothioimidodiphosphonamide, and N,N'''-dinorbornylmonothioimidodiphosphonamide. [Note: The phosphite ($P^{+3}$) valence of the phosphorus atom makes stabilization of high valence metal ions much more difficult, though still possible.]

S—O Valence Stabilizer #13: Examples of dithiodiphosphonamides, bis(dithiodiphosphonamides), and poly(dithiodiphosphonamides) (S—O Bidentates, S—O Tridentates, S—O Tetradentates) that meet the requirements for use as "narrow band" valence stabilizers for $Co^{+3}$ include, but are not limited to: dithiodiphosphonamide, N-methyldithiodiphosphonamide, N-isopropyldithiodiphosphonamide, N-tert-butyldithiodiphosphonamide, N-phenyldithiodiphosphonamide, N-pentafluorophenyldithiodiphosphonamide, N-benzyldithiodiphosphonamide, N-cyclohexyldithiodiphosphonamide, N-norbornyldithiodiphosphonamide, N,N'''-dimethyldithiodiphosphonamide, N,N'''-diisopropyldithiodiphosphonamide, N,N'''-di-tert-butyldithiodiphosphonamide, N,N'''-diphenyldithiodiphosphonamide, N,N'''-di-pentafluorophenyldithiodiphosphonamide, N,N'''-dibenzyldithiodiphosphonamide, N,N'''-dicyclohexyldithiodiphosphonamide, and N,N'''-dinorbornyldithiodiphosphonamide. [Note: The phosphite ($P^{+3}$) valence of the phosphorus atom makes stabilization of high valence metal ions much more difficult, though still possible.]

S—O Valence Stabilizer #14: Examples of dithiodiphosphonic acids, bis(dithiodiphosphonic acids), poly(dithiodiphosphonic acids), and derivatives thereof (S—O Bidentates, S—O Tridentates, S—O Tetradentates) that meet the requirements for use as "narrow band" valence stabilizers for $Co^{+3}$ include, but are not limited to: dithiodiphosphonic acid, methyldithiodiphosphonic acid, isopropyldithiodiphosphonic acid, tert-butyldithiodiphosphonic acid, phenyldithiodiphosphonic acid, pentafluorophenyldithiodiphosphonic acid, benzyldithiodiphosphonic acid, cyclohexyldithiodiphosphonic acid, norbornyldithiodiphosphonic acid, dimethyldithiodiphosphonic acid, diisopropyldiothiodiphosphonic acid, di-tert-butyldithiodiphosphonic acid, diphenyldithiodiphosphonic acid, di-pentafluorophenyldithiodiphosphonic acid, dibenzyldithiodiphosphonic acid, dicyclohexyldithiodiphosphonic acid, and dinorbornyldithiodiphosphoric acid. [Note: The phosphite ($P^{+3}$) valence of the phosphorus atom makes stabilization of high valence metal ions much more difficult, though still possible.]

S—O Valence Stabilizer #15: Examples of monothioperoxydiphosphonamides, bis(monothioperoxydiphosphonamides), and poly(monothioperoxydiphosphonamides) (S—O Bidentates, S—O Tridentates, S—O Tetradentates) that meet the requirements for use as "narrow band" valence stabilizers for $Co^{+3}$ include, but are not limited to: monothioperoxydiphosphonamide, N-methylmonothioperoxydiphosphonamide, N-isopropylmonothioperoxydiphosphonamide, N-tert-butylmonothioperoxydiphosphonamide, N-phenylmonothioperoxydiphosphonamide, N-pentafluorophenylmonothioperoxydiphosphonamide, N-benzylmonothioperoxydiphosphonamide, N-cyclohexylmonothioperoxydiphosphonamide, N-norbornylmonothioperoxydiphosphonamide, N,N'''-dimethylmonothioperoxydiphosphonamide, N,N'''-diisopropylmonothioperoxydiphosphonamide, N,N'''-di-tert-butylmonothioperoxydiphosphonamide, N,N'''-diphenylmonothioperoxydiphosphonamide, N,N'''-di-pentafluorophenylmonothioperoxydiphosphonamide, N,N'''-dibenzylmonothioperoxydiphosphonamide, N,N'''-dicyclohexylmonothioperoxydiphosphonamide, and N,N'''-dinorbornylmonothioperoxydiphosphonamide. [Note: The phosphite ($p^{+3}$) valence of the phosphorus atom makes stabilization of high valence metal ions much more difficult, though still possible.]

S—O Valence Stabilizer #16: Examples of monothioperoxydiphosphonic acids, bis(monothioperoxydiphosphonic acids), poly(monothioperoxydiphosphonic acids), and derivatives thereof (S—O Bidentates, S—O Tridentates, S—O Tetradentates) that meet the requirements for use as "narrow band" valence stabilizers for $Co^{+3}$ include, but are not limited to: monothioperoxydiphosphonic acid, methylmonothioperoxydiphosphonic acid, isopropylmonothioperoxydiphosphonic acid, tert-butylmonothioperoxydiphosphonic acid, phenylmonothioperoxydiphosphonic acid, pentafluorophenylmonothioperoxydiphosphonic acid, benzylmonothioperoxydiphosphonic acid, cyclohexylmonothioperoxydiphosphonic acid, norbornylmonothioperoxydiphosphonic acid, dimethylmonothioperoxydiphosphonic acid, diisopropylmonothioperoxydiphosphonic acid, di-tert-butylmonothioperoxydiphosphonic acid, diphenylmonothioperoxydiphosphonic acid, di-pentafluorophenylmonothioperoxydiphosphonic acid, dibenzylmonothioperoxydiphosphonic acid, dicyclohexylmonothioperoxydiphosphonic acid, and dinorbornylmonothioperoxydiphosphonic acid. [Note: The phosphite ($P^{+3}$) valence of the phosphorus atom makes stabilization of high valence metal ions much more difficult, though still possible.]

S—O Valence Stabilizer #17: Examples of monothiophosphoric acids (phosphorothioic acids), bis(monothiophosphoric acids), poly(monothiophosphoric acids), and derivatives thereof (S—O Bidentates, S—O Tridentates, S—O Tetradentates) that meet the requirements for use as "narrow band" valence stabilizers for $Co^{+3}$ include, but are not limited to: monothiophosphoric acid, O-phenylmonothiophosphoric acid, O-benzylmonothiophosphoric acid, O-cyclohexylmonothiophosphoric acid, O-norbornylmonothiophosphoric acid, O,O-diphenylmonothiophosphoricacid, O,O-dibenzylmonothiophosphoric acid, O,O-dicyclohexylmonothiophosphoricacid, and O,O-dinorbornylmonothiophosphoric acid.

S—O Valence Stabilizer #18: Examples of phosphoro (dithioperoxoic) acids, bis[phosphoro(dithioperoxoic) acids], poly[phosphoro(dithioperoxoic) acids], and derivatives thereof (S—O Bidentates, S—O Tridentates, S—O Tetradentates) that meet the requirements for use as "narrow band" valence stabilizers for $Co^{+3}$ include, but are not limited to: phosphoro(dithioperoxoic) acid, O-phenylphosphoro(dithioperoxoic) acid, O-benzylphosphoro(dithioperoxoic) acid, O-cyclohexylphosphoro(dithioperoxoic) acid, O-norbornylphosphoro(dithioperoxoic) acid, O,O-diphenylphosphoro(dithioperoxoic) acid, O,O-dibenzylphosphoro(dithioperoxoic)acid, O,O-dicyclohexylphosphoro (dithioperoxoic) acid, and O,O-dinorbornylphosphoro (dithioperoxoic) acid.

S—O Valence Stabilizer #19: Examples of monothiophosphonic Acids (phosphonothioic acids), bis(monothiophosphonic acids), poly(monothiophosphonic acids), and derivatives thereof (S—O Bidentates, S—O Tridentates, S—O Tetradentates) that meet the requirements for use as "narrow band" valence stabilizers for $Co^{+3}$ include, but are not limited to: monothiophosphonic acid, O-phenylmonothiophosphonic acid, O-benzylmonothiophosphonic acid, O-cyclohexylmonothiophosphonic acid, O-norbornylmonothiophosphonic acid, O,P-diphenylmonothiophosphonic acid, O,P-dibenzylmonothiophosphonic acid, O,P-dicyclohexylmonothiophosphonic acid, and O,P-dinorbornylmonothiophosphonic acid. [Note: The phosphite ($P^{+3}$) valence of the phosphorus atom makes stabilization of high valence metal ions much more difficult, though still possible.]

S—O Valence Stabilizer #20: Examples of phosphono (dithioperoxoic) acids, bis[phosphono(dithioperoxoic) acids], poly[phosphono(dithioperoxoic) acids], and derivatives thereof (S—O Bidentates, S—O Tridentates, S—O Tetradentates) that meet the requirements for use as "narrow band" valence stabilizers for $Co^{+3}$ include, but are not limited to: phosphono(dithioperoxoic) acid, O-phenylphosphono(dithioperoxoic) acid, O-benzylphosphono (dithioperoxoic) acid, O-cyclohexylphosphono(dithioperoxoic) acid, O-norbornylphosphono(dithioperoxoic) acid,O, P-diphenylphosphono(dithioperoxoic) acid, O,P-dibenzylphosphono(dithioperoxoic) acid, O,P-dicyclohexylphosphono(dithioperoxoic) acid, and O,P-dinorbornylphosphono(dithioperoxoic) acid. [Note: The phosphite ($P^{+3}$) valence of the phosphorus atom makes stabilization of high valence metal ions much more difficult, though still possible.]

S—O Valence Stabilizer #21: Examples of beta-hydroxythioketones, beta-hydroxythioaldehydes, bis(beta-hydroxythioketones), bis(beta-hydroxythioaldehydes), poly(beta-hydroxythioketones), and poly(beta-hydroxythioaldehydes) (S—O Bidentates, S—O Tridentates, S—O Tetradentates) that meet the requirements for use as "narrow band" valence stabilizers for $Co^{+3}$ include, but are not limited to: 4-hydroxypentan-2-thione; 1,3-diphenyl-3-hydroxypropanethioaldehyde; 1,3-dibenzyl-3-hydroxypropanethioaldehyde; 1,3-dicyclohexyl-3-hydroxypropanethioaldehyde; 1,3-dinorbornyl-3-hydroxypropanethioaldehyde; 1,3-di(2-thienyl)-3-hydroxypropanethioaldehyde; 1,3-di(2-furyl)-3-hydroxypropanethioaldehyde; o-hydroxythioacetophenone; and beta-hydroxythiobenzophenone.

S—O Valence Stabilizer #22: Examples of beta-mercaptoketones, beta-mercaptoaldehydes, bis(beta-mercaptoketones), bis(beta-mercaptoaldehydes), poly(beta-mercaptoketones), and poly(beta-mercaptoaldehydes) (S—O Bidentates, S—O Tridentates, S—O Tetradentates) that meet the requirements for use as "narrow band" valence stabilizers for $Co^{+3}$ include, but are not limited to: 4-mercaptopentan-2-one; 1,3-diphenyl-3-mercaptopropanal; 1,3-dibenzyl-3-mercaptopropanal; 1,3-dicyclohexyl-3-mercaptopropanal; 1,3-dinorbornyl-3-mercaptopropanal; 1,3-di(2-thienyl)-3-mercaptopropanal; 1,3-di(2-furyl)-3-mercaptopropanal; 3-mercapto-1,5-pentanedialdehyde; o-mercaptoacetophenone; 5-mercapto-1,4-naphthoquinone; 1-mercaptoacridone; 1-mercaptoanthraquinone; 1,8-dimercaptoanthraquinone; and beta-mercaptobenzophenone.

S—O Valence Stabilizer #23: Examples of N-(aminomethylol)thioureas [N-(aminohydroxymethyl)thioureas], bis[N-(aminomethylol)thioureas], and poly[N-(aminomethylol) thioureas] (S—O Bidentates, S—O Tridentates, S—O Tetradentates) that meet the requirements for use as "narrow band" valence stabilizers for $Co^{+3}$ include, but are not limited to: N'-(aminohydroxymethyl)thiourea; N,N"-dimethyl-N'-(aminohydroxymethyl)thiourea; N,N'-diethyl-N'-(aminohydroxymethyl)thiourea; N,N"-isopropyl-N'-(aminohydroxymethyl)thiourea; N,N"-diphenyl-N'-(aminohydroxymethyl)thiourea; N,N"-dibenzyl-N'-(aminohydroxymethyl)thiourea; N,N"-dicyclohexyl-N'-(aminohydroxymethyl)thiourea; and N,N"-dinorbornyl-N'-(aminohydroxymethyl)thiourea.

S—O Valence Stabilizer #24: Examples of N-(aminomethylthiol)ureas [N-(aminomercaptomethyl)ureas], bis[N-(aminomethylthiol)ureas], and poly[N-(aminomethylthiol)ureas] (S—O Bidentates, S—O Tridentates, S—O Tetradentates) that meet the requirements for use as "narrow band" valence stabilizers for $Co^{+3}$ include, but are not limited to: N'-(aminomercaptomethyl)urea; N,N"-dimethyl-N'-(aminomercaptomethyl)urea; N,N'-diethyl-N'-(aminomercaptomethyl)urea; N,N"-isopropyl-N'-(aminomercaptomethyl)urea; N,N"-diphenyl-N'-(aminomercaptomethyl)urea; N,N"-dibenzyl-N'-(aminomercaptomethyl)urea; N,N"-dicyclohexyl-N'-(aminomercaptomethyl)urea; and N,N"-dinorbornyl-N'-(aminomercaptomethyl)urea.

S—O Valence Stabilizer #25: Examples of monothiooxamides, bis(monothiooxamides), and poly(monothiooxamides) (S—O Bidentates, S—O Tridentates, S—O Tetradentates) that meet the requirements for use as "narrow band" valence stabilizers for $Co^{+3}$ include, but are not limited to: monothiooxamide, N-methylthiooxamide; N-ethylthiooxamide; N-isopropylthiooxamide; N-phenylthiooxamide; N-benzylthiooxamide; N-cyclohexylthiooxamide; N-norbornylthiooxamide; N,N'-dimethylthiooxamide; N,N'-diethylthiooxamide; N,N'diisopropylthiooxamide; N,N'-diphenylthiooxamide; N,N'-dibenzylthiooxamide; N,N'-dicyclohexylthiooxamide; and N,N'-dinorbornylthiooxamide.

S—O Valence Stabilizer #26: Examples of beta-mercapto carboxylic acids, bis(beta-mercapto carboxylic acids), poly (beta-mercapto carboxylic acids), and derivatives thereof (S—O Bidentates, S—O Tridentates, S—O Tetradentates) that meet the requirements for use as "narrow band" valence stabilizers for $Co^{+3}$ include, but are not limited to: methyl 3-mercaptopropanoate; methyl 3-mercaptobutanoate; ethyl 3-mercaptobutanoate; phenyl 3-mercaptobutanoate; cyclohexyl 3-mercaptobutanoate; norbornyl 3-mercaptobutanoate; methyl beta-mercaptohydrocinnamate; ethyl beta-mercaptohydrocinnamate; phenyl beta-mercaptohydrocinnamate; methyl o-mercaptobenzoate; ethyl o-mercaptobenzoate; phenyl o-mercaptobenzoate; cyclohexyl o-mercaptobenzoate; (2-benzothiazolylthio)succinic acid (mtbs); norbornyl o-mercaptobenzoate; and 3-[(benzothiazol-2-yl)thio]propionic acid.

S—O Valence Stabilizer #27: Examples of beta-mercapto thiocarboxylic acids, bis(beta-mercapto thiocarboxylic acids), poly(beta-mercapto thiocarboxylic acids), and derivatives thereof (S—O Bidentates, S—O Tridentates, S—O Tetradentates) that meet the requirements for use as "narrow band" valence stabilizers for $Co^{+3}$ include, but are not limited to: methyl 3-mercaptothiobutanoate; ethyl 3-mercaptothiobutanoate; phenyl 3-mercaptothiobutanoate; cyclohexyl 3-mercaptothiobutanoate; norbornyl 3-mercaptothiobutanoate; methyl beta-mercaptothiocinnamate; ethyl beta-mercaptothiocinnamate; phenyl beta-mercaptothiocinnamate; methyl o-mercaptothiobenzoate; ethyl o-mercaptothiobenzoate; phenyl o-mercaptothiobenzoate; cyclohexyl o-mercaptothiobenzoate; norbornyl o-mercaptothiobenzoate; and (alkylthio)oxoethyl alkyl(aryl)disulfides S—O Valence Stabilizer #28: Examples of beta-hydroxy thiocarboxylic acids, bis(beta-hydroxy thiocarboxylic acids), poly(beta-hydroxy thiocarboxylic acids), and derivatives thereof (S—O Bidentates, S—O Tridentates, S—O Tetradentates) that meet the requirements for use as "narrow band" valence stabilizers for $Co^{+3}$ include, but are not limited to: methyl 3-hydroxythiobutanoate; ethyl 3-hydroxythiobutanoate; phenyl 3-hydroxythiobutanoate; cyclohexyl 3-hydroxythiobutanoate; norbornyl 3-hydroxythiobutanoate; methyl beta-hydroxythiocinnamate; ethyl beta-hydroxythiocinnamate; phenyl beta-hydroxythiocinnamate; methyl o-hydroxythiobenzoate; ethyl o-hydroxythiobenzoate; phenyl o-hydroxythiobenzoate; cyclohexyl o-hydroxythiobenzoate; and norbornyl o-hydroxythiobenzoate.

S—O Valence Stabilizer #29: Examples of beta-mercapto carboxamides, bis(beta-mercapto carboxamides), poly(beta-mercapto carboxamides), and derivatives thereof (S—O Bidentates, S—O Tridentates, S—O Tetradentates) that meet the requirements for use as "narrow band" valence stabilizers for $Co^{+3}$ include, but are not limited to: N-methyl 3-mercaptobutanamide; N-ethyl 3-mercaptobutanamide; N-phenyl 3-mercaptobutanamide; N-cyclohexyl 3-mercaptobutanamide; N-norbornyl 3-mercaptobutanamide; N-methyl o-mercaptobenzamide; N-ethyl o-mercaptobenzamide; N-phenyl o-mercaptobenzamide; N-cyclohexyl o-mercaptobenzamide; and N-norbornyl o-mercaptobenzamide.

S—O Valence Stabilizer #30: Examples of S-alkylthiocarboxylic Acids, S-arylthiocarboxylic Acids, and S,S-thiobiscarboxylic Acids (S—O Bidentates and S—O Tridentates) that meet the requirements for use as "narrow band" valence stabilizers for $Co^{+3}$ include, but are not limited to: (methylthio)acetic acid; (methylthio)benzoic acid; (methylthio) nicotinic acid; (methylthio)napthoic acid; (phenylthio)acetic acid; (phenylthio)benzoic acid; (phenylthio)naphthoic acid; (norbornylthio)acetic acid; (norbornylthio)benzoic acid; (norbornylthio)napthoic acid; thiobisacetic acid; thiobisbenzoic acid; and thiobisnapthoic acid.

S—O Valence Stabilizer #31: Examples of S-alkyldisulfidocarboxylic acids, S-aryldisulfidocarboxylic acids, and S,S'-disulfidobiscarboxylic acids (S—O Bidentates and S—O Tridentates) that meet the requirements for use as "narrow band" valence stabilizers for $Co^{+3}$ include, but are not limited to: (methyldisulfido)acetic acid; (methyldisulfido)benzoic acid; (methyldisulfido)nicotinic acid; (methyldisulfido)napthoic acid; (phenyldisulfido)acetic acid; (phenyldisulfido)benzoic acid; (phenyldisulfido)naphthoic acid; (norbornyldisulfido)acetic acid; (norbornyldisulfido)benzoic acid; (norbornyldisulfido)napthoic acid; S,S'-disulfidobisacetic acid; S,S'-disulfidobisbenzoic acid; and S,S'-disulfidobisnapthoic acid.

S—O Valence Stabilizer #32: Examples of monothiomonocarboxylic acids, dithiodicarboxylic acids, bis(monothiomonocarboxylic acids), bis(dithiodicarboxylic acids), poly (monothiomonocarboxylic acids), poly(dithiodicarboxylic acids), and derivatives thereof (S—O Bidentates and S—O Tetradentates) that meet the requirements for use as "narrow band" valence stabilizers for $Co^{+3}$ include, but are not limited to: thioacetic acid; thiopropionic acid; thiobenzoic acid; thiophenylacetic acid; thiocyclohexanoic acid; thiofuroic acid; thionaphthoic acid; phenyl thioacetate; phenyl thiopropionate; phenyl thiobenzoate; phenyl thiocyclohexanoate; phenyl thiofuroate; phenyl thionaphthoate; dithiooxalic acid (dto); monothiooxalic acid (mtox); dithiomalonic acid; dithiosuccinic acid; diphenyl dithiooxalate; diphenyl dithiomalonate; and diphenyl dithiosuccinate.

S—O Valence Stabilizer #33: Examples of monothiocarbonates and bis(monothiocarbonates) (S—O Bidentates and S—O Tetradentates) that meet the requirements for use as "narrow band" valence stabilizers for $Co^{+3}$ include, but are not limited to: S,O-diethyldithiocarbonate; S,O-diisopropyldithiocarbonate; S,O-diphenyldithiocarbonate; S,O-dibenzyldithiocarbonate; S,O-dicyclohexyldithiocarbonate; and S,O-dinorbornyldithiocarbonate.

S—O Valence Stabilizer #34: Examples of monothiocarbazates (monothiocarbazides), bis(monothiocarbazates), and poly(monothiocarbazates) (S—O Bidentates, S—O Tridentates, and S—O Tetradentates; or possibly N—S Bidentates, N—S Tridentates, and N—S Tetradentates) that meet the requirements for use as "narrow band" valence stabilizers for $Co^{+3}$ include, but are not limited to: N,N'-dimethylmonothiocarbazate; N,N'-di(trifluoromethyl)monothiocarbazate; N,N'-diethylmonothiocarbazate; N,N'-diphenylmonothiocarbazate; N,N'-dibenzylmonothiocarbazate; N,N'-di(pentafluorophenyl)monothiocarbazate; N,N'-dicyclohexylmonothiocarbazate; and N,N'-dinorbornylmonothiocarbazate.

S—O Valence Stabilizer #35: Examples of mercapto alcohols and silylmercaptoalcohols, bis(mercapto alcohols and silylmercaptoalcohols), and poly(mercapto alcohols and silylmercaptoalcohols) (S—O Bidentates, S—O Tridentates, S—O Tetradentates) that meet the requirements for use as "narrow band" valence stabilizers for $Co^{+3}$ include, but are not limited to: 2-mercaptoethanol (mel); 3-mercaptopropanol (mpl); 2-mercaptophenol; 2-mercaptocyclohexanol; 3-mercapto-2-norborneol; 2-mercaptopyridine 1-oxide; 1,4-thioxane; thiodialkanols; 2-(trimethoxysilyl)-1-ethanethiol (tmset); 3-(trimethoxysilyl)-1-propanethiol (tmspt); o-hydroxythiophenols; o-(O-hydroxyalkyl(aryl))thiophenols; and o-(S-thioalkyl(aryl))phenols.

S—O Valence Stabilizer #36: Examples of monothiocarbimates, bis(monothiocarbimates), and poly(monothiocarbimates) (S—O Bidentates, S—O Tridentates, and S—O Tetradentates) that meet the requirements for use as "narrow band" valence stabilizers for $Co^{+3}$ include, but are not limited to: methylmonothiocarbimate; trifluoromethylmonothiocarbimate; ethylmonothiocarbimate; propylmonothiocarbimate; isopropylmonothiocarbimate; butylmonothiocarbimate; tertbutylmonothiocarbimate; cyanomonothiocarbimate; cyanamidomonothiocarbimate; azidomonothiocarbimate; phenylmonothiocarbimate; pentafluorophenylmonothiocarbimate; benzylmonothiocarbimate; naphthylmonothiocarbimate; cyclohexylmonothiocarbimate; norbornylmonothiocarbimate; and adamantylmonothiocarbimate. [Note: Carbimates tend to stabilize lower oxidation states in metal ions.]

S—O Valence Stabilizer #37: Examples of alkyl- and arylmonothioborates and bis(monothioborates) (S—O Bidentates and S—O Tetradentates) that meet the requirements for use as "narrow band" valence stabilizers for $Co^{+3}$ include, but are not limited to: O,O'-diethyl monothioborate; O,O'-diisopropyl monothioborate; O,O'-diphenyl monothioborate; O,O'-dibenzyl monothioborate; O,O'-dicyclohexyl monothioborate; and O,O'-dinorbornyl monothioborate.

S—O Valence Stabilizer #38: Examples of alkyl- and arylmonothioboronates and bis(monothioboronates) (S—O Bidentates and S—O Tetradentates) that meet the requirements for use as "narrow band" valence stabilizers for $Co^{+3}$ include, but are not limited to: diethyl monothioboronate; diisopropyl monothioboronate; diphenyl monothioboronate; dibenzyl monothioboronate; dicyclohexyl monothioboronate; and dinorbornyl monothioboronate. [Note: boronates tend to stabilize lower oxidation states in metal ions.]

S—O Valence Stabilizer #39: Examples of monothioarsonic acids (arsonothioic acids), bis(monothioarsonic acids), poly(monothioarsonic acids), and derivatives thereof (S—O Bidentates, S—O Tridentates, S—O Tetradentates) that meet the requirements for use as "narrow band" valence stabilizers for $Co^{+3}$ include, but are not limited to: monothioarsonic acid, O-phenylmonothioarsonic acid, O-benzylmonothioarsonic acid, O-cyclohexylmonothioarsonic acid, O-norbornylmonothioarsonic acid, O,O-diphenylmonothioarsonic acid, O,O-dibenzylmonothioarsonicacid, O,O-dicyclohexylmonothioarsonic acid, and O,O-dinorbornylmonothioarsonicacid.

S—O Valence Stabilizer #40: Examples of heterocyclic rings containing one or two sulfur atoms and having at least one additional oxygen atom binding site not in a ring (S—O Bidentates, S—O Tridentates, S—O Tetradentates, or S—O Hexadentates) that meet the requirements for use as "narrow band" valence stabilizers for $Co^{+3}$ include, but are not limited to: 2-thiopheneethanol (2-(2-thienyl)ethanol); 2-propionylthiophene (1-(2-thienyl)-1-propanone); N,N'-thiobisphthalimide; 1,1'-thiocarbonyldi-2-pyridone; 2-thiopheneacetic acid; 2-thiophenecarboxaldehyde; 2-thiophenecarboxamide; 2-thiophenecarboxylic acid; 2,5-thiophenedicarboxaldehyde; 2,5-thiophenedicarboxylic acid; 2-thiophenemethanol; 2-thiophenone; thiotetronic acid; alkyl(aryl)2-thienyl ketones; dithienyl ketone; 1,3-dithiane-2-carboxylic acid; and 1,3-dithiolane-2-carboxylic acid.

S—O Valence Stabilizer #41: Examples of heterocyclic rings containing one or two oxygen atoms and having at least one additional sulfur atom binding site not in a ring (S—O Bidentates, S—O Tridentates, S—O Tetradentates, or S—O Hexadentates) that meet the requirements for use as "narrow band" valence stabilizers for $Co^{+3}$ include, but are not limited to: 2-furanethanethiol (2-(2-furyl)ethanethiol); 1-(2-furyl)-1-propanethione); 2-furanthioacetic acid; 2-furanthiocarboxaldehyde; 2-furanthiocarboxamide; 2-furanthiocarboxylic acid; 2,5-furandithiocarboxaldehyde; 2,5-furandithiocarboxylic acid; 2-furanmethanethiol; 2-furanthione; furfuryl disulfide; furfuryl mercaptan; furfuryl sulfide; and furfuryl methyl disulfide.

S—O Valence Stabilizer #42: Examples of heterocyclic rings containing one or two sulfur atoms and having at least one additional oxygen atom binding site in a separate ring (S—O Bidentates, S—O Tridentates, S—O Tetradentates, or S—O Hexadentates) that meet the requirements for use as "narrow band" valence stabilizers for $Co^{+3}$ include, but are not limited to: 2-(2-furyl)thiophene; 2,5-(2-furyl)thiophene; 2-(2-furyl)thiopyran; and 2,5-(2-furyl)thiopyran.

S—O Valence Stabilizer #43: Examples of two-, three-, four-, five-, six-, seven-, eight-, nine-, and ten-membered macrocyclics, macrobicyclics, and macropolycyclics (including catapinands, cryptands, cyclidenes, and sepulchrates) wherein all binding sites are composed of sulfur (usually thiol, mercapto, or thiocarbonyl groups) or oxygen (hydroxy, carboxy, or carbonyl groups) and are not contained in component heterocyclic rings (S—O Bidentates, S—O Tridentates, S—O Tetradentates, and S—O Hexadentates) that meet the requirements for use as "narrow band" valence stabilizers for $Co^{+3}$ include, but are not limited to: thiaoxacyclobutane ([4]aneOS); thiaoxacyclopentane ([5]aneOS); thiaoxacyclohexane ([6]aneOS); thiaoxacycloheptane ([7]aneOS); thiaoxacyclooctane ([8]aneOS); thiaoxacyclobutene ([4]eneOS); thiaoxacyclopentene ([5]eneOS); thiaoxacyclohexene ([6]eneOS); thiaoxacycloheptene ([7]eneOS); thiaoxacyclooctene ([8]eneOS); dithiaoxacyclohexane ([6]aneOS$_2$); dithiaoxacycloheptane ([7]aneOS$_2$); dithiaoxacyclooctane ([8]aneOS$_2$); dithiaoxacyclononane ([9]aneOS$_2$); dithiaoxacyclodecane ([10]aneOS$_2$); dithiaoxacycloundecane ([11]aneOS$_2$); dithiaoxacyclododecane ([12]aneOS$_2$); dithiaoxacyclohexene ([6]eneOS$_2$); dithiaoxacycloheptene ([7]eneOS$_2$); dithiaoxacyclooctene ([8]eneOS$_2$); dithiaoxacyclononene ([9]eneOS$_2$); dithiaoxacyclodecene ([10]eneOS$_2$); dithiaoxacycloundecene ([11]

eneOS$_2$); dithiaoxacyclododecene ([12]eneOS$_2$); dithiadioxacyclooctane ([8]aneO$_2$S$_2$); dithiadioxacyclononane ([9]aneO$_2$S$_2$); dithiadioxacyclodecane ([10]aneO$_2$S$_2$); dithiadioxacycloundecane ([11]aneO$_2$S$_2$); dithiadioxacyclododecane ([12]aneO2S$_2$); dithiadioxacyclotridecane ([13]aneO$_2$S$_2$); dithiadioxacyclotetradecane ([14]aneO$_2$S$_2$); dithiadioxacyclopentadecane ([15]aneO$_2$S$_2$); dithiadioxacyclohexadecane ([16]aneO$_2$S$_2$); dithiadioxacycloheptadecane ([17]aneO$_2$S$_2$); dithiadioxacyclooctadecane ([18]aneO$_2$S$_2$); dithiadioxacyclononadecane ([19]aneO$_2$S$_2$); dithiadioxacycloeicosane ([20]aneO$_2$S$_2$); dithiadioxacyclooctadiene ([8]dieneO$_2$S$_2$); dithiadioxacyclononadiene ([9]dieneO$_2$S$_2$); dithiadioxacyclodecadiene ([10]dieneO$_2$S$_2$); dithiadioxacycloundecadiene ([11]dieneO$_2$S$_2$); dithiadioxacyclododecadiene ([12]dieneO$_2$S$_2$); dithiadioxacyclotridecadiene ([13]dieneO$_2$S$_2$); dithiadioxacyclotetradecadiene ([14]dieneO$_2$S$_2$); dithiadioxacyclopentadecadiene ([15]dieneO$_2$S$_2$); dithiadioxacyclohexadecadiene ([16]dieneO$_2$S$_2$); dithiadioxacycloheptadecadiene ([17]dieneO$_2$S$_2$); dithiadioxacyclooctadecadiene ([18]dieneO$_2$S$_2$); dithiadioxacyclononadecadiene ([19]dieneO$_2$S$_2$); and dithiadioxacycloeicosadiene ([20]dieneO$_2$S$_2$).

S—O Valence Stabilizer #44: Examples of four-, five-, six-, seven-, eight-, nine-, or ten-membered macrocyclics, macrobicyclics, and macropolycyclics (including catapinands, cryptands, cyclidenes, and sepulchrates) wherein all binding sites are composed of sulfur or oxygen and are contained in component heterocyclic rings (S—O Tridentates, S—O Tetradentates, or S—O Hexadentates) that meet the requirements for use as "narrow band" valence stabilizers for $Co^{+3}$ include, but are not limited to: difurandithiophenes; difurantrithiophenes; trifurantrithiophenes; and tetrafurantetrathiophenes.

S—O Valence Stabilizer #45: Examples of four-, five-, six-, seven-, eight-, nine-, or ten-membered macrocyclics, macrobicyclics, and macropolycyclics (including catapinands, cryptands, cyclidenes, and sepulchrates) wherein all binding sites are composed of sulfur or oxygen and are contained in a combination of heterocyclic rings and thiol, mercapto, thiocarbonyl, hydroxy, carboxy, and carbonyl groups (S—O Tridentates, S—O Tetradentates, or S—O Hexadentates) that meet the requirements for use as "narrow band" valence stabilizers for $Co^{+3}$ include, but are not limited to: dithiadifurandithiophenes; tetrathiadifurandithiophenes; trithiatrifurantrithiophenes; trithiatrifurantrithiophenes; tetrathiatetrafurantetrathiophenes; and octathiatetrafurantetrathiophenes.

S—O Valence Stabilizer #46: Examples of sulfoxides that meet the requirements for use as "narrow band" valence stabilizers for $Co^{+3}$ include, but are not limited to: dimethylsulfoxide (DMSO); diethylsulfoxide; diphenylsulfoxide; and tetrahydrothiophene oxide.

S—O Valence Stabilizer #47: Examples of sulfones that meet the requirements for use as "narrow band" valence stabilizers for $Co^{+3}$ include, but are not limited to: dimethyl sulfone; diethyl sulfone; and diphenyl sulfone.

S—O Valence Stabilizer #48: Examples of sulfur dioxide ligands that meet the requirements for use as "narrow band" valence stabilizers for $Co^{+3}$ include, but are not limited to: sulfur dioxide (—$SO_2$) ligands. [Note: Sulfur dioxide is a reducing agent, and complexed metal ions therefore tend to prefer lower oxidation states.]

N—P Valence Stabilizer #1: Examples of aminoaryl phosphines and iminoaryl phosphines (N—P Bidentates, N—P Tridentates, and N—P Tetradentates) that meet the requirements for use as "narrow band" valence stabilizers for $Co^{+3}$ include, but are not limited to: tri(2-aminophenyl)phosphine; tri(2-aminophenyl)phosphine oxide; and tri(2-aminophenyl)phosphine sulfide.

N—P Valence Stabilizer #2: Examples of heterocyclic rings containing one, two, three, or four nitrogen atoms and having at least one additional phosphorus atom binding site not in a ring (N—P Bidentates, N—P Tridentates, N—P Tetradentates, or N—P Hexadentates) that meet the requirements for use as "narrow band" valence stabilizers for $Co^{+3}$ include, but are not limited to: tri(2-imidazolyl)phosphine; tri(2-pyrrolyl)phosphine; tri(2-pyridyl)phosphine; tri(2-imidazolyl)phosphine oxide; tri(2-pyrrolyl)phosphine oxide; tri(2-pyridyl)phosphine oxide; tri(2-imidazolyl)phosphine sulfide; tri(2-pyrrolyl)phosphine sulfide; and tri(2-pyridyl)phosphine sulfide.

N—P Valence Stabilizer #3: Examples of heterocyclic rings containing one, two, or three phosphorus atoms and having at least one additional nitrogen atom binding site not in a ring (N—P Bidentates, N—P Tridentates, N—P Tetradentates, or N—P Hexadentates) that meet the requirements for use as "narrow band" valence stabilizers for $Co^{+3}$ include, but are not limited to: 2-aminophosphole; 2,5-diaminophosphole; 2-(aminomethyl)phosphole; 2,5-di(aminomethyl)phosphole; 2-aminophosphorin; 2,6-diaminophosphorin; 2-(aminomethyl)phosphorin; 2,6-di(aminomethyl)phosphorin; triaminocyclotriphosphazenes; and hexaminocyclotriphosphazenes.

N—P Valence Stabilizer #4: Examples of heterocyclic rings containing one, two, three, or four nitrogen atoms and having at least one additional phosphorus atom binding site in a separate ring (N—P Bidentates, N—P Tridentates, N—P Tetradentates) that meet the requirements for use as "narrow band" valence stabilizers for $Co^{+3}$ include, but are not limited to: 2-(2-pyrrolyl)phosphole; 2,5-di(2-pyrrolyl)phosphole; 2-(2-pyridyl)phosphorin; and 2,6-(2-pyridyl)phosphorin.

N—P Valence Stabilizer #5: Examples of two-, three-, four-, five-, six-, seven-, eight-, nine-, and ten-membered macrocyclics, macrobicyclics, and macropolycyclics (including catapinands, cryptands, cyclidenes, and sepulchrates) wherein all binding sites are composed of nitrogen (usually amine or imine groups) or phosphorus and are not contained in component heterocyclic rings (N—P Bidentates, N—P Tridentates, N—P Tetradentates, and N—P Hexadentates) that meet the requirements for use as "narrow band" valence stabilizers for $Co^{+3}$ include, but are not limited to: cyclobiphosphazenes; cyclotriphosphazenes; cyclotetraphosphazenes; cyclopentaphosphazenes; cyclohexaphosphazenes; diphosphatetraazacyclooctatetraenes; diphospha-s-triazines; and phospha-s-triazines.

N—P Valence Stabilizer #6: Examples of four-, five-, six-, seven-, eight-, nine-, or ten-membered macrocyclics, macrobicyclics, and macropolycyclics (including catapinands, cryptands, cyclidenes, and sepulchrates) wherein all binding sites are composed of nitrogen or phosphorus and are contained in component heterocyclic rings (N—P Bidentates, N—P Tridentates, N—P Tetradentates, or N—P Hexadentates) that meet the requirements for use as "narrow band" valence stabilizers for $Co^{+3}$ include, but are not limited to: diphospholedipyrroles; diphosphorindipyridines;

triphospholetripyrroles; triphosphorintripyridines; tetraphospholetetrapyrroles; and tetraphosphorintetrapyridines.

N—P Valence Stabilizer #7: Examples of four-, five-, six-, seven-, eight-, nine-, or ten-membered macrocyclics, macrobicyclics, and macropolycyclics (including catapinands, cryptands, cyclidenes, and sepulchrates) wherein all binding sites are composed of nitrogen or phosphorus and are contained in a combination of heterocyclic rings and amine, imine, and phosphine groups (N—P Bidentates, N—P Tridentates, N—P Tetradentates, or N—P Hexadentates) that meet the requirements for use as "narrow band" valence stabilizers for $Co^{+3}$ include, but are not limited to: azaphosphatetraphyrins; diazadiphosphatetraphyrins; azaphosphahexaphyrins; diazadiphosphahexaphyrins; triazatriphosphahexaphyrins; and apholate.

S—P Valence Stabilizer #1: Examples of thioaryl phosphines (S—P Bidentates, S—P Tridentates, S—P Tetradentates, and S—P Hexadentates) that meet the requirements for use as "narrow band" valence stabilizers for $Co^{+3}$ include, but are not limited to: tri(2-mercaptophenyl)phosphine; tri(2-mercaptophenyl)phosphine oxide; and tri(2-mercaptophenyl)phosphine sulfide.

S—P Valence Stabilizer #2: Examples of heterocyclic rings containing one or two sulfur atoms and having at least one additional phosphorus atom binding site not in a ring (S—P Bidentates, S—P Tridentates, S—P Tetradentates, or S—P Hexadentates) that meet the requirements for use as "narrow band" valence stabilizers for $Co^{+3}$ include, but are not limited to: tri(2-thiophene)phosphine; tri(2-thiopyran)phosphine; tri(2-thiophene)phosphine oxide; tri(2-thiopyran)phosphine oxide; tri(2-thiophene)phosphine sulfide; and tri(2-thiopyran)phosphine sulfide.

S—P Valence Stabilizer #3: Examples of heterocyclic rings containing one, two, or three phosphorus atoms and having at least one additional sulfur atom binding site not in a ring (S—P Bidentates, S—P Tridentates, S—P Tetradentates, or S—P Hexadentates) that meet the requirements for use as "narrow band" valence stabilizers for $Co^{+3}$ include, but are not limited to: 2-mercaptophosphole; 2,5-dimercaptophosphole; 2-(mercaptomethyl)phosphole; 2,5-di(mercaptomethyl)phosphole; 2-mercaptophosphorin; 2,6-dimercaptophosphorin; 2-(mercaptomethyl)phosphorin; and 2,6-di(mercaptomethyl)phosphorin.

S—P Valence Stabilizer #4: Examples of heterocyclic rings containing one or two sulfur atoms and having at least one additional phosphorus atom binding site in a separate ring (S—P Bidentates, S—P Tridentates, S—P Tetradentates) that meet the requirements for use as "narrow band" valence stabilizers for $Co^{+3}$ include, but are not limited to: 2-(2-thienyl)phosphole; 2,5-di(2-thienyl)phosphole; 2-(2-thienyl)phosphorin; and 2,6-(2-thienyl)phosphorin.

S—P Valence Stabilizer #5: Examples of two-, three-, four-, five-, six-, seven-, eight-, nine-, and ten-membered macrocyclics, macrobicyclics, and macropolycyclics (including catapinands, cryptands, cyclidenes, and sepulchrates) wherein all binding sites are composed of sulfur (usually thiol, mercapto, or thiocarbonyl groups) or phosphorus and are not contained in component heterocyclic rings (S—P Bidentates, S—P Tridentates, S—P Tetradentates, and S—P Hexadentates) that meet the requirements for use as "narrow band" valence stabilizers for $Co^{+3}$ include, but are not limited to: phosphathiacyclobutane ([4]anePS); phosphathiacyclopentane ([5]anePS); phosphathiacyclohexane ([6]anePS); phosphathiacycloheptane ([7]anePS); phosphathiacyclooctane ([8]anePS); diphosphathiacyclohexane ([6]ane$SP_2$); diphosphathiacycloheptane ([7]ane$SP_2$); diphosphathiacyclooctane ([8]ane$SP_2$); diphosphathiacyclononane ([9]ane$SP_2$); diphosphathiacyclodecane ([10]ane$SP_2$); diphosphathiacycloundecane ([11]ane$SP_2$); diphosphathiacyclododecane ([12]ane$SP_2$); diphosphadithiacyclooctane ([8]ane$S_2P_2$); diphosphadithiacyclononane ([9]ane$S_2P_2$); diphosphadithiacyclodecane ([11]ane$S_2P_2$); diphosphadithiacycloundecane ([11 ]ane$S_2P_2$); diphosphadithiacyclododecane ([12]ane$S_2P_2$); diphosphadithiacyclotridecane ([13]ane$S_2P_2$); diphosphadithiacyclotetradecane ([14]ane$S_2P_2$); diphosphadithiacyclopentadecane ([15]ane$S_2P_2$); diphosphadithiacyclohexadecane ([16]ane$S_2P_2$); diphosphadithiacycloheptadecane ([17]ane$S_2P_2$); diphosphadithiacyclooctadecane ([18]ane$S_2P_2$); diphosphadithiacyclononadecane ([19]ane$S_2P_2$); diphosphadithiacycloeicosane ([20]ane$S_2P_2$).

S—P Valence Stabilizer #6: Examples of four-, five-, six-, seven-, eight-, nine-, or ten-membered macrocyclics, macrobicyclics, and macropolycyclics (including catapinands, cryptands, cyclidenes, and sepulchrates) wherein all binding sites are composed of sulfur or phosphorus and are contained in component heterocyclic rings (S—P Bidentates, S—P Tridentates, S—P Tetradentates, or S—P Hexadentates) that meet the requirements for use as "narrow band" valence stabilizers for $Co^{+3}$ include, but are not limited to: diphospholedithiophenes; diphosphorindithiopyrans; triphospholetrithiophenes; triphosphorintrithiopyrans; tetraphospholetetrathiophenes; and tetraphosphorintetrathiopyrans.

S—P Valence Stabilizer #7: Examples of four-, five-, six-, seven-, eight-, nine-, or ten-membered macrocyclics, macrobicyclics, and macropolycyclics (including catapinands, cryptands, cyclidenes, and sepulchrates) wherein all binding sites are composed of sulfur or phosphorus and are contained in a combination of heterocyclic rings and thiol, mercapto, thiocarbonyl, and phosphine groups (S—P Bidentates, S—P Tridentates, S—P Tetradentates, or S—P Hexadentates) that meet the requirements for use as "narrow band" valence stabilizers for $Co^{+3}$ include, but are not limited to: thiaphosphatetraphyrins; dithiadiphosphatetraphyrins; thiaphosphahexaphyrins; dithiadiphosphahexaphyrins; and trithiatriphosphahexaphyrins.

P—O Valence Stabilizer #1: Examples of hydroxyaryl phosphines (P—O Bidentates, P—O Tridentates, P—O Tetradentates, and P—O Hexadentates) that meet the requirements for use as "narrow band" valence stabilizers for $Co^{+3}$ include, but are not limited to: tri(2-hydroxyphenyl)phosphine; tri(2-hydroxyphenyl)phosphine oxide; and tri(2-hydroxyphenyl)phosphine sulfide.

P—O Valence Stabilizer #2: Examples of heterocyclic rings containing one or two oxygen atoms and having at least one additional phosphorus atom binding site not in a ring (P—O Bidentates, P—O Tridentates, P—O Tetradentates, or P—O Hexadentates) that meet the requirements for use as "narrow band" valence stabilizers for $Co^{+3}$ include, but are not limited to: tri(2-furan)phosphine; tri(2-pyran)phosphine; tri(2-furan)phosphine oxide; tri(2-pyran)phosphine oxide; tri(2-furan)phosphine sulfide; and tri(2-pyran)phosphine sulfide.

P—O Valence Stabilizer #3: Examples of heterocyclic rings containing one, two, or three phosphorus atoms and having at least one additional oxygen atom binding site not in a ring (P—O Bidentates, P—O Tridentates, P—O Tetradentates, or P—O Hexadentates) that meet the requirements for use as "narrow band" valence stabilizers for $Co^{+3}$ include, but are not limited to: 2-hydroxyphosphole; 2,5-dihydroxyphosphole; 2-(hydroxymethyl)phosphole; 2,5-di(hydroxymethyl) phosphole; 2-hydroxyphosphorin; 2,6-dihydroxyphosphorin; 2-(hydroxymethyl)phosphorin; and 2,6-di (hydroxymethyl)phosphorin.

P—O Valence Stabilizer #4: Examples of heterocyclic rings containing one or two oxygen atoms and having at least one additional phosphorus atom binding site in a separate ring (P—O Bidentates, P—O Tridentates, P—O Tetradentates) that meet the requirements for use as "narrow band" valence stabilizers for $Co^{+3}$ include, but are not limited to: 2-(2-furyl)phosphole; 2,5-di(2-furyl)phosphole; 2-(2-furyl)phosphorin; and 2,6-(2-furyl)phosphorin.

P—O Valence Stabilizer #5: Examples of two-, three-, four-, five-, six-, seven-, eight-, nine-, and ten-membered macrocyclics, macrobicyclics, and macropolycyclics (including catapinands, cryptands, cyclidenes, and sepulchrates) wherein all binding sites are composed of oxygen (usually hydroxy, carboxy, or carbonyl groups) or phosphorus and are not contained in component heterocyclic rings (P—O Bidentates, P—O Tridentates, P—O Tetradentates, and P—O Hexadentates) that meet the requirements for use as "narrow band" valence stabilizers for $Co^{+3}$ include, but are not limited to: phosphaoxacyclobutane ([4]anePO); phosphaoxacyclopentane ([5]anePO); phosphaoxacyclohexane ([6]anePO); phosphaoxacycloheptane ([7]anePO); phosphaoxacyclooctane ([8]anePO); diphosphaoxacyclohexane ([6] $aneOP_2$); diphosphaoxacycloheptane ([7]$aneOP_2$); diphosphaoxacyclooctane ([8]$aneOP_2$); diphosphaoxacyclononane ([9]$aneOP_2$); diphosphaoxacyclodecane ([10]$aneOP_2$); diphosphaoxacycloundecane ([11]$aneOP_2$); diphosphaoxacyclododecane ([12]$aneOP_2$); diphosphadioxacyclooctane ([8]$aneO_2P_2$); diphosphadioxacyclononane ([9]$aneO_2P_2$); diphosphadioxacyclodecane ([10]$aneO_2P_2$); diphosphadioxacycloundecane ([11]$aneO_2P_2$); diphosphadioxacyclododecane ([12]$aneO_2P_2$); diphosphadioxacyclotridecane ([13] $aneO_2P_2$); diphosphadioxacyclotetradecane ([14]$aneO_2P_2$); diphosphadioxacyclopentadecane ([15]$aneO_2P_2$); diphosphadioxacyclohexadecane ([16]$aneO_2P_2$); diphosphadioxacycloheptadecane ([17]$aneO_2P_2$); diphosphadioxacyclooctadecane ([18]$aneO_2P_2$); diphosphadioxacyclononadecane ([19]$aneO_2P_2$); diphosphadioxacycloeicosane ([20] $aneO_2P_2$); and dioxaphospholane.

P—O Valence Stabilizer #6: Examples of four-, five-, six-, seven-, eight-, nine-, or ten-membered macrocyclics, macrobicyclics, and macropolycyclics (including catapinands, cryptands, cyclidenes, and sepulchrates) wherein all binding sites are composed of oxygen or phosphorus and are contained in component heterocyclic rings (P—O Bidentates, P—O Tridentates, P—O Tetradentates, or P—O Hexadentates) that meet the requirements for use as "narrow band" valence stabilizers for $Co^{+3}$ include, but are not limited to: diphospholedifurans; diphosphorindipyrans; triphospholetrifurans; triphosphorintripyrans; tetraphospholetetrafurans; and tetraphosphorintetrapyrans.

P—O Valence Stabilizer #7: Examples of four-, five-, six-, seven-, eight-, nine-, or ten-membered macrocyclics, macrobicyclics, and macropolycyclics (including catapinands, cryptands, cyclidenes, and sepulchrates) wherein all binding sites are composed of oxygen or phosphorus and are contained in a combination of heterocyclic rings and hydroxy, carboxy, carbonyl, and phosphine groups (P—O Bidentates, P—O Tridentates, P—O Tetradentates, or P—O Hexadentates) that meet the requirements for use as "narrow band" valence stabilizers for $Co^{+3}$ include, but are not limited to: oxaphosphatetraphyrins; dioxadiphosphatetraphyrins; oxaphosphahexaphyrins; dioxadiphosphahexaphyrins; and trioxatriphosphahexaphyrins.

As Valence Stabilizer #1: Examples of monoarsines (As Monodentates) that meet the requirements for use as "narrow band" valence stabilizers for $Co^{+3}$ include, but are not limited to: arsine, triphenylarsine, ticyclohexylarsine, methyldiphenylarsine, ethyldiphenylarsine, arsinonorbornane, and arsinoadamantane.

As Valence Stabilizer #2: Examples of diarsines (As Monodentates or As—As Bidentates) that meet the requirements for use as "narrow band" valence stabilizers for $Co^{+3}$ include, but are not limited to: bis(diphenylarsino)methane, bis(diphenylarsino)ethane, bis(diphenylarsino)propane, bis (diphenylarsino)butane, bis(diphenylarsino)pentane, 1,2-diarsinobenzene, cyclohexane-1,2-diarsine, 1,2-bis(phenylbutylarsino)ethane, o-phenylenebis(methylphenylarsine) and o-phenylenebis(dimethylarsine) (diars). (Note: the aryl derivatives are air-stable, whereas the alkyl derivatives are air-sensitive and therefore unsuitable for these applications.)

As Valence Stabilizer #3: Examples of triarsines (As—As Bidentates, or As—As Tridentates) that meet the requirements for use as "narrow band" valence stabilizers for $Co^{+3}$ include, but are not limited to: 1,1,5,9,9-pentaphenyl-1,5,9-triarsanonane, 3-methyl-3-(As,As-dimethyl)arsinomethyl-1,1,5,5-tetraphenyl-1,5-diarsapentane, As,As-[o-(As-dimethyl)arsinodiphenyl]-(As-phenyl)arsine, As,As-[o-(As-diphenyl)arsinodiphenyl]-(As-phenyl)arsine, hexahydro-2,4,6-trimethyl-1,3,5-triarsinazine. (Note: the aryl derivatives are air-stable, whereas the alkyl derivatives are air-sensitive and therefore unsuitable for these applications.)

As Valence Stabilizer #4: Examples of tetraarsines (As—As Bidentates, As—As Tridentates, or As—As Tetradentates) that meet the requirements for use as "narrow band" valence stabilizers for $Co^{+3}$ include, but are not limited to: 3,3-(As-diphenyl)arsinomethyl-1,1,5,5-tetraphenyl-1,5-diarsapentane. (Note: the aryl derivatives are air-stable, whereas the alkyl derivatives are air-sensitive and therefore unsuitable for these applications.)

As Valence Stabilizer #5: Examples of pentaarsines (As—As Bidentates, As—As Tridentates, or As—As Tetradentates) that meet the requirements for use as "narrow band" valence stabilizers for $Co^{+3}$ include, but are not limited to: 4-[2-(As-diphenyl)arsinoethyl]-1,1,7,10,10-pentaphenyl-1,4,7,10-tetraarsadecane. (Note: the aryl derivatives are air-stable, whereas the alkyl derivatives are air-sensitive and therefore unsuitable for these applications.)

As Valence Stabilizer #6: Examples of hexaarsines (As—As Bidentates, As—As Tridentates, As—As Tetradentates, or As—As Hexadentates) that meet the requirements for use as "narrow band" valence stabilizers for $Co^{+3}$ include, but are not limited to: o-phenylenebis[di-3-(As-diphenyl)arsinopropylarsine]. (Note: the aryl derivatives are air-stable, whereas the alkyl derivatives are air-sensitive and therefore unsuitable for these applications.)

As Valence Stabilizer #7: Examples of 5-membered heterocyclic rings containing one arsenic atom (As Monodentates) that meet the requirements for use as "narrow band" valence stabilizers for $Co^{+3}$ include, but are not limited to: arsole, azarsole, diazarsole, benzarsole, benzazarsole, dibenzarsole, naphtharsole, naphthazarsole.

As Valence Stabilizer #8: Examples of 6-membered heterocyclic rings containing one arsenic atom (As Monodentates) that meet the requirements for use as "narrow band" valence stabilizers for $Co^{+3}$ include, but are not limited to: arsenin, azarsenin, diazarsenin, benzarsenin, benzazarsenin, dibenzarsenin, naphtharsenin, and naphthazarsenin.

As Valence Stabilizer #9: Examples of 5-membered heterocyclic rings containing one arsenic atom and having at least one additional arsenic atom binding site not contained in a ring (As Monodentates, As—As Bidentates, As—As Tridentates, As—As Tetradentates, or As—As Hexadentates) that meet the requirements for use as "narrow band" valence stabilizers for $Co^{+3}$ include, but are not limited to: 2-(As-phenylarsino)arsole; 2,5-(As-phenylarsino)arsole; 2-(As-phenylarsino)benzarsole; 7-(As-phenylarsino)benzarsole; and 1,8-(As-phenylarsino)dibenzarsole.

As Valence Stabilizer #10: Examples of 6-membered heterocyclic rings containing one arsenic atom and having at least one additional arsenic atom binding site not contained in a ring (As Monodentates, As—As Bidentates, As—As Tridentates, As—As Tetradentates, or As—As Hexadentates) that meet the requirements for use as "narrow band" valence stabilizers for $Co^{+3}$ include, but are not limited to: 2-(As-phenylarsino)arsenin; 2,5-(As-phenylarsino)arsenin; 2-(As-phenylarsino)benzarsenin; 7-(As-phenylarsino)benzarsenin; and 1,9-(As-phenylarsino)dibenzarsenin.

As Valence Stabilizer #11: Examples of 5-membered heterocyclic rings containing one arsenic atom and having at least one additional arsenic atom binding site contained in a ring (As Monodentates, As—As Bidentates, As—As Tridentates, As—As Tetradentates) that meet the requirements for use as "narrow band" valence stabilizers for $Co^{+3}$ include, but are not limited to: 2,2'-biarsole; 2,2',2"-triarsole; and 2,2'-bibenzarsole.

As Valence Stabilizer #12: Examples of 6-membered heterocyclic rings containing one arsenic atom and having at least one additional arsenic atom binding site contained in a ring (As Monodentates, As—As Bidentates, As—As Tridentates, As—As Tetradentates) that meet the requirements for use as "narrow band" valence stabilizers for $Co^{+3}$ include, but are not limited to: 2,2'-biarsenin; 2,2',2"-triarsenin; 2,2',2',2'"-tetraarsenin; 2,2'-bibenzarsenin; and 8,8'-bibenzarsenin.

As Valence Stabilizer #13a: Examples of two-membered macrocyclics, macrobicyclics, and macropolycyclics (including catapinands, cryptands, cyclidenes, and sepulchrates) wherein both binding sites are composed of arsenic and are not contained in component heterocyclic rings (As—As Bidentates) that meet the requirements for use as "narrow band" valence stabilizers for $Co^{+3}$ include, but are not limited to: As,As-diphenyldiarsacyclobutane ([4]aneAs$_2$); As,As-diphenyldiarsacyclopentane ([5]aneAs$_2$); As,As-diphenyldiarsacyclohexane ([6]aneAs$_2$); As,As-diphenyldiarsacycloheptane ([7]aneAs$_2$); As,As-diphenyldiarsacyclooctane ([8]aneAs$_2$); As,As-diphenyldiarsacyclobutene ([4]eneAs$_2$); As,As-diphenyldiarsacyclopentene ([S]eneAs$_2$); As,As-diphenyldiarsacyclohexene ([6]eneAs$_2$); As,As-diphenyldiarsacycloheptene ([7]eneAs$_2$); and As,As-diphenyldiarsacyclooctene ([8]eneAs$_2$).

As Valence Stabilizer #13b: Examples of three-membered macrocyclics, macrobicyclics, and macropolycyclics (including catapinands, cryptands, cyclidenes, and sepulchrates) wherein all binding sites are composed of arsenic and are not contained in component heterocyclic rings (As—As Tridentates) that meet the requirements for use as "narrow band" valence stabilizers for $Co^{+3}$ include, but are not limited to: As,As,As-triphenyltriarsacyclohexane ([6]aneAs$_3$); As,As,As-triphenyltriarsacycloheptane ([7]aneAs$_3$); As,As,As-triphenyltriarsacyclooctane ([8]aneAs$_3$); As,As,As-triphenyltriarsacyclononane ([9]aneAs$_3$); As,As,As-triphenyltriarsacyclodecane ([10]aneAs$_3$); As,As,As-triphenyltriarsacycloundecane ([11]aneAs$_3$); As,As,As-triphenyltriarsacyclododecane ([12]aneAs$_3$); As,As,As-triphenyltriarsacyclohexatriene ([6]trieneAs$_3$); As,As,As-triphenyltriarsacycloheptatriene ([7]trieneAs$_3$); As,As,As-triphenyltriarsacyclooctatriene ([8]trieneAs$_3$); As,As,As-triphenyltriarsacyclononatriene ([9]trieneAs$_3$); As,As,As-triphenyltriarsacyclodecatriene ([10]trieneAs$_3$); As,As,As-triphenyltriarsacycloundecatriene ([11]trieneAs$_3$); and As,As,As-triphenyltriarsacyclododecatriene ([12]trieneAs$_3$).

As Valence Stabilizer #13c: Examples of four-membered macrocyclics, macrobicyclics, and macropolycyclics (including catapinands, cryptands, cyclidenes, and sepulchrates) wherein all binding sites are composed of arsenic and are not contained in component heterocyclic rings (As—As Tetradentates) that meet the requirements for use as "narrow band" valence stabilizers for $Co^{+3}$ include, but are not limited to: As,As,As,As-tetraphenyltetraarsacyclooctane ([8]aneAs$_4$); As,As,As,As-tetraphenyltetraarsacyclononane ([9]aneAs$_4$); As,As,As,As-tetraphenyltetraarsacyclodecane ([10]aneAs$_4$); As,As,As,As-tetraphenyltetraarsacycloundecane ([11]aneAs$_4$); As,As,As,As-tetraphenyltetraarsacyclododecane ([12]aneAs$_4$); As,As,As,As-tetraphenyltetraarsacyclotridecane ([13]aneAs$_4$); As,As,As,As-tetraphenyltetraarsacyclotetradecane ([14]aneAs$_4$); As,As,As,As-tetraphenyltetraarsacyclopentadecane ([15]aneAs$_4$); As,As,As,As-tetraphenyltetraarsacyclohexadecane ([16]aneAs$_4$); As,As,As,As,As-tetraphenyltetraarsacycloheptadecane ([17]aneAs$_4$); As,As,As,As-tetraphenyltetraarsacyclooctadecane ([18]aneAs$_4$); As,As,As,As-tetraphenyltetraarsacyclononadecane ([19]aneAs$_4$); and As,As,As,As-tetraphenyltetraarsacycloeicosane ([20]aneAs$_4$).

As Valence Stabilizer #13d: Examples of six-membered macrocyclics, macrobicyclics, and macropolycyclics (including catapinands, cryptands, cyclidenes, and sepulchrates) wherein all binding sites are composed of arsenic and are not contained in component heterocyclic rings (As—As Tridentates, As—As Tetradentates, or As—As Hexadentates) that meet the requirements for use as "narrow band" valence stabilizers for $Co^{+3}$ include, but are not limited to: As,As,As,As,As,As-hexaphenylhexaarsacyclododecane ([12]aneAs$_6$); As—As,As,As,As,As-hexaphenylhexaarsacyclotridecane ([13]aneAs$_6$); As,As,As,As,As,As-hexaphenylhexaarsacyclotetradecane ([14]aneAs$_6$); As,As,As,As,As,As-hexaphenylhexaarsacyclopentadecane ([15]aneAs$_6$); As,As,As,As,As,As-hexaphenylhexaarsacyclohexadecane ([16]aneAs$_6$); As,As,As,As,As,As-hexaphenylhexaarsacycloheptadecane ([17]aneAs$_6$); As,As,As,As,As,As-hexaphenylhexaarsacyclooctadecane ([18]aneAs$_6$); As,As,As,As,As,As-hexaphenylhexaarsacyclononadecane ([19]aneAs$_6$); As,As,As,As,As,As-hexaphenylhexaarsacycloeicosane ([20]aneAs$_6$); As,As,As,As,As,As-hexaphenylhexaarsacycloheneicosane ([21]aneAs$_6$); As,As,As,As,As,As-hexaphenylhexaarsacyclodocosane ([22]aneAs$_6$); As,As,As,As,As,As,As-hexaphenylhexaarsacyclotricosane ([23]aneAs$_6$); and As,As,As,As,As,As-hexaphenylhexaarsacyclotetracosane ([24]aneAs$_6$).

As Valence Stabilizer #14a: Examples of four-membered macrocyclics, macrobicyclics, and macropolycyclics (including catapinands, cryptands, cyclidenes, and sepulchrates) wherein all four binding sites are composed of arsenic and are contained in component 5-membered heterocyclic rings (As—As Tetradentates) that meet the requirements for use as "narrow band" valence stabilizers for $Co^{+3}$ include, but are not limited to: tetraarsoles.

As Valence Stabilizer #14b: Examples of six-membered macrocyclics, macrobicyclics, and macropolycyclics (including catapinands, cryptands, cyclidenes, and sepulchrates) wherein all six binding sites are composed of arsenic and are contained in component 5-membered heterocyclic rings (As—As Tetradentates and As—As Hexadentates) that meet the requirements for use as "narrow band" valence stabilizers for $Co^{+3}$ include, but are not limited to: hexaarsoles.

As Valence Stabilizer #15a: Examples of four-membered macrocyclics, macrobicyclics, and macropolycyclics (including catapinands, cryptands, cyclidenes, and sepulchrates) wherein all four binding sites are composed of arsenic and are contained in a combination of 5-membered heterocyclic rings and arsine groups (As—As Tridentates, As—As Tetradentates) that meet the requirements for use as "narrow band" valence stabilizers for $Co^{+3}$ include, but are not limited to: diarsatetraarsoles; and tetraarsatetraarsoles.

As Valence Stabilizer #15b: Examples of six-membered macrocyclics, macrobicyclics, and macropolycyclics (including catapinands, cryptands, cyclidenes, and sepulchrates) wherein all six binding sites are composed of arsenic and are contained in a combination of 5-membered heterocyclic rings and phosphine groups (As—As Tridentates, As—As Tetradentates, and As—As Hexadentates) that meet the requirements for use as "narrow band" valence stabilizers for $Co^{+3}$ include, but are not limited to: diarsahexaarsoles; and triarsahexaarsoles.

As Valence Stabilizer #16a: Examples of four-membered macrocyclics, macrobicyclics, and macropolycyclics (including catapinands, cryptands, cyclidenes, and sepulchrates) wherein all four binding sites are composed of arsenic and are contained in component 6-membered heterocyclic rings (As—As Tetradentates) that meet the requirements for use as "narrow band" valence stabilizers for $Co^{+3}$ include, but are not limited to: cyclotetraarsenins.

As Valence Stabilizer #16b: Examples of six-membered macrocyclics, macrobicyclics, and macropolycyclics (including catapinands, cryptands, cyclidenes, and sepulchrates) wherein all six binding sites are composed of arsenic and are contained in component 6-membered heterocyclic rings (As—As Tridentates, As—As Tetradentates, and As—As Hexadentates) that meet the requirements for use as "narrow band" valence stabilizers for $Co^{+3}$ include, but are not limited to: cyclohexaarsenins.

As Valence Stabilizer #17a: Examples of four-membered macrocyclics, macrobicyclics, and macropolycyclics (including catapinands, cryptands, cyclidenes, and sepulchrates) wherein all four binding sites are composed of arsenic and are contained in a combination of 6-membered heterocyclic rings and arsine groups (As—As Tridentates, As—As Tetradentates, or As—As Hexadentates) that meet the requirements for use as "narrow band" valence stabilizers for $Co^{+3}$ include, but are not limited to: diarsacyclotetraarsenins; and tetraarsacyclotetraarsenins.

As Valence Stabilizer #17b: Examples of six-membered macrocyclics, macrobicyclics, and macropolycyclics (including catapinands, cryptands, cyclidenes, and sepulchrates) wherein all six binding sites are composed of arsenic and are contained in a combination of 6-membered heterocyclic rings and arsine groups (As—As Tridentates, As—As Tetradentates, or As—As Hexadentates) that meet the requirements for use as "narrow band" valence stabilizers for $Co^{+3}$ include, but are not limited to: diarsacyclohexaarsenins; and triarsacyclohexaarsenins.

Se Valence Stabilizer #1: Examples of monoselenoethers (Se Monodentates) that meet the requirements for use as "narrow band" valence stabilizers for $Co^{+3}$ include, but are not limited to: hydrogen selenide, dimethyl selenide, diethyl selenide, dioctyl selenide, diphenyl selenide, dicyclohexyl selenide, tetramethylene selenide, trimethylene selenide, dimethylene selenide, and selenobicycloheptane.

Se Valence Stabilizer #2: Examples of diselenoethers (Se Bidentates) that meet the requirements for use as "narrow band" valence stabilizers for $Co^{+3}$ include, but are not limited to: 2,5-dimethyl-3,6-diselenaoctane; 2,5-diselenahexane; 2,6-diselenaheptane; 3,7-diselenanonane; 3,6-diselenaoctane; 3-butenyl butyl selenoether (bbs); 4-pentenyl butyl selenoether (pbs); 3-butenyl phenyl selenoether (bps); and 4-pentenyl phenyl selenoether (pps).

Se Valence Stabilizer #3: Examples of triselenoethers (Se Bidentates or Se Tridentates) that meet the requirements for use as "narrow band" valence stabilizers for $Co^{+3}$ include, but are not limited to: 1,3,5-triselenane; 2,5,8-triselenanonane; 3,6,9-triselenaundecane; and 2,6,10-triselenaundecane.

Se Valence Stabilizer #4: Examples of tetraselenoethers (Se Bidentates, Se Tridentates, or Se Tetradentates) that meet the requirements for use as "narrow band" valence stabilizers for $Co^{+3}$ include, but are not limited to: 2,6,10,14-tetraselenapentadecane and 2,5,8,11-tetraselenadodecane.

Se Valence Stabilizer #5a: Examples of 5-membered heterocyclic rings containing one selenium atom (Se Monodentates) that meet the requirements for use as "narrow band" valence stabilizers for $Co^{+3}$ include, but are not limited to: dihydroselenophene, selenophene, selenazole, selenapyrroline, selenaphospholene, selenaphosphole, oxaselenole, selenadiazole, selenatriazole, benzodihydroselenophene, benzoselenophene, benzoselenazole, benzoselenaphosphole, dibenzoselenophene, and naphthoselenophene.

Se Valence Stabilizer #5b: Examples of 5-membered heterocyclic rings containing two selenium atoms (Se Monodentates or Se Bidentates) that meet the requirements for use as "narrow band" valence stabilizers for $Co^{+3}$ include, but are not limited to: diselenole, benzodiselenole, and naphthodiselenole.

Se Valence Stabilizer #6a: Examples of 6-membered heterocyclic rings containing one selenium atom (Se Monodentates) that meet the requirements for use as "narrow band" valence stabilizers for $Co^{+3}$ include, but are not limited to: dihydroselenopyran, selenopyran, selenazine, selenadiazine, selenaphosphorin, selenadiphosphorin, oxaselenin, benzoselenopyran, dibenzoselenopyran, and naphthoselenopyran.

Se Valence Stabilizer #6b: Examples of 6-membered heterocyclic rings containing two selenium atoms (Se Monodentates or Se Bidentates) that meet the requirements for use as "narrow band" valence stabilizers for $Co^{+3}$ include, but are not limited to: dihydrodiselenin, diselenin, benzodiselenin, dibenzodiselenin, and naphthodiselenin.

Se Valence Stabilizer #7: Examples of 5-membered heterocyclic rings containing one selenium atom and having at least one additional selenium atom binding site not contained in a ring (Se Monodentates, Se—Se Bidentates, Se—Se Tridentates, Se—Se Tetradentates, or Se—Se Hexadentates) that meet the requirements for use as "narrow band" valence stabilizers for $Co^{+3}$ include, but are not limited to: 2,5-diseleno-2,5-dihydroselenophene; 2,5-bis(selenomethyl)-2,5-dihydroselenophene; 2,5-bis(2-selenophenyl)-2,5-dihydroselenophene; 2,5-diseleno(selenophene); 2,5-bis(selenomethyl)selenophene; 2,5-bis(2-selenophenyl) selenophene; 2,5-diseleno(selenazole); 2,5-bis(selenomethyl)selenazole; 2,5-bis(2-selenophenyl)selenazole; and 2,5-diseleno-1,3,4-selenadiazole [bismuthselenol].

Se Valence Stabilizer #8: Examples of 6-membered heterocyclic rings containing one selenium atom and having at least one additional selenium atom binding site not contained in a ring (Se Monodentates, Se—Se Bidentates, Se—Se Tridentates, Se—Se Tetradentates, or Se—Se Hexadentates) that meet the requirements for use as "narrow band" valence stabilizers for $Co^{+3}$ include, but are not limited to: 2,6-diseleno-2,5-dihydroselenopyran; 2,6-bis(selenomethyl)-2,5-dihydroselenopyran; 2,6-bis(2-selenophenyl)-2,5-dihydroselenopyran; 2,6-diseleno(selenopyran); 2,6-bis(selenomethyl)selenopyran; 2,6-bis(2-selenophenyl) selenopyran; 2,6-diseleno(selenazine); 2,6-bis(selenomethyl)selenazine; 2,6-bis(2-selenophenyl)selenazine; 2,6-diseleno-1,3,5-selenadiazine; 2-seleno-1-benzoselenopyran; 8-seleno-1-benzoselenopyran; and 1,9-diselenodibenzoselenopyran.

Se Valence Stabilizer #9: Examples of 5-membered heterocyclic rings containing one selenium atom and having at least one additional selenium atom binding site contained in a ring (Se Monodentates, Se—Se Bidentates, Se—Se Tridentates, Se—Se Tetradentates) that meet the requirements for use as "narrow band" valence stabilizers for $Co^{+3}$ include, but are not limited to: 2,2'-bi-2,5-dihydroselenophene; 2,2',2"-tri-2,5-dihydroselenophene; 2,2'-biselenophene; 2,2',2"-triselenophene; 2,2'-biselenazole; 5,5'-biselenazole; 2,2'-bi-1,3,4-selenadiazole; 2,2'-biselenanaphthene; 2,2'-bibenzoselenazole; and 1,1'-bis (dibenzoselenophene).

Se Valence Stabilizer #10: Examples of 6-membered heterocyclic rings containing one selenium atom and having at least one additional selenium atom binding site contained in a ring (Se Monodentates, Se—Se Bidentates, Se—Se Tridentates, Se—Se Tetradentates) that meet the requirements for use as "narrow band" valence stabilizers for $Co^{+3}$ include, but are not limited to: 2,2'-bi-2,5-dihydroselenopyran; 2,2',2"-tri-2,5-dihydroselenopyran; 2,2'-biselenopyran; 2,2',2"-triselenopyran; 2,2'-bi-1,4-selenazine; 2,2'-bi-1,3,5-selenadiazine; 2,2'-bi-1-benzoselenopyran; and 1,1'-bis (dibenzoselenopyran).

Se Valence Stabilizer #11a: Examples of two-membered macrocyclics, macrobicyclics, and macropolycyclics (including catapinands, cryptands, cyclidenes, and sepulchrates) wherein both binding sites are composed of selenium (usually selenol or selenoether groups) and are not contained in component heterocyclic rings (Se—Se Bidentates) that meet the requirements for use as "narrow band" valence stabilizers for $Co^{+3}$ include, but are not limited to: diselenacyclobutane ([4]ane$Se_2$); diselenacyclopentane ([5]ane$Se_2$); diselenacyclohexane ([6]ane$Se_2$); diselenacycloheptane ([7]ane$Se_2$); diselenacyclooctane ([8]ane$Se_2$); diselenacyclobutene ([4]ene$Se_2$); diselenacyclopentene ([5]ene$Se_2$); diselenacyclohexene ([6]ene$Se_2$); diselenacycloheptene ([7]ene$Se_2$); diselenacyclooctene ([8]ene$Se_2$); diselenacyclobutadiene ([4]diene$Se_2$); diselenacyclopentadiene ([5]diene$Se_2$); diselenacyclohexadiene ([6]diene$Se_2$); diselenacycloheptadiene ([7]diene$Se_2$); and diselenacyclooctadiene ([8]diene$Se_2$).

Se Valence Stabilizer #11b: Examples of three-membered macrocyclics, macrobicyclics, and macropolycyclics (including catapinands, cryptands, cyclidenes, and sepulchrates) wherein all binding sites are composed of selenium (usually selenol or selenoether groups) and are not contained in component heterocyclic rings (Se—Se Tridentates) that meet the requirements for use as "narrow band" valence stabilizers for $Co^{+3}$ include, but are not limited to: triselenacyclohexane ([6]ane$Se_3$); triselenacycloheptane ([7]ane$Se_3$); triselenacyclooctane ([8]ane$Se_3$); triselenacyclononane ([9]ane$Se_3$); triselenacyclodecane ([10]ane$Se_3$); triselenacycloundecane ([11]ane$Se_3$); triselenacyclododecane ([12]ane$Se_3$); triselenacyclohexene ([6]ene$Se_3$); triselenacycloheptene ([7]ene$Se_3$); triselenacyclooctene ([8]ene$Se_3$); triselenacyclononene ([9]ene$Se_3$); triselenacyclodecene ([10]ene$Se_3$); triselenacycloundecene ([11]ene$Se_3$); triselenacyclododecene ([12]ene$Se_3$); triselenacyclohexatriene ([6]triene$Se_3$); triselenacycloheptatriene ([7]triene$Se_3$); triselenacyclooctatriene ([8]triene$Se_3$); triselenacyclononatriene ([9]triene$Se_3$); triselenacyclodecatriene ([10]triene$Se_3$); triselenacycloundecatriene ([11]triene$Se_3$); and triselenacyclododecatriene ([12]triene$Se_3$).

Se Valence Stabilizer #11c: Examples of four-membered macrocyclics, macrobicyclics, and macropolycyclics (including catapinands, cryptands, cyclidenes, and sepulchrates) wherein all binding sites are composed of selenium (usually selenol or selenoether groups) and are not contained in component heterocyclic rings (Se—Se Tetradentates) that meet the requirements for use as "narrow band" valence stabilizers for $Co^{+3}$ include, but are not limited to: tetraselenacyclooctane ([8]ane$Se_4$); tetraselenacyclononane ([9]ane$Se_4$); tetraselenacyclodecane ([10]ane$Se_4$); tetraselenacycloundecane ([11]ane$Se_4$); tetraselenacyclododecane ([12]ane$Se_4$); tetraselenacyclotridecane ([13]ane$Se_4$); tetraselenacyclotetradecane ([14]ane$Se_4$); tetraselenacyclopentadecane ([15]ane$Se_4$); tetraselenacyclohexadecane ([16]ane$Se_4$); tetraselenacycloheptadecane ([17]ane$Se_4$); tetraselenacyclooctadecane ([18]ane$Se_4$); tetraselenacyclononadecane ([19]ane$Se_4$); tetraselenacycloeicosane ([20]ane$Se_4$); tetraselenacyclooctadiene ([8]diene$Se_4$); tetraselenacyclononadiene ([9]diene$Se_4$); tetraselenacyclodecadiene ([10]diene$Se_4$); tetraselenacycloundecadiene ([11]diene$Se_4$); tetraselenacyclododecadiene ([12]diene$Se_4$); tetraselenacyclotridecadiene ([13]diene$Se_4$); tetraselenacyclotetradecadiene ([14]diene$Se_4$); tetraselenacyclopentadecadiene ([15]diene$Se_4$); tetraselenacyclohexadecadiene ([16]diene$Se_4$); tetraselenacycloheptadecadiene ([17]diene$Se_4$); tetraselenacyclooctadecadiene ([18]diene$Se_4$); tetraselenacyclononadecadiene ([19]diene$Se_4$); tetraselenacycloeicosadiene ([20]diene$Se_4$); tetraselenacyclooctatetradiene ([8]tetradiene$Se_4$); tetraselenacyclononatetradiene ([9]tetradiene$Se_4$); tetraselenacyclodecatetradiene ([10]tetradiene$Se_4$); and tetraselenacycloundecatetradiene ([11]tetradiene$Se_4$).

Se Valence Stabilizer #11d: Examples of six-membered macrocyclics, macrobicyclics, and macropolycyclics (including catapinands, cryptands, cyclidenes, and sepulchrates) wherein all binding sites are composed of selenium (usually selenol or selenoether groups) and are not contained in component heterocyclic rings (Se—Se Tridentates, Se—Se Tetradentates, or Se—Se Hexadentates) that meet the requirements for use as "narrow band" valence stabilizers for $Co^{+3}$ include, but are not limited to: hexaselenacyclododecane ([12]ane$Se_6$); hexaselenacyclotridecane ([13]ane$Se_6$); hexaselenacyclotetradecane ([14]ane$Se_6$); hexaselenacyclopentadecane ([15]ane$Se_6$); hexaselenacyclohexadecane ([16]ane$Se_6$); hexaselenacycloheptadecane ([17]ane$Se_6$); hexaselenacyclooctadecane ([18]ane$Se_6$); hexaselenacyclononadecane ([19]ane$Se_6$); hexaselenacycloeicosane ([20]ane$Se_6$); hexaselenacycloheneicosane ([21]ane$Se_6$); hexaselenacyclodocosane ([22]ane$Se_6$); hexaselenacyclotricosane ([23]ane$Se_6$); hexaselenacyclotetracosane ([24]ane$Se_6$); hexaselenacyclododecatriene ([12]trien$Se_6$); hexaselenacyclotridecatriene ([13]trien$Se_6$); hexaselenacyclotetradecatriene ([14]trien$Se_6$); hexaselenacyclopentadecatriene ([15]trien$Se_6$); hexaselenacyclohexadecatriene ([16]trien$Se_6$); hexaselenacycloheptadecatriene ([17]trien$Se_6$); and hexaselenacyclooctadecatriene ([18]trien$Se_6$).

Se Valence Stabilizer #12a: Examples of four-membered macrocyclics, macrobicyclics, and macropolycyclics (including catapinands, cryptands, cyclidenes, and sepulchrates) wherein all four binding sites are composed of selenium and are contained in component 5-membered heterocyclic rings (Se—Se Tetradentates) that meet the requirements for use as "narrow band" valence stabilizers for $Co^{+3}$ include, but are not limited to: tetraselenophenes; tetraselenaphospholes; tetraoxaselenoles; and tetradiselenoles.

Se Valence Stabilizer #12b: Examples of six-membered macrocyclics, macrobicyclics, and macropolycyclics (including catapinands, cryptands, cyclidenes, and sepulchrates) wherein all six binding sites are composed of selenium and are contained in component 5-membered heterocyclic rings (Se—Se Tridentates or Se—Se Tetradentates) that meet the requirements for use as "narrow band" valence stabilizers for $Co^{+3}$ include, but are not limited to: hexaselenophenes; hexaselenaphospholes; hexaoxaselenoles; and hexadiselenoles.

Se Valence Stabilizer #13a: Examples of four-membered macrocyclics, macrobicyclics, and macropolycyclics (including catapinands, cryptands, cyclidenes, and sepulchrates) wherein all four binding sites are composed of selenium and are contained in a combination of 5-membered heterocyclic rings and selenol and selenoether groups (Se—Se Tetradentates) that meet the requirements for use as "narrow band" valence stabilizers for $Co^{+3}$ include, but are not limited to: diselenatetraselenophenes; tetraselenatetraselenophenes; diselenatetradiselenoles; and tetraselenatetradiselenoles.

Se Valence Stabilizer #13b: Examples of six-membered macrocyclics, macrobicyclics, and macropolycyclics (including catapinands, cryptands, cyclidenes, and sepulchrates) wherein all six binding sites are composed of selenium and are contained in a combination of 5-membered heterocyclic rings and selenol or selenoether groups (Se—Se Tridentates or Se—Se Hexadentates) that meet the requirements for use as "narrow band" valence stabilizers for $Co^{+3}$ include, but are not limited to: diselenahexaselenophenes; and triselenahexaselenophenes.

Se Valence Stabilizer #14a: Examples of four-membered macrocyclics, macrobicyclics, and macropolycyclics (including catapinands, cryptands, cyclidenes, and sepulchrates) wherein all four binding sites are composed of selenium and are contained in component 6-membered heterocyclic rings (Se—Se Tetradentates) that meet the requirements for use as "narrow band" valence stabilizers for $Co^{+3}$ include, but are not limited to: tetraselenopyrans; tetraselenaphosphorins; tetraselenadiphosphorins; tetraoxaselenins; and tetradiselenins.

Se Valence Stabilizer #14b: Examples of six-membered macrocyclics, macrobicyclics, and macropolycyclics (including catapinands, cryptands, cyclidenes, and sepulchrates) wherein all six binding sites are composed of selenium and are contained in component 6-membered heterocyclic rings (Se—Se Tridentates or Se—Se Hexadentates) that meet the requirements for use as "narrow band" valence stabilizers for $Co^{+3}$ include, but are not limited to: hexaselenopyrans; hexaselenaphosphorins; hexaselenadiphosphorins; hexaoxaselenins; and hexadiselenins.

Se Valence Stabilizer #15a: Examples of four-membered macrocyclics, macrobicyclics, and macropolycyclics (including catapinands, cryptands, cyclidenes, and sepulchrates) wherein all four binding sites are composed of selenium and are contained in a combination of 6-membered heterocyclic rings and selenol or selenoether groups (Se—Se Tetradentates) that meet the requirements for use as "narrow band" valence stabilizers for $Co^{+3}$ include, but are not limited to: diselenatetraselenopyrans; tetraselenatetraselenopyrans; diselenatetraselenaphosphorins; tetraselenatetraselenaphosphorins; diselenatetraoxaselenins; tetraselenatetraoxaselenins; diselenatetradiselenins; and tetraselenatetradiselenins.

Se Valence Stabilizer #15b: Examples of six-membered macrocyclics, macrobicyclics, and macropolycyclics (including catapinands, cryptands, cyclidenes, and sepulchrates) wherein all six binding sites are composed of selenium and are contained in a combination of 6-membered heterocyclic rings and selenol or selenoether groups (Se—Se Tridentates, Se—Se Tetradentates, or Se—Se Hexadentates) that meet the requirements for use as "narrow band" valence stabilizers for $Co^{+3}$ include, but are not limited to: diselenahexaselenopyrans; triselenahexaselenopyrans; diselenahexaselenaphosphorins; triselenahexaselenaphosphorins; diselenahexaoxaselenins; triselenahexaoxaselenins; diselenahexadiselenins; and triselenahexadiselenins.

Se Valence Stabilizer #16: Examples of 1,3-diselenoketones (diseleno-beta-ketonates), 1,3,5-triselenoketones, bis(1,3-diselenoketones), and poly(1,3-diselenoketones) (Se—Se Bidentates, Se—Se Tridentates, Se—Se Tetradentates) that meet the requirements for use as "narrow band" valence stabilizers for $Co^{+3}$ include, but are not limited to: hexafluoropentanediselenone; 1,3-diphenyl-1,3-propanediselenone; selenobenzoylselenopinacolone; diselenocyclohexoylmethane; diphenylpentanetriselenoate; tetramethylnonanetriselenoate; hexafluoroheptanetriselenoate; trifluoroheptanetriselenoate; 1-(2-thienyl)-1,3-butanediselenone, 1-(2-naphthyl)-1,3-butanediselenone, and trifluoroselenoacetylselenocamphor.

Se Valence Stabilizer #17: Examples of 1,1-diselenolates, bis(1,1-diselenolates), and poly(1,1-diselenolates) (Se—Se Bidentates and Se—Se Tetradentates) that meet the requirements for use as "narrow band" valence stabilizers for $Co^{+3}$ include, but are not limited to: 1,1-dicyano-2,2-ethylene diselenolate; 1,1-dicarboalkoxy-2,2-ethylene diselenolate; 1,1-di(trifluoromethyl)-2,2-ethylene diselenolate; 1,1-di(pentafluorophenyl)-2,2-ethylene diselenolate; 1-pentamethylene-2,2-ethylene diselenolate; and 1-nitroethylene diselenolate.

Se Valence Stabilizer #18: Examples of diselenocarbamates, bis(diselenocarbamates), and poly(diselenocarbamates) (including N-hydroxydiselenocarbamates and N-mercaptodiselenocarbamates) (Se—Se Bidentates, Se—Se Tridentates, and Se—Se Tetradentates) that meet the requirements for use as "narrow band" valence stabilizers for $Co^{+3}$ include, but are not limited to: dimethyldiselenocarbamate; di(trifluorodimethyl)diselenocarbamate; diethyldiselenocarbamate; dipropyldiselenocarbamate; diisopropyldiselenocarbamate; dibutyidiselenocarbamate; ditertbutyldiselenocarbamate; dicyanamidodiselenocarbamate; azidoselenoformates; diphenyldiselenocarbamate; di(pentafluorophenyl)diselenocarbamate; dibenzyldiselenocarbamate; dinaphthyldiselenocarbamate; dicyclohexyldiselenocarbamate; dinorbornyldiselenocarbamate; diadamantyldiselenocarbamate; pyrrolidinodiselenocarbamate; piperidinodiselenocarbamate; morpholinodiselenocarbamate; thiamorpholinodiselenocarbamate; 3-pyrrolinodiselenocarbamate; pyrrolodiselenocarbamate; oxazolodiselenocarbamate; isoxazolodiselenocarbamate; thiazolodiselenocarbamate; isothiazolodiselenocarbamate; indolodiselenocarbamate; carbazolodiselenocarbamate; pyrazolinodiselenocarbamate; imidazolinodiselenocarbamate; pyrazolodiselenocarbamate; imidazolodiselenocarbamate; indazolodiselenocarbamate; and triazolodiselenocarbamate.

Se Valence Stabilizer #19: Examples of triselenophosphoric acids (phosphorotriselenoic acids), bis(triselenophosphoric acids), poly(triselenophosphoric acids), and derivatives thereof (Se—Se Bidentates, Se—Se Tridentates, Se—Se Tetradentates) that meet the requirements for use as "narrow band" valence stabilizers for $Co^{+3}$ include, but are not limited to: triselenophosphoric acid, O-phenyltriselenophosphoric acid, O-benzyltriselenophosphoric acid, O-cyclohexyltriselenophosphoric acid, O-norbornyltriselenophosphoric acid, O,Se-diphenyltriselenophosphoric acid, O,Se-dibenzyltriselenophosphoric acid, O,Se-dicyclohexyltriselenophosphoric acid, and O,Se-dinorbornyltriselenophosphoric acid.

Se Valence Stabilizer #20: Examples of diselenophosphoric acids (phosphorodiselenoic acids), bis(diselenophosphoric acids), poly(diselenophosphoric acids), and derivatives thereof (Se—Se Bidentates, Se—Se Tridentates, Se—Se Tetradentates) that meet the requirements for use as "narrow band" valence stabilizers for $Co^{+3}$ include, but are not limited to: diselenophosphoric acid, O-phenyldiselenophosphoric acid, O-benzyldiselenophosphoric acid, O-cyclohexyldiselenophosphoric acid, O-norbornyldiselenophosphoric acid, O,O-diphenyldiselenophosphoricacid, O,O-dibenzyldiselenophosphoric acid, O,O-dicyclohexyldiselenophosphoricacid, and O,O-dinorbornyldiselenophosphoric acid.

Se Valence Stabilizer #21: Examples of tetraselenophosphoric acids (phosphorotetraselenoic acids), bis(tetraselenophosphoric acids), poly(tetraselenophosphoric acids), and derivatives thereof (Se—Se Bidentates, Se—Se Tridentates, Se—Se Tetradentates) that meet the requirements for use as "narrow band" valence stabilizers for $Co^{+3}$ include, but are not limited to: tetraselenophosphoric acid, Se-phenyltetraselenophosphoric acid, Se-benzyltetraselenophosphoric acid, Se-cyclohexyltetraselenophosphoric acid, Se-norbornyltetraselenophosphoric acid, Se,Se-diphenyltetraselenophosphoric acid, Se,Se-dibenzyltetraselenophosphoric acid, Se,Se-dicyclohexyltetraselenophosphoric acid, and Se,Se-dinorbornyltetraselenophosphoric acid.

Se Valence Stabilizer #22: Examples of diselenocarbonates, triselenocarbonates, bis(diselenocarbonates), and bis(triselenocarbonates), (Se—Se Bidentates and S—S Tetradentates) that meet the requirements for use as "narrow band" valence stabilizers for $Co^{+3}$ include, but are not limited to: Se,Se-diethyldiselenocarbonate; Se,Se-diisopropyldiselenocarbonate; Se,Se-diphenyldiselenocarbonate; Se,Se-dibenzyldiselenocarbonate; Se,Se-dicyclohexyldiselenocarbonate; Se,Se-dinorbornyldiselenocarbonate; diethyltriselenocarbonate; diisopropyltriselenocarbonate; diphenyltriselenocarbonate; dibenzyltriselenocarbonate; dicyclohexyltriselenocarbonate; and dinorbornyltriselenocarbonate.

Se Valence Stabilizer #23: Examples of selenocyanate ligands (Se monodentates) that meet the requirements for use as "narrow band" valence stabilizers for $Co^{+3}$ include, but are not limited to: selenocyanate (—SeCN).

Se Valence Stabilizer #24: Examples of selenolates (Se monodentates) that meet the requirements for use as "narrow band" valence stabilizers for $Co^{+3}$ include, but are not limited to: selenophenol; and naphthaleneselenol.

Miscellaneous Valence Stabilizer #1: Examples of diene, bicyclicand tricyclic hydrocarbon ligands that meet the requirements for use as "narrow band" valence stabilizers for $Co^{+3}$ include, but are not limited to: cyclopentadiene; azulene; carotene; norbornane; and adamantane.

Miscellaneous Valence Stabilizer #2: Examples of cyanide and related ligands that meet the requirements for use as "narrow band" valence stabilizers for $Co^{+3}$ include, but are not limited to: cyanide (—CN); and fulminate (—CNO).

Miscellaneous Valence Stabilizer #3: Examples of carbonyl ligands that meet the requirements for use as "narrow band" valence stabilizers for $Co^{+3}$ include, but are not limited to: carbonyl (—CO); and carbon dioxide ($CO_2$) ligands.

Miscellaneous Valence Stabilizer #4: Examples of halogens that meet the requirements for use as "narrow band" valence stabilizers for $Co^{+3}$ include, but are not limited to: fluorine; chlorine; bromine; and iodine.

Miscellaneous Valence Stabilizer #5: Examples of hydroxo and oxo functionalities that meet the requirements for use as "narrow band" valence stabilizers for $Co^{+3}$ include, but are not limited to: water ($H_2O$); dioxygen ($O_2$); oxide ($O^{2-}$); hydroxide ($OH^-$); peroxo groups ($O_2^{2-}$); and superoxo groups ($O_2^-$).

2e) Mixed Inorganic/Organic Valence Stabilizers

Mixing organic and inorganic valence stabilizers in a rinsing or sealing solution will often result in a coating with poor corrosion-inhibiting properties because of cross interference. Inorganic and organic valence stabilizers interact with the $Co^{+3}$ ion in different ways. For example, inorganic valence stabilizers will perform their function by forming a shell of octahedrally or tetrahedrally coordinated anionic species around the captured $Co^{+3}$ ion. Therefore, the net charge of these inorganic valence stabilizer/$Co^{+3}$ complexes is always negative. Organic species stabilize by the formation of a "soft bond" between the bonding atom in the stabilizer (e.g., nitrogen or sulfur) and the $Co^{+3}$ ion. The net charge of these complexes is usually positive. If these two very different types of stabilization ligands are combined, then the magnitude of the charge on the stabilized complex can be reduced significantly. The performance of organic or inorganic stabilized corrosion inhibitor complexes has been found to be directly related to the ability of the complex to form and sustain a thick electrostatic barrier layer. Additionally, a mixed stabilizer can have a poorly developed electrostatic field and a non-optimal packing around the $Co^{+3}$ ion, resulting in a complex with less resistance to aqueous attack. Mixed organic/inorganic stabilized $Co^{+3}$ inhibitor species will usually perform more poorly than inhibitors that have exclusively organic or inorganic valence stabilizers for this reason.

2f) Valence Stabilizers for Tetravalent Cobalt

The $Co^{+4}$ ion forms very few stable complexes with organic compounds, and no currently known inorganically stabilized complexes. $Co^{+4}$ may be used in broader applications in the future with compounds not currently identified. Examples of typical organic ligands for $Co+^{4}$ include dithiocarbamates, dithiolenes, dithiols, dithioketones, norbornyls, biguanides, azo oximes (including hydrazone oximes), some Schiff Bases, and some azo compounds.

3) Oxidation Source

Oxidizers serve two important functions within the coatings enhanced through the use of the described rinses and seals: 1) they act in cooperation with the stabilizer to impede the flow of ionic species through the coating, therefore minimizing charge transport, and 2) if a scratch is formed in the coating, these oxidizing species act to repair the breach by oxidizing the metal in the presence of water, and quickly reforming an oxide barrier. The effectiveness of the oxidizing species is a function of its individual oxidation-reduction potential, with more highly oxidized species exhibiting greater corrosion protection.

In order to provide adequate oxidation potential in the rinse and seal solutions, especially if divalent cobalt compounds are utilized as precursors, an oxidizing species must also be included as a starting material. Additional amounts of oxidizer may be added to help control and maintain a desired amount of $Co^{+3}$ in the rinse or seal solution by reoxidizing $Co^{+3}$ that has been reduced. Because of the high potential of the redox reaction required to oxidize divalent cobalt to trivalent (or tetravalent) cobalt, strong oxidizers must be utilized for this purpose. These oxidizers may be gaseous, liquid, or solid in form. Solid oxidizers are preferable for this application in terms of handling and reagent measurement. Other starting materials (cobalt source, stabilizer source, fluoride source) will frequently also be solids. Liquid oxidizers may also be used, but handling and accurate process metering have proven difficult. Gaseous oxidizers may be the most effective and chemically efficient on a large scale, but are also the most problematic due to handling and venting concerns.

Examples of oxidizers suitable for the purpose of producing and maintaining the cobalt ion in the trivalent charge state include, but are not restricted to: peroxides and peroxo compounds (including superoxides, persulfates, perborates, permitrates, perphosphates, percarbonates, persilicates, peraluminates, pertitanates, perzirconates, permolybdates, pertungstates, pervanadates, and organic peroxyacid derivatives), ozone, hypochlorites, chlorates, perchlorates, hypobromites, chlorites, bromates, nitrates, nitrites, vanadates, iodates, permanganates, periodates, and dissolved oxygen. Both inorganic and organic derivatives of these compounds may be used. Typical oxidizers are peroxides, persulfates, perbenzoates, periodates, bromates, hypochlorites, and gaseous dissolved oxygen (including the oxygen content of air). In general, any inorganic, organic, or combination species that has an oxidation potential of +1.5V or higher (at a pH of 1) will be capable of oxidizing divalent cobalt to the trivalent (or in some instances, tetravalent) oxidation state.

It is also possible to deposit divalent cobalt into the pore via the rinse or seal solution, and then apply a second solution containing an oxidizer to oxidize the cobalt to the trivalent oxidation state. This, however, is less preferred because the percentage of deposited cobalt that will be in the trivalent state will be less than if it were oxidized prior to or during deposition.

In the rinse and seal solutions based on hexavalent chromium, oxidation sources termed "accelerators" are often added to speed up the pore-filling process. Because the application of an acid (i.e., a rinse or seal solution) to an electronegative metal will result in the formation of hydrogen gas, cathodic areas on exposed metal will be partially blocked from further coating formation. Oxidizers ("accelerators") act to eliminate hydrogen gas formation, thereby minimizing its barrier effect, and hence accelerating the overall deposition rate. It is for this reason that it is desirable to have oxidizers in the initial rinsing or sealing solution based on cobalt.

Oxidation of the cobalt to the trivalent state may also be achieved in the rinse or seal solution or in deposited divalent cobalt complexes through electrolytic means. In many instances, however, this approach will not be economically feasible due to the large energy costs associated with electrolytic oxidation. This is especially true of rinse and seal solutions to be used for phosphate or black oxide coatings. For these types of coatings, chemical oxidation, such as that described above, currently offers the lowest-cost means to achieve oxidation of the cobalt to the trivalent state.

However, for anodic coatings and processes, this electrolytic alternative is a very viable option due to the electrolytic application of the first (oxide barrier layer) coating. In fact, electrolytic processes are often used for the coloring of anodic coatings. However, formation of trivalent (or tetravalent) cobalt complexes in the pores of the anodic coating will differ significantly from the current "state-of-the-art" anodic coloring processes. In the current "state-of-the-art" anodic coloring processes achieved by electrolytic means, the bare uncoated work piece to be anodized is first connected to an electrolytic cell as the anode. Once a potential is applied, the metal associated with the work piece is oxidized on the surface, thereby forming an oxide/hydroxide barrier layer. In the second step (electrolytic coloring) of the "state-of-the-art", the work piece is positioned so that it is the cathode of the electrolytic cell, resulting in reduction on the surface of the work piece. (Transfer of the work piece to a cathode is usually achieved by reversing the electric biases of the cell, although manual repositioning is also a possibility.) In this way, the metals associated with the second solution are reduced either to the elemental state or to sulfides within the pores of the anodic coating, resulting in coloring.

In order to oxidize divalent cobalt to the trivalent or tetravalent state in the solution or the coating, a similar procedure as the "state-of-the-art" is followed, except that in the application of the second solution, the work piece should remain as the anode. Therefore, following formation of the oxide barrier film in the anodization process, it is not necessary to reverse the bias or manually transfer the work piece so that it is the cathode in the electrolytic cell. Formation of trivalent or tetravalent cobalt can be achieved with the work piece still connected as the anode. In this way, it is necessary only to change the solution from one used for anodization (e.g., sulfuric acid anodization) to a composition such as that described in this invention to achieve superior corrosion protection. Coloring of the anodic coating will also be achieved using this approach, because of the wide range of colors achievable with trivalent cobalt/valence stabilizer complexes.

4) Preparative Agent Source

The deposition of trivalent cobalt/valence stabilizer complexes within the pores of anodic, phosphate, or "black oxide" coatings is enhanced if some of the existing barrier layer, particularly in the vicinity of the pores, is dissolved. Therefore, a means to remove the existing barrier layer is optionally desirable to achieve high-quality coatings resulting from rinsing and sealing. A preparative agent is any material that removes (dissolves and breaks up) preexisting coating materials. The hexavalent chromium formulations term these materials "activators" or "surface etchants." Because the existing barrier layer material at the margins of the pores will be slightly more disordered than in the bulk of the existing film, the preparative agent will preferentially attack the pore wall material. This in turn locally raises the pH in the vicinity of the pore; thereby further facilitating precipitation of trivalent cobalt/valence stabilizer inhibitor complexes.

Fluoride acids and salts work especially well as preparative agents in rinse and seal compositions. The complex fluoride anions hexafluorozirconate ($ZrF_6^{-2}$) and hexafluorotitanate ($TiF_6^{-2}$) are superior fluoride sources for this application. Hexafluorosilicates ($SiF_6^{-2}$) can be used, but they result in a reduced level of subsequent corrosion protection. The potassium, lithium, sodium, or ammonium salts of these anions work especially well for this application, with potassium performing the best.

Other complex fluorides, including, but not restricted to, fluoroaluminates (e.g., $AlF_6^{-3}$ or $AlF_4^{-1}$), fluoroborates (e.g., $BF_4^{-1}$), fluorogallates (e.g., $GaF_4^{-1}$), fluoroindates (e.g., $InF_4^{-1}$), fluorogermanates (e.g., $GeF_6^{-2}$), fluorostannates (e.g., $SnF_6^{-2}$), fluorophosphates (e.g., $PF_6^{-1}$), fluoroarsenates (e.g., $AsF_6^{-1}$), fluoroantimonates (e.g., $SbF_6^{-1}$), fluorobismuthates (e.g., $BiF_6^{-1}$), fluorosulfates (e.g., $SF_6^{-2}$), fluoroselenates (e.g., $SeF_6^{-2}$), fluorotellurates (e.g., $TeF_6^{-2}$ or $TeOF_5^{-1}$), fluorocuprates (e.g., $CuF_3^{-1}$ or $CuF_4^{-2}$), fluoroargentates (e.g., $AgF_3^{-1}$ or $AgF_4^{-2}$), fluorozincates (e.g., $ZnF_4^{-2}$), fluorohafnates (e.g., $HfF_6^{-2}$), fluorovanadates (e.g., $VF_7^{-2}$), fluoroniobates (e.g., $NbF_7^{-2}$), fluorotantalates (e.g., $TaF_7^{-2}$), fluoromolybdates (e.g., $MoF_6^{-3}$), fluorotungstates (e.g., $WF_6^{-1}$), fluoroyttrates (e.g., $YF_6^{-3}$), fluorolanthanates (e.g., $LaF_6^{-3}$), fluorocerates (e.g., $CeF_6^{-3}$ or $CeF_6^{-2}$), fluoromanganates (e.g., $MnF_6^{-2}$), fluoroferrates (e.g., $FeF_6^{-3}$), fluoronickelates (e.g., $NiF_6^{-2}$), and fluorocobaltates (e.g., $CoF_6^{2}$) are also suitable fluoride sources, but these offer even less corrosion protection than hexafluorosilicates. Water-soluble potassium, sodium, lithium, or ammonium salts of these anions are typical.

Simple inorganic fluorides such as potassium fluoride (KF), potassium hydrogen fluoride ($KHF_2$), sodium fluoride (NaF), sodium hydrogen fluoride ($NaHF_2$), lithium fluoride (LiF), lithium hydrogen fluoride ($LiHF_2$), ammonium fluoride ($NH_4F$), ammonium hydrogen fluoride ($NH_4HF_2$), and hydrofluoric acid solutions (HF) can also be used as a fluoride source. By analogy, organic compounds that readily release fluoride ions will also serve as adequate fluoride sources.

Other halide species, such as chlorides ($Cl^-$), bromides ($Br^-$), and iodides ($I^-$) can also function as preparative agents, although their efficiency in dissolving the existing barrier film will not be as great as the fluorides. Inorganic or organic compounds that release chloride, bromide, or iodide anions can function as preparative agents, as can a number of complex chlorides and bromides that are similar to those described above for the fluorides. By analogy, complex hexachlorozirconates ($ZrC16^{-2}$), hexachlorotitanates ($TiCl_6^{-2}$), and hexachlorosilicates ($SiCl_6^{-2}$) should function better than other chloride sources, and analogous complex bromide and iodide sources will function better than other bromides and iodides.

Acidic species, such as nitric acid, sulfuric acid, phosphoric acid, pyrophosphoric acid, hydrochloric acid, perchloric acid, hydrobromic acid, hydriodic acid, iodic acid, periodic acid, disulfuric acid, selenic acid, telluric acid, polyphosphoric acid, cyclophosphoric acid, boric acid, vanadic acid, molybdic acid, tungstic acid, carboxylic acids, phosphonic acids, and sulfonic acids can also function as preparative agents. Of these, nitric acid is the most useful as a preparative agent.

Although it is less desirable, hydroxides can also function as preparative agents. For example, under high pH conditions zinc and aluminum are known to dissolve in water, through the formation of zincate or aluminate anions. The use of hydroxides such as sodium, potassium, lithium, or ammonium derivatives will result in this pH rise.

If used, the concentration of fluoride preparative agent should not exceed a value wherein the majority of the existing barrier layer should begin to be dissolved in the rinse or seal composition. This will result in reduced corrosion protection of the barrier film-trivalent cobalt/valence stabilizer system. A maximum recommended concentration of fluoride for these rinses and seals is typically 0.5 M $F^-$. For some specialized applications, such as rinsing or sealing refractory metals such as titanium, zirconium, niobium, and tantalum, or for treating tenacious or thick oxides of magnesium or aluminum, fluoride concentrations as high as 5.0 M $F^-$ may be allowable.

5) Additional Solubility Control Agents

One of the roles of the valence stabilizer is to allow for the formation of a trivalent cobalt complex that has a specific solubility range. The anions or cations present in the rinse or sealing solution may be sufficient to form a $Co^{+3}$-containing compound within the rinsed or sealed coating that exhibits the desired solubility characteristics. However, additional solubility control may be desirable to optimize the performance of the trivalent cobalt-valence stabilizer complex. The use of an additional solubility control agent is optional, not required.

Both the organic and inorganic valence stabilizers described above may need some kind of additional solubility control that can be in the form of either inorganic or organic compounds. The key to selecting solubility control agents is to match the cationic or anionic modifiers with individual $Co^{+3}$-valence stabilizer combinations. Some cations or anions may work to optimize one $Co^{+3}$-valence stabilizer complex, but this does not necessarily mean they will optimize the solubility of a different complex.

The initial rinsing or sealing of a barrier film may produce $Co^{+3}$ compounds with solubilities greater than optimal. A post-deposition treatment can be applied to the coating as a remedial treatment or as a desired process step. Additional solubility control agents applied to a work piece can enhance the $Co^{+3}$ content of the coating by forming more insoluble compounds in place. Application of a second solution after the initial rinse or seal process has been found to result in enhanced solubility control of $Co^{+3}$ in many formulations.

Additional solubility control agents are typically applied as a second solution. Otherwise, these cations or anions would begin to precipitate cobalt-containing compounds in the rinse or seal solution, depleting it of cobalt prior to treating the work piece. In general, fine-tuning of solubility by cationic species is typical for $Co^{+3}$-stabilizer combinations when an inorganic valence stabilizer is used, and by anionic species when an organic valence stabilizer is used.

The need for an additional solubility control agent may be illustrated for the situation where molybdate is used as a valence stabilizer for a $Co^{+3}$ seal solution. Cationic species are necessary to deposit a $Co^{+3}$/molybdate compound within the coating (the net charge on a $Co^{+3}$/heteropolymolybdate anion may either be −3 or −6). The cationic species needed to balance the charge and form a compound is usually supplied from cations already present in the rinse solution and/or by cations being pulled into the solution from the work piece. However, if the $Co^{+3}$/molybdate complex composed of the available cations has a much greater solubility than desired, then additional solubility control agents will be required. The differences in effectiveness of a specific rinse or seal formulation upon different substrate materials (e.g., zinc, iron, magnesium) is likely a reflection of the influence that the composition of the alloy itself has upon the solubility of the deposited inhibitor species. Similarly, anions present in a rinse or seal solution or source material will be incorporated in a $Co^{+3}$ compound that requires a negative charge balance. This is frequently observed with $Co^{+3}$/organic valence stabilizer combinations.

The use of solubility control agents to enhance corrosion protection has also been demonstrated in the "state-of-the-art" hexavalent chromium solutions. For example, the sealing of anodic coatings with hexavalent chromium (resulting in the formation of somewhat soluble hydrated aluminum chromate) followed by rinsing with a zinc solution (resulting in the deposition of less-soluble zinc chromate in the pores) has been shown to increase the corrosion resistance for this system. However, hexavalent chromium rinsing of phosphate coatings over electrogalvanized steel does not require additional solubility control because of the initial formation of zinc chromate in the pores.

Additional solubility control can be achieved through the use of nontoxic inorganic cations which include, but are not limited to: $H^+$, $Li^+$, $Na^+$, $K^+$, $Rb^+$, $Cs^+$, $NH_4^+$, $Mg^{+2}$, $Ca^{+2}$, $Sr^{+2}$, $Y^{+3}$, $La^{+3}$, $Ce^{+4}$, $Ce^{+4}$, $Nd^{+3}$, $Pr^{+3}$, $Sc^{+3}$, $Sm^{+3}$, $Eu^{+3}$, $Eu^{+2}$, $Gd^{+3}$, $Tb^{+3}$, $Dy^{+3}$, $Ho^{+3}$, $Er^{+3}$, $Tm^{+3}$, $Yb^{+3}$, $Lu^{+3}$, $Ti^{+4}$, $Zr^{+4}$, $Ti^{+3}$, $Hf^{+4}$, $Nb^{+5}$, $Ta^{+5}$, $Nb^{+4}$, $Ta^{+4}$, $Mo^{+6}$, $W^{+6}$, $Mo^{+5}$, $W^{+5}$, $M^{+4}$, $W^{+4}$, $Mn^{+}2$, $Mn^{+3}$, $Mn^{+4}$, $Fe^{+2}$, $Fe^{+3}$, $Co^{+2}$, $Co^{+3}$, $Ru^{+2}$, $Ru^{+3}$, $Ru^{+4}$, $Rh^{+3}$, $Ir^{+3}$, $Rh^{+2}$, $Ir^{+2}$, $Pd^{+4}$, $Pt^{+4}$, $Pd^{+2}$, $Pt^{+2}$, $Cu^{+}$, $Cu^{+2}$, $Cu^{+3}$, $Ag^{+}$, $Ag^{+2}$, $Ag^{+3}$, $Au^{+}$, $Au^{+2}$, $Au^{+3}$, $Zn^{+2}$, $Al^{+3}$, $Ga^{+3}$, $Ga^{+}$, $In^{+3}$, $In^{+}$, $Ge^{+4}$, $Ge^{+2}$, $Sn^{+2}$, $Sn^{+4}$, $Sb^{+3}$, $Sb^{+5}$, $Bi^{+3}$, and $Bi^{+5}$. Any water-soluble compound that contains these cations can be used for this purpose. Nitrates, chlorides, bromides, and perchlorates of these cations offer inexpensive water-soluble precursors, although many other water-soluble precursors exist.

Cationic solubility control may also be achieved through the use of non-toxic organic cations that include, but are not limited to: quaternary ammonium compounds ($NR_4^+$, where R can be any combination of alkyl, aromatic, or acyclic organic substituents, such as the methyltriethylammonium ion); organics that contain at least one $N^+$ site (such as pyridinium or thiazolium cations); organics that contain at least one phosphonium site ($P^+$, such as the benzyltriphenylphosphonium ion); organics that contain at least one stibonium site ($Sb^+$, such as the tetraphenylstibonium ion); organics that contain at least one oxonium site ($O^+$, such as pyrylium cations); organics that contain at least one sulfonium site ($S^+$, such as the triphenylsulfonium ion); and organics that contain at least one iodonium site ($I^+$, such as the diphenyliodonium ion).

The quaternary ammonium compounds, organics containing at least one $N^+$ site, and organics containing at least one oxonium site are the most important of these classifications because of the very large number of stable cations that are available. Water-soluble precursors for these organic cations are desirable in order to maximize the amount of material available in the appropriate rinse or seal solution. Fluorides, chlorides, and bromides offer the most water-soluble precursors for these organic cations, although lower molecular weight nitrates and perchlorates of these cations (e.g., tetramethylammonium) are also acceptable water-soluble precursors. Nitrates and perchlorates of larger (higher molecular weight) organic cations are not acceptable as precursors because of their low water solubility.

Although it is less desirable, toxic inorganic or organic cations can be used as additional solubility control agents. Examples of toxic inorganic cations that can be used include, but are not limited to: $Be^{+2}$, $Ba^{+2}$, $V^{+5}$, $V^{+4}$, $V^{+3}$, $Cr^{+3}$, $Ni^{+2}$, $Ni^{+4}$, $Os^{+4}$, $Cd^{+2}$, $Hg^{+1}$, $Hg^{+1}$, $Tl^{+}$, $Tl^{+3}$, $As^{+3}$, $As^{+5}$, $Pb^{+2}$, and $Pb^{+4}$. Examples of toxic organic cations include, but are not limited to: organic compounds that contain at least one arsonium site ($As^+$, an example being the tetraphenylarsonium ion) and organic compounds that contain at least one selenonium site ($Se^+$, an example being the triphenylselenonium ion). Use of these materials for additional solubility control may be appropriate in some specific instances where the toxicity of the coating baths is of limited importance to the operator. Water-soluble precursors for these toxic cations are typically used in order to maximize the amount of available cation for solubility control. In general, the nitrates, fluorides, chlorides, bromides, and perchlorates of these cations offer the highest water solubility.

Additional solubility control can also be achieved through the use of nontoxic inorganic anions, especially for $Co^{+3}$/organic valence stabilizer combinations. Water-soluble precursors for these inorganic anions are desirable in order to maximize the amount of material available in the appropriate rinse or seal solution. These include, but are not limited to: fluorotitanates, chlorotitanates, fluorozirconates, chlorozirconates, fluoroniobates, chloroniobates, fluorotantalates, chlorotantalates, molybdates, tungstates, permanganates, fluoromanganates, chloromanganates, fluoroferrates, chloroferrates, fluorocobaltates, chlorocobaltates, fluorozincates, chlorozincates, borates, fluoroborates, fluoroaluminates, chloroaluminates, carbonates, silicates, fluorosilicates, fluorostannates, nitrates, nitrites, azides, phosphates, phosphites, phosphonates, phosphinites, thiophosphates, thiophosphites, thiophosphonates, thiophosphinites, fluorophosphates, fluoroantimonates, chloroantimonates, sulfates, sulfites, sulfonates, thiosulfates, dithionites, dithionates, fluorosulfates, tellurates, fluorides, chlorides, chlorates, perchlorates, bromides, bromates, iodides, iodates, periodates, and heteropolyanions (e.g., heteropolymolybdates, silicomolybdates, etc.).

Additional solubility control can also be achieved through the use of an almost unlimited number of non-toxic organic anions (e.g., organics with different carboxylates or acid groups). Examples include, but are not limited to: ferricyanides; ferrocyanides; cyanocobaltates; cyanocuprates; cyanomanganates; cyanates; cyanatoferrates; cyanatocobaltates; cyanatocuprates; cyanatomanganates; thiocyanates; thiocyanatoferrates; thiocyanatocobaltates; thiocyanatocuprates; thiocyanatomanganates; cyanamides; cyanamidoferrates; cyanamidocobaltates; cyanamidocuprates; cyanamidomanganates; nitritoferrates; nitritocobaltates; azides; (thio)carboxylates, di(thio)carboxylates, tri(thio)carboxylates, or tetra(thio)carboxylates [useful representatives including, but not limited to, acetic acid, benzoic acid, succinic acid, fumaric acid, salicylic acid, lactic acid, tartaric acid, antimonyl tartrates, cinnamic acid, adipic acid, phthalic acid, terephthalic acid, citric acid, ascorbic acid, malic acid, malonic acid, oxalic acid, stearic acid, gallic acid, naphthenic acid, camphoric acid, nitrosalicylic acid, aminosalicylic acid, acetylsalicylic acid, sulfosalicylic acid, nitrobenzoic acid, perfluoro$C_{2-6}$carboxylic acids, trinitrobenzoic acid, chlorobenzoic acid, anisic acid, iodobenzoic acid, anthranilic acid, mandelic acid, toluic acid, nicotinic acid, isonicotinic acid, pyrazolecarboxylic acid, picrolonic acid, quinaldic acid, diphenic acid, benzoquinaldic acid, quinolinecarboxylic acid, isoquinolinecarboxylic acid, triazinecarboxylic acid, (thio)carbonic acids, (thio)carbamic acids, trimethylhexylic acid, tetrafluorophthalic acid, ethylenediaminetetraacetic acid, toluoylpropionic acid, lactobionic acid, octylthiopropionate, lipoic acid, methylbenzoylpropionic acid, anthracenesuccinic acid, benzothiazolecarboxylic acid, phenylacetic acid, glycolic acid, thioglycolic acid, benzothiazolylthiosuccinic acid, benzothiazolylthiopropionic acid, phenylanthranilic acid, furancarboxylic acid, nitrofuroic acid, phosphonobutanetricarboxylic acid, benzothiazolylthiosuccinic acid, N-phosphonomethylglycine, cresoxyacetic acid, aminobutyric acid, alanine, asparagine, cysteine, glutamine, glycine, leucine, methionine, phenylalanine, proline, serine, threonine, tryptophan, tyrosine, valine, glutamic acid, aspartic acid, arginine, histidine, lysine, trihydroxyglutaric acid, phenoxyacetic acid, hydroxynaphthoic acid, phenylbutyric acid, hydroxyphosphonoacetic acid, tropic acid, aminophenylpropionic acid, dihydrocinnamic acid, hydroxycinnamic acid, cinchomeronic acid, aurintricarboxylic acid, benzotriazolecarboxylic acid, hydroxyphosphonoacetic acid, cyanuric acid, barbituric acid, violuric acid, diphenylvioluric acid, dilituric acid, thiobarbituric acid, cresotic acid, trimethylhexylic acid, nitrilotriacetic acid, N,N'-terephthaloylbis(aminocaproic acid), ethyleneglycolbis(aminoethylether)tetraacetic acid, diethylenetriaminepentaacetic acid, 2-phosphonobutanetricarboxylic acid, N,N'-bis(2-hydroxysuccinyl)ethylenediamine, nicotinic acid, naptalam, nitrobenzoic acid, nonylphenoxyacetic acid, and olsalazine]; (thio)phenolates, di(thio)phenolates, tri(thio)phenolates, or tetra(thio)phenolates [useful representatives including, but not limited to, pyrocatechol, resorcinol, picric acid, styphnic acid, pyrogallol, purpurin, purpurogallin, benzopurpurin, gallein, thiophenol, rhodizonic acid, kojic acid, chromotropic acid, carminic acid, fluorescein, tannic acid, and humic acid]; (thio)phosphonates, di(thio)phosphonates, or tri(thio)phosphonates [useful representatives including, but not limited to, diethylphosphonic acid, diphenylphosphonic acid, nitrophenylphosphonic acid, perfluoro$C_{2-16}$phosphonic acids, benzenephosphonic acid, phytic acid, hydroxyethylidenebisphosphonic acid, nitrilotrimethylenephosphonic acid, aminomethylenephosphonic acid, etidronic acid, ethylphosphonic acid, chloroethylphosphonic acid, ethylenediaminotetramethylenephosphonic acid, laurylhydroxydiphosphonic acid, methylaminodimethylenephosphonic acid, alkyl(aryl)diphosphonic acids, N-cetylaminoethanediphosphonic acid, carboxyhydroxymethylphosphonic acid (hpa), oxyethylidenediphosphonic acid, polycaproamidophosphonates, phenylethanetriphosphonic acid, oxidronic acid, and pamidronic acid]; (thio)phosphonamides, di(thio)phosphonamides, or tri(thio)phosphonamides [useful representatives including, but not limited to, phosphorarnidic acid, phosphordiamidic acid (diamidophosphonic acid), and phosphoramidothioic acid]; amino(thio)phosphonates, diamino(thio)phosphonates, or triamino(thio)phosphonates; imino(thio)phosphonates or diimino(thio)phosphonates; (thio)sulfonates, di(thio)sulfonates, or tri(thio)sulfonates [useful representatives including, but not limited to, methanesulfonic acid, benzenesulfonic acid, aminobenzenesulfonic acid (sulfanilic acid), nitrobenzenesulfonic acid, phenylsulfonic acid, naphthalenesulfonic acid, nitronaphthalenesulfonic acid, oxinesulfonic acid, alizarinsulfonic acid, benzidinesulfonic acid, flavianic acid, camphorsulfonic acid, diiodophenolsulfonic acid (sozoiodol), 8-hydroxyquinoline-5-sulfonic acid, 7-nitro-8-hydroxyquinoline-5-sulfonic acid, benzotriazolesulfonic acid, bis(trifluoromethyl)benzenesulfonic acid, diiododihydroxybenzophenonesulfonic acid, p-amino-p'-ethoxydiphenylamine-o-sulfonic acid, 1-amino-2-naphthol-4-sulfonic acid, 1,2-diaminoanthraquinone-3-sulfonic acid, 1,5-dinitro-2-naphthol-7-sulfonic acid, perfluoro$C_{2-16}$sulfonic acids, benzenedisulfonic acid, phenyldisulfonic acid, naphthalenedisulfonic acid, 3,6-naphtholdisulfonic acid, indigodisulfonic acid, benzidinedisulfonic acid, carboxyiodobenzenesulfonic acids, N-benzeneaminomethanesulfonic acid (ams), amido-G-acid, amido-R-acid, naphthalene(di)sulfonic acid (Armstrong's acid), amsonic acid, Badische acid, camphorsulfonic acid, chrysophenine, Cassella's acid, chromotropic acid, Cleve's acid, croceic acid, anthracenesulfonic acid, hydroxyquinolinesulfonic acid, hydrazinobenzenesulfonic acid, indigo carmine, indoxyl, isatinsulfonic acid, indican, lignosulfonic acid, metanil yellow, metanilic acid, naphthoquinonesulfonic acid, Nuclear Fast Red, naphthol(di)sulfonic acid, naphthylamine(di)sulfonic acid, Orange I, orthanilic acid, phenol(di)sulfonic acid, methylenedinaphthalenesulfonic acid, methyl orange, and piperazinediethanesulfonic acid (pipes)]; (thio)sulfonamides, di(thio)sulfonamides, or tri(thio)sulfonamides; amino(thio)sulfonates, diamino(thio)sulfonates, or triamino(thio)sulfonates; imino(thio)sulfonates (including sulfamates) or diimino(thio)sulfonates (including disulfamates) [useful representatives including, but not limited to, methylsulfamic acid and phenylsulfamic acid]; (thio)borates, di(thio)borates, or (thio)boronates [useful representatives including, but not limited to, phenylboric acid and borotartaric acid]; organic silicates; and stibonates [useful representatives including, but not limited to, antimonyl tartrate and benzenestibonic acid]. Water-soluble precursors for these organic anions are desirable to maximize the amount available in the appropriate rinse or seal solution.

Finally, toxic inorganic or organic anions can be used as additional solubility control agents, although this is less desirable. Examples of toxic inorganic anions include, but are not limited to: arsenates, arsenites, fluoroarsenates, chloroarsenates, selenates, selenites, fluorothallates, chlorothallates, iodomercury anions (e.g., Nessler's reagent), thiocyanatomercury anions (Behren's reagent), chloromercurates, bromomercurates, osmates, fluoronickelates, chromates, Reinecke's salt, and vanadates. Examples of toxic organic anions include cyanides; cyanochromates; cyanonickelates; cyanatochromates; cyanatonickelates; thiocyanatochromates; thiocyanatonickelates; cyanamidochromates; cyanamidonickelates; nitritonickelates; arsonates, diarsonates, or triarsonates [useful representatives including, but not limited to, propylarsonic acid, phenylarsonic acid, hydroxyphenylarsonic acid, benzenearsonic acid, methylbenzenearsonic acid, hydroxybenzenearsonic acid, and nitrobenzenearsonic acid]; and selenates, diselenates, or triselenates. These materials may be used in some specific instances for additional solubility control where coating bath toxicity is of limited importance. Water-soluble precursors for these anions are helpful in maximizing the amount of available anion for solubility control. The alkali or ammonium species of these anions typically offer the greatest water solubility.

6) Agents to Increase Lubricious Character of Coating

Iron and manganese phosphate coatings, as well as black oxide coatings, are used predominantly to provide a solid lubricant between two (or more) wear surfaces. A chrome rinse of these coatings can affect the tribological (lubricious) characteristics of the coating. Specifically, materials that exhibit low coefficients of friction, or that result in the formation of materials with low coefficients of friction, can be added to the rinse solution to increase the lubriciousness of the rinsed coating. Examples of these include fine particulate or dissolved molybdenum disulfide, graphite, fluorinated hydrocarbons, polymers, or soft metals such as tin, indium, or silver.

7) Agents to Increase Color-Fastness of Coating

Rinsed or sealed coatings that are to be used for architectural or adornment applications will frequently be colored to improve the aesthetic nature of the work piece. Long-term exposure to high energy wavelengths (i.e., the ultraviolet wavelengths of sunlight) may fade or dim the color of the coated work piece. The rinse or seal solution may include agents that improve the color-fastness of the coating. Typically, these are termed "UV blockers" in the paint and coatings literature. Active UV blockers are typically dark in color and function by absorbing nearly all of the light energy. Passive UV blockers are light in color and function by reflecting back nearly all of the light energy. Examples of active UV blockers include, but are not limited to, carbon black, graphite, or phthalocyanines. Examples of passive UV blockers include, but are not limited to, titanium oxide, tin oxide, lead oxide, silicon oxide, silicates, or aluminosilicates, or combinations thereof.

The degree of color-fastness desired is strongly dependant upon the end use of the treated work piece. For example, metal pieces that have been phosphated or treated to obtain a black oxide coating often have lower ornamental requirements and, therefore, the requirements of the rinsing or sealing solutions are lower. Many anodized coatings, however, must meet very high ornamental requirements (especially for anodized aluminum), and the sealing solution must therefore meet these requirements. Even with anodized aluminum, the end use will dictate the degree of care required of the sealing solution. Thus, for parts that will only be exposed to interior light, a much wider selection of cobalt/valence stabilizer combinations will meet the ornamental requirements. For parts that will be exposed intermittently to UV light, as in automotive trim components, the choice of cobalt/valence stabilizer combinations is narrowed. Finally, work pieces that will be exposed to UV light on a continuous basis, such as architectural components, can only be treated with a limited number of cobalt/valence stabilizer combinations while still meeting the ornamental requirements.

The rinse or seal solution may also include wetting agents, such as nonionic surfactants at a concentration of 5 g/L, as well as agents that prevent smudging to improve the color-fastness of the coating. These agents are particularly useful on powdery coatings and can include, but are not limited to, phosphoric acid, metaphosphates, orthophosphates, pyrophosphates, or polyphosphates, or combinations thereof.

The color fastness of the treated coating will also be dependent upon the valence stabilizer. For example, the solubility of the valence stabilizer or cobalt/valence stabilizer complex to UV light; the concentration of the valence stabilizer in the sealing bath; and the degree of penetration into the coating.

B) Solution Composition and Preparation

Additional important process considerations include chemical concentrations, pH of the rinse or seal solution, redox potential of the rinse or seal solution, application temperature, and contact time.

1) Solvents

Water is a typical solvent for these rinse or seal solutions due to its availability and low cost. Other solvents or combinations of water with other solvents (such as alcohols, ketones, etc.) may also be used if desired. However, these processes will be more costly than those using water exclusively. For sealing anodized aluminum, very high purity water will probably be required, and the concentrations of chloride, fluoride, sulfate, phosphate, and silicate should be minimized.

2) Cobalt Concentrations

The maximum concentration of the cobalt source depends upon the solubility of the specific cobalt source used. Any concentration exceeding this precursor solubility will result in undissolved solid material that will not be incorporated into the rinse or seal solution. Therefore, the solubility of the cobalt sources in water at or near ambient temperature (25° C.) can be used as representative maximum concentrations of the cobalt source that is added. Since the solubility of virtually all materials in water increases with temperature, more cobalt can be added to the rinse or seal solution if the temperature of the bath is increased from ambient. However, cooling of these rinse or seal solutions with higher cobalt precursor concentrations will result in the precipitation of solid cobalt compounds, with no guarantee that they could be resolubilized if the water is again heated (due to evaporation).

Acidic pHs will typically increase the solubility of many inorganic materials, thereby increasing the concentration of cobalt available in solution. A general estimate of the maximum concentration of cobalt in the rinse or seal solution at ambient temperature can be determined from the solubilities of some of the more desirable cobalt sources as listed in Table 4.

TABLE 4

Solubilities of Some Cobalt Sources under Ambient Conditions
[Maximum Concentration of Cobalt in Solution]
(at or near 25° C. and at or near pH 7)

| Cobalt Source | Solubility in Water (mole/L) |
|---|---|
| Cobalt (II) nitrate | $5.1 \times 10^{0}$ |
| Cobalt (II) sulfate | $2.3 \times 10^{0}$ |
| Cobalt (II) perchlorate | $7.08 \times 10^{0}$ |
| Cobalt (II) chloride | $3.46 \times 10^{0}$ |
| Cobalt (II) fluoride | $1.55 \times 10^{-1}$ |
| Cobalt (II) bromide | $3.05 \times 10^{0}$ |
| Cobalt (II) iodide | $1.08 \times 10^{1}$ |
| Cobalt (II) bromate | $1.08 \times 10^{0}$ |
| Cobalt (II) chlorate | $1.67 \times 10^{1}$ |

TABLE 4-continued

Solubilities of Some Cobalt Sources under Ambient Conditions
[Maximum Concentration of Cobalt in Solution]
(at or near 25° C. and at or near pH 7)

| Cobalt Source | Solubility in Water (mole/L) |
|---|---|
| Cobalt (II) hexafluorosilicate | $3.8 \times 10^{0}$ |
| Cobalt (II) tetrafluoroborate | $1 \times 10^{0}$ |
| Cobalt (II) formate | $2.7 \times 10^{-1}$ |
| Cobalt (II) acetate | $1 \times 10^{0}$ |
| Cobalt (II) propionate | $1.3 \times 10^{0}$ |
| Cobalt (II) butyrate | $1 \times 10^{0}$ |
| Cobalt (II) benzoate | $1 \times 10^{0}$ |
| Cobalt (II) glycolate | $1 \times 10^{0}$ |
| Cobalt (II) lactate | $1 \times 10^{0}$ |
| Cobalt (II) citrate | $1.4 \times 10^{-1}$ |
| Ammonium cobalt (II) sulfate | $5.2 \times 10^{-1}$ |
| Hexaammine cobalt (III) chloride | $2.2 \times 10^{-1}$ |
| Hexaammine cobalt (III) nitrate | $4.9 \times 10^{-2}$ |
| Pentaammine cobalt (III) chloride | $9.3 \times 10^{-1}$ |

The depletion of cobalt from the coating solution below an acceptable level is a function of the amount of metal surface area being coated prior to regeneration of the bath. A coating applied to a very large surface area may deplete the solution to the point that subsequent solution applications no longer form effective coatings. Less cobalt will be removed from the rinse or seal solution when treating a smaller surface area of metal, so more work pieces can be treated from the same solution.

The corrosion-inhibiting cobalt compounds formed on the surface of the metal exhibit solubilities ranging from approximately $5\times10^{-2}$ to $5\times10^{-4}$ moles/liter of cobalt in water. Coating solutions with cobalt concentrations much less than these concentrations may: 1) withdraw cobalt from the formed coating in order to attempt to reach an equilibrium, or 2) may produce an incomplete, poorly formed oxide film. Intentionally exhausted (depleted) rinse or seal solutions have been observed to degrade a coated surface and return cobalt to the rinse or seal solution. The lowest concentration of cobalt in the precursor rinse or seal baths from which some resultant corrosion inhibition will be exhibited is probably in the range of $1\times10^{-3}$ to $1\times10^{-5}$ moles/liter of cobalt. We used cobalt concentrations of approximately $1\times10^{-1}$ mole/liter of cobalt with excellent results.

3) Valence Stabilizer Concentrations

The concentration of the valence stabilizer can be any concentration up to the maximum solubility of the specific valence stabilizer source used. Any concentration exceeding this solubility will result in undissolved solid material that will not be available for stabilizing the desired trivalent cobalt ions. If the valence stabilizer is also used to color the coating (i.e., an anodized aluminum), high concentrations will result in darker shades. The concentration of valence stabilizer source should be restricted to its maximum solubility in water at or near ambient temperature (25° C.). Higher temperatures may allow more valence stabilizer to be added to the rinse or seal solutions, but this would result in precipitation if the solutions were allowed to cool. Table 5 shows the aqueous solubility of some of the more desirable sources for wide band inorganic valence stabilizers, and Table 6 shows the aqueous solubility of some sources of narrow band inorganic valence stabilizers.

TABLE 5

Solubilities of Wide Band Inorganic Valence Stabilizer Precursors Under Ambient Conditions
[Maximum Allowable Concentrations in Solution]
(At or near 25° C. and at or near pH 7)

| Wide Band Inorganic Valence Stabilizer | Example Precursors | Solubility in Water (mole/L) |
|---|---|---|
| Molybdates | Molybdenum trioxide | $7.4 \times 10^{-3}$ |
| | Molybdic acid | $7.4 \times 10^{-3}$ |
| | Ammonium molybdate | $\sim5 \times 10^{0}$ |
| | Lithium molybdate | $\sim1 \times 10^{1}$ |
| | Sodium molybdate | $2.15 \times 10^{2}$ |
| | Potassium molybdate | $7.75 \times 10^{2}$ |
| | Rubidium molybdate | $6.4 \times 10^{0}$ |
| | Cesium molybdate | $4.8 \times 10^{0}$ |
| | Magnesium molybdate | $7.4 \times 10^{-1}$ |
| Tungstates | Tungstic acid | $8.0 \times 10^{-1}$ |
| | Ammonium tungstate | $\sim1 \times 10^{2}$ |
| | Lithium tungstate | $5.8 \times 10^{1}$ |
| | Sodium tungstate | $2.49 \times 10^{2}$ |
| | Potassium tungstate | $1.42 \times 10^{2}$ |
| | Rubidium tungstate | $\sim5 \times 10^{1}$ |
| | Cesium tungstate | $\sim5 \times 10^{0}$ |
| | Magnesium tungstate hydrate | $7.2 \times 10^{-1}$ |
| Vanadates | Vanadium pentoxide | $4.4 \times 10^{-2}$ |
| | Ammonium vanadate | $4.4 \times 10^{-2}$ |
| | Lithium vanadate | $\sim1 \times 10^{0}$ |
| | Sodium vanadate | $1.7 \times 10^{0}$ |
| | Potassium vanadate | $\sim1 \times 10^{0}$ |
| | Rubidium vanadate | $\sim5 \times 10^{-1}$ |
| | Cesium vanadate | $\sim5 \times 10^{-1}$ |
| | Magnesium vanadate | $\sim1 \times 10^{0}$ |
| | Calcium vanadate | $\sim5 \times 10^{-1}$ |
| Niobates | Ammonium niobate | $\sim1 \times 10^{-1}$ |
| | Lithium niobate | $\sim1 \times 10^{-1}$ |
| | Sodium niobate | $5.9 \times 10^{-2}$ |
| | Potassium niobate | $\sim5 \times 10^{-2}$ |
| | Magnesium hexaniobate | $8.8 \times 10^{-2}$ |
| | Calcium hexaniobate | $4.7 \times 10^{-2}$ |
| Tantalates | Ammonium tantalate | $\sim1 \times 10^{-2}$ |
| | Lithium tantalate | $\sim1 \times 10^{-2}$ |
| | Sodium tantalate | $5.5 \times 10^{-3}$ |
| | Potassium tantalate | $\sim5 \times 10^{-3}$ |
| Tellurates | Telluric acid | $\sim5 \times 10^{-1}$ |
| | Ammonium tellurate | $\sim5 \times 10^{-1}$ |
| | Lithium tellurate | $\sim1 \times 10^{0}$ |
| | Sodium tellurate | $2.8 \times 10^{-2}$ |
| | Potassium tellurate | $\sim1 \times 10^{-2}$ |
| | Rubidium tellurate | $\sim1 \times 10^{-2}$ |
| | Cesium tellurate | $\sim1 \times 10^{-2}$ |
| Periodates | Periodic acid | $4.96 \times 10^{1}$ |
| | Ammonium periodate | $1.3 \times 10^{-1}$ |
| | Lithium periodate | $\sim5 \times 10^{1}$ |
| | Sodium periodate | $6.7 \times 10^{-1}$ |
| | Potassium periodate | $2.9 \times 10^{-2}$ |
| | Rubidium periodate | $2.4 \times 10^{-2}$ |
| | Cesium periodate | $6.6 \times 10^{-2}$ |
| | Magnesium periodate | $\sim5 \times 10^{0}$ |
| Antimonates | Ammonium antimonate | $\sim1 \times 10^{0}$ |
| | Lithium antimonate | $\sim1 \times 10^{0}$ |
| | Sodium antimonate | $1.2 \times 10^{-3}$ |
| | Potassium antimonate | $1.04 \times 10^{-1}$ |
| | Rubidium antimonate | $\sim1 \times 10^{-1}$ |
| | Cesium antimonate | $\sim5 \times 10^{-2}$ |
| Stannates | Ammonium stannate | $\sim5 \times 10^{0}$ |
| | Lithium stannate | $\sim5 \times 10^{0}$ |
| | Sodium stannate | $2.3 \times 10^{0}$ |
| | Potassium stannate | $3.7 \times 10^{0}$ |
| | Rubidium stannate | $\sim5 \times 10^{0}$ |
| | Cesium stannate | $\sim1 \times 10^{0}$ |
| Iodates | Iodic acid | $1.76 \times 10^{1}$ |
| | Iodine pentoxide | $5.6 \times 10^{0}$ |
| | Ammonium iodate | $1.1 \times 10^{-1}$ |
| | Lithium iodate | $4.4 \times 10^{0}$ |
| | Sodium iodate | $4.5 \times 10^{-1}$ |
| | Potassium iodate | $2.2 \times 10^{-1}$ |

TABLE 5-continued

Solubilities of Wide Band Inorganic Valence Stabilizer Precursors Under Ambient Conditions [Maximum Allowable Concentrations in Solution] (At or near 25° C. and at or near pH 7)

| Wide Band Inorganic Valence Stabilizer | Example Precursors | Solubility in Water (mole/L) |
|---|---|---|
| | Rubidium iodate | $8.1 \times 10^{-2}$ |
| | Cesium iodate | $8.4 \times 10^{-2}$ |
| | Magnesium iodate | $2.29 \times 10^{-1}$ |
| Carbonates | Ammonium carbonate | $8.8 \times 10^{0}$ |
| | Ammonium bicarbonate | $1.5 \times 10^{0}$ |
| | Lithium carbonate | $2.1 \times 10^{-1}$ |
| | Lithium bicarbonate | $8.1 \times 10^{-1}$ |
| | Sodium carbonate | $7.5 \times 10^{-1}$ |
| | Sodium bicarbonate | $8.2 \times 10^{-1}$ |
| | Potassium carbonate | $8.1 \times 10^{0}$ |
| | Potassium bicarbonate | $3.9 \times 10^{0}$ |
| | Rubidium carbonate | $1.95 \times 10^{1}$ |
| | Rubidium bicarbonate | $3.7 \times 10^{0}$ |
| | Cesium carbonate | $8.0 \times 10^{0}$ |
| | Cesium bicarbonate | $1.08 \times 10^{1}$ |

TABLE 6

Solubilities of Narrow Band Inorganic Valence Stabilizer Precursors Under Ambient Conditions [Maximum Allowable Concentrations in Solution] (At or near 25° C. and at or near pH 7)

| Narrow Band Inorganic Valence Stabilizer | Example Precursors | Solubility in Water (mole/L) |
|---|---|---|
| Germanates | Germanium dioxide hydrate | $4.3 \times 10^{-2}$ |
| | Ammonium germanate | $\sim 1 \times 10^{0}$ |
| | Lithium germanate | $6.3 \times 10^{-2}$ |
| | Sodium germanate | $1.55 \times 10^{0}$ |
| | Potassium germanate | $\sim 1 \times 10^{0}$ |
| | Rubidium germanate | $\sim 5 \times 10^{-1}$ |
| | Cesium germanate | $\sim 5 \times 10^{-1}$ |
| Titanates | Titanium hydroxide | $1.36 \times 10^{-4}$ |
| Zirconates | Zirconium hydroxide | $1.26 \times 10^{-3}$ |
| Hafnates | Hafnium hydroxide | $1.37 \times 10^{-3}$ |
| Bismuthates | Bismuth nitrate | $2.7 \times 10^{-2}$ |
| | Bismuthyl perchlorate | $\sim 1 \times 10^{-1}$ |
| Arsenates | Arsenic pentoxide | $6.5 \times 10^{0}$ |
| | Ammonium arsenate | $2.1 \times 10^{0}$ |
| | Sodium arsenate | $9.2 \times 10^{-1}$ |
| | Potassium arsenate | $7.4 \times 10^{-1}$ |
| Silicates | Sodium silicate | $\sim 1 \times 10^{0}$ |
| | Potassium silicate | $\sim 1 \times 10^{0}$ |
| Borates | Boric acid | $1.1 \times 10^{0}$ |
| | Ammonium borate | $2.8 \times 10^{-1}$ |
| | Lithium borate | $5.2 \times 10^{-1}$ |

TABLE 6-continued

Solubilities of Narrow Band Inorganic Valence Stabilizer Precursors Under Ambient Conditions [Maximum Allowable Concentrations in Solution] (At or near 25° C. and at or near pH 7)

| Narrow Band Inorganic Valence Stabilizer | Example Precursors | Solubility in Water (mole/L) |
|---|---|---|
| | Sodium borate | $3.9 \times 10^{0}$ |
| | Potassium borate | $8.7 \times 10^{0}$ |
| Aluminates | Sodium aluminate | $\sim 1 \times 10^{0}$ |
| | Potassium aluminate | $\sim 1 \times 10^{0}$ |
| Phosphates | Phosphoric acid | $5.6 \times 10^{1}$ |
| | Ammonium phosphate | $1.3 \times 10^{0}$ |
| | Lithium phosphate | $3.4 \times 10^{-3}$ |
| | Sodium phosphate | $2.6 \times 10^{-1}$ |
| | Potassium phosphate | $4.2 \times 10^{0}$ |
| | Pyrophosphoric acid | $4.0 \times 10^{1}$ |
| | Sodium pyrophosphate | $1.2 \times 10^{-1}$ |

The maximum concentration of organic valence stabilizers is also dependent upon precursor solubility. Because of the very large number of potential organic valence stabilizers, precursor solubilities are not shown.

The minimum concentration of valence stabilizer is dependent upon the specific $Co^{+3}$-valence stabilizer complex being formed within the rinsed or sealed coating. The number of complexing octahedra or tetrahedra around the central $Co^{+3}$ ion varies from species to species (e.g., molybdates vs. tungstates). Varying the concentration of the complexing agent while keeping the $Co^{+3}$ concentration constant resulted in clear differences in corrosion protection. The degree of corrosion protection was found to fall off dramatically below a valence stabilizer-to-cobalt ratio of about 0.01. Therefore, the minimum valence stabilizer-to-cobalt ratio is about 0.010, with ratios higher than 0.015 being typical.

4) Oxidizer Concentrations

The concentration of the oxidizer source can range up to the maximum solubility of the specific oxidizer source used. Any concentration exceeding this solubility will result in undissolved solid material that will not be available to raise the redox potential of the rinse or seal solution. The maximum concentration of oxidizer source should be restricted to its maximum solubility in water at or near ambient temperature (25° C.). As discussed above, more oxidizer can be added to the solutions if the temperature is increased from ambient. Higher temperatures may lead to higher allowable concentrations of oxidizer precursors, but cooling of these solutions will result in reagent precipitation. Table 7 shows the solubilities in water of some of the more desirable oxidizer sources.

TABLE 7

Solubilities of Some Oxidizer Sources under Ambient Conditions
[Maximum Concentration of Oxidizer in Solution]
(At or near 25° C. and at or near pH 7)

| Oxidizer Source | Example Precursor | Solubility in Water (mole/L) |
|---|---|---|
| Peroxides and superoxides | Hydrogen peroxide | 60 wt. % |
| | Lithium peroxide | $\sim 1 \times 10^{0}$ |
| | Sodium peroxide | $\sim 1 \times 10^{0}$ |
| | Potassium superoxide | $\sim 1 \times 10^{0}$ |
| Persulfates | Ammonium persulfate | $2.6 \times 10^{0}$ |
| | Lithium persulfate | $\sim 3 \times 10^{0}$ |
| | Sodium persulfate | $3.1 \times 10^{0}$ |
| | Potassium persulfate | $2.0 \times 10^{-1}$ |
| | Magnesium persulfate | $\sim 1 \times 10^{1}$ |
| | Calcium persulfate | $\sim 1 \times 10^{1}$ |
| | Strontium persulfate | $\sim 5 \times 10^{0}$ |
| | Barium persulfate | $1.3 \times 10^{0}$ |
| Perborates | Ammonium perborate | $1.8 \times 10^{-1}$ |
| | Lithium perborate | $\sim 1 \times 10^{-1}$ |
| | Sodium perborate | $1.7 \times 10^{-1}$ |
| | Potassium perborate | $1.1 \times 10^{-1}$ |
| Peroxybenzoates | Monoperoxyphthalic acid | $\sim 1 \times 10^{-1}$ |
| | Magnesium monoperoxyphthalate | $\sim 1 \times 10^{-1}$ |
| | Chloroperoxybenzoic acid | $\sim 1 \times 10^{-1}$ |
| Chlorites | Lithium chlorite | $\sim 5 \times 10^{0}$ |
| | Sodium chlorite | $4.3 \times 10^{0}$ |
| | Calcium chlorite | $\sim 1 \times 10^{0}$ |
| | Strontium chlorite | $\sim 5 \times 10^{-1}$ |
| | Barium chlorite | $\sim 1 \times 10^{-1}$ |
| Bromates | Ammonium bromate | $\sim 1 \times 10^{1}$ |
| | Lithium bromate | $4.85 \times 10^{0}$ |
| | Sodium bromate | $1.82 \times 10^{0}$ |
| | Potassium bromate | $8.0 \times 10^{-1}$ |
| | Rubidium bromate | $1.4 \times 10^{-1}$ |
| | Cesium bromate | $1.4 \times 10^{-1}$ |
| | Magnesium bromate | $1.1 \times 10^{0}$ |
| | Calcium bromate | $1.2 \sim 1 \times 10^{0}$ |
| | Strontium bromate | $9.1 \times 10^{-1}$ |
| | Zinc bromate | $\sim 1 \times 10^{0}$ |
| | Ferric bromate | $\sim 1 \times 10^{0}$ |
| Hypochlorites | Lithium hypochlorite | $\sim 1 \times 10^{1}$ |
| | Sodium hypochlorite | $\sim 1 \times 10^{1}$ |
| | Magnesium hypochlorite | $\sim 1 \times 10^{1}$ |
| | Calcium hypochlorite | $\sim 1 \times 10^{1}$ |
| | Strontium hypochlorite | $\sim 5 \times 10^{0}$ |
| | Barium hypochlorite | $\sim 5 \times 10^{0}$ |
| Periodates | Periodic acid | $4.96 \times 10^{1}$ |
| | Ammonium periodate | $1.3 \times 10^{-1}$ |
| | Lithium periodate | $\sim 1 \times 10^{0}$ |
| | Sodium periodate | $6.7 \times 10^{-1}$ |
| | Potassium periodate | $2.9 \times 10^{-2}$ |
| | Rubidium periodate | $2.4 \times 10^{-2}$ |
| | Cesium periodate | $6.6 \times 10^{-2}$ |
| | Magnesium periodate | $\sim 1 \times 10^{-2}$ |
| Chlorates | Lithium chlorate | $5.5 \times 10^{1}$ |
| | Sodium chlorate | $7.5 \times 10^{0}$ |
| | Potassium chlorate | $5.8 \times 10^{-1}$ |
| | Rubidium chlorate | $3.0 \times 10^{-1}$ |
| | Cesium chlorate | $2.9 \times 10^{-1}$ |
| | Magnesium chlorate | $4.3 \times 10^{0}$ |
| | Calcium chlorate | $7.4 \times 10^{0}$ |
| | Strontium chlorate | $6.9 \times 10^{0}$ |
| | Zinc chlorate | $8.6 \times 10^{0}$ |
| | Barium chlorate | $8.5 \times 10^{-1}$ |
| Perchlorates | Perchloric acid | 75 wt. % |
| | Ammonium perchlorate | $1.4 \times 10^{0}$ |
| | Lithium perchlorate | $5.6 \times 10^{0}$ |
| | Sodium perchlorate | $1.5 \times 10^{1}$ |
| | Potassium perchlorate | $3.6 \times 10^{-1}$ |
| | Rubidium perchlorate | $2.2 \times 10^{-1}$ |
| | Cesium perchlorate | $8.6 \times 10^{-2}$ |
| | Magnesium perchlorate | $4.4 \times 10^{0}$ |
| | Calcium perchlorate | $7.9 \times 10^{0}$ |
| | Strontium perchlorate | $1.1 \times 10^{1}$ |
| | Zinc perchlorate | $\sim 1 \times 10^{0}$ |
| | Barium perchlorate | $5.1 \times 10^{0}$ |
| | Aluminum perchlorate | $\sim 1 \times 10^{0}$ |

TABLE 7-continued

Solubilities of Some Oxidizer Sources under Ambient Conditions
[Maximum Concentration of Oxidizer in Solution]
(At or near 25° C. and at or near pH 7)

| Oxidizer Source | Example Precursor | Solubility in Water (mole/L) |
|---|---|---|
| | Ferric perchlorate | $\sim 1 \times 10^{0}$ |
| | $Me_4N^+$ perchlorate | $\sim 1 \times 10^{0}$ |
| | $Et_4N^+$ perchlorate | $\sim 5 \times 10^{-1}$ |
| | $Pr_4N^+$ perchlorate | $\sim 1 \times 10^{-1}$ |
| Nitrates | Nitric acid | 75 wt. % |
| | Ammonium nitrate | $2.5 \times 10^{1}$ |
| | Lithium nitrate | $1.35 \times 10^{1}$ |
| | Sodium nitrate | $1.15 \times 10^{1}$ |
| | Potassium nitrate | $7.4 \times 10^{0}$ |
| | Rubidium nitrate | $3.0 \times 10^{0}$ |
| | Cesium nitrate | $2.1 \times 10^{0}$ |
| | Magnesium nitrate | $4.9 \times 10^{0}$ |
| | Calcium nitrate | $2.15 \times 10^{1}$ |
| | Strontium nitrate | $3.4 \times 10^{0}$ |
| | Zinc nitrate | $6.2 \times 10^{0}$ |
| | Barium nitrate | $3.3 \times 10^{-1}$ |
| | Aluminum nitrate | $1.75 \times 10^{0}$ |
| | Ferric nitrate | $5.7 \times 10^{0}$ |
| | $Me_4N^+$ nitrate | $\sim 1 \times 10^{1}$ |
| | $Et_4N^+$ nitrate | $\sim 5 \times 10^{0}$ |
| | $Pr_4N^+$ nitrate | $\sim 1 \times 10^{0}$ |
| | $Bu_4N^+$ nitrate | $\sim 5 \times 10^{-1}$ |
| Nitrites | Lithium nitrite | $2.8 \times 10^{1}$ |
| | Sodium nitrite | $1.35 \times 10^{1}$ |
| | Potassium nitrite | $3.5 \times 10^{1}$ |
| | Magnesium nitrite | $\sim 1 \times 10^{0}$ |
| | Calcium nitrite | $3.9 \times 10^{0}$ |
| | Strontium nitrite | $3.8 \times 10^{0}$ |
| | Zinc nitrite | $\sim 1 \times 10^{0}$ |
| | Barium nitrite | $2.9 \times 10^{0}$ |
| Vanadates | Vanadium pentoxide | $4.4 \times 10^{-2}$ |
| | Ammonium vanadate | $4.4 \times 10^{-2}$ |
| | Lithium vanadate | $\sim 1 \times 10^{0}$ |
| | Sodium vanadate | $1.7 \times 10^{0}$ |
| | Potassium vanadate | $\sim 1 \times 10^{0}$ |
| | Rubidium vanadate | $\sim 5 \times 10^{-1}$ |
| | Cesium vanadate | $\sim 5 \times 10^{-1}$ |
| | Magnesium vanadate | $\sim 1 \times 10^{0}$ |
| | Calcium vanadate | $\sim 5 \times 10^{-1}$ |
| Iodates | Iodic acid | $1.76 \times 10^{1}$ |
| | Iodine pentoxide | $5.6 \times 10^{0}$ |
| | Ammonium iodate | $1.2 \times 10^{-1}$ |
| | Lithium iodate | $4.4 \times 10^{0}$ |
| | Sodium iodate | $4.5 \times 10^{-1}$ |
| | Potassium iodate | $2.2 \times 10^{-1}$ |
| | Rubidium iodate | $8.1 \times 10^{-2}$ |
| | Cesium iodate | $8.4 \times 10^{-2}$ |
| | Magnesium iodate | $2.29 \times 10^{-1}$ |
| Permanganates | Ammonium permanganate | $5.77 \times 10^{-1}$ |
| | Lithium permanganate | $3.97 \times 10^{0}$ |
| | Sodium permanganate | $\sim 1 \times 10^{0}$ |
| | Potassium permanganate | $4.04 \times 10^{-1}$ |
| | Magnesium permanganate | $\sim 1 \times 10^{1}$ |
| | Calcium permanganate | $9.18 \times 10^{0}$ |
| | Strontium permanganate | $7.67 \times 10^{0}$ |
| | Barium permanganate | $2.01 \times 10^{0}$ |
| | Zinc permanganate | $8.10 \times 10^{-1}$ |
| | Ferric permanganate | $\sim 1 \times 10^{0}$ |

Low oxidizer concentrations may not oxidize a sufficient quantity of cobalt from the divalent state to the trivalent state. This would result in reduced corrosion-inhibiting performance. The redox potential of the coating solutions tends to decrease slowly with time (e.g., several days), so these solutions require additions of oxidizer to maintain the redox potential. The net redox potential of the coating solution is also a function of the surface area of the metal that has been coated.

5) Preparative Agent Concentrations

The concentration of the optional preparative agent is also important for the rinse and sealing solutions. If used, the concentration of the fluoride should not exceed 0.5 M (up to 5.0 M $F^-$ can be used for some specialized applications, such as on anodized titanium or magnesium). Careful control of the available $F^-$ should be exercised so that excessive back-etching of the existing barrier layer (e.g., phosphate or hydroxide/oxide) does not occur. In some applications (i.e., anodized aluminum that is to be color dyed) it may be desirable to have no preparative agent at all. Solubility values for many fluorides (the typical preparative agent) are given in Table 8. Of course, variations in the solution temperature and pH will change the solubilities of each of these preparative agents, but the values given below can be used as general approximations.

TABLE 8

Solubilities of Fluoride Preparative Agents under Ambient Conditions [Maximum Allowable Concentrations in Solution] (At or near 25° C. and at or near pH 7)

| Fluoride Source | Example Precursor | Solubility in Water (mole/L) |
|---|---|---|
| Simple Fluorides | Hydrofluoric acid | 75 wt. % |
| | Ammonium fluoride | $2.7 \times 10^{1}$ |
| | Lithium fluoride | $1.04 \times 10^{-1}$ |
| | Sodium fluoride | $1.01 \times 10^{0}$ |
| | Potassium fluoride | $1.59 \times 10^{1}$ |
| | Potassium bifluoride | $5.25 \times 10^{0}$ |
| | Rubidium fluoride | $1.25 \times 10^{1}$ |
| | Cesium fluoride | $2.42 \times 10^{1}$ |
| | Copper (II) fluoride | $4.62 \times 10^{-1}$ |
| | Silver (I) fluoride | $1.43 \times 10^{1}$ |
| | Zinc fluoride | $1.57 \times 10^{-1}$ |
| | Aluminum fluoride | $6.6 \times 10^{-2}$ |
| | Titanium fluoride | $\sim 1 \times 10^{0}$ |
| | Zirconium fluoride | $8.3 \times 10^{-2}$ |
| | Germanium fluoride hydrate | $\sim 1 \times 10^{-1}$ |
| | Tin (II) fluoride | $\sim 1 \times 10^{-1}$ |
| | Tin (IV) fluoride | $\sim 1 \times 10^{0}$ |
| | Vanadium fluoride | $\sim 1 \times 10^{-1}$ |
| | Niobium fluoride | $\sim 1 \times 10^{0}$ |
| | Tantalum fluoride | $\sim 1 \times 10^{-1}$ |
| | Antimony (III) fluoride | $3.15 \times 10^{-1}$ |
| | Antimony (V) fluoride | $\sim 1 \times 10^{0}$ |
| | Manganese (II) fluoride | $7.1 \times 10^{-2}$ |
| | Cobalt (II) fluoride | $1.55 \times 10^{-1}$ |
| Hexafluorozirconates | Ammonium fluorozirconate | $\sim 1 \times 10^{-1}$ |
| | Lithium hexafluorozirconate | $\sim 8 \times 10^{-2}$ |
| | Sodium hexafluorozirconate | $\sim 6 \times 10^{-2}$ |
| | Potassium hexafluorozirconate | $8.12 \times 10^{-2}$ |
| | Rubidium hexafluorozirconate | $8.48 \times 10^{-2}$ |
| | Cesium hexafluorozirconate | $1.12 \times 10^{-1}$ |
| Hexafluorotitanates | Ammonium hexafluorotitanate | $\sim 1 \times 10^{-1}$ |
| | Lithium hexafluorotitanate | $\sim 5 \times 10^{-2}$ |
| | Sodium hexafluorotitanate | $\sim 1 \times 10^{-2}$ |
| | Potassium hexafluorotitanate | $6.0 \times 10^{-2}$ |
| | Rubidium hexafluorotitanate | $2.5 \times 10^{-2}$ |
| | Cesium hexafluorotitanate | $5.5 \times 10^{-2}$ |
| Hexafluorosilicates | Ammonium hexafluorosilicate | $1.04 \times 10^{0}$ |
| | Lithium hexafluorosilicate | $3.8 \times 10^{0}$ |
| | Sodium hexafluorosilicate | $3.5 \times 10^{-2}$ |
| | Potassium hexafluorosilicate | $5.5 \times 10^{-3}$ |
| | Rubidium hexafluorosilicate | $6.9 \times 10^{-3}$ |
| | Cesium hexafluorosilicate | $2.3 \times 10^{-2}$ |
| | Silver (I) hexafluorosilicate | $\sim 1 \times 10^{0}$ |
| | Magnesium hexafluorosilicate | $3.9 \times 10^{0}$ |
| | Calcium hexafluorosilicate | $\sim 5 \times 10^{-1}$ |
| | Strontium hexafluorosilicate | $1.3 \times 10^{-1}$ |
| | Zinc hexafluorosilicate | $1.11 \times 10^{0}$ |
| | Copper (II) hexafluorosilicate | $7.4 \times 10^{0}$ |
| | Cobalt (II) hexafluorosilicate | $3.82 \times 10^{0}$ |
| | Manganese (II) Fluorosilicate | $4.59 \times 10^{0}$ |
| | Iron (II) hexafluorosilicate | $4.19 \times 10^{0}$ |
| | Iron (III) hexafluorosilicate | "soluble" |
| Hexafluoroaluminates | Ammonium fluoroaluminate | $5.3 \times 10^{-2}$ |
| | Lithium hexafluoroaluminate | $6.6 \times 10^{-3}$ |
| | Sodium hexafluoroaluminate | $2.9 \times 10^{-3}$ |
| | Potassium fluoroaluminate | $6.1 \times 10^{-3}$ |
| Tetrafluoroborates | Ammonium tetrafluoroborate | $2.4 \times 10^{0}$ |
| | Lithium tetrafluoroborate | $\sim 5 \times 10^{0}$ |
| | Sodium tetrafluoroborate | $9.8 \times 10^{0}$ |
| | Potassium tetrafluoroborate | $3.5 \times 10^{-2}$ |
| | Rubidium tetrafluoroborate | $\sim 1 \times 10^{-1}$ |
| | Cesium tetrafluoroborate | $\sim 5 \times 10^{-1}$ |

TABLE 8-continued

Solubilities of Fluoride Preparative Agents under Ambient Conditions [Maximum Allowable Concentrations in Solution] (At or near 25° C. and at or near pH 7)

| Fluoride Source | Example Precursor | Solubility in Water (mole/L) |
|---|---|---|
| Hexafluorogermanates | Ammonium fluorogermanate | $\sim 1 \times 10^{0}$ |
| | Lithium hexafluorogermanate | $\sim 1 \times 10^{0}$ |
| | Sodium hexafluorogermanate | $\sim 1 \times 10^{-2}$ |
| | Potassium fluorogermanate | $2.2 \times 10^{-2}$ |
| | Rubidium fluorogermanate | $1.7 \times 10^{-2}$ |
| | Cesium hexafluorogermanate | $4.7 \times 10^{-2}$ |
| Hexafluorostannates | Ammonium fluorostannate | $\sim 1 \times 10^{-1}$ |
| | Lithium hexafluorostannate | $\sim 1 \times 10^{-2}$ |
| | Sodium hexafluorostannate | $\sim 1 \times 10^{-2}$ |
| | Potassium hexafluorostannate | $1.28 \times 10^{-1}$ |
| | Rubidium hexafluorostannate | $6.2 \times 10^{-2}$ |
| | Cesium hexafluorostannate | $7.9 \times 10^{-2}$ |
| Hexafluorohafnates | Ammonium hexafluorohafnate | $\sim 1 \times 10^{0}$ |
| | Lithium hexafluorohafnate | $\sim 1 \times 10^{-1}$ |
| | Sodium hexafluorohafnate | $\sim 7 \times 10^{-2}$ |
| | Potassium hexafluorohafnate | $1.3 \times 10^{-1}$ |
| | Rubidium hexafluorohafnate | $1.9 \times 10^{-1}$ |
| | Cesium hexafluorohafnate | $1.7 \times 10^{-1}$ |
| Fluorogallates | Ammonium fluorogallate | $\sim 1 \times 10^{-2}$ |
| | Alkali/Alkaline fluorogallates | $\sim 1 \times 10^{-2}$ |
| | Silver (I) fluorogallate | $\sim 1 \times 10^{0}$ |
| | Copper (II) fluorogallate | $\sim 1 \times 10^{-2}$ |
| | Zinc fluorogallate | $\sim 1 \times 10^{-1}$ |
| | Manganese (II), iron (II), and cobalt (II) fluorogallates | $\sim 1 \times 10^{-2}$ |
| Hexafluorophosphates | Ammonium fluorophosphate | $\sim 1 \times 10^{0}$ |
| | Lithium hexafluorophosphate | $\sim 2 \times 10^{0}$ |
| | Sodium hexafluorophosphate | $5.6 \times 10^{0}$ |
| | Potassium fluorophosphate | $5.1 \times 10^{-1}$ |
| | Rubidium fluorophosphate | $\sim 1 \times 10^{-1}$ |
| | Cesium hexafluorophosphate | $\sim 1 \times 10^{-1}$ |
| Hexafluoroantimonates | Ammonium fluoroantimonate | $4.7 \times 10^{0}$ |
| | Lithium hexafluoroantimonate | $\sim 1 \times 10^{0}$ |
| | Sodium hexafluoroantimonate | $4.97 \times 10^{0}$ |
| | Potassium fluoroantimonate | $3.7 \times 10^{0}$ |
| | Rubidium fluoroantimonate | $1.6 \times 10^{0}$ |
| | Cesium hexafluoroantimonate | $\sim 5 \times 10^{0}$ |
| Heptafluoroniobates | Lithium heptafluoroniobate | $\sim 5 \times 10^{-1}$ |
| | Sodium heptafluoroniobate | $\sim 5 \times 10^{-2}$ |
| | Potassium heptafluoroniobate | $2.6 \times 10^{-1}$ |
| | Rubidium heptafluoroniobate | $\sim 1 \times 10^{-1}$ |
| | Cesium heptafluoroniobate | $\sim 3 \times 10^{-1}$ |
| Heptafluorotantalates | Lithium heptafluorotantalate | $\sim 5 \times 10^{-1}$ |
| | Sodium heptafluorotantalate | $\sim 5 \times 10^{-2}$ |
| | Potassium heptafluorotantalate | $\sim 3 \times 10^{-1}$ |
| | Rubidium heptafluorotantalate | $\sim 1 \times 10^{-1}$ |
| | Cesium heptafluorotantalate | $\sim 3 \times 10^{-1}$ |

6) Solubility Control Agent Concentrations

The concentration of the optional solubility control agent can be any concentration up to its maximum solubility under ambient conditions. Exceeding the solubility will result in undissolved solid material that will not be available for adjusting the solubility of the cobalt-stabilizer complex. The solubilities of potential solubility control agents are not shown because of the large number of cationic or anionic species which can be used. Standard values for the solubilities of these materials in water can be used as the maximum allowable concentrations in the prepared solutions.

7) Rinse/Seal Solution pH

The rinse or seal solutions should have a slightly acidic or neutral pH so that a rise in pH caused by 1) interaction with the already-formed, hydrated barrier film (no preparative agent) or 2) barrier layer dissolution (with preparative agent) will result in a rise in local pore pH and the precipitation of the desired inhibitor species. Solution pH must not be so low that the pH rise during the rinsing or sealing process is insufficient to result in inhibitor precipitation. Very low pH values will result in excessive dissolution of the existing barrier film.

The maximum practical pH of the rinse or sealing solution is about 9, and the lowest practical pH is 0. Optimally, however, the pH of the rinse or sealing solutions should not be higher than about 8 or lower than about 1 or 2. For anodized aluminum that is to be colored, the pH range is from about 4.5 to about 6.5. The pH of the trivalent cobalt sealing or rinsing solutions should be checked periodically to confirm that it falls within operational parameters. Separate solutions that contain either valence stabilizers or optional solubility control agents generally do not require careful pH control.

8) Redox Potential of the Coating Solution

The necessary oxidation-reduction (redox) potential of the rinse or sealing solution is a function of both the solution pH and the cobalt concentration. Approximate values for the necessary redox potential of the solution can be derived from the Pourbaix diagram for cobalt and are shown in Table 9. Trivalent cobalt may be produced in solution at slightly lower redox values than those in Table 9 if the cobalt is already complexed with suitable valence stabilizers. In rare instances, some tetravalent cobalt may also be formed in the coating, provided that the redox potential is sufficiently high, and that the optimum valence stabilizer is used.

TABLE 9

Approximate Required Redox Potential as a Function of Rinse or Sealing Solution pH

| pH | Minimum Required Redox Potential (V) |
|---|---|
| 0 | 1.6 |
| 1 | 1.5 |
| 2 | 1.4 |
| 3 | 1.2 |
| 4 | 1.0 |
| 5 | 0.9 |
| 6 | 0.7 |
| 7 | 0.6 |

These redox potential can be achieved through chemical (or electrochemical) means. We have observed that the redox potential of these solutions will slowly drop over a period of several days. The redox potential of the rinse or sealing solution should be brought back up to those values shown in Table 9 if this occurs. Periodic evaluation of the redox potential of these solution can be achieved using ASTM D 1498 (Oxidation-Reduction Potential of Water) or comparable test procedures. The redox potential of any post-treatment solution that contains valence stabilizer or optional additional solubility control agent does not require control.

9) Application Temperature

The application temperature can be any temperature between the freezing and boiling points of the rinse or sealing solution, although temperatures at or near ambient (20-25° C.) are desirable in view of process economics. A typical temperature range is therefore 20 to 50° C. Application temperatures that are cooler than the typical range will result in a much slower coating deposition rate and may result in incomplete film formation. Temperatures higher than the typical range (e.g., 50 to 100° C.) can be used, especially to increase the hydration of the existing barrier layer. This will lead to a much more rapid pH rise in the pores to be treated, thereby further enhancing inhibitor formation and precipitation. If coloring is desired (i.e., on anodized aluminum), higher sealing temperatures will result in darker shades. However, the economics associated with a substantial temperature increase over ambient must be balanced against the benefits derived from this additional energy expenditure, especially if less costly methods to reach the same performance (e.g., use of a preparative agent) are available.

10) Contact Time

The contact time for the solutions should be sufficient to allow the formation of a trivalent or tetravalent cobalt inhibitor species within the pores of the treated coating. A minimum contact time of about 1 minute under ambient conditions to an average time of about 5 minutes should be appropriate. A maximum contact time of 30 minutes may be acceptable under some circumstances (i.e., for anodized aluminum). Longer immersion times will result in darker shades on colored coatings. Rinse or sealing solutions kept in contact with the work piece for longer times did not appear to produce adverse effects on the test specimens.

C) General Application Process

The general process flow diagram for the application of the optimized trivalent or tetravalent cobalt rinse or seal solutions is as follows for a typical work piece:

a) Precleaning (if required)

b) Masking (if required)

c) Alkaline cleaning/rinsing; or other cleaning process d) Deoxidizing/pickling/rinsing (if required)

e) Formation of barrier film (e.g., those listed in Table 1)

f) Rinsing (if required)

g) Application of trivalent or tetravalent cobalt rinsing or sealing solution h) Rinsing (optional)

i) Post-coating treatment (if cobalt stabilizer or cobalt not included in original solution)

j) Rinsing k) Hot water seal (optional)

l) Drying (if required)

m) Application of other coatings

Each of these processing steps are discussed briefly as follows:

a) Precleaning (If Required)

Heavy oils or greases on the part to be coated are removed using an appropriate technique, such as vapor degreasing.

b) Masking (If Required)

Any areas that are not to be coated with the barrier film are masked off using appropriate maskants. Any system component that may be adversely affected by the barrier film coating process should also be masked off.

c) Alkaline Cleaning/Rinsing

Alkaline cleaning is performed using appropriate alkaline cleaning solutions in accordance with manufacturers' specifications in order to remove small traces of oils or hydrocarbon contaminants on the metal surface. These alkaline cleaning solutions frequently require elevated temperatures for application. Following alkaline cleaning, the metal piece should be rinsed while reducing as much as possible the drag-out from the alkaline cleaning bath.

d) Deoxidizing/Pickling/Rinsing

Deoxidizing or pickling should be performed using appropriate deoxidizing solutions in accordance with performance specifications in order to remove the natural oxide film on the surface of the metal piece. Following deoxidizing or pickling, the metal piece is thoroughly rinsed while reducing as much as possible the drag-out from the deoxidizing bath.

e) Formation of Barrier Coating

The barrier coating is formed either through immersion, spray application, fogging, or manual application using methodologies that are described for each specific process. Table 1 of this invention describes some of the barrier film formation processes that can be treated using the embodiments contained herein.

f) Rinsing (If Required)

Standard rinse procedures are used. Rinsing after the formation of the barrier film is almost always necessary. For phosphate barrier films, this is especially important. This rinse helps to avoid blistering of any subsequently applied paint from residual phosphating solution, as well as to prevent contamination of the rinsing or sealing solution if the work piece is to be dipped. A thorough deionized water rinse, especially around holes or slots, or in crevices of the work piece, is frequently used. The temperature of these rinses is typically between 20 and 50° C., with exposure times of approximately 2 minutes. For some anodic coatings, agents such as bicarbonate, oxalic acid, or phthalic acid are sometimes added.

g) Application of Trivalent or Tetravalent Cobalt Rinsing or Sealing Solution

The rinsing or sealing solution is applied through immersion, spray application, fogging, or manual application using embodiments discussed herein.

h) Rinsing (Optional)

Rinsing is typical after application of the cobalt rinsing or sealing solution. In some instances (e.g., if a subsequent valence stabilizer or solubility control agent solution is to be applied), it may not be advisable to rinse.

i) Post-Coating Treatment

If the trivalent (or tetravalent) cobalt stabilizer is not included in the original rinse or sealing bath, then a second solution application (either by immersion, spray application, fogging, or manual application) is necessary. This second solution application would contain the cobalt valence stabilizer. If the valence stabilizer is contained in the first treatment (g) without cobalt, then the cobalt would be included in this treatment. Likewise, if additional solubility control is necessary, then this must be achieved through the application of a post-treatment solution.

j) Rinsing

Standard rinse procedures are used.

k) Hot Water Seal (Optional)

If further sealing of the coating (especially for anodic coatings) is desired, a hot water (>50° C.) seal using pure water can be applied. Bleaching of the coating to remove color can also be performed a this point.

l) Drying (If Required)

Standard drying method may be used.

m) Application of Other Coatings

Application of other coatings is performed at this time. For items that are to be used as wear materials (i.e., manganese or zinc phosphate or black oxide coatings from step e), this frequently involves an oil dip. For anodized coatings, a post-treatment composed of silicates, polymers, or lacquers is frequently applied.

While certain representative embodiments and details have been shown for purposes of illustrating the invention, it will be apparent to those skilled in the art that various changes in the compositions and methods disclosed herein may be made without departing from the scope of the invention, which is defined in the appended claims.

What is claimed is:

1. A solid corrosion-inhibiting seal formed on a coating selected from anodic coatings, phosphating coatings, or black oxide coatings, the solid corrosion-inhibiting seal comprising cobalt, wherein the cobalt is trivalent cobalt, tetravalent cobalt, or combinations thereof, and a valence stabilizer combined to form a cobalt/valence stabilizer complex within the solid corrosion-inhibiting seal, and wherein the cobalt/valence stabilizer complex has a solubility in water of between about $5\times10^{-1}$ and about $1\times10^{-5}$ moles per liter of cobalt at about 25° C. and about 760 Torr.

2. The corrosion-inhibiting seal of claim 1 wherein the solubility of the cobalt/valence stabilizer complex in water is between about $5\times10^{-2}$ and about $5\times10^{-5}$ moles per liter of cobalt at about 25° C. and about 760 Torr.

3. The corrosion-inhibiting seal of claim 1 wherein there is an electrostatic barrier layer around the cobalt/valence stabilizer complex in aqueous solution.

4. The corrosion-inhibiting seal of claim 1 wherein the cobalt/valence stabilizer complex acts as an ion exchange agent towards corrosive ions.

5. The corrosion-inhibiting seal of claim 1 wherein the anodic coatings, phosphating coatings, or black oxide coatings comprise a compound selected from oxides, hydroxides, phosphates, carbonates, oxalates, silicates, aluminates, borates, and polymers, and combinations thereof.

6. The corrosion-inhibiting seal of claim 1 wherein the valence stabilizer is selected from an inorganic valence stabilizer.

7. The corrosion-inhibiting seal of claim 6 wherein the valence stabilizer is the inorganic valence stabilizer selected from molybdates, tungstates, vanadates, niobates, tantalates, tellurates, periodates, iodates, carbonates, antimonates, stannates, titanates, zirconates, hafnates, bismuthates, germanates, arsenates, phosphates, borates, aluminates, and silicates, and combinations thereof.

8. The corrosion-inhibiting seal of claim 7 wherein the valence stabilizer is the inorganic valence stabilizer selected from molybdates, tungstates, vanadates, niobates, tantalates, tellurates, periodates, iodates, carbonates, antimonates, and stannates, and combinations thereof.

9. The corrosion-inhibiting seal of claim 7 wherein the cobalt/valence stabilizer complex has a central cavity containing a cobalt ion and an additional ion.

10. The corrosion-inhibiting seal of claim 9 wherein the additional ion is $B^{+3}$, $Al^{+3}$, $Si^{+4}$, $P^{+5}$, $Ti^{+4}$, $V^{+5}$, $V^{+4}$, $Cr^{+6}$, $Cr^{+3}$, $Mn^{+4}$, $Mn^{+3}$, $Mn^{+2}$, $Fe^{+3}$, $Fe^{+2}$, $Co^{+2}$, $Ni^{2}$, $Ni^{3}$, $Ni^{+4}$, $Cu^{+2}$, $Cu^{+3}$, $Zn^{+2}$, $Ga^{+3}$, $Ge^{+4}$, $As^{+5}$, $As^{+3}$, $Zr^{+4}$, or $Ce^{+4}$.

11. The corrosion-inhibiting seal of claim 1 wherein the valence stabilizer is selected from an organic valence stabilizer.

12. A corrosion-inhibiting seal formed on a coating selected from anodic coatings, phosphating coatings, or black oxide coatings, the solid corrosion-inhibiting seal comprising cobalt, wherein the cobalt is trivalent cobalt, tetravalent cobalt, or combinations thereof, and a valence stabilizer combined to form a cobalt/valence stabilizer complex, wherein the valence stabilizer is selected from molybdates, tungstates, vanadates, niobates, tantalates, tellurates, periodates, iodates, carbonates, antimonates, stannates, titanates, zirconates, hafnates, bismuthates, germanates, arsenates, phosphates, borates, aluminates, and silicates, and combinations thereof, and wherein the cobalt/valence stabilizer complex has a central cavity containing a cobalt ion and an additional ion selected from $B^{+3}$, $Al^{+3}$, $Si^{+4}$, $P^{+5}$, $Ti^{+4}$, $V^{+5}$, $V^{+4}$, $Cr^{+6}$, $Cr^{+3}$, $Mn^{+4}$, $Mn^{+3}$, $Mn^{+2}$, $Fe^{+3}$, $Fe^{+2}$, $Co^{+2}$, $Ni^{+2}$, $Ni^{+3}$, $Ni^{+4}$, $Cu^{+2}$, $Cu^{+3}$, $Zn^{+2}$, $Ga^{+3}$, $Ge^{+4}$, $As^{+5}$, $As^{+3}$, $Zr^{+4}$, or $Ce^{+4}$.

13. A corrosion-inhibiting seal formed on a coating selected from anodic coatings, phosphating coatings, or black oxide coatings, the solid corrosion-inhibiting seal comprising cobalt, wherein the cobalt is trivalent cobalt, tetravalent cobalt, or combinations thereof, and a valence stabilizer combined to form a cobalt/valence stabilizer complex, wherein the valence stabilizer is an organic valence stabilizer selected from monoamines; diamines; triamines; tetraamines; pentamines; hexamines; five- or six-membered heterocyclic rings containing one to four nitrogen atoms optionally having additional nitrogen, sulfur, or oxygen binding sites; five- or six-membered heterocyclic rings containing one or two sulfur atoms and having additional nitrogen binding sites; five- or six-membered heterocyclic rings containing one or two oxygen atoms and having additional nitrogen binding sites; (two-, three-, four-, six-, eight-, or ten-)membered nitrogen, nitrogen-sulfur, or nitrogen-oxygen macrocyclics; macrocyclic oligothioketones or dithiolenes; diazenes; thio-, amido-, or imido-derivatives of hypophosphoric, phosphoric, or diphosphoric acids and salts; azo compounds, triazenes, formazans, azines, hydrazones, or Schiff Bases containing at least two azo, imine, or azine groups; azo compounds, triazenes, formazans, azines, hydrazones, or Schiff Bases with ortho- (for aryl) or alpha- or beta- (for alkyl) substitution; oximes; amidines and imido compounds; dithio ligands; amides; amino acids; N-(thio) acyl 7-aminobenzylidenimines; (thio)hydroxamates; alpha- or ortho-aminothio(di)carboxylic acids and salts; (thio)semicarbazones; (thio)acyl hydrazones; (thio)carbazones; silylaminoalcohols; thioalkyl amines and imines; hydroxyalkyl imines; (thio)aryl amines and imines; guanylureas; guanidinoureas; 2-nitrosophenols; 2-nitrophenols; N-nitrosohydroxylamines; 1,3-monothioketones; monothiomalonamides; 2-thioacylacetamides; 2-acylthioacetamides; dithiodicarbonic diamides; trithiodicarboxylic acids and salts; monothiocarbamates; monothioethers; dithioethers; trithioethers; tetrathioethers; pentathioethers; hexathioethers; disulfides; monophosphines; diphosphines; triphosphines; tetraphosphines; pentaphosphines; hexaphosphines; five- or six-membered heterocyclic rings containing one or two sulfur atoms optionally having additional sulfur, oxygen, or phosphorus binding sites; five- or six-membered heterocyclic rings containing one to three phosphorus atoms optionally having additional phosphorus, nitrogen, oxygen, or sulfur binding sites; five- or six-membered heterocyclic rings containing one to four nitrogen atoms and having additional phosphorus binding sites; five- or six-membered heterocyclic rings containing one or two oxygen atoms and having additional sulfur or phosphorus binding sites; (five-, seven-, or nine-)membered nitrogen, nitrogen-sulfur, or nitrogen-oxygen macrocyclics; (two- to ten-)membered sulfur, sulfur-oxygen, or sulfur-phosphorus macrocyclics, not including oligothioketones or dithiolenes; (two- to ten-) membered phosphorus, nitrogen-phosphorus, or oxygen-phosphorus macrocyclics; thio-, amido-, or imido-derivatives of phosphonic and diphosphonic acids and salts containing no sulfur binding sites; amido-, or imido-derivatives of hypophosphoric, phosphoric, or diphosphoric acids and salts containing no sulfur binding sites; dithioperoxydiphosphoramides; dithioperoxydiphosphoric acids and salts; monothioperoxydiphosphoramides; monothioperoxydiphosphoric acids and salts; monothiophosphoric acids; phosphoro(dithioperoxoic) acids and salts; azo compounds, triazenes, formazans, azines, or Schiff Bases; silylamines; silazanes; guanidines and diguanidines; pyridinaldimines; hydrazones; hydramides; nitriles; thioureas and thioamides; ureas and biurets; monothio ligands; diketone ligands; dithioacyl disulfides; tetrathioperoxydicarbonic diamides; (hexa-, penta-, or tetra-)thioperoxydicarbonic acids and salts; 1,2-dithiolates; rhodanines; dithiocarbimates; (thio) xanthates; S-(alkyl- or aryl-thio)thiocarboxylic acids and salts; phosphinodithioformates; (thio)borates and (thio)boronates; (thio)arsonic acids and salts; (thio)antimonic acids and salts; phosphine and arsine sulfides or oxides; beta-hydroxyketones and -aldehydes; squaric acids and salts; carbamates and carbimates; carbazates; imidosulfurous diamides; sulfurdiimines; thiocarbonyl and mercapto oximes; 2-nitrothiophenols; 2-nitrilo(thio)phenols; acylcyanamides, imidates; 2-amidinoacetates; beta-ketoamines; 3-aminoacrylamides and 3,3-diaminoacrylamides; 3-aminoacrylic acids and salts and 3-hydroxy-3-aminoacrylic acids and salts; 2-nitroanilines; amine and diazine N-oxides; hydrazides and semicarbazides; (amino- or imino-)aryl phosphines; (thio- or hydroxy-)aryl phosphines; arsines; five- or six-membered heterocyclic rings containing one arsenic atom optionally having additional arsenic binding sites; (two- to six-)membered arsenic macrocyclics; selenoethers; five- or six-membered heterocyclic rings containing one or two selenium atoms optionally having additional selenium binding sites; (two- to six-)membered selenium macrocyclics; 1,3-diselenoketones; 1,1-diselenolates; diselenocarbamates; selenophosphoric acids and salts; selenocarbonates; cyanide, isocyanide, and cyanamide ligands; nitrosyl and nitrite ligands; azide ligands; thiolates and selenolates; (thio)cyanate ligands; diene or bicyclic or tricyclic hydrocarbon ligands; and carbonyl, halogen, or hydroxo ligands; or combinations thereof, wherein a solubility of the cobalt/valence stabilizer complex in water is decreased by an addition of a substituent group on the organic valence stabilizer, the substituent group selected from nitro groups ($—NO_2$), perfluoroalkyl groups ($—C_xF_{2x+1}$), perchloroalkyl groups ($—C_xCl_{2x+1}$), nitramine groups ($═N—NO_2$), thioketone groups ($═C═S$), sulfenyl halide groups ($—S—X$), and sulfur dihaloimide groups ($—N═SX_2$), or combinations thereof.

14. A solid corrosion-inhibiting seal formed on a coating selected from anodic coatings, phosphating coatings, or black oxide coatings, the solid corrosion-inhibiting seal comprising cobalt, wherein the cobalt is trivalent cobalt, tetravalent cobalt, or combinations thereof, and a valence stabilizer combined to form a cobalt/valence stabilizer complex within the solid corrosion-inhibiting seal, and wherein the cobalt/valence stabilizer complex is sparingly soluble in water at about 25° C. and about 760 Torr.

15. The corrosion-inhibiting seal of claim 11 wherein the valence stabilizer is the organic valence stabilizer selected from monoamines; diamines; triamines; tetraamines; pentamines; hexamines; five- or six-membered heterocyclic rings containing one to four nitrogen atoms optionally having additional nitrogen, sulfur, or oxygen binding sites; five- or six-membered heterocyclic rings containing one or two sulfur atoms and having additional nitrogen binding sites; five- or six-membered heterocyclic rings containing one or two oxygen atoms and having additional nitrogen binding sites; (two-, three-, four-, six-, eight-, or ten-) membered nitrogen, nitrogen-sulfur, or nitrogen-oxygen macrocyclics; macrocyclic oligothioketones or dithiolenes; diazenes; thio-, amido-, or imido-derivatives of hypophosphoric, phosphoric, or diphosphoric acids and salts; azo compounds, triazenes, formazans, azines, hydrazones, or Schiff Bases containing at least two azo, imine, or azine groups; azo compounds, triazenes, formazans, azines, hydrazones, or Schiff Bases with ortho-(for aryl) or alpha- or beta- (for alkyl) substitution; oximes; amidines and imido compounds; dithio ligands; amides; amino acids; N-(thio) acyl 7-aminobenzylidenimines; (thio)hydroxamates; alpha- or ortho-aminothio(di)carboxylic acids and salts; (thio)semicarbazones; (thio)acyl hydrazones; (thio)carbazones; silylaminoalcohols; thioalkyl amines and imines; hydroxyalkyl imines; (thio)aryl amines and imines; guanylureas; guanidinoureas; 2-nitrosophenols; 2-nitrophenols; N-nitrosohydroxylamines; 1,3-monothioketones; monothiomalonamides; 2-thioacylacetamides; 2-acylthioacetamides; dithiodicarbonic diamides; trithiodicarboxylic acids and salts; monothiocarbamates; monothioethers; dithioethers; trithioethers; tetrathioethers; pentathioethers; hexathioethers; disulfides; monophosphines; diphosphines; triphosphines; tetraphosphines; pentaphosphines; hexaphosphines; five- or six-membered heterocyclic rings containing one or two sulfur atoms optionally having additional sulfur, oxygen, or phosphorus binding sites; five- or six-membered heterocyclic rings containing one to three phosphorus atoms optionally having additional phosphorus, nitrogen, oxygen, or sulfur binding sites; five- or six-membered heterocyclic rings containing one to four nitrogen atoms and having additional phosphorus binding sites; five- or six-membered heterocyclic rings containing one or two oxygen atoms and having additional sulfur or phosphorus binding sites; (five-, seven-, or nine-)membered nitrogen, nitrogen-sulfur, or nitrogen-oxygen macrocyclics; (two- to ten-)membered sulfur, sulfur-oxygen, or sulfur-phosphorus macrocyclics, not including oligothioketones or dithiolenes; (two- to ten-) membered phosphorus, nitrogen-phosphorus, or oxygen-phosphorus macrocyclics; thio-, amido-, or imido-derivatives of phosphonic and diphosphonic acids and salts containing no sulfur binding sites; amido-, or imido-derivatives of hypophosphoric, phosphoric, or diphosphoric acids and salts containing no sulfur binding sites; dithioperoxydiphosphoramides; dithioperoxydiphosphoric acids and salts; monothioperoxydiphosphoramides; monothioperoxydiphosphoric acids and salts; monothiophosphoric acids; phosphoro(dithioperoxoic) acids and salts; azo compounds, triazenes, formazans, azines, or Schiff Bases; silylamines; silazanes; guanidines and diguanidines; pyridinaldimines; hydrazones; hydramides; nitriles; thioureas and thioamides; ureas and biurets; monothio ligands; diketone ligands; dithioacyl disulfides; tetrathioperoxydicarbonic diamides; (hexa-, penta-, or tetra-)thioperoxydicarbonic acids and salts; 1,2-dithiolates; rhodanines; dithiocarbimates; (thio) xanthates; S-(alkyl- or aryl-thio)thiocarboxylic acids and salts; phosphinodithioformates; (thio)borates and (thio)boronates; (thio)arsonic acids and salts; (thio)antimonic acids and salts; phosphine and arsine sulfides or oxides; beta-hydroxyketones and -aldehydes; squaric acids and salts; carbamates and carbimates; carbazates; imidosulfurous diamides; sulfurdiimines; thiocarbonyl and mercapto oximes; 2-nitrothiophenols; 2-nitrilo(thio)phenols; acylcyanamides, imidates; 2-amidinoacetates; beta-ketoamines; 3-aminoacrylamides and 3,3-diaminoacrylamides; 3-aminoacrylic acids and salts and 3-hydroxy-3-aminoacrylic acids and salts; 2-nitroanilines; amine and diazine N-oxides; hydrazides and semicarbazides; (amino- or imino-)aryl phosphines; (thio- or hydroxy-)aryl phosphines; arsines; five- or six-membered heterocyclic rings containing one arsenic atom optionally having additional arsenic binding sites; (two- to six-)membered arsenic macrocyclics; selenoethers; five- or six-membered heterocyclic rings containing one or two selenium atoms optionally having additional selenium binding sites; (two- to six-)membered selenium macrocyclics; 1,3-diselenoketones; 1,1-diselenolates; diselenocarbamates; selenophosphoric acids and salts; selenocarbonates; cyanide, isocyanide, and cyanamide ligands; nitrosyl and nitrite ligands; azide ligands; thiolates and selenolates; (thio)cyanate ligands; diene or bicyclic or tricyclic hydrocarbon ligands; and carbonyl, halogen, or hydroxo ligands; and combinations thereof.

16. The corrosion-inhibiting seal of claim 15 wherein the organic valence stabilizer is selected from monoamines; diamines; triamines; tetraamines; pentamines; hexamines; five- or six-membered heterocyclic rings containing one to four nitrogen atoms optionally having additional nitrogen, sulfur, or oxygen binding sites; five- or six-membered heterocyclic rings containing one or two sulfur atoms and having additional nitrogen binding sites; five- or six-membered heterocyclic rings containing one or two oxygen atoms and having additional nitrogen binding sites; (two-, three-, four-, six-, eight-, or ten-)membered nitrogen, nitrogen-sulfur, or nitrogen-oxygen macrocyclics; macrocyclic oligothioketones or dithiolenes; diazenes; thio-, amido-, or imido-derivatives of hypophosphoric, phosphoric, or diphosphoric acids and salts; azo compounds, triazenes, formazans, azines, hydrazones, or Schiff Bases containing at least two azo, imine, or azine groups; azo compounds, triazenes, formazans, azines, hydrazones, or Schiff Bases with ortho- (for aryl) or alpha- or beta- (for alkyl) substituted azo compounds, triazenes, formazans, axines, hydrazones, or Schiff Bases; oximes; amidines and imido compounds; dithio ligands; amides; amino acids; N-(thio)acyl 7-aminobenzylidenimines; (thio)hydroxamates; alpha- or ortho-aminothio(di)carboxylic acids and salts; (thio)semicarbazones; (thio)acyl hydrazones; (thio)carbazones; silylaminoalcohols; thioalkyl amines and imines; hydroxyalkyl imines; (thio)aryl amines and imines; guanylureas; guanidinoureas; 2-nitrosophenols; 2-nitrophenols; N-nitrosohydroxylamines; 1,3-monothioketones; monothiomalonamides; 2-thioacylacetamides; 2-acylthioacetamides; dithiodicarbonic diamides; trithiodicarboxylic acids and salts; and monothiocarbamates; and combinations thereof.

17. The corrosion-inhibiting seal of claim 15 wherein the organic valence stabilizer is the diazene selected from diazeneformimidamides; diazeneformamides; diazeneformothioamides; diazeneacetimidamides; diazeneacetothioamides; diazeneformimidic acids and salts; diazeneacetimidic acids and salts; diazenecarbothioic acids and salts; diazenecarbodithioic acids and salts; diazeneformimidothioic acids and salts; diazeneformaldehydes; diazeneformothioaldehydes; diazeneacetaldehydes; diazeneacetothioaldehydes; diazenediformamides; diazenediformothioamides; diazenediacetamides; diazenediacetothioamides; diazeneacetimidothioic acids and salts; imidoyldiazenes; diazenediformimidamides; diazenediacetimidamides; diazenediformimidic acids and salts; diazenediacetimidic acids and salts; diazenediformimidothioic acids and salts; diazenediacetimidothioic acids and salts; diazenedicarbothioic acids; diazenedicarbodithioic acids; diazeneformic acids; diazenediformic acids; diazeneacetic acids; diazenediacetic acids; diazenediformaldehydes; diazenediformothioaldehydes; diazenediacetaldehydes; diazenediacetothioaldehydes; and diimidoyldiazenes; and combinations thereof.

18. The corrosion-inhibiting seal of claim 15 wherein the organic valence stabilizer is the thio-, amido-, or imido-derivatives of hypophosphoric, phosphoric, or diphosphoric acids and salts selected from phosphoramidimidic triamides; phosphoramidimidic acids and salts; phosphorodiamidimidic acids and salts; phosphorodiamidimidothioic acids and salts; phosphoramidimidothioic acids and salts; phosphorodiamidimidodithioic acids and salts; phosphoramidimidodithioic acids and salts; (di- or mono-)thiohypophosphoric acids and salts; (di- or mono-)thiohypophosphoramides; phosphoramidic acids and salts; phosphorimidic acids and salts; (di- or mono-)thioimidodiphosphoric acids and salts; (di- or mono-)thiohydrazidodiphosphoric acids and salts; (di- or mono-)thioimidodiphosphoramides; (di- or mono-) thiohydrazidodiphosphoramides; phosphoric triamides; (di- or mono-)thiodiphosphoramides; (di- or mono-)thiodiphosphoric acids and salts; (tetra-, tri-, di-)thiophosphoric acids and salts; phosphoro(dithioperoxo)(mono-,di-, or tri-)thioic acids and salts; phosphorimido(mono-, di-, or tri-)thioic acids and salts; phosphorothioic triamides; phosphoramido (mono, di- or tri-)thioic acids and salts; and phosphorodiamido(mono, di- or tri-)thioic acids and salts; and combinations thereof.

19. The corrosion-inhibiting seal of claim 15 wherein the organic valence stabilizer is a substituent for the ortho- (for aryl) or alpha- or beta- (for alkyl) substituted azo compounds, triazenes, formazans, azines, hydrazones, or Schiff Bases selected from amino; imino; oximo; diazeno; hydrazido; thiol; mercapto; thiocarbonyl; hydroxy; carbox; and carbonyl substituents, and combinations thereof.

20. The corrosion-inhibiting seal of claim 15 wherein the organic valence stabilizer is the oxime selected from monooximes; dioximes; carbonyl oximes; imine oximes; hydroxy oximes; amino oximes; amido oximes; hydrazone oximes; and azo oximes; and combinations thereof.

21. The corrosion-inhibiting seal of claim 15 wherein the organic valence stabilizer is the amidine and imido compound selected from amidines; diamidines; biguanides; biguanidines; diamidinomethanes; imidoylguanidines; amidinoguanidines; diformamidine oxides, sulfides, and disulfides; imidodicarbonimidic acids and salts; diimidodicarbonimidic acids and salts; thioimidodicarbonimidic acids and salts; thiodiimidodicarbonimidic acids and salts; diimidoylimines; diimidoylhydrazides; imidosulfamides; diimidosulfamides; O-amidinocarbamates; O- or S-amidino (mono-, di-, or peroxy-)thiocarbamates; N-hydroxy(or N,N'-dihydroxy)amidines; and diimidosulfuric acids and salts; and combinations thereof.

22. The corrosion-inhibiting seal of claim 17 wherein the organic valence stabilizer is the dithio ligand selected from dithioimidodialdehydes; dithiohydrazidodialdehydes; dithioimidodicarbonic acids and salts; dithiohydrazidodicarbonic acids and salts; 1,3-dithioketones; 1,2-dithioketones; dithiomalonamides; 2-thioacylthioacetamides; dithioacyl sulfides; trithiodicarbonic diamides; (penta-, tetra-, tri-) thiodicarbonic acids and salts; beta-mercaptothioketones and -aldehydes; N-(aminomethylthiol)thioureas; dithiooxamides; 1,1-dithiolates; (di- or per-)thiomonocarboxylic acids and salts; (tetra- or per-)thiodicarboxylic acids and salts; (di-, tri-, or per-)thiocarbonates; dithiocarbamates (including N-hydroxydithiocarbamates and N-mercaptodithiocarbamates); and dithiocarbazates; and combinations thereof.

23. The corrosion-inhibiting seal of claim 17 wherein the organic valence stabilizer is the amide selected from monoamides; lactams; amidinoamides; guanidinoamides; imidoylamides; polyamides; and polylactams; and combinations thereof.

24. The corrosion-inhibiting seal of claim 17 wherein the organic valence stabilizer is the thio-, amido-, or imido-derivative of phosphonic and diphosphonic acids and salts selected from phosphonitrile amides; phosphonimidic diamides; phosphonamidimidic acids and salts; phosphonamidimidothioic acids and salts; dithioimidodiphosphonic acids and salts; dithiohydrazidodiphosphonic acids and salts; dithioimidodiphosphonamides; dithiohydrazidodiphosphonamides; dithiodiphosphonamides; dithiodiphosphonic acids and salts; dithioperoxydiphosphonamides; dithioperoxydiphosphonic acids and salts; (di- and tri-)thiophosphonic acids and salts; phosphono(dithioperoxo)thioic acids and salts; phosphono(dithioperoxo)dithioic acids and salts; phosphonimidothioic acids and salts; phosphonimidodithioic acids and salts; phosphonothioic acids and salts; phosphonanidothioic acids and salts; phosphonamidimidodithioic acids and salts; monothioimidodiphosphonic acids and salts; monothiohydrazidodiphosphonic acids and salts; monothioimidodiphosphonamides; monothiohydrazidodiphosphonamides; monothiodiphosphonamides; monothiodiphosphonic acids and salts; monothioperoxydiphosphonamides; monothioperoxydiphosphonic acids and salts; monothiophosphonic acids and salts; and phosphono(dithioperoxoic) acids and salts; and combinations thereof.

25. The corrosion-inhibiting seal of claim 15 wherein the organic valence stabilizer is the amido-, or imido-derivative of hypophosphoric, phosphoric, or diphosphoric acids and salts containing no sulfur binding sites selected from hypophosphoric acids and salts; hypophosphoramides; imidodiphosphoric acids and salts; hydrazidodiphosphoric acids and salts; imidodiphosphoramides; hydrazidodiphosphoramides; and diphosphoramides; and combinations thereof.

26. The corrosion-inhibiting seal of claim 15 wherein the organic valence stabilizer is the amido-, or imido-derivative of phosphonic or diphosphonic acids and salts containing no sulfur binding sites selected from imidodiphosphonic acids and salts; hydrazidodiphosphonic acids and salts; imidodiphosphonamides; hydrazidodiphosphonamides; diphosphonamides; phosphonimidic acids and salts; phosphonamidic acids and salts; and phosphonic diamides; and combinations thereof.

27. The corrosion-inhibiting seal of claim 15 wherein the organic valence stabilizer is the thiourea and thioamide selected from thioureas; thiocarboxamides; thioacylthioureas, acylthioureas, and thioacylureas; thioaroylthioureas, aroylthioureas, and thioaroylureas; thioimidates; thioguanylureas; guanidinothioureas; amidinothioamides; guanidinothioamides; imidoylthioamides; 3-aminothioacrylamides; thiohydrazides; thiosemicarbazides; (mono- and di-)thiobiurets; (mono- and di-)thioisobiurets; (mono- and di-)thiobiureas; N-(aminomethylol)thioureas; N-(aminomethylthiol) ureas; and beta-mercaptocarboxamides; and combinations thereof.

28. The corrosion-inhibiting seal of claim 15 wherein the organic valence stabilizer is the urea and biuret selected from ureas; pseudoureas; biurets, isobiurets; biureas; acylureas; aroylureas; and N-(aminomethylol)ureas; and combinations thereof.

29. The corrosion-inhibiting seal of claim 15 wherein the organic valence stabilizer is the monothio ligand selected from beta-aminothiones; 3-aminothioacrylic acids and salts; 3-mercapto-3-aminothioacrylic acids and salts; N-thioacyl benzylidenimines; thioimidodialdehydes; thiohydrazidodialdehydes; thioimidodicarbonic acids and salts; thiohydrazidodicarbonic acids and salts; 1,2-monothioketones; trithioperoxydicarbonic diamides; dithioperoxydicarbonic diamides; dithiodicarbonic acids and salts; trithioperoxydicarbonic acids and salts; beta-hydroxythioketones; beta-hydroxythioaldehydes; beta-mercaptoketones; beta-mercaptoaldehydes; monothiooxamides; beta-mercaptocarboxylic acids and salts; beta-mercaptothiocarboxylic acids and salts; beta-hydroxythiocarboxylic acids and salts; S-alkylthiocarboxylic acids and salts; S-arylthiocarboxylic acids and salts; S-alkyldisulfidocarboxylic acids and salts; S-aryldisulfidocarboxylic acids and salts; monothiomonocarboxylic acids and salts; dithiodicarboxylic acids and salts; monothiocarbonates; monothiocarbazates; monothiocarbimates; mercaptoalcohols; and silylmercaptoalcohols; and combinations thereof.

30. The corrosion-inhibiting seal of claim 15 wherein the organic valence stabilizer is the diketone ligand selected from imidodialdehydes; hydrazidodialdehydes; imidodicarbonic acids and salts; hydrazidodicarbonic acids and salts; imidodisulfamic acids and salts; imidodisulfuric acids and salts; 1,3-diketones; 1,2-diketones; malonamides; 2-acylacetamides; monothiodicarbonic diamides; monothiodicarbonic acids and salts; dithioperoxydicarbonic acids and salts; trithionic acids and salts; oxamides; and dicarboxylic acids; and combinations thereof.

31. The corrosion-inhibiting seal of claim 15 wherein the organic valence stabilizer is the S-(alkyl- or aryl-thio)thiocarboxylic acid and salt selected from S-(alkylthio)thiocarboxylic acids and salts; S-(arylthio)thiocarboxylic acids and salts; S,S-thiobisthiocarboxylic acids and salts; S-(alkyldisulfido)thiocarboxylic acids and salts; S-(aryldisulfido)thiocarboxylic acids and salts; and S,S'-disulfidobisthiocarboxylic acids and salts; and combinations thereof.

32. The corrosion-inhibiting seal of claim 15 wherein the organic valence stabilizer is the phosphine and arsine sulfide or oxide selected from phosphine P-sulfides; aminophosphine sulfides; arsine As-sulfides; aminoarsine sulfides; phosphine P-oxides; aminophosphine oxides; arsine As-oxides; and aminoarsine oxides; and combinations thereof.

33. The corrosion-inhibiting seal of claim 15 wherein a solubility of the cobalt/valence stabilizer complex in water is adjusted by an addition of a substituent group on the organic valence stabilizer.

34. The corrosion-inhibiting seal of claim 33 wherein the solubility in water of the cobalt/valence stabilizer complex in water is increased by the addition of the substituent group selected from sulfonate groups ($—SO_3^-$), carboxyl groups ($—CO_2—$), hydroxyl groups (—OH), ester groups ($—CO_3—$), carbonyl groups (═C═O), amine groups ($—NH_2$), nitrosamine groups (═N—N═O), carbonylnitrene groups (—CO—N), sulfoxide groups (═S═O), sulfone groups ($═S[═O]_2$), sulfinyl groups (—N═S═O), sulfodiimines ($═S[═NH]_2$), sulfonyl halide groups ($—S[═O]_2X$), sulfonamide groups ($—S[═O]_2NH_2$), monohalosulfonamide groups ($—S[═O]_2NHX$), dihalosulfonamide groups ($—S[═O]_2MX_2$), halosulfonate groups ($—S[═O]_2OX$), halosulfonate amide groups ($═N—S[═O]_2X$), aminosulfonate groups ($═N—S[═O]_2OH$), iminosulfonate groups ($—N[SO_3^-]_{1-2}$), phosphonate groups ($—PO_3^{-2}$), phosphonamide groups ($—PO_2NH_2^-$), phosphondiamide groups ($—PO[NH_2]_2$), aminophosphonate groups ($═N—PO_3^{-2}$), and iminophosphonate groups ($—N[PO_3^{-2}]_{1-2}$), and combinations thereof.

35. The corrosion-inhibiting seal of claim 33 wherein the solubility in water of the cobalt/valence stabilizer complex in water is decreased by the addition of the substituent group selected from nitro groups ($—NO_2$), perfluoroalkyl groups ($—C_xF_{2x+1}$), perchloroalkyl groups ($—C_xCl_{2x+1}$), nitramine groups ($═N—NO_2$), thioketone groups (═C═S), sulfenyl halide groups (—S—X), and sulfur dihaloimide groups ($—N═SX_2$), and combinations thereof.

36. The corrosion-inhibiting seal of claim 15 wherein an electrostatic barrier layer of the cobalt/valence stabilizer complex is adjusted by an addition of a substituent group on the organic valence stabilizer.

37. The corrosion-inhibiting seal of claim 36 wherein the electrostatic barrier layer is increased by the addition of the substituent group selected from ketones (═C═O), thioketones (═C═S), amides ($—C[═O]—NR_2$), thioamides ($—C[═S]—NR_2$), nitriles or cyano groups, (—CN), isocyanides (—NC), nitroso groups (—N═O), thionitroso groups (—N═S), nitro groups ($—NO_2$), azido groups ($—N_3$), cyanamide or cyanonitrene groups (═N—CN), cyanate groups (—O—CN), isocyanate groups (—N═C═O), thiocyanate groups (—S—CN), isothiocyanate groups (—N═C═S), nitrosamine groups (═N—N═O), thionitrosamine groups (═N—N═S), nitramine groups ($═N—NO_2$), thionitramine groups ($═N—NS_2$), carbonylnitrene groups (—CO—N), thiocarbonylnitrene groups (—CS—N), sulfenyl halides (—S—X), sulfoxides (═S═O), sulfones ($═S[═O]_2$), sulfinyl groups (—N═S═O), thiosulfinyl groups (—N═S═S), sulfenyl thiocyanato groups (—S—S—CN), sulfenyl cyanato groups (—S—O—CN), sulfodiimine groups ($═S[═NH]_2$), sulfur dihaloimido groups ($—N═SX_2$), sulfur oxide dihaloimido groups ($—N═S[═O]X_2$), aminosulfur oxide trihalide groups ($═N—S[═O]X_3$), sulfonyl azide groups ($—S[═O]_2N_3$), sulfonyl thiocyanate groups ($—S[═O]_2SCN$), sulfonyl cyanate groups ($—S[═O]_2OCN$), sulfonyl cyanide groups ($—S[═O]_2CN$), halosulfonate groups ($—S[═O]_2OX$), phosphonyl thiocyanate groups (—P[═O]OHSCN), phosphonyl cyanate groups (—P[═O]OHOCN), and phosphonyl cyanide groups (—P[═O]OHCN), and combinations thereof.

38. The corrosion-inhibiting seal of claim 1 further comprising a solubility control agent.

39. The corrosion-inhibiting seal of claim 38 wherein the solubility control agent is selected from a cationic solubility control agent and an anionic solubility control agent.

40. The corrosion-inhibiting seal of claim 39 wherein the solubility control agent is the cationic solubility control agent selected from $H^+$, $Li^+$, $Na^+$, $K^+$, $Rb^+$, $Cs^+$, $NH_4^+$, $Mg^{+2}$, $Ca^{+2}$, $Sr^{+2}$, $Be^{+2}$, $Ba^{+2}$, $Y^{+3}$, $La^{+3}$, $Ce^{+3}$, $Ce^{+4}$, $Nd^{+3}$, $Pr^{+3}$, $Sc^{+3}$, $Sm^{+3}$, $Eu^{+3}$, $Eu^{+2}$, $Gd^{+3}$, $Tb^{+3}$, $Dy^{+3}$, $Ho^{+3}$, $Er^{+3}$, $Tm^{+3}$, $Yb^{+3}$, $Lu^{+3}$, $Ti^{+4}$, $Zr^{+4}$, $Ti^{+3}$, $Hf^{+4}$, $Nb^{+5}$, $Ta^{+5}$, $Nb^{+4}$, $Ta^{+4}$, $V^{+5}$, $V^{+4}$, $V^{+3}$, $Mo^{+6}$, $W^{+6}$, $Mo^{+5}$, $W^{+5}$, $Mo^{+4}$, $W^{+4}$, $Cr^{+3}$, $Mn^{+2}$, $Mn^{+3}$, $Mn^{+4}$, $Fe^{+2}$, $Fe^{+3}$, $Co^{+2}$, $Co^{+3}$, $Ni^{+2}$, $Ni^{+3}$, $Ni^{+4}$, $Ru^{+2}$, $Ru^{+3}$, $Ru^{+4}$, $Rh^{+3}$, $Ir^{+3}$, $Rh^{+2}$, $Ir^{+2}$, $Pd^{+4}$, $Pt^{+4}$, $Pd^{+2}$, $Pt^{+2}$, $Os^{+4}$, $Cu^+$, $Cu^{+2}$, $Cu^{+3}$, $Ag^+$, $Ag^{+2}$, $Ag^{+3}$, $Au^+$, $Au^{+2}$, $Au^{+3}$, $Zn^{+2}$, $Cd^{+2}$, $Hg^+$, $Hg^{+2}$, $Al^{+3}$, $Ga^{+3}$, $Ga^+$, $In^{+3}$, $In^+$, $Tl^{+3}$, $Tl^+$, $Ge^{+4}$, $Ge^{+2}$, $Sn^{+4}$, $Sn^{+2}$, $Pb^{+4}$, $Pb^{+2}$, $Sb^{+3}$, $Sb^{+5}$, $As^{+3}$, $As^{+5}$, $Bi^{+3}$, $Bi^{+5}$, organic compounds containing at least one $N^+$ site, organic compounds containing at least one phosphonium site, organic compounds containing at least one arsonium site, organic compounds containing at least one stibonium site, organic compounds containing at least one oxonium site, organic compounds containing at least one sulfonium site, organic compounds containing at least one selenonium site, organic compounds containing at least one iodonium site, and quaternary ammonium compounds having a formula $NR_4^+$, where R is an alkyl, aromatic, or acyclic organic constituent, and combinations thereof.

41. The corrosion-inhibiting seal of claim 40 wherein the cationic solubility control agent is selected from $H^+$, $Li^+$, $Na^+$, $K^+$, $Rb^+$, $Cs^+$, $NH_4^+$, $Mg^{+2}$, $Ca^{+2}$, $Sr^{+2}$, $Y^{+3}$, $La^{+3}$, $Ce^{+3}$, $Ce^{+4}$, $Nd^{+3}$, $Pr^{+3}$, $Sc^{+3}$, $Sm^{+3}$, $Eu^{+3}$, $Eu^{+2}$, $Gd^{+3}$, $Tb^{+3}$, $Dy^{+3}$, $Ho^{+3}$, $Er^{+3}$, $Tm^{+3}$, $Yb^{+3}$, $Lu^{+3}$, $T^{+4}$, $Zr^{+4}$, $Ti^{+3}$, $Hf^{+4}$, $Nb^{+5}$, $Ta^{+5}$, $Nb^{+4}$, $Ta^{+4}$, $Mo^{+6}$, $W^{+6}$, $Mo^{+5}$, $W^{+5}$, $Mo^{+4}$, $W^{+4}$, $Mn^{+2}$, $Mn^{+3}$, $Mn^{+4}$, $Fe^{+2}$, $Fe^{+}$, $Co^{+2}$, $Co^{+3}$, $Ru^{+2}$, $Ru^{+3}$, $Ru^{+4}$, $Rh^{+3}$, $Ir^{+3}$, $Rh^{+2}$, $Ir^{+2}$, $Pd^{+4}$, $Pt^{+4}$, $Pd^{+2}$, $Pt^{+2}$, $Cu^{+}$, $Cu^{+2}$, $Cu^{+3}$, $Ag^{+}$, $Ag^{+2}$, $Ag^{+3}$, $Au^{+}$, $Au^{+2}$, $Au^{+3}$, $Zn^{+2}$, $Al^{+3}$, $Ga^{+3}$, $Ga^{+}$, $In^{+3}$, $In^{+}$, $Ge^{+4}$, $Ge^{+2}$, $Sn^{+4}$, $Sn^{+2}$, $Sb^{+3}$, $Sb^{+5}$, $Bi^{+3}$, $Bi^{+5}$, organic compounds containing at least one $N^+$ site, organic compounds containing at least one phosphonium site, organic compounds containing at least one stibonium site, organic compounds containing at least one oxonium site, organic compounds containing at least one sulfonium site, organic compounds containing at least one iodonium site, and quaternary ammonium compounds having a formula $NR_4^+$, where R is an alkyl, aromatic, or acyclic organic constituent, and combinations thereof.

42. The corrosion-inhibiting seal of claim 39 wherein the solubility control agent is the anionic solubility control agent selected from fluorotitanates, chlorotitanates, fluorozirconates, chlorozirconates, fluoroniobates, chloroniobates, fluorotantalates, chlorotantalates, molybdates, tungstates, permanganates, fluoromanganates, chloromanganates, fluoroferrates, chloroferrates, fluorocobaltates, chlorocobaltates, fluorozincates, chlorozincates, borates, fluoroborates, fluoroaluminates, chloroaluminates, carbonates, silicates, fluorosilicates, fluorostannates, nitrates, nitrites, azides, cyanamides, phosphates, phosphites, phosphonates, phosphinites, thiophosphates, thiophosphites, thiophosphonates, thiophosphinites, fluorophosphates, fluoroantimonates, chloroantimonates, sulfates, sulfites, sulfonates, thiosulfates, dithionites, dithionates, fluorosulfates, tellurates, fluorides, chlorides, chlorates, perchlorates, bromides, bromates, iodides, iodates, periodates, heteropolyanions, ferricyanides; ferrocyanides; cyanocobaltates; cyanocuprates; cyanomanganates; cyanates; cyanatoferrates; cyanatocobaltates; cyanatocuprates; cyanatomanganates; thiocyanates; thiocyanatoferrates; thiocyanatocobaltates; thiocyanatocuprates; thiocyanatomanganates; cyanamides; cyanamidoferrates; cyanamidocobaltates; cyanamidocuprates; cyanamidomanganates; nitritoferrates; nitritocobaltates; azides; (thio)carboxylates, di(thio)carboxylates, tri(thio)carboxylates, tetra(thio)carboxylates; (thio)phenolates, di(thio)phenolates, tri(thio)phenolates, tetra(thio)phenolates; (thio) phosphonates, di(thio)phosphonates, tri(thio)phosphonates; (thio)phosphonamides, di(thio)phosphonamides, tri(thio) phosphonamides; amino(thio)phosphonates, diamino(thio) phosphonates, triamino(thio)phosphonates; imino(thio) phosphonates, diimino(thio)phosphonates; (thio)sulfonates, di(thio)sulfonates, tri(thio)sulfonates; (thio)sulfonamides, di(thio)sulfonamides, tri(thio)sulfonamides; amino(thio)sulfonates, diamino(thio)sulfonates, triamino(thio)sulfonates; imino(thio)sulfonates, diimino(thio)sulfonates; (thio)borates, di(thio)borates, (thio)boronates; organic silicates; stibonates; cyanides; cyanochromates; cyanonickelates; cyanatochromates; cyanatonickelates; thiocyanatochromates; thiocyanatonickelates; cyanamidochromates; cyanamidonickelates; nitritonickelates; arsonates, diarsonates, triarsonates; organic selenates, diselenates, triselenates; arsenates, arsenites, fluoroarsenates, chloroarsenates, selenates, selenites, fluorothallates, chlorothallates, iodomercury anions, chloromercurates, bromomercurates, osmates, fluoronickelates, chromates, Reinecke's salt, and vanadates, and combinations thereof.

43. The corrosion-inhibiting seal of claim 42 wherein the anionic solubility control agent is selected from fluorotitanates, chlorotitanates, fluorozirconates, chlorozirconates, fluoroniobates, chloroniobates, fluorotantalates, chlorotantalates, molybdates, tungstates, permanganates, fluoromanganates, chloromanganates, fluoroferrates, chloroferrates, fluorocobaltates, chlorocobaltates, fluorozincates, chlorozincates, borates, fluoroborates, fluoroaluminates, chloroaluminates, carbonates, silicates, fluorosilicates, fluorostannates, nitrates, nitrites, azides, cyanamides, phosphates, phosphites, phosphonates, phosphinites, thiophosphates, thiophosphites, thiophosphonates, thiophosphinites, fluorophosphates, fluoroantimonates, chloroantimonates, sulfates, sulfites, sulfonates, thiosulfates, dithionites, dithionates, fluorosulfates, tellurates, fluorides, chlorides, chlorates, perchlorates, bromides, bromates, iodides, iodates, periodates, heteropolyanions, ferricyanides; ferrocyanides; cyanocobaltates; cyanocuprates; cyanomanganates; cyanates; cyanatoferrates; cyanatocobaltates; cyanatocuprates; cyanatomanganates; thiocyanates; thiocyanatoferrates; thiocyanatocobaltates; thiocyanatocuprates; thiocyanatomanganates; cyanamides; cyanamidoferrates; cyanamidocobaltates; cyanamidocuprates; cyanamidomanganates; nitritoferrates; nitritocobaltates; azides; (thio)carboxylates, di(thio)carboxylates, tri(thio)carboxylates, tetra(thio)carboxylates; (thio)phenolates, di(thio)phenolates, tri(thio)phenolates, tetra(thio)phenolates; (thio)phosphonates, di(thio) phosphonates, tri(thio)phosphonates; (thio) phosphonamides, di(thio)phosphonamides, tri(thio) phosphonamides; amino(thio)phosphonates, diamino(thio) phosphonates, triamino(thio)phosphonates; imino(thio) phosphonates, diimino(thio)phosphonates; (thio)sulfonates, di(thio)sulfonates, tri(thio)sulfonates; (thio)sulfonamides, di(thio)sulfonamides, tri(thio)sulfonamides; amino(thio)sulfonates, diamino(thio)sulfonates, triamino(thio)sulfonates; imino(thio)sulfonates, diimino(thio)sulfonates; (thio)borates, di(thio)borates, (thio)boronates; organic silicates; and stibonates; and combinations thereof.

44. The corrosion-inhibiting seal of claim 1 further comprising a lubricity agent.

45. The corrosion-inhibiting seal of claim 44 wherein the lubricity agent is selected from molybdenum disulfide, fluorinated hydrocarbons, perfluorinated hydrocarbons, graphite, soft metal, and polymers, and combinations thereof.

46. The corrosion-inhibiting seal of claim 45 wherein the lubricity agent is the soft metal selected from tin, indium, and silver.

47. The corrosion-inhibiting seal of claim 1 wherein the corrosion-inhibiting seal has a color.

48. The corrosion-inhibiting seal of claim 47 further comprising an agent which improves color-fastness of the corrosion-inhibiting seal.

49. The corrosion-inhibiting seal of claim 48 wherein the agent which improves color-fastness is selected from an active UV blocker and a passive UV blocker.

50. The corrosion-inhibiting seal of claim 49 wherein the agent which improves color-fastness is the active UV blocker selected from carbon black, graphite, and phthalocyanines.

51. The corrosion-inhibiting seal of claim 49 wherein the agent which improves color-fastness is the passive UV blocker selected from titanium oxide, tin oxide, lead oxide, silicon oxide, silicates, and aluminosilicates, and combinations thereof.

52. The corrosion-inhibiting seal of claim 48 wherein the agent which improves color-fastness is an agent which prevents smudging.

53. The corrosion-inhibiting seal of claim 52 wherein the agent which prevents smudging is selected from phosphoric acid, metaphosphates, orthophosphates, pyrophosphates, and polyphosphates, and combinations thereof.

54. The corrosion-inhibiting seal of claim 48 wherein the agent which improves color-fastness is a wetting agent.

55. The corrosion-inhibiting seal of claim 54 further comprising less than about 5 g/L of the wetting agent.

56. The corrosion-inhibiting seal of claim 54 wherein the wetting agent is a nonionic surfactant.

* * * * *